US011155594B2

(12) United States Patent
Sato

(10) Patent No.: US 11,155,594 B2
(45) Date of Patent: Oct. 26, 2021

(54) PHARMACEUTICAL COMPOSITION OR FOOD COMPOSITION, AND METHOD FOR ASSESSING EFFECT OF ACTIVE INGREDIENT IN VIVO

(71) Applicant: KARYDO THERAPEUTIX, INC., Tokyo (JP)

(72) Inventor: Narutoku Sato, Kyoto (JP)

(73) Assignee: KARYDO THERAPEUTIX, INC., Tokyo (JP)

( * ) Notice: Subject to any disclaimer, the term of this patent is extended or adjusted under 35 U.S.C. 154(b) by 0 days.

(21) Appl. No.: 16/089,648

(22) PCT Filed: Mar. 29, 2017

(86) PCT No.: PCT/JP2017/013124
§ 371 (c)(1),
(2) Date: Mar. 7, 2019

(87) PCT Pub. No.: WO2017/170803
PCT Pub. Date: Oct. 5, 2017

(65) Prior Publication Data

US 2019/0382464 A1 Dec. 19, 2019

(30) Foreign Application Priority Data

Mar. 29, 2016 (JP) ..... JP2016-066684
Jan. 31, 2017 (JP) ..... JP2017-015821

(51) Int. Cl.
*C07K 14/705* (2006.01)
*A61P 13/12* (2006.01)
*A61K 38/00* (2006.01)
*C12N 9/22* (2006.01)
*C12N 15/11* (2006.01)

(52) U.S. Cl.
CPC ..... *C07K 14/70503* (2013.01); *A61P 13/12* (2018.01); *C12N 9/22* (2013.01); *C12N 15/11* (2013.01); *A61K 38/00* (2013.01); *C07K 2319/30* (2013.01); *C12N 2310/20* (2017.05); *C12N 2800/80* (2013.01)

(58) Field of Classification Search
None
See application file for complete search history.

(56) References Cited

U.S. PATENT DOCUMENTS

| | | | |
|---|---|---|---|
| 9,970,946 | B2 | 5/2018 | Uchiyama et al. |
| 2003/0017481 | A1 | 1/2003 | Golub et al. |
| 2004/0091498 | A1 | 5/2004 | Zhang et al. |
| 2004/0185503 | A1 | 9/2004 | Yamanouchi et al. |
| 2005/0079514 | A1 | 4/2005 | Liew |
| 2005/0112701 | A1 | 5/2005 | Arndt et al. |
| 2005/0159896 | A1 | 7/2005 | Ishikawa et al. |
| 2006/0008804 | A1 | 1/2006 | Chibout et al. |
| 2006/0088876 | A1 | 4/2006 | Bauer |
| 2007/0161125 | A1 | 7/2007 | Rosenfeld et al. |
| 2009/0061454 | A1 | 3/2009 | Brody et al. |
| 2009/0291434 | A1 | 11/2009 | Cowens et al. |
| 2010/0322850 | A1 | 12/2010 | Eizirik et al. |
| 2013/0023054 | A1 | 1/2013 | Meikle et al. |
| 2013/0045494 | A1 | 2/2013 | Anderberg et al. |
| 2013/0045873 | A1 | 2/2013 | Hood et al. |
| 2013/0157883 | A1 | 6/2013 | Keller et al. |
| 2013/0259879 | A1 | 10/2013 | Baumhof et al. |
| 2014/0056918 | A1* | 2/2014 | Guo ..... C07K 16/2803 424/172.1 |
| 2014/0100125 | A1 | 4/2014 | Vanburen et al. |
| 2014/0170677 | A1 | 6/2014 | Klinguer-Hamour et al. |

(Continued)

FOREIGN PATENT DOCUMENTS

| | | |
|---|---|---|
| CN | 101611319 | 12/2009 |
| CN | 102558336 | 7/2012 |

(Continued)

OTHER PUBLICATIONS

Imel et al., J Am Soc Nephrol 16: 2565-2575, 2005.*
Extended European Search Report dated Jul. 16, 2019 in European Application No. 16814543.1.
Tothill et al., "An Expression-Based Site of Origin Diagnostic Method Designed for Clinical Application to Cancer of Unknown Origin", Cancer Res., vol. 65, No. 10, May 15, 2005, pp. 4031-4040.
Talantov et al., "A Quantitative Reverse Transcriptase-Polymerase Chain Reaction Assay to Identify Metastatic Carcinoma Tissue of Origin", Journal of Molecular Diagnostics, vol. 8, No. 3, Jul. 2006, pp. 320-329.
Greene et al., "Understanding multicellular function and disease with human tissue-specific networks", Nat Genet., vol. 47, No. 6, Jun. 2015, pp. 569-576.

(Continued)

*Primary Examiner* — Marianne P Allen
(74) *Attorney, Agent, or Firm* — Wenderoth, Lind & Ponack, L.L.P.

(57) ABSTRACT

An object of the present invention is to provide a pharmaceutical composition or food or drink composition comprising an active ingredient that suppresses functional expression of Oscar protein. Another object of the present invention is to provide a pharmaceutical composition or food composition for preventing or treating kidney disease. A further object of the present invention is to provide a pharmaceutical composition or food or drink composition that suppresses functional expression of Oscar in a living organism in order to suppress functional expression of FGF23. A still further object of the present invention is to provide a method for evaluating an effect, in the body, of an active ingredient that suppresses functional expression of Oscar protein. The above objects are achieved by at least one member selected from the group consisting of antagonists of the Oscar protein; genome editing systems that target Oscar gene; at least one RNA molecule selected from the group consisting of siRNA, shRNA, and miRNA that target Oscar mRNA, or vectors capable of expressing the RNA molecule; and antibodies that specifically bind to the Oscar protein and suppress function of the Oscar.

1 Claim, 53 Drawing Sheets

Specification includes a Sequence Listing.

(56) References Cited

U.S. PATENT DOCUMENTS

| | | | |
|---|---|---|---|
| 2014/0286953 | A1 | 9/2014 | Sasu et al. |
| 2015/0285821 | A1 | 10/2015 | Uchiyama et al. |
| 2019/0250170 | A1 | 8/2019 | Anderberg et al. |

FOREIGN PATENT DOCUMENTS

| | | |
|---|---|---|
| CN | 103717620 | 4/2014 |
| CN | 105004864 | 10/2015 |
| DE | 44 00 745 | 7/1995 |
| EP | 1 124 572 | 8/2001 |
| EP | 1 466 925 | 10/2004 |
| EP | 2 479 572 | 7/2012 |
| EP | 3 316 159 | 5/2018 |
| EP | 3 438 282 | 2/2019 |
| JP | 2001-17171 | 1/2001 |
| JP | 2001-37486 | 2/2001 |
| JP | 2002-516107 | 6/2002 |
| JP | 2004-187620 | 7/2004 |
| JP | 2005-500803 | 1/2005 |
| JP | 2005-508505 | 3/2005 |
| JP | 2005-510240 | 4/2005 |
| JP | 2005-518810 | 6/2005 |
| JP | 2005-229834 | 9/2005 |
| JP | 2005-323573 | 11/2005 |
| JP | 2007-521799 | 8/2007 |
| JP | 2008-512104 | 4/2008 |
| JP | 2008-518626 | 6/2008 |
| JP | 2011-50250 | 3/2011 |
| JP | 2012-507012 | 3/2012 |
| JP | 2013-126427 | 6/2013 |
| JP | 2013-215201 | 10/2013 |
| JP | 2013-538565 | 10/2013 |
| JP | 2013-541323 | 11/2013 |
| JP | 2014-122170 | 7/2014 |
| WO | 99/61622 | 12/1999 |
| WO | 00/23100 | 4/2000 |
| WO | 02/20718 | 3/2002 |
| WO | 03/040404 | 5/2003 |
| WO | 03/046180 | 6/2003 |
| WO | 03/057874 | 7/2003 |
| WO | 03/074731 | 9/2003 |
| WO | 03/085548 | 10/2003 |
| WO | 2004/005934 | 1/2004 |
| WO | 2005/045044 | 5/2005 |
| WO | 2005/106493 | 11/2005 |
| WO | 2005/114207 | 12/2005 |
| WO | 2006/027265 | 3/2006 |
| WO | 2007/011412 | 1/2007 |
| WO | 2008/008430 | 1/2008 |
| WO | 2010/048670 | 5/2010 |
| WO | 2010/100633 | 9/2010 |
| WO | 2012/012693 | 1/2012 |
| WO | 2012/012725 | 1/2012 |
| WO | 2013/011059 | 1/2013 |
| WO | 2013/011063 | 1/2013 |
| WO | 2014/093622 | 6/2014 |
| WO | 2015/069900 | 5/2015 |
| WO | 2015/184011 | 12/2015 |

OTHER PUBLICATIONS

Manconi et al., "The intriguing heterogeneity of human salivary proline-rich proteins; Short title: Salivary proline-rich protein species", Journal of Proteomics, 2015, vol. 134, pp. 47-56.

International Preliminary Report on Patentability dated Jun. 5, 2017 in International (PCT) Application No. PCT/JP2017/069564 With English translation.

Partial Supplementary European Search Report dated Dec. 12, 2019 in European Patent Application No. 17775147.6.

Extended European Search Report dated Jan. 7, 2020 in corresponding European Patent Application No. 17775337.3.

Han et al., "Apelin: A novel inhibitor of vascular calcification in chronic kidney disease", Atherosclerosis, 2015, vol. 244, pp. 1-8.

Sagiroglu et al., "Effects of apelin and leptin on renal functions following renal ischemia/reperfusion: An experimental study", Experimental and Therapeutic Medicine, 2012, vol. 3, No. 5, pp. 908-914.

Chen et al., "Apelin protects against acute renal injury by inhibiting TGF-β1", Biochimica et Biophysica Acta, 2015, vol. 1852, No. 7, pp. 1278-1287.

Clarkson et al., "Serum and Urinary Fibrin/Fibrinogen Degradation Products in Glomerulonephritis", British Medical Journal, 1971, vol. 3, pp. 447-451.

Crotti et al., "Osteoimmunology: Major and Costimulatory Pathway Expression Associated with Chronic Inflammatory Induced Bone Loss", Journal of Immunology Research, 2015, vol. 2015, pp. 1-13.

Goettsch et al., "The Osteoclast-Associated Receptor (OSCAR) Is a Novel Receptor Regulated by Oxidized Low-Density Lipoprotein in Human Endothelial Cells", Endocrinology, 2011, vol. 152, No. 12, pp. 4915-4926.

Ndongo-Thiam et al., "Levels of soluble osteoclast-associated receptor (sOSCAR) in rheumatoid arthritis: link to disease severity and cardiovascular risk", Annals of the Rheumatic Diseases, 2014, vol. 73, No. 6, pp. 1276-1277.

Partial Supplementary European Search Report dated Mar. 13, 2019 in European Application No. 16814543.1.

Keen et al., "The Genotype-Tissue Expression (GTEx) Project: Linking Clinical Data with Molecular Analysis to Advance Personalized Medicine", Journal of Personalized Medicine, 2015, vol. 5, No. 1, pp. 22-29.

Uhlén et al., "Tissue-based map of the human proteome", Science, Jan. 2015, vol. 347, Issue No. 6220, pp. 1260419-1 to 1260419-9.

Kim et al., "A draft map of the human proteome", vol. 509, No. 7502, Nature, May 2014, pp. 575-581.

Uhlén et al., "Transcriptomics resources of human tissues and organs", Molecular Systems Biology, 2016, vol. 12:862, No. 4, pp. 1-12.

Kozawa et al., "The Body-wide Transcriptome Landscape of Disease Models", iScience, vol. 2, 2018, pp. 238-268.

Supplementary Extended European Search Report dated Apr. 6, 2020 in European Patent Application No. 17775147.6.

Eulitz et al., "Inhibition of deoxyribonuclease I by actin is to protect cells from premature cell death", Apoptosis, 2007, vol. 12, No. 8, pp. 1511-1521.

Isern et al., "Functional analysis and androgen-regulated expression of mouse organic anion transporting polypeptide 1 (Oatp 1) in the kidney", Biochimica et Biophysica Acta, 2001, vol. 1518, No. 1-2, pp. 73-78.

Saraheimo et al., "Increased levels of α-defensin (-1, -2 and -3) in type 1 diabetic patients with nephropathy", Nephrology Dialysis Transplantation, 2008, vol. 23, No. 3, pp. 914-918.

Young et al., "Hepcidin for Clinicians", Clinical Journal of the American Society of Nephrology, 2009, vol. 4, No. 8, pp. 1384-1387.

Ruchala et al., "The pathophysiology and pharmacology of hepcidin", Trends in Pharmacological Sciences, 2014, vol. 35, No. 3, pp. 155-161.

International Search Report dated Sep. 27, 2016 in International (PCT) Application No. PCT/JP2016/069564.

Takeda, "Senescence-Accelerated Mouse (SAM): With Special Reference to Age-associated Pathologies and Their Modulation", vol. 51, Jpn. J. Hyp., 1996, pp. 569-578, with English abstract.

International Search Report dated Mar. 21, 2017 in International (PCT) Application No. PCT/JP2017/002406.

Oh et al., "Profile of Human β-Defensins 1,2 and Proinflammatory Cytokines (TNF-α, IL-6) in Patients with Chronic Kidney Disease", Kidney & Blood Pressure Research, vol. 37, 2013, pp. 602-610.

Koike et al., "Identification of α-HNP-3 defensin in diabetes mellitus patient's urine—Potential marker for early diagnosis of diabetic nephropathy-", Journal of Analytical Bio-science, vol. 30, No. 4, 2007, pp. 334-339, with English summary, cited in DC.

Orita, "Recent progress in protein restriction therapy for chronic renal insufficiency", Journal of Clinical and Experimental Medicine, vol. 171, No. 6, 1994, pp. 607-610, cited in DC.

(56) References Cited

OTHER PUBLICATIONS

Mikiko Funakoshi et al., "Proline-rich Protein (PRP) Levels in Inflammatory Diseases", The Journal Japan Atherosclerosis Society, vol. 14, No. 6, 1987, pp. 1249-1250, with English summary, cited in DC.
Lu et al., "Inductively coupled mass spectrometry analysis of biometals in conditional Hamp1 and Hamp1 and Hamp2 transgenic mouse models", Transgenic Res., vol. 24, 2015, pp. 765-773.
Lysaght, "Maintenance Dialysis Population Dynamics: Current Trends and Long-Term Implications", J Am Soc Nephrol, vol. 13, 2002, pp. S37-S40.
Sata et al., "New protein in human blood plasma, rich in proline, with lipid-binding properties", Proc. Nat. Acad. Sci. USA, vol. 73, No. 4, Apr. 1976, pp. 1063-1067.
Matsuguch et al., "Molecular Cloning of the cDNA Coding for Proline-Rich Protein (PRP): Identity of PRP as C4b-Binding Protein", Biochemical and Biophysical Research Communications, vol. 165, No. 1, Nov. 30, 1989, pp. 138-144.
International Search Report dated Jul. 4, 2017 in International (PCT) Application No. PCT/JP2017/012761.
Husain-Syed et al., "Cardio-Pulmonary-Renal Interactions", Journal of the American College of Cardiology, 2015, vol. 65, No. 22, pp. 2433-2448.
White et al., "Inflammatory Mechanisms of Organ Crosstalk during Ischemic Acute Kidney Injury", International Journal of Nephrology, 2012, Article ID 505197, pp. 1-8.
Zoccali et al., "Chronic Kidney Disease (CKD) as a Systemic Disease: Whole Body Autoregulation and Inter-Organ Cross-Talk", Kidney & Blood Pressure Research, 2014, vol. 39, pp. 134-141.
White et al., "Surgical Sepsis and Organ Crosstalk: The Role of the Kidney", Journal of Surgical Research, 2011, vol. 167, pp. 306-315.
Lysaght, "Maintenance Dialysis Population Dynamics: Current Trends and Long-Term Implications", Journal of the American Society of Nephrology, 2002, vol. 13, pp. S37-S40.
Hu et al., "Klotho Deficiency Causes Vascular Calcification in Chronic Kidney Disease", Journal of the American Society of Nephrology, 2011, vol. 22, pp. 124-136.
International Search Report dated May 9, 2017 in International (PCT) Application No. PCT/JP2017/013124.
Manconi et al., "The intriguing heterogeneity of human salivary proline-rich proteins; Short title: Salivary proline-rich protein species", Journal of Proteomics, 2015, vol. 134, p. 47-56.
Hoffmann et al., "Fibrinogen Excretion in the Urine and Immunoreactivity in the Kidney Serves as a Translational Biomarker for Acute Kidney Injury", The American Journal of Pathology, 2012, vol. 181, No. 3, pp. 818-828.
Prinsen et al., "Increased albumin and fibrinogen synthesis rate in patients with chronic renal failure", Kidney International, 2003, vol. 64, pp. 1495-1504.
Zhang et al., "Urinary biomarkers track the progression of nephropathy in hypertensive and obese rats", Biomarkers in Medicine, 2014, vol. 8, No. 1, pp. 85-94.
Craciun et al., "Pharmacological and genetic depletion of fibrinogen protects from kidney fibrosis", American Journal of Physiology, 2014, vol. 307, pp. F471-F484.
International Preliminary Report on Patentability dated Apr. 6, 2017 in International (PCT) Application No. PCT/JP2017/002406, with English translation.
International Preliminary Report on Patentability dated Jun. 5, 2017 in International (PCT) Application No. PCT/JP2016/069564 with English translation.
Qisheng et al., "Gene Editing Tools Mediated by CRISPR-Cas", Biotechnology Bulletin, 2014, Issue No. 7, pp. 37-43.
Bing et al., "Significance of change of renal tubule markers before and after treatment in chronic glomerulonephritis", Lab Med Clin, 2012, vol. 9, No. 19, pp. 2436-2439.
Notice of First Office Action dated Sep. 3, 2020 in corresponding Chinese Patent Application No. 201780032992.8, with English Translation.
Karn et al., "Shared and Unique Proteins in Human, Mouse and Rat Saliva Proteomes: Footprints of Functional Adaptation", Proteomes, 2013, vol. 1, pp. 275-289.
Abstract of Isemura et al., "Tissue distribution and nucleotide sequence of bovine mRNA for salivary proline-rich protein P—B", Archives of Oral Biology, 2004, vol. 49, No. 11, pp. 881-887.
Hao et al., "Effects of Valsartan on Ventricular Hypertrophy and Expression of Proline-rich Tyrosine Kinase 2 in Myocardium of Re-novascular Hypertensive Rats", Chin J Hypertension, 2008, vol. 16, No. 3, pp. 249-252, with Abstract.
Machine translation of reference CN 102558336 submitted with the IDS filed on Apr. 7, 2021.
Office Action dated May 25, 2021 in corresponding Chinese Patent Application No. 201680049081.1, with English Machine Translation.

* cited by examiner

[Fig. 1]
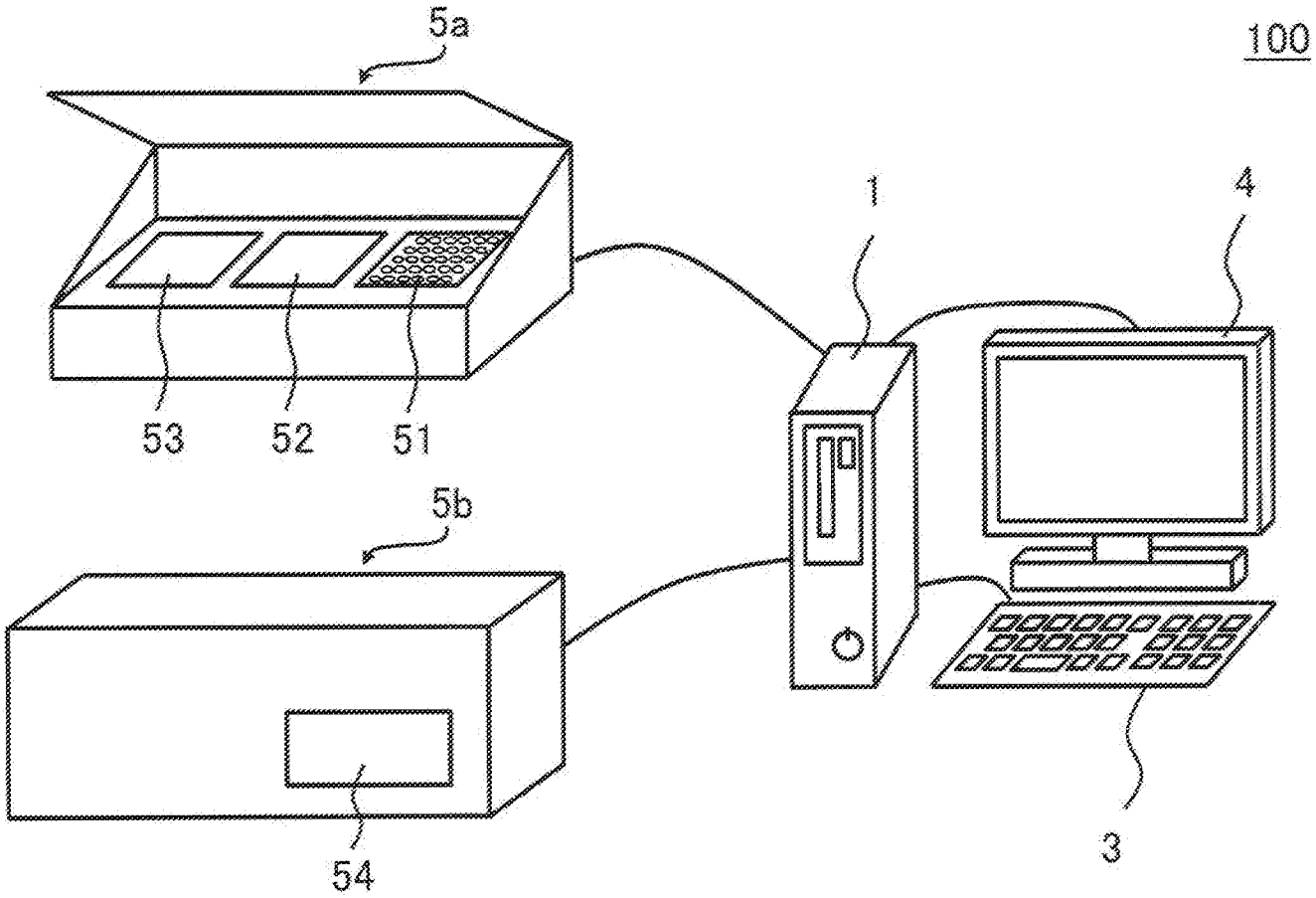

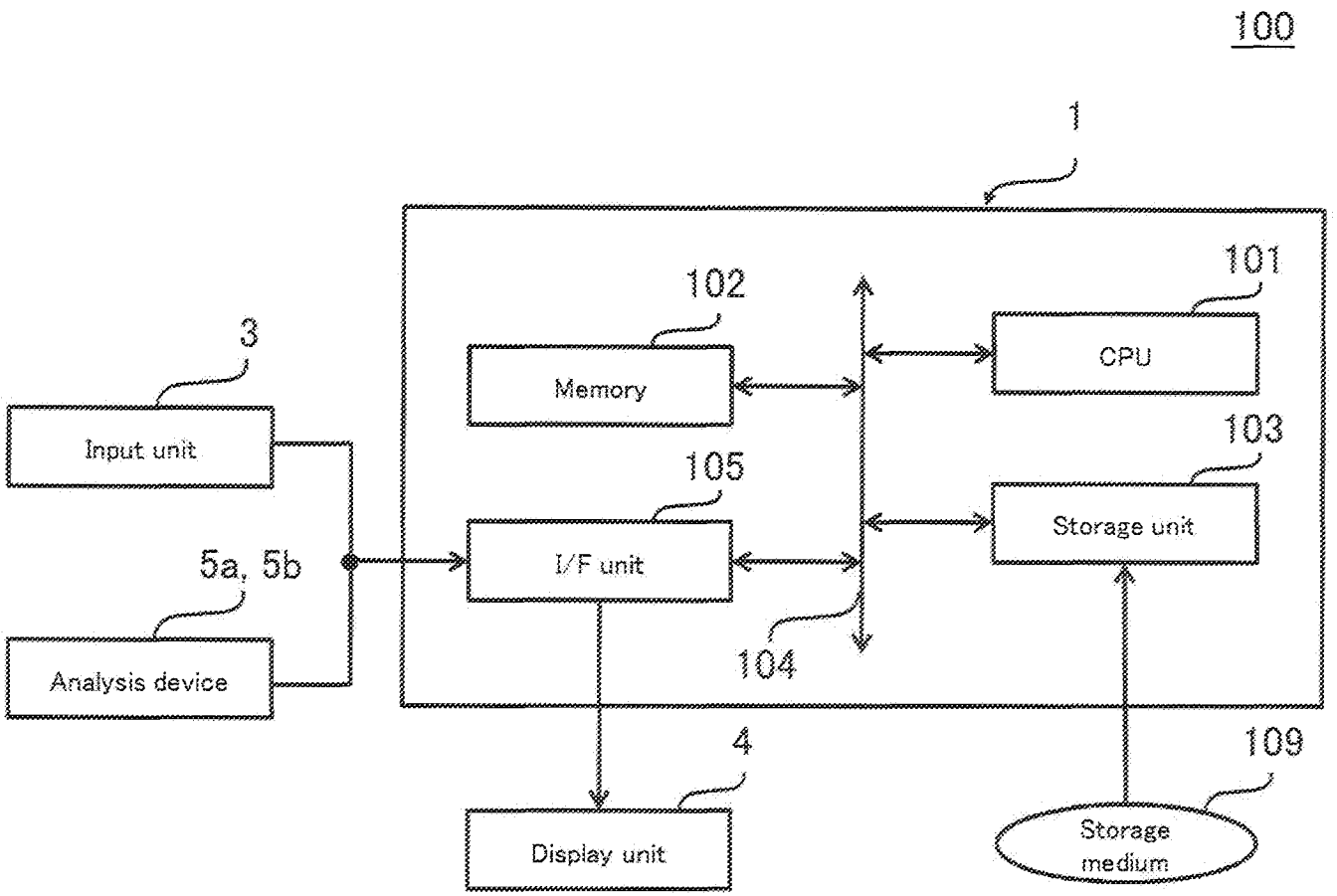
[Fig. 2]

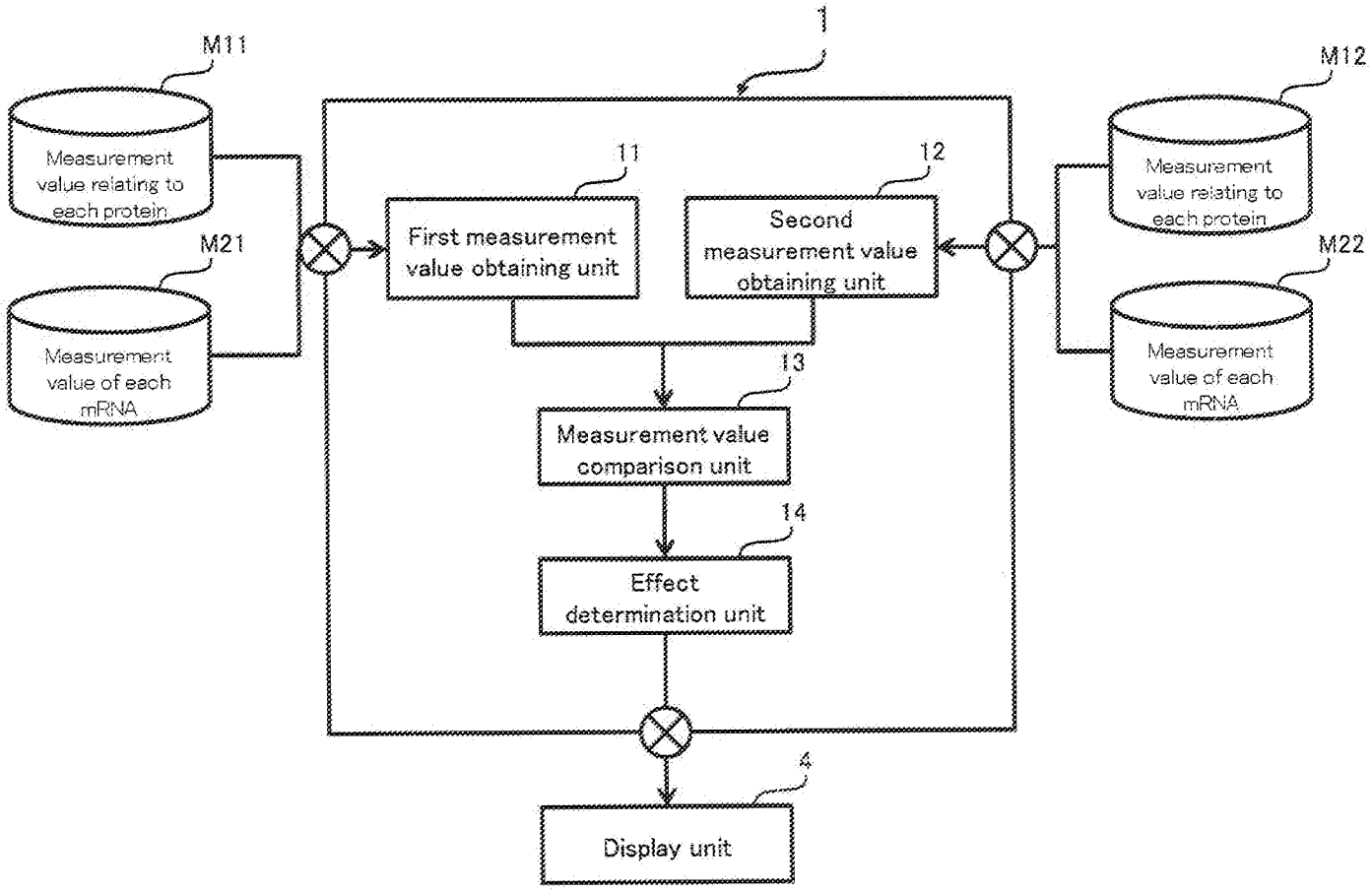
[Fig. 3]

[Fig. 4]
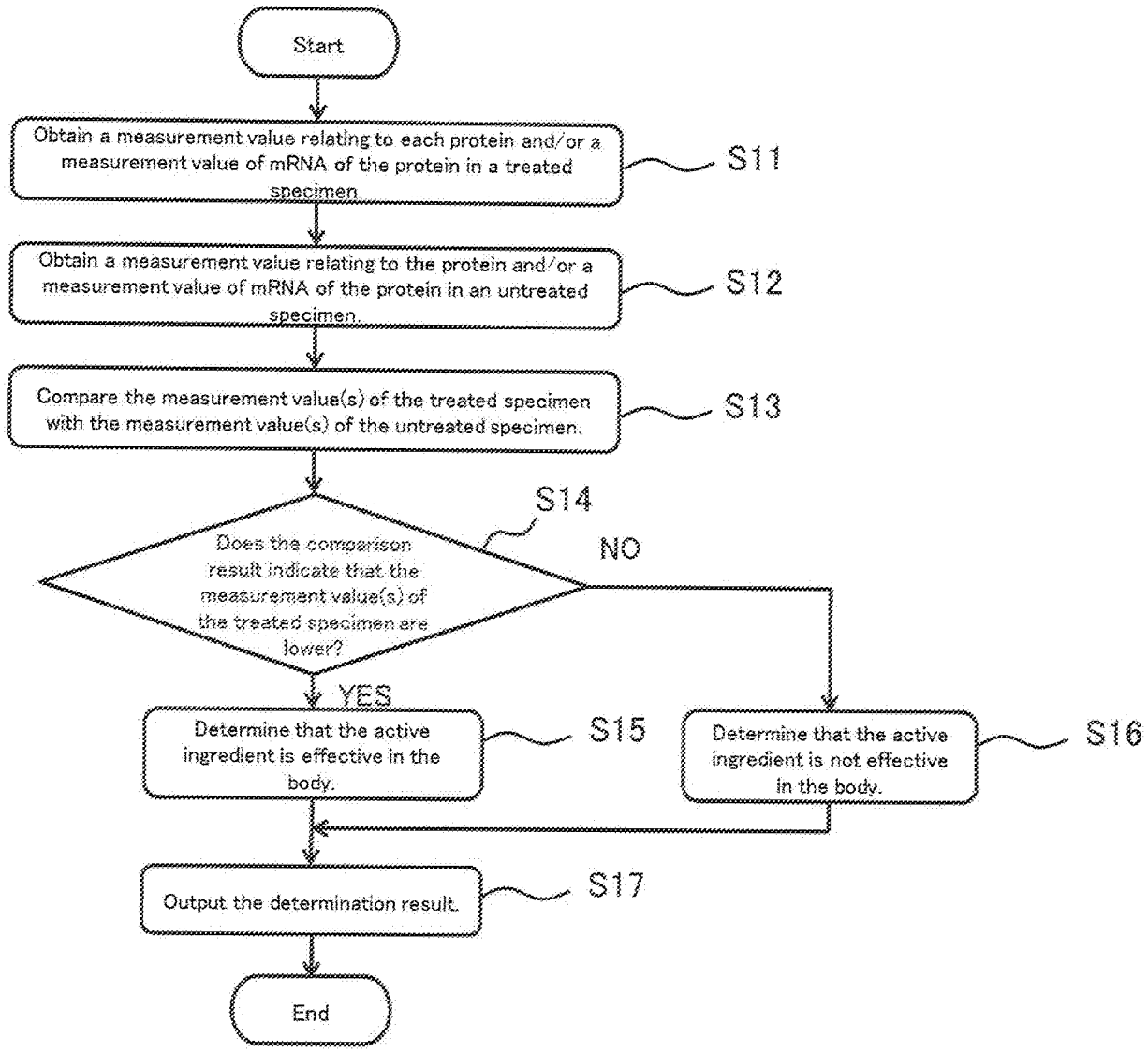

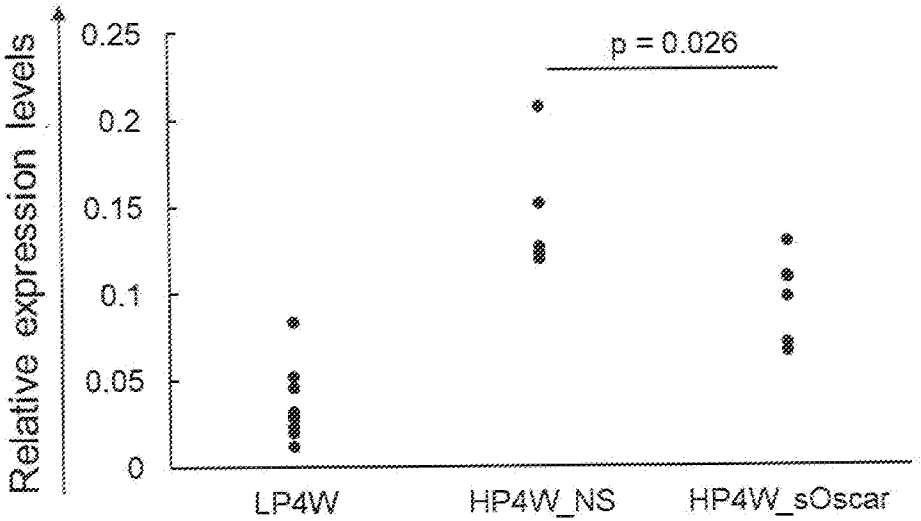
[Fig. 5]

[Fig. 6]
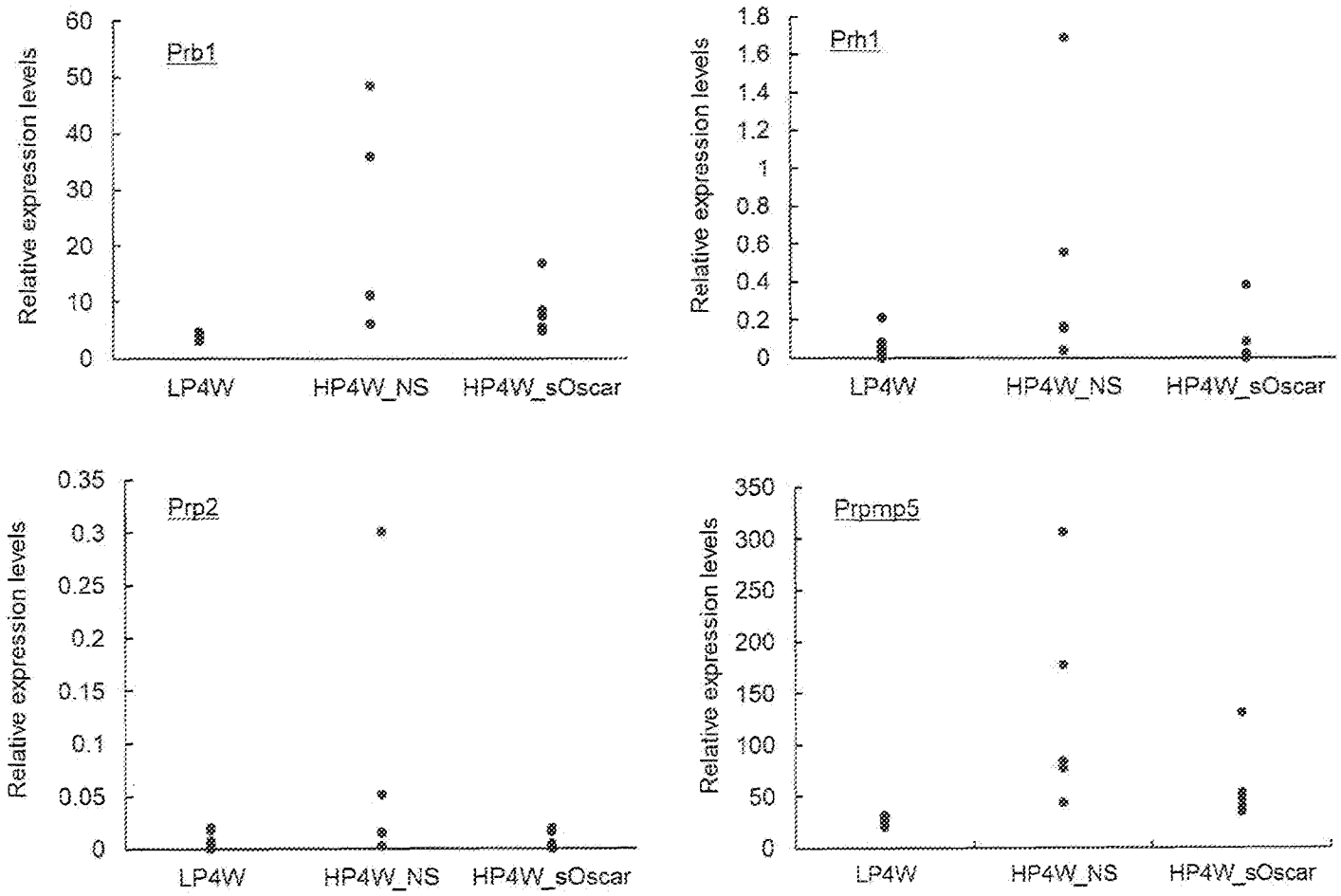

[Fig. 7]
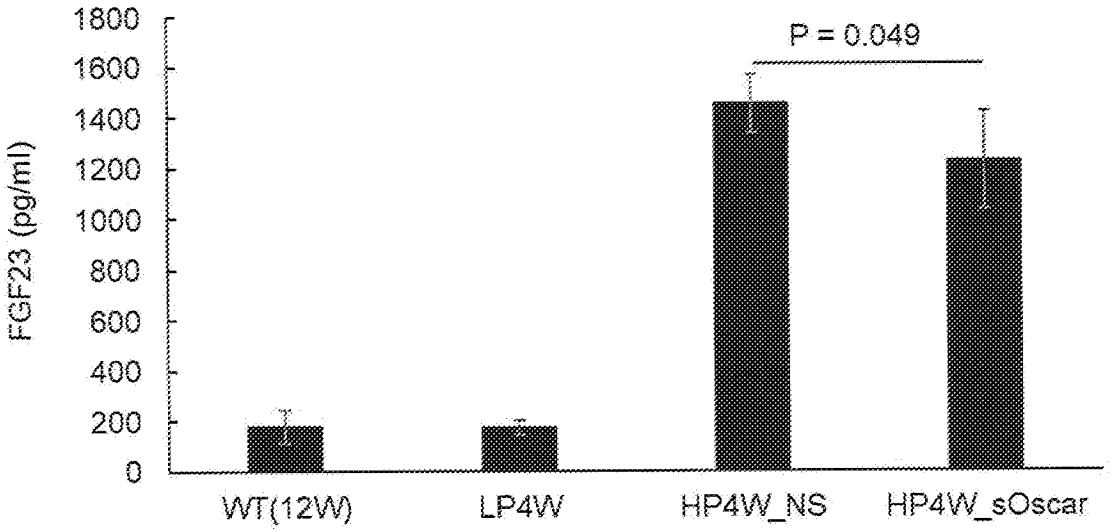

[Fig. 8]
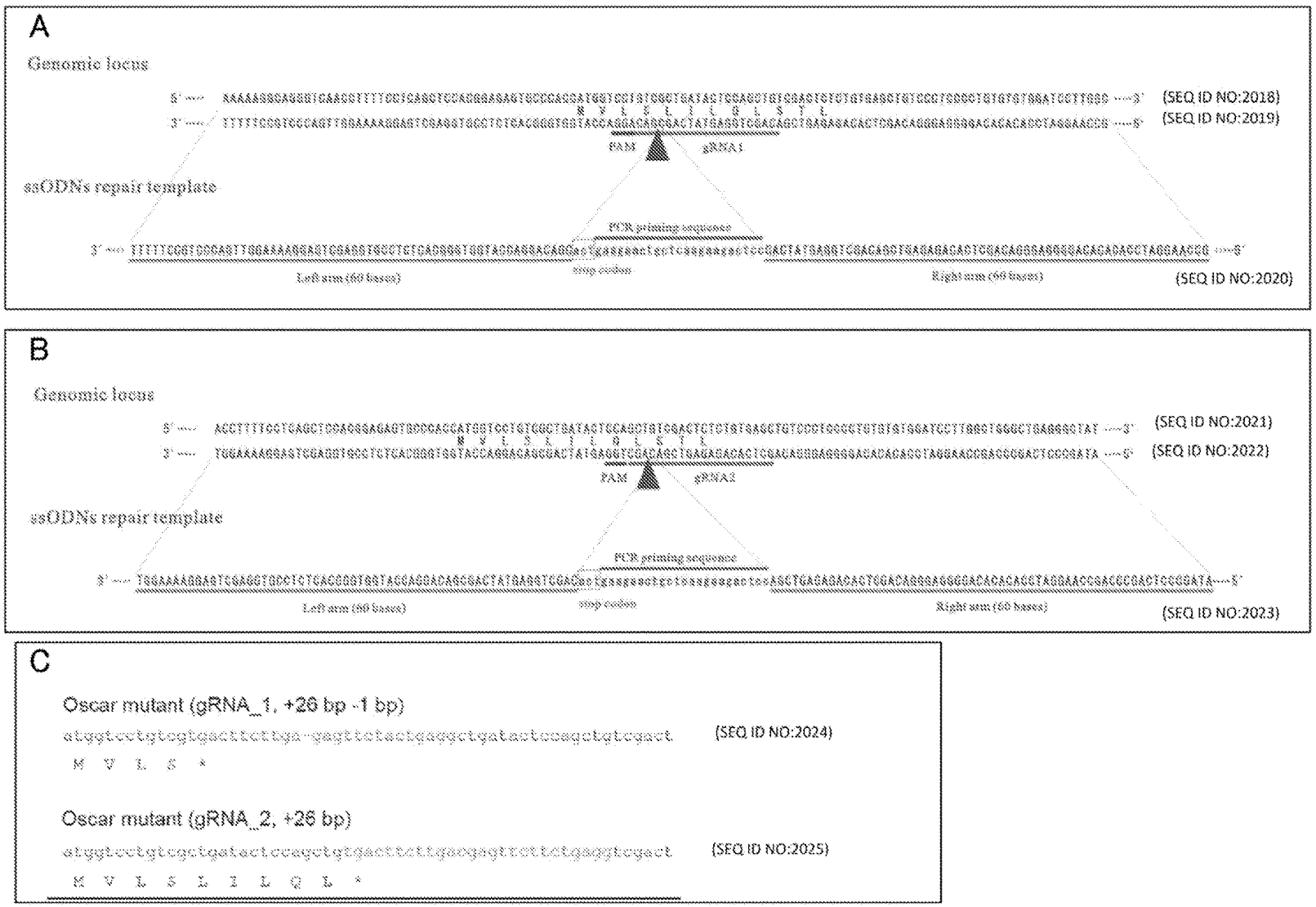

[Fig. 9]
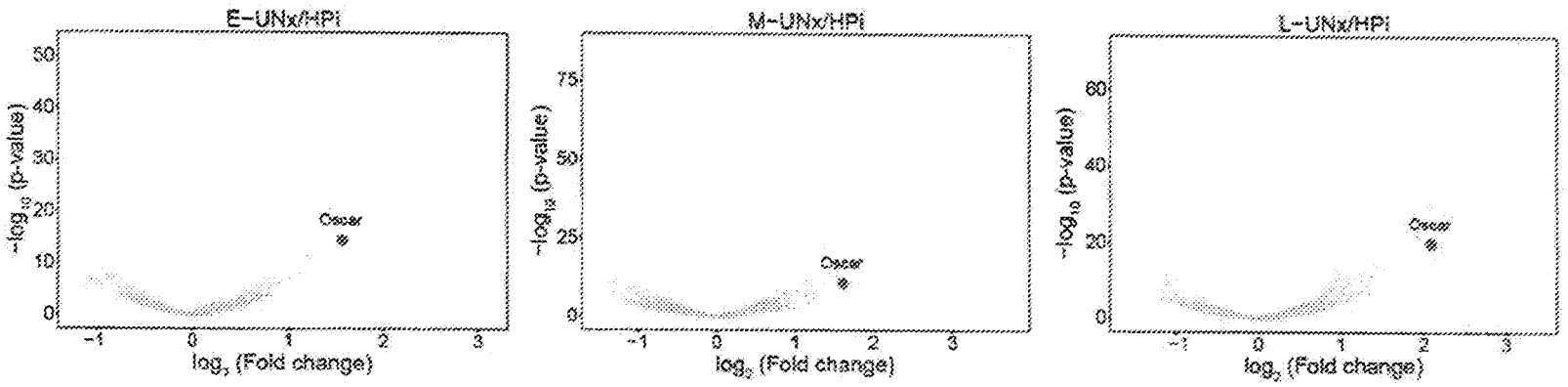

[Fig. 10]
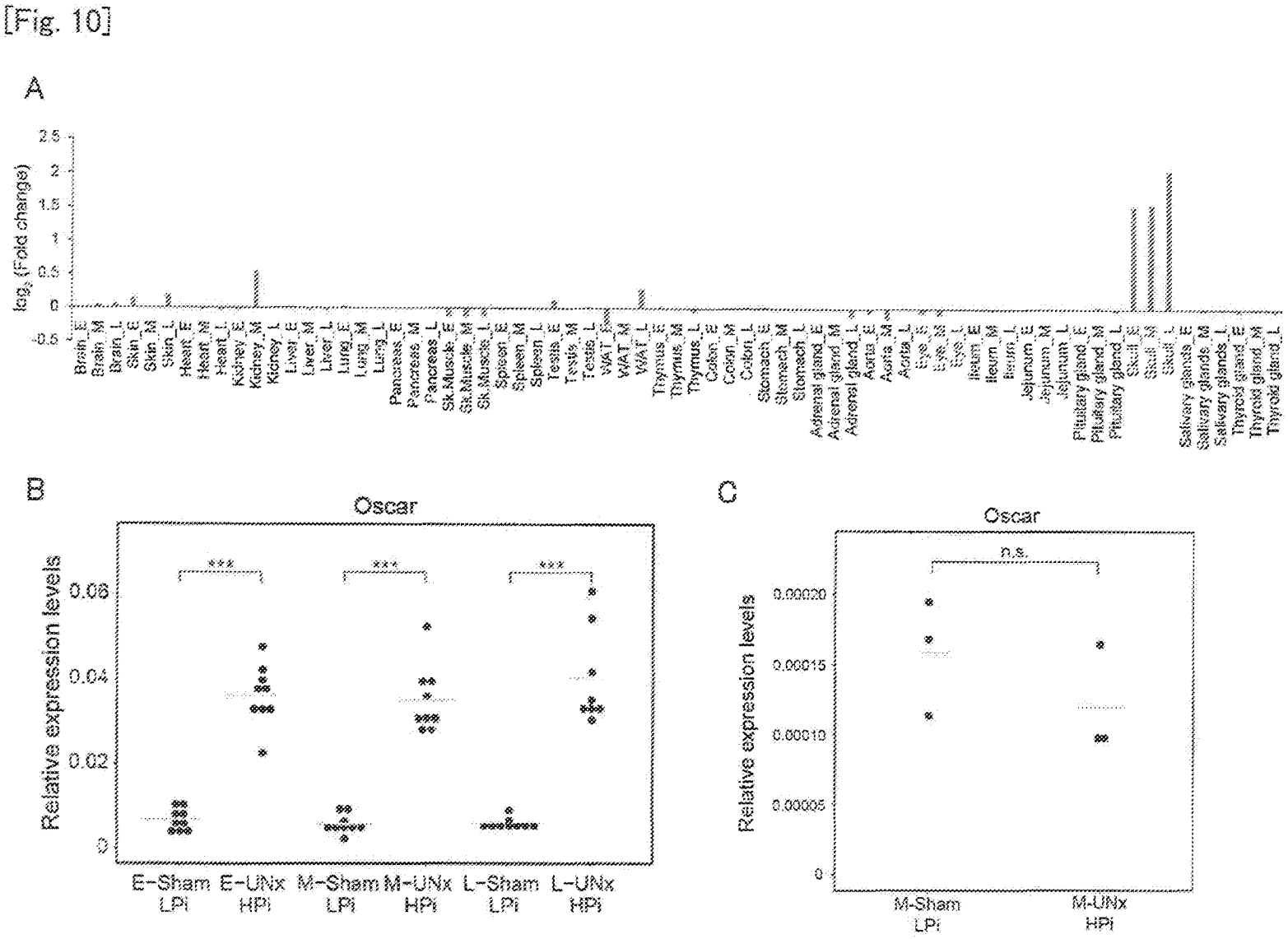

[Fig. 11]
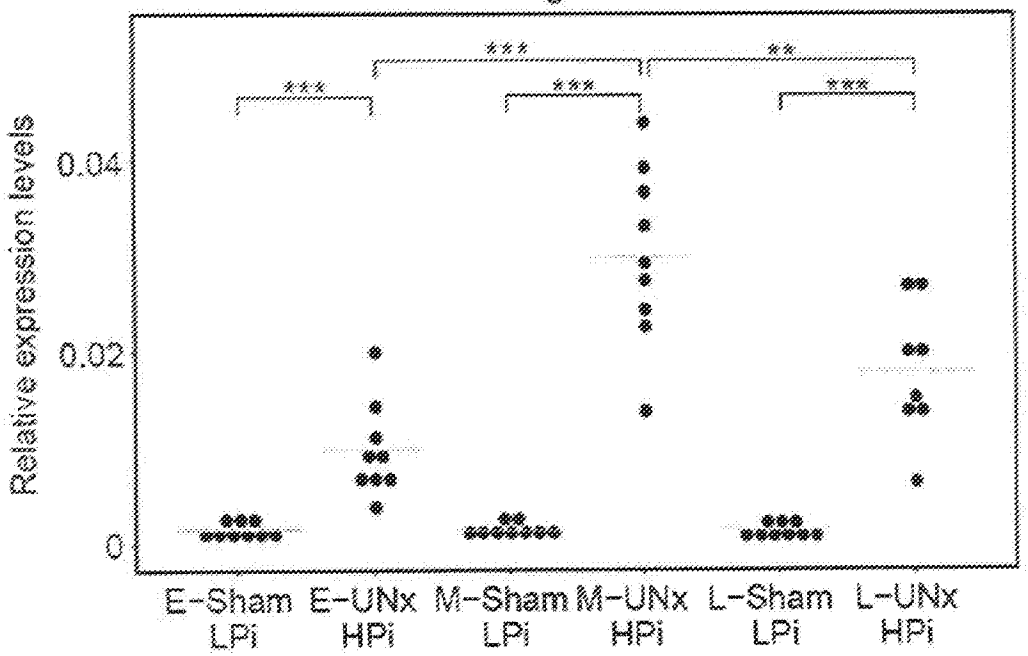

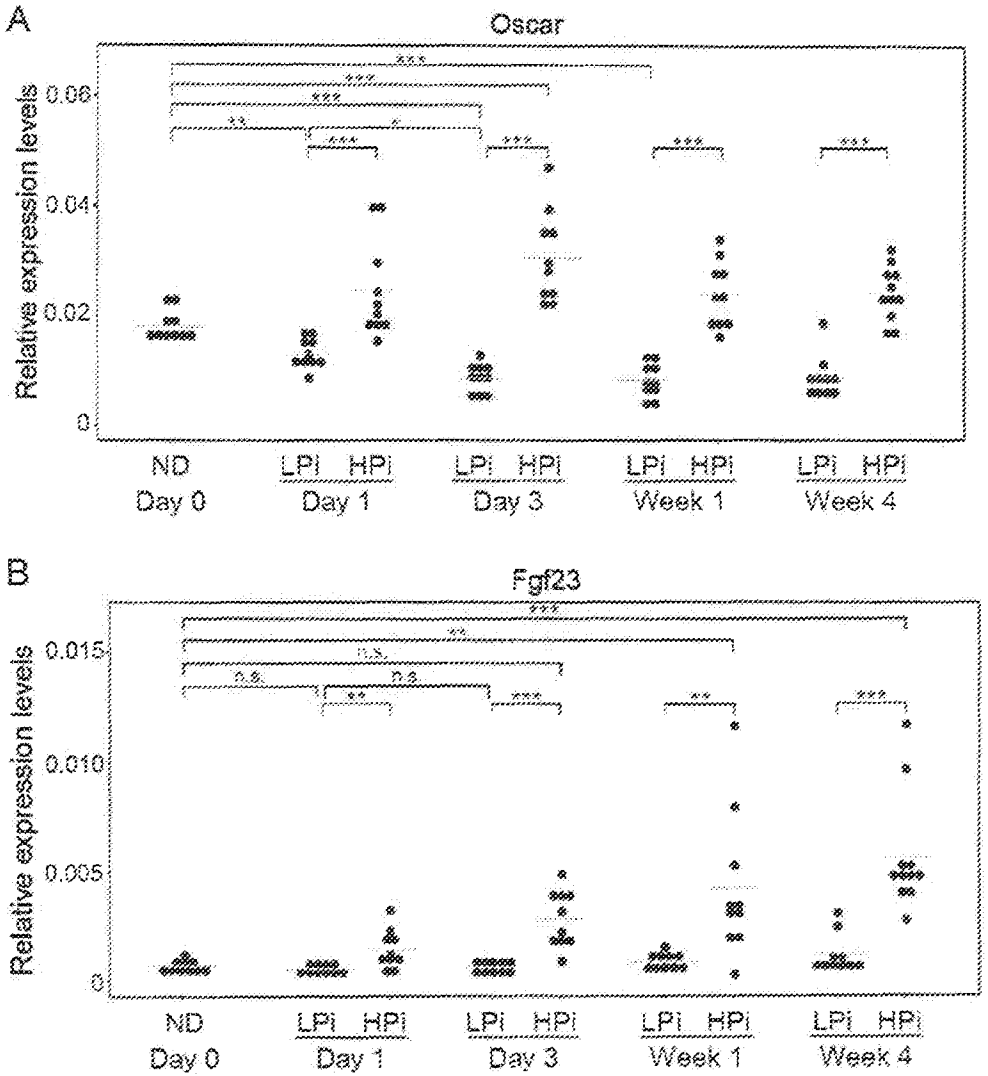
[Fig. 12]

[Fig. 13]
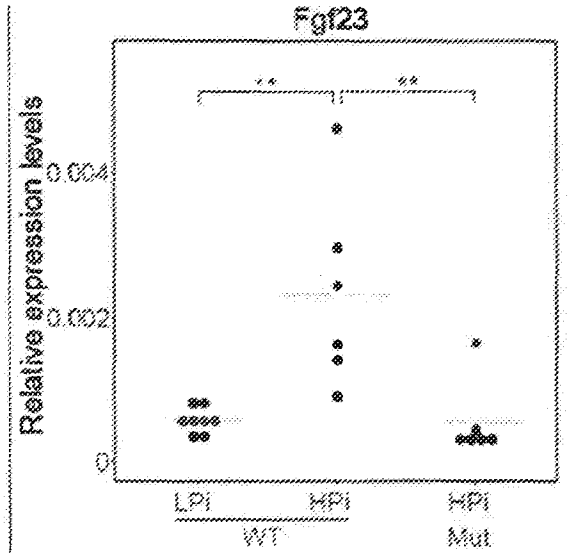

[Fig. 14]
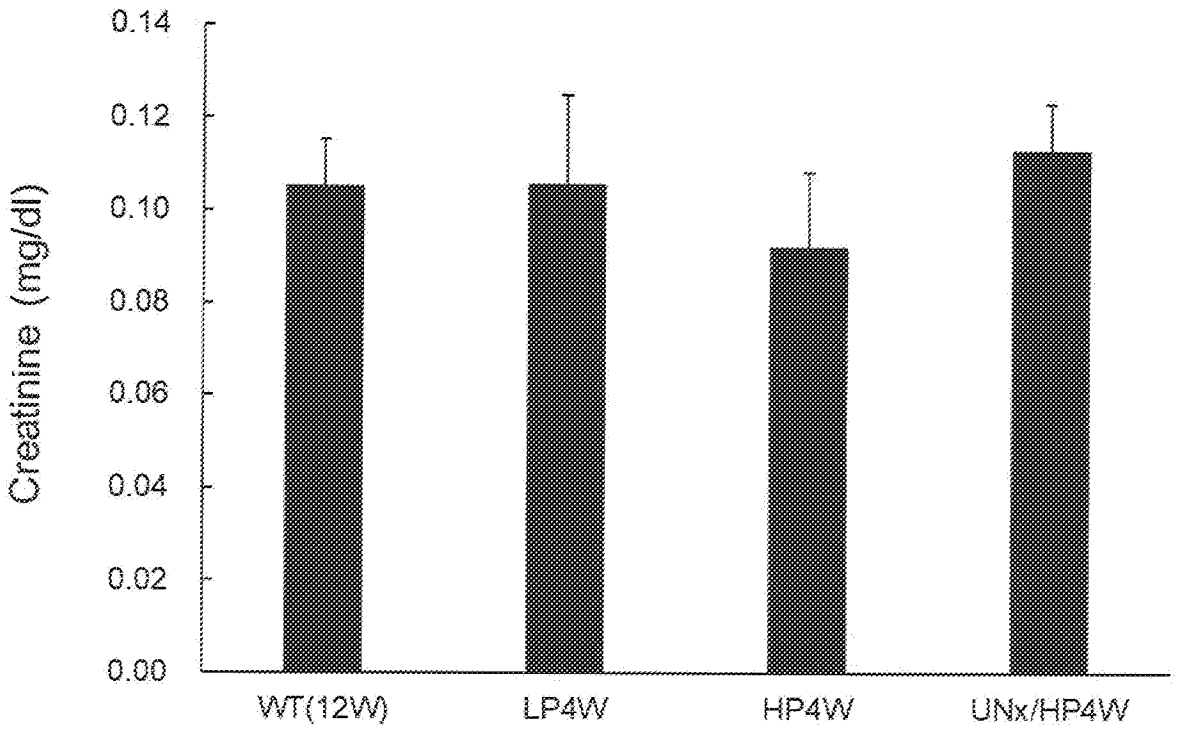

[Fig. 15]
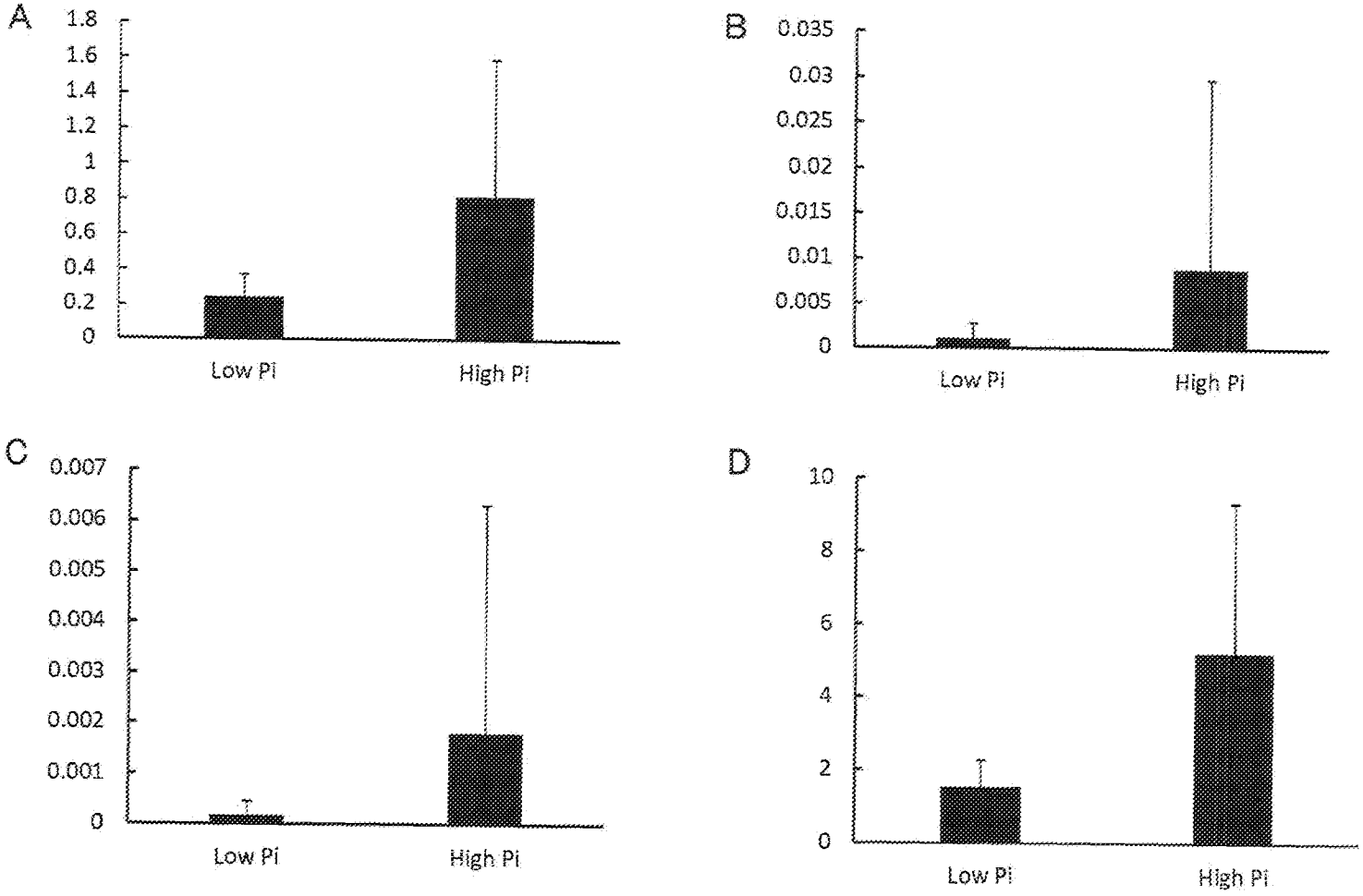

[Fig. 16]
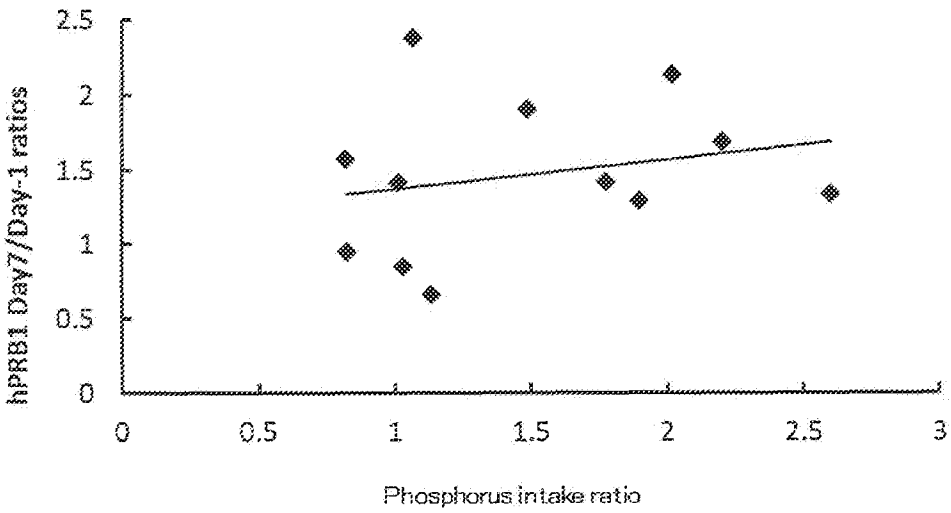

[Fig. 17]
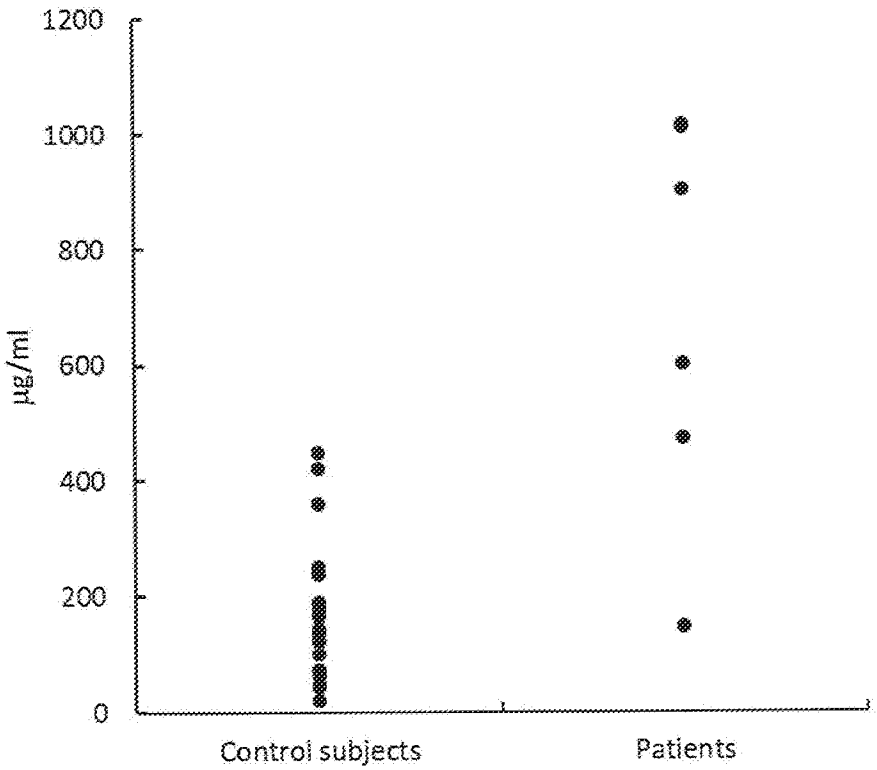

[Fig. 18]
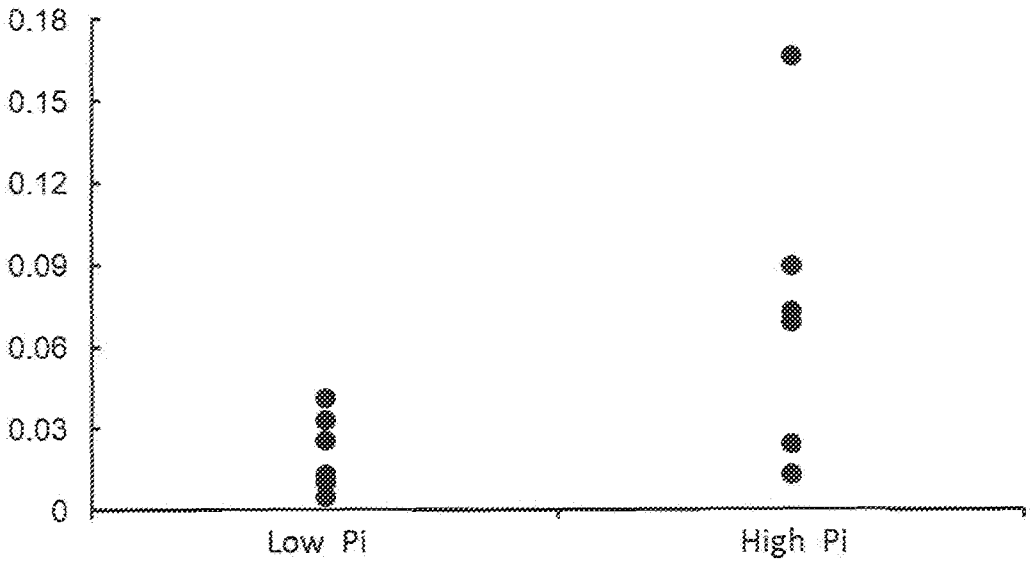

[Fig. 19]
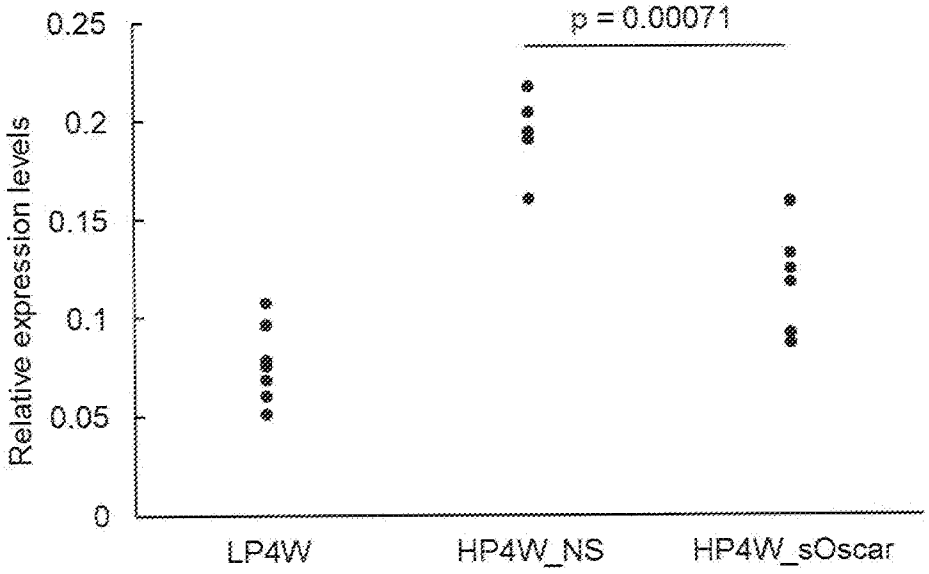

[ Fig. 20-1]

| Variant No./ Exon (E) or Intron (I) No. | Score | Sequence | SEQ ID: |
|---|---|---|---|
| V7/I1 | 94 | CAACACAAATTAGCCGGGCGTGG | 35 |
| | 93 | AGCTCAACATCGGCTCGTCCTGG | 36 |
| | 92 | GTCACTCCGGAGCGACTTCTAGG | 37 |
| | 91 | CCACGCAGGTCCGCAAAGTCAGG | 38 |
| | 91 | GGACTATTTTGTTCCGCCTTAGG | 39 |
| | 91 | GTCTCGAACTTCCCGACCTCAGG | 40 |
| | 91 | GCGAGGGTCTGGCACGTAATAGG | 41 |
| | 90 | CGCCTTAGGTGGGTCGCAGCAGG | 42 |
| | 90 | ACCTCGTGATCCGCCCGCCTCGG | 43 |
| | 90 | AATCGCTTGAACTCGGGAGTCGG | 44 |
| | 90 | TCTTGGTCTTTCAGTCGGACTGG | 45 |
| | 89 | CCTGACTTTGCGGACCTGCGTGG | 46 |
| | 89 | TCTCAGCCTAGAAGTCGCTCCGG | 47 |
| | 89 | CGCTTGAACTCGGGAGTCGGAGG | 48 |
| | 89 | GGAGTGCAATGGCGCGATCTCGG | 49 |
| | 88 | ATGTTGAGCTGAGACCTCGAAGG | 50 |
| | 88 | ACAACCGCGCCCGGCCTAGAGGG | 51 |
| | 87 | AGACTAAGGAGATTCCACGCAGG | 52 |
| | 87 | AACAACCGCGCCCGGCCTAGAGG | 53 |
| | 86 | GGATGAGACCTAGCGCTTCCAGG | 54 |
| | 85 | CAACCGCGCCCGGCCTAGAGGGG | 55 |
| | 84 | TATTTTGTTCCGCCTTAGGTGGG | 56 |
| | 84 | GAGAATGGCGTGAACCCGGGAGG | 57 |
| | 83 | AATGACTAACCTGTCCTTCGAGG | 58 |
| | 83 | TAGCCCCTCTAGGCCGGGCGCGG | 59 |
| | 82 | GGCGGGCGGATCACGAGGTCAGG | 60 |
| | 82 | CGCTAGGTCTCATCCCAGATGGG | 61 |
| | 81 | CTGCTGCGACCCACCTAAGGCGG | 62 |
| | 81 | CGGCTCGTCCTGGAAGCGCTAGG | 63 |
| | 81 | CAGAAAGCTCCTAACCCATCTGG | 64 |
| | 81 | GGGGGTTCAGTCATAACCTGTGG | 65 |
| | 80 | CTATTTTGTTCCGCCTTAGGTGG | 66 |
| | 80 | AGCAGGAGGACTAGTCACTCCGG | 67 |
| | 80 | GAGCTGAGACCTCGAAGGACAGG | 68 |
| | 80 | CACAAATTAGCCGGGCGTGGTGG | 69 |
| | 78 | GCGCCCGTAGTCCCAGCTACTGG | 70 |
| | 78 | CTGCCAACATGGCACAGCGAGGG | 71 |
| | 78 | AACATGGCACAGCGAGGGTCTGG | 72 |
| | 77 | TCGAGGTCTCAGCTCAACATCGG | 73 |
| | 77 | GCGCTAGGTCTCATCCCAGATGG | 74 |
| | 77 | GCAGGAGAATGGCGTGAACCCGG | 75 |
| | 77 | AAAATTAGCCCCTCTAGGCCGGG | 76 |
| | 76 | GGTCTCATCCCAGATGGGTTAGG | 77 |
| | 76 | AATGGCGTGAACCCGGGAGGCGG | 78 |
| | 76 | GAAAAATTAGCCGGCTGTGGAGG | 79 |
| | 76 | CAGGAGAATCGCTTGAACTCGGG | 80 |
| | 75 | CGACTTCTAGGCTGAGACTAAGG | 81 |
| | 75 | AGAAAGCTCCTAACCCATCTGGG | 82 |
| | 75 | AGTGATCTGAGCTATAATGGCGG | 83 |
| | 75 | CAGGAGAATGGCGTGAACCCGGG | 84 |
| | 75 | AAAGAAAAATTAGCCGGCTGTGG | 85 |
| | 75 | AAAAATTAGCCCCTCTAGGCCGG | 86 |
| | 74 | CTCCTGCTGCGACCCACCTAAGG | 87 |
| | 74 | TCAGGAGATCTAGACCATCCTGG | 88 |
| | 74 | CAAGGCGGGTGGATCACCTGAGG | 89 |
| | 74 | CCTCGCTGTGCCATGTTGGCAGG | 90 |

[ Fig. 20-2]

| | | |
|---|---|---|
| 74 | GTCATAGCCCTATGGCACTGTGG | 91 |
| 73 | AATTAGCCGGGCGTGGTGGTGGG | 92 |
| 73 | AGACGGGGGTTTCTCCATGTTGG | 93 |
| 73 | CAGGCGCGCGCCTCCACAGCCGG | 94 |
| 71 | ATGGGTTAGGAGCTTTCTGCGGG | 95 |
| 71 | TCGATCAATTAATCACAGCAAGG | 96 |
| 70 | GAACAAAGATGGAGCCGTGGAGG | 97 |
| 70 | TTAAGTGATCTGAGCTATAATGG | 98 |
| 70 | CCCTTGCTGTGATTGATTGATGG | 99 |
| 69 | CTTAGGTGGGTCGCAGCAGGAGG | 100 |
| 69 | ACAGTATCACACCAAGAGCCTGG | 101 |
| 69 | AGACCCTCGCTGTGCCATGTTGG | 102 |
| 69 | CCTGCCAACATGGCACAGCGAGG | 103 |
| 68 | GATCACTTAAGAAACTGACCTGG | 104 |
| 68 | CTTAAGAAACTGACCTGGTCTGG | 105 |
| 67 | CCGACTGAAAGACCAAGACCAGG | 106 |
| 67 | TCTAGAAACAAATACTAGTCAGG | 107 |
| 66 | ATTAGCACCTGTTAAGTGCCAGG | 108 |
| 66 | GGCACTGTGGAAAAATTAGCAGG | 109 |
| 65 | AAACTGACCTGGTCTGGGCCAGG | 110 |
| 65 | GCCTTAGCCTCCCCAGTAGCTGG | 111 |
| 65 | TCCATCAATCAATCACAGCAAGG | 112 |
| 64 | CGATCAATTAATCACAGCAAGGG | 113 |
| 64 | CCTGGTCTTGGTCTTTCAGTCGG | 114 |
| 64 | CTGCTGCTTGAGAGCAGTAACGG | 115 |
| 64 | TTTCAATCACAGCAAGGGCCTGG | 116 |
| 64 | CAGGCTGCTCTTGAACTCTTGGG | 117 |
| 63 | AGATGGAGCCGTGGAGGTAAAGG | 118 |
| 63 | GCTACTGGGGAGGCTAAGGCAGG | 119 |
| 63 | AAATTAGCCGGGCGTGGTGGTGG | 120 |
| 63 | GCCTCAGCCTCCTGAATAGCTGG | 121 |
| 63 | AATCAATCACAGCAAGGGCCTGG | 122 |
| 62 | GATGGGTTAGGAGCTTTCTGCGG | 123 |
| 62 | TTCTTTTTTAGGAGAGACGGGGG | 124 |
| 62 | GCACTGTGGAAAAATTAGCAGGG | 125 |
| 62 | AGAAACAAATACTAGTCAGGAGG | 126 |
| 61 | CGTAGTCCCAGCTACTGGGGAGG | 127 |
| 61 | AACAAATACTAGTCAGGAGGTGG | 128 |
| 60 | TTAAGAAACTGACCTGGTCTGGG | 129 |
| 60 | CCTTAGCCTCCCCAGTAGCTGGG | 130 |
| 60 | AGATAAAAATTAGCCCCTCTAGG | 131 |
| 60 | CCATCAATCAATCACAGCAAGGG | 132 |
| 59 | GAGGTAAAGGAAGTGGTGTCAGG | 133 |
| 59 | CACTGCAAGCTCCGCCTCCCGGG | 134 |
| 59 | TAATTGATCGATTGATAGATTGG | 135 |
| 58 | AAATACAACACAAATTAGCCGGG | 136 |
| 58 | TCCCTCTGTGCCTGCCAACATGG | 137 |
| 58 | GTTAAATAAATGAACACCACAGG | 138 |
| 57 | GTTAGTCATTCACCTTCTCCCGG | 139 |
| 57 | CACCGCGCCTGGCCCAGACCAGG | 140 |
| 57 | GTTAGTCATTCACCTTCTCCCGG | 141 |
| 57 | AAAAGAAACTGACCTGGTCTTGG | 142 |
| 57 | GCAAGAGTCTGGCACATAATAGG | 143 |
| 56 | AAGAAACTGAGCCCGGGAGAAGG | 144 |
| 56 | CAAGCGCAAGCCTGACTTTGCGG | 145 |
| 56 | CTGGTCTGGGCCAGGCGCGGTGG | 146 |
| 56 | AATCAATGACAGCAAGAGTCTGG | 147 |
| 56 | CCAGGCTGCTCTTGAACTCTTGG | 148 |
| 55 | TTAGTCATTCACCTTCTCCCGGG | 149 |

[ Fig. 20-3]

| | | |
|---|---|---|
| 55 | TCACTGCAAGCTCCGCCTCCCGG | 150 |
| 55 | AAATACTAGTCAGGAGGTGGAGG | 151 |
| 54 | CTATCTTTCAATCACAGCAAGGG | 152 |
| 54 | CAAGAGTTCAAGAGCAGCCTGGG | 153 |
| 53 | GCCATGTTGGCAGGCACAGAGGG | 154 |
| 53 | TGCCATGTTGGCAGGCACAGAGG | 155 |
| 52 | ACAGACGAAGAAACTGAGCCCGG | 156 |
| 52 | TCTATCTTTCAATCACAGCAAGG | 157 |
| 52 | CCAAGAGTTCAAGAGCAGCCTGG | 158 |
| 51 | CCCAGCTACTGGGGAGGCTAAGG | 159 |
| 51 | TTTCTTTTTTAGGAGAGACGGGG | 160 |
| 51 | ACTGTGGAAAAATTAGCAGGGGG | 161 |
| 50 | TGTAATCCCAGCTATTCAGGAGG | 162 |
| 49 | CACCACTTCCTTTACCTCCACGG | 163 |
| 49 | CGCCCGTAGTCCCAGCTACTGGG | 164 |
| 49 | CACTGTGGAAAAATTAGCAGGGG | 165 |
| 48 | CCAAGAGCCTGGCACATAATAGG | 166 |
| 47 | GCCGAGGCGGGCGGATCACGAGG | 167 |
| 47 | CAGGCGTGAACAACCGCGCCCGG | 168 |
| 45 | ATTAACACCAATTATGTGCCAGG | 169 |
| 45 | GCAAGGGCCTGGCACATAATTGG | 170 |
| 43 | CCTCAGCCTCCTGAATAGCTGGG | 171 |
| 43 | ATGGTCTCACTCTATCACCCAGG | 172 |
| 42 | AGCCGTGGAGGTAAAGGAAGTGG | 173 |
| 42 | GCCTGTAATCCCAGCTATTCAGG | 174 |
| 42 | GCAAGGGCCTGGCACTTAACAGG | 175 |
| 42 | GCAGGAGAATCGCTTGAACTCGG | 176 |
| 40 | GACCTGGTCTGGGCCAGGCGCGG | 177 |
| 40 | CTAGACCATCCTGGCTAACATGG | 178 |
| 40 | GTGATTGAAAGATAGATAGATGG | 179 |
| 39 | CAGACGAAGAAACTGAGCCCGGG | 180 |
| 39 | AAAATACAACACAAATTAGCCGG | 181 |
| 39 | GCGGGTGGATCACCTGAGGTCGG | 182 |
| 39 | CCTATTATGTGCCAGGCTCTTGG | 183 |
| 38 | TCCTGAATAGCTGGGATTACAGG | 184 |
| 37 | GCCCGTAGTCCCAGCTACTGGGG | 185 |
| 37 | CTCAGGTGATCCACCCGCCTTGG | 186 |
| 37 | AATTAATCACAGCAAGGGCCTGG | 187 |
| 36 | TTTTCTTTTTTAGGAGAGACGGG | 188 |
| 36 | TAATTTTTCCACAGTGCCATAGG | 189 |
| 35 | TTGTATTTTTAAGTAGAGACAGG | 190 |
| 35 | AATTTTTCCACAGTGCCATAGGG | 191 |
| 33 | CGGGTGGATCACCTGAGGTCGGG | 192 |
| 33 | ACTAGTCAGGAGGTGGAGGCAGG | 193 |
| 31 | TTCATACATAAACTATAAAATGG | 194 |
| 30 | GGGAGGCTAAGGCAGGAGAATGG | 195 |
| 30 | TGAGTCTAGCTCTGTCGCCCAGG | 196 |
| 29 | CTTTGGGAGGCCGAGGCGGGCGG | 197 |
| 29 | CAAAAAAAAAGAAACTGACCTGG | 198 |
| 29 | CGGGCGCCCACCACCACGCCCGG | 199 |
| 29 | CCGGCTAATTTTTCTTTTTTAGG | 200 |
| 28 | TCATACATAAACTATAAAATGGG | 201 |
| 28 | TTGAAAGATAGATAGATGGATGG | 202 |
| 27 | CCCAGCTATTCAGGAGGCTGAGG | 203 |
| 26 | TGTATTTTTAAGTAGAGACAGGG | 204 |
| 26 | CCTAAAAAAGAAAAATTAGCCGG | 205 |
| 25 | CATACATAAACTATAAAATGGGG | 206 |
| 25 | ATTTGCACCTATTATGTGCCAGG | 207 |
| 24 | AGTTTCTTCGTCTGTAAAATGGG | 208 |

[ Fig. 20-4]

| | | | |
|---|---|---|---|
| | 24 | CGCGCCATTGCACTCCAGCCTGG | 209 |
| | 24 | GCGCCATTGCACTCCAGCCTGGG | 210 |
| | 23 | CTTTGGGAGGCCAAGGCGGGTGG | 211 |
| | 21 | GCTATTCAGGAGGCTGAGGCAGG | 212 |
| | 21 | TTTTTCTTTTTTAGGAGAGACGG | 213 |
| | 21 | AAGATAGATAGATGGATGGATGG | 214 |
| | 21 | TATTTATTTATTTTTTAGACAGG | 215 |
| | 19 | AGGGTTTCACCATGTTAGCCAGG | 216 |
| | 19 | CTCCCCAGTAGCTGGGACTACGG | 217 |
| | 18 | GCACTTTGGGAGGCCGAGGCGGG | 218 |
| | 18 | GGAGTGCAGTGGTGTGATCTCGG | 219 |
| | 17 | CAGTTTCTTCGTCTGTAAAATGG | 220 |
| | 17 | TCCCCAGTAGCTGGGACTACGGG | 221 |
| | 16 | TTTCACCATGTTAGCCAGGATGG | 222 |
| | 16 | GGGGTTTCTCCATGTTGGTCAGG | 223 |
| | 16 | AGTCAGGAGGTGGAGGCAGGAGG | 224 |
| | 15 | AGCACTTTGGGAGGCCGAGGCGG | 225 |
| | 15 | TCTAGCTCTGTCGCCCAGGCTGG | 226 |
| | 14 | AGGGTCTCGCTCTGTTGCCCAGG | 227 |
| | 13 | ATTTATTTATTTTTTAGACAGGG | 228 |
| | 12 | TGTGCCACTGCACTCCAGCCTGG | 229 |
| | 11 | GGAGTCTCGCTCTGTCGCCCAGG | 230 |
| | 11 | CACACCACTGCACTCCAGCCTGG | 231 |
| | 11 | TTTCTCCATGTTGGTCAGGCTGG | 232 |
| | 11 | TCTCACTCTATCACCCAGGCTGG | 233 |
| | 10 | CCCAGCACTTTGGGAGGCCGAGG | 234 |
| | 10 | CAGTTTCTTTTTTTTTGAGACGG | 235 |
| | 10 | CGAGACCAGCCTGACCAACATGG | 236 |
| | 10 | TCGCCCAGGCTGGAGTGCAATGG | 237 |
| | 9 | GCCTCGGCCTCCCAAAGTGCTGG | 238 |
| | 9 | TCTCGCTCTGTCGCCCAGGCTGG | 239 |
| | 9 | ACACCACTGCACTCCAGCCTGGG | 240 |
| | 9 | GTGCCACTGCACTCCAGCCTGGG | 241 |
| | 7 | CCTCGGCCTCCCAAAGTGCTGGG | 242 |
| | 7 | GCACTTTGGGAGGCCAAGGCGGG | 243 |
| | 6 | CCCAGCACTTTGGGAGGCCAAGG | 244 |
| | 5 | TCGCCCAGGCTGGAGTGCAGTGG | 245 |
| | 5 | AGCACTTTGGGAGGCCAAGGCGG | 246 |
| | 5 | GCCTTGGCCTCCCAAAGTGCTGG | 247 |
| | 5 | ATTAGCACCTATTATGTGCCAGG | 248 |
| | 4 | CGCCTGTAATCCCAGCACTTTGG | 249 |
| | 4 | CCTTGGCCTCCCAAAGTGCTGGG | 250 |
| | 4 | CGCCTGTAATCCCAGCACTTTGG | 251 |
| | 4 | TCACCCAGGCTGGAGTGCAGTGG | 252 |
| | 3 | TGTAATCCCAGCACTTTGGGAGG | 253 |
| | 3 | GCCTGTAATCCCAGCACTTTGGG | 254 |
| | 3 | TGTAATCCCAGCACTTTGGGAGG | 255 |
| | 3 | GCCTGTAATCCCAGCACTTTGGG | 256 |
| | 2 | CAGGCGTGAGCCACCGCGCCTGG | 257 |
| | 2 | TCCCAAAGTGCTGGGATTACAGG | 258 |
| V7/E2 | 91 | ATTTACGGAAGAGAGTATCGAGG | 259 |
| | 89 | TACGGAAGAGAGTATCGAGGTGG | 260 |
| | 89 | GGGCAGATACCCGCTAGAGCTGG | 261 |
| | 87 | CGGAAGAGAGTATCGAGGTGGGG | 262 |
| | 86 | TAGCGGGTATCTGCCCACCATGG | 263 |
| | 85 | ACGGAAGAGAGTATCGAGGTGGG | 264 |
| | 83 | GATACTCTCTTCCGTAAATGAGG | 265 |
| | 82 | TCTTCCGTAAATGAGGATCTGGG | 266 |
| | 79 | CTCTTCCGTAAATGAGGATCTGG | 267 |

[ Fig. 20-5]

| | | | |
|---|---|---|---|
| | 76 | CGTAAATGAGGATCTGGGTCTGG | 268 |
| | 75 | GTGACTGTGTCATAGCCCTATGG | 269 |
| | 74 | GTATCGAGGTGGGGGCCTGTGGG | 270 |
| | 74 | GTCATAGCCCTATGGCACTGTGG | 271 |
| | 73 | GCTATGACACAGTCACCCACAGG | 272 |
| | 70 | GAGAGGGTGCGACCAAGCCCTGG | 273 |
| | 66 | GGCACTGTGGAAAAATTAGCAGG | 274 |
| | 66 | GGAAGAGAGTATCGAGGTGGGGG | 275 |
| | 66 | TACCCGCTAGAGCTGGAGCCAGG | 276 |
| | 65 | CAGACCCAGATCCTCATTTACGG | 277 |
| | 63 | AGTATCGAGGTGGGGGCCTGTGG | 278 |
| | 62 | GCACTGTGGAAAAATTAGCAGGG | 279 |
| | 54 | CAGCTGGAGGATCAGCACCAGGG | 280 |
| | 54 | GCAGCTGGAGGATCAGCACCAGG | 281 |
| | 54 | ACTCACAGAGGGTCAGCAGCTGG | 282 |
| | 54 | AAGAAAGGGGTGACTCACAGAGG | 283 |
| | 53 | GTATCTGCCCACCATGGCCCTGG | 284 |
| | 52 | TGTTGCCTCATTTCCTGGGAGGG | 285 |
| | 52 | ATGTTGCCTCATTTCCTGGGAGG | 286 |
| | 51 | ACTGTGGAAAAATTAGCAGGGGG | 287 |
| | 51 | CTGATGTTGCCTCATTTCCTGGG | 288 |
| | 51 | AGCCCTGGCTCCAGCTCTAGCGG | 289 |
| | 51 | ATCAGCACCAGGGCCATGGTGGG | 290 |
| | 49 | ACCCGCTAGAGCTGGAGCCAGGG | 291 |
| | 49 | CACTGTGGAAAAATTAGCAGGGG | 292 |
| | 48 | TCTGATGTTGCCTCATTTCCTGG | 293 |
| | 47 | AGAAAGGGGTGACTCACAGAGGG | 294 |
| | 45 | GTTGCCTCATTTCCTGGGAGGGG | 295 |
| | 42 | CTCTCCCCTCCCAGGAAATGAGG | 296 |
| | 38 | GAGGATCAGCACCAGGGCCATGG | 297 |
| | 38 | CACAGAGGGTCAGCAGCTGGAGG | 298 |
| | 36 | TAATTTTTCCACAGTGCCATAGG | 299 |
| | 35 | AATTTTTCCACAGTGCCATAGGG | 300 |
| | 31 | GCCCTGGCTCCAGCTCTAGCGGG | 301 |
| | 30 | CTCATTTCCTGGGAGGGGAGAGG | 302 |
| | 30 | GATCAGCACCAGGGCCATGGTGG | 303 |
| | 28 | TCATTTCCTGGGAGGGGAGAGGG | 304 |
| | 28 | CTAGAGCTGGAGCCAGGGCTTGG | 305 |
| | 28 | GTCGCACCCTCTCCCCTCCCAGG | 306 |
| V1/E3 | 78 | CACACAGACATCACTCCGTCTGG | 307 |
| V6/E3 | 76 | CTAGTCCCTCAACCTCCTACAGG | 308 |
| | 71 | TAGTCCCTCAACCTCCTACAGGG | 309 |
| | 70 | TGGGGTGGCTACTCACCAGACGG | 310 |
| | 60 | AGAGGCCCTGTAGGAGGTTGAGG | 311 |
| | 57 | TGACACAGAGGCCCTGTAGGAGG | 312 |
| | 56 | GAGGCCCTGTAGGAGGTTGAGGG | 313 |
| | 51 | GTGATGTCTGTGTGACACAGAGG | 314 |
| | 50 | GTGTGACACAGAGGCCCTGTAGG | 315 |
| V1/E4 | 83 | CTCACCTATAATGGCCACTAAGG | 316 |
| V3/E4 | 82 | CACCTATAATGGCCACTAAGGGG | 317 |
| | 81 | TCACCTATAATGGCCACTAAGGG | 318 |
| | 79 | TTCCCCTTAGTGGCCATTATAGG | 319 |
| | 71 | TCTTCAGTACTCACCTATAATGG | 320 |
| | 62 | ATAGGTGAGTACTGAAGACCAGG | 321 |
| | 49 | TCTTTTCTCATTCCCCTTAGTGG | 322 |
| V5/I2 | 92 | TGCGTTCAGACTTCTTCGGTAGG | 323 |
| V6/I2 | 91 | TTCAGACTTCTTCGGTAGGTGGG | 324 |
| V7/I2 | 91 | TACTTGAACCCTAGAGTCGGAGG | 325 |
| | 90 | GTTTCTCCTCTCACGAGTTCAGG | 326 |

[ Fig. 20-6]

| | | |
|---|---|---|
| 90 | GTTCAGACTTCTTCGGTAGGTGG | 327 |
| 90 | GAGCATTCGCTATATTGCCCAGG | 328 |
| 89 | GCGGTCTCCCTATGTTGAGCAGG | 329 |
| 87 | AACTGCAGCCTCCGACTCTAGGG | 330 |
| 86 | GCCTCAGCCTCCGTAGTAGCTGG | 331 |
| 86 | CAGATTCCTGAACTCGTGAGAGG | 332 |
| 85 | CAAGCTAGCACTACCACGCCTGG | 333 |
| 84 | TGTAGTCCCAGCTACTACGGAGG | 334 |
| 84 | GAACTCGCTGTTGGGCGCAGCGG | 335 |
| 84 | CTTCTTCGGTAGGTGGGCAATGG | 336 |
| 84 | AGAGAGGGGTTTCGCCATGTTGG | 337 |
| 83 | GGGGTTTCACCACATTAGCCAGG | 338 |
| 83 | CTCACCTATAATGGCCACTAAGG | 339 |
| 83 | AGGTCAGATCGAGATCATCCTGG | 340 |
| 82 | TAACTGCAGCCTCCGACTCTAGG | 341 |
| 82 | CACCTATAATGGCCACTAAGGGG | 342 |
| 81 | TCACCTATAATGGCCACTAAGGG | 343 |
| 81 | TAAAAATAAGGGTCGGGTGAGGG | 344 |
| 81 | CCCCCTCCCATATAAGAATCTGG | 345 |
| 80 | CCTCAGCCTCCGTAGTAGCTGGG | 346 |
| 80 | CCCCATCTCATTGGTAACCCAGG | 347 |
| 79 | TTCCCCTTAGTGGCCATTATAGG | 348 |
| 79 | GCAGGTTGGTCTTAAACTACTGG | 349 |
| 79 | CCCAGATTCTTATATGGGAGGGG | 350 |
| 78 | GGACTCCCAGATTCTTATATGGG | 351 |
| 78 | CTCTCACGAGTTCAGGAATCTGG | 352 |
| 78 | CTCCCAGATTCTTATATGGGAGG | 353 |
| 78 | CCCCTCCCATATAAGAATCTGGG | 354 |
| 78 | CACACAGACATCACTCCGTCTGG | 355 |
| 78 | AGGAAGGCTGTTGGGTCCGGTGG | 356 |
| 78 | ACTCTACGATCATTGTTCCCTGG | 357 |
| 77 | TTTGAAAAGAACTCGCTGTTGGG | 358 |
| 77 | TCTCCCTATGTTGAGCAGGTTGG | 359 |
| 77 | TCTCACGAGTTCAGGAATCTGGG | 360 |
| 77 | GGATCTTGGGCTGGGCGCAATGG | 361 |
| 77 | GCAGAGGCGGGCGGATCACAAGG | 362 |
| 77 | GAGCCGAGGCCCAGCACTTTGGG | 363 |
| 77 | CGAGATCATCCTGGCTAATGTGG | 364 |
| 76 | TTTTGAAAAGAACTCGCTGTTGG | 365 |
| 76 | GGTCTGCGTTCAGACTTCTTCGG | 366 |
| 76 | GCCTGGGCAACCAAGAGTTCAGG | 367 |
| 76 | CTAGTCCCTCAACCTCCTACAGG | 368 |
| 76 | CACAGGGTCTTTAATTAATCTGG | 369 |
| 76 | CAAAAATTATCCGGGCATTGTGG | 370 |
| 76 | AGTCTGAACGCAGACCCCTCTGG | 371 |
| 76 | AGACCAACCTGCTCAACATAGGG | 372 |
| 76 | AATTACTTGAACCCTAGAGTCGG | 373 |
| 75 | CTCCATGGTGGCATGCACTTTGG | 374 |
| 75 | AGAACACAGATTCCCGAAAGAGG | 375 |
| 75 | AAAAATAAGGGTCGGGTGAGGGG | 376 |
| 74 | TCCCAGATTCTTATATGGGAGGG | 377 |
| 74 | TCCATGGTGGCATGCACTTTGGG | 378 |
| 74 | CTGAATAAACGGGGCTGCCTGGG | 379 |
| 74 | CAGACCAGCCTGACCAACATGGG | 380 |
| 74 | ATAAAAATAAGGGTCGGGTGAGG | 381 |
| 73 | AGGACTCCCAGATTCTTATATGG | 382 |
| 73 | ACGATCATTGTTCCCTGGAAAGG | 383 |
| 72 | GTTCTCTTGCTTTAGGACCCAGG | 384 |
| 72 | CTGCCCCTCTGATTTGCACCTGG | 385 |

[ Fig. 20-7]

| | | |
|---|---|---|
| 72 | ATTAGAGTTCTGGCTGGGCGTGG | 386 |
| 72 | AAGACCAACCTGCTCAACATAGG | 387 |
| 71 | TCTTCAGTACTCACCTATAATGG | 388 |
| 71 | TCCTGGGTTACCAATGAGATGGG | 389 |
| 71 | TAGTCCCTCAACCTCCTACAGGG | 390 |
| 71 | CTTAAGCCCTGTACTGTGCCAGG | 391 |
| 71 | CCTGGGTTACCAATGAGATGGGG | 392 |
| 71 | AAAGGGGCAGTAATTGTCCAAGG | 393 |
| 70 | TGTTTGAGCCCAAGAGATTGAGG | 394 |
| 70 | TGGGGTGGCTACTCACCAGACGG | 395 |
| 70 | TGAATACGATGGTGAAACTGAGG | 396 |
| 70 | TCTCATTGTGTCACCCGGGCTGG | 397 |
| 70 | GCTTGTAGTTCCAGCTGTTTGGG | 398 |
| 70 | ATACAAAGATTAGCCTGGTGTGG | 399 |
| 70 | AGCTTGTAGTTCCAGCTGTTTGG | 400 |
| 70 | ACAGGTATCTCTGGTTCTTGAGG | 401 |
| 69 | TCCCAAAGTGCATGCCACCATGG | 402 |
| 69 | CAGGCTACTCTTGAACTCTTGGG | 403 |
| 69 | AATCAAGCCTTGTTAAAACCAGG | 404 |
| 68 | TGCTTTAGGACCCAGGGGTCTGG | 405 |
| 68 | TCACCCGGGCTGGAGTACGGTGG | 406 |
| 68 | GGGCTTAAGAAATAGGATCTTGG | 407 |
| 68 | AGCTTGTAAACTTAGCACTTTGG | 408 |
| 68 | AGAGCCACCGTACTCCAGCCCGG | 409 |
| 68 | AAATTTCTGCCTACTGAGACAGG | 410 |
| 67 | TTCCTGGGTTACCAATGAGATGG | 411 |
| 67 | TGAAACTGAGGTCCTAGCTTAGG | 412 |
| 67 | TCACATATAAATGAATACGATGG | 413 |
| 67 | GATTTGATGAGATCTCACAGCGG | 414 |
| 67 | GAGGTGGGGACAGGTATCTCTGG | 415 |
| 67 | CCTGGAAAGGTGGAGTTCAAGGG | 416 |
| 67 | CCATGTTGGTCAGGCTGGTCTGG | 417 |
| 67 | ATGGTGGCATGCACTTTGGGAGG | 418 |
| 67 | AGTTGCCAAAACTTGCTATTTGG | 419 |
| 67 | AGTTCAAGGGCCTGAACTCTTGG | 420 |
| 67 | AGCAAGCTGTGACTTGTTCTAGG | 421 |
| 66 | TGTGGCCAGCCCCATCTCATTGG | 422 |
| 66 | GGCTTAAGAAATAGGATCTTGGG | 423 |
| 66 | CCAGTTTCTCTCTGTCGCCCAGG | 424 |
| 65 | CCAGATTCTTATATGGGAGGGGG | 425 |
| 65 | ATCACACAAATTAAGAGTACAGG | 426 |
| 65 | ACTGAATAAACGGGGCTGCCTGG | 427 |
| 64 | TAAGAAATAGGATCTTGGGCTGG | 428 |
| 64 | GGTTACCAATGAGATGGGGCTGG | 429 |
| 64 | GCGCAGCGGCTCATGCCTGTGGG | 430 |
| 64 | GAACGCAGACCCCTCTGGCCTGG | 431 |
| 64 | CTGAGGCAGAGGCCTAAGCTAGG | 432 |
| 64 | CAGTACAGGGCTTAAGAAATAGG | 433 |
| 64 | CACTGCAGCCTCAATCTCTTGGG | 434 |
| 64 | CAAGAGTTCAAGAGTAGCCTGGG | 435 |
| 64 | AAAATAAGGGTCGGGTGAGGGGG | 436 |
| 63 | TACAGGAAGGCTGTTGGGTCCGG | 437 |
| 63 | GTATCTCTGGTTCTTGAGGCAGG | 438 |
| 63 | CCCAGCTACTACGGAGGCTGAGG | 439 |
| 63 | CAAGTGCCCGCCACCACACCAGG | 440 |
| 63 | ACAGAAAAATTAGCCAGGCGTGG | 441 |
| 62 | GGTCTTGAACTCCTGTCCTCAGG | 442 |
| 62 | GCAACCACCTCCTGGGTTCAAGG | 443 |
| 62 | GATTAGCCTGGTGTGGTGGCGGG | 444 |

[ Fig. 20-8]

| | | |
|---|---|---|
| 62 | CCAAGAGTTCAAGAGTAGCCTGG | 445 |
| 62 | CAAGGTGGGTGCATCACCTGAGG | 446 |
| 62 | ATAGGTGAGTACTGAAGACCAGG | 447 |
| 62 | AGACACCCTGCAGGGGGACCAGG | 448 |
| 62 | ACAGAGTGAGAACTCCATGGTGG | 449 |
| 61 | TAAAACCAGGTGCAAATCAGAGG | 450 |
| 61 | GGTCTTGAACTCCTGACCTCAGG | 451 |
| 61 | GCTTGTAAACTTAGCACTTTGGG | 452 |
| 61 | GAGATGGGGCTGGCCACAAAGGG | 453 |
| 61 | CTGGAGGATTGTCTGAGCCCAGG | 454 |
| 61 | CCCCCTTTTCCCAGGGAATCAGG | 455 |
| 61 | CAGGCACATGCCACTACACCAGG | 456 |
| 61 | AAAAAATTAGCCTGGTGTAGTGG | 457 |
| 60 | TTCTCTTGCTTTAGGACCCAGGG | 458 |
| 60 | TGAGATGGGGCTGGCCACAAAGG | 459 |
| 60 | TCTCTTGCTTTAGGACCCAGGGG | 460 |
| 60 | TCACTGCAGCTTTGAATTCCTGG | 461 |
| 60 | TACTCAGCATCCCAAACAGCTGG | 462 |
| 60 | GGCTCACTGCAACCACCTCCTGG | 463 |
| 60 | GGCAGCAGGTTTGGGATTCTAGG | 464 |
| 60 | GCTCATGCCTGTGGGAGCCGAGG | 465 |
| 60 | CCTTGAACTCCACCTTTCCAGGG | 466 |
| 60 | CCGAGGCCCAGCACTTTGGGAGG | 467 |
| 60 | CACAAATTAAGAGTACAGGAAGG | 468 |
| 60 | AGCGGCCCATTTTACAGAGAAGG | 469 |
| 60 | AGAGGCCCTGTAGGAGGTTGAGG | 470 |
| 60 | AAGGATATCTGGGATGGGATTGG | 471 |
| 59 | TGGGGTCTCATTGTGTCACCCGG | 472 |
| 59 | GGAGCCGAGGCCCAGCACTTTGG | 473 |
| 59 | CTCTCCCTGATTTTACAAACAGG | 474 |
| 59 | CACAGATTCCCGAAAGAGGAAGG | 475 |
| 59 | CAAAGATTAGCCTGGTGTGGTGG | 476 |
| 59 | AAGAGTACAGGAAGGCTGTTGGG | 477 |
| 58 | TTTAAAATTAGAGTTCTGGCTGG | 478 |
| 58 | TGGGTGCATCACCTGAGGTCAGG | 479 |
| 58 | GTTCAAATAAAGAACAGGGCTGG | 480 |
| 58 | GCCTGTGGTCCCAGGTACTCAGG | 481 |
| 58 | GAAACTGTGTTTACAAACTGTGG | 482 |
| 58 | AGGATATCTGGGATGGGATTGGG | 483 |
| 58 | AGCTGGGGGGACTGAATAAACGG | 484 |
| 57 | TTAAAATTAGAGTTCTGGCTGGG | 485 |
| 57 | TGTCTCAGTAGGCAGAAATTTGG | 486 |
| 57 | TGACACAGAGGCCCTGTAGGAGG | 487 |
| 57 | GCAACAGAGTGAGAACTCCATGG | 488 |
| 57 | GAGCTGGGAACTCAGATTCCTGG | 489 |
| 57 | CCCTTGAACTCCACCTTTCCAGG | 490 |
| 57 | CATGTGCAAAACCCTGAGCCTGG | 491 |
| 57 | CACTGCAGCTTTGAATTCCTGGG | 492 |
| 57 | ATTTGCACCTGGTTTTAACAAGG | 493 |
| 57 | AGCTGTTTGGGATGCTGAGTAGG | 494 |
| 56 | TGGTCCCCCTGCAGGGTGTCTGG | 495 |
| 56 | TCTTGGTTGCCCAGGCCAGAGGG | 496 |
| 56 | GGTCCCCCTGCAGGGTGTCTGGG | 497 |
| 56 | GGGATTTTACCATGTTGGTCAGG | 498 |
| 56 | GAGGCCCTGTAGGAGGTTGAGGG | 499 |
| 56 | CCTGGGCGACAGAGAGAAACTGG | 500 |
| 56 | CCCTGGAAAGGTGGAGTTCAAGG | 501 |
| 56 | CCCTGAGCCTGGCACAGTACAGG | 502 |
| 56 | AGAATCCCAAACCTGCTGCCTGG | 503 |

[ Fig. 20-9]

| | | |
|---|---|---|
| 56 | AACGCAGACCCCTCTGGCCTGGG | 504 |
| 55 | TTTCTGCCTACTGAGACAGGAGG | 505 |
| 55 | TCTAGGTTCAAATAAAGAACAGG | 506 |
| 55 | TAAGAGTACAGGAAGGCTGTTGG | 507 |
| 55 | GTGACTTGTTCTAGGTCATATGG | 508 |
| 55 | GGGAGGAAAATAAGGATATCTGG | 509 |
| 55 | GCTTTAGGACCCAGGGGTCTGGG | 510 |
| 55 | AGCTGGGAACTCAGATTCCTGGG | 511 |
| 55 | AAGAAATAGGATCTTGGGCTGGG | 512 |
| 54 | TTGGGAAATGGTATGAGGTAGGG | 513 |
| 54 | TGTAAACTTAGCACTTTGGGAGG | 514 |
| 54 | GGTGTAGTGGCATGTGCCTGTGG | 515 |
| 54 | CAGGTGCAAATCAGAGGGGCAGG | 516 |
| 54 | ACTCACAGAGGGTCAGCAGCTGG | 517 |
| 54 | AAGAAAGGGGTGACTCACAGAGG | 518 |
| 53 | TTCCCAGCTCCTATCTCCTCTGG | 519 |
| 53 | TGGAGACCCAGACACCCTGCAGG | 520 |
| 53 | GAGCCACCGTACTCCAGCCCGGG | 521 |
| 53 | CCTGGGTCCTCGGGCCTCCTGGG | 522 |
| 53 | AGATTAGCCTGGTGTGGTGGCGG | 523 |
| 53 | AGAGTTCTGGCTGGGCGTGGTGG | 524 |
| 52 | TGTTTGTAATCCCAACACTTTGG | 525 |
| 52 | TGCTGGGCCTCGGCTCCCACAGG | 526 |
| 52 | TCCTGAGTACCTGGGACCACAGG | 527 |
| 52 | GTTCTTTTCAAAACCCTTTGTGG | 528 |
| 52 | GGGAAGGAGGAAAATCACCTTGG | 529 |
| 52 | GCTCACTGCAACCACCTCCTGGG | 530 |
| 52 | GCTACTACGGAGGCTGAGGCAGG | 531 |
| 52 | CTTGGTTGCCCAGGCCAGAGGGG | 532 |
| 52 | CTGAAGACCAGGAACTTCTGAGG | 533 |
| 52 | CGGGTGGATCACCTGAGGACAGG | 534 |
| 51 | TTTGGGAAATGGTATGAGGTAGG | 535 |
| 51 | TCCCAGAGGAGATAGGAGCTGGG | 536 |
| 51 | GTGATGTCTGTGTGACACAGAGG | 537 |
| 51 | GGAGGAAAATAAGGATATCTGGG | 538 |
| 51 | CTTTTCCAAATAGCAAGTTTTGG | 539 |
| 51 | ATTCCCTGGGAAAAGGGGGCTGG | 540 |
| 51 | AGCCAGGACTCCTGATTCCCTGG | 541 |
| 51 | AAAATAAGGATATCTGGGATGGG | 542 |
| 50 | TCAAATAAAGAACAGGGCTGGGG | 543 |
| 50 | GTGTGACACAGAGGCCCTGTAGG | 544 |
| 50 | GGTCTGGAACTCCTGACCTCAGG | 545 |
| 50 | CTGCTGCCTGGTCCCCCTGCAGG | 546 |
| 50 | CGAGGCGGGTGGATCACCTGAGG | 547 |
| 50 | AAACCAGGTGCAAATCAGAGGGG | 548 |
| 50 | AAACACAGTTTCAAAAGGTCAGG | 549 |
| 49 | TTTCATCTTCTGGGGCTCCCAGG | 550 |
| 49 | TTCCCAGAGGAGATAGGAGCTGG | 551 |
| 49 | TGGGAGCCCCAGAAGATGAAAGG | 552 |
| 49 | TCTTTTCTCATTCCCCTTAGTGG | 553 |
| 49 | TATTTGTCTTGGGGTAAGGAAGG | 554 |
| 49 | GTTTGTAATCCCAACACTTTGGG | 555 |
| 49 | GCCTGGGTCCTCGGGCCTCCTGG | 556 |
| 49 | CAGGTGCGTCCCACCACACCCGG | 557 |
| 49 | ATCATTGTTCCCTGGAAAGGTGG | 558 |
| 49 | AATGAATAAAAATAAGGGTCGGG | 559 |
| 49 | AAAACCAGGTGCAAATCAGAGGG | 560 |
| 48 | TTTAAGTAATGAGATGGGAGGGG | 561 |
| 48 | TTCAAATAAAGAACAGGGCTGGG | 562 |

[ Fig. 20-10]

| | | |
|---|---|---|
| 48 | TGAGGCAGAGGGATCACCTGAGG | 563 |
| 48 | TCACTGCAGCCTCAATCTCTTGG | 564 |
| 48 | GAGACCCAGACACCCTGCAGGGG | 565 |
| 48 | GAAAATAAGGATATCTGGGATGG | 566 |
| 48 | CTGCCTACTGAGACAGGAGGAGG | 567 |
| 48 | CCTGAGCCTGGCACAGTACAGGG | 568 |
| 48 | CAGGAGAATCACTTGAACCTGGG | 569 |
| 48 | ACCTCAGCCTCCTGAGTACCTGG | 570 |
| 48 | AATATATTTGTCTTGGGGTAAGG | 571 |
| 47 | TCTTGAGGCAGGAAGAGGTCAGG | 572 |
| 47 | TCCCAGGGAATCAGGAGTCCTGG | 573 |
| 47 | GTGTCACCCGGGCTGGAGTACGG | 574 |
| 47 | GGGAGCCCCAGAAGATGAAAGGG | 575 |
| 47 | GCCTCTGCCTCAGAAGTTCCTGG | 576 |
| 47 | CTCTTGGTTGCCCAGGCCAGAGG | 577 |
| 47 | CTCTTAGCTCCTGAGAGAAGAGG | 578 |
| 47 | CTCCCTCCTCCTGTCTCAGTAGG | 579 |
| 47 | CTCAGGTGATGCACCCACCTTGG | 580 |
| 47 | CCTCCCAAAGTGCTGGGCCTCGG | 581 |
| 47 | CCCAGGAGGCCCGAGGACCCAGG | 582 |
| 47 | CCAGGCTACTCTTGAACTCTTGG | 583 |
| 47 | CAGGCACACACCACAATGCCCGG | 584 |
| 47 | CAACAAAAGGAGAGTGGATGGGG | 585 |
| 47 | ATTCTTATATGGGAGGGGGATGG | 586 |
| 47 | AGAAAGGGGTGACTCACAGAGGG | 587 |
| 46 | TTTTTAAGTAATGAGATGGGAGG | 588 |
| 46 | TGCCTACTGAGACAGGAGGAGGG | 589 |
| 46 | TCTCATTTCCCAGAGGAGATAGG | 590 |
| 46 | GGGGGACCAGGCAGCAGGTTTGG | 591 |
| 46 | GCTATTTAAAATTAGAGTTCTGG | 592 |
| 46 | CCTGATTCCCTGGGAAAAGGGGG | 593 |
| 46 | CAGGAGAATCCCTTGAACCCAGG | 594 |
| 46 | CAGAGGGATCACCTGAGGTCAGG | 595 |
| 46 | AGATTCCCGAAAGAGGAAGGAGG | 596 |
| 45 | CTTAGCACTTTGGGAGGCCGAGG | 597 |
| 45 | ACCAGGAACTTCTGAGGCAGAGG | 598 |
| 44 | TCCTGATTCCCTGGGAAAAGGGG | 599 |
| 44 | TCCCAGCTCCTATCTCCTCTGGG | 600 |
| 44 | GCCAGGACTCCTGATTCCCTGGG | 601 |
| 44 | CATCTTCTGGGGCTCCCAGGAGG | 602 |
| 44 | AAAAATTAGCCGGGTGTGGTGGG | 603 |
| 43 | TTGTTTTGGGAAATGGTATGAGG | 604 |
| 43 | TTCCCTGGGAAAAGGGGGCTGGG | 605 |
| 43 | TGCTGCCTGGTCCCCCTGCAGGG | 606 |
| 43 | TCCCGAAAGAGGAAGGAGGTGGG | 607 |
| 43 | GCCTGAACTCTTGGTTGCCCAGG | 608 |
| 43 | ATTAATCTGGAAGTTGTTTTGGG | 609 |
| 43 | ATGCTAAAAGACAAAACTAGAGG | 610 |
| 43 | ACTCCTGATTCCCTGGGAAAAGG | 611 |
| 43 | ACGGGGCTGCCTGGGTCCTCGGG | 612 |
| 43 | AATTAATCTGGAAGTTGTTTTGG | 613 |
| 42 | TTAAGTAATGAGATGGGAGGGGG | 614 |
| 42 | GAGATGGGATTTTACCATGTTGG | 615 |
| 42 | CTCCTGATTCCCTGGGAAAAGGG | 616 |
| 42 | CAACCACCTCCTGGGTTCAAGGG | 617 |
| 42 | AGTTTCCTGTTTGTAAAATCAGG | 618 |
| 42 | AAAAAAAAATTAGCCGGGTGTGG | 619 |
| 41 | TGGGGCTCCCAGGAGGCCCGAGG | 620 |
| 41 | TCTTAGCTCCTGAGAGAAGAGGG | 621 |

[ Fig. 20-11]

| | | |
|---|---|---|
| 41 | TAGAGGACAAATGATAGTACTGG | 622 |
| 41 | TAATAAAATTACAGAGTTCTGGG | 623 |
| 41 | GCATGCACTTTGGGAGGCTGAGG | 624 |
| 41 | GAGACAGGGTTTCCCCATGTTGG | 625 |
| 41 | CGAGGTGGGAGGATTGCTTGAGG | 626 |
| 41 | ATAAGATTCTCATTTCCCAGAGG | 627 |
| 41 | AACGGGGCTGCCTGGGTCCTCGG | 628 |
| 41 | AAAAAATTAGCCGGGTGTGGTGG | 629 |
| 40 | GGAGACCCAGACACCCTGCAGGG | 630 |
| 40 | GCACCACTGCACTCCGGCCTGGG | 631 |
| 40 | CCAACTTCCCTTTCATCTTCTGG | 632 |
| 40 | ATGGGAGGGGGATGGAAGCCAGG | 633 |
| 40 | AGTCACCCCTTTCTTCTCCCTGG | 634 |
| 40 | AATCTGTGTTCTCTTGCTTTAGG | 635 |
| 40 | AACTTCCCTTTCATCTTCTGGGG | 636 |
| 39 | TGTCAGCAACAAAAGGAGAGTGG | 637 |
| 39 | GTTCCCAGCCCCCTTTTCCCAGG | 638 |
| 39 | GGAGTGCAGTGGTGCAATCTCGG | 639 |
| 39 | CTAGGTTCAAATAAAGAACAGGG | 640 |
| 39 | ATACTATATTGCAAATATTCTGG | 641 |
| 39 | AGACCCAGACACCCTGCAGGGGG | 642 |
| 39 | AAAGGGGTGTCAGCAACAAAAGG | 643 |
| 38 | TTGCTCAGGCAGGAGTGCAGTGG | 644 |
| 38 | TAAAAATACAAAGATTAGCCTGG | 645 |
| 38 | GGGGACCAGGCAGCAGGTTTGGG | 646 |
| 38 | GCAGGAAGAGGTCAGGAGACAGG | 647 |
| 38 | GAGAATCACTTGAACCTGGGAGG | 648 |
| 38 | CTGGTTCTTGAGGCAGGAAGAGG | 649 |
| 38 | CACAGAGGGTCAGCAGCTGGAGG | 650 |
| 38 | CAACTTCCCTTTCATCTTCTGGG | 651 |
| 38 | AAAATCTGAGTAATTGGAAAAGG | 652 |
| 37 | TTCCCAGCCCCCTTTTCCCAGGG | 653 |
| 37 | TGGCATGTGCCTGTGGTCCCAGG | 654 |
| 37 | GGGGTCTCATTGTGTCACCCGGG | 655 |
| 37 | GGGCTGGGGCCCAGACCCCTGGG | 656 |
| 37 | CTCAGGTGATCCACCCGCCTCGG | 657 |
| 37 | CAGAAGATGAAAGGGAAGTTGGG | 658 |
| 37 | CACTTGAACCTGGGAGGCAGAGG | 659 |
| 37 | CAAAATAAAATCTGAGTAATTGG | 660 |
| 36 | TGGGTTCCTGGCTGGGGTTGGGG | 661 |
| 36 | GCCTCAGCCTCCCAAAGTGTTGG | 662 |
| 36 | CTGGAAGTTGTTTTGGGAAATGG | 663 |
| 36 | CCCGAAAGAGGAAGGAGGTGGGG | 664 |
| 36 | CAAAAGGAGAGTGGATGGGGTGG | 665 |
| 36 | ATAATAAAATTACAGAGTTCTGG | 666 |
| 36 | AGCAACAAAAGGAGAGTGGATGG | 667 |
| 35 | TCCCCACCTCCTTCCTCTTTCGG | 668 |
| 35 | GCAACAAAAGGAGAGTGGATGGG | 669 |
| 35 | CTTCTCCCTGGGTTCCTGGCTGG | 670 |
| 35 | AGGGTTTCCCCATGTTGGTCAGG | 671 |
| 35 | AGGGCTGGGGCCCAGACCCCTGG | 672 |
| 34 | TTGTAAAATCAGGGAGAGACTGG | 673 |
| 34 | GTTTCCTGTTTGTAAAATCAGGG | 674 |
| 34 | CTTTCTTCTCCCTGGGTTCCTGG | 675 |
| 34 | CTGCAGGGGGACCAGGCAGCAGG | 676 |
| 34 | CAAGAGAATCGCTTGAACCCAGG | 677 |
| 34 | ACAACTTAAGAAATTTGAAGTGG | 678 |
| 34 | AAAAAAAAGTCTGGGTGTGGTGG | 679 |
| 33 | TTTGTAAACACAGTTTCAAAAGG | 680 |

[ Fig. 20-12]

| | | |
|---|---|---|
| 33 | TCCTGAGAGAAGAGGGAAATGGG | 681 |
| 33 | GGGAAAAGGGGGCTGGGAACAGG | 682 |
| 33 | GGCGCAGCGGCTCATGCCTGTGG | 683 |
| 33 | GGAAACTGAGGCTAAGAAAGGGG | 684 |
| 33 | GCCTCAGCCTCCTGAGTAGCTGG | 685 |
| 33 | GATGAAAGGGAAGTTGGGGAAGG | 686 |
| 33 | AGTAATGAGATGGGAGGGGGCGG | 687 |
| 32 | TTATTTTTAAGTAATGAGATGGG | 688 |
| 32 | TACTGCAACCTCTGCCTCCTGGG | 689 |
| 32 | CCCCATTTCCCTCTTCTCTCAGG | 690 |
| 32 | CAACCCCAGCCAGGAACCCAGGG | 691 |
| 32 | AGGAAACTGAGGCTAAGAAAGGG | 692 |
| 32 | AATCCCTTGAACCCAGGAGGTGG | 693 |
| 32 | AAATCTGAGTAATTGGAAAAGGG | 694 |
| 32 | AAAAGTATTCAAAAAACTATAGG | 695 |
| 31 | TCCTGAGTAGCTGGGATTACAGG | 696 |
| 31 | GCCTCTGCCTCCCAAAGTGCTGG | 697 |
| 31 | CCTGAGAGAAGAGGGAAATGGGG | 698 |
| 31 | CCCTGTACTGTGCCAGGCTCAGG | 699 |
| 30 | CTTTGGGAGGCAGAGGCGGGCGG | 700 |
| 30 | CTACTGAGACAGGAGGAGGGAGG | 701 |
| 30 | CCAGAAGATGAAAGGGAAGTTGG | 702 |
| 30 | CAGGAAGAGGTCAGGAGACAGGG | 703 |
| 30 | ATAGGAAAATATATTTGTCTTGG | 704 |
| 30 | AGGAAAATATATTTGTCTTGGGG | 705 |
| 29 | TTCTCCCTGGGTTCCTGGCTGGG | 706 |
| 29 | TAGGAAAATATATTTGTCTTGGG | 707 |
| 29 | GGAAAAGGGGGCTGGGAACAGGG | 708 |
| 29 | CTTTGGGAGGCCGAGGCGGGTGG | 709 |
| 29 | CCTCAGCCTCCTGAGTACCTGGG | 710 |
| 29 | CCTCAGCCTCCCAAAGTGTTGGG | 711 |
| 29 | CCAACCCCAGCCAGGAACCCAGG | 712 |
| 29 | CAGGAACCCAGGGAGAAGAAAGG | 713 |
| 29 | CAGGAAACTGAGGCTAAGAAAGG | 714 |
| 29 | CACACCACTACACTCCAGCCTGG | 715 |
| 29 | ATTATTTTTAAGTAATGAGATGG | 716 |
| 28 | TTTTAAGTAATGAGATGGGAGGG | 717 |
| 28 | TTCCCGAAAGAGGAAGGAGGTGG | 718 |
| 28 | TGCACCACTGCACTCCGGCCTGG | 719 |
| 28 | GAGAATCGCTTGAACCCAGGAGG | 720 |
| 28 | GAAGAGGTCAGGAGACAGGGAGG | 721 |
| 28 | ATATAAAATAAAAAGTTGTATGG | 722 |
| 28 | AGAAGATGAAAGGGAAGTTGGGG | 723 |
| 27 | TTTCTCTCTGTCGCCCAGGCCGG | 724 |
| 27 | TTACTGCAACCTCTGCCTCCTGG | 725 |
| 27 | GTCACCCCTTTCTTCTCCCTGGG | 726 |
| 27 | GGGGTTTCGCCATGTTGGTCAGG | 727 |
| 27 | GAGAATCCCTTGAACCCAGGAGG | 728 |
| 27 | CTCCTGAGAGAAGAGGGAAATGG | 729 |
| 27 | CTAAGGGGAATGAGAAAAGAAGG | 730 |
| 26 | TTTCTGTTTTTAGTAGAGATGGG | 731 |
| 26 | TCGCCCAGGCTGGAGTGTAGTGG | 732 |
| 26 | GGGTTCCTGGCTGGGGTTGGGGG | 733 |
| 26 | GCACTTTGGGAGGCAGAGGCGGG | 734 |
| 26 | CCCCACCTCCTTCCTCTTTCGGG | 735 |
| 26 | CAATTACTCAGATTTTATTTTGG | 736 |
| 26 | ATTTTACAAACAGGAAACTGAGG | 737 |
| 26 | ACTTGTAGTCCCAGCTACTACGG | 738 |
| 26 | AAAAAAAAAAAGTCTGGGTGTGG | 739 |

[ Fig. 20-13]

| | | |
|---|---|---|
| 25 | TGTAATCCCAGCTACTCAGGAGG | 740 |
| 25 | TGGAGGGAGGGAGGAAAATAAGG | 741 |
| 25 | TAAAAATACAAAAATTATCCGGG | 742 |
| 25 | GGGGAATGAGAAAAGAAGGAAGG | 743 |
| 25 | AGGAACCCAGGGAGAAGAAAGGG | 744 |
| 25 | ACACCACTACACTCCAGCCTGGG | 745 |
| 24 | TTTTATTCATTTTTAGAGATGGG | 746 |
| 24 | TCTCCCTGGGTTCCTGGCTGGGG | 747 |
| 24 | TACTGAGACAGGAGGAGGGAGGG | 748 |
| 24 | CACTGCAACCTCTGCCTCCCAGG | 749 |
| 24 | AGCACTTTGGGAGGCAGAGGCGG | 750 |
| 24 | AAATGAATAAAAATAAGGGTCGG | 751 |
| 23 | TCCTGAGTAGCTGGGACTACAGG | 752 |
| 23 | CCCAGCACTTTGGGAGGCAGAGG | 753 |
| 22 | TTTATTCATTTTTAGAGATGGGG | 754 |
| 22 | GGAACCCAGGGAGAAGAAAGGGG | 755 |
| 22 | GCAGGAGAATCACTTGAACCTGG | 756 |
| 22 | GAGATTGCACCACTGCACTCCGG | 757 |
| 22 | CTTTGGGAGGCTGAGGCAGAGGG | 758 |
| 22 | AAGAGGAAGGAGGTGGGGACAGG | 759 |
| 21 | CTGGGTTCCTGGCTGGGGTTGGG | 760 |
| 21 | CCTGGGTTCCTGGCTGGGGTTGG | 761 |
| 20 | TATTTGGAAAAGAAAAATGTTGG | 762 |
| 20 | TAAAAACAGAAAAATTAGCCAGG | 763 |
| 20 | CTTTGGGAGGCCGAGGTGGGAGG | 764 |
| 20 | CTCAAGCAATCCTCCCACCTCGG | 765 |
| 19 | TTTTACCATGTTGGTCAGGCTGG | 766 |
| 19 | TCGCCCAGGCCGGAGTGCAGTGG | 767 |
| 19 | CTAAAAATACAAAAATTATCCGG | 768 |
| 19 | CCCAGGTACTCAGGAGGCTGAGG | 769 |
| 19 | CATTTCCTTCTCTGTAAAATGGG | 770 |
| 19 | AGGTACTCAGGAGGCTGAGGTGG | 771 |
| 19 | AAGAAGGAAGGAATGGAGGGAGG | 772 |
| 18 | TACTCAGGAGGCTGAGGTGGAGG | 773 |
| 18 | GTTTAAAAAAAAAGAAACACAGG | 774 |
| 18 | GCACTTTGGGAGGCCGAGGCGGG | 775 |
| 18 | CTTTGGGAGGCTGAGGCTGGAGG | 776 |
| 18 | CCTCTGCCTCCCAAAGTGCTGGG | 777 |
| 18 | AGTGCTGGGATTACAGACGTTGG | 778 |
| 17 | TTTTTATTCATTTTTAGAGATGG | 779 |
| 17 | GGGGGCAGAGAGAGAGGCAATGG | 780 |
| 17 | GCGCCACTGCACTCCAGCCTGGG | 781 |
| 17 | CGCGCCACTGCACTCCAGCCTGG | 782 |
| 17 | CCCAACACTTTGGGAGGCTGAGG | 783 |
| 17 | AGAAAAGAAGGAAGGAATGGAGG | 784 |
| 17 | ACTTTGGGAGGCTGAGGCAGAGG | 785 |
| 17 | ACCTCGGCCTCCCAAAGTGCTGG | 786 |
| 16 | TTTCCCCATGTTGGTCAGGCTGG | 787 |
| 16 | GGATTACAGCTGTGAGCCACCGG | 788 |
| 16 | GGAGTCTTGCACTGTCACCCAGG | 789 |
| 16 | GAAAGGGAAGTTGGGGAAGGAGG | 790 |
| 16 | CCATTTTACAGAGAAGGAAATGG | 791 |
| 16 | CCATTTCCTTCTCTGTAAAATGG | 792 |
| 16 | CCAGACCAGCCTGACCAACATGG | 793 |
| 16 | AGGGTCTTGCTCTGTTGCTCAGG | 794 |
| 15 | TCTAAAAATGAATAAAAATAAGG | 795 |
| 15 | GCTACTCAGGAGGCTGAGGCAGG | 796 |
| 15 | CGCTTGAACCCAGGAGGCAGAGG | 797 |
| 15 | CCCAGCTACTCAGGAGGCTGAGG | 798 |

[ Fig. 20-14]

| | | |
|---|---|---|
| 15 | CAAGACCAGCCTGACCAACATGG | 799 |
| 15 | AGCACTTTGGGAGGCCGAGGTGG | 800 |
| 15 | AGCACTTTGGGAGGCCGAGGCGG | 801 |
| 14 | TTTTTTTTTTAGTAGAGACGGGG | 802 |
| 14 | TCTTGCACTGTCACCCAGGCTGG | 803 |
| 14 | CCTCAGCCTCCTGAGTAGCTGGG | 804 |
| 14 | ACCTGTAATCCCAGCTACTCAGG | 805 |
| 14 | ACAAACAAAAAAAACTCTTTTGG | 806 |
| 13 | TTTCGCCATGTTGGTCAGGCTGG | 807 |
| 13 | TCTTTGTATTTTTAGTAGAGAGG | 808 |
| 13 | GGGGTTGGGGGCAGAGAGAGAGG | 809 |
| 13 | CAGCTGTAATCCCAGCACTTTGG | 810 |
| 13 | ATGAGAAAAGAAGGAAGGAATGG | 811 |
| 13 | AGACCAGCCTGACCAACATGGGG | 812 |
| 12 | TTTTTTTTTTTAGTAGAGACGGG | 813 |
| 12 | GCCTGTAGTCCCAGCTACTCAGG | 814 |
| 12 | GCACTTTGGGAGGCTGAGGCTGG | 815 |
| 12 | GCACTTTGGGAGGCCAAGGTGGG | 816 |
| 12 | GAAAAGAAGGAAGGAATGGAGGG | 817 |
| 12 | CTCTGCCCCCAACCCCAGCCAGG | 818 |
| 11 | CGTCTGTAATCCCAGCACTTTGG | 819 |
| 10 | TTTTCTGTTTTTAGTAGAGATGG | 820 |
| 10 | TTTAAAAAAAAAGAAACACAGGG | 821 |
| 10 | TGTAATCCCAACACTTTGGGAGG | 822 |
| 10 | TCTTGCTCTGTTGCTCAGGCAGG | 823 |
| 10 | CTAAAAATGAATAAAAATAAGGG | 824 |
| 10 | CCCAGCACTTTGGGAGGCCGAGG | 825 |
| 10 | AGAGTCTCACTCTGTCGCCCAGG | 826 |
| 10 | AGAAGGAAGGAATGGAGGGAGGG | 827 |
| 9 | TGTGGTCCCAGGTACTCAGGAGG | 828 |
| 9 | GCCTCGGCCTCCCAAAGTGCTGG | 829 |
| 9 | CATGCCACTGCACTCCAGCCTGG | 830 |
| 9 | AGCTGTAATCCCAGCACTTTGGG | 831 |
| 7 | TAAAAAAAAAAAAAATTAGCCTGG | 832 |
| 7 | CCTTTTTTTTTTTTTGTCTGAGG | 833 |
| 7 | CCTCGGCCTCCCAAAGTGCTGGG | 834 |
| 7 | ATGCCACTGCACTCCAGCCTGGG | 835 |
| 7 | ACCTTGGCCTCCCAAAGTGCTGG | 836 |
| 6 | TTTGTATTTTTAGTAGAGAGGGG | 837 |
| 6 | GTCTGTAATCCCAGCACTTTGGG | 838 |
| 6 | CCCAGCACTTTGGGAGGCCAAGG | 839 |
| 6 | CACCTGTAATCCCAGCACTTTGG | 840 |
| 5 | TTGTTTGTTTGTTTTTGAAGTGG | 841 |
| 5 | TTGCCCAGGCTGGAGTGCAGTGG | 842 |
| 5 | TCTCACTCTGTCGCCCAGGCTGG | 843 |
| 5 | AGCACTTTGGGAGGCCAAGGTGG | 844 |
| 4 | TTTTTTTTTTTTAGTAGAGACGG | 845 |
| 4 | TTGTATTTTTAGTAGAGACAGGG | 846 |
| 4 | TGTAGTCCCAGCTACTCAGGAGG | 847 |
| 4 | TCACCCAGGCTGGAGTGCAGTGG | 848 |
| 4 | CCTTGGCCTCCCAAAGTGCTGGG | 849 |
| 4 | CCTCAGACAAAAAAAAAAAAAGG | 850 |
| 4 | AGGAAGGAATGGAGGGAGGGAGG | 851 |
| 4 | AATAAATAAATAAAATAAATAGG | 852 |
| 4 | AAAAAAAAAAAAAATTAGCCGGG | 853 |
| 3 | TGTAATCCCAGCACTTTGGGAGG | 854 |
| 3 | TCTCACTCTGTTGCCCAGGCTGG | 855 |
| 3 | ACCTGTAATCCCAGCACTTTGGG | 856 |
| 3 | AAAAAAAAAAAAAAATTAGCCGG | 857 |

[ Fig. 20-15]

| | | | |
|---|---|---|---|
| | 2 | TTTGTATTTTTAGTAGAGACAGG | 858 |
| | 2 | TCCCAAAGTGCTGGGATTACAGG | 859 |
| | 2 | CTTTGTATTTTTAGTAGAGAGGG | 860 |
| | 1 | TTTTTTTTTTTTTTTGAGGCAGG | 861 |
| | 1 | TTTTTTTTTTTTTTGAGGCAGGG | 862 |
| | 0 | TTTTTTTTTTTTTTTTTTTGAGG | 863 |
| | 0 | AAAAAAAAAAAAAAAAAGTCTGGG | 864 |
| | 0 | AAAAAAAAAAAAAAAAAGTCTGG | 865 |
| V1/I3 | 83 | CTCACCTATAATGGCCACTAAGG | 866 |
| V3/I3 | 82 | CACCTATAATGGCCACTAAGGGG | 867 |
| | 81 | TCACCTATAATGGCCACTAAGGG | 868 |
| | 79 | TTCCCCTTAGTGGCCATTATAGG | 869 |
| | 78 | CACACAGACATCACTCCGTCTGG | 870 |
| | 71 | TCTTCAGTACTCACCTATAATGG | 871 |
| | 70 | TGGGGTGGCTACTCACCAGACGG | 872 |
| | 70 | TGAATACGATGGTGAAACTGAGG | 873 |
| | 67 | TGAAACTGAGGTCCTAGCTTAGG | 874 |
| | 67 | TCACATATAAATGAATACGATGG | 875 |
| | 67 | AGCAAGCTGTGACTTGTTCTAGG | 876 |
| | 64 | CTGAGGCAGAGGCCTAAGCTAGG | 877 |
| | 62 | ATAGGTGAGTACTGAAGACCAGG | 878 |
| | 60 | AAGGATATCTGGGATGGGATTGG | 879 |
| | 58 | AGGATATCTGGGATGGGATTGGG | 880 |
| | 55 | GTGACTTGTTCTAGGTCATATGG | 881 |
| | 55 | GGGAGGAAAATAAGGATATCTGG | 882 |
| | 52 | CTGAAGACCAGGAACTTCTGAGG | 883 |
| | 51 | AAAATAAGGATATCTGGGATGGG | 884 |
| | 51 | GGAGGAAAATAAGGATATCTGGG | 885 |
| | 49 | TCTTTTCTCATTCCCCTTAGTGG | 886 |
| | 48 | GAAAATAAGGATATCTGGGATGG | 887 |
| | 47 | CAACAAAAGGAGAGTGGATGGGG | 888 |
| | 47 | GCCTCTGCCTCAGAAGTTCCTGG | 889 |
| | 45 | ACCAGGAACTTCTGAGGCAGAGG | 890 |
| | 39 | TGTCAGCAACAAAAGGAGAGTGG | 891 |
| | 39 | AAAGGGGTGTCAGCAACAAAAGG | 892 |
| | 38 | AAAATCTGAGTAATTGGAAAAGG | 893 |
| | 37 | CAAAATAAAATCTGAGTAATTGG | 894 |
| | 36 | AGCAACAAAAGGAGAGTGGATGG | 895 |
| | 36 | CAAAAGGAGAGTGGATGGGGTGG | 896 |
| | 35 | GCAACAAAAGGAGAGTGGATGGG | 897 |
| | 32 | AAATCTGAGTAATTGGAAAAGGG | 898 |
| | 27 | CTAAGGGGAATGAGAAAAGAAGG | 899 |
| | 26 | CAATTACTCAGATTTTATTTTGG | 900 |
| | 25 | TGGAGGGAGGGAGGAAAATAAGG | 901 |
| | 25 | GGGGAATGAGAAAAGAAGGAAGG | 902 |
| | 19 | AAGAAGGAAGGAATGGAGGGAGG | 903 |
| | 17 | AGAAAAGAAGGAAGGAATGGAGG | 904 |
| | 13 | ATGAGAAAAGAAGGAAGGAATGG | 905 |
| | 12 | GAAAAGAAGGAAGGAATGGAGGG | 906 |
| | 10 | AGAAGGAAGGAATGGAGGGAGGG | 907 |
| | 4 | AGGAAGGAATGGAGGGAGGGAGG | 908 |
| V1/I4 | 91 | TACTTGAACCCTAGAGTCGGAGG | 909 |
| V3/I4 | 90 | GAGCATTCGCTATATTGCCCAGG | 910 |
| V4/I3 | 89 | GCGGTCTCCCTATGTTGAGCAGG | 911 |
| V6/I3 | 87 | AACTGCAGCCTCCGACTCTAGGG | 912 |
| | 85 | CAAGCTAGCACTACCACGCCTGG | 913 |
| | 83 | CTCACCTATAATGGCCACTAAGG | 914 |
| | 83 | GGGGTTTCACCACATTAGCCAGG | 915 |
| | 83 | AGGTCAGATCGAGATCATCCTGG | 916 |

[ Fig. 20-16]

| | | |
|---|---|---|
| 83 | CTCACCTATAATGGCCACTAAGG | 917 |
| 82 | CACCTATAATGGCCACTAAGGGG | 918 |
| 82 | TAACTGCAGCCTCCGACTCTAGG | 919 |
| 81 | TCACCTATAATGGCCACTAAGGG | 920 |
| 81 | TAAAAATAAGGGTCGGGTGAGGG | 921 |
| 79 | TTCCCCTTAGTGGCCATTATAGG | 922 |
| 79 | GCAGGTTGGTCTTAAACTACTGG | 923 |
| 78 | AGGAAGGCTGTTGGGTCCGGTGG | 924 |
| 77 | TCTCCCTATGTTGAGCAGGTTGG | 925 |
| 77 | CGAGATCATCCTGGCTAATGTGG | 926 |
| 77 | GGATCTTGGGCTGGGCGCAATGG | 927 |
| 77 | GCAGAGGCGGGCGGATCACAAGG | 928 |
| 76 | AGACCAACCTGCTCAACATAGGG | 929 |
| 76 | CAAAAATTATCCGGGCATTGTGG | 930 |
| 76 | AATTACTTGAACCCTAGAGTCGG | 931 |
| 76 | CACAGGGTCTTTAATTAATCTGG | 932 |
| 75 | CTCCATGGTGGCATGCACTTTGG | 933 |
| 75 | AAAAATAAGGGTCGGGTGAGGGG | 934 |
| 74 | CTGAATAAACGGGGCTGCCTGGG | 935 |
| 74 | TCCATGGTGGCATGCACTTTGGG | 936 |
| 74 | ATAAAAATAAGGGTCGGGTGAGG | 937 |
| 74 | CAGACCAGCCTGACCAACATGGG | 938 |
| 72 | AAGACCAACCTGCTCAACATAGG | 939 |
| 72 | CTGCCCCTCTGATTTGCACCTGG | 940 |
| 72 | ATTAGAGTTCTGGCTGGGCGTGG | 941 |
| 71 | TCTTCAGTACTCACCTATAATGG | 942 |
| 71 | AAAGGGGCAGTAATTGTCCAAGG | 943 |
| 71 | CTTAAGCCCTGTACTGTGCCAGG | 944 |
| 71 | TCTTCAGTACTCACCTATAATGG | 945 |
| 70 | TGTTTGAGCCCAAGAGATTGAGG | 946 |
| 70 | TGAATACGATGGTGAAACTGAGG | 947 |
| 70 | TCTCATTGTGTCACCCGGGCTGG | 948 |
| 70 | GCTTGTAGTTCCAGCTGTTTGGG | 949 |
| 70 | AGCTTGTAGTTCCAGCTGTTTGG | 950 |
| 69 | CAGGCTACTCTTGAACTCTTGGG | 951 |
| 69 | AATCAAGCCTTGTTAAAACCAGG | 952 |
| 69 | TCCCAAAGTGCATGCCACCATGG | 953 |
| 68 | AGCTTGTAAACTTAGCACTTTGG | 954 |
| 68 | GGGCTTAAGAAATAGGATCTTGG | 955 |
| 68 | AGAGCCACCGTACTCCAGCCCGG | 956 |
| 68 | TCACCCGGGCTGGAGTACGGTGG | 957 |
| 67 | GATTTGATGAGATCTCACAGCGG | 958 |
| 67 | TGAAACTGAGGTCCTAGCTTAGG | 959 |
| 67 | TCACATATAAATGAATACGATGG | 960 |
| 67 | AGCAAGCTGTGACTTGTTCTAGG | 961 |
| 67 | ATGGTGGCATGCACTTTGGGAGG | 962 |
| 67 | CCATGTTGGTCAGGCTGGTCTGG | 963 |
| 67 | AGTTGCCAAAACTTGCTATTTGG | 964 |
| 66 | GGCTTAAGAAATAGGATCTTGGG | 965 |
| 66 | CCAGTTTCTCTCTGTCGCCCAGG | 966 |
| 65 | ACTGAATAAACGGGGCTGCCTGG | 967 |
| 65 | ATCACACAAATTAAGAGTACAGG | 968 |
| 64 | CAAGAGTTCAAGAGTAGCCTGGG | 969 |
| 64 | CACTGCAGCCTCAATCTCTTGGG | 970 |
| 64 | TAAGAAATAGGATCTTGGGCTGG | 971 |
| 64 | CAGTACAGGGCTTAAGAAATAGG | 972 |
| 64 | CTGAGGCAGAGGCCTAAGCTAGG | 973 |
| 64 | AAAATAAGGGTCGGGTGAGGGGG | 974 |
| 63 | TACAGGAAGGCTGTTGGGTCCGG | 975 |

[ Fig. 20-17]

| | | |
|---|---|---|
| 63 | ACAGAAAAATTAGCCAGGCGTGG | 976 |
| 62 | ATAGGTGAGTACTGAAGACCAGG | 977 |
| 62 | CCAAGAGTTCAAGAGTAGCCTGG | 978 |
| 62 | ACAGAGTGAGAACTCCATGGTGG | 979 |
| 62 | GCAACCACCTCCTGGGTTCAAGG | 980 |
| 62 | CAAGGTGGGTGCATCACCTGAGG | 981 |
| 61 | AAAAAATTAGCCTGGTGTAGTGG | 982 |
| 61 | CAGGCACATGCCACTACACCAGG | 983 |
| 61 | GCTTGTAAACTTAGCACTTTGGG | 984 |
| 61 | TAAAACCAGGTGCAAATCAGAGG | 985 |
| 61 | CTGGAGGATTGTCTGAGCCCAGG | 986 |
| 61 | GGTCTTGAACTCCTGACCTCAGG | 987 |
| 60 | AGCGGCCCATTTTACAGAGAAGG | 988 |
| 60 | TCACTGCAGCTTTGAATTCCTGG | 989 |
| 60 | GGCTCACTGCAACCACCTCCTGG | 990 |
| 60 | CACAAATTAAGAGTACAGGAAGG | 991 |
| 60 | TACTCAGCATCCCAAACAGCTGG | 992 |
| 59 | CTCTCCCTGATTTTACAAACAGG | 993 |
| 59 | TGGGGTCTCATTGTGTCACCCGG | 994 |
| 59 | AAGAGTACAGGAAGGCTGTTGGG | 995 |
| 58 | GCCTGTGGTCCCAGGTACTCAGG | 996 |
| 58 | GAAACTGTGTTTACAAACTGTGG | 997 |
| 58 | AGCTGGGGGGGACTGAATAAACGG | 998 |
| 58 | TGGGTGCATCACCTGAGGTCAGG | 999 |
| 58 | TTTAAAATTAGAGTTCTGGCTGG | 1000 |
| 57 | ATTTGCACCTGGTTTTAACAAGG | 1001 |
| 57 | CATGTGCAAAACCCTGAGCCTGG | 1002 |
| 57 | GCAACAGAGTGAGAACTCCATGG | 1003 |
| 57 | CACTGCAGCTTTGAATTCCTGGG | 1004 |
| 57 | AGCTGTTTGGGATGCTGAGTAGG | 1005 |
| 57 | TTAAAATTAGAGTTCTGGCTGGG | 1006 |
| 56 | CCCTGAGCCTGGCACAGTACAGG | 1007 |
| 56 | CCTGGGCGACAGAGAGAAACTGG | 1008 |
| 56 | GGGATTTTACCATGTTGGTCAGG | 1009 |
| 55 | GTGACTTGTTCTAGGTCATATGG | 1010 |
| 55 | AAGAAATAGGATCTTGGGCTGGG | 1011 |
| 55 | TAAGAGTACAGGAAGGCTGTTGG | 1012 |
| 54 | GGTGTAGTGGCATGTGCCTGTGG | 1013 |
| 54 | TGTAAACTTAGCACTTTGGGAGG | 1014 |
| 54 | CAGGTGCAAATCAGAGGGGCAGG | 1015 |
| 54 | TTGGGAAATGGTATGAGGTAGGG | 1016 |
| 53 | CCTGGGTCCTCGGGCCTCCTGGG | 1017 |
| 53 | GAGCCACCGTACTCCAGCCCGGG | 1018 |
| 53 | AGAGTTCTGGCTGGGCGTGGTGG | 1019 |
| 52 | CTGAAGACCAGGAACTTCTGAGG | 1020 |
| 52 | TCCTGAGTACCTGGGACCACAGG | 1021 |
| 52 | GGGAAGGAGGAAAATCACCTTGG | 1022 |
| 52 | TGTTTGTAATCCCAACACTTTGG | 1023 |
| 52 | GCTCACTGCAACCACCTCCTGGG | 1024 |
| 51 | TTTGGGAAATGGTATGAGGTAGG | 1025 |
| 51 | CTTTTCCAAATAGCAAGTTTTGG | 1026 |
| 50 | AAACACAGTTTCAAAAGGTCAGG | 1027 |
| 50 | AAACCAGGTGCAAATCAGAGGGG | 1028 |
| 50 | GGTCTGGAACTCCTGACCTCAGG | 1029 |
| 49 | AAAACCAGGTGCAAATCAGAGGG | 1030 |
| 49 | TGGGAGCCCCAGAAGATGAAAGG | 1031 |
| 49 | TTTCATCTTCTGGGGCTCCCAGG | 1032 |
| 49 | GCCTGGGTCCTCGGGCCTCCTGG | 1033 |
| 49 | CAGGTGCGTCCCACCACACCCGG | 1034 |

[ Fig. 20-18]

| | | |
|---|---|---|
| 49 | GTTTGTAATCCCAACACTTTGGG | 1035 |
| 49 | AATGAATAAAAATAAGGGTCGGG | 1036 |
| 49 | TATTTGTCTTGGGGTAAGGAAGG | 1037 |
| 48 | ACCTCAGCCTCCTGAGTACCTGG | 1038 |
| 48 | TCACTGCAGCCTCAATCTCTTGG | 1039 |
| 48 | TTTAAGTAATGAGATGGGAGGGG | 1040 |
| 48 | CCTGAGCCTGGCACAGTACAGGG | 1041 |
| 48 | TGAGGCAGAGGGATCACCTGAGG | 1042 |
| 48 | AATATATTTGTCTTGGGGTAAGG | 1043 |
| 47 | GCCTCTGCCTCAGAAGTTCCTGG | 1044 |
| 47 | CCAGGCTACTCTTGAACTCTTGG | 1045 |
| 47 | CCCAGGAGGCCCGAGGACCCAGG | 1046 |
| 47 | GGGAGCCCCAGAAGATGAAAGGG | 1047 |
| 47 | GTGTCACCCGGGCTGGAGTACGG | 1048 |
| 47 | CAGGCACACACCACAATGCCCGG | 1049 |
| 47 | CTCAGGTGATGCACCCACCTTGG | 1050 |
| 46 | TTTTTAAGTAATGAGATGGGAGG | 1051 |
| 46 | CAGAGGGATCACCTGAGGTCAGG | 1052 |
| 46 | CAGGAGAATCCCTTGAACCCAGG | 1053 |
| 46 | GCTATTTAAAATTAGAGTTCTGG | 1054 |
| 45 | ACCAGGAACTTCTGAGGCAGAGG | 1055 |
| 45 | CTTAGCACTTTGGGAGGCCGAGG | 1056 |
| 44 | CATCTTCTGGGGCTCCCAGGAGG | 1057 |
| 44 | AAAAATTAGCCGGGTGTGGTGGG | 1058 |
| 43 | ACGGGGCTGCCTGGGTCCTCGGG | 1059 |
| 43 | ATGCTAAAAGACAAAACTAGAGG | 1060 |
| 43 | AATTAATCTGGAAGTTGTTTTGG | 1061 |
| 43 | TTGTTTTGGGAAATGGTATGAGG | 1062 |
| 43 | ATTAATCTGGAAGTTGTTTTGGG | 1063 |
| 42 | TTAAGTAATGAGATGGGAGGGGG | 1064 |
| 42 | AGTTTCCTGTTTGTAAAATCAGG | 1065 |
| 42 | AAAAAAAAATTAGCCGGGTGTGG | 1066 |
| 42 | CAACCACCTCCTGGGTTCAAGGG | 1067 |
| 42 | GAGATGGGATTTTACCATGTTGG | 1068 |
| 41 | TAATAAAATTACAGAGTTCTGGG | 1069 |
| 41 | CGAGGTGGGAGGATTGCTTGAGG | 1070 |
| 41 | AACGGGGCTGCCTGGGTCCTCGG | 1071 |
| 41 | TGGGGCTCCCAGGAGGCCCGAGG | 1072 |
| 41 | AAAAAATTAGCCGGGTGTGGTGG | 1073 |
| 41 | GCATGCACTTTGGGAGGCTGAGG | 1074 |
| 41 | GAGACAGGGTTTCCCCATGTTGG | 1075 |
| 41 | TAGAGGACAAATGATAGTACTGG | 1076 |
| 40 | AACTTCCCTTTCATCTTCTGGGG | 1077 |
| 40 | CCAACTTCCCTTTCATCTTCTGG | 1078 |
| 40 | GCACCACTGCACTCCGGCCTGGG | 1079 |
| 39 | GGAGTGCAGTGGTGCAATCTCGG | 1080 |
| 39 | ATACTATATTGCAAATATTCTGG | 1081 |
| 38 | TTGCTCAGGCAGGAGTGCAGTGG | 1082 |
| 38 | CAACTTCCCTTTCATCTTCTGGG | 1083 |
| 37 | TGGCATGTGCCTGTGGTCCCAGG | 1084 |
| 37 | CAGAAGATGAAAGGGAAGTTGGG | 1085 |
| 37 | GGGGTCTCATTGTGTCACCCGGG | 1086 |
| 36 | ATAATAAAATTACAGAGTTCTGG | 1087 |
| 36 | GCCTCAGCCTCCCAAAGTGTTGG | 1088 |
| 36 | CTGGAAGTTGTTTTGGGAAATGG | 1089 |
| 35 | AGGGTTTCCCCATGTTGGTCAGG | 1090 |
| 34 | AAAAAAAAGTCTGGGTGTGGTGG | 1091 |
| 34 | GTTTCCTGTTTGTAAAATCAGGG | 1092 |
| 34 | TTGTAAAATCAGGGAGAGACTGG | 1093 |

[ Fig. 20-19]

| | | |
|---|---|---|
| 34 | CAAGAGAATCGCTTGAACCCAGG | 1094 |
| 34 | ACAACTTAAGAAATTTGAAGTGG | 1095 |
| 33 | AGTAATGAGATGGGAGGGGGCGG | 1096 |
| 33 | TTTGTAAACACAGTTTCAAAAGG | 1097 |
| 33 | GATGAAAGGGAAGTTGGGGAAGG | 1098 |
| 33 | GGAAACTGAGGCTAAGAAAGGGG | 1099 |
| 33 | GCCTCAGCCTCCTGAGTAGCTGG | 1100 |
| 32 | TTATTTTTAAGTAATGAGATGGG | 1101 |
| 32 | AGGAAACTGAGGCTAAGAAAGGG | 1102 |
| 32 | TACTGCAACCTCTGCCTCCTGGG | 1103 |
| 32 | AATCCCTTGAACCCAGGAGGTGG | 1104 |
| 32 | AAAAGTATTCAAAAAACTATAGG | 1105 |
| 31 | TCCTGAGTAGCTGGGATTACAGG | 1106 |
| 31 | CCCTGTACTGTGCCAGGCTCAGG | 1107 |
| 31 | GCCTCTGCCTCCCAAAGTGCTGG | 1108 |
| 30 | CCAGAAGATGAAAGGGAAGTTGG | 1109 |
| 30 | CTTTGGGAGGCAGAGGCGGGCGG | 1110 |
| 30 | ATAGGAAAATATATTTGTCTTGG | 1111 |
| 30 | AGGAAAATATATTTGTCTTGGGG | 1112 |
| 29 | CCTCAGCCTCCTGAGTACCTGGG | 1113 |
| 29 | ATTATTTTTAAGTAATGAGATGG | 1114 |
| 29 | CAGGAAACTGAGGCTAAGAAAGG | 1115 |
| 29 | CCTCAGCCTCCCAAAGTGTTGGG | 1116 |
| 29 | TAGGAAAATATATTTGTCTTGGG | 1117 |
| 28 | TTTTAAGTAATGAGATGGGAGGG | 1118 |
| 28 | AGAAGATGAAAGGGAAGTTGGGG | 1119 |
| 28 | GAGAATCGCTTGAACCCAGGAGG | 1120 |
| 28 | TGCACCACTGCACTCCGGCCTGG | 1121 |
| 28 | ATATAAAATAAAAAGTTGTATGG | 1122 |
| 27 | TTACTGCAACCTCTGCCTCCTGG | 1123 |
| 27 | GAGAATCCCTTGAACCCAGGAGG | 1124 |
| 27 | TTTCTCTCTGTCGCCCAGGCCGG | 1125 |
| 26 | AAAAAAAAAAAAGTCTGGGTGTGG | 1126 |
| 26 | ATTTTACAAACAGGAAACTGAGG | 1127 |
| 26 | GCACTTTGGGAGGCAGAGGCGGG | 1128 |
| 26 | TTTCTGTTTTTAGTAGAGATGGG | 1129 |
| 25 | TGTAATCCCAGCTACTCAGGAGG | 1130 |
| 25 | TAAAAATACAAAAATTATCCGGG | 1131 |
| 24 | AGCACTTTGGGAGGCAGAGGCGG | 1132 |
| 24 | TTTTATTCATTTTTAGAGATGGG | 1133 |
| 24 | AAATGAATAAAAATAAGGGTCGG | 1134 |
| 23 | CCCAGCACTTTGGGAGGCAGAGG | 1135 |
| 23 | TCCTGAGTAGCTGGGACTACAGG | 1136 |
| 22 | TTTATTCATTTTTAGAGATGGGG | 1137 |
| 22 | CTTTGGGAGGCTGAGGCAGAGGG | 1138 |
| 22 | GAGATTGCACCACTGCACTCCGG | 1139 |
| 20 | CTTTGGGAGGCCGAGGTGGGAGG | 1140 |
| 20 | CTCAAGCAATCCTCCCACCTCGG | 1141 |
| 20 | CTTTGGGAGGCCGAGGTGGGAGG | 1142 |
| 20 | CTCAAGCAATCCTCCCACCTCGG | 1143 |
| 20 | TAAAAACAGAAAAATTAGCCAGG | 1144 |
| 20 | TATTTGGAAAAGAAAAATGTTGG | 1145 |
| 19 | AGGTACTCAGGAGGCTGAGGTGG | 1146 |
| 19 | CCCAGGTACTCAGGAGGCTGAGG | 1147 |
| 19 | CATTTCCTTCTCTGTAAAATGGG | 1148 |
| 19 | CTAAAAATACAAAAATTATCCGG | 1149 |
| 19 | TCGCCCAGGCCGGAGTGCAGTGG | 1150 |
| 19 | TTTTACCATGTTGGTCAGGCTGG | 1151 |
| 18 | TACTCAGGAGGCTGAGGTGGAGG | 1152 |

[ Fig. 20-20]

| | | |
|---|---|---|
| 18 | AGTGCTGGGATTACAGACGTTGG | 1153 |
| 18 | CCTCTGCCTCCCAAAGTGCTGGG | 1154 |
| 18 | CTTTGGGAGGCTGAGGCTGGAGG | 1155 |
| 18 | GTTTAAAAAAAAAGAAACACAGG | 1156 |
| 17 | GCGCCACTGCACTCCAGCCTGGG | 1157 |
| 17 | CGCGCCACTGCACTCCAGCCTGG | 1158 |
| 17 | TTTTTATTCATTTTTAGAGATGG | 1159 |
| 17 | ACTTTGGGAGGCTGAGGCAGAGG | 1160 |
| 17 | CCCAACACTTTGGGAGGCTGAGG | 1161 |
| 17 | ACCTCGGCCTCCCAAAGTGCTGG | 1162 |
| 16 | AGGGTCTTGCTCTGTTGCTCAGG | 1163 |
| 16 | GAAAGGGAAGTTGGGGAAGGAGG | 1164 |
| 16 | GGAGTCTTGCACTGTCACCCAGG | 1165 |
| 16 | CCATTTCCTTCTCTGTAAAATGG | 1166 |
| 16 | CCATTTTACAGAGAAGGAAATGG | 1167 |
| 16 | CCAGACCAGCCTGACCAACATGG | 1168 |
| 16 | TTTCCCCATGTTGGTCAGGCTGG | 1169 |
| 16 | GGATTACAGCTGTGAGCCACCGG | 1170 |
| 15 | AGCACTTTGGGAGGCCGAGGTGG | 1171 |
| 15 | CGCTTGAACCCAGGAGGCAGAGG | 1172 |
| 15 | CCCAGCTACTCAGGAGGCTGAGG | 1173 |
| 15 | TCTAAAAATGAATAAAAATAAGG | 1174 |
| 15 | GCTACTCAGGAGGCTGAGGCAGG | 1175 |
| 15 | CAAGACCAGCCTGACCAACATGG | 1176 |
| 14 | ACAAACAAAAAAAACTCTTTTGG | 1177 |
| 14 | CCTCAGCCTCCTGAGTAGCTGGG | 1178 |
| 14 | ACCTGTAATCCCAGCTACTCAGG | 1179 |
| 14 | TCTTGCACTGTCACCCAGGCTGG | 1180 |
| 14 | TTTTTTTTTTTAGTAGAGACGGGG | 1181 |
| 14 | CCTCAGCCTCCTGAGTAGCTGGG | 1182 |
| 13 | AGACCAGCCTGACCAACATGGGG | 1183 |
| 13 | CAGCTGTAATCCCAGCACTTTGG | 1184 |
| 12 | TTTTTTTTTTTTAGTAGAGACGGG | 1185 |
| 12 | GCACTTTGGGAGGCTGAGGCTGG | 1186 |
| 12 | GCCTGTAGTCCCAGCTACTCAGG | 1187 |
| 12 | GCACTTTGGGAGGCCAAGGTGGG | 1188 |
| 11 | CGTCTGTAATCCCAGCACTTTGG | 1189 |
| 10 | TCTTGCTCTGTTGCTCAGGCAGG | 1190 |
| 10 | TGTAATCCCAACACTTTGGGAGG | 1191 |
| 10 | CTAAAAATGAATAAAAATAAGGG | 1192 |
| 10 | TTTTCTGTTTTTAGTAGAGATGG | 1193 |
| 10 | CCCAGCACTTTGGGAGGCCGAGG | 1194 |
| 10 | TTTAAAAAAAAAAGAAACACAGGG | 1195 |
| 9 | TGTGGTCCCAGGTACTCAGGAGG | 1196 |
| 9 | AGCTGTAATCCCAGCACTTTGGG | 1197 |
| 9 | CATGCCACTGCACTCCAGCCTGG | 1198 |
| 7 | TAAAAAAAAAAAAATTAGCCTGG | 1199 |
| 7 | ATGCCACTGCACTCCAGCCTGGG | 1200 |
| 7 | ACCTTGGCCTCCCAAAGTGCTGG | 1201 |
| 7 | CCTCGGCCTCCCAAAGTGCTGGG | 1202 |
| 6 | GTCTGTAATCCCAGCACTTTGGG | 1203 |
| 6 | CCCAGCACTTTGGGAGGCCAAGG | 1204 |
| 6 | CACCTGTAATCCCAGCACTTTGG | 1205 |
| 5 | TTGTTTGTTTGTTTTTGAAGTGG | 1206 |
| 5 | TTGCCCAGGCTGGAGTGCAGTGG | 1207 |
| 5 | AGCACTTTGGGAGGCCAAGGTGG | 1208 |
| 4 | AAAAAAAAAAAAAATTAGCCGGG | 1209 |
| 4 | TCACCCAGGCTGGAGTGCAGTGG | 1210 |
| 4 | TTTTTTTTTTTTAGTAGAGACGG | 1211 |

[ Fig. 20-21]

| | | | |
|---|---|---|---|
| | 4 | TTGTATTTTTAGTAGAGACAGGG | 1212 |
| | 4 | AATAAATAAATAAAATAAATAGG | 1213 |
| | 4 | TGTAGTCCCAGCTACTCAGGAGG | 1214 |
| | 4 | CCTTGGCCTCCCAAAGTGCTGGG | 1215 |
| | 3 | AAAAAAAAAAAAAAAATTAGCCGG | 1216 |
| | 3 | TCTCACTCTGTTGCCCAGGCTGG | 1217 |
| | 3 | ACCTGTAATCCCAGCACTTTGGG | 1218 |
| | 3 | TGTAATCCCAGCACTTTGGGAGG | 1219 |
| | 2 | TTTGTATTTTTAGTAGAGACAGG | 1220 |
| | 2 | TCCCAAAGTGCTGGGATTACAGG | 1221 |
| | 1 | TTTTTTTTTTTTTTTGAGGCAGGG | 1222 |
| | 1 | TTTTTTTTTTTTTTTTGAGGCAGG | 1223 |
| | 0 | AAAAAAAAAAAAAAAAGTCTGGG | 1224 |
| | 0 | AAAAAAAAAAAAAAAAAGTCTGG | 1225 |
| | 0 | TTTTTTTTTTTTTTTTTTTGAGG | 1226 |
| V1/E5 | 93 | TCCAAATCTCCAAGCGGGTTGGG | 1227 |
| V3/E5 | 89 | CCAAATCTCCAAGCGGGTTGGGG | 1228 |
| V4/E4 | 87 | GTCCAAATCTCCAAGCGGGTTGG | 1229 |
| V5/E3 | 86 | CCGGCTACAGTTGTGACCCCTGG | 1230 |
| V6/E4 | 85 | CCCCAACCCGCTTGGAGATTTGG | 1231 |
| V7/E3 | 84 | GCCGGGCACCCCAACCCGCTTGG | 1232 |
| | 84 | CGGCTACAGTTGTGACCCCTGGG | 1233 |
| | 83 | CTCAAGGTCACGTTGACCCCAGG | 1234 |
| | 83 | CCGGGATGTGTCCTCCGAGCTGG | 1235 |
| | 80 | TTGGGGTGCCCGGCATCTCAAGG | 1236 |
| | 80 | AAAGAATTCTGCCAGCTCGGAGG | 1237 |
| | 80 | AGCAGCTCCAGGACATCGCTGGG | 1238 |
| | 79 | TCAACGTGACCTTGAGATGCCGG | 1239 |
| | 78 | GCTTAGGGTGGTATGAAGCTGGG | 1240 |
| | 78 | CTTCATACCACCCTAAGCCATGG | 1241 |
| | 78 | CCAGGGGTCACAACTGTAGCCGG | 1242 |
| | 78 | GCTGCTACCGAAGGCCAGACTGG | 1243 |
| | 78 | CTGCTACCGAAGGCCAGACTGGG | 1244 |
| | 76 | TCAAGGTCACGTTGACCCCAGGG | 1245 |
| | 75 | GGCTTAGGGTGGTATGAAGCTGG | 1246 |
| | 75 | AGAAGGGGAGCGATCTCTCCAGG | 1247 |
| | 75 | GTCCCAGCCCAGCGATGTCCTGG | 1248 |
| | 74 | ATACCACCCTAAGCCATGGCTGG | 1249 |
| | 73 | CAACGTGACCTTGAGATGCCGGG | 1250 |
| | 71 | GAGCTCCCAGCCATGGCTTAGGG | 1251 |
| | 71 | TGCTACCGAAGGCCAGACTGGGG | 1252 |
| | 71 | GCTACCGAAGGCCAGACTGGGGG | 1253 |
| | 70 | CAAGGTCACGTTGACCCCAGGGG | 1254 |
| | 70 | TACCACCCTAAGCCATGGCTGGG | 1255 |
| | 70 | TCCAAGCGGGTTGGGGTGCCCGG | 1256 |
| | 70 | GCTCCAGGACATCGCTGGGCTGG | 1257 |
| | 69 | CTTAGGGTGGTATGAAGCTGGGG | 1258 |
| | 68 | GGCTACAGTTGTGACCCCTGGGG | 1259 |
| | 67 | CCAGCTCGGAGGACACATCCCGG | 1260 |
| | 66 | AGATCGCTCCCCTTCTCTTCCGG | 1261 |
| | 66 | TGAGCTCCCAGCCATGGCTTAGG | 1262 |
| | 66 | CAGCAGCTCCAGGACATCGCTGG | 1263 |
| | 65 | AGATTTGGACTTTTCAAGCCTGG | 1264 |
| | 65 | AGGACACATCCCGGAAGAGAAGG | 1265 |
| | 65 | CAGACTGGGGGCCGGGTGTCTGG | 1266 |
| | 65 | ACTGAATAAACGGGGCTGCCTGG | 1267 |
| | 64 | GGACACATCCCGGAAGAGAAGGG | 1268 |
| | 63 | CTCCCAGCCATGGCTTAGGGTGG | 1269 |
| | 62 | CGAGCTGGCAGAATTCTTTCTGG | 1270 |

[ Fig. 20-22]

| | | | |
|---|---|---|---|
| | 62 | AGGAGGTGACTCCAGCCCAAGGG | 1271 |
| | 62 | CAGACACCCGGCCCCCAGTCTGG | 1272 |
| | 61 | TAGGGTGGTATGAAGCTGGGGGG | 1273 |
| | 60 | TTAGGGTGGTATGAAGCTGGGGG | 1274 |
| | 60 | AGCAGCGGTAACTTCCCCCTTGG | 1275 |
| | 59 | CTGGCCTTCGGTAGCAGCAGCGG | 1276 |
| | 58 | GAAAAGTCCAAATCTCCAAGCGG | 1277 |
| | 58 | AGCTGGGGGGACTGAATAAACGG | 1278 |
| | 58 | GCAGCGGTAACTTCCCCCTTGGG | 1279 |
| | 58 | AGCTGGGGGGACTGAATAAACGG | 1280 |
| | 57 | AAAAGTCCAAATCTCCAAGCGGG | 1281 |
| | 56 | CTCCAGGACATCGCTGGGCTGGG | 1282 |
| | 56 | CCGGCCCCCAGTCTGGCCTTCGG | 1283 |
| | 55 | GACACATCCCGGAAGAGAAGGGG | 1284 |
| | 54 | GGAGGTGACTCCAGCCCAAGGGG | 1285 |
| | 54 | CGGTAACTTCCCCCTTGGGCTGG | 1286 |
| | 53 | CAGAAAGAATTCTGCCAGCTCGG | 1287 |
| | 52 | GATCGCTCCCCTTCTCTTCCGGG | 1288 |
| | 52 | TGGTGACAGGTGAGGTCCTGGGG | 1289 |
| | 51 | CTGGTGACAGGTGAGGTCCTGGG | 1290 |
| | 51 | CAGCGATGTCCTGGAGCTGCTGG | 1291 |
| | 51 | CTGGTGACAGGTGAGGTCCTGGG | 1292 |
| | 50 | GAGGTGACTCCAGCCCAAGGGGG | 1293 |
| | 50 | GCTGGTGACAGGTGAGGTCCTGG | 1294 |
| | 50 | CTGGGCTGGGACCAGACACCCGG | 1295 |
| | 50 | CCGAAGGCCAGACTGGGGGCCGG | 1296 |
| | 49 | CAGGTGAGGTCCTGGGGTCGGGG | 1297 |
| | 48 | GCTGGCAGAATTCTTTCTGGAGG | 1298 |
| | 47 | GCCATGGCTGGGAGCTCAGCCGG | 1299 |
| | 47 | GGCAGAATTCTTTCTGGAGGAGG | 1300 |
| | 47 | GTTACCGCTGCTGCTACCGAAGG | 1301 |
| | 46 | CGAAGGCCAGACTGGGGGCCGGG | 1302 |
| | 44 | GCCGGCTGAGCTCCCAGCCATGG | 1303 |
| | 44 | ACAGGTGAGGTCCTGGGGTCGGG | 1304 |
| | 38 | GAGGAGGTGACTCCAGCCCAAGG | 1305 |
| | 38 | GGAGCTGCTGGTGACAGGTGAGG | 1306 |
| | 37 | GTCCTGGAGCTGCTGGTGACAGG | 1307 |
| | 17 | CACCTGTCACCAGCAGCTCCAGG | 1308 |
| V1/I5 | 92 | GCGAGCGGAAGACGCTCACGCGG | 1309 |
| V3/I5 | 88 | GGAAGACGCTCACGCGGCCCCGG | 1310 |
| V4/I4 | 77 | AGAGACGGGGTGAGAGTCCGGGG | 1311 |
| V5/I3 | 66 | AGAGAGAGAGGTACAGTGCGGGG | 1312 |
| V6/I4 | 64 | AGAGAGAGGTACAGTGCGGGGGG | 1313 |
| V7/I3 | 64 | CAGAGACGGGGTGAGAGTCCGGG | 1314 |
| | 61 | AAACAGAGCGAGCGAGCGAGCGG | 1315 |
| | 59 | GTGGGTGGAACAAGGGAGTTGGG | 1316 |
| | 59 | GACAGATACAGAGACACTAGGGG | 1317 |
| | 59 | GAGAGAGAGGTACAGTGCGGGGG | 1318 |
| | 57 | GCAGCTCCTCTGCAGAGACGGGG | 1319 |
| | 56 | ACAGATACAGAGACACTAGGGGG | 1320 |
| | 54 | AGTGGGTGGAACAAGGGAGTTGG | 1321 |
| | 52 | TGGTGACAGGTGAGGTCCTGGGG | 1322 |
| | 52 | TGGGTGGAACAAGGGAGTTGGGG | 1323 |
| | 52 | TCTCTGCAGAGGAGCTGCCGCGG | 1324 |
| | 51 | CTGGTGACAGGTGAGGTCCTGGG | 1325 |
| | 51 | GAGAGAGAGAGGTACAGTGCGGG | 1326 |
| | 50 | GCTGGTGACAGGTGAGGTCCTGG | 1327 |
| | 50 | GCAGAGACGGGGTGAGAGTCCGG | 1328 |
| | 49 | CAGGTGAGGTCCTGGGGTCGGGG | 1329 |

[ Fig. 20-23]

| | | | |
|---|---|---|---|
| | 48 | CTCTCACCCCGTCTCTGCAGAGG | 1330 |
| | 45 | AGAGAGAGAGAGGTACAGTGCGG | 1331 |
| | 44 | ACAGGTGAGGTCCTGGGGTCGGG | 1332 |
| | 44 | GGGTGGAACAAGGGAGTTGGGGG | 1333 |
| | 43 | GGCAGCTCCTCTGCAGAGACGGG | 1334 |
| | 42 | GAGGAGAAGTGGGTGGAACAAGG | 1335 |
| | 41 | CACTTCTCCTCCCCGACCCCAGG | 1336 |
| | 40 | GGGAGGGACAGAGAGATATAGGG | 1337 |
| | 40 | GGGGAGGGACAGAGAGATATAGG | 1338 |
| | 39 | GACAGGTGAGGTCCTGGGGTCGG | 1339 |
| | 38 | GTGAGGTCCTGGGGTCGGGGAGG | 1340 |
| | 38 | GGAGCTGCTGGTGACAGGTGAGG | 1341 |
| | 38 | TGGGGTCGGGGAGGAGAAGTGGG | 1342 |
| | 37 | GTCCTGGAGCTGCTGGTGACAGG | 1343 |
| | 36 | TGGAACAAGGGAGTTGGGGGAGG | 1344 |
| | 36 | CGGCAGCTCCTCTGCAGAGACGG | 1345 |
| | 35 | AAAGAGAGACAGAGCGAGGCGGG | 1346 |
| | 31 | GGAACAAGGGAGTTGGGGGAGGG | 1347 |
| | 31 | GAAAGAGAGACAGAGCGAGGCGG | 1348 |
| | 29 | AGGGAAAGAGAGACAGAGCGAGG | 1349 |
| | 28 | GGTCGGGGAGGAGAAGTGGGTGG | 1350 |
| | 27 | CTGGGGTCGGGGAGGAGAAGTGG | 1351 |
| | 25 | AGGAGAAGTGGGTGGAACAAGGG | 1352 |
| | 25 | AAGACAGATACAGAGACACTAGG | 1353 |
| | 22 | ACAGAGAAAGCGAGAGACAGAGG | 1354 |
| | 21 | AGAGGCAGAAGGAGAAAGGGAGG | 1355 |
| | 21 | AAAGCGAGAGACAGAGGAGAAGG | 1356 |
| | 18 | CTAGGGGGAGAGAGAGAGACAGG | 1357 |
| | 17 | CACCTGTCACCAGCAGCTCCAGG | 1358 |
| | 15 | AGGGAGGCAGAGAGAGAGGCAGG | 1359 |
| | 15 | AGAGAGGCAGGCAGAGAGAGAGG | 1360 |
| | 15 | AGAAAGAGGCAGAAGGAGAAAGG | 1361 |
| | 15 | AGGGAGGCAGAGAGAGAGGCAGG | 1362 |
| | 13 | AGAGGGAGGCAGAGAGAGGGAGG | 1363 |
| | 13 | AGGCAGGCAGAGAGAGAGGCAGG | 1364 |
| | 12 | GAAAGAGGCAGAAGGAGAAAGGG | 1365 |
| | 12 | AGGCAGGCAGAGAGAGAGGGAGG | 1366 |
| | 11 | AGACAGGCAGAGAGAAAGAGAGG | 1367 |
| | 10 | TAGGGGGAGAGAGAGAGACAGGG | 1368 |
| | 10 | AGGGGGAGAGAGAGAGACAGGGG | 1369 |
| | 10 | AGGGGAGCAGAGAGAGAGAGAGG | 1370 |
| | 10 | GAGAGGCAGGCAGAGAGAGAGGG | 1371 |
| | 10 | AGAAAGGGAGGCAGAGAGAGAGG | 1372 |
| | 10 | AGGCAGACAGAGAGAGAGACAGG | 1373 |
| | 9 | AGAGAGAGGGAGGCAGAGAGAGG | 1374 |
| | 8 | AGGGAGGCAGAGAGAGAGGGAGG | 1375 |
| | 8 | AGAGAGGGAGGCAGAGAGAGAGG | 1376 |
| | 7 | GAAAGGGAGGCAGAGAGAGAGGG | 1377 |
| | 7 | GAGAGAGAGAAAGAGGCAGAAGG | 1378 |
| | 6 | GAGAGAGGGAGGCAGAGAGAGGG | 1379 |
| | 6 | GGGGGGAGAGAGAGAGAAAGAGG | 1380 |
| | 5 | GAGAGGGAGGCAGAGAGAGAGGG | 1381 |
| | 5 | AGAGGCAGAAAGAGAGAGAGAGG | 1382 |
| V1/E6 | 95 | GAGCTTCGTGCTGTACCGCGAGG | 1383 |
| V3/E6 | 95 | CGGGGGAACCTAGTCCGCCTGGG | 1384 |
| V4/E5 | 94 | GGGGTCTAAGGACCGTTCCGCGG | 1385 |
| V5/E4 | 93 | GTTCCCCCGGGTGTAGTCGGAGG | 1386 |
| V6/E5 | 93 | GGGGGAACCTAGTCCGCCTGGGG | 1387 |
| V7/F4 | 92 | AGCTTCGTGCTGTACCGCGAGGG | 1388 |

[ Fig. 20-24]

| | | |
|---|---|---|
| 92 | CGTGCTGTACCGCGAGGGCGTGG | 1389 |
| 92 | CTGCGCTGCGACAGCACGTAGGG | 1390 |
| 92 | TAGGTTCCCCCGGGTGTAGTCGG | 1391 |
| 92 | AAAAGTGACCAGCGCGCCCAGGG | 1392 |
| 92 | GCGCGCTGGTCACTTTTGACTGG | 1393 |
| 91 | GCACGAAGCTCATGTTCCGCAGG | 1394 |
| 91 | GACAGCACGTAGGGCGCGGAGGG | 1395 |
| 91 | TGAAAGGAAGACGCGATTAGTGG | 1396 |
| 90 | TGGGCCGACTTCACGCTGCTGGG | 1397 |
| 90 | AGCAGCGTGAAGTCGGCCCAGGG | 1398 |
| 90 | GCTCAGGGGCGGATACCAGCAGG | 1399 |
| 90 | CAAAAGTGACCAGCGCGCCCAGG | 1400 |
| 90 | GGAATAAAAGCTGGCGAGCGCGG | 1401 |
| 89 | CGCGCAGCGCAGGCTCACGTTGG | 1402 |
| 89 | AGCGCCACCAGCGACGGCCGCGG | 1403 |
| 89 | CTGCGACAGCACGTAGGGCGCGG | 1404 |
| 89 | CCGGGGGAACCTAGTCCGCCTGG | 1405 |
| 89 | CAATCAGCAGGACACGGGCGGGG | 1406 |
| 89 | CCATTTTACAGAGCGCTGATTGG | 1407 |
| 88 | AACGTGAGCCTGCGCTGCGCGGG | 1408 |
| 87 | CAACGTGAGCCTGCGCTGCGCGG | 1409 |
| 87 | GCTGCGCTGCGACAGCACGTAGG | 1410 |
| 86 | CGACAGCACGTAGGGCGCGGAGG | 1411 |
| 86 | CGTGCTGTCGCAGCGCAGCGAGG | 1412 |
| 86 | CTGGGCCGACTTCACGCTGCTGG | 1413 |
| 86 | CAGCAGCGTGAAGTCGGCCCAGG | 1414 |
| 86 | GCTCCTCCGACTACACCCGGGGG | 1415 |
| 86 | GCTGGCTGAGCTCCGCGGAACGG | 1416 |
| 85 | GCTGTACCGCGAGGGCGTGGCGG | 1417 |
| 85 | CGAAGCTCATGTTCCGCAGGCGG | 1418 |
| 85 | GGCTCCTCCGACTACACCCGGGG | 1419 |
| 84 | AGAGTCTGCTTCCACGTTGTGGG | 1420 |
| 83 | CTGGCTCCTCCGACTACACCCGG | 1421 |
| 83 | CAAAGTTGAGGGGGAGTCGATGG | 1422 |
| 83 | CAGGCGGACTAGGTTCCCCCGGG | 1423 |
| 82 | GGACACGGGCGGGGACAATAAGG | 1424 |
| 81 | CGGAGTGGCGGTACTGCAGCGGG | 1425 |
| 81 | GGAGTGGCGGTACTGCAGCGGGG | 1426 |
| 81 | AGTCAGAACCGCGCTCCTGCTGG | 1427 |
| 81 | CCAGGCGGACTAGGTTCCCCCGG | 1428 |
| 81 | CCTCATCTCCCTGGGCGCGCTGG | 1429 |
| 80 | GCGGAGTGGCGGTACTGCAGCGG | 1430 |
| 80 | TGGCTCCTCCGACTACACCCGGG | 1431 |
| 80 | TCGATGGAGGCTTCAACTCCTGG | 1432 |
| 80 | GAACCTAGTCCGCCTGGGGCTGG | 1433 |
| 79 | TTGGCGCCAGGACCCACCACCGG | 1434 |
| 79 | CGTGTGATAGTAGCAGCTGTAGG | 1435 |
| 79 | GTCGCAGCGCAGCGAGGTGCTGG | 1436 |
| 79 | CCAATCAGCAGGACACGGGCGGG | 1437 |
| 79 | AGAACAAAGCTCCCACAACGTGG | 1438 |
| 79 | CAGAGTCTGCTTCCACGTTGTGG | 1439 |
| 79 | CCAATCAGCGCTCTGTAAAATGG | 1440 |
| 79 | GACACGGGCGGGGACAATAAGGG | 1441 |
| 78 | CCGGGCAGCGCCACCAGCGACGG | 1442 |
| 78 | GCTGCCGCGGCCGTCGCTGGTGG | 1443 |
| 78 | CGATGGAGGCTTCAACTCCTGGG | 1444 |
| 78 | AGCTTCTCCGCCACTCAGGTTGG | 1445 |
| 78 | CCCGAGACTTCCAACCTGAGTGG | 1446 |
| 77 | GGCGCCCAGCAGCGTGAAGTCGG | 1447 |

[ Fig. 20-25]

| | | |
|---|---|---|
| 77 | GACTAGACTCCTGGATCTGAGGG | 1448 |
| 77 | CGGCCAGCCCCAGGCGGACTAGG | 1449 |
| 76 | GATTCGAACCCTCTGTCTTCTGG | 1450 |
| 76 | CACAACGTGGAAGCAGACTCTGG | 1451 |
| 75 | GTAGCAGCTGTAGGTGCCGGGGG | 1452 |
| 75 | GCGAGGTGCTGGTCATCAGCTGG | 1453 |
| 75 | ATAGTAGCAGCTGTAGGTGCCGG | 1454 |
| 75 | GAGCTGGAGGACTAGACTCCTGG | 1455 |
| 75 | GGCTGCAGGACTAGACCCCTGGG | 1456 |
| 75 | AGTTGAGGGGGAGTCGATGGAGG | 1457 |
| 75 | ACAGGGCACAGCGGGGTCTAAGG | 1458 |
| 75 | CTACTACTACAGTGAGTAGACGG | 1459 |
| 75 | ACCAATCAGCAGGACACGGGCGG | 1460 |
| 74 | GCTCCCGGACCCCAAAGTCTGGG | 1461 |
| 74 | CCACTCAGGTTGGAAGTCTCGGG | 1462 |
| 74 | GCCACTCAGGTTGGAAGTCTCGG | 1463 |
| 73 | ACGTGGAAGCAGACTCTGGTGGG | 1464 |
| 72 | GGAGCTGCCGCGGCCGTCGCTGG | 1465 |
| 72 | AGTAGCAGCTGTAGGTGCCGGGG | 1466 |
| 72 | AGCTCCCGGACCCCAAAGTCTGG | 1467 |
| 72 | CAGTGAGTAGACGGCAGTGCTGG | 1468 |
| 72 | CCATCTTACAGAGTGCTGATTGG | 1469 |
| 71 | GCGCTGCCCGGGCCGGTGGTGGG | 1470 |
| 71 | CCAATCAGCACTCTGTAAGATGG | 1471 |
| 70 | TAGTAGCAGCTGTAGGTGCCGGG | 1472 |
| 70 | CGAGGTGCTGGTCATCAGCTGGG | 1473 |
| 70 | GGGCTGCAGGACTAGACCCCTGG | 1474 |
| 70 | GGTCCCTAAGTCCACCCCAGGGG | 1475 |
| 70 | GAGACTTCCAACCTGAGTGGCGG | 1476 |
| 70 | TTCAACCCAGGAAGTCCAGCTGG | 1477 |
| 70 | TAGTGAGACGTGAAGCCAGCTGG | 1478 |
| 70 | AGTGAGTAGACGGCAGTGCTGGG | 1479 |
| 70 | TGTAAAATGGACCAATCAGCAGG | 1480 |
| 69 | TGCGCTGCGCGGGCCGCCTGCGG | 1481 |
| 69 | GCAGGCGGCCCGCGCAGCGCAGG | 1482 |
| 69 | AACTTTGAGACTGTAGAGTCAGG | 1483 |
| 69 | CAGCCCCTGGGGTGGACTTAGGG | 1484 |
| 69 | ACTCTACAGTCTCAAAGTTGAGG | 1485 |
| 69 | GGCGGATACCAGCAGGAGCGCGG | 1486 |
| 69 | AACCTGAGTGGCGGAGAAGCTGG | 1487 |
| 69 | TGGACTTCCTGGGTTGAATGGGG | 1488 |
| 68 | GGACTAGACTCCTGGATCTGAGG | 1489 |
| 68 | TCCAGGTCCCCATTCAACCCAGG | 1490 |
| 67 | GCGGGGCCGCCACGCCCTCGCGG | 1491 |
| 67 | GCCAGGACCCACCACCGGCCCGG | 1492 |
| 67 | GACTAGACCCCTGGGTCTGAAGG | 1493 |
| 67 | GTACTGGGGCCCGGGAATCCTGG | 1494 |
| 67 | CCGGCTCCGCCCGCAGACTCTGG | 1495 |
| 67 | CCAGAGTCTGCGGGCGGAGCCGG | 1496 |
| 66 | GTCTCGGGCTGCAGTGCTCCTGG | 1497 |
| 66 | ACCTGAGTGGCGGAGAAGCTGGG | 1498 |
| 65 | CTACAGTCTCAAAGTTGAGGGGG | 1499 |
| 65 | GAGTTCAGGGCCCAGACTTTGGG | 1500 |
| 65 | GCTGGACTTCCTGGGTTGAATGG | 1501 |
| 65 | CTGGACTTCCTGGGTTGAATGGG | 1502 |
| 65 | TGGACCAATCAGCAGGACACGGG | 1503 |
| 64 | ACCGCCACTCCGCGCAGCCCTGG | 1504 |
| 64 | TACTGGGGCCCGGGAATCCTGGG | 1505 |
| 64 | CAGGTCCCTAAGTCCACCCCAGG | 1506 |

[ Fig. 20-26]

| | | |
|---|---|---|
| 64 | TTCCGCGGAGCTCAGCCAGCAGG | 1507 |
| 64 | CGTGGAAGCAGACTCTGGTGGGG | 1508 |
| 64 | AACGTGGAAGCAGACTCTGGTGG | 1509 |
| 63 | CGTCGCTGGTGGCGCTGCCCGGG | 1510 |
| 63 | CCGTCGCTGGTGGCGCTGCCCGG | 1511 |
| 63 | CCTGGACTGCTGGATCAGGAAGG | 1512 |
| 62 | CCCGGGCCGGTGGTGGGTCCTGG | 1513 |
| 62 | GCTGTAGGTGCCGGGGGCGCGGG | 1514 |
| 62 | GGTCTGAGGGCGGAGGTCCTGGG | 1515 |
| 62 | AGGTCCCTAAGTCCACCCCAGGG | 1516 |
| 62 | CAGAGTCTGCGGGCGGAGCCGGG | 1517 |
| 62 | TCTCGGGCTGCAGTGCTCCTGGG | 1518 |
| 61 | GAAGTCGGCCCAGGGCTGCGCGG | 1519 |
| 61 | CCCGGGAATCCTGGGTCTGAGGG | 1520 |
| 61 | TCGGAGGAGCCAGAGTCTGCGGG | 1521 |
| 61 | TCTACAGTCTCAAAGTTGAGGGG | 1522 |
| 61 | CTCTACAGTCTCAAAGTTGAGGG | 1523 |
| 61 | AGTTCAGGGCCCAGACTTTGGGG | 1524 |
| 61 | TGAAGCCAGCTGGACTTCCTGGG | 1525 |
| 61 | CTGGAAAGAAGCTACAGCACAGG | 1526 |
| 60 | TAGACTCCTGGATCTGAGGGAGG | 1527 |
| 60 | AAGTCTGGGCCCTGAACTCCAGG | 1528 |
| 60 | ATGGACCAATCAGCAGGACACGG | 1529 |
| 59 | CCGCCACTCCGCGCAGCCCTGGG | 1530 |
| 59 | AGCTGTAGGTGCCGGGGGCGCGG | 1531 |
| 59 | CCTTCCTGATCCAGCAGTCCAGG | 1532 |
| 58 | CTGCATTCCTGGGGCGGAGGAGG | 1533 |
| 58 | TAGACCCCTGGGTCTGAAGGAGG | 1534 |
| 58 | TCCCAGCTTCTCCGCCACTCAGG | 1535 |
| 58 | TTTCCCAAGGAGTAGCTGAAAGG | 1536 |
| 58 | GAACCCTCTGTCTTCTGGCTTGG | 1537 |
| 58 | CTTACAAGAGGATTGTAAAATGG | 1538 |
| 57 | GCAGCTCCTCTGCAGAGACGGGG | 1539 |
| 57 | CTCCTCCGCCCCAGGAATGCAGG | 1540 |
| 57 | GGTATCCGCCCCTGAGCCCCAGG | 1541 |
| 57 | TAGTAGTAGCAGCTACAGAAAGG | 1542 |
| 57 | TTTCAGCTACTCCTTGGGAAAGG | 1543 |
| 56 | GGTGGCGCTGCCCGGGCCGGTGG | 1544 |
| 56 | CCAGGACCCACCACCGGCCCGGG | 1545 |
| 56 | CCCAGGAATCCTGGGTCTGAGGG | 1546 |
| 56 | GGGGCCTGGACTGCTGGATCAGG | 1547 |
| 56 | CCAGCCCCTGGGGTGGACTTAGG | 1548 |
| 56 | TAGTCCGCCTGGGGCTGGCCGGG | 1549 |
| 56 | CGGGCTGGTCCTCATCTCCCTGG | 1550 |
| 56 | CTAGTCCGCCTGGGGCTGGCCGG | 1551 |
| 56 | CTTCCTTTCAGCTACTCCTTGGG | 1552 |
| 56 | GTAAGACAGAAAAGTTCTCCAGG | 1553 |
| 55 | CGGCCCAGGGCTGCGCGGAGTGG | 1554 |
| 55 | CTGCTGGGCGCCCGCGCCCCCGG | 1555 |
| 55 | GGCCTGCATTCCTGGGGCGGAGG | 1556 |
| 55 | CTCGGGCTGCAGTGCTCCTGGGG | 1557 |
| 55 | AGCTCAGCCAGCAGGACTGTGGG | 1558 |
| 55 | GAACTTTTCTGTCTTACAAGAGG | 1559 |
| 54 | GGCGCTGCCCGGGCCGGTGGTGG | 1560 |
| 54 | GTCTGAGGGCGGAGGTCCTGGGG | 1561 |
| 53 | GGGTCTGAGGGCGGAGGTCCTGG | 1562 |
| 53 | CCCAGGGCTGCGCGGAGTGGCGG | 1563 |
| 53 | AGGAGGCGGGCCGGGCCTCAGGG | 1564 |
| 53 | CCTAAGTCCACCCCAGGGGCTGG | 1565 |

[ Fig. 20-27]

| | | |
|---|---|---|
| 53 | GCTACTCCTTGGGAAAGGCCTGG | 1566 |
| 52 | TCTCTGCAGAGGAGCTGCCGCGG | 1567 |
| 52 | GTGCTGGTCATCAGCTGGGAAGG | 1568 |
| 52 | GGCTGGAAACCTGGAGTTCAGGG | 1569 |
| 52 | AGGGCCCAGACTTTGGGGTCCGG | 1570 |
| 52 | AGCTGATGGCCCCTCTCTCCCGG | 1571 |
| 52 | CCAGCGCGCCCAGGGAGATGAGG | 1572 |
| 52 | CTACAGCACAGGGCACAGCGGGG | 1573 |
| 51 | GGAGTTCAGGGCCCAGACTTTGG | 1574 |
| 51 | AGAGAGGGGCCATCAGCTCCCGG | 1575 |
| 50 | GCTGGTGGCGCTGCCCGGGCCGG | 1576 |
| 50 | GGCTGGGTCCCAGGAATCCTGGG | 1577 |
| 50 | GAGGAGCCAGAGTCTGCGGGCGG | 1578 |
| 50 | GCGGGCGGAGCCGGGAGAGAGGG | 1579 |
| 49 | GGTCCTGGGGCCTGCATTCCTGG | 1580 |
| 49 | GGTCATCAGCTGGGAAGGTGAGG | 1581 |
| 49 | GCCTGGAGTCCTGGGTCTGAGGG | 1582 |
| 49 | GGTCTGAGGGAGGAGGTACTGGG | 1583 |
| 49 | GTCGGAGGAGCCAGAGTCTGCGG | 1584 |
| 49 | CTGTGCTGTAGCTTCTTTCCAGG | 1585 |
| 49 | TCCTGGGTTGAATGGGGACCTGG | 1586 |
| 49 | GACAATAAGGGAATAAAAGCTGG | 1587 |
| 48 | CTCTCACCCCGTCTCTGCAGAGG | 1588 |
| 48 | GGGCCCAGACTTTGGGGTCCGGG | 1589 |
| 48 | TGGAAAGAAGCTACAGCACAGGG | 1590 |
| 46 | GTCCTGGGGCCTGCATTCCTGGG | 1591 |
| 46 | CCCTCAGACCCAGGATTCCCGGG | 1592 |
| 46 | GCTCAGCCAGCAGGACTGTGGGG | 1593 |
| 45 | GGACCTCCGCCCTCAGACCCAGG | 1594 |
| 45 | AGGAATCCTGGGTCTGAGGGAGG | 1595 |
| 45 | CCTCTCCTCCTTCAGACCCAGGG | 1596 |
| 45 | TCCCAGGAATCCTGGGTCTGAGG | 1597 |
| 45 | AACTCCAGGTTTCCAGCCCCTGG | 1598 |
| 45 | TGCAGTGCTCCTGGGGCTCAGGG | 1599 |
| 45 | AGGAAAGGACAGTCCAGCCCAGG | 1600 |
| 45 | CCCGCCCGTGTCCTGCTGATTGG | 1601 |
| 44 | GCTCCTGGGTCTGAGGGCGGAGG | 1602 |
| 44 | CTTCCTGGACCCAGGACTCCAGG | 1603 |
| 44 | GTCTGAGGGAGGAGGTACTGGGG | 1604 |
| 44 | CACCCCAGGGGCTGGAAACCTGG | 1605 |
| 44 | GGACTGCTGGATCAGGAAGGAGG | 1606 |
| 44 | CTTTGGGGTCCGGGAGCTGATGG | 1607 |
| 44 | CTGCAGCCCCACAGTCCTGCTGG | 1608 |
| 44 | GGCGGAGAAGCTGGGACCCTGGG | 1609 |
| 43 | GGCAGCTCCTCTGCAGAGACGGG | 1610 |
| 43 | GCCCGGGAATCCTGGGTCTGAGG | 1611 |
| 43 | GACTGCTGGATCAGGAAGGAGGG | 1612 |
| 43 | ACTCCTGGGTCCAGGAAGAAGGG | 1613 |
| 43 | ACTTCCAAGCCAGAAGACAGAGG | 1614 |
| 42 | ATTCCTGGGGCGGAGGAGGCGGG | 1615 |
| 42 | GCCCCAGGAATGCAGGCCCCAGG | 1616 |
| 42 | TCCCTCAGACCCAGGATTCCCGG | 1617 |
| 42 | TCCCTCAGACCCAGGATTCCTGG | 1618 |
| 42 | GGGCTGGGTCCCAGGAATCCTGG | 1619 |
| 42 | GCCTCTCCTCCTTCAGACCCAGG | 1620 |
| 42 | GGGTCTGAGGGAGGAGGTACTGG | 1621 |
| 42 | GAGCTCAGCCAGCAGGACTGTGG | 1622 |
| 41 | GCCTGGGCTCCTGGGTCTGAGGG | 1623 |
| 41 | GAGGAGGCGGGCCGGGCCTCAGG | 1624 |

[ Fig. 20-28]

| | | |
|---|---|---|
| 41 | CCCTCAGACCCAGGATTCCTGGG | 1625 |
| 41 | CTGGAGTCCTGGGTCCAGGAAGG | 1626 |
| 41 | CTCTCCTCCTTCAGACCCAGGGG | 1627 |
| 41 | GGGAATCCTGGGTCTGAGGGAGG | 1628 |
| 41 | CAGGTTTCCAGCCCCTGGGGTGG | 1629 |
| 41 | CAGGGAGATGAGGACCAGCCCGG | 1630 |
| 41 | AGCTACAGCACAGGGCACAGCGG | 1631 |
| 41 | CTTCCAAGCCAGAAGACAGAGGG | 1632 |
| 40 | CGGCCCGCCTCCTCCGCCCCAGG | 1633 |
| 40 | TGGAGTCCTGGGTCTGAGGGAGG | 1634 |
| 40 | GGGCTGGAAACCTGGAGTTCAGG | 1635 |
| 40 | TGCGGGCGGAGCCGGGAGAGAGG | 1636 |
| 40 | CTCCAGGTTTCCAGCCCCTGGGG | 1637 |
| 39 | TGGCGGAGAAGCTGGGACCCTGG | 1638 |
| 39 | CCGCCTGGGGCTGGCCGGGCTGG | 1639 |
| 38 | AACTCCTGGGTCCAGGAAGAAGG | 1640 |
| 38 | CGGGCGGAGCCGGGAGAGAGGGG | 1641 |
| 38 | GCAGTGCTCCTGGGGCTCAGGGG | 1642 |
| 38 | GCTACAGCACAGGGCACAGCGGG | 1643 |
| 37 | TGGGGCGGAGGAGGCGGGCCGGG | 1644 |
| 37 | ACTCCTGGATCTGAGGGAGGAGG | 1645 |
| 37 | TCCCTCAGACCCAGGACTCCAGG | 1646 |
| 37 | AGCCCCTTCTTCCTGGACCCAGG | 1647 |
| 37 | CTGCAGTGCTCCTGGGGCTCAGG | 1648 |
| 37 | GTCCTGCTGGCTGAGCTCCGCGG | 1649 |
| 36 | CGGCAGCTCCTCTGCAGAGACGG | 1650 |
| 36 | GCCCCTCCTCCCTCAGATCCAGG | 1651 |
| 36 | ACTGCTGGATCAGGAAGGAGGGG | 1652 |
| 36 | AGGCTTCAACTCCTGGGTCCAGG | 1653 |
| 35 | TCCTGGGGCCTGCATTCCTGGGG | 1654 |
| 35 | TGGGCTCCTGGGTCTGAGGGCGG | 1655 |
| 35 | GTACCTCCTCCCTCAGACCCAGG | 1656 |
| 35 | GGGCTGGTCCTCATCTCCCTGGG | 1657 |
| 34 | CATTCCTGGGGCGGAGGAGGCGG | 1658 |
| 34 | CTCCTGGATCTGAGGGAGGAGGG | 1659 |
| 34 | TGGGTCCAGGAAGAAGGGGCTGG | 1660 |
| 34 | CTGGATCAGGAAGGAGGGGCTGG | 1661 |
| 34 | CTCCTGGGTCCAGGAAGAAGGGG | 1662 |
| 34 | GGACCAGCCCGGCCAGCCCCAGG | 1663 |
| 34 | TTCTTTCCAGGCCTTTCCCAAGG | 1664 |
| 33 | CGCAGGCTCACGTTGGCGCCAGG | 1665 |
| 33 | GTCATCAGCTGGGAAGGTGAGGG | 1666 |
| 33 | CTGGGGCGGAGGAGGCGGGCCGG | 1667 |
| 33 | AGGGAGGAGGTACTGGGGCCCGG | 1668 |
| 33 | ACTCCAGGTTTCCAGCCCCTGGG | 1669 |
| 32 | CAGCAGGACTGTGGGGCTGCAGG | 1670 |
| 32 | GGACTGTGGGGCTGCAGGAAAGG | 1671 |
| 31 | GCCCTCAGACCCAGGAGCCCAGG | 1672 |
| 31 | GGGAGGAGGTACTGGGGCCCGGG | 1673 |
| 31 | AGTCCTGGGTCCAGGAAGGAGGG | 1674 |
| 31 | CCCTGGGTCTGAAGGAGGAGAGG | 1675 |
| 31 | TGGATCAGGAAGGAGGGGCTGGG | 1676 |
| 31 | GGAAAGGACAGTCCAGCCCAGGG | 1677 |
| 30 | AAGGTGAGGGCCCTGAGGCCCGG | 1678 |
| 30 | AGCCCCTCCTTCCTGGACCCAGG | 1679 |
| 30 | ATCCTGGGTCTGAGGGAGGAGGG | 1680 |
| 30 | AATCCTGGGTCTGAGGGAGGAGG | 1681 |
| 29 | GTCCTGGGTCCAGGAAGGAGGGG | 1682 |
| 29 | GGTCTGAAGGAGGAGAGGCTGGG | 1683 |

[ Fig. 20-29]

| | | | |
|---|---|---|---|
| | 29 | GGGTCCAGGAAGAAGGGGCTGGG | 1684 |
| | 28 | AGGCCCCAGCCCCTTCTTCCTGG | 1685 |
| | 28 | TCTTCCTTTCAGCTACTCCTTGG | 1686 |
| | 27 | GGCTGGGGGCCTGGAGTCCTGGG | 1687 |
| | 27 | GGCCTGGAGTCCTGGGTCTGAGG | 1688 |
| | 27 | AGTCCTGGGTCTGAGGGAGGAGG | 1689 |
| | 27 | GTGAAGCCAGCTGGACTTCCTGG | 1690 |
| | 26 | GGCCTGGGCTCCTGGGTCTGAGG | 1691 |
| | 26 | TGGGGCCTGCATTCCTGGGGCGG | 1692 |
| | 26 | GGGCTGGGGGCCTGGAGTCCTGG | 1693 |
| | 26 | TGGGTCCAGGAAGGAGGGGCTGG | 1694 |
| | 26 | GGTCCAGGAAGAAGGGGCTGGGG | 1695 |
| | 25 | TCTGAAGGAGGAGAGGCTGGGGG | 1696 |
| | 25 | GATCTGAGGGAGGAGGGGCTGGG | 1697 |
| | 25 | GGGGCTGGGGCCTGGACTGCTGG | 1698 |
| | 25 | GTGCTCCTGGGGCTCAGGGGCGG | 1699 |
| | 24 | GGCTGGGGGCCTGGGCTCCTGGG | 1700 |
| | 24 | GAGTCCTGGGTCCAGGAAGGAGG | 1701 |
| | 24 | GGGCCTGGAGTCCTGGGTCCAGG | 1702 |
| | 24 | GTCTGAAGGAGGAGAGGCTGGGG | 1703 |
| | 24 | GGGTCTGAAGGAGGAGAGGCTGG | 1704 |
| | 23 | TCCTGGATCTGAGGGAGGAGGGG | 1705 |
| | 23 | GGGAGGAGGGGCTGGGTCCCAGG | 1706 |
| | 23 | GGGTCCAGGAAGGAGGGGCTGGG | 1707 |
| | 22 | TCTGAGGGAGGAGGGGCTGCAGG | 1708 |
| | 22 | GGAGGAGAGGCTGGGGGCCTGGG | 1709 |
| | 22 | GATCAGGAAGGAGGGGCTGGGGG | 1710 |
| | 21 | CTGGGAAGGTGAGGGCCCTGAGG | 1711 |
| | 21 | AGGAGGAGAGGCTGGGGGCCTGG | 1712 |
| | 20 | AGGCTGGGGGCCTGGGCTCCTGG | 1713 |
| | 20 | GGTCCAGGAAGGAGGGGCTGGGG | 1714 |
| | 20 | GAGAAGCTGGGACCCTGGGCTGG | 1715 |
| | 20 | CCAGCCCGGCCAGCCCCAGGCGG | 1716 |
| | 19 | GCTCCTCCTCCCTCAGACCCAGG | 1717 |
| | 19 | GGCCCCCAGCCCCTCCTTCCTGG | 1718 |
| | 19 | GTCCAGGAAGGAGGGGCTGGGGG | 1719 |
| | 18 | GCCCCTCCTCCCTCAGACCCAGG | 1720 |
| | 18 | GGAAGGAGGGGCTGGGGGCCTGG | 1721 |
| | 18 | TCTGAGGGAGGAGGAGCTGGAGG | 1722 |
| | 18 | GGATCAGGAAGGAGGGGCTGGGG | 1723 |
| | 17 | TCCTGGGTCTGAGGGAGGAGGGG | 1724 |
| | 15 | GGGTCTGAGGGAGGAGGAGCTGG | 1725 |
| | 14 | GGATCTGAGGGAGGAGGGGCTGG | 1726 |
| | 14 | AGGAAGAAGGGGCTGGGGCCTGG | 1727 |
| V3/E7 | 95 | CGGGGGAACCTAGTCCGCCTGGG | 1728 |
| V4/E6 | 94 | GGGGTCTAAGGACCGTTCCGCGG | 1729 |
| V5/E5 | 93 | GTTCCCCCGGGTGTAGTCGGAGG | 1730 |
| | 93 | GGGGGAACCTAGTCCGCCTGGGG | 1731 |
| | 92 | TAGGTTCCCCCGGGTGTAGTCGG | 1732 |
| | 92 | AAAAGTGACCAGCGCGCCCAGGG | 1733 |
| | 92 | GCGCGCTGGTCACTTTTGACTGG | 1734 |
| | 91 | TGAAAGGAAGACGCGATTAGTGG | 1735 |
| | 90 | GCTCAGGGGCGGATACCAGCAGG | 1736 |
| | 90 | CAAAAGTGACCAGCGCGCCCAGG | 1737 |
| | 90 | GGAATAAAAGCTGGCGAGCGCGG | 1738 |
| | 89 | CCGGGGGAACCTAGTCCGCCTGG | 1739 |
| | 89 | CAATCAGCAGGACACGGGCGGGG | 1740 |
| | 89 | CCATTTTACAGAGCGCTGATTGG | 1741 |
| | 86 | GCTCCTCCGACTACACCCGGGGG | 1742 |

[ Fig. 20-30]

| | | |
|---|---|---|
| 86 | GCTGGCTGAGCTCCGCGGAACGG | 1743 |
| 85 | GGCTCCTCCGACTACACCCGGGG | 1744 |
| 84 | AGAGTCTGCTTCCACGTTGTGGG | 1745 |
| 83 | CAGGCGGACTAGGTTCCCCCGGG | 1746 |
| 83 | CTGGCTCCTCCGACTACACCCGG | 1747 |
| 82 | GGACACGGGCGGGGACAATAAGG | 1748 |
| 81 | AGTCAGAACCGCGCTCCTGCTGG | 1749 |
| 81 | CCAGGCGGACTAGGTTCCCCCGG | 1750 |
| 81 | CCTCATCTCCCTGGGCGCGCTGG | 1751 |
| 80 | TGGCTCCTCCGACTACACCCGGG | 1752 |
| 80 | GAACCTAGTCCGCCTGGGGCTGG | 1753 |
| 79 | CCAATCAGCAGGACACGGGCGGG | 1754 |
| 79 | AGAACAAAGCTCCCACAACGTGG | 1755 |
| 79 | CAGAGTCTGCTTCCACGTTGTGG | 1756 |
| 79 | CCAATCAGCGCTCTGTAAAATGG | 1757 |
| 79 | GACACGGGCGGGGACAATAAGGG | 1758 |
| 78 | AGCTTCTCCGCCACTCAGGTTGG | 1759 |
| 78 | CCCGAGACTTCCAACCTGAGTGG | 1760 |
| 77 | CGGCCAGCCCCAGGCGGACTAGG | 1761 |
| 76 | GATTCGAACCCTCTGTCTTCTGG | 1762 |
| 76 | CACAACGTGGAAGCAGACTCTGG | 1763 |
| 75 | ACAGGGCACAGCGGGGTCTAAGG | 1764 |
| 75 | CTACTACTACAGTGAGTAGACGG | 1765 |
| 75 | ACCAATCAGCAGGACACGGGCGG | 1766 |
| 74 | CCACTCAGGTTGGAAGTCTCGGG | 1767 |
| 74 | GCCACTCAGGTTGGAAGTCTCGG | 1768 |
| 73 | ACGTGGAAGCAGACTCTGGTGGG | 1769 |
| 72 | CAGTGAGTAGACGGCAGTGCTGG | 1770 |
| 72 | CCATCTTACAGAGTGCTGATTGG | 1771 |
| 71 | CCAATCAGCACTCTGTAAGATGG | 1772 |
| 70 | GAGACTTCCAACCTGAGTGGCGG | 1773 |
| 70 | TAGTGAGACGTGAAGCCAGCTGG | 1774 |
| 70 | AGTGAGTAGACGGCAGTGCTGGG | 1775 |
| 70 | TGTAAAATGGACCAATCAGCAGG | 1776 |
| 69 | GGCGGATACCAGCAGGAGCGCGG | 1777 |
| 69 | AACCTGAGTGGCGGAGAAGCTGG | 1778 |
| 69 | TGGACTTCCTGGGTTGAATGGGG | 1779 |
| 68 | TCCAGGTCCCCATTCAACCCAGG | 1780 |
| 67 | CCGGCTCCGCCCGCAGACTCTGG | 1781 |
| 67 | CCAGAGTCTGCGGGCGGAGCCGG | 1782 |
| 66 | GTCTCGGGCTGCAGTGCTCCTGG | 1783 |
| 66 | ACCTGAGTGGCGGAGAAGCTGGG | 1784 |
| 65 | GCTGGACTTCCTGGGTTGAATGG | 1785 |
| 65 | TGGACCAATCAGCAGGACACGGG | 1786 |
| 65 | CTGGACTTCCTGGGTTGAATGGG | 1787 |
| 64 | TTCCGCGGAGCTCAGCCAGCAGG | 1788 |
| 64 | CGTGGAAGCAGACTCTGGTGGGG | 1789 |
| 64 | AACGTGGAAGCAGACTCTGGTGG | 1790 |
| 62 | CAGAGTCTGCGGGCGGAGCCGGG | 1791 |
| 62 | TCTCGGGCTGCAGTGCTCCTGGG | 1792 |
| 61 | TCGGAGGAGCCAGAGTCTGCGGG | 1793 |
| 61 | TGAAGCCAGCTGGACTTCCTGGG | 1794 |
| 61 | CTGGAAAGAAGCTACAGCACAGG | 1795 |
| 60 | ATGGACCAATCAGCAGGACACGG | 1796 |
| 58 | TCCCAGCTTCTCCGCCACTCAGG | 1797 |
| 58 | TTTCCCAAGGAGTAGCTGAAAGG | 1798 |
| 58 | GAACCCTCTGTCTTCTGGCTTGG | 1799 |
| 58 | CTTACAAGAGGATTGTAAAATGG | 1800 |
| 57 | GGTATCCGCCCCTGAGCCCCAGG | 1801 |

[ Fig. 20-31]

| | | | |
|---|---|---|---|
| | 57 | TAGTAGTAGCAGCTACAGAAAGG | 1802 |
| | 57 | TTTCAGCTACTCCTTGGGAAAGG | 1803 |
| | 56 | TAGTCCGCCTGGGGCTGGCCGGG | 1804 |
| | 56 | CGGGCTGGTCCTCATCTCCCTGG | 1805 |
| | 56 | CTAGTCCGCCTGGGGCTGGCCGG | 1806 |
| | 56 | CTTCCTTTCAGCTACTCCTTGGG | 1807 |
| | 56 | GTAAGACAGAAAAGTTCTCCAGG | 1808 |
| | 55 | CTCGGGCTGCAGTGCTCCTGGGG | 1809 |
| | 55 | AGCTCAGCCAGCAGGACTGTGGG | 1810 |
| | 55 | GAACTTTTCTGTCTTACAAGAGG | 1811 |
| | 53 | GCTACTCCTTGGGAAAGGCCTGG | 1812 |
| | 52 | CCAGCGCGCCCAGGGAGATGAGG | 1813 |
| | 52 | CTACAGCACAGGGCACAGCGGGG | 1814 |
| | 50 | GAGGAGCCAGAGTCTGCGGGCGG | 1815 |
| | 49 | GTCGGAGGAGCCAGAGTCTGCGG | 1816 |
| | 49 | CTGTGCTGTAGCTTCTTTCCAGG | 1817 |
| | 49 | GACAATAAGGGAATAAAAGCTGG | 1818 |
| | 49 | TCCTGGGTTGAATGGGGACCTGG | 1819 |
| | 48 | TGGAAAGAAGCTACAGCACAGGG | 1820 |
| | 46 | GCTCAGCCAGCAGGACTGTGGGG | 1821 |
| | 45 | TGCAGTGCTCCTGGGGCTCAGGG | 1822 |
| | 45 | AGGAAAGGACAGTCCAGCCCAGG | 1823 |
| | 45 | CCCGCCCGTGTCCTGCTGATTGG | 1824 |
| | 44 | GGCGGAGAAGCTGGGACCCTGGG | 1825 |
| | 44 | CTGCAGCCCCACAGTCCTGCTGG | 1826 |
| | 43 | ACTTCCAAGCCAGAAGACAGAGG | 1827 |
| | 42 | GAGCTCAGCCAGCAGGACTGTGG | 1828 |
| | 41 | CAGGGAGATGAGGACCAGCCCGG | 1829 |
| | 41 | AGCTACAGCACAGGGCACAGCGG | 1830 |
| | 41 | CTTCCAAGCCAGAAGACAGAGGG | 1831 |
| | 39 | TGGCGGAGAAGCTGGGACCCTGG | 1832 |
| | 39 | CCGCCTGGGGCTGGCCGGGCTGG | 1833 |
| | 38 | GCAGTGCTCCTGGGGCTCAGGGG | 1834 |
| | 38 | GCTACAGCACAGGGCACAGCGGG | 1835 |
| | 37 | CTGCAGTGCTCCTGGGGCTCAGG | 1836 |
| | 37 | GTCCTGCTGGCTGAGCTCCGCGG | 1837 |
| | 35 | GGGCTGGTCCTCATCTCCCTGGG | 1838 |
| | 34 | GGACCAGCCCGGCCAGCCCCAGG | 1839 |
| | 34 | TTCTTTCCAGGCCTTTCCCAAGG | 1840 |
| | 32 | GGACTGTGGGGCTGCAGGAAAGG | 1841 |
| | 32 | CAGCAGGACTGTGGGGCTGCAGG | 1842 |
| | 31 | GGAAAGGACAGTCCAGCCCAGGG | 1843 |
| | 28 | TCTTCCTTTCAGCTACTCCTTGG | 1844 |
| | 27 | GTGAAGCCAGCTGGACTTCCTGG | 1845 |
| | 25 | GTGCTCCTGGGGCTCAGGGGCGG | 1846 |
| | 20 | GAGAAGCTGGGACCCTGGGCTGG | 1847 |
| | 20 | CCAGCCCGGCCAGCCCCAGGCGG | 1848 |
| V3/I6 | 83 | CAAAGTTGAGGGGGAGTCGATGG | 1849 |
| V4/I5 | 80 | TCGATGGAGGCTTCAACTCCTGG | 1850 |
| V5/I4 | 78 | CGATGGAGGCTTCAACTCCTGGG | 1851 |
| | 77 | GACTAGACTCCTGGATCTGAGGG | 1852 |
| | 75 | GGCTGCAGGACTAGACCCCTGGG | 1853 |
| | 75 | GAGCTGGAGGACTAGACTCCTGG | 1854 |
| | 75 | AGTTGAGGGGGAGTCGATGGAGG | 1855 |
| | 74 | GCTCCCGGACCCCAAAGTCTGGG | 1856 |
| | 72 | AGCTCCCGGACCCCAAAGTCTGG | 1857 |
| | 70 | GGTCCCTAAGTCCACCCCAGGGG | 1858 |
| | 70 | GGGCTGCAGGACTAGACCCCTGG | 1859 |
| | 69 | CAGCCCCTGGGGTGGACTTAGGG | 1860 |

[ Fig. 20-32]

| | | |
|---|---|---|
| 69 | ACTCTACAGTCTCAAAGTTGAGG | 1861 |
| 69 | AACTTTGAGACTGTAGAGTCAGG | 1862 |
| 68 | GGACTAGACTCCTGGATCTGAGG | 1863 |
| 67 | GTACTGGGGCCCGGGAATCCTGG | 1864 |
| 67 | GACTAGACCCCTGGGTCTGAAGG | 1865 |
| 67 | CCGGCTCCGCCCGCAGACTCTGG | 1866 |
| 67 | CCAGAGTCTGCGGGCGGAGCCGG | 1867 |
| 65 | GAGTTCAGGGCCCAGACTTTGGG | 1868 |
| 65 | CTACAGTCTCAAAGTTGAGGGGG | 1869 |
| 64 | TACTGGGGCCCGGGAATCCTGGG | 1870 |
| 64 | CAGGTCCCTAAGTCCACCCCAGG | 1871 |
| 63 | CCTGGACTGCTGGATCAGGAAGG | 1872 |
| 62 | GGTCTGAGGGCGGAGGTCCTGGG | 1873 |
| 62 | CAGAGTCTGCGGGCGGAGCCGGG | 1874 |
| 62 | AGGTCCCTAAGTCCACCCCAGGG | 1875 |
| 61 | TCTACAGTCTCAAAGTTGAGGGG | 1876 |
| 61 | TCGGAGGAGCCAGAGTCTGCGGG | 1877 |
| 61 | CTCTACAGTCTCAAAGTTGAGGG | 1878 |
| 61 | CCCGGGAATCCTGGGTCTGAGGG | 1879 |
| 61 | AGTTCAGGGCCCAGACTTTGGGG | 1880 |
| 60 | TAGACTCCTGGATCTGAGGGAGG | 1881 |
| 60 | AAGTCTGGGCCCTGAACTCCAGG | 1882 |
| 59 | CCTTCCTGATCCAGCAGTCCAGG | 1883 |
| 58 | TAGACCCCTGGGTCTGAAGGAGG | 1884 |
| 58 | CTGCATTCCTGGGGCGGAGGAGG | 1885 |
| 57 | CTCCTCCGCCCCAGGAATGCAGG | 1886 |
| 56 | GGGGCCTGGACTGCTGGATCAGG | 1887 |
| 56 | CCCAGGAATCCTGGGTCTGAGGG | 1888 |
| 56 | CCAGCCCCTGGGGTGGACTTAGG | 1889 |
| 55 | GGCCTGCATTCCTGGGGCGGAGG | 1890 |
| 54 | GTCTGAGGGCGGAGGTCCTGGGG | 1891 |
| 53 | GGGTCTGAGGGCGGAGGTCCTGG | 1892 |
| 53 | CCTAAGTCCACCCCAGGGGCTGG | 1893 |
| 53 | AGGAGGCGGGCCGGGCCTCAGGG | 1894 |
| 52 | GTGCTGGTCATCAGCTGGGAAGG | 1895 |
| 52 | GGCTGGAAACCTGGAGTTCAGGG | 1896 |
| 52 | AGGGCCCAGACTTTGGGGTCCGG | 1897 |
| 52 | AGCTGATGGCCCCTCTCTCCCGG | 1898 |
| 51 | GGAGTTCAGGGCCCAGACTTTGG | 1899 |
| 51 | AGAGAGGGGCCATCAGCTCCCGG | 1900 |
| 50 | GGCTGGGTCCCAGGAATCCTGGG | 1901 |
| 50 | GCGGGCGGAGCCGGGAGAGAGGG | 1902 |
| 50 | GAGGAGCCAGAGTCTGCGGGCGG | 1903 |
| 49 | GTCGGAGGAGCCAGAGTCTGCGG | 1904 |
| 49 | GGTCTGAGGGAGGAGGTACTGGG | 1905 |
| 49 | GGTCCTGGGGCCTGCATTCCTGG | 1906 |
| 49 | GGTCATCAGCTGGGAAGGTGAGG | 1907 |
| 49 | GCCTGGAGTCCTGGGTCTGAGGG | 1908 |
| 48 | GGGCCCAGACTTTGGGGTCCGGG | 1909 |
| 46 | GTCCTGGGGCCTGCATTCCTGGG | 1910 |
| 46 | CCCTCAGACCCAGGATTCCCGGG | 1911 |
| 45 | TCCCAGGAATCCTGGGTCTGAGG | 1912 |
| 45 | GGACCTCCGCCCTCAGACCCAGG | 1913 |
| 45 | CCTCTCCTCCTTCAGACCCAGGG | 1914 |
| 45 | AGGAATCCTGGGTCTGAGGGAGG | 1915 |
| 45 | AACTCCAGGTTTCCAGCCCCTGG | 1916 |
| 44 | GTCTGAGGGAGGAGGTACTGGGG | 1917 |
| 44 | GGACTGCTGGATCAGGAAGGAGG | 1918 |
| 44 | GCTCCTGGGTCTGAGGGCGGAGG | 1919 |

[ Fig. 20-33]

| | | |
|---|---|---|
| 44 | CTTTGGGGTCCGGGAGCTGATGG | 1920 |
| 44 | CTTCCTGGACCCAGGACTCCAGG | 1921 |
| 44 | CACCCCAGGGGCTGGAAACCTGG | 1922 |
| 43 | GCCCGGGAATCCTGGGTCTGAGG | 1923 |
| 43 | GACTGCTGGATCAGGAAGGAGGG | 1924 |
| 43 | ACTCCTGGGTCCAGGAAGAAGGG | 1925 |
| 42 | TCCCTCAGACCCAGGATTCCTGG | 1926 |
| 42 | TCCCTCAGACCCAGGATTCCCGG | 1927 |
| 42 | GGGTCTGAGGGAGGAGGTACTGG | 1928 |
| 42 | GGGCTGGGTCCCAGGAATCCTGG | 1929 |
| 42 | GCCTCTCCTCCTTCAGACCCAGG | 1930 |
| 42 | GCCCCAGGAATGCAGGCCCCAGG | 1931 |
| 42 | ATTCCTGGGGCGGAGGAGGCGGG | 1932 |
| 41 | GGGAATCCTGGGTCTGAGGGAGG | 1933 |
| 41 | GCCTGGGCTCCTGGGTCTGAGGG | 1934 |
| 41 | GAGGAGGCGGGCCGGGCCTCAGG | 1935 |
| 41 | CTGGAGTCCTGGGTCCAGGAAGG | 1936 |
| 41 | CTCTCCTCCTTCAGACCCAGGGG | 1937 |
| 41 | CCCTCAGACCCAGGATTCCTGGG | 1938 |
| 41 | CAGGTTTCCAGCCCCTGGGGTGG | 1939 |
| 40 | TGGAGTCCTGGGTCTGAGGGAGG | 1940 |
| 40 | TGCGGGCGGAGCCGGGAGAGAGG | 1941 |
| 40 | GGGCTGGAAACCTGGAGTTCAGG | 1942 |
| 40 | CTCCAGGTTTCCAGCCCCTGGGG | 1943 |
| 40 | CGGCCCGCCTCCTCCGCCCCAGG | 1944 |
| 38 | CGGGCGGAGCCGGGAGAGAGGGG | 1945 |
| 38 | AACTCCTGGGTCCAGGAAGAAGG | 1946 |
| 37 | TGGGGCGGAGGAGGCGGGCCGGG | 1947 |
| 37 | TCCCTCAGACCCAGGACTCCAGG | 1948 |
| 37 | AGCCCCTTCTTCCTGGACCCAGG | 1949 |
| 37 | ACTCCTGGATCTGAGGGAGGAGG | 1950 |
| 36 | GCCCCTCCTCCCTCAGATCCAGG | 1951 |
| 36 | AGGCTTCAACTCCTGGGTCCAGG | 1952 |
| 36 | ACTGCTGGATCAGGAAGGAGGGG | 1953 |
| 35 | TGGGCTCCTGGGTCTGAGGGCGG | 1954 |
| 35 | TCCTGGGGCCTGCATTCCTGGGG | 1955 |
| 35 | GTACCTCCTCCCTCAGACCCAGG | 1956 |
| 34 | TGGGTCCAGGAAGAAGGGGCTGG | 1957 |
| 34 | CTGGATCAGGAAGGAGGGGCTGG | 1958 |
| 34 | CTCCTGGGTCCAGGAAGAAGGGG | 1959 |
| 34 | CTCCTGGATCTGAGGGAGGAGGG | 1960 |
| 34 | CATTCCTGGGGCGGAGGAGGCGG | 1961 |
| 33 | GTCATCAGCTGGGAAGGTGAGGG | 1962 |
| 33 | CTGGGGCGGAGGAGGCGGGCCGG | 1963 |
| 33 | AGGGAGGAGGTACTGGGGCCCGG | 1964 |
| 33 | ACTCCAGGTTTCCAGCCCCTGGG | 1965 |
| 31 | TGGATCAGGAAGGAGGGGCTGGG | 1966 |
| 31 | GGGAGGAGGTACTGGGGCCCGGG | 1967 |
| 31 | GCCCTCAGACCCAGGAGCCCAGG | 1968 |
| 31 | CCCTGGGTCTGAAGGAGGAGAGG | 1969 |
| 31 | AGTCCTGGGTCCAGGAAGGAGGG | 1970 |
| 30 | ATCCTGGGTCTGAGGGAGGAGGG | 1971 |
| 30 | AGCCCCTCCTTCCTGGACCCAGG | 1972 |
| 30 | AATCCTGGGTCTGAGGGAGGAGG | 1973 |
| 30 | AAGGTGAGGGCCCTGAGGCCCGG | 1974 |
| 29 | GTCCTGGGTCCAGGAAGGAGGGG | 1975 |
| 29 | GGTCTGAAGGAGGAGAGGCTGGG | 1976 |
| 29 | GGGTCCAGGAAGAAGGGGCTGGG | 1977 |
| 28 | AGGCCCCAGCCCCTTCTTCCTGG | 1978 |

[ Fig. 20-34]

| | | | |
|---|---|---|---|
| | 27 | GGCTGGGGGCCTGGAGTCCTGGG | 1979 |
| | 27 | GGCCTGGAGTCCTGGGTCTGAGG | 1980 |
| | 27 | AGTCCTGGGTCTGAGGGAGGAGG | 1981 |
| | 26 | TGGGTCCAGGAAGGAGGGGCTGG | 1982 |
| | 26 | TGGGGCCTGCATTCCTGGGGCGG | 1983 |
| | 26 | GGTCCAGGAAGAAGGGGCTGGGG | 1984 |
| | 26 | GGGCTGGGGGCCTGGAGTCCTGG | 1985 |
| | 26 | GGCCTGGGCTCCTGGGTCTGAGG | 1986 |
| | 25 | TCTGAAGGAGGAGAGGCTGGGGG | 1987 |
| | 25 | GGGGCTGGGGCCTGGACTGCTGG | 1988 |
| | 25 | GATCTGAGGGAGGAGGGGCTGGG | 1989 |
| | 24 | GTCTGAAGGAGGAGAGGCTGGGG | 1990 |
| | 24 | GGGTCTGAAGGAGGAGAGGCTGG | 1991 |
| | 24 | GGGCCTGGAGTCCTGGGTCCAGG | 1992 |
| | 24 | GGCTGGGGGCCTGGGCTCCTGGG | 1993 |
| | 24 | GAGTCCTGGGTCCAGGAAGGAGG | 1994 |
| | 23 | TCCTGGATCTGAGGGAGGAGGGG | 1995 |
| | 23 | GGGTCCAGGAAGGAGGGGCTGGG | 1996 |
| | 23 | GGGAGGAGGGGCTGGGTCCCAGG | 1997 |
| | 22 | TCTGAGGGAGGAGGGGCTGCAGG | 1998 |
| | 22 | GGAGGAGAGGCTGGGGGCCTGGG | 1999 |
| | 22 | GATCAGGAAGGAGGGGCTGGGGG | 2000 |
| | 21 | CTGGGAAGGTGAGGGCCCTGAGG | 2001 |
| | 21 | AGGAGGAGAGGCTGGGGGCCTGG | 2002 |
| | 20 | GGTCCAGGAAGGAGGGGCTGGGG | 2003 |
| | 20 | AGGCTGGGGGCCTGGGCTCCTGG | 2004 |
| | 19 | GTCCAGGAAGGAGGGGCTGGGGG | 2005 |
| | 19 | GGCCCCCAGCCCCTCCTTCCTGG | 2006 |
| | 19 | GCTCCTCCTCCCTCAGACCCAGG | 2007 |
| | 18 | TCTGAGGGAGGAGGAGCTGGAGG | 2008 |
| | 18 | GGATCAGGAAGGAGGGGCTGGGG | 2009 |
| | 18 | GGAAGGAGGGGCTGGGGGCCTGG | 2010 |
| | 18 | GCCCCTCCTCCCTCAGACCCAGG | 2011 |
| | 17 | TCCTGGGTCTGAGGGAGGAGGGG | 2012 |
| | 15 | GGGTCTGAGGGAGGAGGAGCTGG | 2013 |
| | 14 | GGATCTGAGGGAGGAGGGGCTGG | 2014 |
| | 14 | AGGAAGAAGGGGCTGGGGCCTGG | 2015 |

PHARMACEUTICAL COMPOSITION OR FOOD COMPOSITION, AND METHOD FOR ASSESSING EFFECT OF ACTIVE INGREDIENT IN VIVO

A sequence listing in electronic (ASCII text file) format is filed with this application and incorporated herein by reference. The name of the ASCII text file is "P17-066US_Seq_Listing_210514.txt"; the file was created on May 18, 2021; the size of the file is 314 kilobytes (KB) or 322,454 bytes (b).

TECHNICAL FIELD

The present invention relates to a pharmaceutical composition or food composition comprising an active ingredient capable of suppressing functional expression of Oscar protein. The present invention also relates to a device, program, and method for evaluating an effect of the active ingredient in the body.

BACKGROUND ART

Diseases include those in a state that can be reversibly treated, and those in a state that cannot, i.e., those in an irreversible state. Early detection and treatment of abnormalities during a reversible state, or preventing such a state from occurring, is essential for health maintenance. Even in a reversible state, early detection of disease directly leads to milder treatment, a shorter treatment period, and better prognostic health. As in heart disease, brain disease, cancer, and diabetes, it is well known that abnormalities in one organ or tissue lead to a disease state in other organs (commonly called a "complication"). In such diseases, it is essential to prevent, at the earliest possible time, abnormalities in one organ or tissue from causing disease in other organs or tissue.

In all animals, including humans, each organ and tissue form a functional network, rather than serving as separate parts, and quality control at the individual level is achieved. Transport of endocrine factors, such as hormones, by the vascular network throughout the entire body and coordinated adjustment of organ functions by the neural network are typical examples of an "inter-organ cross talk system," and systematized as physiology or endocrinology.

Meanwhile, the number of end-stage kidney disease (ESKD) patients in need of dialysis or kidney transplant has been increasing worldwide. The number of ESKD patients increased from 430,000 to 1,065,000 over the decade from 1990 to 2000, and further increased to at least about 1,650,000 in 2008 (Non-patent Literature 1). Chronic kidney disease (CKD) progresses to ESKD. However, in the kidneys, called the "silent organ," even if kidney damage occurs, its condition is less likely to appear in clinical data etc. Thus, early detection of declined kidney function before onset of chronic kidney disease is difficult.

FGF23 is a hormone that lowers the phosphorus concentration in blood, and is known to suppress reabsorption of phosphorus in the renal proximal tubule and absorption of phosphorus from the intestinal tract, to thereby lower the phosphorus concentration in blood. An increase in the concentration of FGF23 is also known to cause chronic kidney disease-mineral and bone disorder (CKD-MBD).

Further, it has been reported that the fibrinogen concentration in urine or blood is increased in patients with chronic kidney disease (CKD), acute kidney injury, renal fibrosis, glomerulonephritis, or like disease; therefore, fibrinogen has the property of a biomarker of kidney function (Non-patent Literature 2 to 5).

CITATION LIST

Non-Patent Literature

NPL 1: Lysaght M J: J Am Soc Nephrol. 2002 January; 13 Suppl 1; S37-40.

NPL 2: Hoffmann, D. et al.; The American Journal of Pathology, 181, 818-828, doi:10.1016/j.ajpath.2012.06.004 (2012).

NPL 3: Prinsen, B. H. et al.; Kidney International, 64, 1495-1504, doi:10.1046/j.1523-1755.2003.00211.x (2003).

NPL 4: Zhang, Q. et al.; Biomarkers in Medicine, 8, 85-94, doi:10.2217/bmm.13.106 (2014).

NPL 5: Craciun, F. L. et al.; American Journal of Physiology—Renal Physiology, 307, F471-484, doi:10.1152/ajprenal.00189.2014 (2014).

SUMMARY OF INVENTION

Technical Problem

CKD develops due to various diseases such as diabetes, hypertension, and like lifestyle-related diseases; and urinary tract infection, urinary tract obstruction, glomerulonephritis, vascular disease in the kidneys (blood flow disorder), drug-induced nephropathy caused by an analgesic, and like urinary system diseases. Thus, after kidney function has declined, treatment of such a primary disease is first performed in order to slow progression of the declined kidney function. In addition, treatment such as blood-pressure control or dietary restriction is conducted to slow progression of CKD. Further, for example, a drug therapy using a phosphate-binding agent etc. is performed for abnormal bone metabolism associated with chronic kidney disease when CKD progresses.

However, there is currently no fundamental therapeutic agent that halts progression of declined kidney function.

An object of the present invention is to provide a pharmaceutical composition or food or drink composition comprising an active ingredient that suppresses functional expression of Oscar protein. Another object of the present invention is to provide a pharmaceutical composition or food composition for use in preventing or treating kidney disease. A further object of the present invention is to provide a pharmaceutical composition or food or drink composition that suppresses functional expression of Oscar in a living organism in order to suppress functional expression of FGF23. A still further object of the present invention is to provide a method for evaluating an effect, in the body, of an active ingredient that suppresses functional expression of Oscar protein.

Solution to Problem

The present inventor conducted extensive research, and found that the expression of Oscar protein is increased in a kidney disease animal model. The inventor also found that progression of declined kidney function can be suppressed, or that declined kidney function can be improved, by suppressing the function of Oscar protein.

Moreover, the inventor conducted extensive research, and found that the expression of Oscar is increased in the bones of unilateral nephrectomy, model mice ingested diet with high phosphorus content compared with that in a sham-operated model. The inventor also found that an increase in the expression of FGF23 is mitigated in Oscar gene mutant mice.

The present invention has been accomplished based on these findings, and includes the following embodiments.

I. Pharmaceutical Composition or Food or Drink Composition

I-1. A pharmaceutical composition or food or drink composition comprising an active ingredient that suppresses functional expression of Oscar protein.

I-2. The pharmaceutical composition or food or drink composition according to Item I-1, wherein the active ingredient is at least one member selected from the group consisting of antagonists of the Oscar protein;

genome editing systems that target Oscar gene;

at least one RNA molecule selected from the group consisting of siRNA, shRNA, and miRNA that target Oscar mRNA, or vectors capable of expressing the RNA molecule; and antibodies that specifically bind to the Oscar protein and suppress function of the Oscar.

I-3. The pharmaceutical composition or food or drink composition according to Item I-2, wherein the active ingredient is an antagonist of the Oscar protein, and the antagonist is a soluble receptor of the Oscar.

I-4. The pharmaceutical composition or food or drink composition according to Item I-2, wherein the active ingredient is a genome editing system that targets the Oscar gene, and the genome editing system is a CRISPR/Cas9 system comprising a sequence that targets the Oscar gene.

I-5. The pharmaceutical composition or food or drink composition according to any one of Items I-1 to I-4 for use in preventing or treating kidney disease.

I-6. The pharmaceutical composition or food or drink composition according to any one of Items I-1 to I-4 for use in suppressing functional expression of FGF23.

I-7. The pharmaceutical composition or food or drink composition according to any one of Items I-1 to I-4, wherein the pharmaceutical composition or food or drink composition is administered to an individual with a high measurement value relating to at least one protein selected from the group consisting of proline-rich proteins (PRPs) and fibrinogens in a specimen, and/or a high measurement value of mRNA of the protein in a specimen.

I-8. A method of treatment, comprising administering an active ingredient to an individual, the active ingredient being at least one member selected from the group consisting of antagonists of Oscar protein;

genome editing systems that target Oscar gene;

at least one RNA molecule selected from the group consisting of siRNA, shRNA, and miRNA that target Oscar mRNA, or vectors capable of expressing the RNA molecule; and antibodies that specifically bind to Oscar protein and suppress function of the Oscar.

I-9. Use of at least one member selected from the group consisting of antagonists of Oscar protein; genome editing systems that target Oscar gene; at least one RNA molecule selected from the group consisting of siRNA, shRNA, and miRNA that target Oscar mRNA, or vectors capable of expressing the RNA molecule; and antibodies that specifically bind to Oscar protein and suppress function of the Oscar, for the production of a composition for preventing or treating kidney disease; or for the production of a composition for suppressing functional expression of FGF23.

I-10. At least one member selected from the group consisting of antagonists of Oscar protein; genome editing systems that target Oscar gene; at least one RNA molecule selected from the group consisting of siRNA, shRNA, and miRNA that target Oscar mRNA, or vectors capable of expressing the RNA molecule; and antibodies that specifically bind to Oscar protein and suppress function of the Oscar, for use in preventing or treating kidney disease; or for use in suppressing functional expression of FGF23.

Here, Items I-8 to I-10 may have dependent items containing features corresponding to Items I-3 to I-7 described above.

II. Evaluation of Effect of Active Ingredient in Body

II-1. A device for evaluating an effect, in the body, of an active ingredient that suppresses functional expression of Oscar protein, the device comprising the following computation means:

first obtaining means for obtaining a measurement value relating to at least one protein selected from the group consisting of proline-rich proteins (PRPs) and fibrinogens contained in a specimen collected from a subject to which the active ingredient has been administered (a treated specimen), and/or a measurement value of mRNA of the protein contained in a specimen collected from the subject; and means for evaluating the effect of the active ingredient based on the measurement value(s) obtained by the obtaining means.

II-2. The device according to Item II-1, further comprising:

second obtaining means for obtaining a measurement value relating to the at least one protein selected from the group consisting of proline-rich proteins (PRPs) and fibrinogens, and/or a measurement value of mRNA of the protein in a specimen collected from a subject, test tissue, or test cell that is not treated with the active ingredient (an untreated specimen); and means for comparing the measurement value(s) of the treated specimen with the measurement value(s) of the untreated specimen, wherein the evaluation means evaluates the effect of the active ingredient in the body based on the comparison result obtained by the measurement value comparison means.

II-3. The device according to Item II-2, wherein the evaluation means determines that the active ingredient is effective in the body when the measurement value(s) of the treated specimen are lower than the measurement value(s) of the untreated specimen.

II-4. The device according to any one of Items II-1 to II-3, wherein the active ingredient is at least one member selected from the group consisting of antagonists of the Oscar protein;

genome editing systems that target Oscar gene;

at least one RNA molecule selected from the group consisting of siRNA, snRNA, and miRNA that target Oscar mRNA, or vectors capable of expressing the RNA molecule; and antibodies that specifically bind to the Oscar protein and suppress function of the Oscar.

II-5. An evaluation program that, when executed by a computer, causes the computer to carry out the following processing to evaluate an effect, in the body, of an active ingredient that suppresses functional expression of Oscar protein:

first obtaining processing of obtaining a measurement value relating to at least one protein selected from the group consisting of proline-rich proteins (PRPs) and fibrinogens contained in a specimen collected from a subject to which the active ingredient has been administered (a treated specimen), and/or a measurement value of mRNA of the protein contained in a specimen collected from the subject; and processing of evaluating the effect of the active ingredient based on the measurement value(s) obtained by the obtaining processing.

II-6. The evaluation program according to Item II-5, wherein the program further causes the computer to carry out second obtaining processing of obtaining a measurement value relating to the at least one protein selected from the group consisting of proline-rich proteins (PRPs) and fibrinogens, and/or a measurement value of mRNA of the protein in a specimen collected from a subject, test tissue, or test cell that is not treated with the active ingredient (an untreated specimen); and processing of comparing the measurement value(s) of the treated specimen with the measurement value(s) of the untreated specimen, and in the evaluation processing, the effect of the active ingredient in the body is evaluated based on the comparison result obtained by the measurement value comparison processing.

II-7. The evaluation program according to Item II-6, wherein in the evaluation processing, it is determined that the active ingredient is effective in the body when the measurement value(s) of the treated specimen are lower than the measurement value(s) of the untreated specimen.

II-8. The evaluation program according to any one of Items II-5 to II-7, wherein the active ingredient is at least one member selected from the group consisting of antagonists of the Oscar protein;

genome editing systems that target Oscar gene;

at least one RNA molecule selected from the group consisting of siRNA, shRNA, and miRNA that target Oscar mRNA, or vectors capable of expressing the RNA molecule; and antibodies that specifically bind to the Oscar protein and suppress function of the Oscar.

II-9. A method for supporting the evaluation of an effect, in the body, of an active ingredient that suppresses functional expression of Oscar protein, the method comprising the following steps:

a first obtaining step of obtaining a measurement value relating to at least one protein selected from the group consisting of proline-rich proteins (PRPs) and fibrinogens contained in a specimen collected from a subject to which the active ingredient has been administered (a treated specimen), and/or a measurement value of mRNA of the protein contained in a specimen collected from the subject; and a step of evaluating the effect of the active ingredient based on the measurement value(s) obtained by the obtaining step.

II-10. The method according to Item II-9, further comprising the following steps:

a second obtaining step of obtaining a measurement value relating to the at least one protein selected from the group consisting of proline-rich proteins (PRPs) and fibrinogens, and/or a measurement value of mRNA of the protein in a specimen collected from a subject, test tissue, or test cell that is not treated with the active ingredient (an untreated specimen); and a step of comparing the measurement value(s) of the treated specimen with the measurement value(s) of the untreated specimen, wherein in the evaluation step, the effect of the active ingredient in the body is evaluated based on the comparison result obtained by the measurement value comparison step.

II-11. The method according to Item II-10, wherein in the evaluation step, it is determined that the active ingredient is effective in the body when the measurement value(s) of the treated specimen are lower than the measurement value(s) of the untreated specimen.

II-12. The method according to any one of Items II-9 to II-11, wherein the active ingredient is at least one member selected from the group consisting of antagonists of the Oscar protein;

genome editing systems that target Oscar gene;

at least one RNA molecule selected from the group consisting of siRNA, shRNA, and miRNA that target Oscar mRNA, or vectors capable of expressing the RNA molecule; and antibodies that specifically bind to the Oscar protein and suppress function of the Oscar.

III. Genome Editing System and gRNA

III-1. A genome editing system comprising a sequence that targets Oscar gene.

III-2. The genome editing system according to Item III-1, which is a CRISPR/Cas9 system comprising a sequence that targets the Oscar gene.

III-3. gRNA comprising a sequence that targets Oscar gene.

Advantageous Effects of Invention

The present invention makes it possible to provide a pharmaceutical composition or food or drink composition that suppresses the function of Oscar protein. The present invention also makes it possible to provide a pharmaceutical composition or food or drink composition for suppressing progression of declined kidney function or improving declined kidney function, and preventing or treating a disease selected from the group consisting of declined kidney function, chronic kidney disease, and renal failure. The present invention further makes it possible to provide a pharmaceutical composition or food or drink composition for suppressing functional expression of FGF23. Furthermore, the present invention makes it possible to evaluate an effect, in the body, of an active ingredient that suppresses functional expression of Oscar protein.

BRIEF DESCRIPTION OF DRAWINGS

FIG. 1 is an overview of a system 100 according to a first embodiment of the present invention.

FIG. 2 is a block diagram illustrating a hardware configuration of the system 100 according to the fourth embodiment of the present invention.

FIG. 3 is a block diagram illustrating functions of an evaluation device 1 according to the fourth embodiment of the present invention.

FIG. 4 is a flow chart illustrating a flow of data processing performed by the evaluation device 1 according to the fourth embodiment of the present invention to carry out an evaluation method.

FIG. 5 shows qRT-PCR results of FGF23 in the skull. HP4W indicates mice 4 weeks after the start of a diet with high phosphorus content, and LP4W indicates mice 4 weeks after the start of a diet with low phosphorus content (a control group). sOscar indicates mice to which a soluble human Oscar-Fc fusion protein was administered, and NS indicates mice to which physiological saline was administered in place of the soluble human Oscar-Fc fusion protein.

FIG. 6 shows qRT-PCR results of PRP genes in the parotid gland. HP4W indicates mice 4 weeks after the start of a diet with high phosphorus content, and LP4W indicates mice 4 weeks after the start of a diet with low phosphorus content (a control group). sOscar indicates mice to which a soluble human Oscar-Fc fusion protein was administered, and NS indicates mice to which physiological saline was administered in place of the soluble human Oscar-Fc fusion protein.

FIG. 7 shows ELISA measurement results of FGF23 in plasma. HP4W indicates mice 4 weeks after the start of a diet with high phosphorus content, and LP4W indicates mice 4 weeks after the start of a diet with low phosphorus content (a control group). sOscar indicates mice to which a soluble human Oscar-Fc fusion protein was administered, and NS indicates mice to which physiological saline was administered in place of the soluble human Oscar-Fc fusion protein. WT (12W) indicates 12-week-old male wild-type mice fed a normal diet.

FIG. 8 shows mutation sites by CRISPR/Cas9 and sequences of ssODNs for obtaining Oscar gene mutant mice. FIG. 8A shows a mutation site of Oscar-gRNA1 and a sequence of ssODNs. FIG. 8B shows a mutation site of Oscar-gRNA2 and a sequence of ssODNs. FIG. 8C indicates genotypes of Oscar in obtained mutant mice. In FIG. 8A, the amino acid sequence vertically between SEQ ID NO: 2018 and SEQ ID NO: 2019 is SEQ ID NO: 2026. In FIG. 8B, the amino acid sequence vertically between SEQ ID NO: 2021 and SEQ ID NO: 2022 is also SEQ ID NO: 2026. In FIG. 8C, the amino acid sequence directly below SEQ ID NO: 2024 is SEQ ID NO: 2027, and the amino acid sequence directly below SEQ ID NO: 2025 is SEQ ID NO: 2028.

FIG. 9 shows volcano plots in the skull 1 week (E), 4 weeks (M), and 8 weeks (L) after the start of a diet with high phosphorus content in UNx/HPi model mice (a diet with low phosphorus content in a Sham group).

FIG. 10A shows DESeq analysis results of expression of Oscar gene in each tissue. FIG. 10B shows results of expression of Oscar mRNA in the UNx/HPi model mice and sham mice at E, M, and L examined by qRT-PCR. FIG. 10C shows results of the expression of Oscar gene in the kidneys confirmed by qRT-PCR. In the graphs, *** indicates $p<0.001$, and n.s. indicates no significant difference.

FIG. 11 shows results of expression of FGF23 gene in the skull confirmed by qRT-PCR. In the graph,  indicates $p<0.01$, and * indicates $p<0.001$.

FIG. 12A shows the expression of Oscar gene in the skull 1 day, 3 days, 1 week, and 4 weeks after switching from a normal diet to a diet with low phosphorus content or a diet with high phosphorus content. FIG. 12B shows the expression of FGF23 gene in the skull 1 day, 3 days, 1 week, and 4 weeks after switching from a normal diet to a diet with low phosphorus content or a diet with high phosphorus content. In the graphs, indicates $p<0.05$,  indicates $p<0.01$, * indicates $p<0.001$, and n.s. indicates no significant difference.

FIG. 13 shows the expression of FGF23 in the bones of normal mice and Oscar gene mutant mice fed a diet with high phosphorus content. ** indicates $p<0.01$.

FIG. 14 shows the concentration of creatinine in plasma. HP4W indicates mice 4 weeks after the start of a diet with high phosphorus content, and LP4W indicates mice 4 weeks after the start of a diet with low phosphorus content (a control group). WT (12W) indicates 12-week-old male wild-type mice fed a normal diet. UNx/HP4W indicates UNx/HPi model mice 4 weeks after the start of a diet with high phosphorus content.

FIG. 15 shows the expression levels of PRPs in the salivary glands of a group that ingested a diet with high phosphorus content (High Pi) and a group that ingested a diet with low phosphorus content (Low Pi). A: Prb1, B: Prh1, C: Prp2, and D: Prpmp5.

FIG. 16 shows the ratios of the concentrations of hPRB1 in saliva on the final day of a test (Day 7) divided by the concentrations of hPRB1 in saliva one day before the start of the test (Day −1) in group A and group B (hPRB1 Day 7/Day −1 ratios). "Phosphorus intake ratio" is a ratio of the total phosphorus intake for 7 days after the start of the diet with high phosphorus content (or normal diet) ingestion test divided by the total phosphorus intake for 7 days before the start of the diet with high phosphorus content (or normal diet) ingestion test.

FIG. 17 shows the concentrations of hPRB1 in saliva in subjects diagnosed with chronic kidney disease, or diagnosed as having multiple myeloma and being at risk for kidney disease (Patients); and healthy subjects (Control Subjects).

FIG. 18 shows the concentrations of proline in saliva in a group that ingested a diet with high phosphorus content (group A: High Pi), and a group that ingested a diet with low phosphorus content (group B: Low Pi).

FIG. 19 shows qRT-PCR results of Fgg gene in the kidneys. HP4W indicates mice 4 weeks after the start of a diet with high phosphorus content, and LP4W indicates mice 4 weeks after the start of a diet with low phosphorus content (a control group). sOscar indicates mice to which a soluble human Oscar-Fc fusion protein was administered, and NS indicates mice to which physiological saline was administered in place of the soluble human Oscar-Fc fusion protein.

FIG. 20 shows the sequences of gRNA. FIG. 20 is a multi-page figure which is divided into FIGS. 20-1 to 20-34.

DESCRIPTION OF EMBODIMENTS

1. Explanation of terms

First, terms used in the present specification, claims, and abstract are explained. Unless otherwise stated, terms used in the present specification, claims, and abstract are in accordance with the definitions in this section.

"Oscar mRNA" as used herein includes, for example, RNA shown in Table 1, splicing variants of the RNA, and the RNA having SNPs. "Oscar protein" includes, for example, proteins translated from RNA shown in Table 1, splicing variants of the RNA, and the RNA having SNPs. "Oscar gene" includes, for example, genes indicated by the Gene IDs of Table 1.

TABLE 1

| Animal species | Ref. Seq. No.* | Gene ID |
|---|---|---|
| Mouse | NM_001290377.1<br>NM_175632.3 | 232790 |
| Rat | NM_001184973.1<br>XM_006228020.3 | 292537 |
| Human | NM_206818.2<br>NM_130771.4<br>NM_133169.4<br>NM_133168.4<br>NM_001282349.1<br>NM_001282350.1 | 126014 |

*NCBI Reference Sequence Number

"Functional expression" means that original functions of Oscar proteins or FGF23 proteins are exhibited. For example, the functional expression of Oscar protein is a function to increase the expression of FGF23 mRNA; a function to activate osteoclasts via NFATc1; a function to activate immune cells via calcium release, immune cell maturation, inhibition of apoptosis, and antigen transport and antigen presentation by an MHC class II antigen; or a function to enhance a pro-inflammatory response via IL-8.

Such a function of Oscar can be evaluated by a method described in the section "3. Evaluation of function of Oscar protein" described later.

The functional expression of FGF23 protein is a function to suppress the expression of NaPi-2a and NaPi-2c in the kidneys, and suppress phosphorus reabsorption in the kidneys; a function to induce the expression of CYP24A1 while suppressing the expression of CYP27B1 in the kidneys and inhibit synthesis of 1,25-dihydroxyvitamin D, thereby suppressing phosphorus absorption in the intestinal tract; a function to suppress secretion of PTH from the parathyroid glands; or a function to induce the expression of Klotho in the kidneys and/or activate the function of Klotho.

Such a function of FGF23 protein is suppressed by suppressing the functional expression of Oscar protein.

"Suppressing the functional expression" refers to suppressing or decreasing exhibition of an aforementioned function of Oscar protein or FGF23 protein, and suppressing the expression of Oscar protein or FGF23 protein.

"Active ingredient" as used herein is not limited, as long as it can suppress the functional expression of Oscar protein in the body of an individual. Examples include antagonists of Oscar protein; genome editing systems that target Oscar gene; at least one RNA molecule selected from the group consisting of siRNA, shRNA, and miRNA that targets Oscar mRNA or vectors capable of expressing the RNA molecule; at least one member selected from antibodies that specifically bind to Oscar protein and suppress function of the Oscar protein; and inhibitors of Oscar protein.

In the present invention, the antagonist may be a type that competitively inhibits a target (competitive inhibitory-type), or a type that non-competitively inhibits a target (non-competitive inhibitory-type). The antagonist is preferably a competitive inhibitory-type.

Examples of competitive inhibitory-type antagonists include substances that compete with a molecule for binding to Oscar protein as a target (hereinafter also referred to as "competitive substances").

The antagonist is preferably, for example, a soluble receptor of Oscar protein. The soluble receptor comprises an amino acid sequence of a ligand-binding region in the Oscar protein. The soluble receptor may also comprise, for example, the Fc portion of an immunoglobulin or synthetic polymer polyethylene glycol (PEG) as a molecule other than the amino acid sequence of the ligand-binding region in the Oscar protein. In the case of humans, an example of the soluble receptor is the soluble receptor set forth in NP_996554.2 (SEQ ID NO: 1), which is capable of inhibiting activation of Oscar protein. In the case of humans, the soluble receptor comprises, among the sequence of the 1st to 228th amino acids of the amino acid sequence set forth in SEQ ID NO: 1, at least the sequence of the 1st to 220th amino acids, preferably the sequence of the 1st to 228th amino acids. The soluble receptor may comprise an amino acid sequence with at least 70%, preferably at least 80%, more preferably at least 85%, even more preferably at least 90%, still even more preferably at least 95% homology to the sequence of the 1st to 228th amino acids of the amino acid sequence set forth in SEQ ID NO: 1, in place of the amino acid sequence set forth in SEQ ID NO: 1. The soluble receptor is preferably, for example, a soluble receptor comprising a peptide comprising the amino acid sequence set forth in SEQ ID NO: 2 or a peptide having the same amino acid sequence as the amino acid sequence of the peptide, except that one to three amino acids are substituted, deleted, or inserted, the amino acid sequence being capable of inhibiting activation of human Oscar. In the case of mice, an example of the soluble receptor is the soluble receptor set forth in NP_783440.1 (SEQ ID NO: 3), which is capable of inhibiting activation of Oscar. The soluble receptor comprises, among the sequence of the 1st to 235th amino acids of the amino acid sequence set forth in SEQ ID NO: 3, at least the sequence of the 1st to 225th amino acids, and preferably the sequence of the 1st to 235th amino acids. The soluble receptor may comprise an amino acid sequence with at least 70%, preferably at least 80%, more preferably at least 85%, even more preferably at least 90%, still even more preferably at least 95% homology to the sequence of the 1st to 235th amino acids of the amino acid sequence set forth in SEQ ID NO: 3, in place of the amino acid sequence set forth in SEQ ID NO: 3. The soluble receptor is preferably a soluble receptor comprising a peptide comprising the amino acid sequence set forth in SEQ ID NO: 4 or a peptide having the same amino acid sequence as the amino acid sequence of the peptide, except that one to three amino acids are substituted, deleted, or inserted, the amino acid sequence being capable of inhibiting activation of mouse Oscar.

When the antagonist is systemically administered, it can be administered in an amount of 0.01 to 1,000 mg/day per kg of body weight of an adult.

When the antagonist is locally administered, it can be administered in an amount of 0.01 to 100 mg per $cm^2$ of target tissue.

"Genome editing systems that target Oscar gene" as used herein are not particularly limited, as long as they are systems that enable recombination to take place in the Oscar gene in the body of an individual. Examples include a CompoZr Zinc Finger Nuclease (ZFN) system, TAL effector nuclease (TALEN) system, Clustered regularly interspaced short palindromic repeats/CRISPR associated protein 9 (CRISPR/Cas9) system, and the like. A CRISPR/Cas9 system is preferable. A CRISPR/Cas9 system using a vector is preferable. In the CRISPR/Cas9 system using a vector, a nucleic acid encoding CRISPR and a nucleic acid encoding Cas9 may be located on different vectors, or one vector. The promoter for allowing CRISPR to function is not particularly limited, and is preferably a U6 promoter. The promoter for allowing Cas9 to function is not particularly limited, and is preferably a promoter that is expressed in mammalian cells, such as a cytomegalovirus promoter. As the CRISPR/Cas9 system, a commercially available vector such as pX330-U6-Chimeric BB-CBh-hSpCas9 vector can be preferably used.

The sequence that targets Oscar gene (hereinafter also referred to as "Oscar gene target sequence") to be incorporated into the CRISPR sequence is not limited, as long as it is a sequence that can be incorporated into guide RNA (also called gRNA or crRNA) by the CRISPR/Cas9 system, and transcribed to achieve recombination of the Oscar gene. It is generally said that a sequence of about 20 nucleotides in the 5' upstream region of nucleotide sequence "NGG" present in the Oscar gene can be selected as the Oscar gene target sequence. The Oscar gene target sequence can be designed using a known publicly available design tool, such as Optimized CRISPR design tool (website of Massachusetts Institute of Technology, Zhang Lab (http://crispr.mit.edu/)), E-CRISP (http://www.e-crisp.org/E-CRISP/(German Cancer Research Center)), ZiFiT Targeter (http://zifit.partners.org/ZiFit/(Zing Finger Consortium)), Cas9 design (http://cas9.cbi.pku.edu.cn (Peking University)), CRISPRdirect (http://crispr.dbcls.jp (University of Tokyo)), or CRISPR-P (http://cbi.hzau.edu.cn/crispr/(Huazhong Agricultural University)).

Examples of sequences that target human Oscar gene include the sequences shown in FIGS. 20-1 to 20-32. The sequences shown in FIGS. 20-1 to 20-32 are sequences designed by using the Optimized CRISPR design tool. gRNA having a sequence designed using this tool enables efficient recombination; therefore, any of such sequences may be used as the target sequence. Preferable examples include sequences in which the score shown in FIGS. 20-1 to 20-32 exceeds 70%, more preferably 80%, and even more preferably 90°. The sequence that targets human Oscar gene is preferably a sequence present in exon 2, 3, or 4, more preferably a sequence present in exon 2 or 3, even more preferably a sequence present in exon 2.

Moreover, when single nucleotide polymorphisms (SNPs) are present in a PAM sequence, it is preferable to avoid such a sequence. When SNPs of an individual are known, it is preferable to optimize the target sequence according to each SNP.

The selected sequence of 20 nucleotides may be 1, 2, 3, or 4 nucleotides shorter, preferably 1, 2, or 3 nucleotides shorter, in the 5' end region of the Oscar gene target sequence. The 5' end region of the Oscar gene target sequence may include a sequence of one or two nucleotides upstream of a sequence shown in FIG. 20.

The CRISPR/Cas9 system may be transfected into cells as a vector. Alternatively, a combination of gRNA, trans-activating crRNA (tracrRNA), and RNA encoding Cas9 artificially synthesized or synthesized by in vitro transcription may be introduced into cells.

Further, in the genome editing system, donor oligo DNA, such as single-stranded oligodeoxynucleotides (ssODNs), may be co-introduced. The ssODNs can be designed by a known method.

When the genome editing system that targets Oscar gene is administered to an individual, it may be administered systemically or locally. In the case of systemic administration, it is preferably administered intravenously. When the genome editing system is a system in which a nucleic acid based on DNA, for example, a lentivirus-derived or adenovirus-derived vector that can be expressed in an individual may be used as a vector. In addition, the vector may be administered to an individual with a nucleic acid delivery reagent, such as a liposome. When the genome editing system is a system in which a nucleic acid based on RNA, a vector may be administered with a liposome. Such a vector is preferably linearized as necessary.

When the genome editing system is administered systemically, it can be administered in an amount of $10^{10}$ to $10^{18}$ vg/day per kg of body weight of an adult.

When the genome editing system is administered locally, a vector or RNA can be injected into target tissue using a syringe or a catheter. In this case, a nucleic acid delivery reagent, such as a liposome, may also be used. In the case of local administration, the genome editing system can be administered in an amount of $10^9$ to $10^{16}$ vg/day per $cm^2$ of target tissue.

In both systemic administration and local administration, the genome editing system can be administered in a single dose, or multiple doses. When the genome editing system is administered in multiple doses, the administration can be repeated every three days, every five days, or every other week. When the genome editing system is administered in multiple doses, it can be administered twice, 5 times, 10 times, 15 times, 20 times, or 24 times.

In this embodiment, "RNA molecule that targets Oscar mRNA" is not particularly limited, as long as it can target Oscar mRNA and suppress expression of the Oscar protein. Examples include RNA molecules that have an action to degrade target mRNA, such as siRNA, siRNA, dsRNA, or miRNA; and/or RNA molecules that suppress translation of target mRNA. The sequences of these RNA molecules can be appropriately designed by a person skilled in the art according to a known method on the basis of information regarding the nucleotide sequence of the target gene described above. The RNA molecules may be prepared based on a known method, or commercially available RNA molecules may be used. As the RNA molecules, siRNA, shRNA, and miRNA are preferable, and siRNA and shRNA are particularly preferable.

The vector capable of expressing the RNA molecule that targets Oscar mRNA is not particularly limited, as long as it is capable of expressing the RNA molecule that suppresses the expression of the Oscar protein, in the body of an individual or in cells. An example of the vector is a vector expressing hairpin RNA. The vector expressing hairpin RNA comprises, for example, at least a sense strand DNA nucleotide sequence having the same sequence as the sense strand of target mRNA (note that uracil in mRNA is replaced by thymine); a loop nucleotide sequence that forms a loop structure after transcription; an antisense strand DNA nucleotide sequence capable of complementarily binding to all or a portion of the sense strand DNA nucleotide sequence; and a terminator sequence, downstream of a promoter nucleotide sequence suitable for expression of short RNA, such as a U6 promoter. Examples of vectors include plasmid vectors, adenovirus vectors, retrovirus vectors, lentivirus vectors, and the like.

When at least one RNA molecule selected from the group consisting of siRNA, shRNA, and miRNA that target Oscar mRNA or a vector capable of expressing the RNA molecule is administered systemically, it can be administered in an amount of 0.1 to 1,000 mg/day per kg of body weight of an adult. The vector can be linearized as necessary.

When at least one RNA molecule selected from the group consisting of siRNA, shRNA, and miRNA that target Oscar mRNA or a vector capable of expressing the RNA molecule is administered locally, the vector or RNA can be injected into target tissue using a syringe or a catheter. In this case, a nucleic acid delivery reagent, such as a liposome, may also be used. In the case of local administration, the RNA or vector can be administered in an amount of 0.01 to 100 mg/day per $cm^2$ of target tissue.

In both systemic administration and local administration, at least one RNA molecule selected from the group consisting of siRNA, shRNA, and miRNA that target Oscar mRNA or a vector capable of expressing the RNA molecule can be administered in a single dose, or multiple doses. When the RNA or vector is administered in multiple doses, the administration can be repeated every three days, every five days, or every other week. When the RNA or vector is administered in multiple doses, it can be administered twice, 5 times, 10 times, 15 times, 20 times, or 24 times.

In the present invention, "antibodies that bind to the Oscar protein" are not limited, as long as they can specifically bind to the Oscar protein, and suppress the functional expression of the protein. The antibodies may be polyclonal antibodies or monoclonal antibodies. The polyclonal antibodies and monoclonal antibodies can be suitably prepared by a person skilled in the art according to a known method. When the antibodies are monoclonal antibodies, they may be chimeric antibodies, humanized antibodies, or human antibodies prepared by a known method. The antibodies may also be antibody fragments, such as Fab, $F(ab)_2$, a diabody, scFv, a minibody, a peptibody, or a mimetibody. Examples of antibodies that bind to the Oscar protein include antibodies described in WO2013/011059A1.

When an antibody that binds to the Oscar protein is administered systemically, it can be administered in an amount of 0.01 to 1,000 mg/day per kg of body weight of an adult.

When an antibody that binds to the Oscar protein is administered locally, it can be administered in an amount of 0.01 to 100 mg per $cm^2$ of target tissue.

"Kidney disease" as used herein refers to any abnormality or disease of the kidneys that causes declined kidney function, and is not particularly limited as long as there is some impairment in the kidneys functionally or physically. Specific examples include acute kidney disease such as acute renal failure, acute pyelonephritis, acute glomerulonephritis (e.g., glomerulonephritis accompanied by hemolytic streptococcal infection, and rapidly progressive glomerulonephritis), and acute disease (e.g., cardiorenal syndrome type 1) among kidney disease accompanied by heart disease; chronic kidney disease such as chronic pyelonephritis, reflux nephropathy, interstitial nephritis, polycystic kidney disease, chronic glomerulonephritis (e.g., IgA nephropathy and glomerulonephritis due to systemic lupus erythematosus (lupus nephritis)), chronic disease (e.g., cardiorenal syndrome type 2) among kidney disease accompanied by heart disease, diabetic nephropathy, kidney glomerular fibrosis, and like chronic nephritis; nephrotic syndrome; and kidney tumor; and like. The kidney disease is preferably acute kidney disease. As another embodiment, the kidney disease is preferably kidney disease accompanied by ischemic heart disease, particularly acute kidney disease accompanied by ischemic heart disease (e.g., cardiorenal syndrome type 1). The kidney disease is preferably at least one disease selected from the group consisting of declined kidney function, chronic kidney disease, and renal failure.

"Declined kidney function" as used herein refers to, in the case of humans, a condition in which, for example, at least one kidney disease marker (preferably other than urinary proteins) shown in Tables 2-1 to 2-3 below, which are generally measured in clinical examination, falls outside a threshold range. More preferably, the kidney disease marker is at least one member selected from the group consisting of serum urea nitrogen, serum creatinine, serum inorganic phosphorus, fibrinogen in urine, creatinine clearance, 24-hour creatinine clearance estimated glomerular filtration rate (eGFR), urea clearance, inulin clearance, sodium thiosulfate clearance, renal plasma flow, filtration fraction, fractional excretion of sodium, fractional excretion of lithium, phenolsulfonphthalein test, concentration test, dilution test, free water clearance, free water reabsorption, maximal tubular excretory capacity, maximal tubular reabsorption capacity, rate of phosphate reabsorption, β2-microglobulin, and al-microglobulin.

"Declined kidney function" as used herein refers to, in the case of humans, a condition in which, for example, at least one kidney disease marker shown in Tables 2-1 to 2-3 below falls outside a threshold range.

TABLE 2-1

| | Item | Threshold | Unit | Measurement method |
|---|---|---|---|---|
| Serum | Total protein | 6.7 to 7.8 | g/dl | Biuret method |
| | Albumin | 3.8 to 5.3 | mg/dl | BCG method |
| | Urea nitrogen | 8 to 20 | mg/dl | Urease-GLDH method |
| | Creatinine | Male: 0.6 to 1.0<br>Female: 0 4 to 0.8 | mg/dl | Enzymatic method |
| | Uric add | Male: 3 to 7.7<br>Female: 2 to 7.7 | mg/dl | Uricase-POD method |
| | Ammonia | 12 to 66 | μg/dl | GLDH method |
| | Sodium | 136 to 145 | mEq/l | ISE |
| | Potassium | 3.4 to 4.5 | mEq/l | ISE |
| | Chlorine | 100 to 108 | mEq/l | ISE |
| | Total calcium | 8.6 to 10.1 | mg/dl | OCPC method |
| | Magnesium | 1.8 to 2.3 | mg/dl | Enzymatic method |
| | Inorganic phosphorus | Adult: 2.2 to 4.1<br>Child: 4.0 to 7.0 | mg/dl | Enzymatic method |
| | Copper | 71 to 132 | μg/dl | Chelate colorimetric method |
| | Amylase | 40 to 126 | IU/l | JSCC standardization corresponding method |
| | FGF23 | Full-length assay threshold: 10 to 50<br>C-terminal assay threshold: 150 | pg/ml<br>RU/ml | ELISA |
| Whole blood | Red blood cell count | Male: 414 to 563<br>Female: 373 to 495 | $\times 10^4/\mu l$ | Electrical resistance-type automatic blood cell counter |
| | Hemoglobin | Male: 12.9 to 17.4<br>Female: 10.7 to 15.3 | g/dl | Oxyhemoglobin method |
| | Pyruvic acid | 0.30 to 0.94 | mg/dl | Enzymatic method |

TABLE 2-2

| | Item | Threshold | Unit | Measurement method |
|---|---|---|---|---|
| Arterial blood gas analysis/acid-base | $O_2$ saturation $SaO_2$ | 94 to 99 | % | |
| | $O_2$ partial pressure $PaO_2$ | 80 to 100 | Torr | |
| | $CO_2$ partial pressure $PaCO_2$ | 35 to 45 | Torr | |
| | pH | 7.35 to 7.45 | | |

TABLE 2-2-continued

| | Item | Threshold | Unit | Measurement method |
|---|---|---|---|---|
| equilibrium | $HCO_3^-$ | 22 to 26 | mEq/l | |
| | Base excess (BE) | −2.2 to +2.2 | mEq/l | |
| | Buffer base (BB) | 46 to 52 | mEq/l | |
| | Standard bicarbonate (SB) | 21 to 25 | mEq/l | |
| Urine | Urinary output | 600 to 1,600 | ml/day | |
| | Specific gravity (spot urine) | 1.006 to 1.030 | | |
| | pH | 4.5 to 7.5 | | |
| | Urinary protein | 20 to 120 | mg/day | Pyrogallol red-Mo coloring method |
| | Albumin | 5.7 ± 2.6 | mg/day | |
| | Glucose | 2 to 20 | mg/dl | |
| Urinary sediment | Red blood cell count | <5 | /400x field | |
| | Leukocyte count | <5 | | |
| | Epithelial cell count | Less than 1 (excluding squamous epithelium) | | |
| | Cast count | <1 | | |

TABLE 2-3

| | Item | Threshold | Unit | Measurement method |
|---|---|---|---|---|
| Kidney function | Creatinine clearance (Ccr) | 70 to 130 | ml/min | |
| | 24-Hour creatinine clearance | Male: 62 to 108<br>Female: 57 to 78 | ml/ min | |
| | Glomerular filtration rate (GFR) | Male: 129 ± 26<br>Female: 97 ± 13 | ml/min | |
| | Urea clearance | Maximum clearance: 62 to 77<br>Standard clearance: 45 to 55 | ml/min | |
| | Inulin clearance (GFR) | Male: 72 to 176<br>Female: 81 to 137 | ml/min/1.73 $m^2$<br>ml/min/1.73 $m^2$ | |
| | Sodium thiosulfate clearance | Male: 90 to 138<br>Female: 86 to 120 | ml/min | |
| | Renal plasma flow (RPF) | 350 to 650 | ml/min | $C_{PAII}$ |
| | Filtration fraction (FF) | 0.18 to 0.22 | | GRF/RPF |
| | Fractional excretion of sodium | 1≤ | % | |
| | Fractional excretion of lithium | 20 to 30 | % | |
| | Phendsulfonphthalein (PSP) test | ≤100<br>15 min value: ≥25<br>120 min value: ≥55 | mOsm/kg<br>%<br>% | |
| | Concentration test | ≥1.025 | (Specific gravity) | Fishberg |
| | Dilution test | ≤ 1.006 | (Specific gravity) | Fishberg |
| | Free water clearance | At the time of water diuresis: 13 to 15 | ml/min | |
| | Free water reabsorption | At the time of concentration: 1.5 to 2.0 | ml/min | |
| | Maximal tubular excretory capacity | 81 ± 11 | mg/min/1.48 $m^2$ | $T_{mPAII}$ |
| | Maximal tubular reabsorption capacity | 340 ± 18 | mg/min/1.48 $m^2$ | $T_{mPAII}$ |
| | Rate of phosphate reabsorption | 80 to 96 | % | %TRP |
| | $\beta_2$- Microglobulin | Serum: 0.8 to 0.2<br>Urine: 11 to 253 (30 to 340) | mg/l<br>μg/day (μg/l) | LPIA<br>LPIA |
| | $\alpha_1$- Microglobulin | Serum: 10 to 30<br>Urine: 1.8 ± 0.9 | mg/l<br>mg/l | EIA<br>EIA |

The kidney disease markers described above can be measured according to known methods described in, for example, Kanai's Manual of Clinical Laboratory Medicine, Revised 32nd Edition (edited by Masamitsu Kanai; Kanehara & Co., Ltd.).

"Acute renal failure" as used herein is a disease in which kidney function is rapidly declined. For example, acute renal failure is a disease in which the serum creatinine value is rapidly increased to 2.0 to 2.5 mg/dl or more (a disease in which the serum creatinine value is increased by 50% or more compared to the previous value when there is underlying declined kidney failure), or a disease in which the serum creatinine value is increased at a rate of 0.5 mg/dl/day or more and urea nitrogen is increased at a rate of 10 mg/dl/day or more. Acute renal failure includes (1) prerenal acute renal failure, caused by a decrease in renal blood flow; (2) renal acute renal failure, in which there is damage in the renal parenchyma; and (3) postrenal acute renal failure, caused by urine flow disorder downstream of the kidneys. Acute renal function to which the present invention is preferably applied is prerenal acute renal failure and renal acute renal failure, and preferably prerenal acute renal failure.

"Chronic kidney disease" as used herein refers to, when the subject is a human, a condition in which kidney damage (for example, urine abnormalities such as proteinuria including microalbuminuria, abnormal urinary sediment, imaging abnormalities such as a single kidney and polycystic kidney disease, declined kidney function such as increased serum creatinine, electrolyte abnormalities such as hypokalemia due to tubular damage, abnormalities in histopathological examination such as renal biopsy), or declined kidney function, i.e., an estimated GFR (glomerular filtration rate) of less than 60 mL/min/1.73 $m^2$, persists for 3 months or more, according to the Clinical Practice Guidebook for Diagnosis and Treatment of Chronic Kidney Disease 2012 (edited by the Japanese Society of Nephrology).

Here, the estimated GFR (eGFR) can be calculated using the estimation formulas (eGFRcreat) from a serum creatinine value shown in Table 3 below. The estimation formulas (eGFRcys) based on serum cystatin C can be applied to those who have extremely low muscle mass, such as lower-extremity amputees.

TABLE 3

| | |
|---|---|
| Male | eGFRcreat (mL/min/1.73 $m^2$) = $194 \times Cr^{-1.094} \times age^{-0.287}$ |
| | eGFRcys (mL/min/1.73 $m^2$) = $(104 \times \text{Cys-C}^{-1.019} \times 0.996^{age}) - 8$ |
| Female | eGFRcreat (mL/min/1.73 $m^2$) = $194 \times Cr^{-1.094} \times age^{-0.287} \times 0.739$ |
| | eGFRcys (mL/min/1.73 $m^2$) = $(104 \times \text{Cys-C}^{-1.019} \times 0.996^{age} \times 0.929) - 8$ |

*This evaluation of kidney function is performed for persons aged 18 or older.

Kidney disease accompanied by heart disease is also called cardiorenal syndrome. Cardiorenal syndrome includes acute and chronic clinical states, and is categorized into multiple types. Among these, type 1 and type 2 are triggered by heart disease. Type 1 is acute cardiorenal syndrome, and type 2 is chronic cardiorenal syndrome. Type 1 may be triggered by ischemic heart disease or the like.

Cardiorenal syndrome type 1 is a condition that falls under any of the following stages 1 to 3 due to some sort of heart disease:

Stage 1: The serum creatinine value is increased to about 1.5 to 1.9 times the threshold, or the serum creatinine value is increased by 0.3 mg/dl or more compared to the previous value in the same individual, and the urinary output is about 0.5 ml/kg/hour over a period of 6 to 12 hours.

Stage 2: The serum creatinine value is increased to about 2.0 to 2.9 times the threshold, and urinary output of less than 0.5 mL/kg/hour persists for 12 hours or more.

Stage 3: The serum creatinine value is increased to about 3 times the threshold, the serum creatinine value is increased by 4.0 mg/dL or more compared to the previous value in the same individual, renal replacement therapy is started, or eGFR is decreased to less than 35 mL/min/1.73 $m^2$ in a patient under the age of 18; and, in addition to any of the above four conditions, urinary output of less than 0.3 mL/kg/hour persists for 24 hours or more, or anuria persists for 12 hours or more.

For example, in the case in which protein is used as an index, when the results of a urine test 3 months or more prior and a recent urine test show that the subject has a persistent urinary protein level of 0.15 g/gCr or more, such a condition can be diagnosed as chronic kidney disease. When the subject has diabetes and the results of an albuminuria test 3 months or more prior and a recent albuminuria test show that the subject has a persistent urinary albumin level of 30 mg/gCr or more, such a condition can be diagnosed as chronic kidney disease.

For children, a threshold of serum creatinine (Cr) can be determined by using an enzymatic method for Japanese children, and used to evaluate children with kidney function abnormalities. For example, the eGFR in % for children aged 2 or older but 11 or younger can be represented by equation 1 below.

$$\text{eGFR (\%)} = (0.3 \times \text{body height (m)} / \text{serum Cr value in subject}) \times 100 \quad \text{Equation 1}$$

In the case of non-human mammals, such as cats and dogs, it can be predicted whether a non-human mammal has chronic kidney disease from, for example, average daily water intake or urine specific gravity.

The severity of chronic kidney disease can be determined based on, for example, Table 4 below in the case of humans (Table 4 is Table 2 in the Clinical Practice Guidebook for Diagnosis and Treatment of Chronic Kidney Disease, 2012).

TABLE 4

| Primary disease | proteinuria category | A1 | A2 | A3 |
|---|---|---|---|---|
| Diabetes | Urinary albumin quantification (mg/day) Urinary albumin/Cr ratio (mg/gCr) | Normal Less than 30 | Microalbuminuria 30~299 | Macroalbuminuria 300 or more |

TABLE 4-continued

| Primary disease | | proteinuria category | | A1 | A2 | A3 |
|---|---|---|---|---|---|---|
| High blood pressure Nephritis Polycystic kidney Renal graft Unknown Others | | Urinary protein quantification (g/day) Urinary protein/Cr ratio (g/gCr) | | Normal Less than 0.15 | Mild proteinuria 0.15~0.49 | High proteinuria 0.50 or more |
| GFR Category (MI/MIN/ 1.73M2 | G1 | Normal or elevated value | ≥90 | A | B | C |
| | G2 | Normal or mild reduction | 60~89 | A | B | C |
| | G3a | Mild to moderate reduction | 45~59 | B | C | D |
| | G3b | Moderate to severe reduction | 30~44 | C | D | D |
| | G4 | Severe reduction | 15~29 | D | D | D |
| | G5 | End-stage kidney disease (ESKD) | <15 | D | D | D |

The severity is evaluated by a stage in which the primary disease, the GFR category, and the proteinuria category are combined. Regarding the severity of CKD, the risks of mortality, end-stage kidney disease, and cardiovascular mortality increase as the stage increases in the order of B, C, and D with reference to the stage A.

"Renal failure" as used herein is included in the "chronic kidney disease" described above. For example, in the case of humans, "renal failure" refers to a condition in which eGFR is less than 45 ml/min/1.73 $m^2$, preferably less than 30 ml/min/1.73 $m^2$, and more preferably less than 15 ml/min/1.73 $m^2$ in chronic kidney disease.

The disease associated with FGF23 is not limited, as long as it is a disease that develops in association with overexpression of FGF23. Examples include hypophosphatemic rickets/osteomalacia, autosomal dominant hypophosphatemic rickets/osteomalacia, autosomal recessive hypophosphatemic rickets/osteomalacia, X-linked hypophosphatemic rickets/osteomalacia, tumor-induced rickets/osteomalacia, secondary hyperparathyroidism, abnormal phosphorous metabolism in acute kidney disease or chronic kidney disease, chronic kidney disease-mineral and bone disorder (CKD-MBD), McCune-Albright syndrome, Osteoglophonic dysplasia, epidermal nevus syndrome, familial tumoral calcinosis, X-linked hypophosphatemia, and the like.

"Individual" as used herein is not particularly limited, and includes humans and non-human mammals. Examples of non-human mammals include bovines, horses, sheep, goats, pigs, dogs, cats, rabbits, monkeys, and the like. Humans, cats, and dogs are preferable. There is no limitation on the age or sex of the individual.

"Subject" is an individual to which an active ingredient is to be administered. The subject is preferably an individual with a history of declined kidney function or other kidney disease. Individuals that may be the subject preferably have symptoms, such as polyuria, thirst, increased water intake, excessive gastric juice, vomiting, bloody urine, and general malaise. Further, individuals that may be the subject include individuals suspected of having kidney damage or chronic kidney disease according to a known diagnostic method, such as a medical interview, a urine test, a biochemical test of blood, kidney diagnostic imaging, or a renal biopsy, disease animal models, and the like.

"Test tissue" as used herein refers to tissue from which a measurement value described later is to be obtained. For example, the test tissue is living tissue in vitro, for example, collected from an individual that may be the subject, and cultured in vitro. The tissue may be an entire organ or a portion of an organ.

"Test cell" as used herein refers to a cell from which a measurement value described later is to be obtained. For example, the test cell is a living cell in vitro, for example, collected from an individual that may be the subject, and cultured in vitro. The cell may be a cell whose passage capability is limited, such as a primary cultured cell; or may be a so-called cultured cell whose passage capability is maintained. Such cells may be cells prepared by genetic engineering.

"Specimen" as used herein includes cells, tissue (the adrenal glands, aorta, brain, lungs, pancreas, pituitary gland, skin, skull, skeletal muscle, spleen, testes, thyroid gland, kidneys, colon, eyeballs, heart, liver, submandibular glands, thymus, adipose tissue, stomach, jejunum, ileum, and the like), body fluids (sweat, secretions from skin, lacrimal fluid, saliva, spinal fluid, ascites fluid, and pleural effusion), urine, blood samples, and the like, derived from a subject described above. As specimens, adipose tissue, skin, hair roots, salivary glands (parotid glands, submandibular glands, and sublingual glands, and preferably parotid glands), sweat, secretions from skin, lacrimal fluid, saliva, urine, and blood samples are preferable; and saliva, salivary glands (particularly preferably parotid glands), adipose tissue, hair roots, skin, secretions from skin, and sweat are more preferable.

Moreover, "specimen" may include test tissue itself, a portion of test tissue, a test cell itself, a portion of a test cell, and a culture supernatant of test tissue or a test cell.

In the section "2. Method for obtaining each measurement value" described later, when a measurement value relating to at least one protein selected from the group consisting of proline-rich proteins (PRPs) and/or a measurement value of mRNA of the protein is obtained, the specimen is preferably saliva, salivary glands (particularly preferably parotid glands), blood sample, saliva, or like body fluid. In the same section, when a measurement value of mRNA of a kidney function prediction marker protein is obtained, the specimen is preferably the parotid glands or saliva. When a measurement value relating to at least one protein selected from the group consisting of fibrinogens and/or a measurement value of mRNA of the protein is obtained, the specimen is preferably the kidneys; or a body fluid such as a blood sample or urine. In the same section, when a measurement value of mRNA of a kidney function prediction marker protein is obtained, the specimen is preferably the kidneys.

"Blood sample" as used herein includes blood (whole blood) collected from a subject, or serum, plasma, or the like prepared from the blood. The blood sample is preferably serum or plasma, and more preferably serum. When the measurement value of mRNA is obtained, it is preferable to use whole blood. The type of anticoagulant used for collecting plasma is not particularly limited. The type of blood sample of a subject used for measurement and the type of blood sample used for determining a predetermined threshold may be the same or different, and are preferably the same. When plasma is used as a blood sample, it is preferable that plasma for determining a predetermined threshold is prepared from blood collected using the same anticoagulant as used for plasma of the subject.

Further, the specimen may be a fresh specimen, or may be a preserved specimen. When the specimen is preserved, it can be preserved in a room-temperature environment, a refrigerated environment, or a frozen environment; and cryopreservation is preferable.

Further, a specimen collected from a subject, test tissue, or test cell treated with an active ingredient may be referred to as "active-ingredient-treated specimen" in the present specification. In addition, a specimen collected from a subject, test tissue, or test cell that is not treated with an active ingredient may be referred to as "untreated specimen" in the present specification.

"Healthy individual" is not particularly limited. Preferably, the healthy individual is a human or non-human mammal that is described in the explanation of the term "individual" and that does not show abnormal data in biochemical tests, blood tests, urine tests, serum tests, physiological tests, etc. The age and sex of the healthy individual are not particularly limited.

"Proline-rich proteins (PRPs)" as used herein include acidic PRPs (aPRPs) including PRH1 and PRH2; basic PRPs (bPRPs) including PRB1, PRB2, and PRB4; glycosylated PRPs (GPRPs) including PRB3; PRPMP5; PRP2; splicing variants thereof; post-translationally modified variants thereof; and the like.

PRPs expressed from a group of genes that cluster around 132055403 to 132601236 of chromosome 6 (mm10 database: GRCm38/mm10: December 2011) in the case of mice, PRPs expressed from a group of genes that cluster around 10824960 to 11395565 of chromosome 12 (hg38 database: GRCh38/hg38: December, 2013) in the case of humans, splicing variants thereof, post-translationally modified variants thereof, and the like are preferable. At least one member selected from the group consisting of PRH1, PRP2, PRB1, and PRPMP5, splicing variants thereof, and post-translationally modified variants thereof is more preferable.

The PRH1 protein is preferably NCBI Reference sequence ID: NP_035304.4 in the case of mice, and a protein expressed from the gene shown in NCBI Gene ID: 5554 (updated on Nov. 22, 2015) in the case of humans. The PRH1 protein may also include splicing variants thereof, post-translationally modified variants thereof, and the like.

The PRP2 protein is preferably NCBI Reference sequence ID: NP_113687.2 in the case of mice, and may also include splicing variants thereof, post-translationally modified variants thereof, and the like.

The PRB1 protein is preferably NCBI Reference sequence ID: NP_941071.1 in the case of mice, and a protein expressed from the gene shown in NCBI Gene ID: 5542 (updated on Jan. 3, 2016) in the case of humans. The PRB1 protein may also include splicing variants thereof, post-translationally modified variants thereof, and the like.

The PRPMP5 protein is preferably NCBI Reference sequence ID: NP_001019876.2 in the case of mice, and may also include splicing variants thereof, post-translationally modified variants thereof, and the like.

The PRH1 mRNA is preferably NCBI Reference sequence ID: NM_011174.4 in the case of mice, and mRNA expressed from the gene shown in NCBI Gene ID: 5554 (updated on Nov. 22, 2015) in the case of humans. The PRH1 mRNA may also include splicing variants thereof and the like.

The PRP2 mRNA is preferably NCBI Reference sequence ID: NM_031499.2 in the case of mice, and may also include splicing variants thereof and the like.

The PRB1 mRNA is preferably NCBI Reference sequence ID: NM_198669.1 in the case of mice, and mRNA expressed from the gene shown in NCBI Gene ID: 5542 (updated on Jan. 3, 2016) in the case of humans. The PRB1 mRNA may also include splicing variants thereof and the like.

The PRPMP5 mRNA is preferably NCBI Reference sequence ID: NM_001024705.2 in the case of mice, and may also include splicing variants thereof and the like.

Fibrinogen (Fg) is a homodimer in which two polypeptide chains are linked by disulfide bonds, and each of the two polypeptide chains contains an Aα chain, a Bβ, chain, and a γ chain. The Aa chain, chain, and γ chain are individually encoded by three independent genes (FGA, FGB, FGG). Fibrinogens include FGA, FGB, FGG, and splicing variants thereof. In the case of humans, for example, FGA protein is NCBI Reference sequence ID: NP_000499.1 or NP_068657.1; FGB protein is NCBI Reference sequence ID: NP_005132.2 or NP_005132.2; FGG protein is NCBI Reference sequence ID: NP_068656.2 or NP_000500.2. In the case of humans, for example, FGA mRNA is NCBI Reference sequence ID: NM_000508.4 or NM_021871.3; FGB mRNA is NCBI Reference sequence ID: NM_005141.4 or NM_001184741.1; and FGG mRNA is NCBI Reference sequence ID: NM_021870.2 or NM_000509.5.

In the case of mice, for example, FGA protein is NCBI Reference sequence ID: NP_034326.1 or NP_001104518.1; FGB protein is NCBI Reference sequence ID: NP_862897.1; and FGG protein is NCBI Reference sequence ID: NP_598623.1 or NP_001304034.1. In the case of mice, for example, FGA mRNA is NCBI Reference sequence ID: NM_0NM_001111048.2.4 or NM_010196.4; FGB mRNA is NCBI Reference sequence ID: NM_181849.3; and FGG mRNA is NCBI Reference sequence ID: NM_133862.2 or NM_001317105.1. "Measurement value relating to at least one protein selected from the group consisting of proline-rich proteins (PRPs)" or "measurement value relating to at least one protein selected from the group consisting of fibrinogens" refers to a value reflecting the amount or concentration of at least one protein selected from the group consisting of PRPs, or at least one protein selected from the group consisting of fibrinogens. When the measurement value is indicated by "amount," it may be expressed on either a mole basis or a mass basis; however, it is preferable to indicate the amount on a mass basis. When the value is expressed in terms of "concentration," it may be a molar concentration or a ratio of a mass per constant volume of a specimen (mass/volume), preferably a mass/volume ratio. The value reflecting the amount or concentration may be the above, or the intensity of a signal such as fluorescence or luminescence. The measurement value relating to at least one protein selected from the group consisting of PRPs may be the measurement value of at least one protein itself selected from the group consisting of PRPs, or a value measured as the amount of proline after treating at least one protein selected from the group consisting of PRPs with an enzyme or the like. Proline can be measured by, for example, the method shown in Reference Example 3.

"Measurement value of at least one mRNA selected from the group consisting of proline-rich proteins (PRPs)" or "measurement value of at least one mRNA selected from the group consisting of fibrinogens" may be represented by the number of copies (absolute amount) of each mRNA present in a certain amount of a specimen; or may be a value reflecting the relative expression level to that of a housekeeping gene, such as β2-microglobulin mRNA, GAPDH mRNA, Maea mRNA, or β-actin mRNA. The measurement value may also be represented by the intensity of a signal such as fluorescence or luminescence.

"Anti-PRP antibody" or "anti-fibrinogen antibody" is not limited, as long as the antibody specifically binds to at least one protein selected from the group consisting of PRPs, or at least one protein selected from the group consisting of fibrinogens. For example, any of polyclonal antibodies, monoclonal antibodies, and fragments thereof (for example, Fab, $F(ab)_2$, etc.) obtained by immunizing a non-human animal with at least one protein selected from the group consisting of PRPs or a part thereof, or at least one protein selected from the group consisting of fibrinogens or a part thereof, as an antigen can be used. Additionally, immunoglobulin classes and subclasses are not particularly limited. Moreover, the anti-PRP antibody or anti-fibrinogen antibody may be a chimeric antibody. Further, the anti-PRP antibody or anti-fibrinogen antibody may be scFv or the like.

Examples of proteins used as an antigen for preparing an anti-PRP antibody or an anti-fibrinogen antibody include the entirety or a part of at least one protein selected from the group consisting of PRPs, or the entirety or a part of at least one protein selected from the group consisting of fibrinogens.

"Nucleic acid for PRP mRNA detection" as used herein is not limited, as long as it contains a sequence that specifically hybridizes to at least one mRNA selected from the group consisting of PRPs, or to a reverse transcription product of the mRNA. "Nucleic acid for fibrinogen mRNA detection" is not limited, as long as it contains a sequence that specifically hybridizes to at least one mRNA selected from the group consisting of fibrinogens, or to a reverse transcription product of the mRNA. The nucleic acid for detection may be DNA or RNA, and the nucleotides contained in the nucleic acid for detection may be naturally occurring nucleotides or artificially synthesized nucleotides.

The length of the nucleic acid for detection is not particularly limited. When the nucleic acid for detection is used as a capture probe in, for example, a microarray, the length of sequence that hybridizes to a target nucleic acid is preferably about 100 mer, more preferably about 60 mer, and even more preferably about 20 to 30 mer. The capture probe can be produced with, for example, a known oligonucleotide synthesizer. The capture probe may contain a sequence that does not hybridize to the target nucleic acid.

When the nucleic acid for detection is a primer used for PCR reactions, the length of sequence that hybridizes to a target nucleic acid is preferably about 50 mer, more preferably about 30 mer, and even more preferably about 15 to 25 mer. The primer can be produced with, for example, a known oligonucleotide synthesizer. The primer may contain a sequence that does not hybridize to the target nucleic acid. The primer may be labeled with a fluorescent dye or the like.

A probe for quantification that is decomposed during a PCR reaction may also be used for real-time quantification of a PCR product in RT-PCR, in addition to primers. The probe for quantification is not limited as long as it hybridizes to a target nucleic acid. The probe for quantification is preferably a nucleic acid with a length of about 5 to 20 mer that contains a sequence that hybridizes to a target nucleic acid. Further, it is preferred that the probe for quantification is labeled at one end with a fluorescent dye, and at the other end with a quencher of the fluorescent dye.

When the measurement value relating to at least one protein selected from the group consisting of proline-rich proteins (PRPs) (hereinafter may be abbreviated as "measurement value of a PRP protein" in the present specification) is measured, a measurement method using an anti-PRP antibody described above can be used in the process in order to obtain the measurement value. A known ELISA method or the like can be used as the measurement method for obtaining the measurement value of a PRP protein.

When the measurement value relating to at least one protein selected from the group consisting of fibrinogens (hereinafter may be abbreviated as "measurement value of a fibrinogen protein" in the present specification) is measured, a measurement method using an anti-fibrinogen antibody described above can be used in the process in order to obtain the measurement value. A known ELISA method or the like can be used as the measurement method for obtaining the measurement value of a fibrinogen protein.

In this embodiment, an anti-PRP antibody for antigen capture or an anti-fibrinogen antibody for antigen capture can be immobilized on a solid phase such as a microplate, fluorescent beads, or magnetic beads in advance, and a complex between the immobilized anti-PRP antibody or anti-fibrinogen antibody and an antigen in a specimen can be formed. The amount or concentration of the PRP protein or fibrinogen protein contained in the specimen can be measured by detecting the complex immobilized on the solid phase or the complex formed on the solid phase by a method known in the art. In this embodiment, a complex between an anti-PRP antibody for antigen capture or an anti-fibrinogen antibody for antigen capture and an antigen in a specimen may be formed in advance, and then immobilized on a solid phase.

The method for immobilizing an antibody for antigen capture on a solid phase is not particularly limited. An antibody may be directly immobilized or indirectly immobilized with another substance interposed therebetween by using a known method. Examples of direct binding include physical adsorption and the like. Preferably, for example, an immunoplate may be used to directly physically bind an antibody to the microplate.

The shape of the solid phase is not particularly limited. Examples include microplates, microtubes, test tubes, beads, and the like. The material of the solid phase is not particularly limited. For example, polystyrene, polypropylene, and the like can be used for microplates, microtubes, test tubes, etc. In the case of beads, Polystyrene xMAP (registered trademark) Beads (Luminex), MagPlex (registered trademark) Microspheres (Luminex), and the like can be used.

This method may comprise, following the formation of the complex, an operation of washing the solid phase. In washing, for example, PBS containing a surfactant or the like may be used.

In this method, the complex can be detected by using an anti-PRP antibody for detection labeled with a labeling substance or an anti-fibrinogen antibody for detection labeled with a labeling substance; or using an unlabeled anti-PRP antibody or anti-fibrinogen antibody, an anti-immunoglobulin antibody labeled with a labeling substance and capable of binding to the unlabeled anti-PRP antibody or anti-fibrinogen antibody, etc. It is preferable to use a labeled anti-PRP antibody for detection, or a labeled anti-fibrinogen antibody for detection. It is also preferable that the epitope in the antigen of the antibody for detection is different from the epitope in the antigen of the antibody for antigen capture.

The labeling substance used for the antibody for detection or the labeled anti-immunoglobulin antibody is not particularly limited, as long as the labeling substance generates a detectable signal. Examples include fluorescent substances, radioactive isotopes, enzymes, and the like. Examples of enzymes include alkaline phosphatase, peroxidase, and the like. Examples of fluorescent substances include fluorescent dyes such as fluorescein isothiocyanate (FITC), rhodamine, and Alexa Fluor (registered trademark), fluorescent proteins such as GFP, and the like. Examples of radioactive isotopes include 1251, 14C, 32P and the like. Among them, alkaline phosphatase or peroxidase is preferable as the labeling substance.

The antibody for detection is obtained by labeling an antibody with the above-mentioned labeling substance by a labeling method known in the art. Alternatively, such labeling may be performed using a commercially available labeling kit or the like. For the labeled immunoglobulin antibody, the same method as the labeling of the antibody for detection may be used, or a commercially available product may be used.

In this method, the measurement value of the kidney function prediction marker contained in the specimen can be obtained by detecting a signal generated by the labeling substance of the labeled antibody contained in the complex. Here, "detecting a signal" includes qualitatively detecting the presence or absence of a signal, quantifying the signal intensity, and semi-quantitatively detecting the signal intensity. Such semi-quantitative detection refers to indicating the signal intensity in stages such as "no signal generation," "weak," "medium," and "strong." In this step, it is preferable to detect the signal intensity quantitatively or semi-quantitatively.

As the method for detecting a signal, a known method may be used. In this method, a measurement method according to the type of signal derived from the above-mentioned labeling substance may be appropriately selected. For example, when the labeling substance is an enzyme, detection of a signal may be performed by measuring a signal such as light or color generated by the reaction of the enzyme with a substrate using a known device such as a luminometer or a spectrophotometer.

The substrate of an enzyme can be appropriately selected from known substrates depending on the type of enzyme. For example, when alkaline phosphatase is used as an enzyme, examples of substrates include chemiluminescent substrates such as CDP-Star (registered trademark) (disodium 4-chloro-3-(methoxyspiro[1,2-dioxetane-3,2'-(5'-chloro)tricyclo[3.3.1.1$^{3,7}$]decan]-4-yl)phenyl phosphate), and chromogenic substrates such as 5-bromo-4-chloro-3-indolyl phosphate (BCIP), disodium 5-bromo-6-chloro-3-indolyl phosphate, and p-nitrophenyl phosphate. When the labeling substance is peroxidase, examples of substrates include tetramethylbenzidine (TMB) and the like.

When the labeling substance is a radioactive isotope, a signal, i.e., radiation, can be measured using a known device such as a scintillation counter. When the labeling substance is a fluorescent substance, a signal, i.e., fluorescence, can be measured using a known device such as a fluorescence microplate reader or Luminex (registered trademark) system (Luminex). The excitation wavelength and the fluorescence wavelength can be appropriately determined according to the type of fluorescent substance used.

The detection results of the signal can be used as the measurement value of the PRP protein, or the measurement value of the fibrinogen protein. For example, when the signal intensity is quantitatively detected, the measurement value itself of the signal intensity or a value calculated from the measurement value of the signal intensity can be used as the measurement value of the kidney function prediction marker protein.

2. Method for Measuring PRP mRNA or Fibrinogen mRNA

The methods for obtaining a measurement value relating to at least one protein selected from the group consisting of proline-rich proteins (PRPs) and fibrinogens, and a measurement value of mRNA of the protein in the present specification are not limited, as long as the measurement values can be obtained. For example, they can be obtained according to the methods described below.

A known measurement method, such as a microarray method, an RNA-Seq analysis method, or a quantitative RT-PCR method, can be used to obtain the measurement value of at least one mRNA selected from the group consisting of proline-rich proteins (PRPs) (hereinafter may be abbreviated as "measurement value of PRP mRNA" in the present specification), or the measurement value of at least one mRNA selected from the group consisting of fibrinogens (hereinafter may be abbreviated as "measurement value of fibrinogen mRNA" in the present specification). As probes used for the microarray method, probes of one's choosing, or known probes, may be synthesized and used; or a commercially available microarray chip may be used.

In this method, any of total RNA and mRNA extracted from a specimen may be used. It is preferred that the specimen used for total RNA and mRNA extraction is subjected to RNA extraction immediately after being collected from an individual; or is frozen (preferably under an atmosphere at −196° C. or less (rapidly cooled in liquid nitrogen)) immediately after being collected from an individual, and stored at −80° C. or less until RNA extraction.

The method for extracting total RNA and mRNA from a specimen is not particularly limited, and a known extraction method may be used.

Quantification by the microarray method may be performed according to a known method. The expression level of each mRNA may be expressed as the relative expression level to that of a housekeeping gene; or expressed as the measurement value of the signal intensity of, for example, a fluorescent dye.

Quantification by RT-PCR may be performed by conducting a reverse transcription reaction using total RNA or mRNA extracted from a specimen as a template, and performing analysis by a real-time PCR method or the like with the obtained cDNA as a template by using specific primers for each mRNA. In this case, the expression level of each mRNA may be expressed as the relative expression level to that of a housekeeping gene; or expressed as the measurement value of the signal intensity of, for example, a fluorescent dye.

In the RNA-Seq analysis method, mRNA extracted from a specimen is fragmented, cDNA is synthesized by reverse transcription reaction using these fragments as a template, and libraries are prepared. The nucleotide sequence of each fragment contained in each library is determined by using a next-generation sequencer, the obtained information is mapped to a reference gene sequence, and the expression level of mRNA is represented as RPKM (Reads Per Kilobase per Million). RPKM may be represented as the intensity of a signal in, for example, a heat map.

The detection results of the signal can be used as the expression level of each mRNA. For example, when the signal intensity is quantitatively detected, the measurement value itself of the signal intensity, or a value calculated from the measurement value of the signal intensity, can be used as the expression level of each mRNA.

Examples of the value calculated from the measurement value of the signal intensity include a value obtained by subtracting, from the measurement value of the signal intensity, the measurement value of the signal intensity of a negative control sample; a value obtained by dividing the measurement value of the signal intensity by the measurement value of the signal intensity of a positive control sample; a combination thereof; and the like. Examples of negative control samples include specimens of healthy subjects and the like. Examples of positive control samples include specimens containing individual mRNAs at a predetermined expression level.

The detection results obtained by using the ELISA method, Western blotting method, quantitative RT-PCR method, RNA-Seq method, and reporter assay, and the measurement results of a chemical mediator can be used as evaluation results of function of Oscar protein. The evaluation results may be quantitative data, semi-quantitative information such as "high" and "low," or qualitative data such as "present" and "not present."

A situation in which the measurement value relating to at least one protein selected from the group consisting of proline-rich proteins (PRPs) in a specimen and/or the measurement value of mRNA of the protein in a specimen is high includes at least a case in which the measurement value derived from the specimen is higher than the measurement value of a healthy individual. This situation also includes a case in which the measurement value is higher when compared with a past measurement value in the same individual. Further, a situation in which the measurement value relating to at least one protein selected from the group consisting of fibrinogens in a specimen and/or the measurement value of mRNA of the protein in a specimen is high includes at least a case in which the measurement value derived from the specimen is higher than the measurement value of a healthy individual. This situation also includes a case in which the measurement value is higher when compared with a past measurement value in the same individual.

3. Evaluation of Function of Oscar Protein

In the present invention, the method for evaluating the function of Oscar protein is not particularly limited, as long as the function of Oscar protein can be evaluated. "Function of Oscar protein" as used herein is the original function of Oscar protein.

An example of the method for evaluating the function of Oscar protein is a method in which the presence or absence of, for example, phosphorylation or dephosphorylation of a protein downstream in the signaling pathway to which Oscar protein belongs; an increase or decrease in the expression level of a protein located downstream; activation or inactivation of the transcriptional regulatory region of a protein located downstream; or the like is detected. More specifically, when the measurement value of FGF23 protein, which is considered to be a protein downstream of Oscar protein, and/or the measurement value of mRNA of the protein in a specimen treated with a test substance is decreased, it can be determined that the test substance is a candidate substance for an active ingredient. When the measurement value of a fibrinogen protein, which is considered to be a protein downstream of Oscar protein, and/or the measurement value of mRNA of the protein in a specimen treated with a test substance is decreased, it can be determined that the test substance is a candidate substance for an active ingredient. When the measurement value of a proline-rich protein (PRP), which is considered to be a protein downstream of Oscar protein, and/or the measurement value of mRNA of the protein in a specimen treated with a test substance is decreased, it can be determined that the test substance is a candidate substance for an active ingredient. Further, when the activity of lipoprotein lipase in a specimen treated with a test substance is enhanced, it can be determined that the test substance is a candidate substance for an active ingredient.

For example, the presence or absence of phosphorylation of a protein can be detected by a known method, such as Western blotting. For example, an increase or decrease in the expression level of a protein can be detected by a known method, such as the ELISA method, Western blotting method, quantitative RT-PCR method, or RNA-Seq method. Further, activation or inactivation of the transcriptional regulatory region can be detected by a reporter assay. Examples of reporters include firefly luciferase, *Renilla* luciferase, GFP (Green Fluorescent Protein), β-galactosidase, and the like. The reporter assay can be performed according to a known method.

An example of another method for evaluating the function of Oscar protein is a method in which the binding activity of NFATc1 is observed by a reporter assay. More specifically, the binding activity can be observed by the method described in, for example, JCI 2011; 121: 3505/J Immunol 2015; 194: 3317. The function of Oscar protein can be measured by, for example, a method in which an Oscar ligand is added to NFAT-GFP reporter cells expressing a protein in which the Oscar extracellular domain is fused to the TCR CD3 signal chain, and then downstream signaling by binding of Oscar to the Oscar ligand is quantified using the amount of GFP fluorescence.

Moreover, an example of another method for evaluating the function of Oscar protein is a method in which the concentration of calcium in monocytes or dendritic cells is measured. The concentration of calcium in the cells can be measured by a known method.

Examples of another method for evaluating the function of Oscar protein include a method in which the expression level of Bcl-2 is measured by the Western blotting method or the like; and a method in which apoptosis inhibitory action is evaluated by the TUNEL method.

4. Pharmaceutical Composition and Food or Drink Composition

The present invention includes, as an embodiment, a pharmaceutical composition or a food or drink composition.

Moreover, the present invention includes, as an embodiment, a pharmaceutical composition or food or drink composition for preventing or treating kidney disease. The pharmaceutical composition or food or drink composition comprises, as an active ingredient, a substance capable of regulating the functional expression of Oscar protein.

As shown in Example 1 and Experimental Example 1 described later, a substance capable of regulating the functional expression of Oscar protein can be used for suppressing the functional expression of FGF23. Moreover, as shown in Non-patent Literature 2 to 5, it has been reported that the fibrinogen concentration in urine or blood is increased in patients with chronic kidney disease (CKD), acute kidney injury, renal fibrosis, glomerulonephritis, or like disease. Furthermore, as shown in Example 2 described later, a substance capable of regulating the functional expression of Oscar protein can be used for suppressing the expression of a fibrinogen gene in model mice ingested a diet with high phosphorus content; therefore, a substance capable of regulating the functional expression of Oscar protein is believed to improve kidney function. In the model mice ingested a diet with high phosphorus content, the mRNA expression of PRPs in the parotid glands and the amount of secretion of PRPs in saliva are increased before creatinine, which is a kidney function marker, shows changes. On the other hand, this increased expression is mitigated by a substance capable of regulating the functional expression of Oscar protein, as shown in Example 2.

The present invention thus includes, as another embodiment, a pharmaceutical composition or food or drink composition for use in suppressing the functional expression of FGF23. The present invention includes, as another further embodiment, a pharmaceutical composition or food or drink composition for being administered to an individual with a high measurement value relating to at least one protein selected from the group consisting of proline-rich proteins (PRPs) and fibrinogens in a specimen, and/or a high measurement value of mRNA of the protein in a specimen.

"Preventing kidney disease" as used herein includes preventing the onset of kidney disease; and includes suppressing a shift from normal state to declined kidney function, a shift from declined kidney function to chronic kidney disease, or a shift from a state of a lower category to a state of a higher category in the GFR categories shown in Table 4 in chronic kidney disease. "Treating kidney disease" includes improving or curing kidney disease. Here, improving means that data about at least one of the items shown in Tables 2-1 to 2-3 is shifted toward the threshold.

The pharmaceutical composition according to a first embodiment of the present invention can be prepared by combining the active ingredient described above with suitable carriers or additives. As carriers and additives that can be used for preparing the pharmaceutical composition, carriers and additives widely used in typical drugs can be used according to the dosage form of the pharmaceutical composition. Examples of carriers and additives include excipients, binders, disintegrators, lubricants, coloring agents, taste enhancers, flavor enhancers, surfactants, and the like.

When the active ingredient is a peptide, an antibody, an antibody fragment, an RNA molecule, a plasmid vector, or the like, a transfection reagent containing a polymer, a lipid, magnetism, etc., may be used as a carrier.

The dosage form of the pharmaceutical composition for oral administration is not particularly limited, and examples include tablets, powders, granules, capsules (including hard capsules and soft capsules), fluids, pills, suspensions, emulsions, and the like. The dosage form of the pharmaceutical composition for parenteral administration include injections, drops, suppositories, nasal drops, preparations for transpulmonary administration, and the like.

When the pharmaceutical composition is prepared in the form of a solid oral composition, such as tablets, powders, granules, pills, and capsules, examples of usable carriers include excipients such as lactose, saccharose, sodium chloride, glucose, urea, starch, calcium carbonate, kaolin, crystalline cellulose, silicic acid, methylcellulose, glycerol, sodium alginate, and gum arabic; binders such as simple syrups, liquid glucose, liquid starch, gelatin solutions, polyvinyl alcohol, polyvinyl ether, polyvinylpyrrolidone, carboxymethylcellulose, shellac, methylcellulose, ethylcellulose, water, ethanol, and potassium phosphate; disintegrators such as dried starch, sodium alginate, powdered agar, powdered laminaran, sodium hydrogencarbonate, calcium carbonate, polyoxyethylene sorbitan fatty acid esters, sodium lauryl sulfate, stearic acid monoglycerides, starch, and lactose; disintegration inhibitors such as saccharose, stearic acid, cocoa butter, and hydrogenated oils; absorption enhancers such as sodium lauryl sulfate; humectants such as glycerol and starch; adsorbents such as starch, lactose, kaolin, bentonite, and colloidal silicic acid; lubricants such as purified talc, stearic acid salts, powdered boric acid, and polyethylene glycol; and the like. Tablets may be optionally provided with general coatings to provide sugar-coated tablets, gelatin-coated tablets, enteric-coated tablets, film-coated tablets, double-layer tablets, multi-layer tablets, and the like.

When the pharmaceutical composition is prepared in the form of a pill, which is a solid oral composition, examples of usable carriers include excipients such as glucose, lactose, starch, cacao butter, hydrogenated vegetable oils, kaolin, and talc; binders such as powdered gum arabic, powdered tragacanth, and gelatin; disintegrators such as laminaran and agar; and the like.

When the pharmaceutical composition is prepared in the form of a capsule, which is a solid oral composition, it is prepared by mixing the active ingredient with carriers mentioned above, and filling a hard capsule, a soft capsule, or the like with the mixture.

When the preparation is a liquid preparation, it may take the form of a water-based or oil-based suspension, solution, syrup, or elixir; and can be prepared according to a common method, using generally used additives.

When the pharmaceutical composition is prepared in the form of an injection, examples of usable carriers include diluents such as water, ethyl alcohol, macrogol, propylene glycol, ethoxylated isostearyl alcohol, polyoxylated isostearyl alcohol, and polyoxyethylene sorbitan fatty acid esters; pH-adjusters such as sodium citrate, sodium acetate, and sodium phosphate; buffers such as dipotassium phosphate, trisodium phosphate, sodium hydrogen phosphate, and sodium citrate; stabilizers such as sodium pyrosulfite, EDTA, thioglycolic acid, and thiolactic acid; saccharides such as mannitol, inositol, maltose, sucrose, and lactose for use as binders in freeze-drying; and the like. In this case, glucose or glycerol may be incorporated in the pharmaceutical preparation in an amount sufficient to prepare an isotonic solution. General solubilizing agents, soothing agents, topical anesthetics, etc., may also be added to the solution. Subcutaneous, intramuscular, and intravenous injections can be prepared according to common methods by adding these carriers.

When the preparation is prepared in the form of a drop, it can be prepared by dissolving the compound to be administered in an isotonic electrolyte infusion preparation, such as physiological saline or Ringer's solution.

The dose of the pharmaceutical composition of the present invention is not particularly limited as long as the effects of the present invention are achieved, and can be suitably determined according to the dosage form; the age, sex, and condition of a patient; etc. For example, the daily dose is about 0.1 to 1,000 mg/kg, and preferably about 0.5 to 500 mg/kg, in terms of the amount of the active ingredient in an adult (15 years of age or older) (calculated based on the assumption that the body weight is about 60 kg).

The food or drink composition according to the present embodiment includes general food and food with health claims (foods with function claims, food with nutrient function claims, food for specified health uses). The definition and classification of food with health claims are in accordance with those prescribed by the Health Promotion Act and the Food Sanitation Act in Japan.

The food or drink composition according to a second embodiment of the present invention includes food and drink (pet food) for pets (e.g., dogs, cats, hamsters, rabbits, and birds), and food and drink (feed compositions) for livestock (cattle, pigs, poultry).

The food or drink composition according to the present embodiment is not particularly limited. Examples include drinks (e.g., milk beverages, lactic acid bacteria beverages, fruit-juice-containing soft drinks, carbonated drinks, fruit juice drinks, vegetable drinks, vegetable and fruit drinks, alcohol, sports drinks, powder drinks, and tea drinks), chilled desserts (e.g., jelly, bavarois, and custard pudding), iced desserts (e.g., ice cream, ice milk, lacto ice (ice cream with a milk solids content of 3% or more), and sherbet), confectioneries (e.g., cookies, biscuits, rice crackers, candies, chocolates, and gum), bread, noodles (e.g., Chinese noodles, pasta, wheat-flour noodles, buckwheat noodles, and somen (thin noodles)), soups (including powdered soup and soup cubes), seasonings (e.g., dressings, jellied seasonings, sauces, mayonnaise-like sauces, and sauces for dipping, basting, etc.), and the like.

Moreover, the food or drink composition according to the present invention includes not only food and drink in the forms described above, but also food or drink compositions in the form of a supplement and food for the sick (including food for persons in need of nursing care and food for persons with dysphagia). When the food or drink composition is prepared as a composition in the form of a supplement or as food for the sick, preferable forms thereof are, for example, fluids (drinkable preparations), syrups, dry syrups, jelly preparations (including jelly preparations prepared at the time of use; the same applies hereinafter), granules, powders, pills, tablets, capsules (hard capsules, soft capsules), lozenges, and chewables, in view of ease of continuous intake. Fluids (drinkable preparations), jelly preparations, granules, tablets, and capsules (hard capsules, soft capsules) are preferable, and fluids (drinkable preparations) and jelly preparations are more preferable. The composition in such a form can be prepared by an ordinary method for producing preparations using pharmaceutically acceptable carriers or additives according to the form of each preparation, as explained in the section of the phaLmaceutical composition described above.

If the domestic laws of a country prohibit the use, for the food or drink composition, of a statement concerning the relationship between the composition and a disease, the statement concerning the relationship with the disease can be changed so as not to violate the domestic laws. For example, an expression, such as "for keeping the kidneys in a good state (in a healthy state)," may be indicated as a use of the food or drink composition.

The dose of the food or drink composition according to the present invention is not particularly limited as long as the effects of the present invention are achieved, and can be suitably determined according to the dosage form; the age, sex, and condition of a patient; etc. For example, the daily dose is about 0.1 to 1,000 mg/kg, and preferably about 0.5 to 500 mg/kg, in terms of the amount of the active ingredient in an adult (15 years of age or older) (calculated based on the assumption that the body weight is about 60 kg).

5. Evaluation of Effect of Active Ingredient in Body

5-1. Method for Supporting Evaluation of Effect of Active Ingredient in Body The present invention includes, as a third embodiment, a method for supporting the evaluation of an effect, in the body, of an active ingredient that suppresses functional expression of Oscar protein. Specifically, the third embodiment comprises a step of obtaining a measurement value relating to at least one protein selected from the group consisting of proline-rich proteins (PRPs) and fibrinogens contained in a specimen collected from a subject to which the active ingredient has been administered (a treated specimen), and/or a measurement value of mRNA of the protein contained in a specimen collected from the subject; and a step of evaluating the effect of the active ingredient based on the measurement value(s) obtained by the obtaining step. The method may also comprise a second obtaining step of obtaining a measurement value relating to the at least one protein selected from the group consisting of proline-rich proteins (PRPs) and fibrinogens, and/or a measurement value of mRNA of the protein in a specimen collected from a subject, test tissue, or test cell that is not treated with the active ingredient (an untreated specimen). The method may further comprise a step of comparing the measurement value(s) of the treated specimen with the measurement value(s) of the untreated specimen. Moreover, in the evaluation step, the effect of the active ingredient in the body can be evaluated based on the comparison result obtained by the measurement value comparison step. Specifically, when the measurement value(s) of the treated specimen are lower than the measurement value(s) of the untreated specimen, it can be determined that the active ingredient is effective in the body.

Here, the subject, test tissue, or test cell that is not treated with the active ingredient is a subject, test tissue, or test cell that has never been treated with the test substance. Instead of using this, a comparison may be made with a measurement value relating to the at least one protein selected from the group consisting of proline-rich proteins (PRPs) and fibrinogens, and/or a measurement value of mRNA relating to the protein. Hereinafter, the same applies to the fourth and fifth embodiments.

5-2. System Configuration

FIG. 1 is an overview of a system 100 according to a fourth embodiment of the present invention, and FIG. 2 is a block diagram illustrating a hardware configuration of the system 100. As an embodiment, the system 100 comprises an evaluation device 1, an input unit 3, a display unit 4, and an analysis device 5*a* or an analysis device 5*b*.

The evaluation device 1 includes, for example, a general-purpose personal computer; and comprises a CPU 101 for performing data processing described later, a memory 102 serving as a work area for data processing, a storage unit 103 for storing processed data, a bus 104 for transmitting data between the units, and an interface unit 105 (hereinafter referred to as "I/F unit") for performing data input and output between the evaluation device and external devices. The input unit 3 and the display unit 4 are connected to the evaluation device 1. The input unit 3 includes, for example, a keyboard; and the display unit 4 includes, for example, a liquid crystal display. The input unit 3 and the display unit 4 may be integrated and implemented as a display with a touch panel. The evaluation device 1 need not be a single device; and the CPU 101, the memory 102, the storage unit 103, and the like may be located in separate places, and connected via a network. The evaluation device may also be a device that omits the input unit 3 and the display unit 4, and that does not require an operator.

The evaluation device 1 and the analysis device 5*a* or the analysis device 5*b* are also not necessarily located in one place, and may be configured such that the devices located in separate places are communicatively connected to each other via a network.

In the explanation below, a process performed by the evaluation device 1 means a process performed by the CPU 101 of the evaluation device 1 based on an evaluation program stored in the storage unit 103 or the memory 102 shown in FIG. 2, unless otherwise specified. The CPU 101 temporarily stores necessary data (such as intermediate data being processed) in the memory 102 that serves as a work area, and suitably stores data that is stored for a long period of time, such as computation results, in the storage unit 103.

The analysis device 5*a* is a device for measuring the amount or concentration of a protein, and comprises a sample placement area 51, a reaction unit 52, and a detection unit 53. A specimen, collected from a subject, set in the sample placement area 51 is dispensed into and incubated in a microplate that is placed in the reaction unit 52 and on which an antibody against an kidney function prediction marker for antibody capture is immobilized. The unreacted antigen is removed, if necessary. Thereafter, a detection antibody is dispensed into the microplate, followed by incubation. The unreacted antigen is removed if necessary, and a substrate for detecting the detection antibody is dispensed into the microplate. The microplate is transferred to the detection unit 53, and a signal generated by reaction with the substrate is measured. Another embodiment of the analysis device 5*a* is a device for measuring the expression level of mRNA by microarray analysis. A reverse transcription reaction product set in the sample placement area 51 is dispensed into a microarray chip set in the reaction unit 52, followed by hybridization. After the microarray chip is washed, it is transferred to the detection unit 53, and a signal is detected.

Further, another embodiment of the analysis device 5*a* is a device for measuring the expression level of mRNA by RT-PCR. A reverse transcription reaction product set in the sample placement area 51 is dispensed into a microtube set in the reaction unit 52, and a reagent for quantitative PCR is subsequently dispensed into the microtube. A signal in the tube is detected by the detection unit 53 while performing a PCR reaction in the reaction unit 52.

The analysis device 5*b* is a device for measuring the expression level of mRNA by the RNA-Seq method, and comprises a sequence analysis unit 54. A sample subjected to a reaction for RNA-Seq is set in the sequence analysis unit 54, and analysis of nucleotide sequences is performed in the sequence analysis unit 54.

The analysis devices 5*a* or 5*b* are connected to the evaluation device 1 by a wired or wireless connection. The analysis device 5*a* A/D converts the measurement value of a protein or the measurement value of mRNA and transmits it as digital data to the evaluation device 1. Similarly, the analysis device 5*b* A/D converts the measurement value of mRNA, and transmits it as digital data to the evaluation device 1. Therefore, the evaluation device 1 can obtain, as digital data that can be computed, the measurement value of a protein or the measurement value of mRNA.

5-3. Evaluation Device

The present invention includes, as the fourth embodiment, a device for evaluating an effect, in the body, of an active ingredient that suppresses functional expression of Oscar protein, the device comprising the following computation means:

means for obtaining a measurement value relating to at least one protein selected from the group consisting of proline-rich proteins (PRPs) and fibrinogens contained in a specimen collected from a subject to which the active ingredient has been administered (a treated specimen), and/or a measurement value of mRNA of the protein contained in a specimen collected from the subject; and means for evaluating the effect of the active ingredient based on the measurement value(s) obtained by the obtaining means.

The fourth embodiment may further comprises:

second obtaining means for obtaining a measurement value relating to the at least one protein selected from the group consisting of proline-rich proteins (PRPs) and fibrinogens, and/or a measurement value of mRNA relating to the protein in a specimen collected from a subject, test tissue, or test cell that is not treated with the active ingredient (an untreated specimen); and means for comparing the measurement value(s) of the treated specimen with the measurement value(s) of the untreated specimen. Further, the evaluation means may evaluate the effect of the active ingredient in the body based on the comparison result obtained by the measurement value comparison means. The evaluation means can determine that the active ingredient is effective in the body when the measurement value(s) of the treated specimen are lower than the measurement value(s) of the untreated specimen.

In this embodiment, an effect, in the body, of an active ingredient that suppresses functional expression of Oscar protein can be evaluated by the system 100 (FIG. 1) comprising the evaluation device 1 as the evaluation device described above.

FIG. 3 is a block diagram illustrating functions of the evaluation device 1 according to this embodiment. The evaluation device 1 comprises a first measurement value obtaining unit 11, a second measurement value obtaining unit 12, a measurement value comparison unit 13, and a candidate substance determination unit 14. The second measurement value obtaining unit 12 may be optional. These functional blocks are implemented by installing the evaluation program according to the present invention in the storage unit 103 or the memory 102 of the evaluation device 1 shown in FIG. 2, and causing the CPU 101 to execute the evaluation program. Thereby, the evaluation device 1 carries out the method in the section "5-5. Evaluation method" described later. The first obtaining means, second obtaining means, measurement value comparison means, and determination means recited in the claims correspond to the first measurement value obtaining unit 11, second measurement value obtaining unit 12, measurement value comparison unit 13, and effect determination unit 14 shown in FIG. 3, respectively.

In other words, the evaluation device 1 is a device for evaluating an effect, in the body, of an active ingredient that suppresses functional expression of Oscar protein, the device executing the following computation functions by the CPU 101:

a first obtaining function for obtaining a measurement value relating to at least one protein selected from the group consisting of proline-rich proteins (PRPs) and fibrinogens contained in a specimen collected from a subject to which the active ingredient has been administered (a treated specimen), and/or a measurement value of mRNA of the protein contained in a specimen collected from the subject; and a function for evaluating the effect of the active ingredient based on the measurement value(s) obtained by the obtaining function.

Preferably, the evaluation device 1 further executes the following functions by the CPU 101:

a second obtaining function for obtaining a measurement value relating to the at least one protein selected from the group consisting of proline-rich proteins (PRPs) and fibrinogens, and/or a measurement value of mRNA of the protein in a specimen collected from a subject, test tissue, or test cell that is not treated with the active ingredient (an untreated specimen); and a function for comparing the measurement value(s) of the treated specimen with the measurement value(s) of the untreated specimen, wherein the evaluation function evaluates the effect of the active ingredient in the body based on the comparison result obtained by the measurement value comparison function, and the evaluation function determines that the active ingredient is effective in the body when the measurement value(s) of the treated specimen are lower than the measurement value(s) of the untreated specimen.

In this embodiment, a measurement value M11 relating to each protein is put into the evaluation device 1 from the analysis device 5*a*, and a measurement value M21 of mRNA of the protein is put into the evolution device 1 from the analysis device 5*a* or 5*b*. Similarly, a measurement value M12 relating to the protein in an untreated specimen is also put into the evaluation device 1 from the analysis device 5*a*, and a measurement value M22 of mRNA of the protein is also put into the evaluation device 1 from the analysis device 5*a* or 5*b*.

The measurement values M11 and M12 relating to the protein and the measurement values M21 and M22 of mRNA of the protein in the treated specimen and the untreated specimen may also be put into the evaluation device 1 from a third-party organization (not shown) via a network.

Moreover, the functional blocks, i.e., the first measurement value obtaining unit 11, the second measurement value obtaining unit 12, the measurement value comparison unit 13, and the effect determination unit 14, are not necessarily executed by a single CPU, and may be processed by multiple CPUs in a distributed manner. For example, these functional blocks may be configured such that the functions of the first measurement value obtaining unit 11 and the second measurement value obtaining unit 12 are executed by a CPU of a first computer, and such that the functions of the measurement value comparison unit 13 and the effect determination unit 14 are executed by a CPU of a second computer, i.e., another computer.

5-4. Evaluation Program

In order to carry out the processing for steps S11 to S17 in FIG. 4 below, the evaluation device 1 according to the fourth embodiment of the present invention stores the evaluation program according to this embodiment in the storage unit 103 beforehand, for example, in an executable format (for example, a form in which the program can be produced by conversion from a programming language using a compiler). The evaluation device 1 carries out the processing using the evaluation program stored in the storage unit 103.

Specifically, the evaluation program according to the fourth embodiment of the present invention is an evaluation program that, when executed by a computer, causes the computer to carry out the following processing to evaluate an effect, in the body, of an active ingredient that suppresses functional expression of Oscar protein:

first obtaining processing of obtaining a measurement value relating to at least one protein selected from the group consisting of proline-rich proteins (PRPs) and fibrinogens contained in a specimen collected from a subject to which the active ingredient has been administered (a treated specimen), and/or a measurement value of mRNA of the protein contained in a specimen collected from the subject; and processing of evaluating the effect of the active ingredient based on the measurement value(s) obtained by the obtaining processing.

The evaluation program may further cause the computer to carry out second obtaining processing of obtaining a measurement value relating to the at least one protein selected from the group consisting of proline-rich proteins (PRPs) and fibrinogens, and/or a measurement value of mRNA of the protein in a specimen collected from a subject, test tissue, or test cell that is not treated with the active ingredient (an untreated specimen); and processing of comparing the measurement value(s) of the treated specimen with the measurement value(s) of the untreated specimen. In the evaluation processing, the effect of the active ingredient in the body may be evaluated based on the comparison result obtained by the measurement value comparison processing. In the evaluation processing, it can be determined that the active ingredient is effective in the body when the measurement value(s) of the treated specimen are lower than the measurement value(s) of the untreated specimen.

In this embodiment, as shown in FIG. 2, the evaluation program is stored in a computer-readable non-transitory tangible storage medium 109, such as a CD-ROM, and is installed in the evaluation device 1 from the storage medium 109; alternatively, the evaluation device 1 may be connected to the internet (not shown) to download the program code of the evaluation program via the internet.

5-5. Evaluation Method

FIG. 4 is a flow chart illustrating a flow of data processing performed by the evaluation device 1 according to the fourth embodiment of the present invention to carry out the evaluation method. Steps S11, S12, and S13 are performed by the first measurement value obtaining unit 11, second measurement value obtaining unit 12, and measurement value comparison unit 13 shown in FIG. 3, respectively. Steps S14 to S17 are performed by the effect determination unit 14 shown in FIG. 3.

In step S11, the first measurement value obtaining unit 11 obtains a measurement value M11 relating to each protein and/or a measurement value M21 of mRNA of the protein in a treated specimen.

In step S12, the second measurement value obtaining unit 12 obtains a measurement value M12 relating to the protein and/or a measurement value M22 of mRNA of the protein in an untreated specimen.

In step S13, the measurement value comparison unit 13 compares the measurement value(s) of the treated specimen obtained in step S11 with the measurement value(s) of the untreated specimen obtained in step S12. The comparison result is output to the effect determination unit 14.

The effect determination unit 14 determines that the active ingredient is effective in the body based on the comparison result obtained by the measurement value comparison unit 13. More specifically, when the comparison result indicates that the measurement value(s) of the treated specimen are lower (YES in step S14), the effect determination unit 14 determines, in step S15, that the active ingredient is effective in the body.

More specifically, when a value obtained by dividing M11 by M12 or a value obtained by dividing M21 by M22 is, for example, 0.85 or less, preferably 0.7 or less, and more preferably 0.5 or less, the measurement value comparison unit 13 determines that the active ingredient is effective in the body, and outputs the comparison result such that the active ingredient is effective.

In step S17, the effect determination unit 14 outputs the result determined in step S15. In this embodiment, whether the active ingredient is effective in the body is displayed on the display unit 4, and the determination result is stored in the storage unit 103 in the evaluation device 1. The determination result may be displayed on a display unit of an external computer terminal connected to the evaluation device 1 via the internet, for example, a display unit of a computer terminal in a third-party organization (not shown), instead of displaying the determination result on the display unit 4.

When the comparison result indicates that the measurement value(s) of the treated specimen are not lower in step S14, the processing proceeds to step S16, and the effect determination unit 14 determines that the active ingredient is not effective in the body. In this case, the result such that the active ingredient is not effective may be displayed on the display unit 4.

6. Genome Editing System and Kit Comprising the System

The present invention includes a genome editing system comprising a sequence that targets Oscar gene described in the above section "1. Explanation of terms." The genome editing system is preferably a CRISPR/Cas9 system comprising a sequence that targets Oscar gene. The CRISPR/Cas9 system comprising a sequence that targets Oscar gene may be a combination of gRNA, tracrRNA, and RNA encoding Cas9. In this case, the gRNA, tracrRNA, and RNA encoding Cas9 may be provided in the same package, or in separate packages.

The genome editing system comprising a sequence that targets Oscar gene according to the present invention may be provided in the form of a kit.

For example, when the genome editing system is a vector, the kit may comprise, in addition to the vector, a package insert, a transfection reagent such as a liposome, a buffer for dissolving the vector, a sequestering agent, and the like.

When the genome editing system is RNA, the kit may comprise, in addition to the RNA, a package insert, a transfection reagent such as a liposome, a buffer for dissolving the RNA, an RNase inhibitor, a sequestering agent, and the like. Moreover, the kit may comprise both gRNA and RNA encoding Cas9, or may comprise only gRNA.

The kit can be used for preventing, improving, or treating kidney disease.

EXAMPLES

The present invention is described in more detail below with reference to examples. The present invention, however, should not be construed as limited to the examples.

Example 1: Preparation of Soluble Human Oscar-Fc Fusion Protein

An expression plasmid containing a nucleotide sequence encoding a soluble human Oscar-Fc fusion protein was expressed in animal cells, thereby preparing the soluble human Oscar-Fc fusion protein shown in SEQ ID NO: 2. The preparation of the protein was outsourced to Protein-Express Co., Ltd. (Chiba, Japan).

```
<Amino acid sequence of humanOscar-humanIgG1>
                                        (SEQ ID NO: 2)
MALVLILQLLTLWPLCHTDITPSVAIIVPPASYHPKPWLGAQPATVVTPG

VNVTLRCRAPQPAWRFGLFKPGEIAPLLFRDVSSELAEFFLEEVTPAQGG

SYRCCYRRPDWGPGVWSQPSDVLELLVTEELPRPSLVALPGPVVGPGANV

SLRCAGRLRNMSFVLYREGVAAPLQYRHSAQPWADFTLLGARAPGTYSCY

YHTPSAPYVLSQRSEVLVISWEGEGPEARPASDKTHTCPPCRAPELLGGP

SVFLFPPKPKDTLMISRTPEVTCVVVDVSHEDPEVKFNWYVDGVEVHNAK

TKPREEQYNSTYRVVSVLTVLRQDWLNGKEYKCKVSNKALPAPIEKTISK

AKGQPREPQVYTLPPSREEMTKNQVSLTCLVKGFYPSDIAVEWESNGQPE

NNYKTTPPVLDSDGSFFLYSKLTVDKSRWQQGNVESCSVMHEALHNHYTQ

KSLSLSPGK*
```

(The underline indicates a hinge region. The upstream from the hinge region indicates the sequence of human Oscar, and the downstream from the hinge region indicates the human IgG1 sequence.)

1. Preparation of Cells

FreeStyle 293-F cells were subcultured in FreeStyle 293 Expression Medium (Invitrogen). The subculture was performed using a 500 ml flask at the following conditions: a shaking speed of 120 r.p.m., a carbon dioxide concentration of 8%, and a temperature of 37° C. (170 mL of medium). The cells were diluted at $6\times10^5$ cells/mL to a total amount of 1 L the day before transfection, and cultured for 24 hours. After the culture, the number of cells was adjusted to $1\times10^6$ cells/mL, and the cells were used for transfection.

2. Expression Test 2.1 mL of 293fectin Transfection Reagent (Invitrogen) was added to 30 mL of OptiPRO SFM (Invitrogen) prewarmed to 37° C., thereby preparing a reagent solution. Similarly, 1 mg of pcDNA3 (Invitrogen) containing kozak-hOscar-hIgG1-intronXbaI having the following sequence was added to 30 mL of OptiPRO SFM, thereby preparing a DNA solution. The prepared reagent solution and DNA solution were incubated at room temperature for 5 minutes. The reagent solution and DNA solution after the 5 minutes were mixed to prepare a transfection solution. The transfection solution was incubated at room temperature for 20 minutes and added to the culture medium adjusted for transfection, followed by sampling on day 1, day 2, and day 3 after the start of the transfection. The culture was then terminated on day 4. The obtained samples were centrifuged to separate into a supernatant and a precipitate. The protein expression was confirmed by SDS-PAGE and Western blotting.

<kozak-hOscar-hIgG1-intronXbaI>

(SEQ ID NO: 5)

aagcttgccaccATGGCCCTCGTGCTTATCCTCCAACTTCTCACGCTT

TGGCCTCTGTGCCACACCGACATTACTCCGTCTGTTGCGATAATTGTC

CCTCCCGCCTCTTATCACCCTAAACCTTGGCTGGGCGCACAGCCAGCT

ACTGTGGTTACTCCTGGGGTGAACGTAACACTGCGCTGCCGTGCTCCT

CAGCCCGCCTGGAGATTTGGGTTGTTTAAGCCCGGAGAGATAGCACCA

CTGCTGTTTCGGGATGTGTCCTCAGAGCTGGCTGAGTTCTTCCTGGAA

GAGGTCACTCCTGCCCAAGGAGGCAGCTATCGGTGCTGTTATAGGCGG

CCGGATTGGGGACCCGGCGTTTGGTCCCAACCATCTGATGTGCTCGAA

CTGCTTGTGACAGAAGAGCTGCCCAGACCTAGCTTGGTAGCCTTGCCC

GGTCCTGTCGTCGGACCTGGTGCCAATGTTTCTCTTCGATGTGCCGGA

AGGCTGCGCAATATGTCCTTTGTACTGTATAGGGAGGGAGTAGCCGCA

CCTCTGCAGTATAGGCATAGCGCTCAGCCCTGGGCGGATTTTACTCTG

CTTGGTGCCAGAGCACCCGGGACCTATTCCTGCTACTACCACACTCCT

TCCGCACCCTACGTCCTGTCACAGAGATCAGAAGTGCTCGTGATCTCC

TGGGAGGGAGAAGGCCCAGAAGCCGACAAAACTCACACATGCCCACCG

TGCCCAGgtaagccagcccaggcctcgccctccagctcaaggcgggac aggtgccctagagtagcctgcatccagggacaggccccagccgggtgc tgacacgtccacctccatctcttcctcagCACCTGAACTCCTGGGGGG

ACCGTCAGTCTTCCTCTTCCCCCCAAAACCCAAGGACACCCTCATGAT

CTCCCGGACCCCTGAGGTCACATGCGTGGTGGTGGACGTGAGCCACGA

AGACCCTGAGGTCAAGTTCAACTGGTACGTGGACGGCGTGGAGGTGCA

TAATGCCAAGACAAAGCCGCGGGAGGAGCAGTACAACAGCACGTACCG

TGTGGTCAGCGTCCTCACCGTCCTGCACCAGGACTGGCTGAATGGCAA

GGAGTACAAGTGCAAGGTCTCCAACAAAGCCCTCCCAGCCCCCATCGA

GAAAACCATCTCCAAAGCCAAAGgtgggacccgtggggtgcgagggcc acatggacagaggccggctcggcccaccctctgccctgagagtgactg ctgtaccaacctctgtccctacagGGCAGCCCCGAGAACCACAGGTGT

ACACCCTGCCCCCATCCCGGGATGAGCTGACCAAGAACCAGGTCAGCC

TGACCTGCCTGGTCAAAGGCTTCTATCCCAGCGACATCGCCGTGGAGT

GGGAGAGCAATGGGCAGCCGGAGAACAACTACAAGACCACGCCTCCCG

TGCTGGACTCCGACGGCTCCTTCTTCCTCTACAGCAAGCTCACCGTGG

ACAAGAGCAGGTGGCAGCAGGGGAACGTCTTCTCATGCTCCGTGATGC

ATGAGGCTCTGCACAACCACTACACGCAGAAGAGCCTCTCCCTGTCTC

CGGGTAAATGAtctaga

3. Purification Using Bipo Resin Protein A

The culture supernatant (1 L) was loaded on Bipo Resin Protein A (10 mL) to purify a target protein. After washing with PBS, elution of the target protein was performed using 100 mM citric acid buffer (pH 2.5) (5 mL×5). The eluate was neutralized with 1M Tris-HCl (pH 9.0). After the purification, protein purification was confirmed in each fraction by SDS-PAGE and Western blotting. The results confirmed a band of the target protein in the elution fraction. The fraction containing the target protein was collected, followed by a buffer exchange into PBS (total amount: 50 mL). Thereby, 1 mg/mL of a soluble human Oscar-Fc fusion protein was obtained.

Example 2: Experiment of Administration of Soluble Human Oscar-Fc Fusion Protein to HP Model Mice HP mice (mice ingested a diet with high phosphorus content) were obtained by feeding mice a diet with high phosphorus content. The soluble human Oscar-Fc fusion protein was administered to this model every week.

1. Phosphorus Overload

Mice ingested a diet with high phosphorus content (HP) were obtained by feeding mice (C57BL/6N, 8 weeks old, male) a diet containing 2% inorganic phosphorus (TD.10662, OrientalBioService, Inc.) as a special phosphorus diet. Mice ingested a diet with low phosphorus content (LP) were fed a diet containing 0.35% inorganic phosphorus (TD.10662 modified type, OrientalBioService, Inc.).

2. Administration of Soluble Human Oscar-Fc Fusion Protein and Collection of Tissue The soluble human Oscar-Fc fusion protein (10 mg/kg) was intraperitoneally administered weekly from the start date of the diet with high phosphorus content (week 0) to week 4, i.e., a total of five times. In this experiment, physiological saline was administered to a control group. Tissue was collected the day after completion of the intraperitoneal administration on week 4, i.e., the fifth intraperitoneal administration. The animals from which the tissue was to be collected were euthanized by cervical dislocation after blood was collected in an EDTA-supplemented tube from the orbit under tribromoethanol anesthesia (250 mg/kg), and the organs and tissue (the skull, brain, pituitary gland, parotid glands, thyroid gland, heart, lung, pancreas, kidney, adrenal glands, liver, spleen, thymus, aorta, femoral muscle, skin, testis, adipose tissue, stomach, jejunum, ileum, colon, and bone marrow cells) were collected. After the wet weights of the collected organs and tissue were measured, the organs and tissue were rapidly frozen in liquid nitrogen and stored at −80° C. The collected blood was centrifuged at 1200 g for 10 minutes at room temperature. After the centrifugation, the supernatant plasma was collected and stored at −80° C.

3. Analysis of Gene Expression in Each Tissue 3-1. RNA Extraction from Each Tissue Each cryopreserved tissue was individually homogenized in TRIzol Reagent (Thermo Fisher Scientific, MA, USA) with a PT10-35 GT Polytron homogenizer (KINEMATICA, Luzern, Switzerland) at 15,000 r.p.m. for 10 minutes, or homogenized using zirconia beads of different sizes (1.5 mm diameter×50, 3 mm diameter×5, 5 mm diameter×2) with a Cell Destroyer PS1000 or PS2000 (Bio Medical Science Inc., Tokyo, Japan) at 4,260 r.p.m. for 45 seconds at 4° C. After incubation at room temperature for 5 minutes to separate proteins, 0.2 ml of chloroform was added per 1 mL of TRIzol, and the tube was capped. Subsequently, the mixture was vortexed vigorously for 15 seconds. After the vortexing, the mixture was incubated at room temperature for 3 minutes and centrifuged at 12,000 g for 15 minutes at 4° C., and the RNA-containing aqueous layer was collected in a fresh tube. An equal amount of 70% ethanol was added to the collected aqueous layer, and mixed. Then, 700 μL of the mixture was applied to each RNeasy Mini column (Qiagen), and purified RNAs were collected according to the RNeasy Mini kit (Qiagen) standard protocol. The quality and concentration of each of the collected RNAs was evaluated by using NanoDrop (Thermo Fisher Scientific, MA, USA).

3-2. qRT-PCR 0.5 to 1 μg of total RNA obtained from each tissue was used as a template for cDNA synthesis, and cDNA was synthesized using Oligo dT20 primer according to the standard protocol of SuperScript III First-Strand Synthesis SuperMix (Life Technologies). After the synthesized cDNA was diluted 20-fold with TE buffer (10 mM Tris-HCl, pH 8.0, 0.1 mM EDTA), real-time PCR was performed with a LightCycler 480 II (Roche) according to the standard protocol of LightCycler 480 SYBR Green I Master (Roche, Basel, Switzerland), and Cp values were measured. The relative expression level of each gene to a reference gene was quantified by comparing the Cp value obtained for each gene with the Cp value for Maea as the reference gene. The primer pairs used in the real-time PCR are as shown in Table 5. All of the primers were designed by using Primer-BLAST (NCBI).

TABLE 5

| | Gene | Forward | SEQ ID NO. | Reverse | SEQ ID NO. |
|---|---|---|---|---|---|
| 1 | Maea | AAGACCTTGAGTAGTTGCCCA | (6) | TGCTCGATCCTACGTTTGCAG | (7) |
| 2 | Fgf23 | AGGAGCCATGACTCGAAGGT | (8) | GCTCACCAGGTAGTGATGCTT | (9) |
| 3 | Prb1 | ACCCCAGCATGGAAACAAAG | (10) | AAGAATGGTATTGAAGTCATCTGTC | (11) |
| 4 | Prh1 | ACCCCGTGAAGAAAATCAGAA | (12) | TAACAGGCGGTCTTGGTTGG | (13) |
| 5 | Prp2 | TGGTGGTCCTGTTTACAGTGG | (14) | TTCTGAAGTTCTTCACGGGGT | (15) |
| 6 | Prpmp5 | CCTACGAAGACTCAAATTCTCAGC | (16) | GAGGACCATGGTGGTGTCC | (17) |
| 7 | B2m | GCTCGGTGACCCTGGTCTTT | (18) | AATGTGAGGCGGGTGGAACT | (19) |
| 8 | Fgg | CTCCATCGGAGAAGGACAGC | (2016) | AGGTCCTGAAAGTCCATTGTCC | (2017) |

4. Measurement of Concentration of FGF23 in Plasma by ELISA Method

The concentration of FGF23 in plasma was measured using an ELISA kit sold by KAINOS Laboratories, Inc. (TCY4000). A plasma sample cryopreserved in a freezer was thawed on ice, and the sample undiluted or the sample diluted 5-fold with standard solution 1 (FGF-23 concentration, 0 pg/ml) supplied with the kit was used for measurement.

50 μl of the diluted sample or a sample for a calibration curve was added to each well of an ELISA plate supplied with the kit. The plate was sealed, followed by stirring and incubating at room temperature for 2 hours. After the 2 hours, the sample in each well was aspirated and discarded. 300 μl of a wash solution supplied with the kit was then added to each well, and the wash solution was removed. This operation was performed four times. After the wash solution was thoroughly removed, 100 μl of an enzyme-labeled antibody solution (FGF-23 Conjugate) supplied with the kit was added to each well, and the plate was sealed, followed by stirring and incubating at room temperature for 1 hour. After the 1 hour, the sample in each well was aspirated and discarded. 300 μl of the wash solution supplied with the kit was then added to each well, and the wash solution was removed. This operation was performed four times. After the wash solution was thoroughly removed, 100 μl of a substrate solution (Substrate) supplied with the kit was added to each well, and the plate was allowed to stand at room temperature for 30 minutes in the shade. Thereafter, 100 μl of a reaction stop solution (Stop Solution) supplied with the kit was added to each well, followed by gentle shaking. Absorbance at 450 nm was then measured with an absorbance microplate reader (Multiskan GO, Thermo Fisher Scientific Inc.). The concentration of FGF23 in plasma was calculated by making a calibration curve from the measurement result of recombinant FGF23 supplied with the kit.

5. Statistical Analysis

In statistical analysis, Student's t-test or one-way analysis of variance was performed, and then significant differences were determined by the Tukey-Kramer test. The case in which the p-value is less than 0.05 was defined as being significant.

6. Results

Hereinafter, in the drawings, HP4W indicates mice 4 weeks after the start of the diet with high phosphorus content, and LP4W indicates mice 4 weeks after the start of the diet with low phosphorus content (control group). sOscar indicates mice to which the soluble human Oscar-Fc fusion protein was administered, and NS indicates mice to which physiological saline was administered in place of the soluble human Oscar-Fc fusion protein. WT (12W) indicates 12-week-old male wild-type mice fed a normal diet.

FIG. 5 shows qRT-PCR results of FGF23 in the skull. FIG. 6 shows qRT-PCR results of PRP genes in the parotid glands. FGF23 is a master regulator of inter-organ cross talk between the parathyroid glands, bones, and kidneys in kidney disease. The expression of FGF23 was induced by the diet with high phosphorus content in the skulls. However, the expression of FGF23 was suppressed by administration of the soluble human Oscar-Fc fusion protein (FIG. 5) (n=5 to 6). The expression was normalized by by the expression of the Maea gene, and a significance test was performed. The results showed a significant difference (p=0.026) between HP to which sOscar was administered and HP to which sOscar was not administered. The expression of PRP genes (Prb1, Prh1, Prp2, and Prpmp5) whose expression is induced by the diet with high phosphorus content was suppressed by administration of the soluble human Oscar-Fc fusion protein in the parotid glands (FIG. 6) (n=5 to 6). From the above, it was indicated that the expression of renal failure early markers FGF23 gene (the skull) and PRP genes (the parotid glands) was suppressed by administration of the soluble human Oscar-Fc fusion protein to the model mouse of phosphorus overload for 4 weeks.

FIG. 7 shows ELISA measurement results of FGF23 in plasma. In HP, the concentration of FGF23 in plasma was higher than that in LP4W and WT (12W). The increase in the concentration of FGF23, which is a renal failure early marker in blood, was statistically significantly suppressed by administration of the soluble human Oscar-Fc fusion protein to HP (p=0.049).

As described later, qRT-PCR analysis in the bones of the 1-week model of Oscar gene mutant mice fed the diet with high phosphorus content showed that the increase in the expression of renal failure early marker FGF23 gene was significantly suppressed. In this experiment, administering the soluble human Oscar-Fc fusion protein, which has an effect of inhibiting ligand binding to Oscar, from the early stage of phosphorus overload suppressed the expression of the FGF23 gene, which is deeply involved in clinical states such as chronic kidney disease, in the bones; and further suppressed the increase in the concentration of FGF23 in plasma. This showed the potential of administering the soluble human Oscar-Fc fusion protein as a novel treatment method for improving a clinical state caused by an excess phosphorus state, such as kidney damage.

To evaluate the effect of the soluble Oscar-Fc fusion protein on kidney function, the expression of a kidney function marker was confirmed in the kidneys of HP4W NS, HP4W sOscar, and LP4W.

In the kidneys, the expression of the Fgg gene, which is a fibrinogen gene whose expression is induced by a diet with high phosphorus content, was significantly suppressed by administration of the soluble Oscar-Fc fusion protein (FIG. 19) (p=0.00071; n=5 to 6). Fibrinogen genes have been reported as kidney function markers and therapeutic targets. Thus, the results suggest that at least one disease selected from the group consisting of declined kidney function, chronic kidney disease, and renal failure, which are associated with a high-phosphorus state, can be prevented or treated by administering the soluble Oscar-Fc fusion protein.

Experimental Example I. Establishment of Oscar Gene Mutant Mice

1. Construction of gRNA and Cas9 Expression Vector gRNA sequences (Oscar-gRNA1 and Oscar-gRNA2) were designed, and oligo DNA encoding the gRNA sequences was synthesized using an Optimized CRISPR design tool (publicly available on the website of Massachusetts Institute of Technology, Zhang Lab (http://crispr.mit.edu/)). The Oscar gene target sequences contained in these sequences are the following sequences: ACAGCTGGAGTATCAGCGAC (SEQ ID NO: 20) in Oscar-gRNA1 and GCTCACAGAGAGTCGACAGC (SEQ ID NO: 21) in Oscar-gRNA2, which are present in exon 1 of the Oscar gene. These were individually inserted into pX330-U6-Chimeric_BB-CBh-hSpCas9, which is a Cas9 expression vector (pX330-Oscar-gRNA1 and pX330-Oscar-gRNA2). The nucleotide sequences of the gRNA insertion sites in the obtained vectors were determined to confirm that gRNA was inserted as designed. In addition, single-stranded oligodeoxynucleotides (ssODNs) were individually synthesized so as to include the respective Oscar gene target sequences. The donor oligo DNA region was designed so that a stop codon is placed immediately downstream of the Serine coding sequence of the predetermined Oscar-gRNA1 cleavage site, and immediately downstream of the Leucine coding sequence of the predetermined Oscar-gRNA2 cleavage site (FIG. 8A and FIG. 8B).

```
ssODNs for Oscar-gRNA1:
                                                    (SEQ ID NO: 22)
GCCAAGGATCCACACACAGGGGAGGGGACAGCTCACAGAGAGTCGACA

GCTGGAGTATCAGcctcagaagaactcgtcaagaagtcaCGACAGGAC

CATGGTGGGCACTCTCCGTGGAGCTGAGGAAAAGGTTGACCCTGCCTT

TTT

ssODNs for Oscar-gRNA2:
                                                    (SEQ ID NO: 23)
ATAGCCCTCAGCCCAGCCAAGGATCCACACACAGGGGAGGGACAGCTC

ACAGAGAGTCGAcctcagaagaactcgtcaagaagtcaCAGCTGGAGT

ATCAGCGACAGGACCATGGTGGGCACTCTCCGTGGAGCTGAGGAAAAG

GT
```

2. Establishment of Oscar Gene Mutant Mice pX330-Oscar-gRNA1 and pX330-Oscar-gRNA2 were individually injected into C57BL/6N Slc fertilized eggs together with the corresponding ssODNs. The fertilized eggs after the injection were injected into the oviducts of pseudopregnant ICR female mice. The genotype of the F0 mice was confirmed by PCR (for the primers, see Table 5) and direct sequencing. F1 mice were obtained by mating the F0 mice.

The genotype of each mouse was determined by direct sequencing and high-resolution melting (HRM) analyses using the primers shown in Table 5.

FIG. 8C shows the sequences of the genotypes of the obtained mutant mice.

Experimental Example II. Establishment of Disease Model Mice

1. Establishment of UNx/HPi Model Mice

UNx/HPi mice (unilateral nephrectomy—a diet with high phosphorus content-ingested mice) were obtained by feeding mice a diet with high phosphorus content after unilateral nephrectomy. As a control, mice were obtained by feeding them a diet with low phosphorus content after a sham operation.

1-1. Unilateral Nephrectomy

After mice (C57BL/6J, 8 weeks old, male) were anesthetized by intraperitoneal administration of Avertin (250 mg/kg), the skin was incised from the back. The right renal artery and vein, and ureter were ligated. After cutting on the distal side of the ligation, the right kidney was removed, and the incision was closed. The control mice were subjected to a sham operation. In the sham operation, the right renal artery and vein, and ureter were exposed, and the incision was closed without ligation. In order to wait for the mice to completely recover from operative stress, the mice were fed a 0.54% inorganic phosphorus-containing normal diet (CE-2, CLEA Japan, Inc.) for 4 weeks.

1-2. Phosphorus Overload and Collection of Tissue

From 4 weeks after the completion of the operation (12 weeks old), the unilaterally nephrectomized mice were given a diet with high phosphorus content in which contains 2% inorganic phosphorus (TD.10662, OrientalBioService, Inc.) (hereinafter also referred to as the "kidney disease group"). The sham-operated mice were given a diet with low phosphorus content in which contains 0.35% inorganic phosphorus (TD.10662 modified type, OrientalBioService, Inc.) (hereinafter also referred to as the "Sham group").

The model mice of chronic kidney disease were obtained by a modification of the method described in Hu M. C. et al.

(J Am Soc Nephrol 22, 124-136, 2011). In Hu M. C. et al., the remaining kidney (left kidney) is subjected to ischemia-reperfusion injury at the time of unilateral nephrectomy in Item 1 above. However, in this modification, ischemia-reperfusion was not performed. Tissue was collected 1 week (E), 4 weeks (M), and 8 weeks (L) after the start of the a diet with high phosphorus content (the diet with low phosphorus content in the Sham group).

The animals from which the tissue was to be collected were euthanized by cervical dislocation after blood was collected from the orbit under anesthesia, and the organs and tissue (bone marrow, brain, skin, heart, kidney, liver, lung, pancreas, skeletal muscle, spleen, testis, thymus, adipose, colon, stomach, adrenal glands, aorta, eyes, ileum, jejunum, pituitary gland, skull, salivary glands, and thyroid gland) were collected. After the wet weights of the collected organs and tissue were measured, the organs and tissue were rapidly frozen in liquid nitrogen and stored at −80° C.

2. Establishment of Model of Phosphorus-Overloaded Mice 2-1. Phosphorus Overload WT mice (C57BL/6N, 7 weeks old, male) or Oscar gene mutant mice (7-16 weeks old, male/female) were fed a 0.54° inorganic phosphorus-containing normal diet (CE-2, CLEA Japan, Inc.) for 1 week. Thereafter, the mice were given a diet with high phosphorus content in which contains 2% inorganic phosphorus (TD.10662, OrientalBioService, Inc.) or a diet with low phosphorus content in which contains 0.35% inorganic phosphorus (TD.10662 modified type, OrientalBioService, Inc.) as a special phosphorus diet.

2-2. Collection of Tissue

The skull was collected at the time of the start of the special phosphorus diet fed to the WT mice (8 weeks old), 1 day, 3 days, 1 week (9 weeks old), and 4 weeks (12 weeks old) after the start. In the Oscar gene mutant mice, the skull was collected 1 week after the start of the special phosphorus diet. The animals from which the tissue was to be collected were euthanized by cervical dislocation after being anesthetized by intraperitoneal administration of Avertin (250 mg/kg), and the tissue was collected. After the weight of the collected tissue was measured, the tissue was rapidly frozen in liquid nitrogen, and stored at −80° C.

Experimental Example III. Analysis of Gene Expression in Each Tissue

1. Extraction of RNA from Each Tissue

Each cryopreserved tissue was individually homogenized in TRIzol Reagent (Thermo Fisher Scientific, MA, USA) with a PT10-35 GT Polytron homogenizer (KINEMATICA, Luzern, Switzerland) at 15,000 r.p.m. for 10 minutes; or ground with a mortar and pestle in liquid nitrogen, dried, and then homogenized in TRIzol Reagent (Thermo Fisher Scientific, MA, USA) with a PT10-35 GT Polytron homogenizer (KINEMATICA, Luzern, Switzerland) at 15,000 r.p.m. for 10 minutes; or homogenized using zirconia beads of different sizes (1.5 mm diameter×50, 3 mm diameter×5, 5 mm diameter×2) with Cell Destroyer PS1000 or PS2000 (Bio Medical Science Inc., Tokyo, Japan) at 4,260 r.p.m. for 45 seconds at 4° C. After incubation at room temperature for 5 minutes to separate proteins, 0.2 mL of chloroform was added per mL of TRIzol, and the tube was capped. Subsequently, the mixture was vortexed vigorously for 15 seconds. After the vortexing, the mixture was incubated at room temperature for 3 minutes and centrifuged at 12,000 g for 15 minutes at 4° C., and the RNA-containing aqueous layer was collected in a fresh tube. An equal amount of 70% ethanol was added to the collected aqueous layer, and mixed. Then, 700 μL of the mixture was applied to each RNeasy Mini column (Qiagen), and purified RNAs were collected according to the RNeasy Mini kit (Qiagen) standard protocol. The quality and concentration of each of the collected RNAs was evaluated by using NanoDrop (Thermo Fisher Scientific, MA, USA).

2. Analysis of RNA Expression (RNA-Seq)

(1) Obtaining RNA-Seq Data

RNA-Seq data was obtained using the samples described above by the following procedure.

a. Quality Check

Quality testing of the samples was performed based on the following items.

Concentration measurement using NanoDrop (spectrophotometer)

Concentration measurement and quality check using Agilent 2100 Bioanalyzer b. Preparation of sample A library for a HiSeq next-generation sequencer was prepared with a SureSelect Strand-Specific RNA library preparation kit in the following manner.

i. Collection of poly (A)+RNA (mRNA) from total RNA using Oligo (dT) magnetic beads ii. Fragmentation of RNA iii. cDNA synthesis iv. Double-stranded cDNA synthesis v. Terminus repair, phosphorylation, A tail addition vi. Ligation of adapters with indices vii. 13-cycle PCR viii. Purification with magnetic beads c. Obtaining Data Using Next-Generation Sequencer Sequencing was performed using a HiSeq 2500 or 4000 next-generation sequencer (Illumina) in the following manner.

i. Addition of Sequencing Reagent

Reagent: TruSeq PE Cluster Kit v3-cBot-HS (1 flowcell) <PE-401-3001> (Illumina)

Reagent: TruSeq SBS Kit v3-HS (200 cycle)<FC-401-3001>

(Illumina)

ii. Single-base extension reaction iii. Removal of unreacted bases iv. Incorporation of fluorescent signal v. Removal of protecting groups and fluorescence The cycle was repeated (e.g., cycle 2, cycle 3 . . . ) and these steps were carried out to 100 cycles.

vi. For the opposite strand (Read 2), i to v were carried out to 100 cycles.

(2) Analysis of RNA-Seq Data (2)-1. Analysis of Output Data Obtained Using Next-Generation Sequencer The following information processing was carried out for the output data.

i. Base calling: text data of nucleotide sequences was obtained from the output raw data of analysis (image data).

ii. Filtering: selection of read data by predetermined filtering was performed.

iii. Sorting based on index sequences: sample data was sorted based on index information.

(2)-2. Secondary Analysis of Output Data

The data file (Fastq format) obtained using an Illumina HiSeq 2500 or 4000 was uploaded on Galaxy (https://usegalaxy.org/) downloaded to a local server.

Thereafter, analysis was carried out using Bowtie2 (http://bowtie-bio.sourceforge.net/bowtie2/index.shtml) to map each sequence to mouse genome map information mm10. The BAM file obtained using Bowtie2 was analyzed using Cufflinks (http://cole-trapnell-lab.github.io/cufflinks/) to calculate the FPKM (RPKM) of genes. That is, in this analysis, all RNAs expressed in each tissue were analyzed.

3. qRT-PCR

1 μg of total RNA obtained from each tissue was used as a template for cDNA synthesis, and cDNA was synthesized using Oligo dT20 primer according to the standard protocol of SuperScript III First-Strand Synthesis SuperMix (Life Technologies). After the synthesized cDNA was diluted 20-fold with TE buffer (10 mM Tris-HCl, pH 8.0, 0.1 mM EDTA), real-time PCR was performed with a LightCycler 480 II (Roche) according to the standard protocol of LightCycler 480 SYBR Green I Master (Roche, Basel, Switzerland), and Cp values were measured. The relative expression level of each gene to a reference gene was quantified by comparing the Cp value obtained for each gene with the Cp value for 32-microglobulin (B2m) as the reference gene. The primer pairs used in the real-time PCR are as shown in Table 6. All of the primers were designed by using Primer-BLAST (NCBI).

TABLE 6

| Target | Sequence | SEQ ID NO. |
|---|---|---|
| Forward primer for Direct-sequence analysis | CTACTTAGCGACAACGTCCT | 24 |
| Reverse primer for Direct-sequence analysis | GCCTTGGGGTTTGAAGGTTT | 25 |
| Sequence primer for Direct-sequence analysis | CAGAGGCTATGACTGTTCCA | 26 |
| Forward primer for HRM analysis | GGCAGGGTCAACCTTTTCCT | 27 |
| Reverse primer for HRM analysis | AGGGACAGCTCACAGAGACT | 28 |
| Forward primer: B2m | GCTCGGTGACCCTGGTCTTT | 29 |
| Reverse primer: B2m | AATGTGAGGCGGGTGGAACT | 30 |
| Forward primer: Oscar | CGGGCATGAGTTTTGCACTG | 31 |
| Reverse primer: Oscar | TGGGTATAGTCCAAGGAGCCA | 32 |
| Forward primer: Fgf23 | AGGAGCCATGACTCGAAGGT | 33 |
| Reverse primer: Fgf23 | GCTCACCAGGTAGTGATGCTT | 34 |

4. Analysis of Differentially Expressed Genes

To extract differentially expressed genes, the number of annotation reads of each transcript in sequence data mapped by Bowtie2 was counted by using HTSeq-count (parameter: -r was pos, and -s was no). The obtained results were analyzed by DESeq2 (Love, M. I., Huber, W. & Anders, S.; Genome biology 15, 550, doi:10.1186/s13059-014-0550-8 (2014)) with default settings. Expression differences were compared in E-UNx/HPi vs. E-/M-/L-Sham (n=3), M-UNx/HPi vs. E-/M-/L-Sham (n=3), and L-UNx/HPi vs. E-/M-/L-Sham (n=3). Gene ontology (GO) enrichment analysis was performed using R package "topGO." In the gene ontology (GO) enrichment analysis, the case in which the result of the DESeq2 analysis is 1 or more and the p-value is less than 0.05 was defined as "$\log_2$ (fold-change)."

5. Statistical Analysis

In statistical analysis, Student's t-test or one-way analysis of variance was performed, and then significant differences were determined by the Tukey-Kramer test. The case in which the p-value is less than 0.05 was defined as being significant (* $p<0.05$,  $p<0.01$, and * $p<0.001$). In the scatter plots, the average value is indicated by a horizontal line.

6. Results

FIG. 9 shows volcano plots in the skull 1 week (E-UNx/HPi), 4 weeks (M-UNx/HPi), and 8 weeks (L-UNx/HPi) after the start of the diet with high phosphorus content. Each mRNA after DESeq analysis was plotted as a small dot, and Oscar was indicated by a large dot. The expression of the Oscar gene increased in the UNx/HPi model mice (HPi) at E-UNx/HPi, M-UNx/HPi, and L-UNx/HPi compared with that in the sham-operated mice (LPi). FIG. 10A shows DESeq analysis results of expression of the Oscar gene in each tissue. The Oscar gene showed high expression in the skull of the UNx/HPi model at E-, M-, and L-. This result was confirmed by qRT-PCR (n=8 to 9). As a result, it was revealed that the expression of the Oscar gene increased in the skull in the UNx/HPi model mice (HPi) at E-UNx/HPi, M-UNx/HPi, and L-UNx/HPi compared with that in the sham-operated mice (LPi) (FIG. 10B). The expression of the Oscar gene slightly increased in the kidney in the DESeq analysis; however, no significant difference was observed in confirmation by qRT-PCR (FIG. 10C).

FGF23 is a master regulator of inter-organ cross talk between the parathyroid glands, bones, and kidneys in kidney disease. The expression of the FGF23 gene in the skull increased in the UNx/HPi model mice (HPi) at E-UNx/HPi, M-UNx/HPi, and L-UNx/HPi, compared with that in the sham-operated mice (LPi) (FIG. 11).

Next, the expression of the Oscar gene and the FGF23 gene over time after the feed of the mice was switched from the noLnLal diet to the diet with low phosphorus content or the diet with high phosphorus content was examined in the skull. FIG. 12A shows the expression of the Oscar gene in the skull 1 day, 3 days, 1 week, and 4 weeks after switching to the diet with low phosphorus content or the diet with high phosphorus content. FIG. 12B shows the expression of the FGF23 gene 1 day, 3 days, 1 week, and 4 weeks after switching to the diet with low phosphorus content or the diet with high phosphorus content. The expression of the Oscar gene and the FGF23 gene already increased in the skull on day 1 after switching to the diet with high phosphorus content. Because the p-value was lower in Student's t-test, the expression of the Oscar gene increased more robustly than the expression of the FGF23 gene. After the feed was switched from the normal diet to the diet with low phosphorus content, the expression level of the Oscar gene significantly decreased, whereas the expression level of the FGF23 gene was unchanged. After peaking 3 days following the switch to the diet with high phosphorus content, the expression of the Oscar gene showed a tendency to gradually cease to increase. In contrast, the expression of the FGF23 gene gradually increased as the period of the diet with high phosphorus content lengthened. These results showed that the expression of the Oscar gene reflects phosphorus intake more strongly and more sensitively than the expression of FGF23.

Further, what effect an increase in the expression of Oscar in the bones has on the expression of FGF23 in the bones was examined. The Oscar gene mutant mice obtained in Item I. above were fed a diet with high phosphorus content, and the expression of FGF23 in the bones was examined by qRT-PCR. The results revealed that the expression of FGF23 did not increase in the bones of the Oscar gene mutant mice even if they were fed the diet with high phosphorus content, as shown in FIG. 13.

The above results showed that Oscar up-regulates the expression pathway of FGF23. This indicated that suppressing the functional expression of Oscar enables suppression of the functional expression of FGF23, and further that suppressing the functional expression of Oscar enables control of disease associated with FGF23.

Experimental Example IV: Measurement of Creatinine in Plasma

Mice (C57BL/6N, 8 weeks old, male) were fed a diet with high phosphorus content in which contains 2% inorganic phosphorus (TD.10662, OrientalBioService, Inc.) or a diet with low phosphorus content in which contains 0.35% inorganic phosphorus (TD.10662 modified type, OrientalBioService, Inc.) as a special phosphorus diet for 4 weeks. Thereafter, plasma samples (LP4W, HP4W) were collected and cryopreserved. A plasma sample (WT (12W)) was collected from 12-week-old male mice (C57BL/6N) fed a normal diet, and cryopreserved. 8-week-old male mice (C57BL/6N) were subjected to unilateral nephrectomy, and after being adapted for 4 weeks, the mice were fed a diet with high phosphorus content for 4 weeks. Thereafter, a plasma sample (UNx/HP4W) was collected and cryopreserved. Creatinine values in plasma were measured using 100 μl of each sample by an enzymatic method.

FIG. 14 shows a creatinine value in plasma in each model of phosphorus overload. In the HP4W model and the UNx/HP4W model, the amount of creatinine, which is a blood marker of renal failure, did not increase.

From the fact that the expression of PRPs and Fgg increased in the HP4W model and the UNx/HP4W model, it was believed that measuring PRPs and Fgg enables detection of declined kidney function earlier than the amount of creatinine in blood increases. Therefore, it was believed that a decline in kidney function can be suppressed in an early stage by administering the soluble human Oscar-Fc fusion protein at a stage when the amount of creatinine has not yet increased, and when PRPs and Fgg are increased.

Reference Example 1: Expression of PRPs in Model of Phosphorus-Overloaded Mice 1. Establishment of Model of Phosphorus-Overloaded Mice Mice (C57BL/6, 7 weeks old, male) that had not been subjected to unilateral nephrectomy were fed a 0.54% inorganic phosphorus-containing normal diet (CE-2, CLEA Japan, Inc.) for 1 week. Thereafter, the mice were given a diet which contains 2% inorganic phosphorus (TD.10662, OrientalBioService, Inc.) as a diet with high phosphorus content or a diet which contains 0.35% inorganic phosphorus (TD.10662 modified type, OrientalBioService, Inc.) as a diet with low phosphorus content. In each group, n=10.

2. Analysis of Proline-Rich Protein (PRP) Gene Expression in Salivary Glands (1) Collection of Tissue The salivary glands and skull were collected 1 week (9 weeks old) and 4 weeks (12 weeks old) after the start of the diet with high phosphorus content or the diet with low phosphorus content in the mice. Regarding the salivary glands, the submandibular glands, sublingual glands, parotid glands, and surrounding connective tissue (including lymph nodes) were separately collected individually. The animals from which the tissue was to be collected were euthanized by cervical dislocation after being anesthetized by intraperitoneal administration of Avertin (250 mg/kg), and the tissue was collected. After the weight of the collected tissue was measured, the tissue was rapidly frozen in liquid nitrogen, and stored at −80° C.

(2) Analysis of RNA i. Extraction of RNA from Each Tissue

Each cryopreserved tissue was individually homogenized in TRIzol Reagent (Life Technologies) with a Cell Destroyer PS1000 (Bio Medical Science Inc.). After incubation at room temperature for 5 minutes to separate proteins, 0.2 mL of chloroform was added per mL of TRIzol, and the tube was capped. Subsequently, the mixture was vortexed vigorously for 15 seconds. After the vortexing, the mixture was incubated at room temperature for 3 minutes and centrifuged at 12,000 g for 15 minutes at 4° C., and the RNA-containing aqueous layer was collected in a fresh tube. An equal amount of 70% ethanol was added to the collected aqueous layer, and mixed. Then, the mixture was applied to an RNeasy Mini column (Qiagen), and purified RNAs were collected according to the RNeasy Mini kit (Qiagen) standard protocol. The quality and concentration of each of the collected RNAs was evaluated by 1% agarose electrophoresis and NanoDrop.

ii. cDNA Synthesis and Quantifying Relative Expression Level by Real-Time PCR

1 μg of total RNA obtained from each tissue was used as a template for cDNA synthesis, and cDNA was synthesized using Oligo dT20 primer according to the standard protocol of SuperScript III First-Strand Synthesis SuperMix (Life Technologies). After the synthesized cDNA was diluted 20-fold with TE buffer (10 mM Tris-HCl, pH 8.0, 0.1 mM EDTA), real-time PCR was performed with a LightCycler 480 II (Roche) according to the standard protocol of LightCycler 480 SYBR Green I Master (Roche), and Cp values were measured. The relative expression level ($2^{-\Delta Cp}$) of each gene to a reference gene was quantified by comparing the Cp value obtained for each gene with the Cp value for β2-microglobulin (B2m) or Maea as the reference gene. The expression of PRP genes (PRPs: Prb1, Prh1, Prp2, Prpmp5) was examined in each salivary gland tissue, and the expression of FGF23 was examined in the skull. The primer pairs used in the real-time PCR are as shown in Table 5.

(3) Results

As shown in FIG. 15, the expression levels of Prb1 (FIG. 15A), Prh1 (FIG. 15B), Prp2 (FIG. 15C), and Prpmp5 (FIG. 15D) were increased in the parotid glands in the group ingested the diet with high phosphorus content (High Pi) compared with those in the group ingested the diet with low phosphorus content (Low Pi).

Example 3: Expression of PRPs in Subject Who Ingested Diet with High Phosphorus Content (1) Subject Subjects were selected according to the following inclusion criteria.

i. Person who is able to fully understand this study plan, and is able to give consent by themselves ii. Person aged 20 years or older at the time of obtaining consent However, persons who meet any of the following criteria were excluded from the subjects.

i. Person with a history of kidney disease to date ii. Person having a cardiovascular risk factor (obesity, high blood pressure, diabetes, smoking)

iii. Person who is deemed unsuitable as a subject by a researcher (2) Diet with High Phosphorus Content Ingestion A diet with high phosphorus content group (group A) was asked to ingest a diet with high phosphorus content in addition to a normal diet. A normal diet group (group B) was a subject group that ingests a normal diet; the normal diet group was, however, asked to ingest as few phosphorus-rich foods as possible.

Both group A and group B were asked to refrain from ingesting phosphorus-rich foods (foods listed in Table 7) as much as possible from Day −7. Group A was asked to select one of the dietary patterns shown in Table 8, and ingest the diet from Day 1 for 7 days. Group B was asked to ingest a normal diet (refrain from ingesting phosphorus-rich foods as much as possible). Table 9 shows the diet and saliva collection schedule.

TABLE 7

| |
|---|
| Fish and shellfish |
| dried whitebait, dried small sardine, sardine, sand lance, splendid alfonsino, ayu (sweetfish), smelt, eel, dried squid, dried shrimp, salmon roe, cod roe, sea urchin, etc. |
| Pulses |
| freeze-dried tofu, soybean, soybean flour, pea, fermented soybean, etc. |
| Dairy products |
| processed cheese, skim milk powder, milk, etc. |
| Flesh |
| egg yolk, beef jerky, liver, etc. |
| Nuts |
| sesame, pine nut, cashew nut, almond, pistachio, peanut, walnut, etc. |
| Processed foods rich in inorganic phosphorus as a food additive |
| pastry, instant noodles, Chinese noodles, confectionery (biscuit, cookie)/seasoning for sprinkling over rice, rice ball containing solid ingredients, take-out meal in a box, savory bread, instant Chinese noodles, ham/sausage, bacon, frozen food, hamburger steak, fish meat/fish-paste product, food boiled in soy sauce, pastry, biscuit, cookie, carbonated drink, etc. |
| Processed foods in which the following are indicated as ingredients |
| lye water (potassium phosphate, sodium phosphate) |
| yeast food (phosphoric acid salt) |
| emulsifier etc. |
| leavening agent (calcium phosphate) |
| binding agent (phosphoric acid salt, potassium polyphosphate) |
| agent for quality improvement (sodium polyphosphate) |

TABLE 8

| | | | | |
|---|---|---|---|---|
| Pattern A | Drink | Skim milk (Megmilk Snow Brand Mainichi Honebuto*) | 1 L (powder: 96 g) | 960 mg |
| Pattern B | Side dish | 6P cheese (Megmilk Snow Brand*) | 18 g × 6 pieces | 800 mg |
| | Snack between meals | One of snacks a to c | | 200 mg |
| Pattern C | Staple food | Cup Noodles* (Nissin*) | 1 | 120 mg |
| | Drink | Skim mik (Megmilk Snow Brand Mainichi Honebuto*) | 500 ml (powder: 48 g) | 480 mg |
| | Side dish | 6P cheese (Megmilk Snow Brand*) | 18 g × 3 pieces | 400 mg |
| Pattern D | Drink | Skim milk (Megmilk Snow Brand Mainichi Honebuto*) | 500 ml (powder: 48 g) | 480 mg |
| | Side dish | 6P cheese (Megmilk Snow Brand*) | 18 g × 3 pieces | 400 mg |
| | Snack between meals | One of snacks a to c | | 200 mg |

Snack a: popcorn (Seven & i), one bag (90 g)
Snack b: chocolate bar (Meiji Milk Chocolate), two bars (116 g)
Snack c: Glico Pucchin Purin* (pudding), 67 g × 3 (201 g)
The asterisk (*) indicates a registered trademark.

TABLE 9

| | Day −7 | Day −6 | Day −5 | Day −4 | Day −3 | Day −2 | Day −1 | Day 1 | Day 2 | Day 3 | Day 4 | Day 5 | Day 6 | Day 7 |
|---|---|---|---|---|---|---|---|---|---|---|---|---|---|---|
| Group A (high-phosphorus diet group | ⇦ Ingest as few phosphorus-rich foods as possible ⇨ | | | | | | | ⇦ normal diet + high-phosphorus diet ⇨ | | | | | | |
| Group B (normal diet group) | ⇦ Ingest as few phosphorus-rich foods as possible ⇨ | | | | | | | ⇦ Ingest as few phosphorus-rich foods as possible ⇨ | | | | | | |
| Saliva collection | — | — | — | — | — | — | ○ | ○ | — | ○ | — | ○ | — | ○ |
| Diet record | ○ | ○ | ○ | ○ | ○ | ○ | ○ | ○ | ○ | ○ | ○ | ○ | ○ | ○ |

(3) Preparation of saliva sample

Saliva was collected with a Saliva Collection Aid (SCA) (Salimetrics LLC, Carlsbad, Calif.) on Days −1, 1, 3, 5, and 7. The collected saliva was stored in a freezer before measurement.

The saliva was stored in the freezer until measurement after collection from the subjects. At the time of measurement, the cryopreserved saliva was thawed, and part of the saliva was transferred to a 1.5-mL tube, followed by centrifugation at 1,000 g for 15 minutes at 4° C. After the centrifugation, the supernatant was collected, and PRPs in saliva samples obtained by diluting the supernatant 100- to 800-fold (hPRH2) or 10,000- to 80,000-fold (hPRB1, hPRB2) in phosphate buffer (PBS) were quantified by ELISA.

(4) ELISA Protocol

The concentrations of human PRPs in each saliva sample were measured by using ELISA kits sold by Cloud-Clone Corp. (SED810Hu (for detection of hPRB1), SED809Hu (for detection of hPRB2), SED812Hu (for detection of hPRH2)).

100 μl of the saliva sample or a sample for a calibration curve containing a recombinant protein in a predetermined amount, which is supplied with each kit, was added to each well of an ELISA plate supplied with the kit. The plate containing the sample was sealed, followed by incubation at 37° C. for 2 hours. After the incubation, the sample in each well was aspirated and discarded, and 100 μl of Detection Reagent A containing a biotin-labeled antibody prepared according to the kit protocol was added to each well. The plate was sealed, followed by incubation at 37° C. for 1 hour. After the incubation, the solution in each well was aspirated and discarded, and each well was washed three times with a wash solution. After the wash solution was thoroughly removed, 100 μl of Detection Reagent B containing enzyme-labeled avidin prepared according to the kit protocol was added to each well. The plate was sealed, followed by incubation at 37° C. for 30 minutes. After the 30 minutes, the solution in each well was aspirated and discarded, and each well was washed five times with a wash solution. After the wash solution was thoroughly removed, 90 μl of a substrate solution supplied with the kit was added to each well. The plate was sealed, followed by incubation at 37° C. for 20 minutes (hPRB1, hPRB2) or 40 minutes (PRH2). Thereafter, 50 μl of a reaction stop solution supplied with the kit was added to each well, and absorbance at 450 nm was measured with an absorbance microplate reader (Multiskan GO, Thermo Fisher Scientific Inc.). The concentration of each protein, i.e., the concentration of each of PRPs in the saliva, was calculated by making a calibration curve using each recombinant protein supplied with the kit.

(5) Results

FIG. 16 shows the ratios of the concentrations of hPRB1 in saliva on the final day of the test (Day 7) divided by the concentrations of hPRB1 in saliva on one day before the start of the test (Day −1) in group A and group B (hPRB1 Day7/Day−1 ratios).

Phosphorus intake was calculated from the ingested diets. "Phosphorus intake ratio" in FIG. 16 is a ratio of the total phosphorus intake for 7 days after the start of the diet with high phosphorus content (or normal diet) ingestion test divided by the total phosphorus intake for 7 days before the start of the diet with high phosphorus content (or normal diet) ingestion test. In subjects showing a high phosphorus intake ratio (subjects who ingested the diet with high phosphorus content), the amount of hPRB1 in saliva increased. This indicates that PRPs reflect kidney function and phosphorus intake.

Reference Example 2: Expression of PRPs in Patient with Kidney Disease (1) Subject Subjects were selected according to the following inclusion criteria.

i. Patient diagnosed with chronic kidney disease or diabetic nephropathy

Regarding chronic kidney disease, patient in GFR category G3 to G5

Regarding diabetic nephropathy, patient in clinical stage 1 to 3

Patient with multiple myeloma and at risk for kidney disease Alternatively, healthy subject (including subject at risk for lifestyle-related disease)

ii. Person who is able to fully understand this study plan, and is able to give consent by themselves iii. Person aged 20 years or older at the time of obtaining consent However, persons who meet any of the following criteria were excluded from the subjects.

i. Person who is deemed unsuitable as a subject by a researcher ii. HBs antigen-positive person, HCV antibody-positive person iii. Subject undergoing dialysis Table 10 shows clinical data of subjects diagnosed with chronic kidney disease or diabetic nephropathy.

TABLE 10

| | Subject No. | | | | | | | |
|---|---|---|---|---|---|---|---|---|
| | 1 | 2 | 3 | 4 | 5 | 6 | Reference value | Unit |
| Underlying disease | CKD | MM | MM | CKD | CKD | CKD | | |
| Notes | MDS, ML | | | ML | MDS | MDS | | |
| Body height | 166.8 | 147.7 | 167.8 | 156.3 | 152.2 | 160.7 | | |
| Body weight | 61.6 | 55.2 | 65.4 | 55.2 | 53.2 | 60.8 | | |
| BMI | 22.14 | 25.3 | 23.28 | 22.6 | 26.67 | 23.16 | | |
| Age | 72 | 77 | 72 | 81 | 85 | 75 | | |
| Sex | M | M | M | M | M | M | | |
| Blood pressure | 106/52 | 122/64 | 120/82 | 125/80 | 138/75 | 113/59 | | |
| Blood cell count | | | | | | | | |
| WBC | 1500 | 3100 | 5600 | 6300 | 2900 | 1300 | 3400-8600 | /μl |
| RBC | 262 | 242 | 302 | 351 | 328 | 237 | 429-571(M), 369-491(F) | ×10^4/μl |
| Hb | 9 | 7.6 | 9.6 | 10.9 | 9 | 7.4 | 13.4-17.1(M), 11.4-15.1(F) | |

TABLE 10-continued

| | Subject No. | | | | | | | |
|---|---|---|---|---|---|---|---|---|
| | 1 | 2 | 3 | 4 | 5 | 6 | Reference value | Unit |
| | | | | | | | | g/dl |
| Ht | 26.5 | 23.7 | 29.9 | 33.5 | 29.7 | 23.2 | 39.9-50.1(M), 34.9-45.1(F) | % |
| Plt | 0.4 | 0.8 | 21.7 | 22.8 | 3.1 | 1.8 | 14.9-35.1 | ×10^4/μl |
| | | | Biochemical data | | | | | |
| GOT | 16 | 10 | 19 | 20 | 23 | 19 | 13-33 | U/L |
| GPT | 13 | 15 | 32 | 24 | 12 | 14 | 6.0-27 | U/L |
| γGTP | 15 | 35 | 16 | 49 | 18 | 30 | 10-47 | U/L |
| Neutral fat | 186 | 96 | 157 | 165 | 101 | 199 | 30-149 | mg/dl |
| HDL-Chol | 39.5 | 50.8 | 52.4 | 50.4 | 47 | 24 | 40-96 | mg/dl |
| LDL-Chol | 93 | 63 | 70 | 104 | 90 | 86 | 70-139 | mg/dl |
| Creatinine | 2.05 | 0.85 | 1.19 | 1.27 | 1.31 | 1.12 | 0.4-0.7 | mg/dl |
| eGFR | 25.9 | 66.6 | 47 | 42.3 | 40.3 | 49.6 | | |
| Inorganic P | 3.8 | 3.5 | 4.5 | 3.1 | 3.6 | 2.6 | 2.5-4.7 | mg/dl |
| BUN | 23.9 | 23.1 | 22.3 | 19.7 | 37.6 | 12.3 | 8.0-22 | mg/dl |
| Albumin | 3.3 | 3.4 | 3 | 3.7 | 3.8 | 2.7 | 4.0-5.0 | mg/dl |
| FGF23 (serum) | 162 | 33 | 122 | 12 | 69 | 46 | ?? | pg/ml |
| Fasting blood sugar | 89 | 79 | 102 | 77 | 109 | 89 | 70-109 | mg/dl |
| HbA1c (NGSP) | 5.8 | 5.7 | 6.2 | 6 | 5.4 | 6.2 | 4.6-6.2 | % |
| Urinary protein | — | 2+ | — | — | — | — | | |
| Urinary sugar | — | — | — | — | — | — | | |
| L-FABP (urine) concentration | 9.26 | 106.82 | 1.77 | 4.42 | 2.84 | 9.76 | ?? | ng/ml |
| L-FABP in terms of creatinine | 13.35 | 177.41 | 2.37 | 7.93 | 4.94 | 19.06 | 8.4 or less | μg/gCr |
| hPrb1 in saliva | 145.9 | 472.8 | 1018.1 | 904.1 | 602.2 | 1013.6 | | μg/ml |

CKD: chronic kidney disease,
MM: multiple myeloma,
MDS: myelodysplastic syndrome,
ML: malignant lymphoma (2) Measurement of hPRB1

The concentration of hPRB1 in saliva of each subject was measured according to the methods of Example 3 (3) and (4).

Statistical Analysis was Performed by Using Student's t-Test.

(3) Results

As shown in FIG. 17, the concentration of hPRB1 in saliva of the subjects diagnosed with chronic kidney disease or diagnosed as having multiple myeloma and being at risk for kidney disease (Patients) was higher than that in the healthy subjects (Control Subjects) ($p=1.3\times10^{-6}$). This indicates that PRPs can be used as kidney function prediction markers.

Reference Example 3: Expression of PRPs in Subject Who Ingested Diet with High Phosphorus Content (2)

The proteins in saliva collected from the subjects of Reference Example 2(1) were decomposed with a proteolytic enzyme, and the concentration of proline was measured to examine whether the proline concentration correlates with the diet with high phosphorus content.

(1) Decomposition of Protein in Saliva and Derivatization of Decomposition Product After cryopreserved saliva was thawed, 700 μL of the saliva was transferred to a 1.5-mL tube and centrifuged at 1,000×g for 15 minutes at 4° C., and the supernatant was collected. 10.5 μL of the saliva supernatant was diluted 20-fold with 199.5 μL of Digestion Buffer (0.1 M Tris-HCl (pH 7.5), 0.5% SDS). 100 μL of the diluted saliva supernatant was transferred to a 1.5-mL tube. 20 μL of Pronase (10 μg/mL) was added to 100 μL of the diluted saliva supernatant, and the tube was wrapped with aluminum foil, followed by reacting at room temperature for 1 hour.

1.5 μL of 2-isopropylmalic acid (internal standard) was added per mL of chromatography grade methanol, and a requisite amount of the resulting solution was prepared. Subsequently, 500 μL of the methanol solution containing 2-isopropylmalic acid was added to the Pronase reaction mixture, and the mixture was stirred by vortexing for 30 seconds for spin-down. After the mixture was allowed to stand at room temperature for 5 minutes, 200 μL of ultrapure water was added, and the mixture was stirred by vortexing for 30 seconds and centrifuged at 4600×g for 5 minutes at 4° C. 400 μL of the first supernatant was transferred from the centrifuge tube to another 1.5-mL tube. 200 μL of ultrapure water was added to the first supernatant, and the mixture was stirred by vortexing for 30 seconds and centrifuged at 4600×g for 5 minutes at 4° C. 400 μL of the second supernatant was transferred from the centrifuge tube to an ultrafiltration unit cup (Hydrophilic PTFE membrane, 0.2 μm; Millipore) and centrifuged at 9100×g for 15 minutes at 4° C. The filtrate was dried under reduced pressure at 65° C. for one hour and 30 minutes. 50 μL of a pyridine solution containing 20 mg/mL methoxyamine hydrochloride was added to the residue after drying, and the mixture was shaken with a shaker at 37° C. for 90 minutes. Thereafter, 50 μL of N-methyl-N-trimethylsilyltrifluoroacetamide (MSTFA) was further added, and the mixture was shaken with a shaker at 37° C. for 30 minutes, and trimethylsilylated.

(2) GCMS Measurement

GCMS-TQ8030 (Shimadzu Corporation) was used for GCMS, and DB-5 (30 m×0.25 mm (inner diameter)×1.00 um (film thickness)) (Agilent Technologies) was used as a capillary column for GC. GC was performed under the following temperature increase conditions: the temperature was increased at a rate of 4° C./rain from 100° C. to 320° C. The injector port temperature was 280° C. Helium was used as a carrier gas, and made to flow at a rate of 39.0 cm/sec. The energy of the electron ionization was 150 eV, the ion source temperature was 200° C., and proline-2TMS {142.10/73.0} and 2-isopropylmalic acid {216.10/147.10} were measured in MRM mode. 1 μL of the sample was injected, the splitless mode was used, and measurement was performed at a detector voltage of 1.50 kV.

(3) Analysis of GCMS Data

Analysis was performed by using GCMS Solution Ver. 4.2 data analysis software and the GCMS Metabolites Database (Shimadzu Corporation). A dilution series of purified proline at the following six points: 0.02, 0.01, 0.005, 0.0005, 0.00005, and 0.000005 (nmol/μL) was prepared, and a calibration curve was prepared by using known concentrations of proline.

The concentration of proline was determined by dividing the peak area of proline by the peak area of the internal standard (2-isopropylmalic acid) to obtain a ratio, and applying the ratio to the calibration curve.

(4) Quantification Results

As shown in FIG. 18, the concentration of proline increased in the group that had ingested the diet with high phosphorus content for 7 days (High Pi) compared with that in the group that had ingested the diet with low phosphorus content (Low Pi). This indicates that kidney function and phosphorus intake can be predicted by decomposing the proteins in saliva, and measuring the concentration of proline in the decomposition liquid.

DESCRIPTION OF REFERENCE NUMERALS

1 Evaluation device
3 Input unit
4 Display unit
5*a* Analysis device
5*b* Analysis device
11 First measurement value obtaining unit
12 Second measurement value obtaining unit
13 Measurement value comparison unit
14 Effect determination unit
52 Reaction/electrophoresis unit
53 Detection unit
100 System
101 CPU
102 Memory
103 Storage unit
104 Bus
105 Interface unit
109 Storage medium

SEQUENCE LISTING

```
<160> NUMBER OF SEQ ID NOS: 2028

<210> SEQ ID NO 1
<211> LENGTH: 286
<212> TYPE: PRT
<213> ORGANISM: Homo sapiens

<400> SEQUENCE: 1

Met Ala Leu Val Leu Ile Leu Gln Leu Leu Thr Leu Trp Pro Leu Cys
1               5                   10                  15

His Thr Asp Ile Thr Pro Ser Val Ala Ile Ile Val Pro Pro Ala Ser
            20                  25                  30

Tyr His Pro Lys Pro Trp Leu Gly Ala Gln Pro Ala Thr Val Val Thr
        35                  40                  45

Pro Gly Val Asn Val Thr Leu Arg Cys Arg Ala Pro Gln Pro Ala Trp
    50                  55                  60

Arg Phe Gly Leu Phe Lys Pro Gly Glu Ile Ala Pro Leu Leu Phe Arg
65                  70                  75                  80

Asp Val Ser Ser Glu Leu Ala Glu Phe Phe Leu Glu Glu Val Thr Pro
                85                  90                  95

Ala Gln Gly Gly Ser Tyr Arg Cys Cys Tyr Arg Arg Pro Asp Trp Gly
            100                 105                 110

Pro Gly Val Trp Ser Gln Pro Ser Asp Val Leu Glu Leu Leu Val Thr
        115                 120                 125

Glu Glu Leu Pro Arg Pro Ser Leu Val Ala Leu Pro Gly Pro Val Val
    130                 135                 140

Gly Pro Gly Ala Asn Val Ser Leu Arg Cys Ala Gly Arg Leu Arg Asn
145                 150                 155                 160

Met Ser Phe Val Leu Tyr Arg Glu Gly Val Ala Ala Pro Leu Gln Tyr
                165                 170                 175

Arg His Ser Ala Gln Pro Trp Ala Asp Phe Thr Leu Leu Gly Ala Arg
            180                 185                 190

Ala Pro Gly Thr Tyr Ser Cys Tyr Tyr His Thr Pro Ser Ala Pro Tyr
        195                 200                 205

Val Leu Ser Gln Arg Ser Glu Val Leu Val Ile Ser Trp Glu Gly Glu
```

```
    210                 215                 220

Gly Pro Glu Ala Arg Pro Ala Ser Ser Ala Pro Gly Met Gln Ala Pro
225                 230                 235                 240

Gly Pro Pro Pro Ser Asp Pro Gly Ala Gln Ala Pro Ser Leu Ser Ser
                245                 250                 255

Phe Arg Pro Arg Gly Leu Val Leu Gln Pro Leu Leu Pro Gln Thr Gln
            260                 265                 270

Asp Ser Trp Asp Pro Ala Pro Pro Pro Ser Asp Pro Gly Val
        275                 280                 285


<210> SEQ ID NO 2
<211> LENGTH: 459
<212> TYPE: PRT
<213> ORGANISM: Artificial Sequence
<220> FEATURE:
<223> OTHER INFORMATION: Oscar-Fc fusion

<400> SEQUENCE: 2

Met Ala Leu Val Leu Ile Leu Gln Leu Leu Thr Leu Trp Pro Leu Cys
1               5                   10                  15

His Thr Asp Ile Thr Pro Ser Val Ala Ile Ile Val Pro Pro Ala Ser
            20                  25                  30

Tyr His Pro Lys Pro Trp Leu Gly Ala Gln Pro Ala Thr Val Val Thr
        35                  40                  45

Pro Gly Val Asn Val Thr Leu Arg Cys Arg Ala Pro Gln Pro Ala Trp
    50                  55                  60

Arg Phe Gly Leu Phe Lys Pro Gly Glu Ile Ala Pro Leu Leu Phe Arg
65                  70                  75                  80

Asp Val Ser Ser Glu Leu Ala Glu Phe Phe Leu Glu Glu Val Thr Pro
                85                  90                  95

Ala Gln Gly Gly Ser Tyr Arg Cys Cys Tyr Arg Arg Pro Asp Trp Gly
            100                 105                 110

Pro Gly Val Trp Ser Gln Pro Ser Asp Val Leu Glu Leu Leu Val Thr
        115                 120                 125

Glu Glu Leu Pro Arg Pro Ser Leu Val Ala Leu Pro Gly Pro Val Val
    130                 135                 140

Gly Pro Gly Ala Asn Val Ser Leu Arg Cys Ala Gly Arg Leu Arg Asn
145                 150                 155                 160

Met Ser Phe Val Leu Tyr Arg Glu Gly Val Ala Ala Pro Leu Gln Tyr
                165                 170                 175

Arg His Ser Ala Gln Pro Trp Ala Asp Phe Thr Leu Leu Gly Ala Arg
            180                 185                 190

Ala Pro Gly Thr Tyr Ser Cys Tyr Tyr His Thr Pro Ser Ala Pro Tyr
        195                 200                 205

Val Leu Ser Gln Arg Ser Glu Val Leu Val Ile Ser Trp Glu Gly Glu
    210                 215                 220

Gly Pro Glu Ala Arg Pro Ala Ser Asp Lys Thr His Thr Cys Pro Pro
225                 230                 235                 240

Cys Pro Ala Pro Glu Leu Leu Gly Gly Pro Ser Val Phe Leu Phe Pro
                245                 250                 255

Pro Lys Pro Lys Asp Thr Leu Met Ile Ser Arg Thr Pro Glu Val Thr
            260                 265                 270

Cys Val Val Val Asp Val Ser His Glu Asp Pro Glu Val Lys Phe Asn
        275                 280                 285

Trp Tyr Val Asp Gly Val Glu Val His Asn Ala Lys Thr Lys Pro Arg
```

```
    290                 295                 300

Glu Glu Gln Tyr Asn Ser Thr Tyr Arg Val Val Ser Val Leu Thr Val
305                 310                 315                 320

Leu His Gln Asp Trp Leu Asn Gly Lys Glu Tyr Lys Cys Lys Val Ser
                325                 330                 335

Asn Lys Ala Leu Pro Ala Pro Ile Glu Lys Thr Ile Ser Lys Ala Lys
            340                 345                 350

Gly Gln Pro Arg Glu Pro Gln Val Tyr Thr Leu Pro Pro Ser Arg Glu
        355                 360                 365

Glu Met Thr Lys Asn Gln Val Ser Leu Thr Cys Leu Val Lys Gly Phe
    370                 375                 380

Tyr Pro Ser Asp Ile Ala Val Glu Trp Glu Ser Asn Gly Gln Pro Glu
385                 390                 395                 400

Asn Asn Tyr Lys Thr Thr Pro Pro Val Leu Asp Ser Asp Gly Ser Phe
                405                 410                 415

Phe Leu Tyr Ser Lys Leu Thr Val Asp Lys Ser Arg Trp Gln Gln Gly
            420                 425                 430

Asn Val Phe Ser Cys Ser Val Met His Glu Ala Leu His Asn His Tyr
        435                 440                 445

Thr Gln Lys Ser Leu Ser Leu Ser Pro Gly Lys
    450                 455


<210> SEQ ID NO 3
<211> LENGTH: 271
<212> TYPE: PRT
<213> ORGANISM: Mus musculus

<400> SEQUENCE: 3

Met Val Leu Ser Leu Ile Leu Gln Leu Ser Thr Leu Cys Glu Leu Ser
1               5                   10                  15

Leu Pro Trp Pro Ala Cys Arg Ala Asp Phe Thr Pro Thr Ala Pro Leu
            20                  25                  30

Ala Ser Tyr Pro Gln Pro Trp Leu Gly Ala His Pro Ala Ala Val Val
        35                  40                  45

Thr Pro Gly Ile Asn Val Thr Leu Thr Cys Arg Ala Pro Gln Ser Ala
    50                  55                  60

Trp Arg Phe Ala Leu Phe Lys Ser Gly Leu Val Thr Pro Leu Leu Leu
65                  70                  75                  80

Arg Asp Val Ser Val Glu Leu Ala Glu Phe Phe Leu Glu Glu Val Thr
                85                  90                  95

Pro Ala Gln Gly Gly Ser Tyr His Cys Arg Tyr Arg Lys Thr Asp Trp
            100                 105                 110

Gly Pro Gly Val Trp Ser Gln Pro Ser Asn Val Leu Glu Leu Leu Val
        115                 120                 125

Thr Asp Gln Leu Pro Arg Pro Ser Leu Val Ala Leu Pro Gly Pro Val
    130                 135                 140

Val Ala Pro Gly Ala Asn Val Ser Leu Arg Cys Ala Gly Arg Ile Pro
145                 150                 155                 160

Gly Met Ser Phe Ala Leu Tyr Arg Val Gly Val Ala Thr Pro Leu Gln
                165                 170                 175

Tyr Ile Asp Ser Val Gln Pro Trp Ala Asp Phe Leu Leu Ile Gly Thr
            180                 185                 190

His Thr Pro Gly Thr Tyr Cys Cys Tyr Tyr His Thr Pro Ser Ala Pro
        195                 200                 205
```

```
Tyr Val Leu Ser Gln Arg Ser Gln Pro Leu Val Ile Ser Phe Glu Gly
    210                 215                 220

Ser Gly Ser Leu Asp Tyr Thr Gln Gly Asn Leu Ile Arg Leu Gly Leu
225                 230                 235                 240

Ala Gly Met Val Leu Ile Cys Leu Gly Ile Ile Val Thr Cys Asp Trp
                245                 250                 255

His Ser Arg Ser Ser Ala Phe Asp Gly Leu Leu Pro Gln Gln Asn
            260                 265                 270


<210> SEQ ID NO 4
<211> LENGTH: 462
<212> TYPE: PRT
<213> ORGANISM: Artificial Sequence
<220> FEATURE:
<223> OTHER INFORMATION: Oscar-Fc fusion

<400> SEQUENCE: 4

Met Val Leu Ser Leu Ile Leu Gln Leu Ser Thr Leu Cys Glu Leu Ser
1               5                   10                  15

Leu Pro Trp Pro Ala Cys Arg Ala Asp Phe Thr Pro Thr Ala Pro Leu
            20                  25                  30

Ala Ser Tyr Pro Gln Pro Trp Leu Gly Ala His Pro Ala Ala Val Val
        35                  40                  45

Thr Pro Gly Ile Asn Val Thr Leu Thr Cys Arg Ala Pro Gln Ser Ala
    50                  55                  60

Trp Arg Phe Ala Leu Phe Lys Ser Gly Leu Val Thr Pro Leu Leu Leu
65                  70                  75                  80

Arg Asp Val Ser Val Glu Leu Ala Glu Phe Phe Leu Glu Glu Val Thr
                85                  90                  95

Pro Ala Gln Gly Gly Ser Tyr His Cys Arg Tyr Arg Lys Thr Asp Trp
            100                 105                 110

Gly Pro Gly Val Trp Ser Gln Pro Ser Asn Val Leu Glu Leu Leu Val
        115                 120                 125

Thr Asp Gln Leu Pro Arg Pro Ser Leu Val Ala Leu Pro Gly Pro Val
    130                 135                 140

Val Ala Pro Gly Ala Asn Val Ser Leu Arg Cys Ala Gly Arg Ile Pro
145                 150                 155                 160

Gly Met Ser Phe Ala Leu Tyr Arg Val Gly Val Ala Thr Pro Leu Gln
                165                 170                 175

Tyr Ile Asp Ser Val Gln Pro Trp Ala Asp Phe Leu Leu Ile Gly Thr
            180                 185                 190

His Thr Pro Gly Thr Tyr Cys Cys Tyr Tyr His Thr Pro Ser Ala Pro
        195                 200                 205

Tyr Val Leu Ser Gln Arg Ser Gln Pro Leu Val Ile Ser Phe Glu Gly
    210                 215                 220

Ser Gly Ser Leu Asp Tyr Thr Gln Gly Asn Leu Asp Lys Thr His Thr
225                 230                 235                 240

Cys Pro Pro Cys Pro Ala Pro Glu Leu Leu Gly Gly Pro Ser Val Phe
                245                 250                 255

Leu Phe Pro Pro Lys Pro Lys Asp Thr Leu Met Ile Ser Arg Thr Pro
            260                 265                 270

Glu Val Thr Cys Val Val Val Asp Val Ser His Glu Asp Pro Glu Val
        275                 280                 285

Lys Phe Asn Trp Tyr Val Asp Gly Val Glu Val His Asn Ala Lys Thr
    290                 295                 300
```

```
Lys Pro Arg Glu Glu Gln Tyr Asn Ser Thr Tyr Arg Val Val Ser Val
305                 310                 315                 320

Leu Thr Val Leu His Gln Asp Trp Leu Asn Gly Lys Glu Tyr Lys Cys
                325                 330                 335

Lys Val Ser Asn Lys Ala Leu Pro Ala Pro Ile Glu Lys Thr Ile Ser
            340                 345                 350

Lys Ala Lys Gly Gln Pro Arg Glu Pro Gln Val Tyr Thr Leu Pro Pro
        355                 360                 365

Ser Arg Glu Glu Met Thr Lys Asn Gln Val Ser Leu Thr Cys Leu Val
    370                 375                 380

Lys Gly Phe Tyr Pro Ser Asp Ile Ala Val Glu Trp Glu Ser Asn Gly
385                 390                 395                 400

Gln Pro Glu Asn Asn Tyr Lys Thr Thr Pro Pro Val Leu Asp Ser Asp
                405                 410                 415

Gly Ser Phe Phe Leu Tyr Ser Lys Leu Thr Val Asp Lys Ser Arg Trp
            420                 425                 430

Gln Gln Gly Asn Val Phe Ser Cys Ser Val Met His Glu Ala Leu His
        435                 440                 445

Asn His Tyr Thr Gln Lys Ser Leu Ser Leu Ser Pro Gly Lys
    450                 455                 460


<210> SEQ ID NO 5
<211> LENGTH: 1601
<212> TYPE: DNA
<213> ORGANISM: Artificial Sequence
<220> FEATURE:
<223> OTHER INFORMATION: Oscar-Fc

<400> SEQUENCE: 5

aagcttgcca ccatggccct cgtgcttatc ctccaacttc tcacgctttg gcctctgtgc     60

cacaccgaca ttactccgtc tgttgcgata attgtccctc ccgcctctta tcaccctaaa    120

ccttggctgg gcgcacagcc agctactgtg gttactcctg gggtgaacgt aacactgcgc    180

tgccgtgctc ctcagcccgc ctggagattt gggttgttta agcccggaga gatagcacca    240

ctgctgtttc gggatgtgtc ctcagagctg gctgagttct tcctggaaga ggtcactcct    300

gcccaaggag gcagctatcg gtgctgttat aggcggccgg attggggacc cggcgtttgg    360

tcccaaccat ctgatgtgct cgaactgctt gtgacagaag agctgcccag acctagcttg    420

gtagccttgc ccggtcctgt cgtcggacct ggtgccaatg tttctcttcg atgtgccgga    480

aggctgcgca atatgtcctt tgtactgtat agggagggag tagccgcacc tctgcagtat    540

aggcatagcg ctcagccctg ggcggatttt actctgcttg gtgccagagc acccgggacc    600

tattcctgct actaccacac tccttccgca ccctacgtcc tgtcacagag atcagaagtg    660

ctcgtgatct cctgggaggg agaaggccca gaagccgaca aaactcacac atgcccaccg    720

tgcccaggta agccagccca ggcctcgccc tccagctcaa ggcgggacag gtgccctaga    780

gtagcctgca tccagggaca ggccccagcc gggtgctgac acgtccacct ccatctcttc    840

ctcagcacct gaactcctgg ggggaccgtc agtcttcctc ttccccccaa aacccaagga    900

caccctcatg atctcccgga cccctgaggt cacatgcgtg gtggtggacg tgagccacga    960

agaccctgag gtcaagttca actggtacgt ggacggcgtg gaggtgcata atgccaagac   1020

aaagccgcgg gaggagcagt acaacagcac gtaccgtgtg gtcagcgtcc tcaccgtcct   1080

gcaccaggac tggctgaatg gcaaggagta caagtgcaag gtctccaaca aagccctccc   1140

agcccccatc gagaaaacca tctccaaagc caaaggtggg acccgtgggg tgcgagggcc   1200
```

acatggacag aggccggctc ggcccaccct ctgccctgag agtgactgct gtaccaacct 1260 ctgtccctac agggcagccc cgagaaccac aggtgtacac cctgccccca tcccgggatg 1320 agctgaccaa gaaccaggtc agcctgacct gcctggtcaa aggcttctat cccagcgaca 1380 tcgccgtgga gtgggagagc aatgggcagc cggagaacaa ctacaagacc acgcctcccg 1440 tgctggactc cgacggctcc ttcttcctct acagcaagct caccgtggac aagagcaggt 1500 ggcagcaggg gaacgtcttc tcatgctccg tgatgcatga ggctctgcac aaccactaca 1560 cgcagaagag cctctccctg tctccgggta aatgatctag a 1601

<210> SEQ ID NO 6
<211> LENGTH: 21
<212> TYPE: DNA
<213> ORGANISM: Artificial Sequence
<220> FEATURE:
<223> OTHER INFORMATION: primer

<400> SEQUENCE: 6 aagaccttga gtagttgccc a 21

<210> SEQ ID NO 7
<211> LENGTH: 21
<212> TYPE: DNA
<213> ORGANISM: Artificial Sequence
<220> FEATURE:
<223> OTHER INFORMATION: primer

<400> SEQUENCE: 7 tgctcgatcc tacgtttgca g 21

<210> SEQ ID NO 8
<211> LENGTH: 20
<212> TYPE: DNA
<213> ORGANISM: Artificial Sequence
<220> FEATURE:
<223> OTHER INFORMATION: primer

<400> SEQUENCE: 8 aggagccatg actcgaaggt 20

<210> SEQ ID NO 9
<211> LENGTH: 21
<212> TYPE: DNA
<213> ORGANISM: Artificial Sequence
<220> FEATURE:
<223> OTHER INFORMATION: primer

<400> SEQUENCE: 9 gctcaccagg tagtgatgct t 21

<210> SEQ ID NO 10
<211> LENGTH: 20
<212> TYPE: DNA
<213> ORGANISM: Artificial Sequence
<220> FEATURE:
<223> OTHER INFORMATION: primer

<400> SEQUENCE: 10 accccagcat ggaaacaaag 20

<210> SEQ ID NO 11
<211> LENGTH: 25
<212> TYPE: DNA

<213> ORGANISM: Artificial Sequence
<220> FEATURE:
<223> OTHER INFORMATION: primer

<400> SEQUENCE: 11 aagaatggta ttgaagtcat ctgtc 25

<210> SEQ ID NO 12
<211> LENGTH: 21
<212> TYPE: DNA
<213> ORGANISM: Artificial Sequence
<220> FEATURE:
<223> OTHER INFORMATION: primer

<400> SEQUENCE: 12 accccgtgaa gaaaatcaga a 21

<210> SEQ ID NO 13
<211> LENGTH: 20
<212> TYPE: DNA
<213> ORGANISM: Artificial Sequence
<220> FEATURE:
<223> OTHER INFORMATION: primer

<400> SEQUENCE: 13 taacaggcgg tcttggttgg 20

<210> SEQ ID NO 14
<211> LENGTH: 21
<212> TYPE: DNA
<213> ORGANISM: Artificial Sequence
<220> FEATURE:
<223> OTHER INFORMATION: primer

<400> SEQUENCE: 14 tggtggtcct gtttacagtg g 21

<210> SEQ ID NO 15
<211> LENGTH: 21
<212> TYPE: DNA
<213> ORGANISM: Artificial Sequence
<220> FEATURE:
<223> OTHER INFORMATION: primer

<400> SEQUENCE: 15 ttctgaagtt cttcacgggg t 21

<210> SEQ ID NO 16
<211> LENGTH: 24
<212> TYPE: DNA
<213> ORGANISM: Artificial Sequence
<220> FEATURE:
<223> OTHER INFORMATION: primer

<400> SEQUENCE: 16 cctacgaaga ctcaaattct cagc 24

<210> SEQ ID NO 17
<211> LENGTH: 19
<212> TYPE: DNA
<213> ORGANISM: Artificial Sequence
<220> FEATURE:
<223> OTHER INFORMATION: primer

<400> SEQUENCE: 17 gaggaccatg gtggtgtcc 19

<210> SEQ ID NO 18
<211> LENGTH: 20
<212> TYPE: DNA
<213> ORGANISM: Artificial Sequence
<220> FEATURE:
<223> OTHER INFORMATION: primer

<400> SEQUENCE: 18 gctcggtgac cctggtcttt 20

<210> SEQ ID NO 19
<211> LENGTH: 20
<212> TYPE: DNA
<213> ORGANISM: Artificial Sequence
<220> FEATURE:
<223> OTHER INFORMATION: primer

<400> SEQUENCE: 19 aatgtgaggc gggtggaact 20

<210> SEQ ID NO 20
<211> LENGTH: 20
<212> TYPE: DNA
<213> ORGANISM: Mus musculus

<400> SEQUENCE: 20 acagctggag tatcagcgac 20

<210> SEQ ID NO 21
<211> LENGTH: 20
<212> TYPE: DNA
<213> ORGANISM: Mus musculus

<400> SEQUENCE: 21 gctcacagag agtcgacagc 20

<210> SEQ ID NO 22
<211> LENGTH: 146
<212> TYPE: DNA
<213> ORGANISM: Artificial Sequence
<220> FEATURE:
<223> OTHER INFORMATION: ssODN

<400> SEQUENCE: 22 gccaaggatc cacacacagg ggagggacag ctcacagaga gtcgacagct ggagtatcag 60 cctcagaaga actcgtcaag aagtcacgac aggaccatgg tgggcactct ccgtggagct 120 gaggaaaagg ttgaccctgc cttttt 146

<210> SEQ ID NO 23
<211> LENGTH: 146
<212> TYPE: DNA
<213> ORGANISM: Artificial Sequence
<220> FEATURE:
<223> OTHER INFORMATION: ssODN

<400> SEQUENCE: 23 atagccctca gcccagccaa ggatccacac acaggggagg gacagctcac agagagtcga 60 cctcagaaga actcgtcaag aagtcacagc tggagtatca gcgacaggac catggtgggc 120 actctccgtg gagctgagga aaaggt 146

<210> SEQ ID NO 24

<211> LENGTH: 20
<212> TYPE: DNA
<213> ORGANISM: Artificial Sequence
<220> FEATURE:
<223> OTHER INFORMATION: primer

<400> SEQUENCE: 24 ctacttagcg acaacgtcct 20

<210> SEQ ID NO 25
<211> LENGTH: 20
<212> TYPE: DNA
<213> ORGANISM: Artificial Sequence
<220> FEATURE:
<223> OTHER INFORMATION: primer

<400> SEQUENCE: 25 gccttggggt ttgaaggttt 20

<210> SEQ ID NO 26
<211> LENGTH: 20
<212> TYPE: DNA
<213> ORGANISM: Artificial Sequence
<220> FEATURE:
<223> OTHER INFORMATION: primer

<400> SEQUENCE: 26 cagaggctat gactgttcca 20

<210> SEQ ID NO 27
<211> LENGTH: 20
<212> TYPE: DNA
<213> ORGANISM: Artificial Sequence
<220> FEATURE:
<223> OTHER INFORMATION: primer

<400> SEQUENCE: 27 ggcagggtca acctttcct 20

<210> SEQ ID NO 28
<211> LENGTH: 20
<212> TYPE: DNA
<213> ORGANISM: Artificial Sequence
<220> FEATURE:
<223> OTHER INFORMATION: primer

<400> SEQUENCE: 28 agggacagct cacagagagt 20

<210> SEQ ID NO 29
<211> LENGTH: 20
<212> TYPE: DNA
<213> ORGANISM: Artificial Sequence
<220> FEATURE:
<223> OTHER INFORMATION: primer

<400> SEQUENCE: 29 gctcggtgac cctggtcttt 20

<210> SEQ ID NO 30
<211> LENGTH: 20
<212> TYPE: DNA
<213> ORGANISM: Artificial Sequence
<220> FEATURE:
<223> OTHER INFORMATION: primer

<400> SEQUENCE: 30 aatgtgaggc gggtggaact 20

<210> SEQ ID NO 31
<211> LENGTH: 20
<212> TYPE: DNA
<213> ORGANISM: Artificial Sequence
<220> FEATURE:
<223> OTHER INFORMATION: primer

<400> SEQUENCE: 31 cgggcatgag ttttgcactg 20

<210> SEQ ID NO 32
<211> LENGTH: 21
<212> TYPE: DNA
<213> ORGANISM: Artificial Sequence
<220> FEATURE:
<223> OTHER INFORMATION: primer

<400> SEQUENCE: 32 tgggtatagt ccaaggagcc a 21

<210> SEQ ID NO 33
<211> LENGTH: 20
<212> TYPE: DNA
<213> ORGANISM: Artificial Sequence
<220> FEATURE:
<223> OTHER INFORMATION: primer

<400> SEQUENCE: 33 aggagccatg actcgaaggt 20

<210> SEQ ID NO 34
<211> LENGTH: 21
<212> TYPE: DNA
<213> ORGANISM: Artificial Sequence
<220> FEATURE:
<223> OTHER INFORMATION: primer

<400> SEQUENCE: 34 gctcaccagg tagtgatgct t 21

<210> SEQ ID NO 35
<211> LENGTH: 23
<212> TYPE: DNA
<213> ORGANISM: Homo sapiens

<400> SEQUENCE: 35 caacacaaat tagccgggcg tgg 23

<210> SEQ ID NO 36
<211> LENGTH: 23
<212> TYPE: DNA
<213> ORGANISM: Homo sapiens

<400> SEQUENCE: 36 agctcaacat cggctcgtcc tgg 23

<210> SEQ ID NO 37
<211> LENGTH: 23
<212> TYPE: DNA
<213> ORGANISM: Homo sapiens

<400> SEQUENCE: 37 gtcactccgg agcgacttct agg 23

<210> SEQ ID NO 38
<211> LENGTH: 23
<212> TYPE: DNA
<213> ORGANISM: Homo sapiens

<400> SEQUENCE: 38 ccacgcaggt ccgcaaagtc agg 23

<210> SEQ ID NO 39
<211> LENGTH: 23
<212> TYPE: DNA
<213> ORGANISM: Homo sapiens

<400> SEQUENCE: 39 ggactatttt gttccgcctt agg 23

<210> SEQ ID NO 40
<211> LENGTH: 23
<212> TYPE: DNA
<213> ORGANISM: Homo sapiens

<400> SEQUENCE: 40 gtctcgaact tcccgacctc agg 23

<210> SEQ ID NO 41
<211> LENGTH: 23
<212> TYPE: DNA
<213> ORGANISM: Homo sapiens

<400> SEQUENCE: 41 gcgagggtct ggcacgtaat agg 23

<210> SEQ ID NO 42
<211> LENGTH: 23
<212> TYPE: DNA
<213> ORGANISM: Homo sapiens

<400> SEQUENCE: 42 cgccttaggt gggtcgcagc agg 23

<210> SEQ ID NO 43
<211> LENGTH: 23
<212> TYPE: DNA
<213> ORGANISM: Homo sapiens

<400> SEQUENCE: 43 acctcgtgat ccgcccgcct cgg 23

<210> SEQ ID NO 44
<211> LENGTH: 23
<212> TYPE: DNA
<213> ORGANISM: Homo sapiens

<400> SEQUENCE: 44 aatcgcttga actcgggagt cgg 23

<210> SEQ ID NO 45
<211> LENGTH: 23
<212> TYPE: DNA
<213> ORGANISM: Homo sapiens

<400> SEQUENCE: 45 tcttggtctt tcagtcggac tgg 23

<210> SEQ ID NO 46
<211> LENGTH: 23
<212> TYPE: DNA
<213> ORGANISM: Homo sapiens

<400> SEQUENCE: 46 cctgactttg cggacctgcg tgg 23

<210> SEQ ID NO 47
<211> LENGTH: 23
<212> TYPE: DNA
<213> ORGANISM: Homo sapiens

<400> SEQUENCE: 47 tctcagccta gaagtcgctc cgg 23

<210> SEQ ID NO 48
<211> LENGTH: 23
<212> TYPE: DNA
<213> ORGANISM: Homo sapiens

<400> SEQUENCE: 48 cgcttgaact cgggagtcgg agg 23

<210> SEQ ID NO 49
<211> LENGTH: 23
<212> TYPE: DNA
<213> ORGANISM: Homo sapiens

<400> SEQUENCE: 49 ggagtgcaat ggcgcgatct cgg 23

<210> SEQ ID NO 50
<211> LENGTH: 23
<212> TYPE: DNA
<213> ORGANISM: Homo sapiens

<400> SEQUENCE: 50 atgttgagct gagacctcga agg 23

<210> SEQ ID NO 51
<211> LENGTH: 23
<212> TYPE: DNA
<213> ORGANISM: Homo sapiens

<400> SEQUENCE: 51 acaaccgcgc ccggcctaga ggg 23

<210> SEQ ID NO 52
<211> LENGTH: 23
<212> TYPE: DNA
<213> ORGANISM: Homo sapiens

<400> SEQUENCE: 52 agactaagga gattccacgc agg 23

<210> SEQ ID NO 53
<211> LENGTH: 23
<212> TYPE: DNA
<213> ORGANISM: Homo sapiens

<400> SEQUENCE: 53 aacaaccgcg cccggcctag agg 23

<210> SEQ ID NO 54
<211> LENGTH: 23
<212> TYPE: DNA
<213> ORGANISM: Homo sapiens

<400> SEQUENCE: 54 ggatgagacc tagcgcttcc agg 23

<210> SEQ ID NO 55
<211> LENGTH: 23
<212> TYPE: DNA
<213> ORGANISM: Homo sapiens

<400> SEQUENCE: 55 caaccgcgcc cggcctagag ggg 23

<210> SEQ ID NO 56
<211> LENGTH: 23
<212> TYPE: DNA
<213> ORGANISM: Homo sapiens

<400> SEQUENCE: 56 tattttgttc cgccttaggt ggg 23

<210> SEQ ID NO 57
<211> LENGTH: 23
<212> TYPE: DNA
<213> ORGANISM: Homo sapiens

<400> SEQUENCE: 57 gagaatggcg tgaacccggg agg 23

<210> SEQ ID NO 58
<211> LENGTH: 23
<212> TYPE: DNA
<213> ORGANISM: Homo sapiens

<400> SEQUENCE: 58 aatgactaac ctgtccttcg agg 23

<210> SEQ ID NO 59
<211> LENGTH: 23
<212> TYPE: DNA
<213> ORGANISM: Homo sapiens

<400> SEQUENCE: 59 tagcccctct aggccgggcg cgg 23

<210> SEQ ID NO 60
<211> LENGTH: 23
<212> TYPE: DNA
<213> ORGANISM: Homo sapiens

<400> SEQUENCE: 60 ggcgggcgga tcacgaggtc agg 23

<210> SEQ ID NO 61
<211> LENGTH: 23
<212> TYPE: DNA
<213> ORGANISM: Homo sapiens

<400> SEQUENCE: 61 cgctaggtct catcccagat ggg 23

<210> SEQ ID NO 62
<211> LENGTH: 23
<212> TYPE: DNA
<213> ORGANISM: Homo sapiens

<400> SEQUENCE: 62 ctgctgcgac ccacctaagg cgg 23

<210> SEQ ID NO 63
<211> LENGTH: 23
<212> TYPE: DNA
<213> ORGANISM: Homo sapiens

<400> SEQUENCE: 63 cggctcgtcc tggaagcgct agg 23

<210> SEQ ID NO 64
<211> LENGTH: 23
<212> TYPE: DNA
<213> ORGANISM: Homo sapiens

<400> SEQUENCE: 64 cagaaagctc ctaacccatc tgg 23

<210> SEQ ID NO 65
<211> LENGTH: 23
<212> TYPE: DNA
<213> ORGANISM: Homo sapiens

<400> SEQUENCE: 65 gggggttcag tcataacctg tgg 23

<210> SEQ ID NO 66
<211> LENGTH: 23
<212> TYPE: DNA
<213> ORGANISM: Homo sapiens

<400> SEQUENCE: 66 ctattttgtt ccgccttagg tgg 23

<210> SEQ ID NO 67
<211> LENGTH: 23
<212> TYPE: DNA
<213> ORGANISM: Homo sapiens

<400> SEQUENCE: 67 agcaggagga ctagtcactc cgg 23

<210> SEQ ID NO 68
<211> LENGTH: 23
<212> TYPE: DNA
<213> ORGANISM: Homo sapiens

<400> SEQUENCE: 68 gagctgagac ctcgaaggac agg 23

<210> SEQ ID NO 69
<211> LENGTH: 23
<212> TYPE: DNA

<213> ORGANISM: Homo sapiens

<400> SEQUENCE: 69 cacaaattag ccgggcgtgg tgg 23

<210> SEQ ID NO 70
<211> LENGTH: 23
<212> TYPE: DNA
<213> ORGANISM: Homo sapiens

<400> SEQUENCE: 70 gcgcccgtag tcccagctac tgg 23

<210> SEQ ID NO 71
<211> LENGTH: 23
<212> TYPE: DNA
<213> ORGANISM: Homo sapiens

<400> SEQUENCE: 71 ctgccaacat ggcacagcga ggg 23

<210> SEQ ID NO 72
<211> LENGTH: 23
<212> TYPE: DNA
<213> ORGANISM: Homo sapiens

<400> SEQUENCE: 72 aacatggcac agcgagggtc tgg 23

<210> SEQ ID NO 73
<211> LENGTH: 23
<212> TYPE: DNA
<213> ORGANISM: Homo sapiens

<400> SEQUENCE: 73 tcgaggtctc agctcaacat cgg 23

<210> SEQ ID NO 74
<211> LENGTH: 23
<212> TYPE: DNA
<213> ORGANISM: Homo sapiens

<400> SEQUENCE: 74 gcgctaggtc tcatcccaga tgg 23

<210> SEQ ID NO 75
<211> LENGTH: 23
<212> TYPE: DNA
<213> ORGANISM: Homo sapiens

<400> SEQUENCE: 75 gcaggagaat ggcgtgaacc cgg 23

<210> SEQ ID NO 76
<211> LENGTH: 23
<212> TYPE: DNA
<213> ORGANISM: Homo sapiens

<400> SEQUENCE: 76 aaaattagcc cctctaggcc ggg 23

<210> SEQ ID NO 77
<211> LENGTH: 23

<212> TYPE: DNA
<213> ORGANISM: Homo sapiens

<400> SEQUENCE: 77 ggtctcatcc cagatgggtt agg 23

<210> SEQ ID NO 78
<211> LENGTH: 23
<212> TYPE: DNA
<213> ORGANISM: Homo sapiens

<400> SEQUENCE: 78 aatggcgtga acccgggagg cgg 23

<210> SEQ ID NO 79
<211> LENGTH: 23
<212> TYPE: DNA
<213> ORGANISM: Homo sapiens

<400> SEQUENCE: 79 gaaaaattag ccggctgtgg agg 23

<210> SEQ ID NO 80
<211> LENGTH: 23
<212> TYPE: DNA
<213> ORGANISM: Homo sapiens

<400> SEQUENCE: 80 caggagaatc gcttgaactc ggg 23

<210> SEQ ID NO 81
<211> LENGTH: 23
<212> TYPE: DNA
<213> ORGANISM: Homo sapiens

<400> SEQUENCE: 81 cgacttctag gctgagacta agg 23

<210> SEQ ID NO 82
<211> LENGTH: 23
<212> TYPE: DNA
<213> ORGANISM: Homo sapiens

<400> SEQUENCE: 82 agaaagctcc taacccatct ggg 23

<210> SEQ ID NO 83
<211> LENGTH: 23
<212> TYPE: DNA
<213> ORGANISM: Homo sapiens

<400> SEQUENCE: 83 agtgatctga gctataatgg cgg 23

<210> SEQ ID NO 84
<211> LENGTH: 23
<212> TYPE: DNA
<213> ORGANISM: Homo sapiens

<400> SEQUENCE: 84 caggagaatg gcgtgaaccc ggg 23

<210> SEQ ID NO 85

<211> LENGTH: 23
<212> TYPE: DNA
<213> ORGANISM: Homo sapiens

<400> SEQUENCE: 85 aaagaaaaat tagccggctg tgg 23

<210> SEQ ID NO 86
<211> LENGTH: 23
<212> TYPE: DNA
<213> ORGANISM: Homo sapiens

<400> SEQUENCE: 86 aaaaattagc ccctctaggc cgg 23

<210> SEQ ID NO 87
<211> LENGTH: 23
<212> TYPE: DNA
<213> ORGANISM: Homo sapiens

<400> SEQUENCE: 87 ctcctgctgc gacccaccta agg 23

<210> SEQ ID NO 88
<211> LENGTH: 23
<212> TYPE: DNA
<213> ORGANISM: Homo sapiens

<400> SEQUENCE: 88 tcaggagatc tagaccatcc tgg 23

<210> SEQ ID NO 89
<211> LENGTH: 23
<212> TYPE: DNA
<213> ORGANISM: Homo sapiens

<400> SEQUENCE: 89 caaggcgggt ggatcacctg agg 23

<210> SEQ ID NO 90
<211> LENGTH: 23
<212> TYPE: DNA
<213> ORGANISM: Homo sapiens

<400> SEQUENCE: 90 cctcgctgtg ccatgttggc agg 23

<210> SEQ ID NO 91
<211> LENGTH: 23
<212> TYPE: DNA
<213> ORGANISM: Homo sapiens

<400> SEQUENCE: 91 gtcatagccc tatggcactg tgg 23

<210> SEQ ID NO 92
<211> LENGTH: 23
<212> TYPE: DNA
<213> ORGANISM: Homo sapiens

<400> SEQUENCE: 92 aattagccgg gcgtggtggt ggg 23

<210> SEQ ID NO 93
<211> LENGTH: 23
<212> TYPE: DNA
<213> ORGANISM: Homo sapiens

<400> SEQUENCE: 93 agacgggggt ttctccatgt tgg 23

<210> SEQ ID NO 94
<211> LENGTH: 23
<212> TYPE: DNA
<213> ORGANISM: Homo sapiens

<400> SEQUENCE: 94 caggcgcgcg cctccacagc cgg 23

<210> SEQ ID NO 95
<211> LENGTH: 23
<212> TYPE: DNA
<213> ORGANISM: Homo sapiens

<400> SEQUENCE: 95 atgggttagg agctttctgc ggg 23

<210> SEQ ID NO 96
<211> LENGTH: 23
<212> TYPE: DNA
<213> ORGANISM: Homo sapiens

<400> SEQUENCE: 96 tcgatcaatt aatcacagca agg 23

<210> SEQ ID NO 97
<211> LENGTH: 23
<212> TYPE: DNA
<213> ORGANISM: Homo sapiens

<400> SEQUENCE: 97 gaacaaagat ggagccgtgg agg 23

<210> SEQ ID NO 98
<211> LENGTH: 23
<212> TYPE: DNA
<213> ORGANISM: Homo sapiens

<400> SEQUENCE: 98 ttaagtgatc tgagctataa tgg 23

<210> SEQ ID NO 99
<211> LENGTH: 23
<212> TYPE: DNA
<213> ORGANISM: Homo sapiens

<400> SEQUENCE: 99 cccttgctgt gattgattga tgg 23

<210> SEQ ID NO 100
<211> LENGTH: 23
<212> TYPE: DNA
<213> ORGANISM: Homo sapiens

<400> SEQUENCE: 100 cttaggtggg tcgcagcagg agg 23

<210> SEQ ID NO 101
<211> LENGTH: 23
<212> TYPE: DNA
<213> ORGANISM: Homo sapiens

<400> SEQUENCE: 101 acagtatcac accaagagcc tgg 23

<210> SEQ ID NO 102
<211> LENGTH: 23
<212> TYPE: DNA
<213> ORGANISM: Homo sapiens

<400> SEQUENCE: 102 agaccctcgc tgtgccatgt tgg 23

<210> SEQ ID NO 103
<211> LENGTH: 23
<212> TYPE: DNA
<213> ORGANISM: Homo sapiens

<400> SEQUENCE: 103 cctgccaaca tggcacagcg agg 23

<210> SEQ ID NO 104
<211> LENGTH: 23
<212> TYPE: DNA
<213> ORGANISM: Homo sapiens

<400> SEQUENCE: 104 gatcacttaa gaaactgacc tgg 23

<210> SEQ ID NO 105
<211> LENGTH: 23
<212> TYPE: DNA
<213> ORGANISM: Homo sapiens

<400> SEQUENCE: 105 cttaagaaac tgacctggtc tgg 23

<210> SEQ ID NO 106
<211> LENGTH: 23
<212> TYPE: DNA
<213> ORGANISM: Homo sapiens

<400> SEQUENCE: 106 ccgactgaaa gaccaagacc agg 23

<210> SEQ ID NO 107
<211> LENGTH: 23
<212> TYPE: DNA
<213> ORGANISM: Homo sapiens

<400> SEQUENCE: 107 tctagaaaca aatactagtc agg 23

<210> SEQ ID NO 108
<211> LENGTH: 23
<212> TYPE: DNA
<213> ORGANISM: Homo sapiens

<400> SEQUENCE: 108 attagcacct gttaagtgcc agg 23

<210> SEQ ID NO 109
<211> LENGTH: 23
<212> TYPE: DNA
<213> ORGANISM: Homo sapiens

<400> SEQUENCE: 109 ggcactgtgg aaaaattagc agg 23

<210> SEQ ID NO 110
<211> LENGTH: 23
<212> TYPE: DNA
<213> ORGANISM: Homo sapiens

<400> SEQUENCE: 110 aaactgacct ggtctgggcc agg 23

<210> SEQ ID NO 111
<211> LENGTH: 23
<212> TYPE: DNA
<213> ORGANISM: Homo sapiens

<400> SEQUENCE: 111 gccttagcct ccccagtagc tgg 23

<210> SEQ ID NO 112
<211> LENGTH: 23
<212> TYPE: DNA
<213> ORGANISM: Homo sapiens

<400> SEQUENCE: 112 tccatcaatc aatcacagca agg 23

<210> SEQ ID NO 113
<211> LENGTH: 23
<212> TYPE: DNA
<213> ORGANISM: Homo sapiens

<400> SEQUENCE: 113 cgatcaatta atcacagcaa ggg 23

<210> SEQ ID NO 114
<211> LENGTH: 23
<212> TYPE: DNA
<213> ORGANISM: Homo sapiens

<400> SEQUENCE: 114 cctggtcttg gtctttcagt cgg 23

<210> SEQ ID NO 115
<211> LENGTH: 23
<212> TYPE: DNA
<213> ORGANISM: Homo sapiens

<400> SEQUENCE: 115 ctgctgcttg agagcagtaa cgg 23

<210> SEQ ID NO 116
<211> LENGTH: 23
<212> TYPE: DNA
<213> ORGANISM: Homo sapiens

<400> SEQUENCE: 116 tttcaatcac agcaagggcc tgg 23

<210> SEQ ID NO 117
<211> LENGTH: 23
<212> TYPE: DNA
<213> ORGANISM: Homo sapiens

<400> SEQUENCE: 117 caggctgctc ttgaactctt ggg 23

<210> SEQ ID NO 118
<211> LENGTH: 23
<212> TYPE: DNA
<213> ORGANISM: Homo sapiens

<400> SEQUENCE: 118 agatggagcc gtggaggtaa agg 23

<210> SEQ ID NO 119
<211> LENGTH: 23
<212> TYPE: DNA
<213> ORGANISM: Homo sapiens

<400> SEQUENCE: 119 gctactgggg aggctaaggc agg 23

<210> SEQ ID NO 120
<211> LENGTH: 23
<212> TYPE: DNA
<213> ORGANISM: Homo sapiens

<400> SEQUENCE: 120 aaattagccg ggcgtggtgg tgg 23

<210> SEQ ID NO 121
<211> LENGTH: 23
<212> TYPE: DNA
<213> ORGANISM: Homo sapiens

<400> SEQUENCE: 121 gcctcagcct cctgaatagc tgg 23

<210> SEQ ID NO 122
<211> LENGTH: 23
<212> TYPE: DNA
<213> ORGANISM: Homo sapiens

<400> SEQUENCE: 122 aatcaatcac agcaagggcc tgg 23

<210> SEQ ID NO 123
<211> LENGTH: 23
<212> TYPE: DNA
<213> ORGANISM: Homo sapiens

<400> SEQUENCE: 123 gatgggttag gagctttctg cgg 23

<210> SEQ ID NO 124
<211> LENGTH: 23
<212> TYPE: DNA
<213> ORGANISM: Homo sapiens

<400> SEQUENCE: 124 ttctttttta ggagagacgg ggg 23

<210> SEQ ID NO 125
<211> LENGTH: 23
<212> TYPE: DNA
<213> ORGANISM: Homo sapiens

<400> SEQUENCE: 125 gcactgtgga aaaattagca ggg 23

<210> SEQ ID NO 126
<211> LENGTH: 23
<212> TYPE: DNA
<213> ORGANISM: Homo sapiens

<400> SEQUENCE: 126 agaaacaaat actagtcagg agg 23

<210> SEQ ID NO 127
<211> LENGTH: 23
<212> TYPE: DNA
<213> ORGANISM: Homo sapiens

<400> SEQUENCE: 127 cgtagtccca gctactgggg agg 23

<210> SEQ ID NO 128
<211> LENGTH: 23
<212> TYPE: DNA
<213> ORGANISM: Homo sapiens

<400> SEQUENCE: 128 aacaaatact agtcaggagg tgg 23

<210> SEQ ID NO 129
<211> LENGTH: 23
<212> TYPE: DNA
<213> ORGANISM: Homo sapiens

<400> SEQUENCE: 129 ttaagaaact gacctggtct ggg 23

<210> SEQ ID NO 130
<211> LENGTH: 23
<212> TYPE: DNA
<213> ORGANISM: Homo sapiens

<400> SEQUENCE: 130 ccttagcctc cccagtagct ggg 23

<210> SEQ ID NO 131
<211> LENGTH: 23
<212> TYPE: DNA
<213> ORGANISM: Homo sapiens

<400> SEQUENCE: 131 agataaaaat tagcccctct agg 23

<210> SEQ ID NO 132
<211> LENGTH: 23
<212> TYPE: DNA
<213> ORGANISM: Homo sapiens

<400> SEQUENCE: 132 ccatcaatca atcacagcaa ggg 23

<210> SEQ ID NO 133
<211> LENGTH: 23
<212> TYPE: DNA
<213> ORGANISM: Homo sapiens

<400> SEQUENCE: 133 gaggtaaagg aagtggtgtc agg 23

<210> SEQ ID NO 134
<211> LENGTH: 23
<212> TYPE: DNA
<213> ORGANISM: Homo sapiens

<400> SEQUENCE: 134 cactgcaagc tccgcctccc ggg 23

<210> SEQ ID NO 135
<211> LENGTH: 23
<212> TYPE: DNA
<213> ORGANISM: Homo sapiens

<400> SEQUENCE: 135 taattgatcg attgatagat tgg 23

<210> SEQ ID NO 136
<211> LENGTH: 23
<212> TYPE: DNA
<213> ORGANISM: Homo sapiens

<400> SEQUENCE: 136 aaatacaaca caaattagcc ggg 23

<210> SEQ ID NO 137
<211> LENGTH: 23
<212> TYPE: DNA
<213> ORGANISM: Homo sapiens

<400> SEQUENCE: 137 tccctctgtg cctgccaaca tgg 23

<210> SEQ ID NO 138
<211> LENGTH: 23
<212> TYPE: DNA
<213> ORGANISM: Homo sapiens

<400> SEQUENCE: 138 gttaaataaa tgaacaccac agg 23

<210> SEQ ID NO 139
<211> LENGTH: 23
<212> TYPE: DNA
<213> ORGANISM: Homo sapiens

<400> SEQUENCE: 139 gttagtcatt caccttctcc cgg 23

<210> SEQ ID NO 140
<211> LENGTH: 23
<212> TYPE: DNA
<213> ORGANISM: Homo sapiens

<400> SEQUENCE: 140 caccgcgcct ggcccagacc agg 23

<210> SEQ ID NO 141
<211> LENGTH: 23
<212> TYPE: DNA
<213> ORGANISM: Homo sapiens

<400> SEQUENCE: 141 gttagtcatt caccttctcc cgg 23

<210> SEQ ID NO 142
<211> LENGTH: 23
<212> TYPE: DNA
<213> ORGANISM: Homo sapiens

<400> SEQUENCE: 142 aaaagaaact gacctggtct tgg 23

<210> SEQ ID NO 143
<211> LENGTH: 23
<212> TYPE: DNA
<213> ORGANISM: Homo sapiens

<400> SEQUENCE: 143 gcaagagtct ggcacataat agg 23

<210> SEQ ID NO 144
<211> LENGTH: 23
<212> TYPE: DNA
<213> ORGANISM: Homo sapiens

<400> SEQUENCE: 144 aagaaactga gcccgggaga agg 23

<210> SEQ ID NO 145
<211> LENGTH: 23
<212> TYPE: DNA
<213> ORGANISM: Homo sapiens

<400> SEQUENCE: 145 caagcgcaag cctgactttg cgg 23

<210> SEQ ID NO 146
<211> LENGTH: 23
<212> TYPE: DNA
<213> ORGANISM: Homo sapiens

<400> SEQUENCE: 146 ctggtctggg ccaggcgcgg tgg 23

<210> SEQ ID NO 147
<211> LENGTH: 23
<212> TYPE: DNA
<213> ORGANISM: Homo sapiens

<400> SEQUENCE: 147 aatcaatgac agcaagagtc tgg 23

<210> SEQ ID NO 148
<211> LENGTH: 23
<212> TYPE: DNA

<213> ORGANISM: Homo sapiens

<400> SEQUENCE: 148 ccaggctgct cttgaactct tgg 23

<210> SEQ ID NO 149
<211> LENGTH: 23
<212> TYPE: DNA
<213> ORGANISM: Homo sapiens

<400> SEQUENCE: 149 ttagtcattc accttctccc ggg 23

<210> SEQ ID NO 150
<211> LENGTH: 23
<212> TYPE: DNA
<213> ORGANISM: Homo sapiens

<400> SEQUENCE: 150 tcactgcaag ctccgcctcc cgg 23

<210> SEQ ID NO 151
<211> LENGTH: 23
<212> TYPE: DNA
<213> ORGANISM: Homo sapiens

<400> SEQUENCE: 151 aaatactagt caggaggtgg agg 23

<210> SEQ ID NO 152
<211> LENGTH: 23
<212> TYPE: DNA
<213> ORGANISM: Homo sapiens

<400> SEQUENCE: 152 ctatctttca atcacagcaa ggg 23

<210> SEQ ID NO 153
<211> LENGTH: 23
<212> TYPE: DNA
<213> ORGANISM: Homo sapiens

<400> SEQUENCE: 153 caagagttca agagcagcct ggg 23

<210> SEQ ID NO 154
<211> LENGTH: 23
<212> TYPE: DNA
<213> ORGANISM: Homo sapiens

<400> SEQUENCE: 154 gccatgttgg caggcacaga ggg 23

<210> SEQ ID NO 155
<211> LENGTH: 23
<212> TYPE: DNA
<213> ORGANISM: Homo sapiens

<400> SEQUENCE: 155 tgccatgttg gcaggcacag agg 23

<210> SEQ ID NO 156
<211> LENGTH: 23

<212> TYPE: DNA
<213> ORGANISM: Homo sapiens

<400> SEQUENCE: 156 acagacgaag aaactgagcc cgg 23

<210> SEQ ID NO 157
<211> LENGTH: 23
<212> TYPE: DNA
<213> ORGANISM: Homo sapiens

<400> SEQUENCE: 157 tctatctttc aatcacagca agg 23

<210> SEQ ID NO 158
<211> LENGTH: 23
<212> TYPE: DNA
<213> ORGANISM: Homo sapiens

<400> SEQUENCE: 158 ccaagagttc aagagcagcc tgg 23

<210> SEQ ID NO 159
<211> LENGTH: 23
<212> TYPE: DNA
<213> ORGANISM: Homo sapiens

<400> SEQUENCE: 159 cccagctact ggggaggcta agg 23

<210> SEQ ID NO 160
<211> LENGTH: 23
<212> TYPE: DNA
<213> ORGANISM: Homo sapiens

<400> SEQUENCE: 160 tttctttttt aggagagacg ggg 23

<210> SEQ ID NO 161
<211> LENGTH: 23
<212> TYPE: DNA
<213> ORGANISM: Homo sapiens

<400> SEQUENCE: 161 actgtggaaa aattagcagg ggg 23

<210> SEQ ID NO 162
<211> LENGTH: 23
<212> TYPE: DNA
<213> ORGANISM: Homo sapiens

<400> SEQUENCE: 162 tgtaatccca gctattcagg agg 23

<210> SEQ ID NO 163
<211> LENGTH: 23
<212> TYPE: DNA
<213> ORGANISM: Homo sapiens

<400> SEQUENCE: 163 caccacttcc tttacctcca cgg 23

<210> SEQ ID NO 164

<211> LENGTH: 23
<212> TYPE: DNA
<213> ORGANISM: Homo sapiens

<400> SEQUENCE: 164 cgcccgtagt cccagctact ggg 23

<210> SEQ ID NO 165
<211> LENGTH: 23
<212> TYPE: DNA
<213> ORGANISM: Homo sapiens

<400> SEQUENCE: 165 cactgtggaa aaattagcag ggg 23

<210> SEQ ID NO 166
<211> LENGTH: 23
<212> TYPE: DNA
<213> ORGANISM: Homo sapiens

<400> SEQUENCE: 166 ccaagagcct ggcacataat agg 23

<210> SEQ ID NO 167
<211> LENGTH: 23
<212> TYPE: DNA
<213> ORGANISM: Homo sapiens

<400> SEQUENCE: 167 gccgaggcgg gcggatcacg agg 23

<210> SEQ ID NO 168
<211> LENGTH: 23
<212> TYPE: DNA
<213> ORGANISM: Homo sapiens

<400> SEQUENCE: 168 caggcgtgaa caaccgcgcc cgg 23

<210> SEQ ID NO 169
<211> LENGTH: 23
<212> TYPE: DNA
<213> ORGANISM: Homo sapiens

<400> SEQUENCE: 169 attaacacca attatgtgcc agg 23

<210> SEQ ID NO 170
<211> LENGTH: 23
<212> TYPE: DNA
<213> ORGANISM: Homo sapiens

<400> SEQUENCE: 170 gcaagggcct ggcacataat tgg 23

<210> SEQ ID NO 171
<211> LENGTH: 23
<212> TYPE: DNA
<213> ORGANISM: Homo sapiens

<400> SEQUENCE: 171 cctcagcctc ctgaatagct ggg 23

<210> SEQ ID NO 172
<211> LENGTH: 23
<212> TYPE: DNA
<213> ORGANISM: Homo sapiens

<400> SEQUENCE: 172 atggtctcac tctatcaccc agg 23

<210> SEQ ID NO 173
<211> LENGTH: 23
<212> TYPE: DNA
<213> ORGANISM: Homo sapiens

<400> SEQUENCE: 173 agccgtggag gtaaaggaag tgg 23

<210> SEQ ID NO 174
<211> LENGTH: 23
<212> TYPE: DNA
<213> ORGANISM: Homo sapiens

<400> SEQUENCE: 174 gcctgtaatc ccagctattc agg 23

<210> SEQ ID NO 175
<211> LENGTH: 23
<212> TYPE: DNA
<213> ORGANISM: Homo sapiens

<400> SEQUENCE: 175 gcaagggcct ggcacttaac agg 23

<210> SEQ ID NO 176
<211> LENGTH: 23
<212> TYPE: DNA
<213> ORGANISM: Homo sapiens

<400> SEQUENCE: 176 gcaggagaat cgcttgaact cgg 23

<210> SEQ ID NO 177
<211> LENGTH: 23
<212> TYPE: DNA
<213> ORGANISM: Homo sapiens

<400> SEQUENCE: 177 gacctggtct gggccaggcg cgg 23

<210> SEQ ID NO 178
<211> LENGTH: 23
<212> TYPE: DNA
<213> ORGANISM: Homo sapiens

<400> SEQUENCE: 178 ctagaccatc ctggctaaca tgg 23

<210> SEQ ID NO 179
<211> LENGTH: 23
<212> TYPE: DNA
<213> ORGANISM: Homo sapiens

<400> SEQUENCE: 179 gtgattgaaa gatagataga tgg 23

<210> SEQ ID NO 180
<211> LENGTH: 23
<212> TYPE: DNA
<213> ORGANISM: Homo sapiens

<400> SEQUENCE: 180 cagacgaaga aactgagccc ggg 23

<210> SEQ ID NO 181
<211> LENGTH: 23
<212> TYPE: DNA
<213> ORGANISM: Homo sapiens

<400> SEQUENCE: 181 aaaatacaac acaaattagc cgg 23

<210> SEQ ID NO 182
<211> LENGTH: 23
<212> TYPE: DNA
<213> ORGANISM: Homo sapiens

<400> SEQUENCE: 182 gcgggtggat cacctgaggt cgg 23

<210> SEQ ID NO 183
<211> LENGTH: 23
<212> TYPE: DNA
<213> ORGANISM: Homo sapiens

<400> SEQUENCE: 183 cctattatgt gccaggctct tgg 23

<210> SEQ ID NO 184
<211> LENGTH: 23
<212> TYPE: DNA
<213> ORGANISM: Homo sapiens

<400> SEQUENCE: 184 tcctgaatag ctgggattac agg 23

<210> SEQ ID NO 185
<211> LENGTH: 23
<212> TYPE: DNA
<213> ORGANISM: Homo sapiens

<400> SEQUENCE: 185 gcccgtagtc ccagctactg ggg 23

<210> SEQ ID NO 186
<211> LENGTH: 23
<212> TYPE: DNA
<213> ORGANISM: Homo sapiens

<400> SEQUENCE: 186 ctcaggtgat ccacccgcct tgg 23

<210> SEQ ID NO 187
<211> LENGTH: 23
<212> TYPE: DNA
<213> ORGANISM: Homo sapiens

<400> SEQUENCE: 187 aattaatcac agcaagggcc tgg 23

<210> SEQ ID NO 188
<211> LENGTH: 23
<212> TYPE: DNA
<213> ORGANISM: Homo sapiens

<400> SEQUENCE: 188 ttttcttttt taggagagac ggg 23

<210> SEQ ID NO 189
<211> LENGTH: 23
<212> TYPE: DNA
<213> ORGANISM: Homo sapiens

<400> SEQUENCE: 189 taatttttcc acagtgccat agg 23

<210> SEQ ID NO 190
<211> LENGTH: 23
<212> TYPE: DNA
<213> ORGANISM: Homo sapiens

<400> SEQUENCE: 190 ttgtattttt aagtagagac agg 23

<210> SEQ ID NO 191
<211> LENGTH: 23
<212> TYPE: DNA
<213> ORGANISM: Homo sapiens

<400> SEQUENCE: 191 aatttttcca cagtgccata ggg 23

<210> SEQ ID NO 192
<211> LENGTH: 23
<212> TYPE: DNA
<213> ORGANISM: Homo sapiens

<400> SEQUENCE: 192 cgggtggatc acctgaggtc ggg 23

<210> SEQ ID NO 193
<211> LENGTH: 23
<212> TYPE: DNA
<213> ORGANISM: Homo sapiens

<400> SEQUENCE: 193 actagtcagg aggtggaggc agg 23

<210> SEQ ID NO 194
<211> LENGTH: 23
<212> TYPE: DNA
<213> ORGANISM: Homo sapiens

<400> SEQUENCE: 194 ttcatacata aactataaaa tgg 23

<210> SEQ ID NO 195
<211> LENGTH: 23
<212> TYPE: DNA
<213> ORGANISM: Homo sapiens

<400> SEQUENCE: 195 gggaggctaa ggcaggagaa tgg 23

<210> SEQ ID NO 196
<211> LENGTH: 23
<212> TYPE: DNA
<213> ORGANISM: Homo sapiens

<400> SEQUENCE: 196 tgagtctagc tctgtcgccc agg 23

<210> SEQ ID NO 197
<211> LENGTH: 23
<212> TYPE: DNA
<213> ORGANISM: Homo sapiens

<400> SEQUENCE: 197 ctttgggagg ccgaggcggg cgg 23

<210> SEQ ID NO 198
<211> LENGTH: 23
<212> TYPE: DNA
<213> ORGANISM: Homo sapiens

<400> SEQUENCE: 198 caaaaaaaaa gaaactgacc tgg 23

<210> SEQ ID NO 199
<211> LENGTH: 23
<212> TYPE: DNA
<213> ORGANISM: Homo sapiens

<400> SEQUENCE: 199 cgggcgccca ccaccacgcc cgg 23

<210> SEQ ID NO 200
<211> LENGTH: 23
<212> TYPE: DNA
<213> ORGANISM: Homo sapiens

<400> SEQUENCE: 200 ccggctaatt tttctttttt agg 23

<210> SEQ ID NO 201
<211> LENGTH: 23
<212> TYPE: DNA
<213> ORGANISM: Homo sapiens

<400> SEQUENCE: 201 tcatacataa actataaaat ggg 23

<210> SEQ ID NO 202
<211> LENGTH: 23
<212> TYPE: DNA
<213> ORGANISM: Homo sapiens

<400> SEQUENCE: 202 ttgaaagata gatagatgga tgg 23

<210> SEQ ID NO 203
<211> LENGTH: 23
<212> TYPE: DNA
<213> ORGANISM: Homo sapiens

<400> SEQUENCE: 203 cccagctatt caggaggctg agg 23

<210> SEQ ID NO 204
<211> LENGTH: 23
<212> TYPE: DNA
<213> ORGANISM: Homo sapiens

<400> SEQUENCE: 204 tgtattttta agtagagaca ggg 23

<210> SEQ ID NO 205
<211> LENGTH: 23
<212> TYPE: DNA
<213> ORGANISM: Homo sapiens

<400> SEQUENCE: 205 cctaaaaaag aaaaattagc cgg 23

<210> SEQ ID NO 206
<211> LENGTH: 23
<212> TYPE: DNA
<213> ORGANISM: Homo sapiens

<400> SEQUENCE: 206 catacataaa ctataaaatg ggg 23

<210> SEQ ID NO 207
<211> LENGTH: 23
<212> TYPE: DNA
<213> ORGANISM: Homo sapiens

<400> SEQUENCE: 207 atttgcacct attatgtgcc agg 23

<210> SEQ ID NO 208
<211> LENGTH: 23
<212> TYPE: DNA
<213> ORGANISM: Homo sapiens

<400> SEQUENCE: 208 agtttcttcg tctgtaaaat ggg 23

<210> SEQ ID NO 209
<211> LENGTH: 23
<212> TYPE: DNA
<213> ORGANISM: Homo sapiens

<400> SEQUENCE: 209 cgcgccattg cactccagcc tgg 23

<210> SEQ ID NO 210
<211> LENGTH: 23
<212> TYPE: DNA
<213> ORGANISM: Homo sapiens

<400> SEQUENCE: 210 gcgccattgc actccagcct ggg 23

<210> SEQ ID NO 211
<211> LENGTH: 23
<212> TYPE: DNA
<213> ORGANISM: Homo sapiens

<400> SEQUENCE: 211 ctttgggagg ccaaggcggg tgg 23

<210> SEQ ID NO 212
<211> LENGTH: 23
<212> TYPE: DNA
<213> ORGANISM: Homo sapiens

<400> SEQUENCE: 212 gctattcagg aggctgaggc agg 23

<210> SEQ ID NO 213
<211> LENGTH: 23
<212> TYPE: DNA
<213> ORGANISM: Homo sapiens

<400> SEQUENCE: 213 tttttctttt ttaggagaga cgg 23

<210> SEQ ID NO 214
<211> LENGTH: 23
<212> TYPE: DNA
<213> ORGANISM: Homo sapiens

<400> SEQUENCE: 214 aagatagata gatggatgga tgg 23

<210> SEQ ID NO 215
<211> LENGTH: 23
<212> TYPE: DNA
<213> ORGANISM: Homo sapiens

<400> SEQUENCE: 215 tatttattta ttttttagac agg 23

<210> SEQ ID NO 216
<211> LENGTH: 23
<212> TYPE: DNA
<213> ORGANISM: Homo sapiens

<400> SEQUENCE: 216 agggtttcac catgttagcc agg 23

<210> SEQ ID NO 217
<211> LENGTH: 23
<212> TYPE: DNA
<213> ORGANISM: Homo sapiens

<400> SEQUENCE: 217 ctccccagta gctgggacta cgg 23

<210> SEQ ID NO 218
<211> LENGTH: 23
<212> TYPE: DNA
<213> ORGANISM: Homo sapiens

<400> SEQUENCE: 218 gcactttggg aggccgaggc ggg 23

<210> SEQ ID NO 219
<211> LENGTH: 23
<212> TYPE: DNA
<213> ORGANISM: Homo sapiens

<400> SEQUENCE: 219 ggagtgcagt ggtgtgatct cgg 23

<210> SEQ ID NO 220
<211> LENGTH: 23
<212> TYPE: DNA
<213> ORGANISM: Homo sapiens

<400> SEQUENCE: 220 cagtttcttc gtctgtaaaa tgg 23

<210> SEQ ID NO 221
<211> LENGTH: 23
<212> TYPE: DNA
<213> ORGANISM: Homo sapiens

<400> SEQUENCE: 221 tccccagtag ctgggactac ggg 23

<210> SEQ ID NO 222
<211> LENGTH: 23
<212> TYPE: DNA
<213> ORGANISM: Homo sapiens

<400> SEQUENCE: 222 tttcaccatg ttagccagga tgg 23

<210> SEQ ID NO 223
<211> LENGTH: 23
<212> TYPE: DNA
<213> ORGANISM: Homo sapiens

<400> SEQUENCE: 223 ggggtttctc catgttggtc agg 23

<210> SEQ ID NO 224
<211> LENGTH: 23
<212> TYPE: DNA
<213> ORGANISM: Homo sapiens

<400> SEQUENCE: 224 agtcaggagg tggaggcagg agg 23

<210> SEQ ID NO 225
<211> LENGTH: 23
<212> TYPE: DNA
<213> ORGANISM: Homo sapiens

<400> SEQUENCE: 225 agcactttgg gaggccgagg cgg 23

<210> SEQ ID NO 226
<211> LENGTH: 23
<212> TYPE: DNA
<213> ORGANISM: Homo sapiens

<400> SEQUENCE: 226 tctagctctg tcgcccaggc tgg 23

<210> SEQ ID NO 227
<211> LENGTH: 23
<212> TYPE: DNA

<213> ORGANISM: Homo sapiens

<400> SEQUENCE: 227 agggtctcgc tctgttgccc agg 23

<210> SEQ ID NO 228
<211> LENGTH: 23
<212> TYPE: DNA
<213> ORGANISM: Homo sapiens

<400> SEQUENCE: 228 atttatttat tttttagaca ggg 23

<210> SEQ ID NO 229
<211> LENGTH: 23
<212> TYPE: DNA
<213> ORGANISM: Homo sapiens

<400> SEQUENCE: 229 tgtgccactg cactccagcc tgg 23

<210> SEQ ID NO 230
<211> LENGTH: 23
<212> TYPE: DNA
<213> ORGANISM: Homo sapiens

<400> SEQUENCE: 230 ggagtctcgc tctgtcgccc agg 23

<210> SEQ ID NO 231
<211> LENGTH: 23
<212> TYPE: DNA
<213> ORGANISM: Homo sapiens

<400> SEQUENCE: 231 cacaccactg cactccagcc tgg 23

<210> SEQ ID NO 232
<211> LENGTH: 23
<212> TYPE: DNA
<213> ORGANISM: Homo sapiens

<400> SEQUENCE: 232 tttctccatg ttggtcaggc tgg 23

<210> SEQ ID NO 233
<211> LENGTH: 23
<212> TYPE: DNA
<213> ORGANISM: Homo sapiens

<400> SEQUENCE: 233 tctcactcta tcacccaggc tgg 23

<210> SEQ ID NO 234
<211> LENGTH: 23
<212> TYPE: DNA
<213> ORGANISM: Homo sapiens

<400> SEQUENCE: 234 cccagcactt tgggaggccg agg 23

<210> SEQ ID NO 235
<211> LENGTH: 23

<212> TYPE: DNA
<213> ORGANISM: Homo sapiens

<400> SEQUENCE: 235 cagtttcttt ttttttgaga cgg 23

<210> SEQ ID NO 236
<211> LENGTH: 23
<212> TYPE: DNA
<213> ORGANISM: Homo sapiens

<400> SEQUENCE: 236 cgagaccagc ctgaccaaca tgg 23

<210> SEQ ID NO 237
<211> LENGTH: 23
<212> TYPE: DNA
<213> ORGANISM: Homo sapiens

<400> SEQUENCE: 237 tcgcccaggc tggagtgcaa tgg 23

<210> SEQ ID NO 238
<211> LENGTH: 23
<212> TYPE: DNA
<213> ORGANISM: Homo sapiens

<400> SEQUENCE: 238 gcctcggcct cccaaagtgc tgg 23

<210> SEQ ID NO 239
<211> LENGTH: 23
<212> TYPE: DNA
<213> ORGANISM: Homo sapiens

<400> SEQUENCE: 239 tctcgctctg tcgcccaggc tgg 23

<210> SEQ ID NO 240
<211> LENGTH: 23
<212> TYPE: DNA
<213> ORGANISM: Homo sapiens

<400> SEQUENCE: 240 acaccactgc actccagcct ggg 23

<210> SEQ ID NO 241
<211> LENGTH: 23
<212> TYPE: DNA
<213> ORGANISM: Homo sapiens

<400> SEQUENCE: 241 gtgccactgc actccagcct ggg 23

<210> SEQ ID NO 242
<211> LENGTH: 23
<212> TYPE: DNA
<213> ORGANISM: Homo sapiens

<400> SEQUENCE: 242 cctcggcctc ccaaagtgct ggg 23

<210> SEQ ID NO 243

<211> LENGTH: 23
<212> TYPE: DNA
<213> ORGANISM: Homo sapiens

<400> SEQUENCE: 243 gcactttggg aggccaaggc ggg 23

<210> SEQ ID NO 244
<211> LENGTH: 23
<212> TYPE: DNA
<213> ORGANISM: Homo sapiens

<400> SEQUENCE: 244 cccagcactt tgggaggcca agg 23

<210> SEQ ID NO 245
<211> LENGTH: 23
<212> TYPE: DNA
<213> ORGANISM: Homo sapiens

<400> SEQUENCE: 245 tcgcccaggc tggagtgcag tgg 23

<210> SEQ ID NO 246
<211> LENGTH: 23
<212> TYPE: DNA
<213> ORGANISM: Homo sapiens

<400> SEQUENCE: 246 agcactttgg gaggccaagg cgg 23

<210> SEQ ID NO 247
<211> LENGTH: 23
<212> TYPE: DNA
<213> ORGANISM: Homo sapiens

<400> SEQUENCE: 247 gccttggcct cccaaagtgc tgg 23

<210> SEQ ID NO 248
<211> LENGTH: 23
<212> TYPE: DNA
<213> ORGANISM: Homo sapiens

<400> SEQUENCE: 248 attagcacct attatgtgcc agg 23

<210> SEQ ID NO 249
<211> LENGTH: 23
<212> TYPE: DNA
<213> ORGANISM: Homo sapiens

<400> SEQUENCE: 249 cgcctgtaat cccagcactt tgg 23

<210> SEQ ID NO 250
<211> LENGTH: 23
<212> TYPE: DNA
<213> ORGANISM: Homo sapiens

<400> SEQUENCE: 250 ccttggcctc ccaaagtgct ggg 23

<210> SEQ ID NO 251
<211> LENGTH: 23
<212> TYPE: DNA
<213> ORGANISM: Homo sapiens

<400> SEQUENCE: 251 cgcctgtaat cccagcactt tgg 23

<210> SEQ ID NO 252
<211> LENGTH: 23
<212> TYPE: DNA
<213> ORGANISM: Homo sapiens

<400> SEQUENCE: 252 tcacccaggc tggagtgcag tgg 23

<210> SEQ ID NO 253
<211> LENGTH: 23
<212> TYPE: DNA
<213> ORGANISM: Homo sapiens

<400> SEQUENCE: 253 tgtaatccca gcactttggg agg 23

<210> SEQ ID NO 254
<211> LENGTH: 23
<212> TYPE: DNA
<213> ORGANISM: Homo sapiens

<400> SEQUENCE: 254 gcctgtaatc ccagcacttt ggg 23

<210> SEQ ID NO 255
<211> LENGTH: 23
<212> TYPE: DNA
<213> ORGANISM: Homo sapiens

<400> SEQUENCE: 255 tgtaatccca gcactttggg agg 23

<210> SEQ ID NO 256
<211> LENGTH: 23
<212> TYPE: DNA
<213> ORGANISM: Homo sapiens

<400> SEQUENCE: 256 gcctgtaatc ccagcacttt ggg 23

<210> SEQ ID NO 257
<211> LENGTH: 23
<212> TYPE: DNA
<213> ORGANISM: Homo sapiens

<400> SEQUENCE: 257 caggcgtgag ccaccgcgcc tgg 23

<210> SEQ ID NO 258
<211> LENGTH: 23
<212> TYPE: DNA
<213> ORGANISM: Homo sapiens

<400> SEQUENCE: 258 tcccaaagtg ctgggattac agg 23

<210> SEQ ID NO 259
<211> LENGTH: 23
<212> TYPE: DNA
<213> ORGANISM: Homo sapiens

<400> SEQUENCE: 259 atttacggaa gagagtatcg agg 23

<210> SEQ ID NO 260
<211> LENGTH: 23
<212> TYPE: DNA
<213> ORGANISM: Homo sapiens

<400> SEQUENCE: 260 tacggaagag agtatcgagg tgg 23

<210> SEQ ID NO 261
<211> LENGTH: 23
<212> TYPE: DNA
<213> ORGANISM: Homo sapiens

<400> SEQUENCE: 261 gggcagatac ccgctagagc tgg 23

<210> SEQ ID NO 262
<211> LENGTH: 23
<212> TYPE: DNA
<213> ORGANISM: Homo sapiens

<400> SEQUENCE: 262 cggaagagag tatcgaggtg ggg 23

<210> SEQ ID NO 263
<211> LENGTH: 23
<212> TYPE: DNA
<213> ORGANISM: Homo sapiens

<400> SEQUENCE: 263 tagcgggtat ctgcccacca tgg 23

<210> SEQ ID NO 264
<211> LENGTH: 23
<212> TYPE: DNA
<213> ORGANISM: Homo sapiens

<400> SEQUENCE: 264 acggaagaga gtatcgaggt ggg 23

<210> SEQ ID NO 265
<211> LENGTH: 23
<212> TYPE: DNA
<213> ORGANISM: Homo sapiens

<400> SEQUENCE: 265 gatactctct tccgtaaatg agg 23

<210> SEQ ID NO 266
<211> LENGTH: 23
<212> TYPE: DNA
<213> ORGANISM: Homo sapiens

<400> SEQUENCE: 266 tcttccgtaa atgaggatct ggg 23

<210> SEQ ID NO 267
<211> LENGTH: 23
<212> TYPE: DNA
<213> ORGANISM: Homo sapiens

<400> SEQUENCE: 267 ctcttccgta aatgaggatc tgg 23

<210> SEQ ID NO 268
<211> LENGTH: 23
<212> TYPE: DNA
<213> ORGANISM: Homo sapiens

<400> SEQUENCE: 268 cgtaaatgag gatctgggtc tgg 23

<210> SEQ ID NO 269
<211> LENGTH: 23
<212> TYPE: DNA
<213> ORGANISM: Homo sapiens

<400> SEQUENCE: 269 gtgactgtgt catagcccta tgg 23

<210> SEQ ID NO 270
<211> LENGTH: 23
<212> TYPE: DNA
<213> ORGANISM: Homo sapiens

<400> SEQUENCE: 270 gtatcgaggt gggggcctgt ggg 23

<210> SEQ ID NO 271
<211> LENGTH: 23
<212> TYPE: DNA
<213> ORGANISM: Homo sapiens

<400> SEQUENCE: 271 gtcatagccc tatggcactg tgg 23

<210> SEQ ID NO 272
<211> LENGTH: 23
<212> TYPE: DNA
<213> ORGANISM: Homo sapiens

<400> SEQUENCE: 272 gctatgacac agtcacccac agg 23

<210> SEQ ID NO 273
<211> LENGTH: 23
<212> TYPE: DNA
<213> ORGANISM: Homo sapiens

<400> SEQUENCE: 273 gagagggtgc gaccaagccc tgg 23

<210> SEQ ID NO 274
<211> LENGTH: 23
<212> TYPE: DNA
<213> ORGANISM: Homo sapiens

<400> SEQUENCE: 274 ggcactgtgg aaaaattagc agg 23

<210> SEQ ID NO 275
<211> LENGTH: 23
<212> TYPE: DNA
<213> ORGANISM: Homo sapiens

<400> SEQUENCE: 275 ggaagagagt atcgaggtgg ggg 23

<210> SEQ ID NO 276
<211> LENGTH: 23
<212> TYPE: DNA
<213> ORGANISM: Homo sapiens

<400> SEQUENCE: 276 tacccgctag agctggagcc agg 23

<210> SEQ ID NO 277
<211> LENGTH: 23
<212> TYPE: DNA
<213> ORGANISM: Homo sapiens

<400> SEQUENCE: 277 cagacccaga tcctcattta cgg 23

<210> SEQ ID NO 278
<211> LENGTH: 23
<212> TYPE: DNA
<213> ORGANISM: Homo sapiens

<400> SEQUENCE: 278 agtatcgagg tgggggcctg tgg 23

<210> SEQ ID NO 279
<211> LENGTH: 23
<212> TYPE: DNA
<213> ORGANISM: Homo sapiens

<400> SEQUENCE: 279 gcactgtgga aaaattagca ggg 23

<210> SEQ ID NO 280
<211> LENGTH: 23
<212> TYPE: DNA
<213> ORGANISM: Homo sapiens

<400> SEQUENCE: 280 cagctggagg atcagcacca ggg 23

<210> SEQ ID NO 281
<211> LENGTH: 23
<212> TYPE: DNA
<213> ORGANISM: Homo sapiens

<400> SEQUENCE: 281 gcagctggag gatcagcacc agg 23

<210> SEQ ID NO 282
<211> LENGTH: 23
<212> TYPE: DNA
<213> ORGANISM: Homo sapiens

<400> SEQUENCE: 282 actcacagag ggtcagcagc tgg 23

<210> SEQ ID NO 283
<211> LENGTH: 23
<212> TYPE: DNA
<213> ORGANISM: Homo sapiens

<400> SEQUENCE: 283 aagaaagggg tgactcacag agg 23

<210> SEQ ID NO 284
<211> LENGTH: 23
<212> TYPE: DNA
<213> ORGANISM: Homo sapiens

<400> SEQUENCE: 284 gtatctgccc accatggccc tgg 23

<210> SEQ ID NO 285
<211> LENGTH: 23
<212> TYPE: DNA
<213> ORGANISM: Homo sapiens

<400> SEQUENCE: 285 tgttgcctca tttcctggga ggg 23

<210> SEQ ID NO 286
<211> LENGTH: 23
<212> TYPE: DNA
<213> ORGANISM: Homo sapiens

<400> SEQUENCE: 286 atgttgcctc atttcctggg agg 23

<210> SEQ ID NO 287
<211> LENGTH: 23
<212> TYPE: DNA
<213> ORGANISM: Homo sapiens

<400> SEQUENCE: 287 actgtggaaa aattagcagg ggg 23

<210> SEQ ID NO 288
<211> LENGTH: 23
<212> TYPE: DNA
<213> ORGANISM: Homo sapiens

<400> SEQUENCE: 288 ctgatgttgc ctcatttcct ggg 23

<210> SEQ ID NO 289
<211> LENGTH: 23
<212> TYPE: DNA
<213> ORGANISM: Homo sapiens

<400> SEQUENCE: 289 agccctggct ccagctctag cgg 23

<210> SEQ ID NO 290
<211> LENGTH: 23
<212> TYPE: DNA
<213> ORGANISM: Homo sapiens

<400> SEQUENCE: 290 atcagcacca gggccatggt ggg 23

<210> SEQ ID NO 291
<211> LENGTH: 23
<212> TYPE: DNA
<213> ORGANISM: Homo sapiens

<400> SEQUENCE: 291 acccgctaga gctggagcca ggg 23

<210> SEQ ID NO 292
<211> LENGTH: 23
<212> TYPE: DNA
<213> ORGANISM: Homo sapiens

<400> SEQUENCE: 292 cactgtggaa aaattagcag ggg 23

<210> SEQ ID NO 293
<211> LENGTH: 23
<212> TYPE: DNA
<213> ORGANISM: Homo sapiens

<400> SEQUENCE: 293 tctgatgttg cctcatttcc tgg 23

<210> SEQ ID NO 294
<211> LENGTH: 23
<212> TYPE: DNA
<213> ORGANISM: Homo sapiens

<400> SEQUENCE: 294 agaaaggggt gactcacaga ggg 23

<210> SEQ ID NO 295
<211> LENGTH: 23
<212> TYPE: DNA
<213> ORGANISM: Homo sapiens

<400> SEQUENCE: 295 gttgcctcat ttcctgggag ggg 23

<210> SEQ ID NO 296
<211> LENGTH: 23
<212> TYPE: DNA
<213> ORGANISM: Homo sapiens

<400> SEQUENCE: 296 ctctcccctc ccaggaaatg agg 23

<210> SEQ ID NO 297
<211> LENGTH: 23
<212> TYPE: DNA
<213> ORGANISM: Homo sapiens

<400> SEQUENCE: 297 gaggatcagc accagggcca tgg 23

<210> SEQ ID NO 298
<211> LENGTH: 23
<212> TYPE: DNA
<213> ORGANISM: Homo sapiens

<400> SEQUENCE: 298 cacagagggt cagcagctgg agg 23

<210> SEQ ID NO 299
<211> LENGTH: 23
<212> TYPE: DNA
<213> ORGANISM: Homo sapiens

<400> SEQUENCE: 299 taatttttcc acagtgccat agg 23

<210> SEQ ID NO 300
<211> LENGTH: 23
<212> TYPE: DNA
<213> ORGANISM: Homo sapiens

<400> SEQUENCE: 300 aatttttcca cagtgccata ggg 23

<210> SEQ ID NO 301
<211> LENGTH: 23
<212> TYPE: DNA
<213> ORGANISM: Homo sapiens

<400> SEQUENCE: 301 gccctggctc cagctctagc ggg 23

<210> SEQ ID NO 302
<211> LENGTH: 23
<212> TYPE: DNA
<213> ORGANISM: Homo sapiens

<400> SEQUENCE: 302 ctcatttcct gggaggggag agg 23

<210> SEQ ID NO 303
<211> LENGTH: 23
<212> TYPE: DNA
<213> ORGANISM: Homo sapiens

<400> SEQUENCE: 303 gatcagcacc agggccatgg tgg 23

<210> SEQ ID NO 304
<211> LENGTH: 23
<212> TYPE: DNA
<213> ORGANISM: Homo sapiens

<400> SEQUENCE: 304 tcatttcctg ggaggggaga ggg 23

<210> SEQ ID NO 305
<211> LENGTH: 23
<212> TYPE: DNA
<213> ORGANISM: Homo sapiens

<400> SEQUENCE: 305 ctagagctgg agccagggct tgg 23

<210> SEQ ID NO 306
<211> LENGTH: 23
<212> TYPE: DNA

<213> ORGANISM: Homo sapiens

<400> SEQUENCE: 306 gtcgcaccct ctcccctccc agg 23

<210> SEQ ID NO 307
<211> LENGTH: 23
<212> TYPE: DNA
<213> ORGANISM: Homo sapiens

<400> SEQUENCE: 307 cacacagaca tcactccgtc tgg 23

<210> SEQ ID NO 308
<211> LENGTH: 23
<212> TYPE: DNA
<213> ORGANISM: Homo sapiens

<400> SEQUENCE: 308 ctagtccctc aacctcctac agg 23

<210> SEQ ID NO 309
<211> LENGTH: 23
<212> TYPE: DNA
<213> ORGANISM: Homo sapiens

<400> SEQUENCE: 309 tagtccctca acctcctaca ggg 23

<210> SEQ ID NO 310
<211> LENGTH: 23
<212> TYPE: DNA
<213> ORGANISM: Homo sapiens

<400> SEQUENCE: 310 tggggtggct actcaccaga cgg 23

<210> SEQ ID NO 311
<211> LENGTH: 23
<212> TYPE: DNA
<213> ORGANISM: Homo sapiens

<400> SEQUENCE: 311 agaggccctg taggaggttg agg 23

<210> SEQ ID NO 312
<211> LENGTH: 23
<212> TYPE: DNA
<213> ORGANISM: Homo sapiens

<400> SEQUENCE: 312 tgacacagag gccctgtagg agg 23

<210> SEQ ID NO 313
<211> LENGTH: 23
<212> TYPE: DNA
<213> ORGANISM: Homo sapiens

<400> SEQUENCE: 313 gaggccctgt aggaggttga ggg 23

<210> SEQ ID NO 314
<211> LENGTH: 23

<212> TYPE: DNA
<213> ORGANISM: Homo sapiens

<400> SEQUENCE: 314 gtgatgtctg tgtgacacag agg 23

<210> SEQ ID NO 315
<211> LENGTH: 23
<212> TYPE: DNA
<213> ORGANISM: Homo sapiens

<400> SEQUENCE: 315 gtgtgacaca gaggccctgt agg 23

<210> SEQ ID NO 316
<211> LENGTH: 23
<212> TYPE: DNA
<213> ORGANISM: Homo sapiens

<400> SEQUENCE: 316 ctcacctata atggccacta agg 23

<210> SEQ ID NO 317
<211> LENGTH: 23
<212> TYPE: DNA
<213> ORGANISM: Homo sapiens

<400> SEQUENCE: 317 cacctataat ggccactaag ggg 23

<210> SEQ ID NO 318
<211> LENGTH: 23
<212> TYPE: DNA
<213> ORGANISM: Homo sapiens

<400> SEQUENCE: 318 tcacctataa tggccactaa ggg 23

<210> SEQ ID NO 319
<211> LENGTH: 23
<212> TYPE: DNA
<213> ORGANISM: Homo sapiens

<400> SEQUENCE: 319 ttccccttag tggccattat agg 23

<210> SEQ ID NO 320
<211> LENGTH: 23
<212> TYPE: DNA
<213> ORGANISM: Homo sapiens

<400> SEQUENCE: 320 tcttcagtac tcacctataa tgg 23

<210> SEQ ID NO 321
<211> LENGTH: 23
<212> TYPE: DNA
<213> ORGANISM: Homo sapiens

<400> SEQUENCE: 321 ataggtgagt actgaagacc agg 23

<210> SEQ ID NO 322

<211> LENGTH: 23
<212> TYPE: DNA
<213> ORGANISM: Homo sapiens

<400> SEQUENCE: 322 tcttttctca ttccccttag tgg 23

<210> SEQ ID NO 323
<211> LENGTH: 23
<212> TYPE: DNA
<213> ORGANISM: Homo sapiens

<400> SEQUENCE: 323 tgcgttcaga cttcttcggt agg 23

<210> SEQ ID NO 324
<211> LENGTH: 23
<212> TYPE: DNA
<213> ORGANISM: Homo sapiens

<400> SEQUENCE: 324 ttcagacttc ttcggtaggt ggg 23

<210> SEQ ID NO 325
<211> LENGTH: 23
<212> TYPE: DNA
<213> ORGANISM: Homo sapiens

<400> SEQUENCE: 325 tacttgaacc ctagagtcgg agg 23

<210> SEQ ID NO 326
<211> LENGTH: 23
<212> TYPE: DNA
<213> ORGANISM: Homo sapiens

<400> SEQUENCE: 326 gtttctcctc tcacgagttc agg 23

<210> SEQ ID NO 327
<211> LENGTH: 23
<212> TYPE: DNA
<213> ORGANISM: Homo sapiens

<400> SEQUENCE: 327 gttcagactt cttcggtagg tgg 23

<210> SEQ ID NO 328
<211> LENGTH: 23
<212> TYPE: DNA
<213> ORGANISM: Homo sapiens

<400> SEQUENCE: 328 gagcattcgc tatattgccc agg 23

<210> SEQ ID NO 329
<211> LENGTH: 23
<212> TYPE: DNA
<213> ORGANISM: Homo sapiens

<400> SEQUENCE: 329 gcggtctccc tatgttgagc agg 23

<210> SEQ ID NO 330
<211> LENGTH: 23
<212> TYPE: DNA
<213> ORGANISM: Homo sapiens

<400> SEQUENCE: 330 aactgcagcc tccgactcta ggg 23

<210> SEQ ID NO 331
<211> LENGTH: 23
<212> TYPE: DNA
<213> ORGANISM: Homo sapiens

<400> SEQUENCE: 331 gcctcagcct ccgtagtagc tgg 23

<210> SEQ ID NO 332
<211> LENGTH: 23
<212> TYPE: DNA
<213> ORGANISM: Homo sapiens

<400> SEQUENCE: 332 cagattcctg aactcgtgag agg 23

<210> SEQ ID NO 333
<211> LENGTH: 23
<212> TYPE: DNA
<213> ORGANISM: Homo sapiens

<400> SEQUENCE: 333 caagctagca ctaccacgcc tgg 23

<210> SEQ ID NO 334
<211> LENGTH: 23
<212> TYPE: DNA
<213> ORGANISM: Homo sapiens

<400> SEQUENCE: 334 tgtagtccca gctactacgg agg 23

<210> SEQ ID NO 335
<211> LENGTH: 23
<212> TYPE: DNA
<213> ORGANISM: Homo sapiens

<400> SEQUENCE: 335 gaactcgctg ttgggcgcag cgg 23

<210> SEQ ID NO 336
<211> LENGTH: 23
<212> TYPE: DNA
<213> ORGANISM: Homo sapiens

<400> SEQUENCE: 336 cttcttcggt aggtgggcaa tgg 23

<210> SEQ ID NO 337
<211> LENGTH: 23
<212> TYPE: DNA
<213> ORGANISM: Homo sapiens

<400> SEQUENCE: 337 agagaggggt ttcgccatgt tgg 23

<210> SEQ ID NO 338
<211> LENGTH: 23
<212> TYPE: DNA
<213> ORGANISM: Homo sapiens

<400> SEQUENCE: 338 ggggtttcac cacattagcc agg 23

<210> SEQ ID NO 339
<211> LENGTH: 23
<212> TYPE: DNA
<213> ORGANISM: Homo sapiens

<400> SEQUENCE: 339 ctcacctata atggccacta agg 23

<210> SEQ ID NO 340
<211> LENGTH: 23
<212> TYPE: DNA
<213> ORGANISM: Homo sapiens

<400> SEQUENCE: 340 aggtcagatc gagatcatcc tgg 23

<210> SEQ ID NO 341
<211> LENGTH: 23
<212> TYPE: DNA
<213> ORGANISM: Homo sapiens

<400> SEQUENCE: 341 taactgcagc ctccgactct agg 23

<210> SEQ ID NO 342
<211> LENGTH: 23
<212> TYPE: DNA
<213> ORGANISM: Homo sapiens

<400> SEQUENCE: 342 cacctataat ggccactaag ggg 23

<210> SEQ ID NO 343
<211> LENGTH: 23
<212> TYPE: DNA
<213> ORGANISM: Homo sapiens

<400> SEQUENCE: 343 tcacctataa tggccactaa ggg 23

<210> SEQ ID NO 344
<211> LENGTH: 23
<212> TYPE: DNA
<213> ORGANISM: Homo sapiens

<400> SEQUENCE: 344 taaaaataag ggtcgggtga ggg 23

<210> SEQ ID NO 345
<211> LENGTH: 23
<212> TYPE: DNA
<213> ORGANISM: Homo sapiens

<400> SEQUENCE: 345 ccccctccca tataagaatc tgg 23

<210> SEQ ID NO 346
<211> LENGTH: 23
<212> TYPE: DNA
<213> ORGANISM: Homo sapiens

<400> SEQUENCE: 346 cctcagcctc cgtagtagct ggg 23

<210> SEQ ID NO 347
<211> LENGTH: 23
<212> TYPE: DNA
<213> ORGANISM: Homo sapiens

<400> SEQUENCE: 347 ccccatctca ttggtaaccc agg 23

<210> SEQ ID NO 348
<211> LENGTH: 23
<212> TYPE: DNA
<213> ORGANISM: Homo sapiens

<400> SEQUENCE: 348 ttccccttag tggccattat agg 23

<210> SEQ ID NO 349
<211> LENGTH: 23
<212> TYPE: DNA
<213> ORGANISM: Homo sapiens

<400> SEQUENCE: 349 gcaggttggt cttaaactac tgg 23

<210> SEQ ID NO 350
<211> LENGTH: 23
<212> TYPE: DNA
<213> ORGANISM: Homo sapiens

<400> SEQUENCE: 350 cccagattct tatatgggag ggg 23

<210> SEQ ID NO 351
<211> LENGTH: 23
<212> TYPE: DNA
<213> ORGANISM: Homo sapiens

<400> SEQUENCE: 351 ggactcccag attcttatat ggg 23

<210> SEQ ID NO 352
<211> LENGTH: 23
<212> TYPE: DNA
<213> ORGANISM: Homo sapiens

<400> SEQUENCE: 352 ctctcacgag ttcaggaatc tgg 23

<210> SEQ ID NO 353
<211> LENGTH: 23
<212> TYPE: DNA
<213> ORGANISM: Homo sapiens

<400> SEQUENCE: 353 ctcccagatt cttatatggg agg 23

<210> SEQ ID NO 354
<211> LENGTH: 23
<212> TYPE: DNA
<213> ORGANISM: Homo sapiens

<400> SEQUENCE: 354 cccctcccat ataagaatct ggg 23

<210> SEQ ID NO 355
<211> LENGTH: 23
<212> TYPE: DNA
<213> ORGANISM: Homo sapiens

<400> SEQUENCE: 355 cacacagaca tcactccgtc tgg 23

<210> SEQ ID NO 356
<211> LENGTH: 23
<212> TYPE: DNA
<213> ORGANISM: Homo sapiens

<400> SEQUENCE: 356 aggaaggctg ttgggtccgg tgg 23

<210> SEQ ID NO 357
<211> LENGTH: 23
<212> TYPE: DNA
<213> ORGANISM: Homo sapiens

<400> SEQUENCE: 357 actctacgat cattgttccc tgg 23

<210> SEQ ID NO 358
<211> LENGTH: 23
<212> TYPE: DNA
<213> ORGANISM: Homo sapiens

<400> SEQUENCE: 358 tttgaaaaga actcgctgtt ggg 23

<210> SEQ ID NO 359
<211> LENGTH: 23
<212> TYPE: DNA
<213> ORGANISM: Homo sapiens

<400> SEQUENCE: 359 tctccctatg ttgagcaggt tgg 23

<210> SEQ ID NO 360
<211> LENGTH: 23
<212> TYPE: DNA
<213> ORGANISM: Homo sapiens

<400> SEQUENCE: 360 tctcacgagt tcaggaatct ggg 23

<210> SEQ ID NO 361
<211> LENGTH: 23
<212> TYPE: DNA
<213> ORGANISM: Homo sapiens

<400> SEQUENCE: 361 ggatcttggg ctgggcgcaa tgg 23

<210> SEQ ID NO 362
<211> LENGTH: 23
<212> TYPE: DNA
<213> ORGANISM: Homo sapiens

<400> SEQUENCE: 362 gcagaggcgg gcggatcaca agg 23

<210> SEQ ID NO 363
<211> LENGTH: 23
<212> TYPE: DNA
<213> ORGANISM: Homo sapiens

<400> SEQUENCE: 363 gagccgaggc ccagcacttt ggg 23

<210> SEQ ID NO 364
<211> LENGTH: 23
<212> TYPE: DNA
<213> ORGANISM: Homo sapiens

<400> SEQUENCE: 364 cgagatcatc ctggctaatg tgg 23

<210> SEQ ID NO 365
<211> LENGTH: 23
<212> TYPE: DNA
<213> ORGANISM: Homo sapiens

<400> SEQUENCE: 365 ttttgaaaag aactcgctgt tgg 23

<210> SEQ ID NO 366
<211> LENGTH: 23
<212> TYPE: DNA
<213> ORGANISM: Homo sapiens

<400> SEQUENCE: 366 ggtctgcgtt cagacttctt cgg 23

<210> SEQ ID NO 367
<211> LENGTH: 23
<212> TYPE: DNA
<213> ORGANISM: Homo sapiens

<400> SEQUENCE: 367 gcctgggcaa ccaagagttc agg 23

<210> SEQ ID NO 368
<211> LENGTH: 23
<212> TYPE: DNA
<213> ORGANISM: Homo sapiens

<400> SEQUENCE: 368 ctagtccctc aacctcctac agg 23

<210> SEQ ID NO 369
<211> LENGTH: 23
<212> TYPE: DNA
<213> ORGANISM: Homo sapiens

<400> SEQUENCE: 369 cacagggtct ttaattaatc tgg 23

<210> SEQ ID NO 370
<211> LENGTH: 23
<212> TYPE: DNA
<213> ORGANISM: Homo sapiens

<400> SEQUENCE: 370 caaaaattat ccgggcattg tgg 23

<210> SEQ ID NO 371
<211> LENGTH: 23
<212> TYPE: DNA
<213> ORGANISM: Homo sapiens

<400> SEQUENCE: 371 agtctgaacg cagacccctc tgg 23

<210> SEQ ID NO 372
<211> LENGTH: 23
<212> TYPE: DNA
<213> ORGANISM: Homo sapiens

<400> SEQUENCE: 372 agaccaacct gctcaacata ggg 23

<210> SEQ ID NO 373
<211> LENGTH: 23
<212> TYPE: DNA
<213> ORGANISM: Homo sapiens

<400> SEQUENCE: 373 aattacttga accctagagt cgg 23

<210> SEQ ID NO 374
<211> LENGTH: 23
<212> TYPE: DNA
<213> ORGANISM: Homo sapiens

<400> SEQUENCE: 374 ctccatggtg gcatgcactt tgg 23

<210> SEQ ID NO 375
<211> LENGTH: 23
<212> TYPE: DNA
<213> ORGANISM: Homo sapiens

<400> SEQUENCE: 375 agaacacaga ttcccgaaag agg 23

<210> SEQ ID NO 376
<211> LENGTH: 23
<212> TYPE: DNA
<213> ORGANISM: Homo sapiens

<400> SEQUENCE: 376 aaaaataagg gtcgggtgag ggg 23

<210> SEQ ID NO 377
<211> LENGTH: 23
<212> TYPE: DNA
<213> ORGANISM: Homo sapiens

<400> SEQUENCE: 377 tcccagattc ttatatggga ggg 23

<210> SEQ ID NO 378
<211> LENGTH: 23
<212> TYPE: DNA
<213> ORGANISM: Homo sapiens

<400> SEQUENCE: 378 tccatggtgg catgcacttt ggg 23

<210> SEQ ID NO 379
<211> LENGTH: 23
<212> TYPE: DNA
<213> ORGANISM: Homo sapiens

<400> SEQUENCE: 379 ctgaataaac ggggctgcct ggg 23

<210> SEQ ID NO 380
<211> LENGTH: 23
<212> TYPE: DNA
<213> ORGANISM: Homo sapiens

<400> SEQUENCE: 380 cagaccagcc tgaccaacat ggg 23

<210> SEQ ID NO 381
<211> LENGTH: 23
<212> TYPE: DNA
<213> ORGANISM: Homo sapiens

<400> SEQUENCE: 381 ataaaaataa gggtcgggtg agg 23

<210> SEQ ID NO 382
<211> LENGTH: 23
<212> TYPE: DNA
<213> ORGANISM: Homo sapiens

<400> SEQUENCE: 382 aggactccca gattcttata tgg 23

<210> SEQ ID NO 383
<211> LENGTH: 23
<212> TYPE: DNA
<213> ORGANISM: Homo sapiens

<400> SEQUENCE: 383 acgatcattg ttccctggaa agg 23

<210> SEQ ID NO 384
<211> LENGTH: 23
<212> TYPE: DNA
<213> ORGANISM: Homo sapiens

<400> SEQUENCE: 384 gttctcttgc tttaggaccc agg 23

<210> SEQ ID NO 385
<211> LENGTH: 23
<212> TYPE: DNA

<213> ORGANISM: Homo sapiens

<400> SEQUENCE: 385 ctgcccctct gatttgcacc tgg 23

<210> SEQ ID NO 386
<211> LENGTH: 23
<212> TYPE: DNA
<213> ORGANISM: Homo sapiens

<400> SEQUENCE: 386 attagagttc tggctgggcg tgg 23

<210> SEQ ID NO 387
<211> LENGTH: 23
<212> TYPE: DNA
<213> ORGANISM: Homo sapiens

<400> SEQUENCE: 387 aagaccaacc tgctcaacat agg 23

<210> SEQ ID NO 388
<211> LENGTH: 23
<212> TYPE: DNA
<213> ORGANISM: Homo sapiens

<400> SEQUENCE: 388 tcttcagtac tcacctataa tgg 23

<210> SEQ ID NO 389
<211> LENGTH: 23
<212> TYPE: DNA
<213> ORGANISM: Homo sapiens

<400> SEQUENCE: 389 tcctgggtta ccaatgagat ggg 23

<210> SEQ ID NO 390
<211> LENGTH: 23
<212> TYPE: DNA
<213> ORGANISM: Homo sapiens

<400> SEQUENCE: 390 tagtccctca acctcctaca ggg 23

<210> SEQ ID NO 391
<211> LENGTH: 23
<212> TYPE: DNA
<213> ORGANISM: Homo sapiens

<400> SEQUENCE: 391 cttaagccct gtactgtgcc agg 23

<210> SEQ ID NO 392
<211> LENGTH: 23
<212> TYPE: DNA
<213> ORGANISM: Homo sapiens

<400> SEQUENCE: 392 cctgggttac caatgagatg ggg 23

<210> SEQ ID NO 393
<211> LENGTH: 23

<212> TYPE: DNA
<213> ORGANISM: Homo sapiens

<400> SEQUENCE: 393 aaaggggcag taattgtcca agg 23

<210> SEQ ID NO 394
<211> LENGTH: 23
<212> TYPE: DNA
<213> ORGANISM: Homo sapiens

<400> SEQUENCE: 394 tgtttgagcc caagagattg agg 23

<210> SEQ ID NO 395
<211> LENGTH: 23
<212> TYPE: DNA
<213> ORGANISM: Homo sapiens

<400> SEQUENCE: 395 tggggtggct actcaccaga cgg 23

<210> SEQ ID NO 396
<211> LENGTH: 23
<212> TYPE: DNA
<213> ORGANISM: Homo sapiens

<400> SEQUENCE: 396 tgaatacgat ggtgaaactg agg 23

<210> SEQ ID NO 397
<211> LENGTH: 23
<212> TYPE: DNA
<213> ORGANISM: Homo sapiens

<400> SEQUENCE: 397 tctcattgtg tcacccgggc tgg 23

<210> SEQ ID NO 398
<211> LENGTH: 23
<212> TYPE: DNA
<213> ORGANISM: Homo sapiens

<400> SEQUENCE: 398 gcttgtagtt ccagctgttt ggg 23

<210> SEQ ID NO 399
<211> LENGTH: 23
<212> TYPE: DNA
<213> ORGANISM: Homo sapiens

<400> SEQUENCE: 399 atacaaagat tagcctggtg tgg 23

<210> SEQ ID NO 400
<211> LENGTH: 23
<212> TYPE: DNA
<213> ORGANISM: Homo sapiens

<400> SEQUENCE: 400 agcttgtagt tccagctgtt tgg 23

<210> SEQ ID NO 401

<211> LENGTH: 23
<212> TYPE: DNA
<213> ORGANISM: Homo sapiens

<400> SEQUENCE: 401 acaggtatct ctggttcttg agg 23

<210> SEQ ID NO 402
<211> LENGTH: 23
<212> TYPE: DNA
<213> ORGANISM: Homo sapiens

<400> SEQUENCE: 402 tcccaaagtg catgccacca tgg 23

<210> SEQ ID NO 403
<211> LENGTH: 23
<212> TYPE: DNA
<213> ORGANISM: Homo sapiens

<400> SEQUENCE: 403 caggctactc ttgaactctt ggg 23

<210> SEQ ID NO 404
<211> LENGTH: 23
<212> TYPE: DNA
<213> ORGANISM: Homo sapiens

<400> SEQUENCE: 404 aatcaagcct tgttaaaacc agg 23

<210> SEQ ID NO 405
<211> LENGTH: 23
<212> TYPE: DNA
<213> ORGANISM: Homo sapiens

<400> SEQUENCE: 405 tgctttagga cccaggggtc tgg 23

<210> SEQ ID NO 406
<211> LENGTH: 23
<212> TYPE: DNA
<213> ORGANISM: Homo sapiens

<400> SEQUENCE: 406 tcacccgggc tggagtacgg tgg 23

<210> SEQ ID NO 407
<211> LENGTH: 23
<212> TYPE: DNA
<213> ORGANISM: Homo sapiens

<400> SEQUENCE: 407 gggcttaaga aataggatct tgg 23

<210> SEQ ID NO 408
<211> LENGTH: 23
<212> TYPE: DNA
<213> ORGANISM: Homo sapiens

<400> SEQUENCE: 408 agcttgtaaa cttagcactt tgg 23

<210> SEQ ID NO 409
<211> LENGTH: 23
<212> TYPE: DNA
<213> ORGANISM: Homo sapiens

<400> SEQUENCE: 409 agagccaccg tactccagcc cgg 23

<210> SEQ ID NO 410
<211> LENGTH: 23
<212> TYPE: DNA
<213> ORGANISM: Homo sapiens

<400> SEQUENCE: 410 aaatttctgc ctactgagac agg 23

<210> SEQ ID NO 411
<211> LENGTH: 23
<212> TYPE: DNA
<213> ORGANISM: Homo sapiens

<400> SEQUENCE: 411 ttcctgggtt accaatgaga tgg 23

<210> SEQ ID NO 412
<211> LENGTH: 23
<212> TYPE: DNA
<213> ORGANISM: Homo sapiens

<400> SEQUENCE: 412 tgaaactgag gtcctagctt agg 23

<210> SEQ ID NO 413
<211> LENGTH: 23
<212> TYPE: DNA
<213> ORGANISM: Homo sapiens

<400> SEQUENCE: 413 tcacatataa atgaatacga tgg 23

<210> SEQ ID NO 414
<211> LENGTH: 23
<212> TYPE: DNA
<213> ORGANISM: Homo sapiens

<400> SEQUENCE: 414 gatttgatga gatctcacag cgg 23

<210> SEQ ID NO 415
<211> LENGTH: 23
<212> TYPE: DNA
<213> ORGANISM: Homo sapiens

<400> SEQUENCE: 415 gaggtgggga caggtatctc tgg 23

<210> SEQ ID NO 416
<211> LENGTH: 23
<212> TYPE: DNA
<213> ORGANISM: Homo sapiens

<400> SEQUENCE: 416 cctggaaagg tggagttcaa ggg 23

<210> SEQ ID NO 417
<211> LENGTH: 23
<212> TYPE: DNA
<213> ORGANISM: Homo sapiens

<400> SEQUENCE: 417 ccatgttggt caggctggtc tgg 23

<210> SEQ ID NO 418
<211> LENGTH: 23
<212> TYPE: DNA
<213> ORGANISM: Homo sapiens

<400> SEQUENCE: 418 atggtggcat gcactttggg agg 23

<210> SEQ ID NO 419
<211> LENGTH: 23
<212> TYPE: DNA
<213> ORGANISM: Homo sapiens

<400> SEQUENCE: 419 agttgccaaa acttgctatt tgg 23

<210> SEQ ID NO 420
<211> LENGTH: 23
<212> TYPE: DNA
<213> ORGANISM: Homo sapiens

<400> SEQUENCE: 420 agttcaaggg cctgaactct tgg 23

<210> SEQ ID NO 421
<211> LENGTH: 23
<212> TYPE: DNA
<213> ORGANISM: Homo sapiens

<400> SEQUENCE: 421 agcaagctgt gacttgttct agg 23

<210> SEQ ID NO 422
<211> LENGTH: 23
<212> TYPE: DNA
<213> ORGANISM: Homo sapiens

<400> SEQUENCE: 422 tgtggccagc cccatctcat tgg 23

<210> SEQ ID NO 423
<211> LENGTH: 23
<212> TYPE: DNA
<213> ORGANISM: Homo sapiens

<400> SEQUENCE: 423 ggcttaagaa ataggatctt ggg 23

<210> SEQ ID NO 424
<211> LENGTH: 23
<212> TYPE: DNA
<213> ORGANISM: Homo sapiens

<400> SEQUENCE: 424 ccagtttctc tctgtcgccc agg 23

<210> SEQ ID NO 425
<211> LENGTH: 23
<212> TYPE: DNA
<213> ORGANISM: Homo sapiens

<400> SEQUENCE: 425 ccagattctt atatgggagg ggg 23

<210> SEQ ID NO 426
<211> LENGTH: 23
<212> TYPE: DNA
<213> ORGANISM: Homo sapiens

<400> SEQUENCE: 426 atcacacaaa ttaagagtac agg 23

<210> SEQ ID NO 427
<211> LENGTH: 23
<212> TYPE: DNA
<213> ORGANISM: Homo sapiens

<400> SEQUENCE: 427 actgaataaa cggggctgcc tgg 23

<210> SEQ ID NO 428
<211> LENGTH: 23
<212> TYPE: DNA
<213> ORGANISM: Homo sapiens

<400> SEQUENCE: 428 taagaaatag gatcttgggc tgg 23

<210> SEQ ID NO 429
<211> LENGTH: 23
<212> TYPE: DNA
<213> ORGANISM: Homo sapiens

<400> SEQUENCE: 429 ggttaccaat gagatggggc tgg 23

<210> SEQ ID NO 430
<211> LENGTH: 23
<212> TYPE: DNA
<213> ORGANISM: Homo sapiens

<400> SEQUENCE: 430 gcgcagcggc tcatgcctgt ggg 23

<210> SEQ ID NO 431
<211> LENGTH: 23
<212> TYPE: DNA
<213> ORGANISM: Homo sapiens

<400> SEQUENCE: 431 gaacgcagac ccctctggcc tgg 23

<210> SEQ ID NO 432
<211> LENGTH: 23
<212> TYPE: DNA
<213> ORGANISM: Homo sapiens

<400> SEQUENCE: 432 ctgaggcaga ggcctaagct agg 23

<210> SEQ ID NO 433
<211> LENGTH: 23
<212> TYPE: DNA
<213> ORGANISM: Homo sapiens

<400> SEQUENCE: 433 cagtacaggg cttaagaaat agg 23

<210> SEQ ID NO 434
<211> LENGTH: 23
<212> TYPE: DNA
<213> ORGANISM: Homo sapiens

<400> SEQUENCE: 434 cactgcagcc tcaatctctt ggg 23

<210> SEQ ID NO 435
<211> LENGTH: 23
<212> TYPE: DNA
<213> ORGANISM: Homo sapiens

<400> SEQUENCE: 435 caagagttca agagtagcct ggg 23

<210> SEQ ID NO 436
<211> LENGTH: 23
<212> TYPE: DNA
<213> ORGANISM: Homo sapiens

<400> SEQUENCE: 436 aaaataaggg tcgggtgagg ggg 23

<210> SEQ ID NO 437
<211> LENGTH: 23
<212> TYPE: DNA
<213> ORGANISM: Homo sapiens

<400> SEQUENCE: 437 tacaggaagg ctgttgggtc cgg 23

<210> SEQ ID NO 438
<211> LENGTH: 23
<212> TYPE: DNA
<213> ORGANISM: Homo sapiens

<400> SEQUENCE: 438 gtatctctgg ttcttgaggc agg 23

<210> SEQ ID NO 439
<211> LENGTH: 23
<212> TYPE: DNA
<213> ORGANISM: Homo sapiens

<400> SEQUENCE: 439 cccagctact acggaggctg agg 23

<210> SEQ ID NO 440
<211> LENGTH: 23
<212> TYPE: DNA
<213> ORGANISM: Homo sapiens

<400> SEQUENCE: 440 caagtgcccg ccaccacacc agg 23

<210> SEQ ID NO 441
<211> LENGTH: 23
<212> TYPE: DNA
<213> ORGANISM: Homo sapiens

<400> SEQUENCE: 441 acagaaaaat tagccaggcg tgg 23

<210> SEQ ID NO 442
<211> LENGTH: 23
<212> TYPE: DNA
<213> ORGANISM: Homo sapiens

<400> SEQUENCE: 442 ggtcttgaac tcctgtcctc agg 23

<210> SEQ ID NO 443
<211> LENGTH: 23
<212> TYPE: DNA
<213> ORGANISM: Homo sapiens

<400> SEQUENCE: 443 gcaaccacct cctgggttca agg 23

<210> SEQ ID NO 444
<211> LENGTH: 23
<212> TYPE: DNA
<213> ORGANISM: Homo sapiens

<400> SEQUENCE: 444 gattagcctg gtgtggtggc ggg 23

<210> SEQ ID NO 445
<211> LENGTH: 23
<212> TYPE: DNA
<213> ORGANISM: Homo sapiens

<400> SEQUENCE: 445 ccaagagttc aagagtagcc tgg 23

<210> SEQ ID NO 446
<211> LENGTH: 23
<212> TYPE: DNA
<213> ORGANISM: Homo sapiens

<400> SEQUENCE: 446 caaggtgggt gcatcacctg agg 23

<210> SEQ ID NO 447
<211> LENGTH: 23
<212> TYPE: DNA
<213> ORGANISM: Homo sapiens

<400> SEQUENCE: 447 ataggtgagt actgaagacc agg 23

<210> SEQ ID NO 448
<211> LENGTH: 23
<212> TYPE: DNA
<213> ORGANISM: Homo sapiens

<400> SEQUENCE: 448 agacaccctg caggggacc agg 23

<210> SEQ ID NO 449
<211> LENGTH: 23
<212> TYPE: DNA
<213> ORGANISM: Homo sapiens

<400> SEQUENCE: 449 acagagtgag aactccatgg tgg 23

<210> SEQ ID NO 450
<211> LENGTH: 23
<212> TYPE: DNA
<213> ORGANISM: Homo sapiens

<400> SEQUENCE: 450 taaaaccagg tgcaaatcag agg 23

<210> SEQ ID NO 451
<211> LENGTH: 23
<212> TYPE: DNA
<213> ORGANISM: Homo sapiens

<400> SEQUENCE: 451 ggtcttgaac tcctgacctc agg 23

<210> SEQ ID NO 452
<211> LENGTH: 23
<212> TYPE: DNA
<213> ORGANISM: Homo sapiens

<400> SEQUENCE: 452 gcttgtaaac ttagcacttt ggg 23

<210> SEQ ID NO 453
<211> LENGTH: 23
<212> TYPE: DNA
<213> ORGANISM: Homo sapiens

<400> SEQUENCE: 453 gagatggggc tggccacaaa ggg 23

<210> SEQ ID NO 454
<211> LENGTH: 23
<212> TYPE: DNA
<213> ORGANISM: Homo sapiens

<400> SEQUENCE: 454 ctggaggatt gtctgagccc agg 23

<210> SEQ ID NO 455
<211> LENGTH: 23
<212> TYPE: DNA
<213> ORGANISM: Homo sapiens

<400> SEQUENCE: 455 cccccttttc ccagggaatc agg 23

<210> SEQ ID NO 456
<211> LENGTH: 23
<212> TYPE: DNA
<213> ORGANISM: Homo sapiens

<400> SEQUENCE: 456 caggcacatg ccactacacc agg 23

<210> SEQ ID NO 457
<211> LENGTH: 23
<212> TYPE: DNA
<213> ORGANISM: Homo sapiens

<400> SEQUENCE: 457 aaaaaattag cctggtgtag tgg 23

<210> SEQ ID NO 458
<211> LENGTH: 23
<212> TYPE: DNA
<213> ORGANISM: Homo sapiens

<400> SEQUENCE: 458 ttctcttgct ttaggaccca ggg 23

<210> SEQ ID NO 459
<211> LENGTH: 23
<212> TYPE: DNA
<213> ORGANISM: Homo sapiens

<400> SEQUENCE: 459 tgagatgggg ctggccacaa agg 23

<210> SEQ ID NO 460
<211> LENGTH: 23
<212> TYPE: DNA
<213> ORGANISM: Homo sapiens

<400> SEQUENCE: 460 tctcttgctt taggacccag ggg 23

<210> SEQ ID NO 461
<211> LENGTH: 23
<212> TYPE: DNA
<213> ORGANISM: Homo sapiens

<400> SEQUENCE: 461 tcactgcagc tttgaattcc tgg 23

<210> SEQ ID NO 462
<211> LENGTH: 23
<212> TYPE: DNA
<213> ORGANISM: Homo sapiens

<400> SEQUENCE: 462 tactcagcat cccaaacagc tgg 23

<210> SEQ ID NO 463
<211> LENGTH: 23
<212> TYPE: DNA
<213> ORGANISM: Homo sapiens

<400> SEQUENCE: 463 ggctcactgc aaccacctcc tgg 23

<210> SEQ ID NO 464
<211> LENGTH: 23
<212> TYPE: DNA

<213> ORGANISM: Homo sapiens

<400> SEQUENCE: 464 ggcagcaggt ttgggattct agg 23

<210> SEQ ID NO 465
<211> LENGTH: 23
<212> TYPE: DNA
<213> ORGANISM: Homo sapiens

<400> SEQUENCE: 465 gctcatgcct gtgggagccg agg 23

<210> SEQ ID NO 466
<211> LENGTH: 23
<212> TYPE: DNA
<213> ORGANISM: Homo sapiens

<400> SEQUENCE: 466 ccttgaactc cacctttcca ggg 23

<210> SEQ ID NO 467
<211> LENGTH: 23
<212> TYPE: DNA
<213> ORGANISM: Homo sapiens

<400> SEQUENCE: 467 ccgaggccca gcactttggg agg 23

<210> SEQ ID NO 468
<211> LENGTH: 23
<212> TYPE: DNA
<213> ORGANISM: Homo sapiens

<400> SEQUENCE: 468 cacaaattaa gagtacagga agg 23

<210> SEQ ID NO 469
<211> LENGTH: 23
<212> TYPE: DNA
<213> ORGANISM: Homo sapiens

<400> SEQUENCE: 469 agcggcccat tttacagaga agg 23

<210> SEQ ID NO 470
<211> LENGTH: 23
<212> TYPE: DNA
<213> ORGANISM: Homo sapiens

<400> SEQUENCE: 470 agaggccctg taggaggttg agg 23

<210> SEQ ID NO 471
<211> LENGTH: 23
<212> TYPE: DNA
<213> ORGANISM: Homo sapiens

<400> SEQUENCE: 471 aaggatatct gggatgggat tgg 23

<210> SEQ ID NO 472
<211> LENGTH: 23

<212> TYPE: DNA
<213> ORGANISM: Homo sapiens

<400> SEQUENCE: 472 tggggtctca ttgtgtcacc cgg 23

<210> SEQ ID NO 473
<211> LENGTH: 23
<212> TYPE: DNA
<213> ORGANISM: Homo sapiens

<400> SEQUENCE: 473 ggagccgagg cccagcactt tgg 23

<210> SEQ ID NO 474
<211> LENGTH: 23
<212> TYPE: DNA
<213> ORGANISM: Homo sapiens

<400> SEQUENCE: 474 ctctccctga ttttacaaac agg 23

<210> SEQ ID NO 475
<211> LENGTH: 23
<212> TYPE: DNA
<213> ORGANISM: Homo sapiens

<400> SEQUENCE: 475 cacagattcc cgaaagagga agg 23

<210> SEQ ID NO 476
<211> LENGTH: 23
<212> TYPE: DNA
<213> ORGANISM: Homo sapiens

<400> SEQUENCE: 476 caaagattag cctggtgtgg tgg 23

<210> SEQ ID NO 477
<211> LENGTH: 23
<212> TYPE: DNA
<213> ORGANISM: Homo sapiens

<400> SEQUENCE: 477 aagagtacag gaaggctgtt ggg 23

<210> SEQ ID NO 478
<211> LENGTH: 23
<212> TYPE: DNA
<213> ORGANISM: Homo sapiens

<400> SEQUENCE: 478 tttaaaatta gagttctggc tgg 23

<210> SEQ ID NO 479
<211> LENGTH: 23
<212> TYPE: DNA
<213> ORGANISM: Homo sapiens

<400> SEQUENCE: 479 tgggtgcatc acctgaggtc agg 23

<210> SEQ ID NO 480

<211> LENGTH: 23
<212> TYPE: DNA
<213> ORGANISM: Homo sapiens

<400> SEQUENCE: 480 gttcaaataa agaacagggc tgg 23

<210> SEQ ID NO 481
<211> LENGTH: 23
<212> TYPE: DNA
<213> ORGANISM: Homo sapiens

<400> SEQUENCE: 481 gcctgtggtc ccaggtactc agg 23

<210> SEQ ID NO 482
<211> LENGTH: 23
<212> TYPE: DNA
<213> ORGANISM: Homo sapiens

<400> SEQUENCE: 482 gaaactgtgt ttacaaactg tgg 23

<210> SEQ ID NO 483
<211> LENGTH: 23
<212> TYPE: DNA
<213> ORGANISM: Homo sapiens

<400> SEQUENCE: 483 aggatatctg ggatgggatt ggg 23

<210> SEQ ID NO 484
<211> LENGTH: 23
<212> TYPE: DNA
<213> ORGANISM: Homo sapiens

<400> SEQUENCE: 484 agctgggggg actgaataaa cgg 23

<210> SEQ ID NO 485
<211> LENGTH: 23
<212> TYPE: DNA
<213> ORGANISM: Homo sapiens

<400> SEQUENCE: 485 ttaaaattag agttctggct ggg 23

<210> SEQ ID NO 486
<211> LENGTH: 23
<212> TYPE: DNA
<213> ORGANISM: Homo sapiens

<400> SEQUENCE: 486 tgtctcagta ggcagaaatt tgg 23

<210> SEQ ID NO 487
<211> LENGTH: 23
<212> TYPE: DNA
<213> ORGANISM: Homo sapiens

<400> SEQUENCE: 487 tgacacagag gccctgtagg agg 23

<210> SEQ ID NO 488
<211> LENGTH: 23
<212> TYPE: DNA
<213> ORGANISM: Homo sapiens

<400> SEQUENCE: 488 gcaacagagt gagaactcca tgg 23

<210> SEQ ID NO 489
<211> LENGTH: 23
<212> TYPE: DNA
<213> ORGANISM: Homo sapiens

<400> SEQUENCE: 489 gagctgggaa ctcagattcc tgg 23

<210> SEQ ID NO 490
<211> LENGTH: 23
<212> TYPE: DNA
<213> ORGANISM: Homo sapiens

<400> SEQUENCE: 490 cccttgaact ccacctttcc agg 23

<210> SEQ ID NO 491
<211> LENGTH: 23
<212> TYPE: DNA
<213> ORGANISM: Homo sapiens

<400> SEQUENCE: 491 catgtgcaaa accctgagcc tgg 23

<210> SEQ ID NO 492
<211> LENGTH: 23
<212> TYPE: DNA
<213> ORGANISM: Homo sapiens

<400> SEQUENCE: 492 cactgcagct ttgaattcct ggg 23

<210> SEQ ID NO 493
<211> LENGTH: 23
<212> TYPE: DNA
<213> ORGANISM: Homo sapiens

<400> SEQUENCE: 493 atttgcacct ggttttaaca agg 23

<210> SEQ ID NO 494
<211> LENGTH: 23
<212> TYPE: DNA
<213> ORGANISM: Homo sapiens

<400> SEQUENCE: 494 agctgtttgg gatgctgagt agg 23

<210> SEQ ID NO 495
<211> LENGTH: 23
<212> TYPE: DNA
<213> ORGANISM: Homo sapiens

<400> SEQUENCE: 495 tggtccccct gcagggtgtc tgg 23

<210> SEQ ID NO 496
<211> LENGTH: 23
<212> TYPE: DNA
<213> ORGANISM: Homo sapiens

<400> SEQUENCE: 496 tcttggttgc ccaggccaga ggg 23

<210> SEQ ID NO 497
<211> LENGTH: 23
<212> TYPE: DNA
<213> ORGANISM: Homo sapiens

<400> SEQUENCE: 497 ggtccccctg cagggtgtct ggg 23

<210> SEQ ID NO 498
<211> LENGTH: 23
<212> TYPE: DNA
<213> ORGANISM: Homo sapiens

<400> SEQUENCE: 498 gggattttac catgttggtc agg 23

<210> SEQ ID NO 499
<211> LENGTH: 23
<212> TYPE: DNA
<213> ORGANISM: Homo sapiens

<400> SEQUENCE: 499 gaggccctgt aggaggttga ggg 23

<210> SEQ ID NO 500
<211> LENGTH: 23
<212> TYPE: DNA
<213> ORGANISM: Homo sapiens

<400> SEQUENCE: 500 cctgggcgac agagagaaac tgg 23

<210> SEQ ID NO 501
<211> LENGTH: 23
<212> TYPE: DNA
<213> ORGANISM: Homo sapiens

<400> SEQUENCE: 501 ccctggaaag gtggagttca agg 23

<210> SEQ ID NO 502
<211> LENGTH: 23
<212> TYPE: DNA
<213> ORGANISM: Homo sapiens

<400> SEQUENCE: 502 ccctgagcct ggcacagtac agg 23

<210> SEQ ID NO 503
<211> LENGTH: 23
<212> TYPE: DNA
<213> ORGANISM: Homo sapiens

<400> SEQUENCE: 503 agaatcccaa acctgctgcc tgg 23

<210> SEQ ID NO 504
<211> LENGTH: 23
<212> TYPE: DNA
<213> ORGANISM: Homo sapiens

<400> SEQUENCE: 504 aacgcagacc cctctggcct ggg 23

<210> SEQ ID NO 505
<211> LENGTH: 23
<212> TYPE: DNA
<213> ORGANISM: Homo sapiens

<400> SEQUENCE: 505 tttctgccta ctgagacagg agg 23

<210> SEQ ID NO 506
<211> LENGTH: 23
<212> TYPE: DNA
<213> ORGANISM: Homo sapiens

<400> SEQUENCE: 506 tctaggttca aataaagaac agg 23

<210> SEQ ID NO 507
<211> LENGTH: 23
<212> TYPE: DNA
<213> ORGANISM: Homo sapiens

<400> SEQUENCE: 507 taagagtaca ggaaggctgt tgg 23

<210> SEQ ID NO 508
<211> LENGTH: 23
<212> TYPE: DNA
<213> ORGANISM: Homo sapiens

<400> SEQUENCE: 508 gtgacttgtt ctaggtcata tgg 23

<210> SEQ ID NO 509
<211> LENGTH: 23
<212> TYPE: DNA
<213> ORGANISM: Homo sapiens

<400> SEQUENCE: 509 gggaggaaaa taaggatatc tgg 23

<210> SEQ ID NO 510
<211> LENGTH: 23
<212> TYPE: DNA
<213> ORGANISM: Homo sapiens

<400> SEQUENCE: 510 gctttaggac ccaggggtct ggg 23

<210> SEQ ID NO 511
<211> LENGTH: 23
<212> TYPE: DNA
<213> ORGANISM: Homo sapiens

<400> SEQUENCE: 511 agctgggaac tcagattcct ggg 23

<210> SEQ ID NO 512
<211> LENGTH: 23
<212> TYPE: DNA
<213> ORGANISM: Homo sapiens

<400> SEQUENCE: 512 aagaaatagg atcttgggct ggg 23

<210> SEQ ID NO 513
<211> LENGTH: 23
<212> TYPE: DNA
<213> ORGANISM: Homo sapiens

<400> SEQUENCE: 513 ttgggaaatg gtatgaggta ggg 23

<210> SEQ ID NO 514
<211> LENGTH: 23
<212> TYPE: DNA
<213> ORGANISM: Homo sapiens

<400> SEQUENCE: 514 tgtaaactta gcactttggg agg 23

<210> SEQ ID NO 515
<211> LENGTH: 23
<212> TYPE: DNA
<213> ORGANISM: Homo sapiens

<400> SEQUENCE: 515 ggtgtagtgg catgtgcctg tgg 23

<210> SEQ ID NO 516
<211> LENGTH: 23
<212> TYPE: DNA
<213> ORGANISM: Homo sapiens

<400> SEQUENCE: 516 caggtgcaaa tcagaggggc agg 23

<210> SEQ ID NO 517
<211> LENGTH: 23
<212> TYPE: DNA
<213> ORGANISM: Homo sapiens

<400> SEQUENCE: 517 actcacagag ggtcagcagc tgg 23

<210> SEQ ID NO 518
<211> LENGTH: 23
<212> TYPE: DNA
<213> ORGANISM: Homo sapiens

<400> SEQUENCE: 518 aagaaagggg tgactcacag agg 23

<210> SEQ ID NO 519
<211> LENGTH: 23
<212> TYPE: DNA
<213> ORGANISM: Homo sapiens

<400> SEQUENCE: 519 ttcccagctc ctatctcctc tgg 23

<210> SEQ ID NO 520
<211> LENGTH: 23
<212> TYPE: DNA
<213> ORGANISM: Homo sapiens

<400> SEQUENCE: 520 tggagaccca gacaccctgc agg 23

<210> SEQ ID NO 521
<211> LENGTH: 23
<212> TYPE: DNA
<213> ORGANISM: Homo sapiens

<400> SEQUENCE: 521 gagccaccgt actccagccc ggg 23

<210> SEQ ID NO 522
<211> LENGTH: 23
<212> TYPE: DNA
<213> ORGANISM: Homo sapiens

<400> SEQUENCE: 522 cctgggtcct cgggcctcct ggg 23

<210> SEQ ID NO 523
<211> LENGTH: 23
<212> TYPE: DNA
<213> ORGANISM: Homo sapiens

<400> SEQUENCE: 523 agattagcct ggtgtggtgg cgg 23

<210> SEQ ID NO 524
<211> LENGTH: 23
<212> TYPE: DNA
<213> ORGANISM: Homo sapiens

<400> SEQUENCE: 524 agagttctgg ctgggcgtgg tgg 23

<210> SEQ ID NO 525
<211> LENGTH: 23
<212> TYPE: DNA
<213> ORGANISM: Homo sapiens

<400> SEQUENCE: 525 tgtttgtaat cccaacactt tgg 23

<210> SEQ ID NO 526
<211> LENGTH: 23
<212> TYPE: DNA
<213> ORGANISM: Homo sapiens

<400> SEQUENCE: 526 tgctgggcct cggctcccac agg 23

<210> SEQ ID NO 527
<211> LENGTH: 23
<212> TYPE: DNA
<213> ORGANISM: Homo sapiens

<400> SEQUENCE: 527 tcctgagtac ctgggaccac agg 23

<210> SEQ ID NO 528
<211> LENGTH: 23
<212> TYPE: DNA
<213> ORGANISM: Homo sapiens

<400> SEQUENCE: 528 gttcttttca aaacccttttg tgg 23

<210> SEQ ID NO 529
<211> LENGTH: 23
<212> TYPE: DNA
<213> ORGANISM: Homo sapiens

<400> SEQUENCE: 529 gggaaggagg aaaatcacct tgg 23

<210> SEQ ID NO 530
<211> LENGTH: 23
<212> TYPE: DNA
<213> ORGANISM: Homo sapiens

<400> SEQUENCE: 530 gctcactgca accacctcct ggg 23

<210> SEQ ID NO 531
<211> LENGTH: 23
<212> TYPE: DNA
<213> ORGANISM: Homo sapiens

<400> SEQUENCE: 531 gctactacgg aggctgaggc agg 23

<210> SEQ ID NO 532
<211> LENGTH: 23
<212> TYPE: DNA
<213> ORGANISM: Homo sapiens

<400> SEQUENCE: 532 cttggttgcc caggccagag ggg 23

<210> SEQ ID NO 533
<211> LENGTH: 23
<212> TYPE: DNA
<213> ORGANISM: Homo sapiens

<400> SEQUENCE: 533 ctgaagacca ggaacttctg agg 23

<210> SEQ ID NO 534
<211> LENGTH: 23
<212> TYPE: DNA
<213> ORGANISM: Homo sapiens

<400> SEQUENCE: 534 cgggtggatc acctgaggac agg 23

<210> SEQ ID NO 535
<211> LENGTH: 23
<212> TYPE: DNA
<213> ORGANISM: Homo sapiens

<400> SEQUENCE: 535 tttgggaaat ggtatgaggt agg 23

<210> SEQ ID NO 536
<211> LENGTH: 23
<212> TYPE: DNA
<213> ORGANISM: Homo sapiens

<400> SEQUENCE: 536 tcccagagga gataggagct ggg 23

<210> SEQ ID NO 537
<211> LENGTH: 23
<212> TYPE: DNA
<213> ORGANISM: Homo sapiens

<400> SEQUENCE: 537 gtgatgtctg tgtgacacag agg 23

<210> SEQ ID NO 538
<211> LENGTH: 23
<212> TYPE: DNA
<213> ORGANISM: Homo sapiens

<400> SEQUENCE: 538 ggaggaaaat aaggatatct ggg 23

<210> SEQ ID NO 539
<211> LENGTH: 23
<212> TYPE: DNA
<213> ORGANISM: Homo sapiens

<400> SEQUENCE: 539 cttttccaaa tagcaagttt tgg 23

<210> SEQ ID NO 540
<211> LENGTH: 23
<212> TYPE: DNA
<213> ORGANISM: Homo sapiens

<400> SEQUENCE: 540 attccctggg aaaagggggc tgg 23

<210> SEQ ID NO 541
<211> LENGTH: 23
<212> TYPE: DNA
<213> ORGANISM: Homo sapiens

<400> SEQUENCE: 541 agccaggact cctgattccc tgg 23

<210> SEQ ID NO 542
<211> LENGTH: 23
<212> TYPE: DNA
<213> ORGANISM: Homo sapiens

<400> SEQUENCE: 542 aaaataagga tatctgggat ggg 23

<210> SEQ ID NO 543
<211> LENGTH: 23
<212> TYPE: DNA

<213> ORGANISM: Homo sapiens

<400> SEQUENCE: 543 tcaaataaag aacagggctg ggg 23

<210> SEQ ID NO 544
<211> LENGTH: 23
<212> TYPE: DNA
<213> ORGANISM: Homo sapiens

<400> SEQUENCE: 544 gtgtgacaca gaggccctgt agg 23

<210> SEQ ID NO 545
<211> LENGTH: 23
<212> TYPE: DNA
<213> ORGANISM: Homo sapiens

<400> SEQUENCE: 545 ggtctggaac tcctgacctc agg 23

<210> SEQ ID NO 546
<211> LENGTH: 23
<212> TYPE: DNA
<213> ORGANISM: Homo sapiens

<400> SEQUENCE: 546 ctgctgcctg gtccccctgc agg 23

<210> SEQ ID NO 547
<211> LENGTH: 23
<212> TYPE: DNA
<213> ORGANISM: Homo sapiens

<400> SEQUENCE: 547 cgaggcgggt ggatcacctg agg 23

<210> SEQ ID NO 548
<211> LENGTH: 23
<212> TYPE: DNA
<213> ORGANISM: Homo sapiens

<400> SEQUENCE: 548 aaaccaggtg caaatcagag ggg 23

<210> SEQ ID NO 549
<211> LENGTH: 23
<212> TYPE: DNA
<213> ORGANISM: Homo sapiens

<400> SEQUENCE: 549 aaacacagtt tcaaaaggtc agg 23

<210> SEQ ID NO 550
<211> LENGTH: 23
<212> TYPE: DNA
<213> ORGANISM: Homo sapiens

<400> SEQUENCE: 550 tttcatcttc tggggctccc agg 23

<210> SEQ ID NO 551
<211> LENGTH: 23

<212> TYPE: DNA
<213> ORGANISM: Homo sapiens

<400> SEQUENCE: 551 ttcccagagg agataggagc tgg 23

<210> SEQ ID NO 552
<211> LENGTH: 23
<212> TYPE: DNA
<213> ORGANISM: Homo sapiens

<400> SEQUENCE: 552 tgggagcccc agaagatgaa agg 23

<210> SEQ ID NO 553
<211> LENGTH: 23
<212> TYPE: DNA
<213> ORGANISM: Homo sapiens

<400> SEQUENCE: 553 tcttttctca ttccccttag tgg 23

<210> SEQ ID NO 554
<211> LENGTH: 23
<212> TYPE: DNA
<213> ORGANISM: Homo sapiens

<400> SEQUENCE: 554 tatttgtctt ggggtaagga agg 23

<210> SEQ ID NO 555
<211> LENGTH: 23
<212> TYPE: DNA
<213> ORGANISM: Homo sapiens

<400> SEQUENCE: 555 gtttgtaatc ccaacacttt ggg 23

<210> SEQ ID NO 556
<211> LENGTH: 23
<212> TYPE: DNA
<213> ORGANISM: Homo sapiens

<400> SEQUENCE: 556 gcctgggtcc tcgggcctcc tgg 23

<210> SEQ ID NO 557
<211> LENGTH: 23
<212> TYPE: DNA
<213> ORGANISM: Homo sapiens

<400> SEQUENCE: 557 caggtgcgtc ccaccacacc cgg 23

<210> SEQ ID NO 558
<211> LENGTH: 23
<212> TYPE: DNA
<213> ORGANISM: Homo sapiens

<400> SEQUENCE: 558 atcattgttc cctggaaagg tgg 23

<210> SEQ ID NO 559

<211> LENGTH: 23
<212> TYPE: DNA
<213> ORGANISM: Homo sapiens

<400> SEQUENCE: 559 aatgaataaa aataagggtc ggg 23

<210> SEQ ID NO 560
<211> LENGTH: 23
<212> TYPE: DNA
<213> ORGANISM: Homo sapiens

<400> SEQUENCE: 560 aaaaccaggt gcaaatcaga ggg 23

<210> SEQ ID NO 561
<211> LENGTH: 23
<212> TYPE: DNA
<213> ORGANISM: Homo sapiens

<400> SEQUENCE: 561 tttaagtaat gagatgggag ggg 23

<210> SEQ ID NO 562
<211> LENGTH: 23
<212> TYPE: DNA
<213> ORGANISM: Homo sapiens

<400> SEQUENCE: 562 ttcaaataaa gaacagggct ggg 23

<210> SEQ ID NO 563
<211> LENGTH: 23
<212> TYPE: DNA
<213> ORGANISM: Homo sapiens

<400> SEQUENCE: 563 tgaggcagag ggatcacctg agg 23

<210> SEQ ID NO 564
<211> LENGTH: 23
<212> TYPE: DNA
<213> ORGANISM: Homo sapiens

<400> SEQUENCE: 564 tcactgcagc ctcaatctct tgg 23

<210> SEQ ID NO 565
<211> LENGTH: 23
<212> TYPE: DNA
<213> ORGANISM: Homo sapiens

<400> SEQUENCE: 565 gagacccaga caccctgcag ggg 23

<210> SEQ ID NO 566
<211> LENGTH: 23
<212> TYPE: DNA
<213> ORGANISM: Homo sapiens

<400> SEQUENCE: 566 gaaaataagg atatctggga tgg 23

<210> SEQ ID NO 567
<211> LENGTH: 23
<212> TYPE: DNA
<213> ORGANISM: Homo sapiens

<400> SEQUENCE: 567 ctgcctactg agacaggagg agg 23

<210> SEQ ID NO 568
<211> LENGTH: 23
<212> TYPE: DNA
<213> ORGANISM: Homo sapiens

<400> SEQUENCE: 568 cctgagcctg gcacagtaca ggg 23

<210> SEQ ID NO 569
<211> LENGTH: 23
<212> TYPE: DNA
<213> ORGANISM: Homo sapiens

<400> SEQUENCE: 569 caggagaatc acttgaacct ggg 23

<210> SEQ ID NO 570
<211> LENGTH: 23
<212> TYPE: DNA
<213> ORGANISM: Homo sapiens

<400> SEQUENCE: 570 acctcagcct cctgagtacc tgg 23

<210> SEQ ID NO 571
<211> LENGTH: 23
<212> TYPE: DNA
<213> ORGANISM: Homo sapiens

<400> SEQUENCE: 571 aatatatttg tcttggggta agg 23

<210> SEQ ID NO 572
<211> LENGTH: 23
<212> TYPE: DNA
<213> ORGANISM: Homo sapiens

<400> SEQUENCE: 572 tcttgaggca ggaagaggtc agg 23

<210> SEQ ID NO 573
<211> LENGTH: 23
<212> TYPE: DNA
<213> ORGANISM: Homo sapiens

<400> SEQUENCE: 573 tcccagggaa tcaggagtcc tgg 23

<210> SEQ ID NO 574
<211> LENGTH: 23
<212> TYPE: DNA
<213> ORGANISM: Homo sapiens

<400> SEQUENCE: 574 gtgtcacccg ggctggagta cgg 23

<210> SEQ ID NO 575
<211> LENGTH: 23
<212> TYPE: DNA
<213> ORGANISM: Homo sapiens

<400> SEQUENCE: 575 gggagcccca gaagatgaaa ggg 23

<210> SEQ ID NO 576
<211> LENGTH: 23
<212> TYPE: DNA
<213> ORGANISM: Homo sapiens

<400> SEQUENCE: 576 gcctctgcct cagaagttcc tgg 23

<210> SEQ ID NO 577
<211> LENGTH: 23
<212> TYPE: DNA
<213> ORGANISM: Homo sapiens

<400> SEQUENCE: 577 ctcttggttg cccaggccag agg 23

<210> SEQ ID NO 578
<211> LENGTH: 23
<212> TYPE: DNA
<213> ORGANISM: Homo sapiens

<400> SEQUENCE: 578 ctcttagctc ctgagagaag agg 23

<210> SEQ ID NO 579
<211> LENGTH: 23
<212> TYPE: DNA
<213> ORGANISM: Homo sapiens

<400> SEQUENCE: 579 ctccctcctc ctgtctcagt agg 23

<210> SEQ ID NO 580
<211> LENGTH: 23
<212> TYPE: DNA
<213> ORGANISM: Homo sapiens

<400> SEQUENCE: 580 ctcaggtgat gcacccacct tgg 23

<210> SEQ ID NO 581
<211> LENGTH: 23
<212> TYPE: DNA
<213> ORGANISM: Homo sapiens

<400> SEQUENCE: 581 cctcccaaag tgctgggcct cgg 23

<210> SEQ ID NO 582
<211> LENGTH: 23
<212> TYPE: DNA
<213> ORGANISM: Homo sapiens

<400> SEQUENCE: 582 cccaggaggc ccgaggaccc agg 23

<210> SEQ ID NO 583
<211> LENGTH: 23
<212> TYPE: DNA
<213> ORGANISM: Homo sapiens

<400> SEQUENCE: 583 ccaggctact cttgaactct tgg 23

<210> SEQ ID NO 584
<211> LENGTH: 23
<212> TYPE: DNA
<213> ORGANISM: Homo sapiens

<400> SEQUENCE: 584 caggcacaca ccacaatgcc cgg 23

<210> SEQ ID NO 585
<211> LENGTH: 23
<212> TYPE: DNA
<213> ORGANISM: Homo sapiens

<400> SEQUENCE: 585 caacaaaagg agagtggatg ggg 23

<210> SEQ ID NO 586
<211> LENGTH: 23
<212> TYPE: DNA
<213> ORGANISM: Homo sapiens

<400> SEQUENCE: 586 attcttatat gggaggggga tgg 23

<210> SEQ ID NO 587
<211> LENGTH: 23
<212> TYPE: DNA
<213> ORGANISM: Homo sapiens

<400> SEQUENCE: 587 agaaaggggt gactcacaga ggg 23

<210> SEQ ID NO 588
<211> LENGTH: 23
<212> TYPE: DNA
<213> ORGANISM: Homo sapiens

<400> SEQUENCE: 588 tttttaagta atgagatggg agg 23

<210> SEQ ID NO 589
<211> LENGTH: 23
<212> TYPE: DNA
<213> ORGANISM: Homo sapiens

<400> SEQUENCE: 589 tgcctactga gacaggagga ggg 23

<210> SEQ ID NO 590
<211> LENGTH: 23
<212> TYPE: DNA
<213> ORGANISM: Homo sapiens

<400> SEQUENCE: 590 tctcatttcc cagaggagat agg 23

<210> SEQ ID NO 591
<211> LENGTH: 23
<212> TYPE: DNA
<213> ORGANISM: Homo sapiens

<400> SEQUENCE: 591 gggggaccag gcagcaggtt tgg 23

<210> SEQ ID NO 592
<211> LENGTH: 23
<212> TYPE: DNA
<213> ORGANISM: Homo sapiens

<400> SEQUENCE: 592 gctatttaaa attagagttc tgg 23

<210> SEQ ID NO 593
<211> LENGTH: 23
<212> TYPE: DNA
<213> ORGANISM: Homo sapiens

<400> SEQUENCE: 593 cctgattccc tgggaaaagg ggg 23

<210> SEQ ID NO 594
<211> LENGTH: 23
<212> TYPE: DNA
<213> ORGANISM: Homo sapiens

<400> SEQUENCE: 594 caggagaatc ccttgaaccc agg 23

<210> SEQ ID NO 595
<211> LENGTH: 23
<212> TYPE: DNA
<213> ORGANISM: Homo sapiens

<400> SEQUENCE: 595 cagagggatc acctgaggtc agg 23

<210> SEQ ID NO 596
<211> LENGTH: 23
<212> TYPE: DNA
<213> ORGANISM: Homo sapiens

<400> SEQUENCE: 596 agattcccga aagaggaagg agg 23

<210> SEQ ID NO 597
<211> LENGTH: 23
<212> TYPE: DNA
<213> ORGANISM: Homo sapiens

<400> SEQUENCE: 597 cttagcactt tgggaggccg agg 23

<210> SEQ ID NO 598
<211> LENGTH: 23
<212> TYPE: DNA
<213> ORGANISM: Homo sapiens

<400> SEQUENCE: 598 accaggaact tctgaggcag agg 23

<210> SEQ ID NO 599
<211> LENGTH: 23
<212> TYPE: DNA
<213> ORGANISM: Homo sapiens

<400> SEQUENCE: 599 tcctgattcc ctgggaaaag ggg 23

<210> SEQ ID NO 600
<211> LENGTH: 23
<212> TYPE: DNA
<213> ORGANISM: Homo sapiens

<400> SEQUENCE: 600 tcccagctcc tatctcctct ggg 23

<210> SEQ ID NO 601
<211> LENGTH: 23
<212> TYPE: DNA
<213> ORGANISM: Homo sapiens

<400> SEQUENCE: 601 gccaggactc ctgattccct ggg 23

<210> SEQ ID NO 602
<211> LENGTH: 23
<212> TYPE: DNA
<213> ORGANISM: Homo sapiens

<400> SEQUENCE: 602 catcttctgg ggctcccagg agg 23

<210> SEQ ID NO 603
<211> LENGTH: 23
<212> TYPE: DNA
<213> ORGANISM: Homo sapiens

<400> SEQUENCE: 603 aaaaattagc cgggtgtggt ggg 23

<210> SEQ ID NO 604
<211> LENGTH: 23
<212> TYPE: DNA
<213> ORGANISM: Homo sapiens

<400> SEQUENCE: 604 ttgttttggg aaatggtatg agg 23

<210> SEQ ID NO 605
<211> LENGTH: 23
<212> TYPE: DNA
<213> ORGANISM: Homo sapiens

<400> SEQUENCE: 605 ttccctggga aaagggggct ggg 23

<210> SEQ ID NO 606
<211> LENGTH: 23
<212> TYPE: DNA
<213> ORGANISM: Homo sapiens

<400> SEQUENCE: 606 tgctgcctgg tccccctgca ggg 23

<210> SEQ ID NO 607
<211> LENGTH: 23
<212> TYPE: DNA
<213> ORGANISM: Homo sapiens

<400> SEQUENCE: 607 tcccgaaaga ggaaggaggt ggg 23

<210> SEQ ID NO 608
<211> LENGTH: 23
<212> TYPE: DNA
<213> ORGANISM: Homo sapiens

<400> SEQUENCE: 608 gcctgaactc ttggttgccc agg 23

<210> SEQ ID NO 609
<211> LENGTH: 23
<212> TYPE: DNA
<213> ORGANISM: Homo sapiens

<400> SEQUENCE: 609 attaatctgg aagttgtttt ggg 23

<210> SEQ ID NO 610
<211> LENGTH: 23
<212> TYPE: DNA
<213> ORGANISM: Homo sapiens

<400> SEQUENCE: 610 atgctaaaag acaaaactag agg 23

<210> SEQ ID NO 611
<211> LENGTH: 23
<212> TYPE: DNA
<213> ORGANISM: Homo sapiens

<400> SEQUENCE: 611 actcctgatt ccctgggaaa agg 23

<210> SEQ ID NO 612
<211> LENGTH: 23
<212> TYPE: DNA
<213> ORGANISM: Homo sapiens

<400> SEQUENCE: 612 acggggctgc ctgggtcctc ggg 23

<210> SEQ ID NO 613
<211> LENGTH: 23
<212> TYPE: DNA
<213> ORGANISM: Homo sapiens

<400> SEQUENCE: 613 aattaatctg gaagttgttt tgg 23

<210> SEQ ID NO 614
<211> LENGTH: 23
<212> TYPE: DNA
<213> ORGANISM: Homo sapiens

<400> SEQUENCE: 614 ttaagtaatg agatgggagg ggg 23

<210> SEQ ID NO 615
<211> LENGTH: 23
<212> TYPE: DNA
<213> ORGANISM: Homo sapiens

<400> SEQUENCE: 615 gagatgggat tttaccatgt tgg 23

<210> SEQ ID NO 616
<211> LENGTH: 23
<212> TYPE: DNA
<213> ORGANISM: Homo sapiens

<400> SEQUENCE: 616 ctcctgattc cctgggaaaa ggg 23

<210> SEQ ID NO 617
<211> LENGTH: 23
<212> TYPE: DNA
<213> ORGANISM: Homo sapiens

<400> SEQUENCE: 617 caaccacctc ctgggttcaa ggg 23

<210> SEQ ID NO 618
<211> LENGTH: 23
<212> TYPE: DNA
<213> ORGANISM: Homo sapiens

<400> SEQUENCE: 618 agtttcctgt ttgtaaaatc agg 23

<210> SEQ ID NO 619
<211> LENGTH: 23
<212> TYPE: DNA
<213> ORGANISM: Homo sapiens

<400> SEQUENCE: 619 aaaaaaaaat tagccgggtg tgg 23

<210> SEQ ID NO 620
<211> LENGTH: 23
<212> TYPE: DNA
<213> ORGANISM: Homo sapiens

<400> SEQUENCE: 620 tggggctccc aggaggcccg agg 23

<210> SEQ ID NO 621
<211> LENGTH: 23
<212> TYPE: DNA
<213> ORGANISM: Homo sapiens

<400> SEQUENCE: 621 tcttagctcc tgagagaaga ggg 23

<210> SEQ ID NO 622
<211> LENGTH: 23
<212> TYPE: DNA

<213> ORGANISM: Homo sapiens

<400> SEQUENCE: 622 tagaggacaa atgatagtac tgg 23

<210> SEQ ID NO 623
<211> LENGTH: 23
<212> TYPE: DNA
<213> ORGANISM: Homo sapiens

<400> SEQUENCE: 623 taataaaatt acagagttct ggg 23

<210> SEQ ID NO 624
<211> LENGTH: 23
<212> TYPE: DNA
<213> ORGANISM: Homo sapiens

<400> SEQUENCE: 624 gcatgcactt tgggaggctg agg 23

<210> SEQ ID NO 625
<211> LENGTH: 23
<212> TYPE: DNA
<213> ORGANISM: Homo sapiens

<400> SEQUENCE: 625 gagacagggt ttccccatgt tgg 23

<210> SEQ ID NO 626
<211> LENGTH: 23
<212> TYPE: DNA
<213> ORGANISM: Homo sapiens

<400> SEQUENCE: 626 cgaggtggga ggattgcttg agg 23

<210> SEQ ID NO 627
<211> LENGTH: 23
<212> TYPE: DNA
<213> ORGANISM: Homo sapiens

<400> SEQUENCE: 627 ataagattct catttcccag agg 23

<210> SEQ ID NO 628
<211> LENGTH: 23
<212> TYPE: DNA
<213> ORGANISM: Homo sapiens

<400> SEQUENCE: 628 aacggggctg cctgggtcct cgg 23

<210> SEQ ID NO 629
<211> LENGTH: 23
<212> TYPE: DNA
<213> ORGANISM: Homo sapiens

<400> SEQUENCE: 629 aaaaaattag ccgggtgtgg tgg 23

<210> SEQ ID NO 630
<211> LENGTH: 23

<212> TYPE: DNA
<213> ORGANISM: Homo sapiens

<400> SEQUENCE: 630 ggagacccag acaccctgca ggg 23

<210> SEQ ID NO 631
<211> LENGTH: 23
<212> TYPE: DNA
<213> ORGANISM: Homo sapiens

<400> SEQUENCE: 631 gcaccactgc actccggcct ggg 23

<210> SEQ ID NO 632
<211> LENGTH: 23
<212> TYPE: DNA
<213> ORGANISM: Homo sapiens

<400> SEQUENCE: 632 ccaacttccc tttcatcttc tgg 23

<210> SEQ ID NO 633
<211> LENGTH: 23
<212> TYPE: DNA
<213> ORGANISM: Homo sapiens

<400> SEQUENCE: 633 atgggagggg gatggaagcc agg 23

<210> SEQ ID NO 634
<211> LENGTH: 23
<212> TYPE: DNA
<213> ORGANISM: Homo sapiens

<400> SEQUENCE: 634 agtcacccct ttcttctccc tgg 23

<210> SEQ ID NO 635
<211> LENGTH: 23
<212> TYPE: DNA
<213> ORGANISM: Homo sapiens

<400> SEQUENCE: 635 aatctgtgtt ctcttgcttt agg 23

<210> SEQ ID NO 636
<211> LENGTH: 23
<212> TYPE: DNA
<213> ORGANISM: Homo sapiens

<400> SEQUENCE: 636 aacttccctt tcatcttctg ggg 23

<210> SEQ ID NO 637
<211> LENGTH: 23
<212> TYPE: DNA
<213> ORGANISM: Homo sapiens

<400> SEQUENCE: 637 tgtcagcaac aaaaggagag tgg 23

<210> SEQ ID NO 638

<211> LENGTH: 23
<212> TYPE: DNA
<213> ORGANISM: Homo sapiens

<400> SEQUENCE: 638 gttcccagcc ccctttttccc agg 23

<210> SEQ ID NO 639
<211> LENGTH: 23
<212> TYPE: DNA
<213> ORGANISM: Homo sapiens

<400> SEQUENCE: 639 ggagtgcagt ggtgcaatct cgg 23

<210> SEQ ID NO 640
<211> LENGTH: 23
<212> TYPE: DNA
<213> ORGANISM: Homo sapiens

<400> SEQUENCE: 640 ctaggttcaa ataaagaaca ggg 23

<210> SEQ ID NO 641
<211> LENGTH: 23
<212> TYPE: DNA
<213> ORGANISM: Homo sapiens

<400> SEQUENCE: 641 atactatatt gcaaatattc tgg 23

<210> SEQ ID NO 642
<211> LENGTH: 23
<212> TYPE: DNA
<213> ORGANISM: Homo sapiens

<400> SEQUENCE: 642 agacccagac accctgcagg ggg 23

<210> SEQ ID NO 643
<211> LENGTH: 23
<212> TYPE: DNA
<213> ORGANISM: Homo sapiens

<400> SEQUENCE: 643 aaaggggtgt cagcaacaaa agg 23

<210> SEQ ID NO 644
<211> LENGTH: 23
<212> TYPE: DNA
<213> ORGANISM: Homo sapiens

<400> SEQUENCE: 644 ttgctcaggc aggagtgcag tgg 23

<210> SEQ ID NO 645
<211> LENGTH: 23
<212> TYPE: DNA
<213> ORGANISM: Homo sapiens

<400> SEQUENCE: 645 taaaaataca aagattagcc tgg 23

<210> SEQ ID NO 646
<211> LENGTH: 23
<212> TYPE: DNA
<213> ORGANISM: Homo sapiens

<400> SEQUENCE: 646 ggggaccagg cagcaggttt ggg 23

<210> SEQ ID NO 647
<211> LENGTH: 23
<212> TYPE: DNA
<213> ORGANISM: Homo sapiens

<400> SEQUENCE: 647 gcaggaagag gtcaggagac agg 23

<210> SEQ ID NO 648
<211> LENGTH: 23
<212> TYPE: DNA
<213> ORGANISM: Homo sapiens

<400> SEQUENCE: 648 gagaatcact tgaacctggg agg 23

<210> SEQ ID NO 649
<211> LENGTH: 23
<212> TYPE: DNA
<213> ORGANISM: Homo sapiens

<400> SEQUENCE: 649 ctggttcttg aggcaggaag agg 23

<210> SEQ ID NO 650
<211> LENGTH: 23
<212> TYPE: DNA
<213> ORGANISM: Homo sapiens

<400> SEQUENCE: 650 cacagagggt cagcagctgg agg 23

<210> SEQ ID NO 651
<211> LENGTH: 23
<212> TYPE: DNA
<213> ORGANISM: Homo sapiens

<400> SEQUENCE: 651 caacttccct ttcatcttct ggg 23

<210> SEQ ID NO 652
<211> LENGTH: 23
<212> TYPE: DNA
<213> ORGANISM: Homo sapiens

<400> SEQUENCE: 652 aaaatctgag taattggaaa agg 23

<210> SEQ ID NO 653
<211> LENGTH: 23
<212> TYPE: DNA
<213> ORGANISM: Homo sapiens

<400> SEQUENCE: 653 ttcccagccc ccttttccca ggg 23

<210> SEQ ID NO 654
<211> LENGTH: 23
<212> TYPE: DNA
<213> ORGANISM: Homo sapiens

<400> SEQUENCE: 654 tggcatgtgc ctgtggtccc agg 23

<210> SEQ ID NO 655
<211> LENGTH: 23
<212> TYPE: DNA
<213> ORGANISM: Homo sapiens

<400> SEQUENCE: 655 ggggtctcat tgtgtcaccc ggg 23

<210> SEQ ID NO 656
<211> LENGTH: 23
<212> TYPE: DNA
<213> ORGANISM: Homo sapiens

<400> SEQUENCE: 656 gggctggggc ccagacccct ggg 23

<210> SEQ ID NO 657
<211> LENGTH: 23
<212> TYPE: DNA
<213> ORGANISM: Homo sapiens

<400> SEQUENCE: 657 ctcaggtgat ccacccgcct cgg 23

<210> SEQ ID NO 658
<211> LENGTH: 23
<212> TYPE: DNA
<213> ORGANISM: Homo sapiens

<400> SEQUENCE: 658 cagaagatga aagggaagtt ggg 23

<210> SEQ ID NO 659
<211> LENGTH: 23
<212> TYPE: DNA
<213> ORGANISM: Homo sapiens

<400> SEQUENCE: 659 cacttgaacc tgggaggcag agg 23

<210> SEQ ID NO 660
<211> LENGTH: 23
<212> TYPE: DNA
<213> ORGANISM: Homo sapiens

<400> SEQUENCE: 660 caaaataaaa tctgagtaat tgg 23

<210> SEQ ID NO 661
<211> LENGTH: 23
<212> TYPE: DNA
<213> ORGANISM: Homo sapiens

<400> SEQUENCE: 661 tgggttcctg gctggggttg ggg 23

<210> SEQ ID NO 662
<211> LENGTH: 23
<212> TYPE: DNA
<213> ORGANISM: Homo sapiens

<400> SEQUENCE: 662 gcctcagcct cccaaagtgt tgg 23

<210> SEQ ID NO 663
<211> LENGTH: 23
<212> TYPE: DNA
<213> ORGANISM: Homo sapiens

<400> SEQUENCE: 663 ctggaagttg ttttgggaaa tgg 23

<210> SEQ ID NO 664
<211> LENGTH: 23
<212> TYPE: DNA
<213> ORGANISM: Homo sapiens

<400> SEQUENCE: 664 cccgaaagag gaaggaggtg ggg 23

<210> SEQ ID NO 665
<211> LENGTH: 23
<212> TYPE: DNA
<213> ORGANISM: Homo sapiens

<400> SEQUENCE: 665 caaaaggaga gtggatgggg tgg 23

<210> SEQ ID NO 666
<211> LENGTH: 23
<212> TYPE: DNA
<213> ORGANISM: Homo sapiens

<400> SEQUENCE: 666 ataataaaat tacagagttc tgg 23

<210> SEQ ID NO 667
<211> LENGTH: 23
<212> TYPE: DNA
<213> ORGANISM: Homo sapiens

<400> SEQUENCE: 667 agcaacaaaa ggagagtgga tgg 23

<210> SEQ ID NO 668
<211> LENGTH: 23
<212> TYPE: DNA
<213> ORGANISM: Homo sapiens

<400> SEQUENCE: 668 tccccacctc cttcctcttt cgg 23

<210> SEQ ID NO 669
<211> LENGTH: 23
<212> TYPE: DNA
<213> ORGANISM: Homo sapiens

<400> SEQUENCE: 669 gcaacaaaag gagagtggat ggg 23

<210> SEQ ID NO 670
<211> LENGTH: 23
<212> TYPE: DNA
<213> ORGANISM: Homo sapiens

<400> SEQUENCE: 670 cttctccctg ggttcctggc tgg 23

<210> SEQ ID NO 671
<211> LENGTH: 23
<212> TYPE: DNA
<213> ORGANISM: Homo sapiens

<400> SEQUENCE: 671 agggtttccc catgttggtc agg 23

<210> SEQ ID NO 672
<211> LENGTH: 23
<212> TYPE: DNA
<213> ORGANISM: Homo sapiens

<400> SEQUENCE: 672 agggctgggg cccagacccc tgg 23

<210> SEQ ID NO 673
<211> LENGTH: 23
<212> TYPE: DNA
<213> ORGANISM: Homo sapiens

<400> SEQUENCE: 673 ttgtaaaatc agggagagac tgg 23

<210> SEQ ID NO 674
<211> LENGTH: 23
<212> TYPE: DNA
<213> ORGANISM: Homo sapiens

<400> SEQUENCE: 674 gtttcctgtt tgtaaaatca ggg 23

<210> SEQ ID NO 675
<211> LENGTH: 23
<212> TYPE: DNA
<213> ORGANISM: Homo sapiens

<400> SEQUENCE: 675 ctttcttctc cctgggttcc tgg 23

<210> SEQ ID NO 676
<211> LENGTH: 23
<212> TYPE: DNA
<213> ORGANISM: Homo sapiens

<400> SEQUENCE: 676 ctgcaggggg accaggcagc agg 23

<210> SEQ ID NO 677
<211> LENGTH: 23
<212> TYPE: DNA
<213> ORGANISM: Homo sapiens

<400> SEQUENCE: 677 caagagaatc gcttgaaccc agg 23

<210> SEQ ID NO 678
<211> LENGTH: 23
<212> TYPE: DNA
<213> ORGANISM: Homo sapiens

<400> SEQUENCE: 678 acaacttaag aaatttgaag tgg 23

<210> SEQ ID NO 679
<211> LENGTH: 23
<212> TYPE: DNA
<213> ORGANISM: Homo sapiens

<400> SEQUENCE: 679 aaaaaaaagt ctgggtgtgg tgg 23

<210> SEQ ID NO 680
<211> LENGTH: 23
<212> TYPE: DNA
<213> ORGANISM: Homo sapiens

<400> SEQUENCE: 680 tttgtaaaca cagtttcaaa agg 23

<210> SEQ ID NO 681
<211> LENGTH: 23
<212> TYPE: DNA
<213> ORGANISM: Homo sapiens

<400> SEQUENCE: 681 tcctgagaga agagggaaat ggg 23

<210> SEQ ID NO 682
<211> LENGTH: 23
<212> TYPE: DNA
<213> ORGANISM: Homo sapiens

<400> SEQUENCE: 682 gggaaaaggg ggctgggaac agg 23

<210> SEQ ID NO 683
<211> LENGTH: 23
<212> TYPE: DNA
<213> ORGANISM: Homo sapiens

<400> SEQUENCE: 683 ggcgcagcgg ctcatgcctg tgg 23

<210> SEQ ID NO 684
<211> LENGTH: 23
<212> TYPE: DNA
<213> ORGANISM: Homo sapiens

<400> SEQUENCE: 684 ggaaactgag gctaagaaag ggg 23

<210> SEQ ID NO 685
<211> LENGTH: 23
<212> TYPE: DNA
<213> ORGANISM: Homo sapiens

<400> SEQUENCE: 685 gcctcagcct cctgagtagc tgg 23

<210> SEQ ID NO 686
<211> LENGTH: 23
<212> TYPE: DNA
<213> ORGANISM: Homo sapiens

<400> SEQUENCE: 686 gatgaaaggg aagttgggga agg 23

<210> SEQ ID NO 687
<211> LENGTH: 23
<212> TYPE: DNA
<213> ORGANISM: Homo sapiens

<400> SEQUENCE: 687 agtaatgaga tgggaggggg cgg 23

<210> SEQ ID NO 688
<211> LENGTH: 23
<212> TYPE: DNA
<213> ORGANISM: Homo sapiens

<400> SEQUENCE: 688 ttatttttaa gtaatgagat ggg 23

<210> SEQ ID NO 689
<211> LENGTH: 23
<212> TYPE: DNA
<213> ORGANISM: Homo sapiens

<400> SEQUENCE: 689 tactgcaacc tctgcctcct ggg 23

<210> SEQ ID NO 690
<211> LENGTH: 23
<212> TYPE: DNA
<213> ORGANISM: Homo sapiens

<400> SEQUENCE: 690 ccccatttcc ctcttctctc agg 23

<210> SEQ ID NO 691
<211> LENGTH: 23
<212> TYPE: DNA
<213> ORGANISM: Homo sapiens

<400> SEQUENCE: 691 caaccccagc caggaaccca ggg 23

<210> SEQ ID NO 692
<211> LENGTH: 23
<212> TYPE: DNA
<213> ORGANISM: Homo sapiens

<400> SEQUENCE: 692 aggaaactga ggctaagaaa ggg 23

<210> SEQ ID NO 693
<211> LENGTH: 23
<212> TYPE: DNA
<213> ORGANISM: Homo sapiens

<400> SEQUENCE: 693 aatcccttga acccaggagg tgg 23

<210> SEQ ID NO 694
<211> LENGTH: 23
<212> TYPE: DNA
<213> ORGANISM: Homo sapiens

<400> SEQUENCE: 694 aaatctgagt aattggaaaa ggg 23

<210> SEQ ID NO 695
<211> LENGTH: 23
<212> TYPE: DNA
<213> ORGANISM: Homo sapiens

<400> SEQUENCE: 695 aaaagtattc aaaaaactat agg 23

<210> SEQ ID NO 696
<211> LENGTH: 23
<212> TYPE: DNA
<213> ORGANISM: Homo sapiens

<400> SEQUENCE: 696 tcctgagtag ctgggattac agg 23

<210> SEQ ID NO 697
<211> LENGTH: 23
<212> TYPE: DNA
<213> ORGANISM: Homo sapiens

<400> SEQUENCE: 697 gcctctgcct cccaaagtgc tgg 23

<210> SEQ ID NO 698
<211> LENGTH: 23
<212> TYPE: DNA
<213> ORGANISM: Homo sapiens

<400> SEQUENCE: 698 cctgagagaa gagggaaatg ggg 23

<210> SEQ ID NO 699
<211> LENGTH: 23
<212> TYPE: DNA
<213> ORGANISM: Homo sapiens

<400> SEQUENCE: 699 ccctgtactg tgccaggctc agg 23

<210> SEQ ID NO 700
<211> LENGTH: 23
<212> TYPE: DNA
<213> ORGANISM: Homo sapiens

<400> SEQUENCE: 700 ctttgggagg cagaggcggg cgg 23

<210> SEQ ID NO 701
<211> LENGTH: 23
<212> TYPE: DNA

<213> ORGANISM: Homo sapiens

<400> SEQUENCE: 701 ctactgagac aggaggaggg agg 23

<210> SEQ ID NO 702
<211> LENGTH: 23
<212> TYPE: DNA
<213> ORGANISM: Homo sapiens

<400> SEQUENCE: 702 ccagaagatg aaagggaagt tgg 23

<210> SEQ ID NO 703
<211> LENGTH: 23
<212> TYPE: DNA
<213> ORGANISM: Homo sapiens

<400> SEQUENCE: 703 caggaagagg tcaggagaca ggg 23

<210> SEQ ID NO 704
<211> LENGTH: 23
<212> TYPE: DNA
<213> ORGANISM: Homo sapiens

<400> SEQUENCE: 704 ataggaaaat atatttgtct tgg 23

<210> SEQ ID NO 705
<211> LENGTH: 23
<212> TYPE: DNA
<213> ORGANISM: Homo sapiens

<400> SEQUENCE: 705 aggaaaatat atttgtcttg ggg 23

<210> SEQ ID NO 706
<211> LENGTH: 23
<212> TYPE: DNA
<213> ORGANISM: Homo sapiens

<400> SEQUENCE: 706 ttctccctgg gttcctggct ggg 23

<210> SEQ ID NO 707
<211> LENGTH: 23
<212> TYPE: DNA
<213> ORGANISM: Homo sapiens

<400> SEQUENCE: 707 taggaaaata tatttgtctt ggg 23

<210> SEQ ID NO 708
<211> LENGTH: 23
<212> TYPE: DNA
<213> ORGANISM: Homo sapiens

<400> SEQUENCE: 708 ggaaaagggg gctgggaaca ggg 23

<210> SEQ ID NO 709
<211> LENGTH: 23

<212> TYPE: DNA
<213> ORGANISM: Homo sapiens

<400> SEQUENCE: 709 ctttgggagg ccgaggcggg tgg 23

<210> SEQ ID NO 710
<211> LENGTH: 23
<212> TYPE: DNA
<213> ORGANISM: Homo sapiens

<400> SEQUENCE: 710 cctcagcctc ctgagtacct ggg 23

<210> SEQ ID NO 711
<211> LENGTH: 23
<212> TYPE: DNA
<213> ORGANISM: Homo sapiens

<400> SEQUENCE: 711 cctcagcctc ccaaagtgtt ggg 23

<210> SEQ ID NO 712
<211> LENGTH: 23
<212> TYPE: DNA
<213> ORGANISM: Homo sapiens

<400> SEQUENCE: 712 ccaaccccag ccaggaaccc agg 23

<210> SEQ ID NO 713
<211> LENGTH: 23
<212> TYPE: DNA
<213> ORGANISM: Homo sapiens

<400> SEQUENCE: 713 caggaaccca gggagaagaa agg 23

<210> SEQ ID NO 714
<211> LENGTH: 23
<212> TYPE: DNA
<213> ORGANISM: Homo sapiens

<400> SEQUENCE: 714 caggaaactg aggctaagaa agg 23

<210> SEQ ID NO 715
<211> LENGTH: 23
<212> TYPE: DNA
<213> ORGANISM: Homo sapiens

<400> SEQUENCE: 715 cacaccacta cactccagcc tgg 23

<210> SEQ ID NO 716
<211> LENGTH: 23
<212> TYPE: DNA
<213> ORGANISM: Homo sapiens

<400> SEQUENCE: 716 attattttta agtaatgaga tgg 23

<210> SEQ ID NO 717

<211> LENGTH: 23
<212> TYPE: DNA
<213> ORGANISM: Homo sapiens

<400> SEQUENCE: 717 ttttaagtaa tgagatggga ggg 23

<210> SEQ ID NO 718
<211> LENGTH: 23
<212> TYPE: DNA
<213> ORGANISM: Homo sapiens

<400> SEQUENCE: 718 ttcccgaaag aggaaggagg tgg 23

<210> SEQ ID NO 719
<211> LENGTH: 23
<212> TYPE: DNA
<213> ORGANISM: Homo sapiens

<400> SEQUENCE: 719 tgcaccactg cactccggcc tgg 23

<210> SEQ ID NO 720
<211> LENGTH: 23
<212> TYPE: DNA
<213> ORGANISM: Homo sapiens

<400> SEQUENCE: 720 gagaatcgct tgaacccagg agg 23

<210> SEQ ID NO 721
<211> LENGTH: 23
<212> TYPE: DNA
<213> ORGANISM: Homo sapiens

<400> SEQUENCE: 721 gaagaggtca ggagacaggg agg 23

<210> SEQ ID NO 722
<211> LENGTH: 23
<212> TYPE: DNA
<213> ORGANISM: Homo sapiens

<400> SEQUENCE: 722 atataaaata aaaagttgta tgg 23

<210> SEQ ID NO 723
<211> LENGTH: 23
<212> TYPE: DNA
<213> ORGANISM: Homo sapiens

<400> SEQUENCE: 723 agaagatgaa agggaagttg ggg 23

<210> SEQ ID NO 724
<211> LENGTH: 23
<212> TYPE: DNA
<213> ORGANISM: Homo sapiens

<400> SEQUENCE: 724 tttctctctg tcgcccaggc cgg 23

<210> SEQ ID NO 725
<211> LENGTH: 23
<212> TYPE: DNA
<213> ORGANISM: Homo sapiens

<400> SEQUENCE: 725 ttactgcaac ctctgcctcc tgg 23

<210> SEQ ID NO 726
<211> LENGTH: 23
<212> TYPE: DNA
<213> ORGANISM: Homo sapiens

<400> SEQUENCE: 726 gtcacccctt tcttctccct ggg 23

<210> SEQ ID NO 727
<211> LENGTH: 23
<212> TYPE: DNA
<213> ORGANISM: Homo sapiens

<400> SEQUENCE: 727 ggggtttcgc catgttggtc agg 23

<210> SEQ ID NO 728
<211> LENGTH: 23
<212> TYPE: DNA
<213> ORGANISM: Homo sapiens

<400> SEQUENCE: 728 gagaatccct tgaacccagg agg 23

<210> SEQ ID NO 729
<211> LENGTH: 23
<212> TYPE: DNA
<213> ORGANISM: Homo sapiens

<400> SEQUENCE: 729 ctcctgagag aagagggaaa tgg 23

<210> SEQ ID NO 730
<211> LENGTH: 23
<212> TYPE: DNA
<213> ORGANISM: Homo sapiens

<400> SEQUENCE: 730 ctaaggggaa tgagaaaaga agg 23

<210> SEQ ID NO 731
<211> LENGTH: 23
<212> TYPE: DNA
<213> ORGANISM: Homo sapiens

<400> SEQUENCE: 731 tttctgtttt tagtagagat ggg 23

<210> SEQ ID NO 732
<211> LENGTH: 23
<212> TYPE: DNA
<213> ORGANISM: Homo sapiens

<400> SEQUENCE: 732 tcgcccaggc tggagtgtag tgg 23

<210> SEQ ID NO 733
<211> LENGTH: 23
<212> TYPE: DNA
<213> ORGANISM: Homo sapiens

<400> SEQUENCE: 733 gggttcctgg ctggggttgg ggg 23

<210> SEQ ID NO 734
<211> LENGTH: 23
<212> TYPE: DNA
<213> ORGANISM: Homo sapiens

<400> SEQUENCE: 734 gcactttggg aggcagaggc ggg 23

<210> SEQ ID NO 735
<211> LENGTH: 23
<212> TYPE: DNA
<213> ORGANISM: Homo sapiens

<400> SEQUENCE: 735 ccccacctcc ttcctctttc ggg 23

<210> SEQ ID NO 736
<211> LENGTH: 23
<212> TYPE: DNA
<213> ORGANISM: Homo sapiens

<400> SEQUENCE: 736 caattactca gattttattt tgg 23

<210> SEQ ID NO 737
<211> LENGTH: 23
<212> TYPE: DNA
<213> ORGANISM: Homo sapiens

<400> SEQUENCE: 737 attttacaaa caggaaactg agg 23

<210> SEQ ID NO 738
<211> LENGTH: 23
<212> TYPE: DNA
<213> ORGANISM: Homo sapiens

<400> SEQUENCE: 738 acttgtagtc ccagctacta cgg 23

<210> SEQ ID NO 739
<211> LENGTH: 23
<212> TYPE: DNA
<213> ORGANISM: Homo sapiens

<400> SEQUENCE: 739 aaaaaaaaaa agtctgggtg tgg 23

<210> SEQ ID NO 740
<211> LENGTH: 23
<212> TYPE: DNA
<213> ORGANISM: Homo sapiens

<400> SEQUENCE: 740 tgtaatccca gctactcagg agg 23

<210> SEQ ID NO 741
<211> LENGTH: 23
<212> TYPE: DNA
<213> ORGANISM: Homo sapiens

<400> SEQUENCE: 741 tggagggagg gaggaaaata agg 23

<210> SEQ ID NO 742
<211> LENGTH: 23
<212> TYPE: DNA
<213> ORGANISM: Homo sapiens

<400> SEQUENCE: 742 taaaaataca aaaattatcc ggg 23

<210> SEQ ID NO 743
<211> LENGTH: 23
<212> TYPE: DNA
<213> ORGANISM: Homo sapiens

<400> SEQUENCE: 743 ggggaatgag aaaagaagga agg 23

<210> SEQ ID NO 744
<211> LENGTH: 23
<212> TYPE: DNA
<213> ORGANISM: Homo sapiens

<400> SEQUENCE: 744 aggaacccag ggagaagaaa ggg 23

<210> SEQ ID NO 745
<211> LENGTH: 23
<212> TYPE: DNA
<213> ORGANISM: Homo sapiens

<400> SEQUENCE: 745 acaccactac actccagcct ggg 23

<210> SEQ ID NO 746
<211> LENGTH: 23
<212> TYPE: DNA
<213> ORGANISM: Homo sapiens

<400> SEQUENCE: 746 ttttattcat ttttagagat ggg 23

<210> SEQ ID NO 747
<211> LENGTH: 23
<212> TYPE: DNA
<213> ORGANISM: Homo sapiens

<400> SEQUENCE: 747 tctccctggg ttcctggctg ggg 23

<210> SEQ ID NO 748
<211> LENGTH: 23
<212> TYPE: DNA
<213> ORGANISM: Homo sapiens

<400> SEQUENCE: 748 tactgagaca ggaggaggga ggg 23

<210> SEQ ID NO 749
<211> LENGTH: 23
<212> TYPE: DNA
<213> ORGANISM: Homo sapiens

<400> SEQUENCE: 749 cactgcaacc tctgcctccc agg 23

<210> SEQ ID NO 750
<211> LENGTH: 23
<212> TYPE: DNA
<213> ORGANISM: Homo sapiens

<400> SEQUENCE: 750 agcactttgg gaggcagagg cgg 23

<210> SEQ ID NO 751
<211> LENGTH: 23
<212> TYPE: DNA
<213> ORGANISM: Homo sapiens

<400> SEQUENCE: 751 aaatgaataa aaataagggt cgg 23

<210> SEQ ID NO 752
<211> LENGTH: 23
<212> TYPE: DNA
<213> ORGANISM: Homo sapiens

<400> SEQUENCE: 752 tcctgagtag ctgggactac agg 23

<210> SEQ ID NO 753
<211> LENGTH: 23
<212> TYPE: DNA
<213> ORGANISM: Homo sapiens

<400> SEQUENCE: 753 cccagcactt tgggaggcag agg 23

<210> SEQ ID NO 754
<211> LENGTH: 23
<212> TYPE: DNA
<213> ORGANISM: Homo sapiens

<400> SEQUENCE: 754 tttattcatt tttagagatg ggg 23

<210> SEQ ID NO 755
<211> LENGTH: 23
<212> TYPE: DNA
<213> ORGANISM: Homo sapiens

<400> SEQUENCE: 755 ggaacccagg gagaagaaag ggg 23

<210> SEQ ID NO 756
<211> LENGTH: 23
<212> TYPE: DNA
<213> ORGANISM: Homo sapiens

<400> SEQUENCE: 756 gcaggagaat cacttgaacc tgg 23

<210> SEQ ID NO 757
<211> LENGTH: 23
<212> TYPE: DNA
<213> ORGANISM: Homo sapiens

<400> SEQUENCE: 757 gagattgcac cactgcactc cgg 23

<210> SEQ ID NO 758
<211> LENGTH: 23
<212> TYPE: DNA
<213> ORGANISM: Homo sapiens

<400> SEQUENCE: 758 ctttgggagg ctgaggcaga ggg 23

<210> SEQ ID NO 759
<211> LENGTH: 23
<212> TYPE: DNA
<213> ORGANISM: Homo sapiens

<400> SEQUENCE: 759 aagaggaagg aggtggggac agg 23

<210> SEQ ID NO 760
<211> LENGTH: 23
<212> TYPE: DNA
<213> ORGANISM: Homo sapiens

<400> SEQUENCE: 760 ctgggttcct ggctggggtt ggg 23

<210> SEQ ID NO 761
<211> LENGTH: 23
<212> TYPE: DNA
<213> ORGANISM: Homo sapiens

<400> SEQUENCE: 761 cctgggttcc tggctggggt tgg 23

<210> SEQ ID NO 762
<211> LENGTH: 23
<212> TYPE: DNA
<213> ORGANISM: Homo sapiens

<400> SEQUENCE: 762 tatttggaaa agaaaaatgt tgg 23

<210> SEQ ID NO 763
<211> LENGTH: 23
<212> TYPE: DNA
<213> ORGANISM: Homo sapiens

<400> SEQUENCE: 763 taaaaacaga aaaattagcc agg 23

<210> SEQ ID NO 764
<211> LENGTH: 23
<212> TYPE: DNA
<213> ORGANISM: Homo sapiens

<400> SEQUENCE: 764 ctttgggagg ccgaggtggg agg 23

<210> SEQ ID NO 765
<211> LENGTH: 23
<212> TYPE: DNA
<213> ORGANISM: Homo sapiens

<400> SEQUENCE: 765 ctcaagcaat cctcccacct cgg 23

<210> SEQ ID NO 766
<211> LENGTH: 23
<212> TYPE: DNA
<213> ORGANISM: Homo sapiens

<400> SEQUENCE: 766 ttttaccatg ttggtcaggc tgg 23

<210> SEQ ID NO 767
<211> LENGTH: 23
<212> TYPE: DNA
<213> ORGANISM: Homo sapiens

<400> SEQUENCE: 767 tcgcccaggc cggagtgcag tgg 23

<210> SEQ ID NO 768
<211> LENGTH: 23
<212> TYPE: DNA
<213> ORGANISM: Homo sapiens

<400> SEQUENCE: 768 ctaaaaatac aaaaattatc cgg 23

<210> SEQ ID NO 769
<211> LENGTH: 23
<212> TYPE: DNA
<213> ORGANISM: Homo sapiens

<400> SEQUENCE: 769 cccaggtact caggaggctg agg 23

<210> SEQ ID NO 770
<211> LENGTH: 23
<212> TYPE: DNA
<213> ORGANISM: Homo sapiens

<400> SEQUENCE: 770 catttccttc tctgtaaaat ggg 23

<210> SEQ ID NO 771
<211> LENGTH: 23
<212> TYPE: DNA
<213> ORGANISM: Homo sapiens

<400> SEQUENCE: 771 aggtactcag gaggctgagg tgg 23

<210> SEQ ID NO 772
<211> LENGTH: 23
<212> TYPE: DNA
<213> ORGANISM: Homo sapiens

<400> SEQUENCE: 772 aagaaggaag gaatggaggg agg 23

<210> SEQ ID NO 773
<211> LENGTH: 23
<212> TYPE: DNA
<213> ORGANISM: Homo sapiens

<400> SEQUENCE: 773 tactcaggag gctgaggtgg agg 23

<210> SEQ ID NO 774
<211> LENGTH: 23
<212> TYPE: DNA
<213> ORGANISM: Homo sapiens

<400> SEQUENCE: 774 gtttaaaaaa aaagaaacac agg 23

<210> SEQ ID NO 775
<211> LENGTH: 23
<212> TYPE: DNA
<213> ORGANISM: Homo sapiens

<400> SEQUENCE: 775 gcactttggg aggccgaggc ggg 23

<210> SEQ ID NO 776
<211> LENGTH: 23
<212> TYPE: DNA
<213> ORGANISM: Homo sapiens

<400> SEQUENCE: 776 ctttgggagg ctgaggctgg agg 23

<210> SEQ ID NO 777
<211> LENGTH: 23
<212> TYPE: DNA
<213> ORGANISM: Homo sapiens

<400> SEQUENCE: 777 cctctgcctc ccaaagtgct ggg 23

<210> SEQ ID NO 778
<211> LENGTH: 23
<212> TYPE: DNA
<213> ORGANISM: Homo sapiens

<400> SEQUENCE: 778 agtgctggga ttacagacgt tgg 23

<210> SEQ ID NO 779
<211> LENGTH: 23
<212> TYPE: DNA
<213> ORGANISM: Homo sapiens

<400> SEQUENCE: 779 tttttattca tttttagaga tgg 23

<210> SEQ ID NO 780
<211> LENGTH: 23
<212> TYPE: DNA

<213> ORGANISM: Homo sapiens

<400> SEQUENCE: 780 ggggggcagag agagaggcaa tgg 23

<210> SEQ ID NO 781
<211> LENGTH: 23
<212> TYPE: DNA
<213> ORGANISM: Homo sapiens

<400> SEQUENCE: 781 gcgccactgc actccagcct ggg 23

<210> SEQ ID NO 782
<211> LENGTH: 23
<212> TYPE: DNA
<213> ORGANISM: Homo sapiens

<400> SEQUENCE: 782 cgcgccactg cactccagcc tgg 23

<210> SEQ ID NO 783
<211> LENGTH: 23
<212> TYPE: DNA
<213> ORGANISM: Homo sapiens

<400> SEQUENCE: 783 cccaacactt tgggaggctg agg 23

<210> SEQ ID NO 784
<211> LENGTH: 23
<212> TYPE: DNA
<213> ORGANISM: Homo sapiens

<400> SEQUENCE: 784 agaaaagaag gaaggaatgg agg 23

<210> SEQ ID NO 785
<211> LENGTH: 23
<212> TYPE: DNA
<213> ORGANISM: Homo sapiens

<400> SEQUENCE: 785 actttgggag gctgaggcag agg 23

<210> SEQ ID NO 786
<211> LENGTH: 23
<212> TYPE: DNA
<213> ORGANISM: Homo sapiens

<400> SEQUENCE: 786 acctcggcct cccaaagtgc tgg 23

<210> SEQ ID NO 787
<211> LENGTH: 23
<212> TYPE: DNA
<213> ORGANISM: Homo sapiens

<400> SEQUENCE: 787 tttccccatg ttggtcaggc tgg 23

<210> SEQ ID NO 788
<211> LENGTH: 23

<212> TYPE: DNA
<213> ORGANISM: Homo sapiens

<400> SEQUENCE: 788 ggattacagc tgtgagccac cgg 23

<210> SEQ ID NO 789
<211> LENGTH: 23
<212> TYPE: DNA
<213> ORGANISM: Homo sapiens

<400> SEQUENCE: 789 ggagtcttgc actgtcaccc agg 23

<210> SEQ ID NO 790
<211> LENGTH: 23
<212> TYPE: DNA
<213> ORGANISM: Homo sapiens

<400> SEQUENCE: 790 gaaagggaag ttggggaagg agg 23

<210> SEQ ID NO 791
<211> LENGTH: 23
<212> TYPE: DNA
<213> ORGANISM: Homo sapiens

<400> SEQUENCE: 791 ccattttaca gagaaggaaa tgg 23

<210> SEQ ID NO 792
<211> LENGTH: 23
<212> TYPE: DNA
<213> ORGANISM: Homo sapiens

<400> SEQUENCE: 792 ccatttcctt ctctgtaaaa tgg 23

<210> SEQ ID NO 793
<211> LENGTH: 23
<212> TYPE: DNA
<213> ORGANISM: Homo sapiens

<400> SEQUENCE: 793 ccagaccagc ctgaccaaca tgg 23

<210> SEQ ID NO 794
<211> LENGTH: 23
<212> TYPE: DNA
<213> ORGANISM: Homo sapiens

<400> SEQUENCE: 794 agggtcttgc tctgttgctc agg 23

<210> SEQ ID NO 795
<211> LENGTH: 23
<212> TYPE: DNA
<213> ORGANISM: Homo sapiens

<400> SEQUENCE: 795 tctaaaaatg aataaaaata agg 23

<210> SEQ ID NO 796

<211> LENGTH: 23
<212> TYPE: DNA
<213> ORGANISM: Homo sapiens

<400> SEQUENCE: 796 gctactcagg aggctgaggc agg 23

<210> SEQ ID NO 797
<211> LENGTH: 23
<212> TYPE: DNA
<213> ORGANISM: Homo sapiens

<400> SEQUENCE: 797 cgcttgaacc caggaggcag agg 23

<210> SEQ ID NO 798
<211> LENGTH: 23
<212> TYPE: DNA
<213> ORGANISM: Homo sapiens

<400> SEQUENCE: 798 cccagctact caggaggctg agg 23

<210> SEQ ID NO 799
<211> LENGTH: 23
<212> TYPE: DNA
<213> ORGANISM: Homo sapiens

<400> SEQUENCE: 799 caagaccagc ctgaccaaca tgg 23

<210> SEQ ID NO 800
<211> LENGTH: 23
<212> TYPE: DNA
<213> ORGANISM: Homo sapiens

<400> SEQUENCE: 800 agcactttgg gaggccgagg tgg 23

<210> SEQ ID NO 801
<211> LENGTH: 23
<212> TYPE: DNA
<213> ORGANISM: Homo sapiens

<400> SEQUENCE: 801 agcactttgg gaggccgagg cgg 23

<210> SEQ ID NO 802
<211> LENGTH: 23
<212> TYPE: DNA
<213> ORGANISM: Homo sapiens

<400> SEQUENCE: 802 tttttttttt agtagagacg ggg 23

<210> SEQ ID NO 803
<211> LENGTH: 23
<212> TYPE: DNA
<213> ORGANISM: Homo sapiens

<400> SEQUENCE: 803 tcttgcactg tcacccaggc tgg 23

<210> SEQ ID NO 804
<211> LENGTH: 23
<212> TYPE: DNA
<213> ORGANISM: Homo sapiens

<400> SEQUENCE: 804 cctcagcctc ctgagtagct ggg 23

<210> SEQ ID NO 805
<211> LENGTH: 23
<212> TYPE: DNA
<213> ORGANISM: Homo sapiens

<400> SEQUENCE: 805 acctgtaatc ccagctactc agg 23

<210> SEQ ID NO 806
<211> LENGTH: 23
<212> TYPE: DNA
<213> ORGANISM: Homo sapiens

<400> SEQUENCE: 806 acaaacaaaa aaaactcttt tgg 23

<210> SEQ ID NO 807
<211> LENGTH: 23
<212> TYPE: DNA
<213> ORGANISM: Homo sapiens

<400> SEQUENCE: 807 tttcgccatg ttggtcaggc tgg 23

<210> SEQ ID NO 808
<211> LENGTH: 23
<212> TYPE: DNA
<213> ORGANISM: Homo sapiens

<400> SEQUENCE: 808 tctttgtatt tttagtagag agg 23

<210> SEQ ID NO 809
<211> LENGTH: 23
<212> TYPE: DNA
<213> ORGANISM: Homo sapiens

<400> SEQUENCE: 809 ggggttgggg gcagagagag agg 23

<210> SEQ ID NO 810
<211> LENGTH: 23
<212> TYPE: DNA
<213> ORGANISM: Homo sapiens

<400> SEQUENCE: 810 cagctgtaat cccagcactt tgg 23

<210> SEQ ID NO 811
<211> LENGTH: 23
<212> TYPE: DNA
<213> ORGANISM: Homo sapiens

<400> SEQUENCE: 811 atgagaaaag aaggaaggaa tgg 23

<210> SEQ ID NO 812
<211> LENGTH: 23
<212> TYPE: DNA
<213> ORGANISM: Homo sapiens

<400> SEQUENCE: 812 agaccagcct gaccaacatg ggg 23

<210> SEQ ID NO 813
<211> LENGTH: 23
<212> TYPE: DNA
<213> ORGANISM: Homo sapiens

<400> SEQUENCE: 813 tttttttttt tagtagagac ggg 23

<210> SEQ ID NO 814
<211> LENGTH: 23
<212> TYPE: DNA
<213> ORGANISM: Homo sapiens

<400> SEQUENCE: 814 gcctgtagtc ccagctactc agg 23

<210> SEQ ID NO 815
<211> LENGTH: 23
<212> TYPE: DNA
<213> ORGANISM: Homo sapiens

<400> SEQUENCE: 815 gcactttggg aggctgaggc tgg 23

<210> SEQ ID NO 816
<211> LENGTH: 23
<212> TYPE: DNA
<213> ORGANISM: Homo sapiens

<400> SEQUENCE: 816 gcactttggg aggccaaggt ggg 23

<210> SEQ ID NO 817
<211> LENGTH: 23
<212> TYPE: DNA
<213> ORGANISM: Homo sapiens

<400> SEQUENCE: 817 gaaaagaagg aaggaatgga ggg 23

<210> SEQ ID NO 818
<211> LENGTH: 23
<212> TYPE: DNA
<213> ORGANISM: Homo sapiens

<400> SEQUENCE: 818 ctctgccccc aaccccagcc agg 23

<210> SEQ ID NO 819
<211> LENGTH: 23
<212> TYPE: DNA
<213> ORGANISM: Homo sapiens

<400> SEQUENCE: 819 cgtctgtaat cccagcactt tgg 23

<210> SEQ ID NO 820
<211> LENGTH: 23
<212> TYPE: DNA
<213> ORGANISM: Homo sapiens

<400> SEQUENCE: 820 ttttctgttt ttagtagaga tgg 23

<210> SEQ ID NO 821
<211> LENGTH: 23
<212> TYPE: DNA
<213> ORGANISM: Homo sapiens

<400> SEQUENCE: 821 tttaaaaaaa aagaaacaca ggg 23

<210> SEQ ID NO 822
<211> LENGTH: 23
<212> TYPE: DNA
<213> ORGANISM: Homo sapiens

<400> SEQUENCE: 822 tgtaatccca acactttggg agg 23

<210> SEQ ID NO 823
<211> LENGTH: 23
<212> TYPE: DNA
<213> ORGANISM: Homo sapiens

<400> SEQUENCE: 823 tcttgctctg ttgctcaggc agg 23

<210> SEQ ID NO 824
<211> LENGTH: 23
<212> TYPE: DNA
<213> ORGANISM: Homo sapiens

<400> SEQUENCE: 824 ctaaaaatga ataaaaataa ggg 23

<210> SEQ ID NO 825
<211> LENGTH: 23
<212> TYPE: DNA
<213> ORGANISM: Homo sapiens

<400> SEQUENCE: 825 cccagcactt tgggaggccg agg 23

<210> SEQ ID NO 826
<211> LENGTH: 23
<212> TYPE: DNA
<213> ORGANISM: Homo sapiens

<400> SEQUENCE: 826 agagtctcac tctgtcgccc agg 23

<210> SEQ ID NO 827
<211> LENGTH: 23
<212> TYPE: DNA
<213> ORGANISM: Homo sapiens

<400> SEQUENCE: 827 agaaggaagg aatggaggga ggg 23

<210> SEQ ID NO 828
<211> LENGTH: 23
<212> TYPE: DNA
<213> ORGANISM: Homo sapiens

<400> SEQUENCE: 828 tgtggtccca ggtactcagg agg 23

<210> SEQ ID NO 829
<211> LENGTH: 23
<212> TYPE: DNA
<213> ORGANISM: Homo sapiens

<400> SEQUENCE: 829 gcctcggcct cccaaagtgc tgg 23

<210> SEQ ID NO 830
<211> LENGTH: 23
<212> TYPE: DNA
<213> ORGANISM: Homo sapiens

<400> SEQUENCE: 830 catgccactg cactccagcc tgg 23

<210> SEQ ID NO 831
<211> LENGTH: 23
<212> TYPE: DNA
<213> ORGANISM: Homo sapiens

<400> SEQUENCE: 831 agctgtaatc ccagcacttt ggg 23

<210> SEQ ID NO 832
<211> LENGTH: 23
<212> TYPE: DNA
<213> ORGANISM: Homo sapiens

<400> SEQUENCE: 832 taaaaaaaaa aaaattagcc tgg 23

<210> SEQ ID NO 833
<211> LENGTH: 23
<212> TYPE: DNA
<213> ORGANISM: Homo sapiens

<400> SEQUENCE: 833 cctttttttt tttttgtctg agg 23

<210> SEQ ID NO 834
<211> LENGTH: 23
<212> TYPE: DNA
<213> ORGANISM: Homo sapiens

<400> SEQUENCE: 834 cctcggcctc ccaaagtgct ggg 23

<210> SEQ ID NO 835
<211> LENGTH: 23
<212> TYPE: DNA
<213> ORGANISM: Homo sapiens

<400> SEQUENCE: 835 atgccactgc actccagcct ggg 23

<210> SEQ ID NO 836
<211> LENGTH: 23
<212> TYPE: DNA
<213> ORGANISM: Homo sapiens

<400> SEQUENCE: 836 accttggcct cccaaagtgc tgg 23

<210> SEQ ID NO 837
<211> LENGTH: 23
<212> TYPE: DNA
<213> ORGANISM: Homo sapiens

<400> SEQUENCE: 837 tttgtatttt tagtagagag ggg 23

<210> SEQ ID NO 838
<211> LENGTH: 23
<212> TYPE: DNA
<213> ORGANISM: Homo sapiens

<400> SEQUENCE: 838 gtctgtaatc ccagcacttt ggg 23

<210> SEQ ID NO 839
<211> LENGTH: 23
<212> TYPE: DNA
<213> ORGANISM: Homo sapiens

<400> SEQUENCE: 839 cccagcactt tgggaggcca agg 23

<210> SEQ ID NO 840
<211> LENGTH: 23
<212> TYPE: DNA
<213> ORGANISM: Homo sapiens

<400> SEQUENCE: 840 cacctgtaat cccagcactt tgg 23

<210> SEQ ID NO 841
<211> LENGTH: 23
<212> TYPE: DNA
<213> ORGANISM: Homo sapiens

<400> SEQUENCE: 841 ttgtttgttt gtttttgaag tgg 23

<210> SEQ ID NO 842
<211> LENGTH: 23
<212> TYPE: DNA
<213> ORGANISM: Homo sapiens

<400> SEQUENCE: 842 ttgcccaggc tggagtgcag tgg 23

<210> SEQ ID NO 843
<211> LENGTH: 23
<212> TYPE: DNA
<213> ORGANISM: Homo sapiens

<400> SEQUENCE: 843 tctcactctg tcgcccaggc tgg 23

<210> SEQ ID NO 844
<211> LENGTH: 23
<212> TYPE: DNA
<213> ORGANISM: Homo sapiens

<400> SEQUENCE: 844 agcactttgg gaggccaagg tgg 23

<210> SEQ ID NO 845
<211> LENGTH: 23
<212> TYPE: DNA
<213> ORGANISM: Homo sapiens

<400> SEQUENCE: 845 tttttttttt ttagtagaga cgg 23

<210> SEQ ID NO 846
<211> LENGTH: 23
<212> TYPE: DNA
<213> ORGANISM: Homo sapiens

<400> SEQUENCE: 846 ttgtattttt agtagagaca ggg 23

<210> SEQ ID NO 847
<211> LENGTH: 23
<212> TYPE: DNA
<213> ORGANISM: Homo sapiens

<400> SEQUENCE: 847 tgtagtccca gctactcagg agg 23

<210> SEQ ID NO 848
<211> LENGTH: 23
<212> TYPE: DNA
<213> ORGANISM: Homo sapiens

<400> SEQUENCE: 848 tcacccaggc tggagtgcag tgg 23

<210> SEQ ID NO 849
<211> LENGTH: 23
<212> TYPE: DNA
<213> ORGANISM: Homo sapiens

<400> SEQUENCE: 849 ccttggcctc ccaaagtgct ggg 23

<210> SEQ ID NO 850
<211> LENGTH: 23
<212> TYPE: DNA
<213> ORGANISM: Homo sapiens

<400> SEQUENCE: 850 cctcagacaa aaaaaaaaaa agg 23

<210> SEQ ID NO 851
<211> LENGTH: 23
<212> TYPE: DNA
<213> ORGANISM: Homo sapiens

<400> SEQUENCE: 851 aggaaggaat ggagggaggg agg 23

<210> SEQ ID NO 852
<211> LENGTH: 23
<212> TYPE: DNA
<213> ORGANISM: Homo sapiens

<400> SEQUENCE: 852 aataaataaa taaaataaat agg 23

<210> SEQ ID NO 853
<211> LENGTH: 23
<212> TYPE: DNA
<213> ORGANISM: Homo sapiens

<400> SEQUENCE: 853 aaaaaaaaaa aaaattagcc ggg 23

<210> SEQ ID NO 854
<211> LENGTH: 23
<212> TYPE: DNA
<213> ORGANISM: Homo sapiens

<400> SEQUENCE: 854 tgtaatccca gcactttggg agg 23

<210> SEQ ID NO 855
<211> LENGTH: 23
<212> TYPE: DNA
<213> ORGANISM: Homo sapiens

<400> SEQUENCE: 855 tctcactctg ttgcccaggc tgg 23

<210> SEQ ID NO 856
<211> LENGTH: 23
<212> TYPE: DNA
<213> ORGANISM: Homo sapiens

<400> SEQUENCE: 856 acctgtaatc ccagcacttt ggg 23

<210> SEQ ID NO 857
<211> LENGTH: 23
<212> TYPE: DNA
<213> ORGANISM: Homo sapiens

<400> SEQUENCE: 857 aaaaaaaaaa aaaaattagc cgg 23

<210> SEQ ID NO 858
<211> LENGTH: 23
<212> TYPE: DNA
<213> ORGANISM: Homo sapiens

<400> SEQUENCE: 858 tttgtatttt tagtagagac agg 23

<210> SEQ ID NO 859
<211> LENGTH: 23
<212> TYPE: DNA

<213> ORGANISM: Homo sapiens

<400> SEQUENCE: 859 tcccaaagtg ctgggattac agg 23

<210> SEQ ID NO 860
<211> LENGTH: 23
<212> TYPE: DNA
<213> ORGANISM: Homo sapiens

<400> SEQUENCE: 860 ctttgtattt ttagtagaga ggg 23

<210> SEQ ID NO 861
<211> LENGTH: 23
<212> TYPE: DNA
<213> ORGANISM: Homo sapiens

<400> SEQUENCE: 861 tttttttttt tttttgaggc agg 23

<210> SEQ ID NO 862
<211> LENGTH: 23
<212> TYPE: DNA
<213> ORGANISM: Homo sapiens

<400> SEQUENCE: 862 tttttttttt ttttgaggca ggg 23

<210> SEQ ID NO 863
<211> LENGTH: 23
<212> TYPE: DNA
<213> ORGANISM: Homo sapiens

<400> SEQUENCE: 863 tttttttttt tttttttttg agg 23

<210> SEQ ID NO 864
<211> LENGTH: 23
<212> TYPE: DNA
<213> ORGANISM: Homo sapiens

<400> SEQUENCE: 864 aaaaaaaaaa aaaaaagtct ggg 23

<210> SEQ ID NO 865
<211> LENGTH: 23
<212> TYPE: DNA
<213> ORGANISM: Homo sapiens

<400> SEQUENCE: 865 aaaaaaaaaa aaaaaaagtc tgg 23

<210> SEQ ID NO 866
<211> LENGTH: 23
<212> TYPE: DNA
<213> ORGANISM: Homo sapiens

<400> SEQUENCE: 866 ctcacctata atggccacta agg 23

<210> SEQ ID NO 867
<211> LENGTH: 23

<212> TYPE: DNA
<213> ORGANISM: Homo sapiens

<400> SEQUENCE: 867 cacctataat ggccactaag ggg 23

<210> SEQ ID NO 868
<211> LENGTH: 23
<212> TYPE: DNA
<213> ORGANISM: Homo sapiens

<400> SEQUENCE: 868 tcacctataa tggccactaa ggg 23

<210> SEQ ID NO 869
<211> LENGTH: 23
<212> TYPE: DNA
<213> ORGANISM: Homo sapiens

<400> SEQUENCE: 869 ttccccttag tggccattat agg 23

<210> SEQ ID NO 870
<211> LENGTH: 23
<212> TYPE: DNA
<213> ORGANISM: Homo sapiens

<400> SEQUENCE: 870 cacacagaca tcactccgtc tgg 23

<210> SEQ ID NO 871
<211> LENGTH: 23
<212> TYPE: DNA
<213> ORGANISM: Homo sapiens

<400> SEQUENCE: 871 tcttcagtac tcacctataa tgg 23

<210> SEQ ID NO 872
<211> LENGTH: 23
<212> TYPE: DNA
<213> ORGANISM: Homo sapiens

<400> SEQUENCE: 872 tggggtggct actcaccaga cgg 23

<210> SEQ ID NO 873
<211> LENGTH: 23
<212> TYPE: DNA
<213> ORGANISM: Homo sapiens

<400> SEQUENCE: 873 tgaatacgat ggtgaaactg agg 23

<210> SEQ ID NO 874
<211> LENGTH: 23
<212> TYPE: DNA
<213> ORGANISM: Homo sapiens

<400> SEQUENCE: 874 tgaaactgag gtcctagctt agg 23

<210> SEQ ID NO 875

<211> LENGTH: 23
<212> TYPE: DNA
<213> ORGANISM: Homo sapiens

<400> SEQUENCE: 875 tcacatataa atgaatacga tgg 23

<210> SEQ ID NO 876
<211> LENGTH: 23
<212> TYPE: DNA
<213> ORGANISM: Homo sapiens

<400> SEQUENCE: 876 agcaagctgt gacttgttct agg 23

<210> SEQ ID NO 877
<211> LENGTH: 23
<212> TYPE: DNA
<213> ORGANISM: Homo sapiens

<400> SEQUENCE: 877 ctgaggcaga ggcctaagct agg 23

<210> SEQ ID NO 878
<211> LENGTH: 23
<212> TYPE: DNA
<213> ORGANISM: Homo sapiens

<400> SEQUENCE: 878 ataggtgagt actgaagacc agg 23

<210> SEQ ID NO 879
<211> LENGTH: 23
<212> TYPE: DNA
<213> ORGANISM: Homo sapiens

<400> SEQUENCE: 879 aaggatatct gggatgggat tgg 23

<210> SEQ ID NO 880
<211> LENGTH: 23
<212> TYPE: DNA
<213> ORGANISM: Homo sapiens

<400> SEQUENCE: 880 aggatatctg ggatgggatt ggg 23

<210> SEQ ID NO 881
<211> LENGTH: 23
<212> TYPE: DNA
<213> ORGANISM: Homo sapiens

<400> SEQUENCE: 881 gtgacttgtt ctaggtcata tgg 23

<210> SEQ ID NO 882
<211> LENGTH: 23
<212> TYPE: DNA
<213> ORGANISM: Homo sapiens

<400> SEQUENCE: 882 gggaggaaaa taaggatatc tgg 23

<210> SEQ ID NO 883
<211> LENGTH: 23
<212> TYPE: DNA
<213> ORGANISM: Homo sapiens

<400> SEQUENCE: 883 ctgaagacca ggaacttctg agg 23

<210> SEQ ID NO 884
<211> LENGTH: 23
<212> TYPE: DNA
<213> ORGANISM: Homo sapiens

<400> SEQUENCE: 884 aaaataagga tatctgggat ggg 23

<210> SEQ ID NO 885
<211> LENGTH: 23
<212> TYPE: DNA
<213> ORGANISM: Homo sapiens

<400> SEQUENCE: 885 ggaggaaaat aaggatatct ggg 23

<210> SEQ ID NO 886
<211> LENGTH: 23
<212> TYPE: DNA
<213> ORGANISM: Homo sapiens

<400> SEQUENCE: 886 tcttttctca ttccccttag tgg 23

<210> SEQ ID NO 887
<211> LENGTH: 23
<212> TYPE: DNA
<213> ORGANISM: Homo sapiens

<400> SEQUENCE: 887 gaaaataagg atatctggga tgg 23

<210> SEQ ID NO 888
<211> LENGTH: 23
<212> TYPE: DNA
<213> ORGANISM: Homo sapiens

<400> SEQUENCE: 888 caacaaaagg agagtggatg ggg 23

<210> SEQ ID NO 889
<211> LENGTH: 23
<212> TYPE: DNA
<213> ORGANISM: Homo sapiens

<400> SEQUENCE: 889 gcctctgcct cagaagttcc tgg 23

<210> SEQ ID NO 890
<211> LENGTH: 23
<212> TYPE: DNA
<213> ORGANISM: Homo sapiens

<400> SEQUENCE: 890 accaggaact tctgaggcag agg 23

<210> SEQ ID NO 891
<211> LENGTH: 23
<212> TYPE: DNA
<213> ORGANISM: Homo sapiens

<400> SEQUENCE: 891 tgtcagcaac aaaaggagag tgg 23

<210> SEQ ID NO 892
<211> LENGTH: 23
<212> TYPE: DNA
<213> ORGANISM: Homo sapiens

<400> SEQUENCE: 892 aaaggggtgt cagcaacaaa agg 23

<210> SEQ ID NO 893
<211> LENGTH: 23
<212> TYPE: DNA
<213> ORGANISM: Homo sapiens

<400> SEQUENCE: 893 aaaatctgag taattggaaa agg 23

<210> SEQ ID NO 894
<211> LENGTH: 23
<212> TYPE: DNA
<213> ORGANISM: Homo sapiens

<400> SEQUENCE: 894 caaaataaaa tctgagtaat tgg 23

<210> SEQ ID NO 895
<211> LENGTH: 23
<212> TYPE: DNA
<213> ORGANISM: Homo sapiens

<400> SEQUENCE: 895 agcaacaaaa ggagagtgga tgg 23

<210> SEQ ID NO 896
<211> LENGTH: 23
<212> TYPE: DNA
<213> ORGANISM: Homo sapiens

<400> SEQUENCE: 896 caaaaggaga gtggatgggg tgg 23

<210> SEQ ID NO 897
<211> LENGTH: 23
<212> TYPE: DNA
<213> ORGANISM: Homo sapiens

<400> SEQUENCE: 897 gcaacaaaag gagagtggat ggg 23

<210> SEQ ID NO 898
<211> LENGTH: 23
<212> TYPE: DNA
<213> ORGANISM: Homo sapiens

<400> SEQUENCE: 898 aaatctgagt aattggaaaa ggg 23

<210> SEQ ID NO 899
<211> LENGTH: 23
<212> TYPE: DNA
<213> ORGANISM: Homo sapiens

<400> SEQUENCE: 899 ctaaggggaa tgagaaaaga agg 23

<210> SEQ ID NO 900
<211> LENGTH: 23
<212> TYPE: DNA
<213> ORGANISM: Homo sapiens

<400> SEQUENCE: 900 caattactca gattttattt tgg 23

<210> SEQ ID NO 901
<211> LENGTH: 23
<212> TYPE: DNA
<213> ORGANISM: Homo sapiens

<400> SEQUENCE: 901 tggagggagg gaggaaaata agg 23

<210> SEQ ID NO 902
<211> LENGTH: 23
<212> TYPE: DNA
<213> ORGANISM: Homo sapiens

<400> SEQUENCE: 902 ggggaatgag aaaagaagga agg 23

<210> SEQ ID NO 903
<211> LENGTH: 23
<212> TYPE: DNA
<213> ORGANISM: Homo sapiens

<400> SEQUENCE: 903 aagaaggaag gaatggaggg agg 23

<210> SEQ ID NO 904
<211> LENGTH: 23
<212> TYPE: DNA
<213> ORGANISM: Homo sapiens

<400> SEQUENCE: 904 agaaaagaag gaaggaatgg agg 23

<210> SEQ ID NO 905
<211> LENGTH: 23
<212> TYPE: DNA
<213> ORGANISM: Homo sapiens

<400> SEQUENCE: 905 atgagaaaag aaggaaggaa tgg 23

<210> SEQ ID NO 906
<211> LENGTH: 23
<212> TYPE: DNA
<213> ORGANISM: Homo sapiens

<400> SEQUENCE: 906 gaaaagaagg aaggaatgga ggg 23

<210> SEQ ID NO 907
<211> LENGTH: 23
<212> TYPE: DNA
<213> ORGANISM: Homo sapiens

<400> SEQUENCE: 907 agaaggaagg aatggaggga ggg 23

<210> SEQ ID NO 908
<211> LENGTH: 23
<212> TYPE: DNA
<213> ORGANISM: Homo sapiens

<400> SEQUENCE: 908 aggaaggaat ggagggaggg agg 23

<210> SEQ ID NO 909
<211> LENGTH: 23
<212> TYPE: DNA
<213> ORGANISM: Homo sapiens

<400> SEQUENCE: 909 tacttgaacc ctagagtcgg agg 23

<210> SEQ ID NO 910
<211> LENGTH: 23
<212> TYPE: DNA
<213> ORGANISM: Homo sapiens

<400> SEQUENCE: 910 gagcattcgc tatattgccc agg 23

<210> SEQ ID NO 911
<211> LENGTH: 23
<212> TYPE: DNA
<213> ORGANISM: Homo sapiens

<400> SEQUENCE: 911 gcggtctccc tatgttgagc agg 23

<210> SEQ ID NO 912
<211> LENGTH: 23
<212> TYPE: DNA
<213> ORGANISM: Homo sapiens

<400> SEQUENCE: 912 aactgcagcc tccgactcta ggg 23

<210> SEQ ID NO 913
<211> LENGTH: 23
<212> TYPE: DNA
<213> ORGANISM: Homo sapiens

<400> SEQUENCE: 913 caagctagca ctaccacgcc tgg 23

<210> SEQ ID NO 914
<211> LENGTH: 23
<212> TYPE: DNA
<213> ORGANISM: Homo sapiens

<400> SEQUENCE: 914 ctcacctata atggccacta agg 23

<210> SEQ ID NO 915
<211> LENGTH: 23
<212> TYPE: DNA
<213> ORGANISM: Homo sapiens

<400> SEQUENCE: 915 ggggtttcac cacattagcc agg 23

<210> SEQ ID NO 916
<211> LENGTH: 23
<212> TYPE: DNA
<213> ORGANISM: Homo sapiens

<400> SEQUENCE: 916 aggtcagatc gagatcatcc tgg 23

<210> SEQ ID NO 917
<211> LENGTH: 23
<212> TYPE: DNA
<213> ORGANISM: Homo sapiens

<400> SEQUENCE: 917 ctcacctata atggccacta agg 23

<210> SEQ ID NO 918
<211> LENGTH: 23
<212> TYPE: DNA
<213> ORGANISM: Homo sapiens

<400> SEQUENCE: 918 cacctataat ggccactaag ggg 23

<210> SEQ ID NO 919
<211> LENGTH: 23
<212> TYPE: DNA
<213> ORGANISM: Homo sapiens

<400> SEQUENCE: 919 taactgcagc ctccgactct agg 23

<210> SEQ ID NO 920
<211> LENGTH: 23
<212> TYPE: DNA
<213> ORGANISM: Homo sapiens

<400> SEQUENCE: 920 tcacctataa tggccactaa ggg 23

<210> SEQ ID NO 921
<211> LENGTH: 23
<212> TYPE: DNA
<213> ORGANISM: Homo sapiens

<400> SEQUENCE: 921 taaaaataag ggtcgggtga ggg 23

<210> SEQ ID NO 922
<211> LENGTH: 23
<212> TYPE: DNA
<213> ORGANISM: Homo sapiens

<400> SEQUENCE: 922 ttccccttag tggccattat agg 23

<210> SEQ ID NO 923
<211> LENGTH: 23
<212> TYPE: DNA
<213> ORGANISM: Homo sapiens

<400> SEQUENCE: 923 gcaggttggt cttaaactac tgg 23

<210> SEQ ID NO 924
<211> LENGTH: 23
<212> TYPE: DNA
<213> ORGANISM: Homo sapiens

<400> SEQUENCE: 924 aggaaggctg ttgggtccgg tgg 23

<210> SEQ ID NO 925
<211> LENGTH: 23
<212> TYPE: DNA
<213> ORGANISM: Homo sapiens

<400> SEQUENCE: 925 tctccctatg ttgagcaggt tgg 23

<210> SEQ ID NO 926
<211> LENGTH: 23
<212> TYPE: DNA
<213> ORGANISM: Homo sapiens

<400> SEQUENCE: 926 cgagatcatc ctggctaatg tgg 23

<210> SEQ ID NO 927
<211> LENGTH: 23
<212> TYPE: DNA
<213> ORGANISM: Homo sapiens

<400> SEQUENCE: 927 ggatcttggg ctgggcgcaa tgg 23

<210> SEQ ID NO 928
<211> LENGTH: 23
<212> TYPE: DNA
<213> ORGANISM: Homo sapiens

<400> SEQUENCE: 928 gcagaggcgg gcggatcaca agg 23

<210> SEQ ID NO 929
<211> LENGTH: 23
<212> TYPE: DNA
<213> ORGANISM: Homo sapiens

<400> SEQUENCE: 929 agaccaacct gctcaacata ggg 23

<210> SEQ ID NO 930
<211> LENGTH: 23
<212> TYPE: DNA
<213> ORGANISM: Homo sapiens

<400> SEQUENCE: 930 caaaaattat ccgggcattg tgg 23

<210> SEQ ID NO 931
<211> LENGTH: 23
<212> TYPE: DNA
<213> ORGANISM: Homo sapiens

<400> SEQUENCE: 931 aattacttga accctagagt cgg 23

<210> SEQ ID NO 932
<211> LENGTH: 23
<212> TYPE: DNA
<213> ORGANISM: Homo sapiens

<400> SEQUENCE: 932 cacagggtct ttaattaatc tgg 23

<210> SEQ ID NO 933
<211> LENGTH: 23
<212> TYPE: DNA
<213> ORGANISM: Homo sapiens

<400> SEQUENCE: 933 ctccatggtg gcatgcactt tgg 23

<210> SEQ ID NO 934
<211> LENGTH: 23
<212> TYPE: DNA
<213> ORGANISM: Homo sapiens

<400> SEQUENCE: 934 aaaaataagg gtcgggtgag ggg 23

<210> SEQ ID NO 935
<211> LENGTH: 23
<212> TYPE: DNA
<213> ORGANISM: Homo sapiens

<400> SEQUENCE: 935 ctgaataaac ggggctgcct ggg 23

<210> SEQ ID NO 936
<211> LENGTH: 23
<212> TYPE: DNA
<213> ORGANISM: Homo sapiens

<400> SEQUENCE: 936 tccatggtgg catgcacttt ggg 23

<210> SEQ ID NO 937
<211> LENGTH: 23
<212> TYPE: DNA
<213> ORGANISM: Homo sapiens

<400> SEQUENCE: 937 ataaaaataa gggtcgggtg agg 23

<210> SEQ ID NO 938
<211> LENGTH: 23
<212> TYPE: DNA

<213> ORGANISM: Homo sapiens

<400> SEQUENCE: 938 cagaccagcc tgaccaacat ggg 23

<210> SEQ ID NO 939
<211> LENGTH: 23
<212> TYPE: DNA
<213> ORGANISM: Homo sapiens

<400> SEQUENCE: 939 aagaccaacc tgctcaacat agg 23

<210> SEQ ID NO 940
<211> LENGTH: 23
<212> TYPE: DNA
<213> ORGANISM: Homo sapiens

<400> SEQUENCE: 940 ctgcccctct gatttgcacc tgg 23

<210> SEQ ID NO 941
<211> LENGTH: 23
<212> TYPE: DNA
<213> ORGANISM: Homo sapiens

<400> SEQUENCE: 941 attagagttc tggctgggcg tgg 23

<210> SEQ ID NO 942
<211> LENGTH: 23
<212> TYPE: DNA
<213> ORGANISM: Homo sapiens

<400> SEQUENCE: 942 tcttcagtac tcacctataa tgg 23

<210> SEQ ID NO 943
<211> LENGTH: 23
<212> TYPE: DNA
<213> ORGANISM: Homo sapiens

<400> SEQUENCE: 943 aaaggggcag taattgtcca agg 23

<210> SEQ ID NO 944
<211> LENGTH: 23
<212> TYPE: DNA
<213> ORGANISM: Homo sapiens

<400> SEQUENCE: 944 cttaagccct gtactgtgcc agg 23

<210> SEQ ID NO 945
<211> LENGTH: 23
<212> TYPE: DNA
<213> ORGANISM: Homo sapiens

<400> SEQUENCE: 945 tcttcagtac tcacctataa tgg 23

<210> SEQ ID NO 946
<211> LENGTH: 23

<212> TYPE: DNA
<213> ORGANISM: Homo sapiens

<400> SEQUENCE: 946 tgtttgagcc caagagattg agg 23

<210> SEQ ID NO 947
<211> LENGTH: 23
<212> TYPE: DNA
<213> ORGANISM: Homo sapiens

<400> SEQUENCE: 947 tgaatacgat ggtgaaactg agg 23

<210> SEQ ID NO 948
<211> LENGTH: 23
<212> TYPE: DNA
<213> ORGANISM: Homo sapiens

<400> SEQUENCE: 948 tctcattgtg tcacccgggc tgg 23

<210> SEQ ID NO 949
<211> LENGTH: 23
<212> TYPE: DNA
<213> ORGANISM: Homo sapiens

<400> SEQUENCE: 949 gcttgtagtt ccagctgttt ggg 23

<210> SEQ ID NO 950
<211> LENGTH: 23
<212> TYPE: DNA
<213> ORGANISM: Homo sapiens

<400> SEQUENCE: 950 agcttgtagt tccagctgtt tgg 23

<210> SEQ ID NO 951
<211> LENGTH: 23
<212> TYPE: DNA
<213> ORGANISM: Homo sapiens

<400> SEQUENCE: 951 caggctactc ttgaactctt ggg 23

<210> SEQ ID NO 952
<211> LENGTH: 23
<212> TYPE: DNA
<213> ORGANISM: Homo sapiens

<400> SEQUENCE: 952 aatcaagcct tgttaaaacc agg 23

<210> SEQ ID NO 953
<211> LENGTH: 23
<212> TYPE: DNA
<213> ORGANISM: Homo sapiens

<400> SEQUENCE: 953 tcccaaagtg catgccacca tgg 23

<210> SEQ ID NO 954

<211> LENGTH: 23
<212> TYPE: DNA
<213> ORGANISM: Homo sapiens

<400> SEQUENCE: 954 agcttgtaaa cttagcactt tgg 23

<210> SEQ ID NO 955
<211> LENGTH: 23
<212> TYPE: DNA
<213> ORGANISM: Homo sapiens

<400> SEQUENCE: 955 gggcttaaga aataggatct tgg 23

<210> SEQ ID NO 956
<211> LENGTH: 23
<212> TYPE: DNA
<213> ORGANISM: Homo sapiens

<400> SEQUENCE: 956 agagccaccg tactccagcc cgg 23

<210> SEQ ID NO 957
<211> LENGTH: 23
<212> TYPE: DNA
<213> ORGANISM: Homo sapiens

<400> SEQUENCE: 957 tcacccgggc tggagtacgg tgg 23

<210> SEQ ID NO 958
<211> LENGTH: 23
<212> TYPE: DNA
<213> ORGANISM: Homo sapiens

<400> SEQUENCE: 958 gatttgatga gatctcacag cgg 23

<210> SEQ ID NO 959
<211> LENGTH: 23
<212> TYPE: DNA
<213> ORGANISM: Homo sapiens

<400> SEQUENCE: 959 tgaaactgag gtcctagctt agg 23

<210> SEQ ID NO 960
<211> LENGTH: 23
<212> TYPE: DNA
<213> ORGANISM: Homo sapiens

<400> SEQUENCE: 960 tcacatataa atgaatacga tgg 23

<210> SEQ ID NO 961
<211> LENGTH: 23
<212> TYPE: DNA
<213> ORGANISM: Homo sapiens

<400> SEQUENCE: 961 agcaagctgt gacttgttct agg 23

<210> SEQ ID NO 962
<211> LENGTH: 23
<212> TYPE: DNA
<213> ORGANISM: Homo sapiens

<400> SEQUENCE: 962 atggtggcat gcactttggg agg 23

<210> SEQ ID NO 963
<211> LENGTH: 23
<212> TYPE: DNA
<213> ORGANISM: Homo sapiens

<400> SEQUENCE: 963 ccatgttggt caggctggtc tgg 23

<210> SEQ ID NO 964
<211> LENGTH: 23
<212> TYPE: DNA
<213> ORGANISM: Homo sapiens

<400> SEQUENCE: 964 agttgccaaa acttgctatt tgg 23

<210> SEQ ID NO 965
<211> LENGTH: 23
<212> TYPE: DNA
<213> ORGANISM: Homo sapiens

<400> SEQUENCE: 965 ggcttaagaa ataggatctt ggg 23

<210> SEQ ID NO 966
<211> LENGTH: 23
<212> TYPE: DNA
<213> ORGANISM: Homo sapiens

<400> SEQUENCE: 966 ccagtttctc tctgtcgccc agg 23

<210> SEQ ID NO 967
<211> LENGTH: 23
<212> TYPE: DNA
<213> ORGANISM: Homo sapiens

<400> SEQUENCE: 967 actgaataaa cggggctgcc tgg 23

<210> SEQ ID NO 968
<211> LENGTH: 23
<212> TYPE: DNA
<213> ORGANISM: Homo sapiens

<400> SEQUENCE: 968 atcacacaaa ttaagagtac agg 23

<210> SEQ ID NO 969
<211> LENGTH: 23
<212> TYPE: DNA
<213> ORGANISM: Homo sapiens

<400> SEQUENCE: 969 caagagttca agagtagcct ggg 23

<210> SEQ ID NO 970
<211> LENGTH: 23
<212> TYPE: DNA
<213> ORGANISM: Homo sapiens

<400> SEQUENCE: 970 cactgcagcc tcaatctctt ggg 23

<210> SEQ ID NO 971
<211> LENGTH: 23
<212> TYPE: DNA
<213> ORGANISM: Homo sapiens

<400> SEQUENCE: 971 taagaaatag gatcttgggc tgg 23

<210> SEQ ID NO 972
<211> LENGTH: 23
<212> TYPE: DNA
<213> ORGANISM: Homo sapiens

<400> SEQUENCE: 972 cagtacaggg cttaagaaat agg 23

<210> SEQ ID NO 973
<211> LENGTH: 23
<212> TYPE: DNA
<213> ORGANISM: Homo sapiens

<400> SEQUENCE: 973 ctgaggcaga ggcctaagct agg 23

<210> SEQ ID NO 974
<211> LENGTH: 23
<212> TYPE: DNA
<213> ORGANISM: Homo sapiens

<400> SEQUENCE: 974 aaaataaggg tcgggtgagg ggg 23

<210> SEQ ID NO 975
<211> LENGTH: 23
<212> TYPE: DNA
<213> ORGANISM: Homo sapiens

<400> SEQUENCE: 975 tacaggaagg ctgttgggtc cgg 23

<210> SEQ ID NO 976
<211> LENGTH: 23
<212> TYPE: DNA
<213> ORGANISM: Homo sapiens

<400> SEQUENCE: 976 acagaaaaat tagccaggcg tgg 23

<210> SEQ ID NO 977
<211> LENGTH: 23
<212> TYPE: DNA
<213> ORGANISM: Homo sapiens

<400> SEQUENCE: 977 ataggtgagt actgaagacc agg 23

<210> SEQ ID NO 978
<211> LENGTH: 23
<212> TYPE: DNA
<213> ORGANISM: Homo sapiens

<400> SEQUENCE: 978 ccaagagttc aagagtagcc tgg 23

<210> SEQ ID NO 979
<211> LENGTH: 23
<212> TYPE: DNA
<213> ORGANISM: Homo sapiens

<400> SEQUENCE: 979 acagagtgag aactccatgg tgg 23

<210> SEQ ID NO 980
<211> LENGTH: 23
<212> TYPE: DNA
<213> ORGANISM: Homo sapiens

<400> SEQUENCE: 980 gcaaccacct cctgggttca agg 23

<210> SEQ ID NO 981
<211> LENGTH: 23
<212> TYPE: DNA
<213> ORGANISM: Homo sapiens

<400> SEQUENCE: 981 caaggtgggt gcatcacctg agg 23

<210> SEQ ID NO 982
<211> LENGTH: 23
<212> TYPE: DNA
<213> ORGANISM: Homo sapiens

<400> SEQUENCE: 982 aaaaaattag cctggtgtag tgg 23

<210> SEQ ID NO 983
<211> LENGTH: 23
<212> TYPE: DNA
<213> ORGANISM: Homo sapiens

<400> SEQUENCE: 983 caggcacatg ccactacacc agg 23

<210> SEQ ID NO 984
<211> LENGTH: 23
<212> TYPE: DNA
<213> ORGANISM: Homo sapiens

<400> SEQUENCE: 984 gcttgtaaac ttagcacttt ggg 23

<210> SEQ ID NO 985
<211> LENGTH: 23
<212> TYPE: DNA
<213> ORGANISM: Homo sapiens

<400> SEQUENCE: 985 taaaaccagg tgcaaatcag agg 23

<210> SEQ ID NO 986
<211> LENGTH: 23
<212> TYPE: DNA
<213> ORGANISM: Homo sapiens

<400> SEQUENCE: 986 ctggaggatt gtctgagccc agg 23

<210> SEQ ID NO 987
<211> LENGTH: 23
<212> TYPE: DNA
<213> ORGANISM: Homo sapiens

<400> SEQUENCE: 987 ggtcttgaac tcctgacctc agg 23

<210> SEQ ID NO 988
<211> LENGTH: 23
<212> TYPE: DNA
<213> ORGANISM: Homo sapiens

<400> SEQUENCE: 988 agcggcccat tttacagaga agg 23

<210> SEQ ID NO 989
<211> LENGTH: 23
<212> TYPE: DNA
<213> ORGANISM: Homo sapiens

<400> SEQUENCE: 989 tcactgcagc tttgaattcc tgg 23

<210> SEQ ID NO 990
<211> LENGTH: 23
<212> TYPE: DNA
<213> ORGANISM: Homo sapiens

<400> SEQUENCE: 990 ggctcactgc aaccacctcc tgg 23

<210> SEQ ID NO 991
<211> LENGTH: 23
<212> TYPE: DNA
<213> ORGANISM: Homo sapiens

<400> SEQUENCE: 991 cacaaattaa gagtacagga agg 23

<210> SEQ ID NO 992
<211> LENGTH: 23
<212> TYPE: DNA
<213> ORGANISM: Homo sapiens

<400> SEQUENCE: 992 tactcagcat cccaaacagc tgg 23

<210> SEQ ID NO 993
<211> LENGTH: 23
<212> TYPE: DNA
<213> ORGANISM: Homo sapiens

<400> SEQUENCE: 993 ctctccctga ttttacaaac agg 23

<210> SEQ ID NO 994
<211> LENGTH: 23
<212> TYPE: DNA
<213> ORGANISM: Homo sapiens

<400> SEQUENCE: 994 tggggtctca ttgtgtcacc cgg 23

<210> SEQ ID NO 995
<211> LENGTH: 23
<212> TYPE: DNA
<213> ORGANISM: Homo sapiens

<400> SEQUENCE: 995 aagagtacag gaaggctgtt ggg 23

<210> SEQ ID NO 996
<211> LENGTH: 23
<212> TYPE: DNA
<213> ORGANISM: Homo sapiens

<400> SEQUENCE: 996 gcctgtggtc ccaggtactc agg 23

<210> SEQ ID NO 997
<211> LENGTH: 23
<212> TYPE: DNA
<213> ORGANISM: Homo sapiens

<400> SEQUENCE: 997 gaaactgtgt ttacaaactg tgg 23

<210> SEQ ID NO 998
<211> LENGTH: 23
<212> TYPE: DNA
<213> ORGANISM: Homo sapiens

<400> SEQUENCE: 998 agctgggggg actgaataaa cgg 23

<210> SEQ ID NO 999
<211> LENGTH: 23
<212> TYPE: DNA
<213> ORGANISM: Homo sapiens

<400> SEQUENCE: 999 tgggtgcatc acctgaggtc agg 23

<210> SEQ ID NO 1000
<211> LENGTH: 23
<212> TYPE: DNA
<213> ORGANISM: Homo sapiens

<400> SEQUENCE: 1000 tttaaaatta gagttctggc tgg 23

<210> SEQ ID NO 1001
<211> LENGTH: 23
<212> TYPE: DNA
<213> ORGANISM: Homo sapiens

<400> SEQUENCE: 1001 atttgcacct ggttttaaca agg 23

<210> SEQ ID NO 1002
<211> LENGTH: 23
<212> TYPE: DNA
<213> ORGANISM: Homo sapiens

<400> SEQUENCE: 1002 catgtgcaaa accctgagcc tgg 23

<210> SEQ ID NO 1003
<211> LENGTH: 23
<212> TYPE: DNA
<213> ORGANISM: Homo sapiens

<400> SEQUENCE: 1003 gcaacagagt gagaactcca tgg 23

<210> SEQ ID NO 1004
<211> LENGTH: 23
<212> TYPE: DNA
<213> ORGANISM: Homo sapiens

<400> SEQUENCE: 1004 cactgcagct ttgaattcct ggg 23

<210> SEQ ID NO 1005
<211> LENGTH: 23
<212> TYPE: DNA
<213> ORGANISM: Homo sapiens

<400> SEQUENCE: 1005 agctgtttgg gatgctgagt agg 23

<210> SEQ ID NO 1006
<211> LENGTH: 23
<212> TYPE: DNA
<213> ORGANISM: Homo sapiens

<400> SEQUENCE: 1006 ttaaaattag agttctggct ggg 23

<210> SEQ ID NO 1007
<211> LENGTH: 23
<212> TYPE: DNA
<213> ORGANISM: Homo sapiens

<400> SEQUENCE: 1007 ccctgagcct ggcacagtac agg 23

<210> SEQ ID NO 1008
<211> LENGTH: 23
<212> TYPE: DNA
<213> ORGANISM: Homo sapiens

<400> SEQUENCE: 1008 cctgggcgac agagagaaac tgg 23

<210> SEQ ID NO 1009
<211> LENGTH: 23
<212> TYPE: DNA
<213> ORGANISM: Homo sapiens

<400> SEQUENCE: 1009 gggattttac catgttggtc agg 23

<210> SEQ ID NO 1010
<211> LENGTH: 23
<212> TYPE: DNA
<213> ORGANISM: Homo sapiens

<400> SEQUENCE: 1010 gtgacttgtt ctaggtcata tgg 23

<210> SEQ ID NO 1011
<211> LENGTH: 23
<212> TYPE: DNA
<213> ORGANISM: Homo sapiens

<400> SEQUENCE: 1011 aagaaatagg atcttgggct ggg 23

<210> SEQ ID NO 1012
<211> LENGTH: 23
<212> TYPE: DNA
<213> ORGANISM: Homo sapiens

<400> SEQUENCE: 1012 taagagtaca ggaaggctgt tgg 23

<210> SEQ ID NO 1013
<211> LENGTH: 23
<212> TYPE: DNA
<213> ORGANISM: Homo sapiens

<400> SEQUENCE: 1013 ggtgtagtgg catgtgcctg tgg 23

<210> SEQ ID NO 1014
<211> LENGTH: 23
<212> TYPE: DNA
<213> ORGANISM: Homo sapiens

<400> SEQUENCE: 1014 tgtaaactta gcactttggg agg 23

<210> SEQ ID NO 1015
<211> LENGTH: 23
<212> TYPE: DNA
<213> ORGANISM: Homo sapiens

<400> SEQUENCE: 1015 caggtgcaaa tcagaggggc agg 23

<210> SEQ ID NO 1016
<211> LENGTH: 23
<212> TYPE: DNA
<213> ORGANISM: Homo sapiens

<400> SEQUENCE: 1016 ttgggaaatg gtatgaggta ggg 23

<210> SEQ ID NO 1017
<211> LENGTH: 23
<212> TYPE: DNA

<213> ORGANISM: Homo sapiens

<400> SEQUENCE: 1017 cctgggtcct cgggcctcct ggg 23

<210> SEQ ID NO 1018
<211> LENGTH: 23
<212> TYPE: DNA
<213> ORGANISM: Homo sapiens

<400> SEQUENCE: 1018 gagccaccgt actccagccc ggg 23

<210> SEQ ID NO 1019
<211> LENGTH: 23
<212> TYPE: DNA
<213> ORGANISM: Homo sapiens

<400> SEQUENCE: 1019 agagttctgg ctgggcgtgg tgg 23

<210> SEQ ID NO 1020
<211> LENGTH: 23
<212> TYPE: DNA
<213> ORGANISM: Homo sapiens

<400> SEQUENCE: 1020 ctgaagacca ggaacttctg agg 23

<210> SEQ ID NO 1021
<211> LENGTH: 23
<212> TYPE: DNA
<213> ORGANISM: Homo sapiens

<400> SEQUENCE: 1021 tcctgagtac ctgggaccac agg 23

<210> SEQ ID NO 1022
<211> LENGTH: 23
<212> TYPE: DNA
<213> ORGANISM: Homo sapiens

<400> SEQUENCE: 1022 gggaaggagg aaaatcacct tgg 23

<210> SEQ ID NO 1023
<211> LENGTH: 23
<212> TYPE: DNA
<213> ORGANISM: Homo sapiens

<400> SEQUENCE: 1023 tgtttgtaat cccaacactt tgg 23

<210> SEQ ID NO 1024
<211> LENGTH: 23
<212> TYPE: DNA
<213> ORGANISM: Homo sapiens

<400> SEQUENCE: 1024 gctcactgca accacctcct ggg 23

<210> SEQ ID NO 1025
<211> LENGTH: 23

<212> TYPE: DNA
<213> ORGANISM: Homo sapiens

<400> SEQUENCE: 1025 tttgggaaat ggtatgaggt agg 23

<210> SEQ ID NO 1026
<211> LENGTH: 23
<212> TYPE: DNA
<213> ORGANISM: Homo sapiens

<400> SEQUENCE: 1026 cttttccaaa tagcaagttt tgg 23

<210> SEQ ID NO 1027
<211> LENGTH: 23
<212> TYPE: DNA
<213> ORGANISM: Homo sapiens

<400> SEQUENCE: 1027 aaacacagtt tcaaaaggtc agg 23

<210> SEQ ID NO 1028
<211> LENGTH: 23
<212> TYPE: DNA
<213> ORGANISM: Homo sapiens

<400> SEQUENCE: 1028 aaaccaggtg caaatcagag ggg 23

<210> SEQ ID NO 1029
<211> LENGTH: 23
<212> TYPE: DNA
<213> ORGANISM: Homo sapiens

<400> SEQUENCE: 1029 ggtctggaac tcctgacctc agg 23

<210> SEQ ID NO 1030
<211> LENGTH: 23
<212> TYPE: DNA
<213> ORGANISM: Homo sapiens

<400> SEQUENCE: 1030 aaaaccaggt gcaaatcaga ggg 23

<210> SEQ ID NO 1031
<211> LENGTH: 23
<212> TYPE: DNA
<213> ORGANISM: Homo sapiens

<400> SEQUENCE: 1031 tgggagcccc agaagatgaa agg 23

<210> SEQ ID NO 1032
<211> LENGTH: 23
<212> TYPE: DNA
<213> ORGANISM: Homo sapiens

<400> SEQUENCE: 1032 tttcatcttc tggggctccc agg 23

<210> SEQ ID NO 1033

<211> LENGTH: 23
<212> TYPE: DNA
<213> ORGANISM: Homo sapiens

<400> SEQUENCE: 1033 gcctgggtcc tcgggcctcc tgg 23

<210> SEQ ID NO 1034
<211> LENGTH: 23
<212> TYPE: DNA
<213> ORGANISM: Homo sapiens

<400> SEQUENCE: 1034 caggtgcgtc ccaccacacc cgg 23

<210> SEQ ID NO 1035
<211> LENGTH: 23
<212> TYPE: DNA
<213> ORGANISM: Homo sapiens

<400> SEQUENCE: 1035 gtttgtaatc ccaacacttt ggg 23

<210> SEQ ID NO 1036
<211> LENGTH: 23
<212> TYPE: DNA
<213> ORGANISM: Homo sapiens

<400> SEQUENCE: 1036 aatgaataaa aataagggtc ggg 23

<210> SEQ ID NO 1037
<211> LENGTH: 23
<212> TYPE: DNA
<213> ORGANISM: Homo sapiens

<400> SEQUENCE: 1037 tatttgtctt ggggtaagga agg 23

<210> SEQ ID NO 1038
<211> LENGTH: 23
<212> TYPE: DNA
<213> ORGANISM: Homo sapiens

<400> SEQUENCE: 1038 acctcagcct cctgagtacc tgg 23

<210> SEQ ID NO 1039
<211> LENGTH: 23
<212> TYPE: DNA
<213> ORGANISM: Homo sapiens

<400> SEQUENCE: 1039 tcactgcagc ctcaatctct tgg 23

<210> SEQ ID NO 1040
<211> LENGTH: 23
<212> TYPE: DNA
<213> ORGANISM: Homo sapiens

<400> SEQUENCE: 1040 tttaagtaat gagatgggag ggg 23

<210> SEQ ID NO 1041
<211> LENGTH: 23
<212> TYPE: DNA
<213> ORGANISM: Homo sapiens

<400> SEQUENCE: 1041 cctgagcctg gcacagtaca ggg 23

<210> SEQ ID NO 1042
<211> LENGTH: 23
<212> TYPE: DNA
<213> ORGANISM: Homo sapiens

<400> SEQUENCE: 1042 tgaggcagag ggatcacctg agg 23

<210> SEQ ID NO 1043
<211> LENGTH: 23
<212> TYPE: DNA
<213> ORGANISM: Homo sapiens

<400> SEQUENCE: 1043 aatatatttg tcttggggta agg 23

<210> SEQ ID NO 1044
<211> LENGTH: 23
<212> TYPE: DNA
<213> ORGANISM: Homo sapiens

<400> SEQUENCE: 1044 gcctctgcct cagaagttcc tgg 23

<210> SEQ ID NO 1045
<211> LENGTH: 23
<212> TYPE: DNA
<213> ORGANISM: Homo sapiens

<400> SEQUENCE: 1045 ccaggctact cttgaactct tgg 23

<210> SEQ ID NO 1046
<211> LENGTH: 23
<212> TYPE: DNA
<213> ORGANISM: Homo sapiens

<400> SEQUENCE: 1046 cccaggaggc ccgaggaccc agg 23

<210> SEQ ID NO 1047
<211> LENGTH: 23
<212> TYPE: DNA
<213> ORGANISM: Homo sapiens

<400> SEQUENCE: 1047 gggagcccca gaagatgaaa ggg 23

<210> SEQ ID NO 1048
<211> LENGTH: 23
<212> TYPE: DNA
<213> ORGANISM: Homo sapiens

<400> SEQUENCE: 1048 gtgtcacccg ggctggagta cgg 23

<210> SEQ ID NO 1049
<211> LENGTH: 23
<212> TYPE: DNA
<213> ORGANISM: Homo sapiens

<400> SEQUENCE: 1049 caggcacaca ccacaatgcc cgg 23

<210> SEQ ID NO 1050
<211> LENGTH: 23
<212> TYPE: DNA
<213> ORGANISM: Homo sapiens

<400> SEQUENCE: 1050 ctcaggtgat gcacccacct tgg 23

<210> SEQ ID NO 1051
<211> LENGTH: 23
<212> TYPE: DNA
<213> ORGANISM: Homo sapiens

<400> SEQUENCE: 1051 tttttaagta atgagatggg agg 23

<210> SEQ ID NO 1052
<211> LENGTH: 23
<212> TYPE: DNA
<213> ORGANISM: Homo sapiens

<400> SEQUENCE: 1052 cagagggatc acctgaggtc agg 23

<210> SEQ ID NO 1053
<211> LENGTH: 23
<212> TYPE: DNA
<213> ORGANISM: Homo sapiens

<400> SEQUENCE: 1053 caggagaatc ccttgaaccc agg 23

<210> SEQ ID NO 1054
<211> LENGTH: 23
<212> TYPE: DNA
<213> ORGANISM: Homo sapiens

<400> SEQUENCE: 1054 gctatttaaa attagagttc tgg 23

<210> SEQ ID NO 1055
<211> LENGTH: 23
<212> TYPE: DNA
<213> ORGANISM: Homo sapiens

<400> SEQUENCE: 1055 accaggaact tctgaggcag agg 23

<210> SEQ ID NO 1056
<211> LENGTH: 23
<212> TYPE: DNA
<213> ORGANISM: Homo sapiens

<400> SEQUENCE: 1056 cttagcactt tgggaggccg agg 23

<210> SEQ ID NO 1057
<211> LENGTH: 23
<212> TYPE: DNA
<213> ORGANISM: Homo sapiens

<400> SEQUENCE: 1057 catcttctgg ggctcccagg agg 23

<210> SEQ ID NO 1058
<211> LENGTH: 23
<212> TYPE: DNA
<213> ORGANISM: Homo sapiens

<400> SEQUENCE: 1058 aaaaattagc cgggtgtggt ggg 23

<210> SEQ ID NO 1059
<211> LENGTH: 23
<212> TYPE: DNA
<213> ORGANISM: Homo sapiens

<400> SEQUENCE: 1059 acggggctgc ctgggtcctc ggg 23

<210> SEQ ID NO 1060
<211> LENGTH: 23
<212> TYPE: DNA
<213> ORGANISM: Homo sapiens

<400> SEQUENCE: 1060 atgctaaaag acaaaactag agg 23

<210> SEQ ID NO 1061
<211> LENGTH: 23
<212> TYPE: DNA
<213> ORGANISM: Homo sapiens

<400> SEQUENCE: 1061 aattaatctg gaagttgttt tgg 23

<210> SEQ ID NO 1062
<211> LENGTH: 23
<212> TYPE: DNA
<213> ORGANISM: Homo sapiens

<400> SEQUENCE: 1062 ttgttttggg aaatggtatg agg 23

<210> SEQ ID NO 1063
<211> LENGTH: 23
<212> TYPE: DNA
<213> ORGANISM: Homo sapiens

<400> SEQUENCE: 1063 attaatctgg aagttgtttt ggg 23

<210> SEQ ID NO 1064
<211> LENGTH: 23
<212> TYPE: DNA
<213> ORGANISM: Homo sapiens

<400> SEQUENCE: 1064 ttaagtaatg agatgggagg ggg 23

<210> SEQ ID NO 1065
<211> LENGTH: 23
<212> TYPE: DNA
<213> ORGANISM: Homo sapiens

<400> SEQUENCE: 1065 agtttcctgt ttgtaaaatc agg 23

<210> SEQ ID NO 1066
<211> LENGTH: 23
<212> TYPE: DNA
<213> ORGANISM: Homo sapiens

<400> SEQUENCE: 1066 aaaaaaaaat tagccgggtg tgg 23

<210> SEQ ID NO 1067
<211> LENGTH: 23
<212> TYPE: DNA
<213> ORGANISM: Homo sapiens

<400> SEQUENCE: 1067 caaccacctc ctgggttcaa ggg 23

<210> SEQ ID NO 1068
<211> LENGTH: 23
<212> TYPE: DNA
<213> ORGANISM: Homo sapiens

<400> SEQUENCE: 1068 gagatgggat tttaccatgt tgg 23

<210> SEQ ID NO 1069
<211> LENGTH: 23
<212> TYPE: DNA
<213> ORGANISM: Homo sapiens

<400> SEQUENCE: 1069 taataaaatt acagagttct ggg 23

<210> SEQ ID NO 1070
<211> LENGTH: 23
<212> TYPE: DNA
<213> ORGANISM: Homo sapiens

<400> SEQUENCE: 1070 cgaggtggga ggattgcttg agg 23

<210> SEQ ID NO 1071
<211> LENGTH: 23
<212> TYPE: DNA
<213> ORGANISM: Homo sapiens

<400> SEQUENCE: 1071 aacggggctg cctgggtcct cgg 23

<210> SEQ ID NO 1072
<211> LENGTH: 23
<212> TYPE: DNA
<213> ORGANISM: Homo sapiens

<400> SEQUENCE: 1072 tggggctccc aggaggcccg agg 23

<210> SEQ ID NO 1073
<211> LENGTH: 23
<212> TYPE: DNA
<213> ORGANISM: Homo sapiens

<400> SEQUENCE: 1073 aaaaaattag ccgggtgtgg tgg 23

<210> SEQ ID NO 1074
<211> LENGTH: 23
<212> TYPE: DNA
<213> ORGANISM: Homo sapiens

<400> SEQUENCE: 1074 gcatgcactt tgggaggctg agg 23

<210> SEQ ID NO 1075
<211> LENGTH: 23
<212> TYPE: DNA
<213> ORGANISM: Homo sapiens

<400> SEQUENCE: 1075 gagacagggt ttccccatgt tgg 23

<210> SEQ ID NO 1076
<211> LENGTH: 23
<212> TYPE: DNA
<213> ORGANISM: Homo sapiens

<400> SEQUENCE: 1076 tagaggacaa atgatagtac tgg 23

<210> SEQ ID NO 1077
<211> LENGTH: 23
<212> TYPE: DNA
<213> ORGANISM: Homo sapiens

<400> SEQUENCE: 1077 aacttccctt tcatcttctg ggg 23

<210> SEQ ID NO 1078
<211> LENGTH: 23
<212> TYPE: DNA
<213> ORGANISM: Homo sapiens

<400> SEQUENCE: 1078 ccaacttccc tttcatcttc tgg 23

<210> SEQ ID NO 1079
<211> LENGTH: 23
<212> TYPE: DNA
<213> ORGANISM: Homo sapiens

<400> SEQUENCE: 1079 gcaccactgc actccggcct ggg 23

<210> SEQ ID NO 1080
<211> LENGTH: 23
<212> TYPE: DNA
<213> ORGANISM: Homo sapiens

<400> SEQUENCE: 1080 ggagtgcagt ggtgcaatct cgg 23

<210> SEQ ID NO 1081
<211> LENGTH: 23
<212> TYPE: DNA
<213> ORGANISM: Homo sapiens

<400> SEQUENCE: 1081 atactatatt gcaaatattc tgg 23

<210> SEQ ID NO 1082
<211> LENGTH: 23
<212> TYPE: DNA
<213> ORGANISM: Homo sapiens

<400> SEQUENCE: 1082 ttgctcaggc aggagtgcag tgg 23

<210> SEQ ID NO 1083
<211> LENGTH: 23
<212> TYPE: DNA
<213> ORGANISM: Homo sapiens

<400> SEQUENCE: 1083 caacttccct ttcatcttct ggg 23

<210> SEQ ID NO 1084
<211> LENGTH: 23
<212> TYPE: DNA
<213> ORGANISM: Homo sapiens

<400> SEQUENCE: 1084 tggcatgtgc ctgtggtccc agg 23

<210> SEQ ID NO 1085
<211> LENGTH: 23
<212> TYPE: DNA
<213> ORGANISM: Homo sapiens

<400> SEQUENCE: 1085 cagaagatga aagggaagtt ggg 23

<210> SEQ ID NO 1086
<211> LENGTH: 23
<212> TYPE: DNA
<213> ORGANISM: Homo sapiens

<400> SEQUENCE: 1086 ggggtctcat tgtgtcaccc ggg 23

<210> SEQ ID NO 1087
<211> LENGTH: 23
<212> TYPE: DNA
<213> ORGANISM: Homo sapiens

<400> SEQUENCE: 1087 ataataaaat tacagagttc tgg 23

<210> SEQ ID NO 1088
<211> LENGTH: 23
<212> TYPE: DNA
<213> ORGANISM: Homo sapiens

<400> SEQUENCE: 1088 gcctcagcct cccaaagtgt tgg 23

<210> SEQ ID NO 1089
<211> LENGTH: 23
<212> TYPE: DNA
<213> ORGANISM: Homo sapiens

<400> SEQUENCE: 1089 ctggaagttg ttttgggaaa tgg 23

<210> SEQ ID NO 1090
<211> LENGTH: 23
<212> TYPE: DNA
<213> ORGANISM: Homo sapiens

<400> SEQUENCE: 1090 agggtttccc catgttggtc agg 23

<210> SEQ ID NO 1091
<211> LENGTH: 23
<212> TYPE: DNA
<213> ORGANISM: Homo sapiens

<400> SEQUENCE: 1091 aaaaaaaagt ctgggtgtgg tgg 23

<210> SEQ ID NO 1092
<211> LENGTH: 23
<212> TYPE: DNA
<213> ORGANISM: Homo sapiens

<400> SEQUENCE: 1092 gtttcctgtt tgtaaaatca ggg 23

<210> SEQ ID NO 1093
<211> LENGTH: 23
<212> TYPE: DNA
<213> ORGANISM: Homo sapiens

<400> SEQUENCE: 1093 ttgtaaaatc agggagagac tgg 23

<210> SEQ ID NO 1094
<211> LENGTH: 23
<212> TYPE: DNA
<213> ORGANISM: Homo sapiens

<400> SEQUENCE: 1094 caagagaatc gcttgaaccc agg 23

<210> SEQ ID NO 1095
<211> LENGTH: 23
<212> TYPE: DNA
<213> ORGANISM: Homo sapiens

<400> SEQUENCE: 1095 acaacttaag aaatttgaag tgg 23

<210> SEQ ID NO 1096
<211> LENGTH: 23
<212> TYPE: DNA

<213> ORGANISM: Homo sapiens

<400> SEQUENCE: 1096 agtaatgaga tgggaggggg cgg 23

<210> SEQ ID NO 1097
<211> LENGTH: 23
<212> TYPE: DNA
<213> ORGANISM: Homo sapiens

<400> SEQUENCE: 1097 tttgtaaaca cagtttcaaa agg 23

<210> SEQ ID NO 1098
<211> LENGTH: 23
<212> TYPE: DNA
<213> ORGANISM: Homo sapiens

<400> SEQUENCE: 1098 gatgaaaggg aagttgggga agg 23

<210> SEQ ID NO 1099
<211> LENGTH: 23
<212> TYPE: DNA
<213> ORGANISM: Homo sapiens

<400> SEQUENCE: 1099 ggaaactgag gctaagaaag ggg 23

<210> SEQ ID NO 1100
<211> LENGTH: 23
<212> TYPE: DNA
<213> ORGANISM: Homo sapiens

<400> SEQUENCE: 1100 gcctcagcct cctgagtagc tgg 23

<210> SEQ ID NO 1101
<211> LENGTH: 23
<212> TYPE: DNA
<213> ORGANISM: Homo sapiens

<400> SEQUENCE: 1101 ttatttttaa gtaatgagat ggg 23

<210> SEQ ID NO 1102
<211> LENGTH: 23
<212> TYPE: DNA
<213> ORGANISM: Homo sapiens

<400> SEQUENCE: 1102 aggaaactga ggctaagaaa ggg 23

<210> SEQ ID NO 1103
<211> LENGTH: 23
<212> TYPE: DNA
<213> ORGANISM: Homo sapiens

<400> SEQUENCE: 1103 tactgcaacc tctgcctcct ggg 23

<210> SEQ ID NO 1104
<211> LENGTH: 23

<212> TYPE: DNA
<213> ORGANISM: Homo sapiens

<400> SEQUENCE: 1104 aatcccttga acccaggagg tgg 23

<210> SEQ ID NO 1105
<211> LENGTH: 23
<212> TYPE: DNA
<213> ORGANISM: Homo sapiens

<400> SEQUENCE: 1105 aaaagtattc aaaaaactat agg 23

<210> SEQ ID NO 1106
<211> LENGTH: 23
<212> TYPE: DNA
<213> ORGANISM: Homo sapiens

<400> SEQUENCE: 1106 tcctgagtag ctgggattac agg 23

<210> SEQ ID NO 1107
<211> LENGTH: 23
<212> TYPE: DNA
<213> ORGANISM: Homo sapiens

<400> SEQUENCE: 1107 ccctgtactg tgccaggctc agg 23

<210> SEQ ID NO 1108
<211> LENGTH: 23
<212> TYPE: DNA
<213> ORGANISM: Homo sapiens

<400> SEQUENCE: 1108 gcctctgcct cccaaagtgc tgg 23

<210> SEQ ID NO 1109
<211> LENGTH: 23
<212> TYPE: DNA
<213> ORGANISM: Homo sapiens

<400> SEQUENCE: 1109 ccagaagatg aaagggaagt tgg 23

<210> SEQ ID NO 1110
<211> LENGTH: 23
<212> TYPE: DNA
<213> ORGANISM: Homo sapiens

<400> SEQUENCE: 1110 ctttgggagg cagaggcggg cgg 23

<210> SEQ ID NO 1111
<211> LENGTH: 23
<212> TYPE: DNA
<213> ORGANISM: Homo sapiens

<400> SEQUENCE: 1111 ataggaaaat atatttgtct tgg 23

<210> SEQ ID NO 1112

<211> LENGTH: 23
<212> TYPE: DNA
<213> ORGANISM: Homo sapiens

<400> SEQUENCE: 1112 aggaaaatat atttgtcttg ggg 23

<210> SEQ ID NO 1113
<211> LENGTH: 23
<212> TYPE: DNA
<213> ORGANISM: Homo sapiens

<400> SEQUENCE: 1113 cctcagcctc ctgagtacct ggg 23

<210> SEQ ID NO 1114
<211> LENGTH: 23
<212> TYPE: DNA
<213> ORGANISM: Homo sapiens

<400> SEQUENCE: 1114 attattttta agtaatgaga tgg 23

<210> SEQ ID NO 1115
<211> LENGTH: 23
<212> TYPE: DNA
<213> ORGANISM: Homo sapiens

<400> SEQUENCE: 1115 caggaaactg aggctaagaa agg 23

<210> SEQ ID NO 1116
<211> LENGTH: 23
<212> TYPE: DNA
<213> ORGANISM: Homo sapiens

<400> SEQUENCE: 1116 cctcagcctc ccaaagtgtt ggg 23

<210> SEQ ID NO 1117
<211> LENGTH: 23
<212> TYPE: DNA
<213> ORGANISM: Homo sapiens

<400> SEQUENCE: 1117 taggaaaata tatttgtctt ggg 23

<210> SEQ ID NO 1118
<211> LENGTH: 23
<212> TYPE: DNA
<213> ORGANISM: Homo sapiens

<400> SEQUENCE: 1118 ttttaagtaa tgagatggga ggg 23

<210> SEQ ID NO 1119
<211> LENGTH: 23
<212> TYPE: DNA
<213> ORGANISM: Homo sapiens

<400> SEQUENCE: 1119 agaagatgaa agggaagttg ggg 23

<210> SEQ ID NO 1120
<211> LENGTH: 23
<212> TYPE: DNA
<213> ORGANISM: Homo sapiens

<400> SEQUENCE: 1120 gagaatcgct tgaacccagg agg 23

<210> SEQ ID NO 1121
<211> LENGTH: 23
<212> TYPE: DNA
<213> ORGANISM: Homo sapiens

<400> SEQUENCE: 1121 tgcaccactg cactccggcc tgg 23

<210> SEQ ID NO 1122
<211> LENGTH: 23
<212> TYPE: DNA
<213> ORGANISM: Homo sapiens

<400> SEQUENCE: 1122 atataaaata aaaagttgta tgg 23

<210> SEQ ID NO 1123
<211> LENGTH: 23
<212> TYPE: DNA
<213> ORGANISM: Homo sapiens

<400> SEQUENCE: 1123 ttactgcaac ctctgcctcc tgg 23

<210> SEQ ID NO 1124
<211> LENGTH: 23
<212> TYPE: DNA
<213> ORGANISM: Homo sapiens

<400> SEQUENCE: 1124 gagaatccct tgaacccagg agg 23

<210> SEQ ID NO 1125
<211> LENGTH: 23
<212> TYPE: DNA
<213> ORGANISM: Homo sapiens

<400> SEQUENCE: 1125 tttctctctg tcgcccaggc cgg 23

<210> SEQ ID NO 1126
<211> LENGTH: 23
<212> TYPE: DNA
<213> ORGANISM: Homo sapiens

<400> SEQUENCE: 1126 aaaaaaaaaa agtctgggtg tgg 23

<210> SEQ ID NO 1127
<211> LENGTH: 23
<212> TYPE: DNA
<213> ORGANISM: Homo sapiens

<400> SEQUENCE: 1127 attttacaaa caggaaactg agg 23

<210> SEQ ID NO 1128
<211> LENGTH: 23
<212> TYPE: DNA
<213> ORGANISM: Homo sapiens

<400> SEQUENCE: 1128 gcactttggg aggcagaggc ggg 23

<210> SEQ ID NO 1129
<211> LENGTH: 23
<212> TYPE: DNA
<213> ORGANISM: Homo sapiens

<400> SEQUENCE: 1129 tttctgtttt tagtagagat ggg 23

<210> SEQ ID NO 1130
<211> LENGTH: 23
<212> TYPE: DNA
<213> ORGANISM: Homo sapiens

<400> SEQUENCE: 1130 tgtaatccca gctactcagg agg 23

<210> SEQ ID NO 1131
<211> LENGTH: 23
<212> TYPE: DNA
<213> ORGANISM: Homo sapiens

<400> SEQUENCE: 1131 taaaaataca aaaattatcc ggg 23

<210> SEQ ID NO 1132
<211> LENGTH: 23
<212> TYPE: DNA
<213> ORGANISM: Homo sapiens

<400> SEQUENCE: 1132 agcactttgg gaggcagagg cgg 23

<210> SEQ ID NO 1133
<211> LENGTH: 23
<212> TYPE: DNA
<213> ORGANISM: Homo sapiens

<400> SEQUENCE: 1133 ttttattcat ttttagagat ggg 23

<210> SEQ ID NO 1134
<211> LENGTH: 23
<212> TYPE: DNA
<213> ORGANISM: Homo sapiens

<400> SEQUENCE: 1134 aaatgaataa aaataagggt cgg 23

<210> SEQ ID NO 1135
<211> LENGTH: 23
<212> TYPE: DNA
<213> ORGANISM: Homo sapiens

<400> SEQUENCE: 1135 cccagcactt tgggaggcag agg 23

<210> SEQ ID NO 1136
<211> LENGTH: 23
<212> TYPE: DNA
<213> ORGANISM: Homo sapiens

<400> SEQUENCE: 1136 tcctgagtag ctgggactac agg 23

<210> SEQ ID NO 1137
<211> LENGTH: 23
<212> TYPE: DNA
<213> ORGANISM: Homo sapiens

<400> SEQUENCE: 1137 tttattcatt tttagagatg ggg 23

<210> SEQ ID NO 1138
<211> LENGTH: 23
<212> TYPE: DNA
<213> ORGANISM: Homo sapiens

<400> SEQUENCE: 1138 ctttgggagg ctgaggcaga ggg 23

<210> SEQ ID NO 1139
<211> LENGTH: 23
<212> TYPE: DNA
<213> ORGANISM: Homo sapiens

<400> SEQUENCE: 1139 gagattgcac cactgcactc cgg 23

<210> SEQ ID NO 1140
<211> LENGTH: 23
<212> TYPE: DNA
<213> ORGANISM: Homo sapiens

<400> SEQUENCE: 1140 ctttgggagg ccgaggtggg agg 23

<210> SEQ ID NO 1141
<211> LENGTH: 23
<212> TYPE: DNA
<213> ORGANISM: Homo sapiens

<400> SEQUENCE: 1141 ctcaagcaat cctcccacct cgg 23

<210> SEQ ID NO 1142
<211> LENGTH: 23
<212> TYPE: DNA
<213> ORGANISM: Homo sapiens

<400> SEQUENCE: 1142 ctttgggagg ccgaggtggg agg 23

<210> SEQ ID NO 1143
<211> LENGTH: 23
<212> TYPE: DNA
<213> ORGANISM: Homo sapiens

<400> SEQUENCE: 1143 ctcaagcaat cctcccacct cgg 23

<210> SEQ ID NO 1144
<211> LENGTH: 23
<212> TYPE: DNA
<213> ORGANISM: Homo sapiens

<400> SEQUENCE: 1144 taaaaacaga aaaattagcc agg 23

<210> SEQ ID NO 1145
<211> LENGTH: 23
<212> TYPE: DNA
<213> ORGANISM: Homo sapiens

<400> SEQUENCE: 1145 tatttggaaa agaaaaatgt tgg 23

<210> SEQ ID NO 1146
<211> LENGTH: 23
<212> TYPE: DNA
<213> ORGANISM: Homo sapiens

<400> SEQUENCE: 1146 aggtactcag gaggctgagg tgg 23

<210> SEQ ID NO 1147
<211> LENGTH: 23
<212> TYPE: DNA
<213> ORGANISM: Homo sapiens

<400> SEQUENCE: 1147 cccaggtact caggaggctg agg 23

<210> SEQ ID NO 1148
<211> LENGTH: 23
<212> TYPE: DNA
<213> ORGANISM: Homo sapiens

<400> SEQUENCE: 1148 catttccttc tctgtaaaat ggg 23

<210> SEQ ID NO 1149
<211> LENGTH: 23
<212> TYPE: DNA
<213> ORGANISM: Homo sapiens

<400> SEQUENCE: 1149 ctaaaaatac aaaaattatc cgg 23

<210> SEQ ID NO 1150
<211> LENGTH: 23
<212> TYPE: DNA
<213> ORGANISM: Homo sapiens

<400> SEQUENCE: 1150 tcgcccaggc cggagtgcag tgg 23

<210> SEQ ID NO 1151
<211> LENGTH: 23
<212> TYPE: DNA
<213> ORGANISM: Homo sapiens

<400> SEQUENCE: 1151 ttttaccatg ttggtcaggc tgg 23

<210> SEQ ID NO 1152
<211> LENGTH: 23
<212> TYPE: DNA
<213> ORGANISM: Homo sapiens

<400> SEQUENCE: 1152 tactcaggag gctgaggtgg agg 23

<210> SEQ ID NO 1153
<211> LENGTH: 23
<212> TYPE: DNA
<213> ORGANISM: Homo sapiens

<400> SEQUENCE: 1153 agtgctggga ttacagacgt tgg 23

<210> SEQ ID NO 1154
<211> LENGTH: 23
<212> TYPE: DNA
<213> ORGANISM: Homo sapiens

<400> SEQUENCE: 1154 cctctgcctc ccaaagtgct ggg 23

<210> SEQ ID NO 1155
<211> LENGTH: 23
<212> TYPE: DNA
<213> ORGANISM: Homo sapiens

<400> SEQUENCE: 1155 ctttgggagg ctgaggctgg agg 23

<210> SEQ ID NO 1156
<211> LENGTH: 23
<212> TYPE: DNA
<213> ORGANISM: Homo sapiens

<400> SEQUENCE: 1156 gtttaaaaaa aaagaaacac agg 23

<210> SEQ ID NO 1157
<211> LENGTH: 23
<212> TYPE: DNA
<213> ORGANISM: Homo sapiens

<400> SEQUENCE: 1157 gcgccactgc actccagcct ggg 23

<210> SEQ ID NO 1158
<211> LENGTH: 23
<212> TYPE: DNA
<213> ORGANISM: Homo sapiens

<400> SEQUENCE: 1158 cgcgccactg cactccagcc tgg 23

<210> SEQ ID NO 1159
<211> LENGTH: 23
<212> TYPE: DNA
<213> ORGANISM: Homo sapiens

<400> SEQUENCE: 1159 tttttattca tttttagaga tgg 23

<210> SEQ ID NO 1160
<211> LENGTH: 23
<212> TYPE: DNA
<213> ORGANISM: Homo sapiens

<400> SEQUENCE: 1160 actttgggag gctgaggcag agg 23

<210> SEQ ID NO 1161
<211> LENGTH: 23
<212> TYPE: DNA
<213> ORGANISM: Homo sapiens

<400> SEQUENCE: 1161 cccaacactt tgggaggctg agg 23

<210> SEQ ID NO 1162
<211> LENGTH: 23
<212> TYPE: DNA
<213> ORGANISM: Homo sapiens

<400> SEQUENCE: 1162 acctcggcct cccaaagtgc tgg 23

<210> SEQ ID NO 1163
<211> LENGTH: 23
<212> TYPE: DNA
<213> ORGANISM: Homo sapiens

<400> SEQUENCE: 1163 agggtcttgc tctgttgctc agg 23

<210> SEQ ID NO 1164
<211> LENGTH: 23
<212> TYPE: DNA
<213> ORGANISM: Homo sapiens

<400> SEQUENCE: 1164 gaaagggaag ttggggaagg agg 23

<210> SEQ ID NO 1165
<211> LENGTH: 23
<212> TYPE: DNA
<213> ORGANISM: Homo sapiens

<400> SEQUENCE: 1165 ggagtcttgc actgtcaccc agg 23

<210> SEQ ID NO 1166
<211> LENGTH: 23
<212> TYPE: DNA
<213> ORGANISM: Homo sapiens

<400> SEQUENCE: 1166 ccatttcctt ctctgtaaaa tgg 23

<210> SEQ ID NO 1167
<211> LENGTH: 23
<212> TYPE: DNA
<213> ORGANISM: Homo sapiens

<400> SEQUENCE: 1167 ccattttaca gagaaggaaa tgg 23

<210> SEQ ID NO 1168
<211> LENGTH: 23
<212> TYPE: DNA
<213> ORGANISM: Homo sapiens

<400> SEQUENCE: 1168 ccagaccagc ctgaccaaca tgg 23

<210> SEQ ID NO 1169
<211> LENGTH: 23
<212> TYPE: DNA
<213> ORGANISM: Homo sapiens

<400> SEQUENCE: 1169 tttccccatg ttggtcaggc tgg 23

<210> SEQ ID NO 1170
<211> LENGTH: 23
<212> TYPE: DNA
<213> ORGANISM: Homo sapiens

<400> SEQUENCE: 1170 ggattacagc tgtgagccac cgg 23

<210> SEQ ID NO 1171
<211> LENGTH: 23
<212> TYPE: DNA
<213> ORGANISM: Homo sapiens

<400> SEQUENCE: 1171 agcactttgg gaggccgagg tgg 23

<210> SEQ ID NO 1172
<211> LENGTH: 23
<212> TYPE: DNA
<213> ORGANISM: Homo sapiens

<400> SEQUENCE: 1172 cgcttgaacc caggaggcag agg 23

<210> SEQ ID NO 1173
<211> LENGTH: 23
<212> TYPE: DNA
<213> ORGANISM: Homo sapiens

<400> SEQUENCE: 1173 cccagctact caggaggctg agg 23

<210> SEQ ID NO 1174
<211> LENGTH: 23
<212> TYPE: DNA
<213> ORGANISM: Homo sapiens

<400> SEQUENCE: 1174 tctaaaaatg aataaaaata agg 23

<210> SEQ ID NO 1175
<211> LENGTH: 23
<212> TYPE: DNA

<213> ORGANISM: Homo sapiens

<400> SEQUENCE: 1175 gctactcagg aggctgaggc agg 23

<210> SEQ ID NO 1176
<211> LENGTH: 23
<212> TYPE: DNA
<213> ORGANISM: Homo sapiens

<400> SEQUENCE: 1176 caagaccagc ctgaccaaca tgg 23

<210> SEQ ID NO 1177
<211> LENGTH: 23
<212> TYPE: DNA
<213> ORGANISM: Homo sapiens

<400> SEQUENCE: 1177 acaaacaaaa aaaactcttt tgg 23

<210> SEQ ID NO 1178
<211> LENGTH: 23
<212> TYPE: DNA
<213> ORGANISM: Homo sapiens

<400> SEQUENCE: 1178 cctcagcctc ctgagtagct ggg 23

<210> SEQ ID NO 1179
<211> LENGTH: 23
<212> TYPE: DNA
<213> ORGANISM: Homo sapiens

<400> SEQUENCE: 1179 acctgtaatc ccagctactc agg 23

<210> SEQ ID NO 1180
<211> LENGTH: 23
<212> TYPE: DNA
<213> ORGANISM: Homo sapiens

<400> SEQUENCE: 1180 tcttgcactg tcacccaggc tgg 23

<210> SEQ ID NO 1181
<211> LENGTH: 23
<212> TYPE: DNA
<213> ORGANISM: Homo sapiens

<400> SEQUENCE: 1181 tttttttttt agtagagacg ggg 23

<210> SEQ ID NO 1182
<211> LENGTH: 23
<212> TYPE: DNA
<213> ORGANISM: Homo sapiens

<400> SEQUENCE: 1182 cctcagcctc ctgagtagct ggg 23

<210> SEQ ID NO 1183
<211> LENGTH: 23

<212> TYPE: DNA
<213> ORGANISM: Homo sapiens

<400> SEQUENCE: 1183 agaccagcct gaccaacatg ggg 23

<210> SEQ ID NO 1184
<211> LENGTH: 23
<212> TYPE: DNA
<213> ORGANISM: Homo sapiens

<400> SEQUENCE: 1184 cagctgtaat cccagcactt tgg 23

<210> SEQ ID NO 1185
<211> LENGTH: 23
<212> TYPE: DNA
<213> ORGANISM: Homo sapiens

<400> SEQUENCE: 1185 tttttttttt tagtagagac ggg 23

<210> SEQ ID NO 1186
<211> LENGTH: 23
<212> TYPE: DNA
<213> ORGANISM: Homo sapiens

<400> SEQUENCE: 1186 gcactttggg aggctgaggc tgg 23

<210> SEQ ID NO 1187
<211> LENGTH: 23
<212> TYPE: DNA
<213> ORGANISM: Homo sapiens

<400> SEQUENCE: 1187 gcctgtagtc ccagctactc agg 23

<210> SEQ ID NO 1188
<211> LENGTH: 23
<212> TYPE: DNA
<213> ORGANISM: Homo sapiens

<400> SEQUENCE: 1188 gcactttggg aggccaaggt ggg 23

<210> SEQ ID NO 1189
<211> LENGTH: 23
<212> TYPE: DNA
<213> ORGANISM: Homo sapiens

<400> SEQUENCE: 1189 cgtctgtaat cccagcactt tgg 23

<210> SEQ ID NO 1190
<211> LENGTH: 23
<212> TYPE: DNA
<213> ORGANISM: Homo sapiens

<400> SEQUENCE: 1190 tcttgctctg ttgctcaggc agg 23

<210> SEQ ID NO 1191

<211> LENGTH: 23
<212> TYPE: DNA
<213> ORGANISM: Homo sapiens

<400> SEQUENCE: 1191 tgtaatccca acactttggg agg 23

<210> SEQ ID NO 1192
<211> LENGTH: 23
<212> TYPE: DNA
<213> ORGANISM: Homo sapiens

<400> SEQUENCE: 1192 ctaaaaatga ataaaaataa ggg 23

<210> SEQ ID NO 1193
<211> LENGTH: 23
<212> TYPE: DNA
<213> ORGANISM: Homo sapiens

<400> SEQUENCE: 1193 ttttctgttt ttagtagaga tgg 23

<210> SEQ ID NO 1194
<211> LENGTH: 23
<212> TYPE: DNA
<213> ORGANISM: Homo sapiens

<400> SEQUENCE: 1194 cccagcactt tgggaggccg agg 23

<210> SEQ ID NO 1195
<211> LENGTH: 23
<212> TYPE: DNA
<213> ORGANISM: Homo sapiens

<400> SEQUENCE: 1195 tttaaaaaaa aagaaacaca ggg 23

<210> SEQ ID NO 1196
<211> LENGTH: 23
<212> TYPE: DNA
<213> ORGANISM: Homo sapiens

<400> SEQUENCE: 1196 tgtggtccca ggtactcagg agg 23

<210> SEQ ID NO 1197
<211> LENGTH: 23
<212> TYPE: DNA
<213> ORGANISM: Homo sapiens

<400> SEQUENCE: 1197 agctgtaatc ccagcacttt ggg 23

<210> SEQ ID NO 1198
<211> LENGTH: 23
<212> TYPE: DNA
<213> ORGANISM: Homo sapiens

<400> SEQUENCE: 1198 catgccactg cactccagcc tgg 23

<210> SEQ ID NO 1199
<211> LENGTH: 23
<212> TYPE: DNA
<213> ORGANISM: Homo sapiens

<400> SEQUENCE: 1199 taaaaaaaaa aaaattagcc tgg 23

<210> SEQ ID NO 1200
<211> LENGTH: 23
<212> TYPE: DNA
<213> ORGANISM: Homo sapiens

<400> SEQUENCE: 1200 atgccactgc actccagcct ggg 23

<210> SEQ ID NO 1201
<211> LENGTH: 23
<212> TYPE: DNA
<213> ORGANISM: Homo sapiens

<400> SEQUENCE: 1201 accttggcct cccaaagtgc tgg 23

<210> SEQ ID NO 1202
<211> LENGTH: 23
<212> TYPE: DNA
<213> ORGANISM: Homo sapiens

<400> SEQUENCE: 1202 cctcggcctc ccaaagtgct ggg 23

<210> SEQ ID NO 1203
<211> LENGTH: 23
<212> TYPE: DNA
<213> ORGANISM: Homo sapiens

<400> SEQUENCE: 1203 gtctgtaatc ccagcacttt ggg 23

<210> SEQ ID NO 1204
<211> LENGTH: 23
<212> TYPE: DNA
<213> ORGANISM: Homo sapiens

<400> SEQUENCE: 1204 cccagcactt tgggaggcca agg 23

<210> SEQ ID NO 1205
<211> LENGTH: 23
<212> TYPE: DNA
<213> ORGANISM: Homo sapiens

<400> SEQUENCE: 1205 cacctgtaat cccagcactt tgg 23

<210> SEQ ID NO 1206
<211> LENGTH: 23
<212> TYPE: DNA
<213> ORGANISM: Homo sapiens

<400> SEQUENCE: 1206 ttgtttgttt gtttttgaag tgg 23

<210> SEQ ID NO 1207
<211> LENGTH: 23
<212> TYPE: DNA
<213> ORGANISM: Homo sapiens

<400> SEQUENCE: 1207 ttgcccaggc tggagtgcag tgg 23

<210> SEQ ID NO 1208
<211> LENGTH: 23
<212> TYPE: DNA
<213> ORGANISM: Homo sapiens

<400> SEQUENCE: 1208 agcactttgg gaggccaagg tgg 23

<210> SEQ ID NO 1209
<211> LENGTH: 23
<212> TYPE: DNA
<213> ORGANISM: Homo sapiens

<400> SEQUENCE: 1209 aaaaaaaaaa aaaattagcc ggg 23

<210> SEQ ID NO 1210
<211> LENGTH: 23
<212> TYPE: DNA
<213> ORGANISM: Homo sapiens

<400> SEQUENCE: 1210 tcacccaggc tggagtgcag tgg 23

<210> SEQ ID NO 1211
<211> LENGTH: 23
<212> TYPE: DNA
<213> ORGANISM: Homo sapiens

<400> SEQUENCE: 1211 tttttttttt ttagtagaga cgg 23

<210> SEQ ID NO 1212
<211> LENGTH: 23
<212> TYPE: DNA
<213> ORGANISM: Homo sapiens

<400> SEQUENCE: 1212 ttgtattttt agtagagaca ggg 23

<210> SEQ ID NO 1213
<211> LENGTH: 23
<212> TYPE: DNA
<213> ORGANISM: Homo sapiens

<400> SEQUENCE: 1213 aataaataaa taaaataaat agg 23

<210> SEQ ID NO 1214
<211> LENGTH: 23
<212> TYPE: DNA
<213> ORGANISM: Homo sapiens

<400> SEQUENCE: 1214 tgtagtccca gctactcagg agg 23

<210> SEQ ID NO 1215
<211> LENGTH: 23
<212> TYPE: DNA
<213> ORGANISM: Homo sapiens

<400> SEQUENCE: 1215 ccttggcctc ccaaagtgct ggg 23

<210> SEQ ID NO 1216
<211> LENGTH: 23
<212> TYPE: DNA
<213> ORGANISM: Homo sapiens

<400> SEQUENCE: 1216 aaaaaaaaaa aaaaattagc cgg 23

<210> SEQ ID NO 1217
<211> LENGTH: 23
<212> TYPE: DNA
<213> ORGANISM: Homo sapiens

<400> SEQUENCE: 1217 tctcactctg ttgcccaggc tgg 23

<210> SEQ ID NO 1218
<211> LENGTH: 23
<212> TYPE: DNA
<213> ORGANISM: Homo sapiens

<400> SEQUENCE: 1218 acctgtaatc ccagcacttt ggg 23

<210> SEQ ID NO 1219
<211> LENGTH: 23
<212> TYPE: DNA
<213> ORGANISM: Homo sapiens

<400> SEQUENCE: 1219 tgtaatccca gcactttggg agg 23

<210> SEQ ID NO 1220
<211> LENGTH: 23
<212> TYPE: DNA
<213> ORGANISM: Homo sapiens

<400> SEQUENCE: 1220 tttgtatttt tagtagagac agg 23

<210> SEQ ID NO 1221
<211> LENGTH: 23
<212> TYPE: DNA
<213> ORGANISM: Homo sapiens

<400> SEQUENCE: 1221 tcccaaagtg ctgggattac agg 23

<210> SEQ ID NO 1222
<211> LENGTH: 23
<212> TYPE: DNA
<213> ORGANISM: Homo sapiens

<400> SEQUENCE: 1222 tttttttttt ttttgaggca ggg 23

<210> SEQ ID NO 1223
<211> LENGTH: 23
<212> TYPE: DNA
<213> ORGANISM: Homo sapiens

<400> SEQUENCE: 1223 tttttttttt tttttgaggc agg 23

<210> SEQ ID NO 1224
<211> LENGTH: 23
<212> TYPE: DNA
<213> ORGANISM: Homo sapiens

<400> SEQUENCE: 1224 aaaaaaaaaa aaaaaagtct ggg 23

<210> SEQ ID NO 1225
<211> LENGTH: 23
<212> TYPE: DNA
<213> ORGANISM: Homo sapiens

<400> SEQUENCE: 1225 aaaaaaaaaa aaaaaaagtc tgg 23

<210> SEQ ID NO 1226
<211> LENGTH: 23
<212> TYPE: DNA
<213> ORGANISM: Homo sapiens

<400> SEQUENCE: 1226 tttttttttt tttttttttg agg 23

<210> SEQ ID NO 1227
<211> LENGTH: 23
<212> TYPE: DNA
<213> ORGANISM: Homo sapiens

<400> SEQUENCE: 1227 tccaaatctc caagcgggtt ggg 23

<210> SEQ ID NO 1228
<211> LENGTH: 23
<212> TYPE: DNA
<213> ORGANISM: Homo sapiens

<400> SEQUENCE: 1228 ccaaatctcc aagcgggttg ggg 23

<210> SEQ ID NO 1229
<211> LENGTH: 23
<212> TYPE: DNA
<213> ORGANISM: Homo sapiens

<400> SEQUENCE: 1229 gtccaaatct ccaagcgggt tgg 23

<210> SEQ ID NO 1230
<211> LENGTH: 23
<212> TYPE: DNA
<213> ORGANISM: Homo sapiens

<400> SEQUENCE: 1230 ccggctacag ttgtgacccc tgg 23

<210> SEQ ID NO 1231
<211> LENGTH: 23
<212> TYPE: DNA
<213> ORGANISM: Homo sapiens

<400> SEQUENCE: 1231 ccccaacccg cttggagatt tgg 23

<210> SEQ ID NO 1232
<211> LENGTH: 23
<212> TYPE: DNA
<213> ORGANISM: Homo sapiens

<400> SEQUENCE: 1232 gccgggcacc ccaacccgct tgg 23

<210> SEQ ID NO 1233
<211> LENGTH: 23
<212> TYPE: DNA
<213> ORGANISM: Homo sapiens

<400> SEQUENCE: 1233 cggctacagt tgtgacccct ggg 23

<210> SEQ ID NO 1234
<211> LENGTH: 23
<212> TYPE: DNA
<213> ORGANISM: Homo sapiens

<400> SEQUENCE: 1234 ctcaaggtca cgttgacccc agg 23

<210> SEQ ID NO 1235
<211> LENGTH: 23
<212> TYPE: DNA
<213> ORGANISM: Homo sapiens

<400> SEQUENCE: 1235 ccgggatgtg tcctccgagc tgg 23

<210> SEQ ID NO 1236
<211> LENGTH: 23
<212> TYPE: DNA
<213> ORGANISM: Homo sapiens

<400> SEQUENCE: 1236 ttggggtgcc cggcatctca agg 23

<210> SEQ ID NO 1237
<211> LENGTH: 23
<212> TYPE: DNA
<213> ORGANISM: Homo sapiens

<400> SEQUENCE: 1237 aaagaattct gccagctcgg agg 23

<210> SEQ ID NO 1238
<211> LENGTH: 23
<212> TYPE: DNA
<213> ORGANISM: Homo sapiens

<400> SEQUENCE: 1238 agcagctcca ggacatcgct ggg 23

<210> SEQ ID NO 1239
<211> LENGTH: 23
<212> TYPE: DNA
<213> ORGANISM: Homo sapiens

<400> SEQUENCE: 1239 tcaacgtgac cttgagatgc cgg 23

<210> SEQ ID NO 1240
<211> LENGTH: 23
<212> TYPE: DNA
<213> ORGANISM: Homo sapiens

<400> SEQUENCE: 1240 gcttagggtg gtatgaagct ggg 23

<210> SEQ ID NO 1241
<211> LENGTH: 23
<212> TYPE: DNA
<213> ORGANISM: Homo sapiens

<400> SEQUENCE: 1241 cttcatacca ccctaagcca tgg 23

<210> SEQ ID NO 1242
<211> LENGTH: 23
<212> TYPE: DNA
<213> ORGANISM: Homo sapiens

<400> SEQUENCE: 1242 ccaggggtca caactgtagc cgg 23

<210> SEQ ID NO 1243
<211> LENGTH: 23
<212> TYPE: DNA
<213> ORGANISM: Homo sapiens

<400> SEQUENCE: 1243 gctgctaccg aaggccagac tgg 23

<210> SEQ ID NO 1244
<211> LENGTH: 23
<212> TYPE: DNA
<213> ORGANISM: Homo sapiens

<400> SEQUENCE: 1244 ctgctaccga aggccagact ggg 23

<210> SEQ ID NO 1245
<211> LENGTH: 23
<212> TYPE: DNA
<213> ORGANISM: Homo sapiens

<400> SEQUENCE: 1245 tcaaggtcac gttgacccca ggg 23

<210> SEQ ID NO 1246
<211> LENGTH: 23
<212> TYPE: DNA
<213> ORGANISM: Homo sapiens

<400> SEQUENCE: 1246 ggcttagggt ggtatgaagc tgg 23

<210> SEQ ID NO 1247
<211> LENGTH: 23
<212> TYPE: DNA
<213> ORGANISM: Homo sapiens

<400> SEQUENCE: 1247 agaaggggag cgatctctcc agg 23

<210> SEQ ID NO 1248
<211> LENGTH: 23
<212> TYPE: DNA
<213> ORGANISM: Homo sapiens

<400> SEQUENCE: 1248 gtcccagccc agcgatgtcc tgg 23

<210> SEQ ID NO 1249
<211> LENGTH: 23
<212> TYPE: DNA
<213> ORGANISM: Homo sapiens

<400> SEQUENCE: 1249 ataccaccct aagccatggc tgg 23

<210> SEQ ID NO 1250
<211> LENGTH: 23
<212> TYPE: DNA
<213> ORGANISM: Homo sapiens

<400> SEQUENCE: 1250 caacgtgacc ttgagatgcc ggg 23

<210> SEQ ID NO 1251
<211> LENGTH: 23
<212> TYPE: DNA
<213> ORGANISM: Homo sapiens

<400> SEQUENCE: 1251 gagctcccag ccatggctta ggg 23

<210> SEQ ID NO 1252
<211> LENGTH: 23
<212> TYPE: DNA
<213> ORGANISM: Homo sapiens

<400> SEQUENCE: 1252 tgctaccgaa ggccagactg ggg 23

<210> SEQ ID NO 1253
<211> LENGTH: 23
<212> TYPE: DNA
<213> ORGANISM: Homo sapiens

<400> SEQUENCE: 1253 gctaccgaag gccagactgg ggg 23

<210> SEQ ID NO 1254
<211> LENGTH: 23
<212> TYPE: DNA

<213> ORGANISM: Homo sapiens

<400> SEQUENCE: 1254 caaggtcacg ttgaccccag ggg 23

<210> SEQ ID NO 1255
<211> LENGTH: 23
<212> TYPE: DNA
<213> ORGANISM: Homo sapiens

<400> SEQUENCE: 1255 taccacccta agccatggct ggg 23

<210> SEQ ID NO 1256
<211> LENGTH: 23
<212> TYPE: DNA
<213> ORGANISM: Homo sapiens

<400> SEQUENCE: 1256 tccaagcggg ttggggtgcc cgg 23

<210> SEQ ID NO 1257
<211> LENGTH: 23
<212> TYPE: DNA
<213> ORGANISM: Homo sapiens

<400> SEQUENCE: 1257 gctccaggac atcgctgggc tgg 23

<210> SEQ ID NO 1258
<211> LENGTH: 23
<212> TYPE: DNA
<213> ORGANISM: Homo sapiens

<400> SEQUENCE: 1258 cttagggtgg tatgaagctg ggg 23

<210> SEQ ID NO 1259
<211> LENGTH: 23
<212> TYPE: DNA
<213> ORGANISM: Homo sapiens

<400> SEQUENCE: 1259 ggctacagtt gtgacccctg ggg 23

<210> SEQ ID NO 1260
<211> LENGTH: 23
<212> TYPE: DNA
<213> ORGANISM: Homo sapiens

<400> SEQUENCE: 1260 ccagctcgga ggacacatcc cgg 23

<210> SEQ ID NO 1261
<211> LENGTH: 23
<212> TYPE: DNA
<213> ORGANISM: Homo sapiens

<400> SEQUENCE: 1261 agatcgctcc ccttctcttc cgg 23

<210> SEQ ID NO 1262
<211> LENGTH: 23

<212> TYPE: DNA
<213> ORGANISM: Homo sapiens

<400> SEQUENCE: 1262 tgagctccca gccatggctt agg 23

<210> SEQ ID NO 1263
<211> LENGTH: 23
<212> TYPE: DNA
<213> ORGANISM: Homo sapiens

<400> SEQUENCE: 1263 cagcagctcc aggacatcgc tgg 23

<210> SEQ ID NO 1264
<211> LENGTH: 23
<212> TYPE: DNA
<213> ORGANISM: Homo sapiens

<400> SEQUENCE: 1264 agatttggac ttttcaagcc tgg 23

<210> SEQ ID NO 1265
<211> LENGTH: 23
<212> TYPE: DNA
<213> ORGANISM: Homo sapiens

<400> SEQUENCE: 1265 aggacacatc ccggaagaga agg 23

<210> SEQ ID NO 1266
<211> LENGTH: 23
<212> TYPE: DNA
<213> ORGANISM: Homo sapiens

<400> SEQUENCE: 1266 cagactgggg gccgggtgtc tgg 23

<210> SEQ ID NO 1267
<211> LENGTH: 23
<212> TYPE: DNA
<213> ORGANISM: Homo sapiens

<400> SEQUENCE: 1267 actgaataaa cggggctgcc tgg 23

<210> SEQ ID NO 1268
<211> LENGTH: 23
<212> TYPE: DNA
<213> ORGANISM: Homo sapiens

<400> SEQUENCE: 1268 ggacacatcc cggaagagaa ggg 23

<210> SEQ ID NO 1269
<211> LENGTH: 23
<212> TYPE: DNA
<213> ORGANISM: Homo sapiens

<400> SEQUENCE: 1269 ctcccagcca tggcttaggg tgg 23

<210> SEQ ID NO 1270

<211> LENGTH: 23
<212> TYPE: DNA
<213> ORGANISM: Homo sapiens

<400> SEQUENCE: 1270 cgagctggca gaattctttc tgg 23

<210> SEQ ID NO 1271
<211> LENGTH: 23
<212> TYPE: DNA
<213> ORGANISM: Homo sapiens

<400> SEQUENCE: 1271 aggaggtgac tccagcccaa ggg 23

<210> SEQ ID NO 1272
<211> LENGTH: 23
<212> TYPE: DNA
<213> ORGANISM: Homo sapiens

<400> SEQUENCE: 1272 cagacacccg gcccccagtc tgg 23

<210> SEQ ID NO 1273
<211> LENGTH: 23
<212> TYPE: DNA
<213> ORGANISM: Homo sapiens

<400> SEQUENCE: 1273 tagggtggta tgaagctggg ggg 23

<210> SEQ ID NO 1274
<211> LENGTH: 23
<212> TYPE: DNA
<213> ORGANISM: Homo sapiens

<400> SEQUENCE: 1274 ttagggtggt atgaagctgg ggg 23

<210> SEQ ID NO 1275
<211> LENGTH: 23
<212> TYPE: DNA
<213> ORGANISM: Homo sapiens

<400> SEQUENCE: 1275 agcagcggta acttccccct tgg 23

<210> SEQ ID NO 1276
<211> LENGTH: 23
<212> TYPE: DNA
<213> ORGANISM: Homo sapiens

<400> SEQUENCE: 1276 ctggccttcg gtagcagcag cgg 23

<210> SEQ ID NO 1277
<211> LENGTH: 23
<212> TYPE: DNA
<213> ORGANISM: Homo sapiens

<400> SEQUENCE: 1277 gaaaagtcca aatctccaag cgg 23

<210> SEQ ID NO 1278
<211> LENGTH: 23
<212> TYPE: DNA
<213> ORGANISM: Homo sapiens

<400> SEQUENCE: 1278 agctgggggg actgaataaa cgg 23

<210> SEQ ID NO 1279
<211> LENGTH: 23
<212> TYPE: DNA
<213> ORGANISM: Homo sapiens

<400> SEQUENCE: 1279 gcagcggtaa cttccccctt ggg 23

<210> SEQ ID NO 1280
<211> LENGTH: 23
<212> TYPE: DNA
<213> ORGANISM: Homo sapiens

<400> SEQUENCE: 1280 agctgggggg actgaataaa cgg 23

<210> SEQ ID NO 1281
<211> LENGTH: 23
<212> TYPE: DNA
<213> ORGANISM: Homo sapiens

<400> SEQUENCE: 1281 aaaagtccaa atctccaagc ggg 23

<210> SEQ ID NO 1282
<211> LENGTH: 23
<212> TYPE: DNA
<213> ORGANISM: Homo sapiens

<400> SEQUENCE: 1282 ctccaggaca tcgctgggct ggg 23

<210> SEQ ID NO 1283
<211> LENGTH: 23
<212> TYPE: DNA
<213> ORGANISM: Homo sapiens

<400> SEQUENCE: 1283 ccggccccca gtctggcctt cgg 23

<210> SEQ ID NO 1284
<211> LENGTH: 23
<212> TYPE: DNA
<213> ORGANISM: Homo sapiens

<400> SEQUENCE: 1284 gacacatccc ggaagagaag ggg 23

<210> SEQ ID NO 1285
<211> LENGTH: 23
<212> TYPE: DNA
<213> ORGANISM: Homo sapiens

<400> SEQUENCE: 1285 ggaggtgact ccagcccaag ggg 23

<210> SEQ ID NO 1286
<211> LENGTH: 23
<212> TYPE: DNA
<213> ORGANISM: Homo sapiens

<400> SEQUENCE: 1286 cggtaacttc ccccttgggc tgg 23

<210> SEQ ID NO 1287
<211> LENGTH: 23
<212> TYPE: DNA
<213> ORGANISM: Homo sapiens

<400> SEQUENCE: 1287 cagaaagaat tctgccagct cgg 23

<210> SEQ ID NO 1288
<211> LENGTH: 23
<212> TYPE: DNA
<213> ORGANISM: Homo sapiens

<400> SEQUENCE: 1288 gatcgctccc cttctcttcc ggg 23

<210> SEQ ID NO 1289
<211> LENGTH: 23
<212> TYPE: DNA
<213> ORGANISM: Homo sapiens

<400> SEQUENCE: 1289 tggtgacagg tgaggtcctg ggg 23

<210> SEQ ID NO 1290
<211> LENGTH: 23
<212> TYPE: DNA
<213> ORGANISM: Homo sapiens

<400> SEQUENCE: 1290 ctggtgacag gtgaggtcct ggg 23

<210> SEQ ID NO 1291
<211> LENGTH: 23
<212> TYPE: DNA
<213> ORGANISM: Homo sapiens

<400> SEQUENCE: 1291 cagcgatgtc ctggagctgc tgg 23

<210> SEQ ID NO 1292
<211> LENGTH: 23
<212> TYPE: DNA
<213> ORGANISM: Homo sapiens

<400> SEQUENCE: 1292 ctggtgacag gtgaggtcct ggg 23

<210> SEQ ID NO 1293
<211> LENGTH: 23
<212> TYPE: DNA
<213> ORGANISM: Homo sapiens

<400> SEQUENCE: 1293 gaggtgactc cagcccaagg ggg 23

<210> SEQ ID NO 1294
<211> LENGTH: 23
<212> TYPE: DNA
<213> ORGANISM: Homo sapiens

<400> SEQUENCE: 1294 gctggtgaca ggtgaggtcc tgg 23

<210> SEQ ID NO 1295
<211> LENGTH: 23
<212> TYPE: DNA
<213> ORGANISM: Homo sapiens

<400> SEQUENCE: 1295 ctgggctggg accagacacc cgg 23

<210> SEQ ID NO 1296
<211> LENGTH: 23
<212> TYPE: DNA
<213> ORGANISM: Homo sapiens

<400> SEQUENCE: 1296 ccgaaggcca gactgggggc cgg 23

<210> SEQ ID NO 1297
<211> LENGTH: 23
<212> TYPE: DNA
<213> ORGANISM: Homo sapiens

<400> SEQUENCE: 1297 caggtgaggt cctggggtcg ggg 23

<210> SEQ ID NO 1298
<211> LENGTH: 23
<212> TYPE: DNA
<213> ORGANISM: Homo sapiens

<400> SEQUENCE: 1298 gctggcagaa ttctttctgg agg 23

<210> SEQ ID NO 1299
<211> LENGTH: 23
<212> TYPE: DNA
<213> ORGANISM: Homo sapiens

<400> SEQUENCE: 1299 gccatggctg ggagctcagc cgg 23

<210> SEQ ID NO 1300
<211> LENGTH: 23
<212> TYPE: DNA
<213> ORGANISM: Homo sapiens

<400> SEQUENCE: 1300 ggcagaattc tttctggagg agg 23

<210> SEQ ID NO 1301
<211> LENGTH: 23
<212> TYPE: DNA
<213> ORGANISM: Homo sapiens

<400> SEQUENCE: 1301 gttaccgctg ctgctaccga agg 23

<210> SEQ ID NO 1302
<211> LENGTH: 23
<212> TYPE: DNA
<213> ORGANISM: Homo sapiens

<400> SEQUENCE: 1302 cgaaggccag actgggggcc ggg 23

<210> SEQ ID NO 1303
<211> LENGTH: 23
<212> TYPE: DNA
<213> ORGANISM: Homo sapiens

<400> SEQUENCE: 1303 gccggctgag ctcccagcca tgg 23

<210> SEQ ID NO 1304
<211> LENGTH: 23
<212> TYPE: DNA
<213> ORGANISM: Homo sapiens

<400> SEQUENCE: 1304 acaggtgagg tcctggggtc ggg 23

<210> SEQ ID NO 1305
<211> LENGTH: 23
<212> TYPE: DNA
<213> ORGANISM: Homo sapiens

<400> SEQUENCE: 1305 gaggaggtga ctccagccca agg 23

<210> SEQ ID NO 1306
<211> LENGTH: 23
<212> TYPE: DNA
<213> ORGANISM: Homo sapiens

<400> SEQUENCE: 1306 ggagctgctg gtgacaggtg agg 23

<210> SEQ ID NO 1307
<211> LENGTH: 23
<212> TYPE: DNA
<213> ORGANISM: Homo sapiens

<400> SEQUENCE: 1307 gtcctggagc tgctggtgac agg 23

<210> SEQ ID NO 1308
<211> LENGTH: 23
<212> TYPE: DNA
<213> ORGANISM: Homo sapiens

<400> SEQUENCE: 1308 cacctgtcac cagcagctcc agg 23

<210> SEQ ID NO 1309
<211> LENGTH: 23
<212> TYPE: DNA
<213> ORGANISM: Homo sapiens

<400> SEQUENCE: 1309 gcgagcggaa gacgctcacg cgg 23

<210> SEQ ID NO 1310
<211> LENGTH: 23
<212> TYPE: DNA
<213> ORGANISM: Homo sapiens

<400> SEQUENCE: 1310 ggaagacgct cacgcggccc cgg 23

<210> SEQ ID NO 1311
<211> LENGTH: 23
<212> TYPE: DNA
<213> ORGANISM: Homo sapiens

<400> SEQUENCE: 1311 agagacgggg tgagagtccg ggg 23

<210> SEQ ID NO 1312
<211> LENGTH: 23
<212> TYPE: DNA
<213> ORGANISM: Homo sapiens

<400> SEQUENCE: 1312 agagagagag gtacagtgcg ggg 23

<210> SEQ ID NO 1313
<211> LENGTH: 23
<212> TYPE: DNA
<213> ORGANISM: Homo sapiens

<400> SEQUENCE: 1313 agagagaggt acagtgcggg ggg 23

<210> SEQ ID NO 1314
<211> LENGTH: 23
<212> TYPE: DNA
<213> ORGANISM: Homo sapiens

<400> SEQUENCE: 1314 cagagacggg gtgagagtcc ggg 23

<210> SEQ ID NO 1315
<211> LENGTH: 23
<212> TYPE: DNA
<213> ORGANISM: Homo sapiens

<400> SEQUENCE: 1315 aaacagagcg agcgagcgag cgg 23

<210> SEQ ID NO 1316
<211> LENGTH: 23
<212> TYPE: DNA
<213> ORGANISM: Homo sapiens

<400> SEQUENCE: 1316 gtgggtggaa caagggagtt ggg 23

<210> SEQ ID NO 1317
<211> LENGTH: 23
<212> TYPE: DNA
<213> ORGANISM: Homo sapiens

<400> SEQUENCE: 1317 gacagataca gagacactag ggg 23

<210> SEQ ID NO 1318
<211> LENGTH: 23
<212> TYPE: DNA
<213> ORGANISM: Homo sapiens

<400> SEQUENCE: 1318 gagagagagg tacagtgcgg ggg 23

<210> SEQ ID NO 1319
<211> LENGTH: 23
<212> TYPE: DNA
<213> ORGANISM: Homo sapiens

<400> SEQUENCE: 1319 gcagctcctc tgcagagacg ggg 23

<210> SEQ ID NO 1320
<211> LENGTH: 23
<212> TYPE: DNA
<213> ORGANISM: Homo sapiens

<400> SEQUENCE: 1320 acagatacag agacactagg ggg 23

<210> SEQ ID NO 1321
<211> LENGTH: 23
<212> TYPE: DNA
<213> ORGANISM: Homo sapiens

<400> SEQUENCE: 1321 agtgggtgga acaagggagt tgg 23

<210> SEQ ID NO 1322
<211> LENGTH: 23
<212> TYPE: DNA
<213> ORGANISM: Homo sapiens

<400> SEQUENCE: 1322 tggtgacagg tgaggtcctg ggg 23

<210> SEQ ID NO 1323
<211> LENGTH: 23
<212> TYPE: DNA
<213> ORGANISM: Homo sapiens

<400> SEQUENCE: 1323 tgggtggaac aagggagttg ggg 23

<210> SEQ ID NO 1324
<211> LENGTH: 23
<212> TYPE: DNA
<213> ORGANISM: Homo sapiens

<400> SEQUENCE: 1324 tctctgcaga ggagctgccg cgg 23

<210> SEQ ID NO 1325
<211> LENGTH: 23
<212> TYPE: DNA
<213> ORGANISM: Homo sapiens

<400> SEQUENCE: 1325 ctggtgacag gtgaggtcct ggg 23

<210> SEQ ID NO 1326
<211> LENGTH: 23
<212> TYPE: DNA
<213> ORGANISM: Homo sapiens

<400> SEQUENCE: 1326 gagagagaga ggtacagtgc ggg 23

<210> SEQ ID NO 1327
<211> LENGTH: 23
<212> TYPE: DNA
<213> ORGANISM: Homo sapiens

<400> SEQUENCE: 1327 gctggtgaca ggtgaggtcc tgg 23

<210> SEQ ID NO 1328
<211> LENGTH: 23
<212> TYPE: DNA
<213> ORGANISM: Homo sapiens

<400> SEQUENCE: 1328 gcagagacgg ggtgagagtc cgg 23

<210> SEQ ID NO 1329
<211> LENGTH: 23
<212> TYPE: DNA
<213> ORGANISM: Homo sapiens

<400> SEQUENCE: 1329 caggtgaggt cctggggtcg ggg 23

<210> SEQ ID NO 1330
<211> LENGTH: 23
<212> TYPE: DNA
<213> ORGANISM: Homo sapiens

<400> SEQUENCE: 1330 ctctcacccc gtctctgcag agg 23

<210> SEQ ID NO 1331
<211> LENGTH: 23
<212> TYPE: DNA
<213> ORGANISM: Homo sapiens

<400> SEQUENCE: 1331 agagagagag aggtacagtg cgg 23

<210> SEQ ID NO 1332
<211> LENGTH: 23
<212> TYPE: DNA
<213> ORGANISM: Homo sapiens

<400> SEQUENCE: 1332 acaggtgagg tcctggggtc ggg 23

<210> SEQ ID NO 1333
<211> LENGTH: 23
<212> TYPE: DNA

<213> ORGANISM: Homo sapiens

<400> SEQUENCE: 1333 gggtggaaca agggagttgg ggg 23

<210> SEQ ID NO 1334
<211> LENGTH: 23
<212> TYPE: DNA
<213> ORGANISM: Homo sapiens

<400> SEQUENCE: 1334 ggcagctcct ctgcagagac ggg 23

<210> SEQ ID NO 1335
<211> LENGTH: 23
<212> TYPE: DNA
<213> ORGANISM: Homo sapiens

<400> SEQUENCE: 1335 gaggagaagt gggtggaaca agg 23

<210> SEQ ID NO 1336
<211> LENGTH: 23
<212> TYPE: DNA
<213> ORGANISM: Homo sapiens

<400> SEQUENCE: 1336 cacttctcct ccccgacccc agg 23

<210> SEQ ID NO 1337
<211> LENGTH: 23
<212> TYPE: DNA
<213> ORGANISM: Homo sapiens

<400> SEQUENCE: 1337 gggagggaca gagagatata ggg 23

<210> SEQ ID NO 1338
<211> LENGTH: 23
<212> TYPE: DNA
<213> ORGANISM: Homo sapiens

<400> SEQUENCE: 1338 ggggagggac agagagatat agg 23

<210> SEQ ID NO 1339
<211> LENGTH: 23
<212> TYPE: DNA
<213> ORGANISM: Homo sapiens

<400> SEQUENCE: 1339 gacaggtgag gtcctggggt cgg 23

<210> SEQ ID NO 1340
<211> LENGTH: 23
<212> TYPE: DNA
<213> ORGANISM: Homo sapiens

<400> SEQUENCE: 1340 gtgaggtcct ggggtcgggg agg 23

<210> SEQ ID NO 1341
<211> LENGTH: 23

<212> TYPE: DNA
<213> ORGANISM: Homo sapiens

<400> SEQUENCE: 1341 ggagctgctg gtgacaggtg agg 23

<210> SEQ ID NO 1342
<211> LENGTH: 23
<212> TYPE: DNA
<213> ORGANISM: Homo sapiens

<400> SEQUENCE: 1342 tggggtcggg gaggagaagt ggg 23

<210> SEQ ID NO 1343
<211> LENGTH: 23
<212> TYPE: DNA
<213> ORGANISM: Homo sapiens

<400> SEQUENCE: 1343 gtcctggagc tgctggtgac agg 23

<210> SEQ ID NO 1344
<211> LENGTH: 23
<212> TYPE: DNA
<213> ORGANISM: Homo sapiens

<400> SEQUENCE: 1344 tggaacaagg gagttggggg agg 23

<210> SEQ ID NO 1345
<211> LENGTH: 23
<212> TYPE: DNA
<213> ORGANISM: Homo sapiens

<400> SEQUENCE: 1345 cggcagctcc tctgcagaga cgg 23

<210> SEQ ID NO 1346
<211> LENGTH: 23
<212> TYPE: DNA
<213> ORGANISM: Homo sapiens

<400> SEQUENCE: 1346 aaagagagac agagcgaggc ggg 23

<210> SEQ ID NO 1347
<211> LENGTH: 23
<212> TYPE: DNA
<213> ORGANISM: Homo sapiens

<400> SEQUENCE: 1347 ggaacaaggg agttgggggga ggg 23

<210> SEQ ID NO 1348
<211> LENGTH: 23
<212> TYPE: DNA
<213> ORGANISM: Homo sapiens

<400> SEQUENCE: 1348 gaaagagaga cagagcgagg cgg 23

<210> SEQ ID NO 1349

<211> LENGTH: 23
<212> TYPE: DNA
<213> ORGANISM: Homo sapiens

<400> SEQUENCE: 1349 agggaaagag agacagagcg agg 23

<210> SEQ ID NO 1350
<211> LENGTH: 23
<212> TYPE: DNA
<213> ORGANISM: Homo sapiens

<400> SEQUENCE: 1350 ggtcggggag gagaagtggg tgg 23

<210> SEQ ID NO 1351
<211> LENGTH: 23
<212> TYPE: DNA
<213> ORGANISM: Homo sapiens

<400> SEQUENCE: 1351 ctggggtcgg ggaggagaag tgg 23

<210> SEQ ID NO 1352
<211> LENGTH: 23
<212> TYPE: DNA
<213> ORGANISM: Homo sapiens

<400> SEQUENCE: 1352 aggagaagtg ggtggaacaa ggg 23

<210> SEQ ID NO 1353
<211> LENGTH: 23
<212> TYPE: DNA
<213> ORGANISM: Homo sapiens

<400> SEQUENCE: 1353 aagacagata cagagacact agg 23

<210> SEQ ID NO 1354
<211> LENGTH: 23
<212> TYPE: DNA
<213> ORGANISM: Homo sapiens

<400> SEQUENCE: 1354 acagagaaag cgagagacag agg 23

<210> SEQ ID NO 1355
<211> LENGTH: 23
<212> TYPE: DNA
<213> ORGANISM: Homo sapiens

<400> SEQUENCE: 1355 agaggcagaa ggagaaaggg agg 23

<210> SEQ ID NO 1356
<211> LENGTH: 23
<212> TYPE: DNA
<213> ORGANISM: Homo sapiens

<400> SEQUENCE: 1356 aaagcgagag acagaggaga agg 23

<210> SEQ ID NO 1357
<211> LENGTH: 23
<212> TYPE: DNA
<213> ORGANISM: Homo sapiens

<400> SEQUENCE: 1357 ctagggggag agagagagac agg 23

<210> SEQ ID NO 1358
<211> LENGTH: 23
<212> TYPE: DNA
<213> ORGANISM: Homo sapiens

<400> SEQUENCE: 1358 cacctgtcac cagcagctcc agg 23

<210> SEQ ID NO 1359
<211> LENGTH: 23
<212> TYPE: DNA
<213> ORGANISM: Homo sapiens

<400> SEQUENCE: 1359 agggaggcag agagagaggc agg 23

<210> SEQ ID NO 1360
<211> LENGTH: 23
<212> TYPE: DNA
<213> ORGANISM: Homo sapiens

<400> SEQUENCE: 1360 agagaggcag gcagagagag agg 23

<210> SEQ ID NO 1361
<211> LENGTH: 23
<212> TYPE: DNA
<213> ORGANISM: Homo sapiens

<400> SEQUENCE: 1361 agaaagaggc agaaggagaa agg 23

<210> SEQ ID NO 1362
<211> LENGTH: 23
<212> TYPE: DNA
<213> ORGANISM: Homo sapiens

<400> SEQUENCE: 1362 agggaggcag agagagaggc agg 23

<210> SEQ ID NO 1363
<211> LENGTH: 23
<212> TYPE: DNA
<213> ORGANISM: Homo sapiens

<400> SEQUENCE: 1363 agagggaggc agagagaggg agg 23

<210> SEQ ID NO 1364
<211> LENGTH: 23
<212> TYPE: DNA
<213> ORGANISM: Homo sapiens

<400> SEQUENCE: 1364 aggcaggcag agagagaggc agg 23

<210> SEQ ID NO 1365
<211> LENGTH: 23
<212> TYPE: DNA
<213> ORGANISM: Homo sapiens

<400> SEQUENCE: 1365 gaaagaggca gaaggagaaa ggg 23

<210> SEQ ID NO 1366
<211> LENGTH: 23
<212> TYPE: DNA
<213> ORGANISM: Homo sapiens

<400> SEQUENCE: 1366 aggcaggcag agagagaggg agg 23

<210> SEQ ID NO 1367
<211> LENGTH: 23
<212> TYPE: DNA
<213> ORGANISM: Homo sapiens

<400> SEQUENCE: 1367 agacaggcag agagaaagag agg 23

<210> SEQ ID NO 1368
<211> LENGTH: 23
<212> TYPE: DNA
<213> ORGANISM: Homo sapiens

<400> SEQUENCE: 1368 taggggggaga gagagagaca ggg 23

<210> SEQ ID NO 1369
<211> LENGTH: 23
<212> TYPE: DNA
<213> ORGANISM: Homo sapiens

<400> SEQUENCE: 1369 agggggagag agagagacag ggg 23

<210> SEQ ID NO 1370
<211> LENGTH: 23
<212> TYPE: DNA
<213> ORGANISM: Homo sapiens

<400> SEQUENCE: 1370 aggggagcag agagagagag agg 23

<210> SEQ ID NO 1371
<211> LENGTH: 23
<212> TYPE: DNA
<213> ORGANISM: Homo sapiens

<400> SEQUENCE: 1371 gagaggcagg cagagagaga ggg 23

<210> SEQ ID NO 1372
<211> LENGTH: 23
<212> TYPE: DNA
<213> ORGANISM: Homo sapiens

<400> SEQUENCE: 1372 agaaagggag gcagagagag agg 23

<210> SEQ ID NO 1373
<211> LENGTH: 23
<212> TYPE: DNA
<213> ORGANISM: Homo sapiens

<400> SEQUENCE: 1373 aggcagacag agagagagac agg 23

<210> SEQ ID NO 1374
<211> LENGTH: 23
<212> TYPE: DNA
<213> ORGANISM: Homo sapiens

<400> SEQUENCE: 1374 agagagaggg aggcagagag agg 23

<210> SEQ ID NO 1375
<211> LENGTH: 23
<212> TYPE: DNA
<213> ORGANISM: Homo sapiens

<400> SEQUENCE: 1375 agggaggcag agagagaggg agg 23

<210> SEQ ID NO 1376
<211> LENGTH: 23
<212> TYPE: DNA
<213> ORGANISM: Homo sapiens

<400> SEQUENCE: 1376 agagagggag gcagagagag agg 23

<210> SEQ ID NO 1377
<211> LENGTH: 23
<212> TYPE: DNA
<213> ORGANISM: Homo sapiens

<400> SEQUENCE: 1377 gaaagggagg cagagagaga ggg 23

<210> SEQ ID NO 1378
<211> LENGTH: 23
<212> TYPE: DNA
<213> ORGANISM: Homo sapiens

<400> SEQUENCE: 1378 gagagagaga aagaggcaga agg 23

<210> SEQ ID NO 1379
<211> LENGTH: 23
<212> TYPE: DNA
<213> ORGANISM: Homo sapiens

<400> SEQUENCE: 1379 gagagaggga ggcagagaga ggg 23

<210> SEQ ID NO 1380
<211> LENGTH: 23
<212> TYPE: DNA
<213> ORGANISM: Homo sapiens

<400> SEQUENCE: 1380 gggggggagag agagagaaag agg 23

<210> SEQ ID NO 1381
<211> LENGTH: 23
<212> TYPE: DNA
<213> ORGANISM: Homo sapiens

<400> SEQUENCE: 1381 gagagggagg cagagagaga ggg 23

<210> SEQ ID NO 1382
<211> LENGTH: 23
<212> TYPE: DNA
<213> ORGANISM: Homo sapiens

<400> SEQUENCE: 1382 agaggcagaa agagagagag agg 23

<210> SEQ ID NO 1383
<211> LENGTH: 23
<212> TYPE: DNA
<213> ORGANISM: Homo sapiens

<400> SEQUENCE: 1383 gagcttcgtg ctgtaccgcg agg 23

<210> SEQ ID NO 1384
<211> LENGTH: 23
<212> TYPE: DNA
<213> ORGANISM: Homo sapiens

<400> SEQUENCE: 1384 cgggggaacc tagtccgcct ggg 23

<210> SEQ ID NO 1385
<211> LENGTH: 23
<212> TYPE: DNA
<213> ORGANISM: Homo sapiens

<400> SEQUENCE: 1385 ggggtctaag gaccgttccg cgg 23

<210> SEQ ID NO 1386
<211> LENGTH: 23
<212> TYPE: DNA
<213> ORGANISM: Homo sapiens

<400> SEQUENCE: 1386 gttcccccgg gtgtagtcgg agg 23

<210> SEQ ID NO 1387
<211> LENGTH: 23
<212> TYPE: DNA
<213> ORGANISM: Homo sapiens

<400> SEQUENCE: 1387 gggggaacct agtccgcctg ggg 23

<210> SEQ ID NO 1388
<211> LENGTH: 23
<212> TYPE: DNA
<213> ORGANISM: Homo sapiens

<400> SEQUENCE: 1388 agcttcgtgc tgtaccgcga ggg 23

<210> SEQ ID NO 1389
<211> LENGTH: 23
<212> TYPE: DNA
<213> ORGANISM: Homo sapiens

<400> SEQUENCE: 1389 cgtgctgtac cgcgagggcg tgg 23

<210> SEQ ID NO 1390
<211> LENGTH: 23
<212> TYPE: DNA
<213> ORGANISM: Homo sapiens

<400> SEQUENCE: 1390 ctgcgctgcg acagcacgta ggg 23

<210> SEQ ID NO 1391
<211> LENGTH: 23
<212> TYPE: DNA
<213> ORGANISM: Homo sapiens

<400> SEQUENCE: 1391 taggttcccc cgggtgtagt cgg 23

<210> SEQ ID NO 1392
<211> LENGTH: 23
<212> TYPE: DNA
<213> ORGANISM: Homo sapiens

<400> SEQUENCE: 1392 aaaagtgacc agcgcgccca ggg 23

<210> SEQ ID NO 1393
<211> LENGTH: 23
<212> TYPE: DNA
<213> ORGANISM: Homo sapiens

<400> SEQUENCE: 1393 gcgcgctggt cacttttgac tgg 23

<210> SEQ ID NO 1394
<211> LENGTH: 23
<212> TYPE: DNA
<213> ORGANISM: Homo sapiens

<400> SEQUENCE: 1394 gcacgaagct catgttccgc agg 23

<210> SEQ ID NO 1395
<211> LENGTH: 23
<212> TYPE: DNA
<213> ORGANISM: Homo sapiens

<400> SEQUENCE: 1395 gacagcacgt agggcgcgga ggg 23

<210> SEQ ID NO 1396
<211> LENGTH: 23
<212> TYPE: DNA
<213> ORGANISM: Homo sapiens

<400> SEQUENCE: 1396 tgaaaggaag acgcgattag tgg 23

<210> SEQ ID NO 1397
<211> LENGTH: 23
<212> TYPE: DNA
<213> ORGANISM: Homo sapiens

<400> SEQUENCE: 1397 tgggccgact tcacgctgct ggg 23

<210> SEQ ID NO 1398
<211> LENGTH: 23
<212> TYPE: DNA
<213> ORGANISM: Homo sapiens

<400> SEQUENCE: 1398 agcagcgtga agtcggccca ggg 23

<210> SEQ ID NO 1399
<211> LENGTH: 23
<212> TYPE: DNA
<213> ORGANISM: Homo sapiens

<400> SEQUENCE: 1399 gctcaggggc ggataccagc agg 23

<210> SEQ ID NO 1400
<211> LENGTH: 23
<212> TYPE: DNA
<213> ORGANISM: Homo sapiens

<400> SEQUENCE: 1400 caaaagtgac cagcgcgccc agg 23

<210> SEQ ID NO 1401
<211> LENGTH: 23
<212> TYPE: DNA
<213> ORGANISM: Homo sapiens

<400> SEQUENCE: 1401 ggaataaaag ctggcgagcg cgg 23

<210> SEQ ID NO 1402
<211> LENGTH: 23
<212> TYPE: DNA
<213> ORGANISM: Homo sapiens

<400> SEQUENCE: 1402 cgcgcagcgc aggctcacgt tgg 23

<210> SEQ ID NO 1403
<211> LENGTH: 23
<212> TYPE: DNA
<213> ORGANISM: Homo sapiens

<400> SEQUENCE: 1403 agcgccacca gcgacggccg cgg 23

<210> SEQ ID NO 1404
<211> LENGTH: 23
<212> TYPE: DNA
<213> ORGANISM: Homo sapiens

<400> SEQUENCE: 1404 ctgcgacagc acgtagggcg cgg 23

<210> SEQ ID NO 1405
<211> LENGTH: 23
<212> TYPE: DNA
<213> ORGANISM: Homo sapiens

<400> SEQUENCE: 1405 ccgggggaac ctagtccgcc tgg 23

<210> SEQ ID NO 1406
<211> LENGTH: 23
<212> TYPE: DNA
<213> ORGANISM: Homo sapiens

<400> SEQUENCE: 1406 caatcagcag gacacgggcg ggg 23

<210> SEQ ID NO 1407
<211> LENGTH: 23
<212> TYPE: DNA
<213> ORGANISM: Homo sapiens

<400> SEQUENCE: 1407 ccattttaca gagcgctgat tgg 23

<210> SEQ ID NO 1408
<211> LENGTH: 23
<212> TYPE: DNA
<213> ORGANISM: Homo sapiens

<400> SEQUENCE: 1408 aacgtgagcc tgcgctgcgc ggg 23

<210> SEQ ID NO 1409
<211> LENGTH: 23
<212> TYPE: DNA
<213> ORGANISM: Homo sapiens

<400> SEQUENCE: 1409 caacgtgagc ctgcgctgcg cgg 23

<210> SEQ ID NO 1410
<211> LENGTH: 23
<212> TYPE: DNA
<213> ORGANISM: Homo sapiens

<400> SEQUENCE: 1410 gctgcgctgc gacagcacgt agg 23

<210> SEQ ID NO 1411
<211> LENGTH: 23
<212> TYPE: DNA
<213> ORGANISM: Homo sapiens

<400> SEQUENCE: 1411 cgacagcacg tagggcgcgg agg 23

<210> SEQ ID NO 1412
<211> LENGTH: 23
<212> TYPE: DNA

<213> ORGANISM: Homo sapiens

<400> SEQUENCE: 1412 cgtgctgtcg cagcgcagcg agg 23

<210> SEQ ID NO 1413
<211> LENGTH: 23
<212> TYPE: DNA
<213> ORGANISM: Homo sapiens

<400> SEQUENCE: 1413 ctgggccgac ttcacgctgc tgg 23

<210> SEQ ID NO 1414
<211> LENGTH: 23
<212> TYPE: DNA
<213> ORGANISM: Homo sapiens

<400> SEQUENCE: 1414 cagcagcgtg aagtcggccc agg 23

<210> SEQ ID NO 1415
<211> LENGTH: 23
<212> TYPE: DNA
<213> ORGANISM: Homo sapiens

<400> SEQUENCE: 1415 gctcctccga ctacacccgg ggg 23

<210> SEQ ID NO 1416
<211> LENGTH: 23
<212> TYPE: DNA
<213> ORGANISM: Homo sapiens

<400> SEQUENCE: 1416 gctggctgag ctccgcggaa cgg 23

<210> SEQ ID NO 1417
<211> LENGTH: 23
<212> TYPE: DNA
<213> ORGANISM: Homo sapiens

<400> SEQUENCE: 1417 gctgtaccgc gagggcgtgg cgg 23

<210> SEQ ID NO 1418
<211> LENGTH: 23
<212> TYPE: DNA
<213> ORGANISM: Homo sapiens

<400> SEQUENCE: 1418 cgaagctcat gttccgcagg cgg 23

<210> SEQ ID NO 1419
<211> LENGTH: 23
<212> TYPE: DNA
<213> ORGANISM: Homo sapiens

<400> SEQUENCE: 1419 ggctcctccg actacacccg ggg 23

<210> SEQ ID NO 1420
<211> LENGTH: 23

<212> TYPE: DNA
<213> ORGANISM: Homo sapiens

<400> SEQUENCE: 1420 agagtctgct tccacgttgt ggg 23

<210> SEQ ID NO 1421
<211> LENGTH: 23
<212> TYPE: DNA
<213> ORGANISM: Homo sapiens

<400> SEQUENCE: 1421 ctggctcctc cgactacacc cgg 23

<210> SEQ ID NO 1422
<211> LENGTH: 23
<212> TYPE: DNA
<213> ORGANISM: Homo sapiens

<400> SEQUENCE: 1422 caaagttgag ggggagtcga tgg 23

<210> SEQ ID NO 1423
<211> LENGTH: 23
<212> TYPE: DNA
<213> ORGANISM: Homo sapiens

<400> SEQUENCE: 1423 caggcggact aggttccccc ggg 23

<210> SEQ ID NO 1424
<211> LENGTH: 23
<212> TYPE: DNA
<213> ORGANISM: Homo sapiens

<400> SEQUENCE: 1424 ggacacgggc ggggacaata agg 23

<210> SEQ ID NO 1425
<211> LENGTH: 23
<212> TYPE: DNA
<213> ORGANISM: Homo sapiens

<400> SEQUENCE: 1425 cggagtggcg gtactgcagc ggg 23

<210> SEQ ID NO 1426
<211> LENGTH: 23
<212> TYPE: DNA
<213> ORGANISM: Homo sapiens

<400> SEQUENCE: 1426 ggagtggcgg tactgcagcg ggg 23

<210> SEQ ID NO 1427
<211> LENGTH: 23
<212> TYPE: DNA
<213> ORGANISM: Homo sapiens

<400> SEQUENCE: 1427 agtcagaacc gcgctcctgc tgg 23

<210> SEQ ID NO 1428

<211> LENGTH: 23
<212> TYPE: DNA
<213> ORGANISM: Homo sapiens

<400> SEQUENCE: 1428 ccaggcggac taggttcccc cgg 23

<210> SEQ ID NO 1429
<211> LENGTH: 23
<212> TYPE: DNA
<213> ORGANISM: Homo sapiens

<400> SEQUENCE: 1429 cctcatctcc ctgggcgcgc tgg 23

<210> SEQ ID NO 1430
<211> LENGTH: 23
<212> TYPE: DNA
<213> ORGANISM: Homo sapiens

<400> SEQUENCE: 1430 gcggagtggc ggtactgcag cgg 23

<210> SEQ ID NO 1431
<211> LENGTH: 23
<212> TYPE: DNA
<213> ORGANISM: Homo sapiens

<400> SEQUENCE: 1431 tggctcctcc gactacaccc ggg 23

<210> SEQ ID NO 1432
<211> LENGTH: 23
<212> TYPE: DNA
<213> ORGANISM: Homo sapiens

<400> SEQUENCE: 1432 tcgatggagg cttcaactcc tgg 23

<210> SEQ ID NO 1433
<211> LENGTH: 23
<212> TYPE: DNA
<213> ORGANISM: Homo sapiens

<400> SEQUENCE: 1433 gaacctagtc cgcctggggc tgg 23

<210> SEQ ID NO 1434
<211> LENGTH: 23
<212> TYPE: DNA
<213> ORGANISM: Homo sapiens

<400> SEQUENCE: 1434 ttggcgccag gacccaccac cgg 23

<210> SEQ ID NO 1435
<211> LENGTH: 23
<212> TYPE: DNA
<213> ORGANISM: Homo sapiens

<400> SEQUENCE: 1435 cgtgtgatag tagcagctgt agg 23

<210> SEQ ID NO 1436
<211> LENGTH: 23
<212> TYPE: DNA
<213> ORGANISM: Homo sapiens

<400> SEQUENCE: 1436 gtcgcagcgc agcgaggtgc tgg 23

<210> SEQ ID NO 1437
<211> LENGTH: 23
<212> TYPE: DNA
<213> ORGANISM: Homo sapiens

<400> SEQUENCE: 1437 ccaatcagca ggacacgggc ggg 23

<210> SEQ ID NO 1438
<211> LENGTH: 23
<212> TYPE: DNA
<213> ORGANISM: Homo sapiens

<400> SEQUENCE: 1438 agaacaaagc tcccacaacg tgg 23

<210> SEQ ID NO 1439
<211> LENGTH: 23
<212> TYPE: DNA
<213> ORGANISM: Homo sapiens

<400> SEQUENCE: 1439 cagagtctgc ttccacgttg tgg 23

<210> SEQ ID NO 1440
<211> LENGTH: 23
<212> TYPE: DNA
<213> ORGANISM: Homo sapiens

<400> SEQUENCE: 1440 ccaatcagcg ctctgtaaaa tgg 23

<210> SEQ ID NO 1441
<211> LENGTH: 23
<212> TYPE: DNA
<213> ORGANISM: Homo sapiens

<400> SEQUENCE: 1441 gacacgggcg gggacaataa ggg 23

<210> SEQ ID NO 1442
<211> LENGTH: 23
<212> TYPE: DNA
<213> ORGANISM: Homo sapiens

<400> SEQUENCE: 1442 ccgggcagcg ccaccagcga cgg 23

<210> SEQ ID NO 1443
<211> LENGTH: 23
<212> TYPE: DNA
<213> ORGANISM: Homo sapiens

<400> SEQUENCE: 1443 gctgccgcgg ccgtcgctgg tgg 23

<210> SEQ ID NO 1444
<211> LENGTH: 23
<212> TYPE: DNA
<213> ORGANISM: Homo sapiens

<400> SEQUENCE: 1444 cgatggaggc ttcaactcct ggg 23

<210> SEQ ID NO 1445
<211> LENGTH: 23
<212> TYPE: DNA
<213> ORGANISM: Homo sapiens

<400> SEQUENCE: 1445 agcttctccg ccactcaggt tgg 23

<210> SEQ ID NO 1446
<211> LENGTH: 23
<212> TYPE: DNA
<213> ORGANISM: Homo sapiens

<400> SEQUENCE: 1446 cccgagactt ccaacctgag tgg 23

<210> SEQ ID NO 1447
<211> LENGTH: 23
<212> TYPE: DNA
<213> ORGANISM: Homo sapiens

<400> SEQUENCE: 1447 ggcgcccagc agcgtgaagt cgg 23

<210> SEQ ID NO 1448
<211> LENGTH: 23
<212> TYPE: DNA
<213> ORGANISM: Homo sapiens

<400> SEQUENCE: 1448 gactagactc ctggatctga ggg 23

<210> SEQ ID NO 1449
<211> LENGTH: 23
<212> TYPE: DNA
<213> ORGANISM: Homo sapiens

<400> SEQUENCE: 1449 cggccagccc caggcggact agg 23

<210> SEQ ID NO 1450
<211> LENGTH: 23
<212> TYPE: DNA
<213> ORGANISM: Homo sapiens

<400> SEQUENCE: 1450 gattcgaacc ctctgtcttc tgg 23

<210> SEQ ID NO 1451
<211> LENGTH: 23
<212> TYPE: DNA
<213> ORGANISM: Homo sapiens

<400> SEQUENCE: 1451 cacaacgtgg aagcagactc tgg 23

<210> SEQ ID NO 1452
<211> LENGTH: 23
<212> TYPE: DNA
<213> ORGANISM: Homo sapiens

<400> SEQUENCE: 1452 gtagcagctg taggtgccgg ggg 23

<210> SEQ ID NO 1453
<211> LENGTH: 23
<212> TYPE: DNA
<213> ORGANISM: Homo sapiens

<400> SEQUENCE: 1453 gcgaggtgct ggtcatcagc tgg 23

<210> SEQ ID NO 1454
<211> LENGTH: 23
<212> TYPE: DNA
<213> ORGANISM: Homo sapiens

<400> SEQUENCE: 1454 atagtagcag ctgtaggtgc cgg 23

<210> SEQ ID NO 1455
<211> LENGTH: 23
<212> TYPE: DNA
<213> ORGANISM: Homo sapiens

<400> SEQUENCE: 1455 gagctggagg actagactcc tgg 23

<210> SEQ ID NO 1456
<211> LENGTH: 23
<212> TYPE: DNA
<213> ORGANISM: Homo sapiens

<400> SEQUENCE: 1456 ggctgcagga ctagacccct ggg 23

<210> SEQ ID NO 1457
<211> LENGTH: 23
<212> TYPE: DNA
<213> ORGANISM: Homo sapiens

<400> SEQUENCE: 1457 agttgagggg gagtcgatgg agg 23

<210> SEQ ID NO 1458
<211> LENGTH: 23
<212> TYPE: DNA
<213> ORGANISM: Homo sapiens

<400> SEQUENCE: 1458 acagggcaca gcggggtcta agg 23

<210> SEQ ID NO 1459
<211> LENGTH: 23
<212> TYPE: DNA
<213> ORGANISM: Homo sapiens

<400> SEQUENCE: 1459 ctactactac agtgagtaga cgg 23

<210> SEQ ID NO 1460
<211> LENGTH: 23
<212> TYPE: DNA
<213> ORGANISM: Homo sapiens

<400> SEQUENCE: 1460 accaatcagc aggacacggg cgg 23

<210> SEQ ID NO 1461
<211> LENGTH: 23
<212> TYPE: DNA
<213> ORGANISM: Homo sapiens

<400> SEQUENCE: 1461 gctcccggac cccaaagtct ggg 23

<210> SEQ ID NO 1462
<211> LENGTH: 23
<212> TYPE: DNA
<213> ORGANISM: Homo sapiens

<400> SEQUENCE: 1462 ccactcaggt tggaagtctc ggg 23

<210> SEQ ID NO 1463
<211> LENGTH: 23
<212> TYPE: DNA
<213> ORGANISM: Homo sapiens

<400> SEQUENCE: 1463 gccactcagg ttggaagtct cgg 23

<210> SEQ ID NO 1464
<211> LENGTH: 23
<212> TYPE: DNA
<213> ORGANISM: Homo sapiens

<400> SEQUENCE: 1464 acgtggaagc agactctggt ggg 23

<210> SEQ ID NO 1465
<211> LENGTH: 23
<212> TYPE: DNA
<213> ORGANISM: Homo sapiens

<400> SEQUENCE: 1465 ggagctgccg cggccgtcgc tgg 23

<210> SEQ ID NO 1466
<211> LENGTH: 23
<212> TYPE: DNA
<213> ORGANISM: Homo sapiens

<400> SEQUENCE: 1466 agtagcagct gtaggtgccg ggg 23

<210> SEQ ID NO 1467
<211> LENGTH: 23
<212> TYPE: DNA
<213> ORGANISM: Homo sapiens

<400> SEQUENCE: 1467 agctcccgga ccccaaagtc tgg 23

<210> SEQ ID NO 1468
<211> LENGTH: 23
<212> TYPE: DNA
<213> ORGANISM: Homo sapiens

<400> SEQUENCE: 1468 cagtgagtag acggcagtgc tgg 23

<210> SEQ ID NO 1469
<211> LENGTH: 23
<212> TYPE: DNA
<213> ORGANISM: Homo sapiens

<400> SEQUENCE: 1469 ccatcttaca gagtgctgat tgg 23

<210> SEQ ID NO 1470
<211> LENGTH: 23
<212> TYPE: DNA
<213> ORGANISM: Homo sapiens

<400> SEQUENCE: 1470 gcgctgcccg ggccggtggt ggg 23

<210> SEQ ID NO 1471
<211> LENGTH: 23
<212> TYPE: DNA
<213> ORGANISM: Homo sapiens

<400> SEQUENCE: 1471 ccaatcagca ctctgtaaga tgg 23

<210> SEQ ID NO 1472
<211> LENGTH: 23
<212> TYPE: DNA
<213> ORGANISM: Homo sapiens

<400> SEQUENCE: 1472 tagtagcagc tgtaggtgcc ggg 23

<210> SEQ ID NO 1473
<211> LENGTH: 23
<212> TYPE: DNA
<213> ORGANISM: Homo sapiens

<400> SEQUENCE: 1473 cgaggtgctg gtcatcagct ggg 23

<210> SEQ ID NO 1474
<211> LENGTH: 23
<212> TYPE: DNA
<213> ORGANISM: Homo sapiens

<400> SEQUENCE: 1474 gggctgcagg actagacccc tgg 23

<210> SEQ ID NO 1475
<211> LENGTH: 23
<212> TYPE: DNA
<213> ORGANISM: Homo sapiens

<400> SEQUENCE: 1475 ggtccctaag tccaccccag ggg 23

<210> SEQ ID NO 1476
<211> LENGTH: 23
<212> TYPE: DNA
<213> ORGANISM: Homo sapiens

<400> SEQUENCE: 1476 gagacttcca acctgagtgg cgg 23

<210> SEQ ID NO 1477
<211> LENGTH: 23
<212> TYPE: DNA
<213> ORGANISM: Homo sapiens

<400> SEQUENCE: 1477 ttcaacccag gaagtccagc tgg 23

<210> SEQ ID NO 1478
<211> LENGTH: 23
<212> TYPE: DNA
<213> ORGANISM: Homo sapiens

<400> SEQUENCE: 1478 tagtgagacg tgaagccagc tgg 23

<210> SEQ ID NO 1479
<211> LENGTH: 23
<212> TYPE: DNA
<213> ORGANISM: Homo sapiens

<400> SEQUENCE: 1479 agtgagtaga cggcagtgct ggg 23

<210> SEQ ID NO 1480
<211> LENGTH: 23
<212> TYPE: DNA
<213> ORGANISM: Homo sapiens

<400> SEQUENCE: 1480 tgtaaaatgg accaatcagc agg 23

<210> SEQ ID NO 1481
<211> LENGTH: 23
<212> TYPE: DNA
<213> ORGANISM: Homo sapiens

<400> SEQUENCE: 1481 tgcgctgcgc gggccgcctg cgg 23

<210> SEQ ID NO 1482
<211> LENGTH: 23
<212> TYPE: DNA
<213> ORGANISM: Homo sapiens

<400> SEQUENCE: 1482 gcaggcggcc cgcgcagcgc agg 23

<210> SEQ ID NO 1483
<211> LENGTH: 23
<212> TYPE: DNA
<213> ORGANISM: Homo sapiens

<400> SEQUENCE: 1483 aactttgaga ctgtagagtc agg 23

<210> SEQ ID NO 1484
<211> LENGTH: 23
<212> TYPE: DNA
<213> ORGANISM: Homo sapiens

<400> SEQUENCE: 1484 cagcccctgg ggtggactta ggg 23

<210> SEQ ID NO 1485
<211> LENGTH: 23
<212> TYPE: DNA
<213> ORGANISM: Homo sapiens

<400> SEQUENCE: 1485 actctacagt ctcaaagttg agg 23

<210> SEQ ID NO 1486
<211> LENGTH: 23
<212> TYPE: DNA
<213> ORGANISM: Homo sapiens

<400> SEQUENCE: 1486 ggcggatacc agcaggagcg cgg 23

<210> SEQ ID NO 1487
<211> LENGTH: 23
<212> TYPE: DNA
<213> ORGANISM: Homo sapiens

<400> SEQUENCE: 1487 aacctgagtg gcggagaagc tgg 23

<210> SEQ ID NO 1488
<211> LENGTH: 23
<212> TYPE: DNA
<213> ORGANISM: Homo sapiens

<400> SEQUENCE: 1488 tggacttcct gggttgaatg ggg 23

<210> SEQ ID NO 1489
<211> LENGTH: 23
<212> TYPE: DNA
<213> ORGANISM: Homo sapiens

<400> SEQUENCE: 1489 ggactagact cctggatctg agg 23

<210> SEQ ID NO 1490
<211> LENGTH: 23
<212> TYPE: DNA
<213> ORGANISM: Homo sapiens

<400> SEQUENCE: 1490 tccaggtccc cattcaaccc agg 23

<210> SEQ ID NO 1491
<211> LENGTH: 23
<212> TYPE: DNA

<213> ORGANISM: Homo sapiens

<400> SEQUENCE: 1491 gcggggccgc cacgccctcg cgg 23

<210> SEQ ID NO 1492
<211> LENGTH: 23
<212> TYPE: DNA
<213> ORGANISM: Homo sapiens

<400> SEQUENCE: 1492 gccaggaccc accaccggcc cgg 23

<210> SEQ ID NO 1493
<211> LENGTH: 23
<212> TYPE: DNA
<213> ORGANISM: Homo sapiens

<400> SEQUENCE: 1493 gactagaccc ctgggtctga agg 23

<210> SEQ ID NO 1494
<211> LENGTH: 23
<212> TYPE: DNA
<213> ORGANISM: Homo sapiens

<400> SEQUENCE: 1494 gtactggggc ccgggaatcc tgg 23

<210> SEQ ID NO 1495
<211> LENGTH: 23
<212> TYPE: DNA
<213> ORGANISM: Homo sapiens

<400> SEQUENCE: 1495 ccggctccgc ccgcagactc tgg 23

<210> SEQ ID NO 1496
<211> LENGTH: 23
<212> TYPE: DNA
<213> ORGANISM: Homo sapiens

<400> SEQUENCE: 1496 ccagagtctg cgggcggagc cgg 23

<210> SEQ ID NO 1497
<211> LENGTH: 23
<212> TYPE: DNA
<213> ORGANISM: Homo sapiens

<400> SEQUENCE: 1497 gtctcgggct gcagtgctcc tgg 23

<210> SEQ ID NO 1498
<211> LENGTH: 23
<212> TYPE: DNA
<213> ORGANISM: Homo sapiens

<400> SEQUENCE: 1498 acctgagtgg cggagaagct ggg 23

<210> SEQ ID NO 1499
<211> LENGTH: 23

<212> TYPE: DNA
<213> ORGANISM: Homo sapiens

<400> SEQUENCE: 1499 ctacagtctc aaagttgagg ggg 23

<210> SEQ ID NO 1500
<211> LENGTH: 23
<212> TYPE: DNA
<213> ORGANISM: Homo sapiens

<400> SEQUENCE: 1500 gagttcaggg cccagacttt ggg 23

<210> SEQ ID NO 1501
<211> LENGTH: 23
<212> TYPE: DNA
<213> ORGANISM: Homo sapiens

<400> SEQUENCE: 1501 gctggacttc ctgggttgaa tgg 23

<210> SEQ ID NO 1502
<211> LENGTH: 23
<212> TYPE: DNA
<213> ORGANISM: Homo sapiens

<400> SEQUENCE: 1502 ctggacttcc tgggttgaat ggg 23

<210> SEQ ID NO 1503
<211> LENGTH: 23
<212> TYPE: DNA
<213> ORGANISM: Homo sapiens

<400> SEQUENCE: 1503 tggaccaatc agcaggacac ggg 23

<210> SEQ ID NO 1504
<211> LENGTH: 23
<212> TYPE: DNA
<213> ORGANISM: Homo sapiens

<400> SEQUENCE: 1504 accgccactc cgcgcagccc tgg 23

<210> SEQ ID NO 1505
<211> LENGTH: 23
<212> TYPE: DNA
<213> ORGANISM: Homo sapiens

<400> SEQUENCE: 1505 tactggggcc cgggaatcct ggg 23

<210> SEQ ID NO 1506
<211> LENGTH: 23
<212> TYPE: DNA
<213> ORGANISM: Homo sapiens

<400> SEQUENCE: 1506 caggtcccta agtccacccc agg 23

<210> SEQ ID NO 1507

<211> LENGTH: 23
<212> TYPE: DNA
<213> ORGANISM: Homo sapiens

<400> SEQUENCE: 1507 ttccgcggag ctcagccagc agg 23

<210> SEQ ID NO 1508
<211> LENGTH: 23
<212> TYPE: DNA
<213> ORGANISM: Homo sapiens

<400> SEQUENCE: 1508 cgtggaagca gactctggtg ggg 23

<210> SEQ ID NO 1509
<211> LENGTH: 23
<212> TYPE: DNA
<213> ORGANISM: Homo sapiens

<400> SEQUENCE: 1509 aacgtggaag cagactctgg tgg 23

<210> SEQ ID NO 1510
<211> LENGTH: 23
<212> TYPE: DNA
<213> ORGANISM: Homo sapiens

<400> SEQUENCE: 1510 cgtcgctggt ggcgctgccc ggg 23

<210> SEQ ID NO 1511
<211> LENGTH: 23
<212> TYPE: DNA
<213> ORGANISM: Homo sapiens

<400> SEQUENCE: 1511 ccgtcgctgg tggcgctgcc cgg 23

<210> SEQ ID NO 1512
<211> LENGTH: 23
<212> TYPE: DNA
<213> ORGANISM: Homo sapiens

<400> SEQUENCE: 1512 cctggactgc tggatcagga agg 23

<210> SEQ ID NO 1513
<211> LENGTH: 23
<212> TYPE: DNA
<213> ORGANISM: Homo sapiens

<400> SEQUENCE: 1513 cccgggccgg tggtgggtcc tgg 23

<210> SEQ ID NO 1514
<211> LENGTH: 23
<212> TYPE: DNA
<213> ORGANISM: Homo sapiens

<400> SEQUENCE: 1514 gctgtaggtg ccgggggcgc ggg 23

<210> SEQ ID NO 1515
<211> LENGTH: 23
<212> TYPE: DNA
<213> ORGANISM: Homo sapiens

<400> SEQUENCE: 1515 ggtctgaggg cggaggtcct ggg 23

<210> SEQ ID NO 1516
<211> LENGTH: 23
<212> TYPE: DNA
<213> ORGANISM: Homo sapiens

<400> SEQUENCE: 1516 aggtccctaa gtccacccca ggg 23

<210> SEQ ID NO 1517
<211> LENGTH: 23
<212> TYPE: DNA
<213> ORGANISM: Homo sapiens

<400> SEQUENCE: 1517 cagagtctgc gggcggagcc ggg 23

<210> SEQ ID NO 1518
<211> LENGTH: 23
<212> TYPE: DNA
<213> ORGANISM: Homo sapiens

<400> SEQUENCE: 1518 tctcgggctg cagtgctcct ggg 23

<210> SEQ ID NO 1519
<211> LENGTH: 23
<212> TYPE: DNA
<213> ORGANISM: Homo sapiens

<400> SEQUENCE: 1519 gaagtcggcc cagggctgcg cgg 23

<210> SEQ ID NO 1520
<211> LENGTH: 23
<212> TYPE: DNA
<213> ORGANISM: Homo sapiens

<400> SEQUENCE: 1520 cccgggaatc ctgggtctga ggg 23

<210> SEQ ID NO 1521
<211> LENGTH: 23
<212> TYPE: DNA
<213> ORGANISM: Homo sapiens

<400> SEQUENCE: 1521 tcggaggagc cagagtctgc ggg 23

<210> SEQ ID NO 1522
<211> LENGTH: 23
<212> TYPE: DNA
<213> ORGANISM: Homo sapiens

<400> SEQUENCE: 1522 tctacagtct caaagttgag ggg 23

<210> SEQ ID NO 1523
<211> LENGTH: 23
<212> TYPE: DNA
<213> ORGANISM: Homo sapiens

<400> SEQUENCE: 1523 ctctacagtc tcaaagttga ggg 23

<210> SEQ ID NO 1524
<211> LENGTH: 23
<212> TYPE: DNA
<213> ORGANISM: Homo sapiens

<400> SEQUENCE: 1524 agttcagggc ccagactttg ggg 23

<210> SEQ ID NO 1525
<211> LENGTH: 23
<212> TYPE: DNA
<213> ORGANISM: Homo sapiens

<400> SEQUENCE: 1525 tgaagccagc tggacttcct ggg 23

<210> SEQ ID NO 1526
<211> LENGTH: 23
<212> TYPE: DNA
<213> ORGANISM: Homo sapiens

<400> SEQUENCE: 1526 ctggaaagaa gctacagcac agg 23

<210> SEQ ID NO 1527
<211> LENGTH: 23
<212> TYPE: DNA
<213> ORGANISM: Homo sapiens

<400> SEQUENCE: 1527 tagactcctg gatctgaggg agg 23

<210> SEQ ID NO 1528
<211> LENGTH: 23
<212> TYPE: DNA
<213> ORGANISM: Homo sapiens

<400> SEQUENCE: 1528 aagtctgggc cctgaactcc agg 23

<210> SEQ ID NO 1529
<211> LENGTH: 23
<212> TYPE: DNA
<213> ORGANISM: Homo sapiens

<400> SEQUENCE: 1529 atggaccaat cagcaggaca cgg 23

<210> SEQ ID NO 1530
<211> LENGTH: 23
<212> TYPE: DNA
<213> ORGANISM: Homo sapiens

<400> SEQUENCE: 1530 ccgccactcc gcgcagccct ggg 23

<210> SEQ ID NO 1531
<211> LENGTH: 23
<212> TYPE: DNA
<213> ORGANISM: Homo sapiens

<400> SEQUENCE: 1531 agctgtaggt gccgggggcg cgg 23

<210> SEQ ID NO 1532
<211> LENGTH: 23
<212> TYPE: DNA
<213> ORGANISM: Homo sapiens

<400> SEQUENCE: 1532 ccttcctgat ccagcagtcc agg 23

<210> SEQ ID NO 1533
<211> LENGTH: 23
<212> TYPE: DNA
<213> ORGANISM: Homo sapiens

<400> SEQUENCE: 1533 ctgcattcct ggggcggagg agg 23

<210> SEQ ID NO 1534
<211> LENGTH: 23
<212> TYPE: DNA
<213> ORGANISM: Homo sapiens

<400> SEQUENCE: 1534 tagacccctg ggtctgaagg agg 23

<210> SEQ ID NO 1535
<211> LENGTH: 23
<212> TYPE: DNA
<213> ORGANISM: Homo sapiens

<400> SEQUENCE: 1535 tcccagcttc tccgccactc agg 23

<210> SEQ ID NO 1536
<211> LENGTH: 23
<212> TYPE: DNA
<213> ORGANISM: Homo sapiens

<400> SEQUENCE: 1536 tttcccaagg agtagctgaa agg 23

<210> SEQ ID NO 1537
<211> LENGTH: 23
<212> TYPE: DNA
<213> ORGANISM: Homo sapiens

<400> SEQUENCE: 1537 gaaccctctg tcttctggct tgg 23

<210> SEQ ID NO 1538
<211> LENGTH: 23
<212> TYPE: DNA
<213> ORGANISM: Homo sapiens

<400> SEQUENCE: 1538 cttacaagag gattgtaaaa tgg 23

<210> SEQ ID NO 1539
<211> LENGTH: 23
<212> TYPE: DNA
<213> ORGANISM: Homo sapiens

<400> SEQUENCE: 1539 gcagctcctc tgcagagacg ggg 23

<210> SEQ ID NO 1540
<211> LENGTH: 23
<212> TYPE: DNA
<213> ORGANISM: Homo sapiens

<400> SEQUENCE: 1540 ctcctccgcc ccaggaatgc agg 23

<210> SEQ ID NO 1541
<211> LENGTH: 23
<212> TYPE: DNA
<213> ORGANISM: Homo sapiens

<400> SEQUENCE: 1541 ggtatccgcc cctgagcccc agg 23

<210> SEQ ID NO 1542
<211> LENGTH: 23
<212> TYPE: DNA
<213> ORGANISM: Homo sapiens

<400> SEQUENCE: 1542 tagtagtagc agctacagaa agg 23

<210> SEQ ID NO 1543
<211> LENGTH: 23
<212> TYPE: DNA
<213> ORGANISM: Homo sapiens

<400> SEQUENCE: 1543 tttcagctac tccttgggaa agg 23

<210> SEQ ID NO 1544
<211> LENGTH: 23
<212> TYPE: DNA
<213> ORGANISM: Homo sapiens

<400> SEQUENCE: 1544 ggtggcgctg cccgggccgg tgg 23

<210> SEQ ID NO 1545
<211> LENGTH: 23
<212> TYPE: DNA
<213> ORGANISM: Homo sapiens

<400> SEQUENCE: 1545 ccaggaccca ccaccggccc ggg 23

<210> SEQ ID NO 1546
<211> LENGTH: 23
<212> TYPE: DNA
<213> ORGANISM: Homo sapiens

<400> SEQUENCE: 1546 cccaggaatc ctgggtctga ggg 23

<210> SEQ ID NO 1547
<211> LENGTH: 23
<212> TYPE: DNA
<213> ORGANISM: Homo sapiens

<400> SEQUENCE: 1547 ggggcctgga ctgctggatc agg 23

<210> SEQ ID NO 1548
<211> LENGTH: 23
<212> TYPE: DNA
<213> ORGANISM: Homo sapiens

<400> SEQUENCE: 1548 ccagcccctg gggtggactt agg 23

<210> SEQ ID NO 1549
<211> LENGTH: 23
<212> TYPE: DNA
<213> ORGANISM: Homo sapiens

<400> SEQUENCE: 1549 tagtccgcct ggggctggcc ggg 23

<210> SEQ ID NO 1550
<211> LENGTH: 23
<212> TYPE: DNA
<213> ORGANISM: Homo sapiens

<400> SEQUENCE: 1550 cgggctggtc ctcatctccc tgg 23

<210> SEQ ID NO 1551
<211> LENGTH: 23
<212> TYPE: DNA
<213> ORGANISM: Homo sapiens

<400> SEQUENCE: 1551 ctagtccgcc tggggctggc cgg 23

<210> SEQ ID NO 1552
<211> LENGTH: 23
<212> TYPE: DNA
<213> ORGANISM: Homo sapiens

<400> SEQUENCE: 1552 cttcctttca gctactcctt ggg 23

<210> SEQ ID NO 1553
<211> LENGTH: 23
<212> TYPE: DNA
<213> ORGANISM: Homo sapiens

<400> SEQUENCE: 1553 gtaagacaga aaagttctcc agg 23

<210> SEQ ID NO 1554
<211> LENGTH: 23
<212> TYPE: DNA
<213> ORGANISM: Homo sapiens

<400> SEQUENCE: 1554 cggcccaggg ctgcgcggag tgg 23

<210> SEQ ID NO 1555
<211> LENGTH: 23
<212> TYPE: DNA
<213> ORGANISM: Homo sapiens

<400> SEQUENCE: 1555 ctgctgggcg cccgcgcccc cgg 23

<210> SEQ ID NO 1556
<211> LENGTH: 23
<212> TYPE: DNA
<213> ORGANISM: Homo sapiens

<400> SEQUENCE: 1556 ggcctgcatt cctggggcgg agg 23

<210> SEQ ID NO 1557
<211> LENGTH: 23
<212> TYPE: DNA
<213> ORGANISM: Homo sapiens

<400> SEQUENCE: 1557 ctcgggctgc agtgctcctg ggg 23

<210> SEQ ID NO 1558
<211> LENGTH: 23
<212> TYPE: DNA
<213> ORGANISM: Homo sapiens

<400> SEQUENCE: 1558 agctcagcca gcaggactgt ggg 23

<210> SEQ ID NO 1559
<211> LENGTH: 23
<212> TYPE: DNA
<213> ORGANISM: Homo sapiens

<400> SEQUENCE: 1559 gaacttttct gtcttacaag agg 23

<210> SEQ ID NO 1560
<211> LENGTH: 23
<212> TYPE: DNA
<213> ORGANISM: Homo sapiens

<400> SEQUENCE: 1560 ggcgctgccc gggccggtgg tgg 23

<210> SEQ ID NO 1561
<211> LENGTH: 23
<212> TYPE: DNA
<213> ORGANISM: Homo sapiens

<400> SEQUENCE: 1561 gtctgagggc ggaggtcctg ggg 23

<210> SEQ ID NO 1562
<211> LENGTH: 23
<212> TYPE: DNA
<213> ORGANISM: Homo sapiens

<400> SEQUENCE: 1562 gggtctgagg gcggaggtcc tgg 23

<210> SEQ ID NO 1563
<211> LENGTH: 23
<212> TYPE: DNA
<213> ORGANISM: Homo sapiens

<400> SEQUENCE: 1563 cccagggctg cgcggagtgg cgg 23

<210> SEQ ID NO 1564
<211> LENGTH: 23
<212> TYPE: DNA
<213> ORGANISM: Homo sapiens

<400> SEQUENCE: 1564 aggaggcggg ccgggcctca ggg 23

<210> SEQ ID NO 1565
<211> LENGTH: 23
<212> TYPE: DNA
<213> ORGANISM: Homo sapiens

<400> SEQUENCE: 1565 cctaagtcca ccccaggggc tgg 23

<210> SEQ ID NO 1566
<211> LENGTH: 23
<212> TYPE: DNA
<213> ORGANISM: Homo sapiens

<400> SEQUENCE: 1566 gctactcctt gggaaaggcc tgg 23

<210> SEQ ID NO 1567
<211> LENGTH: 23
<212> TYPE: DNA
<213> ORGANISM: Homo sapiens

<400> SEQUENCE: 1567 tctctgcaga ggagctgccg cgg 23

<210> SEQ ID NO 1568
<211> LENGTH: 23
<212> TYPE: DNA
<213> ORGANISM: Homo sapiens

<400> SEQUENCE: 1568 gtgctggtca tcagctggga agg 23

<210> SEQ ID NO 1569
<211> LENGTH: 23
<212> TYPE: DNA
<213> ORGANISM: Homo sapiens

<400> SEQUENCE: 1569 ggctggaaac ctggagttca ggg 23

<210> SEQ ID NO 1570
<211> LENGTH: 23
<212> TYPE: DNA

<213> ORGANISM: Homo sapiens

<400> SEQUENCE: 1570 agggcccaga ctttggggtc cgg 23

<210> SEQ ID NO 1571
<211> LENGTH: 23
<212> TYPE: DNA
<213> ORGANISM: Homo sapiens

<400> SEQUENCE: 1571 agctgatggc ccctctctcc cgg 23

<210> SEQ ID NO 1572
<211> LENGTH: 23
<212> TYPE: DNA
<213> ORGANISM: Homo sapiens

<400> SEQUENCE: 1572 ccagcgcgcc cagggagatg agg 23

<210> SEQ ID NO 1573
<211> LENGTH: 23
<212> TYPE: DNA
<213> ORGANISM: Homo sapiens

<400> SEQUENCE: 1573 ctacagcaca gggcacagcg ggg 23

<210> SEQ ID NO 1574
<211> LENGTH: 23
<212> TYPE: DNA
<213> ORGANISM: Homo sapiens

<400> SEQUENCE: 1574 ggagttcagg gcccagactt tgg 23

<210> SEQ ID NO 1575
<211> LENGTH: 23
<212> TYPE: DNA
<213> ORGANISM: Homo sapiens

<400> SEQUENCE: 1575 agagaggggc catcagctcc cgg 23

<210> SEQ ID NO 1576
<211> LENGTH: 23
<212> TYPE: DNA
<213> ORGANISM: Homo sapiens

<400> SEQUENCE: 1576 gctggtggcg ctgcccgggc cgg 23

<210> SEQ ID NO 1577
<211> LENGTH: 23
<212> TYPE: DNA
<213> ORGANISM: Homo sapiens

<400> SEQUENCE: 1577 ggctgggtcc caggaatcct ggg 23

<210> SEQ ID NO 1578
<211> LENGTH: 23

<212> TYPE: DNA
<213> ORGANISM: Homo sapiens

<400> SEQUENCE: 1578 gaggagccag agtctgcggg cgg 23

<210> SEQ ID NO 1579
<211> LENGTH: 23
<212> TYPE: DNA
<213> ORGANISM: Homo sapiens

<400> SEQUENCE: 1579 gcgggcggag ccgggagaga ggg 23

<210> SEQ ID NO 1580
<211> LENGTH: 23
<212> TYPE: DNA
<213> ORGANISM: Homo sapiens

<400> SEQUENCE: 1580 ggtcctgggg cctgcattcc tgg 23

<210> SEQ ID NO 1581
<211> LENGTH: 23
<212> TYPE: DNA
<213> ORGANISM: Homo sapiens

<400> SEQUENCE: 1581 ggtcatcagc tgggaaggtg agg 23

<210> SEQ ID NO 1582
<211> LENGTH: 23
<212> TYPE: DNA
<213> ORGANISM: Homo sapiens

<400> SEQUENCE: 1582 gcctggagtc ctgggtctga ggg 23

<210> SEQ ID NO 1583
<211> LENGTH: 23
<212> TYPE: DNA
<213> ORGANISM: Homo sapiens

<400> SEQUENCE: 1583 ggtctgaggg aggaggtact ggg 23

<210> SEQ ID NO 1584
<211> LENGTH: 23
<212> TYPE: DNA
<213> ORGANISM: Homo sapiens

<400> SEQUENCE: 1584 gtcggaggag ccagagtctg cgg 23

<210> SEQ ID NO 1585
<211> LENGTH: 23
<212> TYPE: DNA
<213> ORGANISM: Homo sapiens

<400> SEQUENCE: 1585 ctgtgctgta gcttctttcc agg 23

<210> SEQ ID NO 1586

<211> LENGTH: 23
<212> TYPE: DNA
<213> ORGANISM: Homo sapiens

<400> SEQUENCE: 1586 tcctgggttg aatggggacc tgg 23

<210> SEQ ID NO 1587
<211> LENGTH: 23
<212> TYPE: DNA
<213> ORGANISM: Homo sapiens

<400> SEQUENCE: 1587 gacaataagg gaataaaagc tgg 23

<210> SEQ ID NO 1588
<211> LENGTH: 23
<212> TYPE: DNA
<213> ORGANISM: Homo sapiens

<400> SEQUENCE: 1588 ctctcacccc gtctctgcag agg 23

<210> SEQ ID NO 1589
<211> LENGTH: 23
<212> TYPE: DNA
<213> ORGANISM: Homo sapiens

<400> SEQUENCE: 1589 gggcccagac tttggggtcc ggg 23

<210> SEQ ID NO 1590
<211> LENGTH: 23
<212> TYPE: DNA
<213> ORGANISM: Homo sapiens

<400> SEQUENCE: 1590 tggaaagaag ctacagcaca ggg 23

<210> SEQ ID NO 1591
<211> LENGTH: 23
<212> TYPE: DNA
<213> ORGANISM: Homo sapiens

<400> SEQUENCE: 1591 gtcctggggc ctgcattcct ggg 23

<210> SEQ ID NO 1592
<211> LENGTH: 23
<212> TYPE: DNA
<213> ORGANISM: Homo sapiens

<400> SEQUENCE: 1592 ccctcagacc caggattccc ggg 23

<210> SEQ ID NO 1593
<211> LENGTH: 23
<212> TYPE: DNA
<213> ORGANISM: Homo sapiens

<400> SEQUENCE: 1593 gctcagccag caggactgtg ggg 23

<210> SEQ ID NO 1594
<211> LENGTH: 23
<212> TYPE: DNA
<213> ORGANISM: Homo sapiens

<400> SEQUENCE: 1594 ggacctccgc cctcagaccc agg 23

<210> SEQ ID NO 1595
<211> LENGTH: 23
<212> TYPE: DNA
<213> ORGANISM: Homo sapiens

<400> SEQUENCE: 1595 aggaatcctg ggtctgaggg agg 23

<210> SEQ ID NO 1596
<211> LENGTH: 23
<212> TYPE: DNA
<213> ORGANISM: Homo sapiens

<400> SEQUENCE: 1596 cctctcctcc ttcagaccca ggg 23

<210> SEQ ID NO 1597
<211> LENGTH: 23
<212> TYPE: DNA
<213> ORGANISM: Homo sapiens

<400> SEQUENCE: 1597 tcccaggaat cctgggtctg agg 23

<210> SEQ ID NO 1598
<211> LENGTH: 23
<212> TYPE: DNA
<213> ORGANISM: Homo sapiens

<400> SEQUENCE: 1598 aactccaggt ttccagcccc tgg 23

<210> SEQ ID NO 1599
<211> LENGTH: 23
<212> TYPE: DNA
<213> ORGANISM: Homo sapiens

<400> SEQUENCE: 1599 tgcagtgctc ctggggctca ggg 23

<210> SEQ ID NO 1600
<211> LENGTH: 23
<212> TYPE: DNA
<213> ORGANISM: Homo sapiens

<400> SEQUENCE: 1600 aggaaaggac agtccagccc agg 23

<210> SEQ ID NO 1601
<211> LENGTH: 23
<212> TYPE: DNA
<213> ORGANISM: Homo sapiens

<400> SEQUENCE: 1601 cccgcccgtg tcctgctgat tgg 23

<210> SEQ ID NO 1602
<211> LENGTH: 23
<212> TYPE: DNA
<213> ORGANISM: Homo sapiens

<400> SEQUENCE: 1602 gctcctgggt ctgagggcgg agg 23

<210> SEQ ID NO 1603
<211> LENGTH: 23
<212> TYPE: DNA
<213> ORGANISM: Homo sapiens

<400> SEQUENCE: 1603 cttcctggac ccaggactcc agg 23

<210> SEQ ID NO 1604
<211> LENGTH: 23
<212> TYPE: DNA
<213> ORGANISM: Homo sapiens

<400> SEQUENCE: 1604 gtctgaggga ggaggtactg ggg 23

<210> SEQ ID NO 1605
<211> LENGTH: 23
<212> TYPE: DNA
<213> ORGANISM: Homo sapiens

<400> SEQUENCE: 1605 caccccaggg gctggaaacc tgg 23

<210> SEQ ID NO 1606
<211> LENGTH: 23
<212> TYPE: DNA
<213> ORGANISM: Homo sapiens

<400> SEQUENCE: 1606 ggactgctgg atcaggaagg agg 23

<210> SEQ ID NO 1607
<211> LENGTH: 23
<212> TYPE: DNA
<213> ORGANISM: Homo sapiens

<400> SEQUENCE: 1607 ctttggggtc cgggagctga tgg 23

<210> SEQ ID NO 1608
<211> LENGTH: 23
<212> TYPE: DNA
<213> ORGANISM: Homo sapiens

<400> SEQUENCE: 1608 ctgcagcccc acagtcctgc tgg 23

<210> SEQ ID NO 1609
<211> LENGTH: 23
<212> TYPE: DNA
<213> ORGANISM: Homo sapiens

<400> SEQUENCE: 1609 ggcggagaag ctgggaccct ggg 23

<210> SEQ ID NO 1610
<211> LENGTH: 23
<212> TYPE: DNA
<213> ORGANISM: Homo sapiens

<400> SEQUENCE: 1610 ggcagctcct ctgcagagac ggg 23

<210> SEQ ID NO 1611
<211> LENGTH: 23
<212> TYPE: DNA
<213> ORGANISM: Homo sapiens

<400> SEQUENCE: 1611 gcccgggaat cctgggtctg agg 23

<210> SEQ ID NO 1612
<211> LENGTH: 23
<212> TYPE: DNA
<213> ORGANISM: Homo sapiens

<400> SEQUENCE: 1612 gactgctgga tcaggaagga ggg 23

<210> SEQ ID NO 1613
<211> LENGTH: 23
<212> TYPE: DNA
<213> ORGANISM: Homo sapiens

<400> SEQUENCE: 1613 actcctgggt ccaggaagaa ggg 23

<210> SEQ ID NO 1614
<211> LENGTH: 23
<212> TYPE: DNA
<213> ORGANISM: Homo sapiens

<400> SEQUENCE: 1614 acttccaagc cagaagacag agg 23

<210> SEQ ID NO 1615
<211> LENGTH: 23
<212> TYPE: DNA
<213> ORGANISM: Homo sapiens

<400> SEQUENCE: 1615 attcctgggg cggaggaggc ggg 23

<210> SEQ ID NO 1616
<211> LENGTH: 23
<212> TYPE: DNA
<213> ORGANISM: Homo sapiens

<400> SEQUENCE: 1616 gccccaggaa tgcaggcccc agg 23

<210> SEQ ID NO 1617
<211> LENGTH: 23
<212> TYPE: DNA
<213> ORGANISM: Homo sapiens

<400> SEQUENCE: 1617 tccctcagac ccaggattcc cgg 23

<210> SEQ ID NO 1618
<211> LENGTH: 23
<212> TYPE: DNA
<213> ORGANISM: Homo sapiens

<400> SEQUENCE: 1618 tccctcagac ccaggattcc tgg 23

<210> SEQ ID NO 1619
<211> LENGTH: 23
<212> TYPE: DNA
<213> ORGANISM: Homo sapiens

<400> SEQUENCE: 1619 gggctgggtc ccaggaatcc tgg 23

<210> SEQ ID NO 1620
<211> LENGTH: 23
<212> TYPE: DNA
<213> ORGANISM: Homo sapiens

<400> SEQUENCE: 1620 gcctctcctc cttcagaccc agg 23

<210> SEQ ID NO 1621
<211> LENGTH: 23
<212> TYPE: DNA
<213> ORGANISM: Homo sapiens

<400> SEQUENCE: 1621 gggtctgagg gaggaggtac tgg 23

<210> SEQ ID NO 1622
<211> LENGTH: 23
<212> TYPE: DNA
<213> ORGANISM: Homo sapiens

<400> SEQUENCE: 1622 gagctcagcc agcaggactg tgg 23

<210> SEQ ID NO 1623
<211> LENGTH: 23
<212> TYPE: DNA
<213> ORGANISM: Homo sapiens

<400> SEQUENCE: 1623 gcctgggctc ctgggtctga ggg 23

<210> SEQ ID NO 1624
<211> LENGTH: 23
<212> TYPE: DNA
<213> ORGANISM: Homo sapiens

<400> SEQUENCE: 1624 gaggaggcgg gccgggcctc agg 23

<210> SEQ ID NO 1625
<211> LENGTH: 23
<212> TYPE: DNA
<213> ORGANISM: Homo sapiens

<400> SEQUENCE: 1625 ccctcagacc caggattcct ggg 23

<210> SEQ ID NO 1626
<211> LENGTH: 23
<212> TYPE: DNA
<213> ORGANISM: Homo sapiens

<400> SEQUENCE: 1626 ctggagtcct gggtccagga agg 23

<210> SEQ ID NO 1627
<211> LENGTH: 23
<212> TYPE: DNA
<213> ORGANISM: Homo sapiens

<400> SEQUENCE: 1627 ctctcctcct tcagacccag ggg 23

<210> SEQ ID NO 1628
<211> LENGTH: 23
<212> TYPE: DNA
<213> ORGANISM: Homo sapiens

<400> SEQUENCE: 1628 gggaatcctg ggtctgaggg agg 23

<210> SEQ ID NO 1629
<211> LENGTH: 23
<212> TYPE: DNA
<213> ORGANISM: Homo sapiens

<400> SEQUENCE: 1629 caggtttcca gcccctgggg tgg 23

<210> SEQ ID NO 1630
<211> LENGTH: 23
<212> TYPE: DNA
<213> ORGANISM: Homo sapiens

<400> SEQUENCE: 1630 cagggagatg aggaccagcc cgg 23

<210> SEQ ID NO 1631
<211> LENGTH: 23
<212> TYPE: DNA
<213> ORGANISM: Homo sapiens

<400> SEQUENCE: 1631 agctacagca cagggcacag cgg 23

<210> SEQ ID NO 1632
<211> LENGTH: 23
<212> TYPE: DNA
<213> ORGANISM: Homo sapiens

<400> SEQUENCE: 1632 cttccaagcc agaagacaga ggg 23

<210> SEQ ID NO 1633
<211> LENGTH: 23
<212> TYPE: DNA
<213> ORGANISM: Homo sapiens

<400> SEQUENCE: 1633 cggcccgcct cctccgcccc agg 23

<210> SEQ ID NO 1634
<211> LENGTH: 23
<212> TYPE: DNA
<213> ORGANISM: Homo sapiens

<400> SEQUENCE: 1634 tggagtcctg ggtctgaggg agg 23

<210> SEQ ID NO 1635
<211> LENGTH: 23
<212> TYPE: DNA
<213> ORGANISM: Homo sapiens

<400> SEQUENCE: 1635 gggctggaaa cctggagttc agg 23

<210> SEQ ID NO 1636
<211> LENGTH: 23
<212> TYPE: DNA
<213> ORGANISM: Homo sapiens

<400> SEQUENCE: 1636 tgcgggcgga gccgggagag agg 23

<210> SEQ ID NO 1637
<211> LENGTH: 23
<212> TYPE: DNA
<213> ORGANISM: Homo sapiens

<400> SEQUENCE: 1637 ctccaggttt ccagcccctg ggg 23

<210> SEQ ID NO 1638
<211> LENGTH: 23
<212> TYPE: DNA
<213> ORGANISM: Homo sapiens

<400> SEQUENCE: 1638 tggcggagaa gctgggaccc tgg 23

<210> SEQ ID NO 1639
<211> LENGTH: 23
<212> TYPE: DNA
<213> ORGANISM: Homo sapiens

<400> SEQUENCE: 1639 ccgcctgggg ctggccgggc tgg 23

<210> SEQ ID NO 1640
<211> LENGTH: 23
<212> TYPE: DNA
<213> ORGANISM: Homo sapiens

<400> SEQUENCE: 1640 aactcctggg tccaggaaga agg 23

<210> SEQ ID NO 1641
<211> LENGTH: 23
<212> TYPE: DNA
<213> ORGANISM: Homo sapiens

<400> SEQUENCE: 1641 cgggcggagc cgggagagag ggg 23

<210> SEQ ID NO 1642
<211> LENGTH: 23
<212> TYPE: DNA
<213> ORGANISM: Homo sapiens

<400> SEQUENCE: 1642 gcagtgctcc tggggctcag ggg 23

<210> SEQ ID NO 1643
<211> LENGTH: 23
<212> TYPE: DNA
<213> ORGANISM: Homo sapiens

<400> SEQUENCE: 1643 gctacagcac agggcacagc ggg 23

<210> SEQ ID NO 1644
<211> LENGTH: 23
<212> TYPE: DNA
<213> ORGANISM: Homo sapiens

<400> SEQUENCE: 1644 tggggcggag gaggcgggcc ggg 23

<210> SEQ ID NO 1645
<211> LENGTH: 23
<212> TYPE: DNA
<213> ORGANISM: Homo sapiens

<400> SEQUENCE: 1645 actcctggat ctgagggagg agg 23

<210> SEQ ID NO 1646
<211> LENGTH: 23
<212> TYPE: DNA
<213> ORGANISM: Homo sapiens

<400> SEQUENCE: 1646 tccctcagac ccaggactcc agg 23

<210> SEQ ID NO 1647
<211> LENGTH: 23
<212> TYPE: DNA
<213> ORGANISM: Homo sapiens

<400> SEQUENCE: 1647 agccccttct tcctggaccc agg 23

<210> SEQ ID NO 1648
<211> LENGTH: 23
<212> TYPE: DNA
<213> ORGANISM: Homo sapiens

<400> SEQUENCE: 1648 ctgcagtgct cctggggctc agg 23

<210> SEQ ID NO 1649
<211> LENGTH: 23
<212> TYPE: DNA

<213> ORGANISM: Homo sapiens

<400> SEQUENCE: 1649 gtcctgctgg ctgagctccg cgg 23

<210> SEQ ID NO 1650
<211> LENGTH: 23
<212> TYPE: DNA
<213> ORGANISM: Homo sapiens

<400> SEQUENCE: 1650 cggcagctcc tctgcagaga cgg 23

<210> SEQ ID NO 1651
<211> LENGTH: 23
<212> TYPE: DNA
<213> ORGANISM: Homo sapiens

<400> SEQUENCE: 1651 gcccctcctc cctcagatcc agg 23

<210> SEQ ID NO 1652
<211> LENGTH: 23
<212> TYPE: DNA
<213> ORGANISM: Homo sapiens

<400> SEQUENCE: 1652 actgctggat caggaaggag ggg 23

<210> SEQ ID NO 1653
<211> LENGTH: 23
<212> TYPE: DNA
<213> ORGANISM: Homo sapiens

<400> SEQUENCE: 1653 aggcttcaac tcctgggtcc agg 23

<210> SEQ ID NO 1654
<211> LENGTH: 23
<212> TYPE: DNA
<213> ORGANISM: Homo sapiens

<400> SEQUENCE: 1654 tcctggggcc tgcattcctg ggg 23

<210> SEQ ID NO 1655
<211> LENGTH: 23
<212> TYPE: DNA
<213> ORGANISM: Homo sapiens

<400> SEQUENCE: 1655 tgggctcctg ggtctgaggg cgg 23

<210> SEQ ID NO 1656
<211> LENGTH: 23
<212> TYPE: DNA
<213> ORGANISM: Homo sapiens

<400> SEQUENCE: 1656 gtacctcctc cctcagaccc agg 23

<210> SEQ ID NO 1657
<211> LENGTH: 23

<212> TYPE: DNA
<213> ORGANISM: Homo sapiens

<400> SEQUENCE: 1657 gggctggtcc tcatctccct ggg 23

<210> SEQ ID NO 1658
<211> LENGTH: 23
<212> TYPE: DNA
<213> ORGANISM: Homo sapiens

<400> SEQUENCE: 1658 cattcctggg gcggaggagg cgg 23

<210> SEQ ID NO 1659
<211> LENGTH: 23
<212> TYPE: DNA
<213> ORGANISM: Homo sapiens

<400> SEQUENCE: 1659 ctcctggatc tgagggagga ggg 23

<210> SEQ ID NO 1660
<211> LENGTH: 23
<212> TYPE: DNA
<213> ORGANISM: Homo sapiens

<400> SEQUENCE: 1660 tgggtccagg aagaaggggc tgg 23

<210> SEQ ID NO 1661
<211> LENGTH: 23
<212> TYPE: DNA
<213> ORGANISM: Homo sapiens

<400> SEQUENCE: 1661 ctggatcagg aaggaggggc tgg 23

<210> SEQ ID NO 1662
<211> LENGTH: 23
<212> TYPE: DNA
<213> ORGANISM: Homo sapiens

<400> SEQUENCE: 1662 ctcctgggtc caggaagaag ggg 23

<210> SEQ ID NO 1663
<211> LENGTH: 23
<212> TYPE: DNA
<213> ORGANISM: Homo sapiens

<400> SEQUENCE: 1663 ggaccagccc ggccagcccc agg 23

<210> SEQ ID NO 1664
<211> LENGTH: 23
<212> TYPE: DNA
<213> ORGANISM: Homo sapiens

<400> SEQUENCE: 1664 ttctttccag gcctttccca agg 23

<210> SEQ ID NO 1665

<211> LENGTH: 23
<212> TYPE: DNA
<213> ORGANISM: Homo sapiens

<400> SEQUENCE: 1665 cgcaggctca cgttggcgcc agg 23

<210> SEQ ID NO 1666
<211> LENGTH: 23
<212> TYPE: DNA
<213> ORGANISM: Homo sapiens

<400> SEQUENCE: 1666 gtcatcagct gggaaggtga ggg 23

<210> SEQ ID NO 1667
<211> LENGTH: 23
<212> TYPE: DNA
<213> ORGANISM: Homo sapiens

<400> SEQUENCE: 1667 ctggggcgga ggaggcgggc cgg 23

<210> SEQ ID NO 1668
<211> LENGTH: 23
<212> TYPE: DNA
<213> ORGANISM: Homo sapiens

<400> SEQUENCE: 1668 agggaggagg tactggggcc cgg 23

<210> SEQ ID NO 1669
<211> LENGTH: 23
<212> TYPE: DNA
<213> ORGANISM: Homo sapiens

<400> SEQUENCE: 1669 actccaggtt tccagcccct ggg 23

<210> SEQ ID NO 1670
<211> LENGTH: 23
<212> TYPE: DNA
<213> ORGANISM: Homo sapiens

<400> SEQUENCE: 1670 cagcaggact gtggggctgc agg 23

<210> SEQ ID NO 1671
<211> LENGTH: 23
<212> TYPE: DNA
<213> ORGANISM: Homo sapiens

<400> SEQUENCE: 1671 ggactgtggg gctgcaggaa agg 23

<210> SEQ ID NO 1672
<211> LENGTH: 23
<212> TYPE: DNA
<213> ORGANISM: Homo sapiens

<400> SEQUENCE: 1672 gccctcagac ccaggagccc agg 23

<210> SEQ ID NO 1673
<211> LENGTH: 23
<212> TYPE: DNA
<213> ORGANISM: Homo sapiens

<400> SEQUENCE: 1673 gggaggaggt actggggccc ggg 23

<210> SEQ ID NO 1674
<211> LENGTH: 23
<212> TYPE: DNA
<213> ORGANISM: Homo sapiens

<400> SEQUENCE: 1674 agtcctgggt ccaggaagga ggg 23

<210> SEQ ID NO 1675
<211> LENGTH: 23
<212> TYPE: DNA
<213> ORGANISM: Homo sapiens

<400> SEQUENCE: 1675 ccctgggtct gaaggaggag agg 23

<210> SEQ ID NO 1676
<211> LENGTH: 23
<212> TYPE: DNA
<213> ORGANISM: Homo sapiens

<400> SEQUENCE: 1676 tggatcagga aggaggggct ggg 23

<210> SEQ ID NO 1677
<211> LENGTH: 23
<212> TYPE: DNA
<213> ORGANISM: Homo sapiens

<400> SEQUENCE: 1677 ggaaaggaca gtccagccca ggg 23

<210> SEQ ID NO 1678
<211> LENGTH: 23
<212> TYPE: DNA
<213> ORGANISM: Homo sapiens

<400> SEQUENCE: 1678 aaggtgaggg ccctgaggcc cgg 23

<210> SEQ ID NO 1679
<211> LENGTH: 23
<212> TYPE: DNA
<213> ORGANISM: Homo sapiens

<400> SEQUENCE: 1679 agcccctcct tcctggaccc agg 23

<210> SEQ ID NO 1680
<211> LENGTH: 23
<212> TYPE: DNA
<213> ORGANISM: Homo sapiens

<400> SEQUENCE: 1680 atcctgggtc tgagggagga ggg 23

<210> SEQ ID NO 1681
<211> LENGTH: 23
<212> TYPE: DNA
<213> ORGANISM: Homo sapiens

<400> SEQUENCE: 1681 aatcctgggt ctgagggagg agg 23

<210> SEQ ID NO 1682
<211> LENGTH: 23
<212> TYPE: DNA
<213> ORGANISM: Homo sapiens

<400> SEQUENCE: 1682 gtcctgggtc caggaaggag ggg 23

<210> SEQ ID NO 1683
<211> LENGTH: 23
<212> TYPE: DNA
<213> ORGANISM: Homo sapiens

<400> SEQUENCE: 1683 ggtctgaagg aggagaggct ggg 23

<210> SEQ ID NO 1684
<211> LENGTH: 23
<212> TYPE: DNA
<213> ORGANISM: Homo sapiens

<400> SEQUENCE: 1684 gggtccagga agaaggggct ggg 23

<210> SEQ ID NO 1685
<211> LENGTH: 23
<212> TYPE: DNA
<213> ORGANISM: Homo sapiens

<400> SEQUENCE: 1685 aggccccagc cccttcttcc tgg 23

<210> SEQ ID NO 1686
<211> LENGTH: 23
<212> TYPE: DNA
<213> ORGANISM: Homo sapiens

<400> SEQUENCE: 1686 tcttcctttc agctactcct tgg 23

<210> SEQ ID NO 1687
<211> LENGTH: 23
<212> TYPE: DNA
<213> ORGANISM: Homo sapiens

<400> SEQUENCE: 1687 ggctgggggc ctggagtcct ggg 23

<210> SEQ ID NO 1688
<211> LENGTH: 23
<212> TYPE: DNA
<213> ORGANISM: Homo sapiens

<400> SEQUENCE: 1688 ggcctggagt cctgggtctg agg 23

<210> SEQ ID NO 1689
<211> LENGTH: 23
<212> TYPE: DNA
<213> ORGANISM: Homo sapiens

<400> SEQUENCE: 1689 agtcctgggt ctgagggagg agg 23

<210> SEQ ID NO 1690
<211> LENGTH: 23
<212> TYPE: DNA
<213> ORGANISM: Homo sapiens

<400> SEQUENCE: 1690 gtgaagccag ctggacttcc tgg 23

<210> SEQ ID NO 1691
<211> LENGTH: 23
<212> TYPE: DNA
<213> ORGANISM: Homo sapiens

<400> SEQUENCE: 1691 ggcctgggct cctgggtctg agg 23

<210> SEQ ID NO 1692
<211> LENGTH: 23
<212> TYPE: DNA
<213> ORGANISM: Homo sapiens

<400> SEQUENCE: 1692 tggggcctgc attcctgggg cgg 23

<210> SEQ ID NO 1693
<211> LENGTH: 23
<212> TYPE: DNA
<213> ORGANISM: Homo sapiens

<400> SEQUENCE: 1693 gggctggggg cctggagtcc tgg 23

<210> SEQ ID NO 1694
<211> LENGTH: 23
<212> TYPE: DNA
<213> ORGANISM: Homo sapiens

<400> SEQUENCE: 1694 tgggtccagg aaggaggggc tgg 23

<210> SEQ ID NO 1695
<211> LENGTH: 23
<212> TYPE: DNA
<213> ORGANISM: Homo sapiens

<400> SEQUENCE: 1695 ggtccaggaa gaaggggctg ggg 23

<210> SEQ ID NO 1696
<211> LENGTH: 23
<212> TYPE: DNA
<213> ORGANISM: Homo sapiens

<400> SEQUENCE: 1696 tctgaaggag gagaggctgg ggg 23

<210> SEQ ID NO 1697
<211> LENGTH: 23
<212> TYPE: DNA
<213> ORGANISM: Homo sapiens

<400> SEQUENCE: 1697 gatctgaggg aggaggggct ggg 23

<210> SEQ ID NO 1698
<211> LENGTH: 23
<212> TYPE: DNA
<213> ORGANISM: Homo sapiens

<400> SEQUENCE: 1698 ggggctgggg cctggactgc tgg 23

<210> SEQ ID NO 1699
<211> LENGTH: 23
<212> TYPE: DNA
<213> ORGANISM: Homo sapiens

<400> SEQUENCE: 1699 gtgctcctgg ggctcagggg cgg 23

<210> SEQ ID NO 1700
<211> LENGTH: 23
<212> TYPE: DNA
<213> ORGANISM: Homo sapiens

<400> SEQUENCE: 1700 ggctgggggc ctgggctcct ggg 23

<210> SEQ ID NO 1701
<211> LENGTH: 23
<212> TYPE: DNA
<213> ORGANISM: Homo sapiens

<400> SEQUENCE: 1701 gagtcctggg tccaggaagg agg 23

<210> SEQ ID NO 1702
<211> LENGTH: 23
<212> TYPE: DNA
<213> ORGANISM: Homo sapiens

<400> SEQUENCE: 1702 gggcctggag tcctgggtcc agg 23

<210> SEQ ID NO 1703
<211> LENGTH: 23
<212> TYPE: DNA
<213> ORGANISM: Homo sapiens

<400> SEQUENCE: 1703 gtctgaagga ggagaggctg ggg 23

<210> SEQ ID NO 1704
<211> LENGTH: 23
<212> TYPE: DNA
<213> ORGANISM: Homo sapiens

<400> SEQUENCE: 1704 gggtctgaag gaggagaggc tgg 23

<210> SEQ ID NO 1705
<211> LENGTH: 23
<212> TYPE: DNA
<213> ORGANISM: Homo sapiens

<400> SEQUENCE: 1705 tcctggatct gagggaggag ggg 23

<210> SEQ ID NO 1706
<211> LENGTH: 23
<212> TYPE: DNA
<213> ORGANISM: Homo sapiens

<400> SEQUENCE: 1706 gggaggaggg gctgggtccc agg 23

<210> SEQ ID NO 1707
<211> LENGTH: 23
<212> TYPE: DNA
<213> ORGANISM: Homo sapiens

<400> SEQUENCE: 1707 gggtccagga aggaggggct ggg 23

<210> SEQ ID NO 1708
<211> LENGTH: 23
<212> TYPE: DNA
<213> ORGANISM: Homo sapiens

<400> SEQUENCE: 1708 tctgagggag gaggggctgc agg 23

<210> SEQ ID NO 1709
<211> LENGTH: 23
<212> TYPE: DNA
<213> ORGANISM: Homo sapiens

<400> SEQUENCE: 1709 ggaggagagg ctgggggcct ggg 23

<210> SEQ ID NO 1710
<211> LENGTH: 23
<212> TYPE: DNA
<213> ORGANISM: Homo sapiens

<400> SEQUENCE: 1710 gatcaggaag gaggggctgg ggg 23

<210> SEQ ID NO 1711
<211> LENGTH: 23
<212> TYPE: DNA
<213> ORGANISM: Homo sapiens

<400> SEQUENCE: 1711 ctgggaaggt gagggccctg agg 23

<210> SEQ ID NO 1712
<211> LENGTH: 23
<212> TYPE: DNA
<213> ORGANISM: Homo sapiens

<400> SEQUENCE: 1712 aggaggagag gctgggggcc tgg 23

<210> SEQ ID NO 1713
<211> LENGTH: 23
<212> TYPE: DNA
<213> ORGANISM: Homo sapiens

<400> SEQUENCE: 1713 aggctggggg cctgggctcc tgg 23

<210> SEQ ID NO 1714
<211> LENGTH: 23
<212> TYPE: DNA
<213> ORGANISM: Homo sapiens

<400> SEQUENCE: 1714 ggtccaggaa ggaggggctg ggg 23

<210> SEQ ID NO 1715
<211> LENGTH: 23
<212> TYPE: DNA
<213> ORGANISM: Homo sapiens

<400> SEQUENCE: 1715 gagaagctgg gaccctgggc tgg 23

<210> SEQ ID NO 1716
<211> LENGTH: 23
<212> TYPE: DNA
<213> ORGANISM: Homo sapiens

<400> SEQUENCE: 1716 ccagcccggc cagccccagg cgg 23

<210> SEQ ID NO 1717
<211> LENGTH: 23
<212> TYPE: DNA
<213> ORGANISM: Homo sapiens

<400> SEQUENCE: 1717 gctcctcctc cctcagaccc agg 23

<210> SEQ ID NO 1718
<211> LENGTH: 23
<212> TYPE: DNA
<213> ORGANISM: Homo sapiens

<400> SEQUENCE: 1718 ggcccccagc ccctccttcc tgg 23

<210> SEQ ID NO 1719
<211> LENGTH: 23
<212> TYPE: DNA
<213> ORGANISM: Homo sapiens

<400> SEQUENCE: 1719 gtccaggaag gaggggctgg ggg 23

<210> SEQ ID NO 1720
<211> LENGTH: 23
<212> TYPE: DNA
<213> ORGANISM: Homo sapiens

<400> SEQUENCE: 1720 gcccctcctc cctcagaccc agg 23

<210> SEQ ID NO 1721
<211> LENGTH: 23
<212> TYPE: DNA
<213> ORGANISM: Homo sapiens

<400> SEQUENCE: 1721 ggaaggaggg gctgggggcc tgg 23

<210> SEQ ID NO 1722
<211> LENGTH: 23
<212> TYPE: DNA
<213> ORGANISM: Homo sapiens

<400> SEQUENCE: 1722 tctgagggag gaggagctgg agg 23

<210> SEQ ID NO 1723
<211> LENGTH: 23
<212> TYPE: DNA
<213> ORGANISM: Homo sapiens

<400> SEQUENCE: 1723 ggatcaggaa ggaggggctg ggg 23

<210> SEQ ID NO 1724
<211> LENGTH: 23
<212> TYPE: DNA
<213> ORGANISM: Homo sapiens

<400> SEQUENCE: 1724 tcctgggtct gagggaggag ggg 23

<210> SEQ ID NO 1725
<211> LENGTH: 23
<212> TYPE: DNA
<213> ORGANISM: Homo sapiens

<400> SEQUENCE: 1725 gggtctgagg gaggaggagc tgg 23

<210> SEQ ID NO 1726
<211> LENGTH: 23
<212> TYPE: DNA
<213> ORGANISM: Homo sapiens

<400> SEQUENCE: 1726 ggatctgagg gaggaggggc tgg 23

<210> SEQ ID NO 1727
<211> LENGTH: 23
<212> TYPE: DNA
<213> ORGANISM: Homo sapiens

<400> SEQUENCE: 1727 aggaagaagg ggctggggcc tgg 23

<210> SEQ ID NO 1728
<211> LENGTH: 23
<212> TYPE: DNA

<213> ORGANISM: Homo sapiens

<400> SEQUENCE: 1728 cgggggaacc tagtccgcct ggg 23

<210> SEQ ID NO 1729
<211> LENGTH: 23
<212> TYPE: DNA
<213> ORGANISM: Homo sapiens

<400> SEQUENCE: 1729 ggggtctaag gaccgttccg cgg 23

<210> SEQ ID NO 1730
<211> LENGTH: 23
<212> TYPE: DNA
<213> ORGANISM: Homo sapiens

<400> SEQUENCE: 1730 gttcccccgg gtgtagtcgg agg 23

<210> SEQ ID NO 1731
<211> LENGTH: 23
<212> TYPE: DNA
<213> ORGANISM: Homo sapiens

<400> SEQUENCE: 1731 gggggaacct agtccgcctg ggg 23

<210> SEQ ID NO 1732
<211> LENGTH: 23
<212> TYPE: DNA
<213> ORGANISM: Homo sapiens

<400> SEQUENCE: 1732 taggttcccc cgggtgtagt cgg 23

<210> SEQ ID NO 1733
<211> LENGTH: 23
<212> TYPE: DNA
<213> ORGANISM: Homo sapiens

<400> SEQUENCE: 1733 aaaagtgacc agcgcgccca ggg 23

<210> SEQ ID NO 1734
<211> LENGTH: 23
<212> TYPE: DNA
<213> ORGANISM: Homo sapiens

<400> SEQUENCE: 1734 gcgcgctggt cacttttgac tgg 23

<210> SEQ ID NO 1735
<211> LENGTH: 23
<212> TYPE: DNA
<213> ORGANISM: Homo sapiens

<400> SEQUENCE: 1735 tgaaaggaag acgcgattag tgg 23

<210> SEQ ID NO 1736
<211> LENGTH: 23

<212> TYPE: DNA
<213> ORGANISM: Homo sapiens

<400> SEQUENCE: 1736 gctcaggggc ggataccagc agg 23

<210> SEQ ID NO 1737
<211> LENGTH: 23
<212> TYPE: DNA
<213> ORGANISM: Homo sapiens

<400> SEQUENCE: 1737 caaaagtgac cagcgcgccc agg 23

<210> SEQ ID NO 1738
<211> LENGTH: 23
<212> TYPE: DNA
<213> ORGANISM: Homo sapiens

<400> SEQUENCE: 1738 ggaataaaag ctggcgagcg cgg 23

<210> SEQ ID NO 1739
<211> LENGTH: 23
<212> TYPE: DNA
<213> ORGANISM: Homo sapiens

<400> SEQUENCE: 1739 ccgggggaac ctagtccgcc tgg 23

<210> SEQ ID NO 1740
<211> LENGTH: 23
<212> TYPE: DNA
<213> ORGANISM: Homo sapiens

<400> SEQUENCE: 1740 caatcagcag gacacgggcg ggg 23

<210> SEQ ID NO 1741
<211> LENGTH: 23
<212> TYPE: DNA
<213> ORGANISM: Homo sapiens

<400> SEQUENCE: 1741 ccattttaca gagcgctgat tgg 23

<210> SEQ ID NO 1742
<211> LENGTH: 23
<212> TYPE: DNA
<213> ORGANISM: Homo sapiens

<400> SEQUENCE: 1742 gctcctccga ctacacccgg ggg 23

<210> SEQ ID NO 1743
<211> LENGTH: 23
<212> TYPE: DNA
<213> ORGANISM: Homo sapiens

<400> SEQUENCE: 1743 gctggctgag ctccgcggaa cgg 23

<210> SEQ ID NO 1744

<211> LENGTH: 23
<212> TYPE: DNA
<213> ORGANISM: Homo sapiens

<400> SEQUENCE: 1744 ggctcctccg actacacccg ggg 23

<210> SEQ ID NO 1745
<211> LENGTH: 23
<212> TYPE: DNA
<213> ORGANISM: Homo sapiens

<400> SEQUENCE: 1745 agagtctgct tccacgttgt ggg 23

<210> SEQ ID NO 1746
<211> LENGTH: 23
<212> TYPE: DNA
<213> ORGANISM: Homo sapiens

<400> SEQUENCE: 1746 caggcggact aggttccccc ggg 23

<210> SEQ ID NO 1747
<211> LENGTH: 23
<212> TYPE: DNA
<213> ORGANISM: Homo sapiens

<400> SEQUENCE: 1747 ctggctcctc cgactacacc cgg 23

<210> SEQ ID NO 1748
<211> LENGTH: 23
<212> TYPE: DNA
<213> ORGANISM: Homo sapiens

<400> SEQUENCE: 1748 ggacacgggc ggggacaata agg 23

<210> SEQ ID NO 1749
<211> LENGTH: 23
<212> TYPE: DNA
<213> ORGANISM: Homo sapiens

<400> SEQUENCE: 1749 agtcagaacc gcgctcctgc tgg 23

<210> SEQ ID NO 1750
<211> LENGTH: 23
<212> TYPE: DNA
<213> ORGANISM: Homo sapiens

<400> SEQUENCE: 1750 ccaggcggac taggttcccc cgg 23

<210> SEQ ID NO 1751
<211> LENGTH: 23
<212> TYPE: DNA
<213> ORGANISM: Homo sapiens

<400> SEQUENCE: 1751 cctcatctcc ctgggcgcgc tgg 23

<210> SEQ ID NO 1752
<211> LENGTH: 23
<212> TYPE: DNA
<213> ORGANISM: Homo sapiens

<400> SEQUENCE: 1752 tggctcctcc gactacaccc ggg 23

<210> SEQ ID NO 1753
<211> LENGTH: 23
<212> TYPE: DNA
<213> ORGANISM: Homo sapiens

<400> SEQUENCE: 1753 gaacctagtc cgcctggggc tgg 23

<210> SEQ ID NO 1754
<211> LENGTH: 23
<212> TYPE: DNA
<213> ORGANISM: Homo sapiens

<400> SEQUENCE: 1754 ccaatcagca ggacacgggc ggg 23

<210> SEQ ID NO 1755
<211> LENGTH: 23
<212> TYPE: DNA
<213> ORGANISM: Homo sapiens

<400> SEQUENCE: 1755 agaacaaagc tcccacaacg tgg 23

<210> SEQ ID NO 1756
<211> LENGTH: 23
<212> TYPE: DNA
<213> ORGANISM: Homo sapiens

<400> SEQUENCE: 1756 cagagtctgc ttccacgttg tgg 23

<210> SEQ ID NO 1757
<211> LENGTH: 23
<212> TYPE: DNA
<213> ORGANISM: Homo sapiens

<400> SEQUENCE: 1757 ccaatcagcg ctctgtaaaa tgg 23

<210> SEQ ID NO 1758
<211> LENGTH: 23
<212> TYPE: DNA
<213> ORGANISM: Homo sapiens

<400> SEQUENCE: 1758 gacacgggcg gggacaataa ggg 23

<210> SEQ ID NO 1759
<211> LENGTH: 23
<212> TYPE: DNA
<213> ORGANISM: Homo sapiens

<400> SEQUENCE: 1759 agcttctccg ccactcaggt tgg 23

<210> SEQ ID NO 1760
<211> LENGTH: 23
<212> TYPE: DNA
<213> ORGANISM: Homo sapiens

<400> SEQUENCE: 1760 cccgagactt ccaacctgag tgg 23

<210> SEQ ID NO 1761
<211> LENGTH: 23
<212> TYPE: DNA
<213> ORGANISM: Homo sapiens

<400> SEQUENCE: 1761 cggccagccc caggcggact agg 23

<210> SEQ ID NO 1762
<211> LENGTH: 23
<212> TYPE: DNA
<213> ORGANISM: Homo sapiens

<400> SEQUENCE: 1762 gattcgaacc ctctgtcttc tgg 23

<210> SEQ ID NO 1763
<211> LENGTH: 23
<212> TYPE: DNA
<213> ORGANISM: Homo sapiens

<400> SEQUENCE: 1763 cacaacgtgg aagcagactc tgg 23

<210> SEQ ID NO 1764
<211> LENGTH: 23
<212> TYPE: DNA
<213> ORGANISM: Homo sapiens

<400> SEQUENCE: 1764 acagggcaca gcggggtcta agg 23

<210> SEQ ID NO 1765
<211> LENGTH: 23
<212> TYPE: DNA
<213> ORGANISM: Homo sapiens

<400> SEQUENCE: 1765 ctactactac agtgagtaga cgg 23

<210> SEQ ID NO 1766
<211> LENGTH: 23
<212> TYPE: DNA
<213> ORGANISM: Homo sapiens

<400> SEQUENCE: 1766 accaatcagc aggacacggg cgg 23

<210> SEQ ID NO 1767
<211> LENGTH: 23
<212> TYPE: DNA
<213> ORGANISM: Homo sapiens

<400> SEQUENCE: 1767 ccactcaggt tggaagtctc ggg 23

<210> SEQ ID NO 1768
<211> LENGTH: 23
<212> TYPE: DNA
<213> ORGANISM: Homo sapiens

<400> SEQUENCE: 1768 gccactcagg ttggaagtct cgg 23

<210> SEQ ID NO 1769
<211> LENGTH: 23
<212> TYPE: DNA
<213> ORGANISM: Homo sapiens

<400> SEQUENCE: 1769 acgtggaagc agactctggt ggg 23

<210> SEQ ID NO 1770
<211> LENGTH: 23
<212> TYPE: DNA
<213> ORGANISM: Homo sapiens

<400> SEQUENCE: 1770 cagtgagtag acggcagtgc tgg 23

<210> SEQ ID NO 1771
<211> LENGTH: 23
<212> TYPE: DNA
<213> ORGANISM: Homo sapiens

<400> SEQUENCE: 1771 ccatcttaca gagtgctgat tgg 23

<210> SEQ ID NO 1772
<211> LENGTH: 23
<212> TYPE: DNA
<213> ORGANISM: Homo sapiens

<400> SEQUENCE: 1772 ccaatcagca ctctgtaaga tgg 23

<210> SEQ ID NO 1773
<211> LENGTH: 23
<212> TYPE: DNA
<213> ORGANISM: Homo sapiens

<400> SEQUENCE: 1773 gagacttcca acctgagtgg cgg 23

<210> SEQ ID NO 1774
<211> LENGTH: 23
<212> TYPE: DNA
<213> ORGANISM: Homo sapiens

<400> SEQUENCE: 1774 tagtgagacg tgaagccagc tgg 23

<210> SEQ ID NO 1775
<211> LENGTH: 23
<212> TYPE: DNA
<213> ORGANISM: Homo sapiens

<400> SEQUENCE: 1775 agtgagtaga cggcagtgct ggg 23

<210> SEQ ID NO 1776
<211> LENGTH: 23
<212> TYPE: DNA
<213> ORGANISM: Homo sapiens

<400> SEQUENCE: 1776 tgtaaaatgg accaatcagc agg 23

<210> SEQ ID NO 1777
<211> LENGTH: 23
<212> TYPE: DNA
<213> ORGANISM: Homo sapiens

<400> SEQUENCE: 1777 ggcggatacc agcaggagcg cgg 23

<210> SEQ ID NO 1778
<211> LENGTH: 23
<212> TYPE: DNA
<213> ORGANISM: Homo sapiens

<400> SEQUENCE: 1778 aacctgagtg gcggagaagc tgg 23

<210> SEQ ID NO 1779
<211> LENGTH: 23
<212> TYPE: DNA
<213> ORGANISM: Homo sapiens

<400> SEQUENCE: 1779 tggacttcct gggttgaatg ggg 23

<210> SEQ ID NO 1780
<211> LENGTH: 23
<212> TYPE: DNA
<213> ORGANISM: Homo sapiens

<400> SEQUENCE: 1780 tccaggtccc cattcaaccc agg 23

<210> SEQ ID NO 1781
<211> LENGTH: 23
<212> TYPE: DNA
<213> ORGANISM: Homo sapiens

<400> SEQUENCE: 1781 ccggctccgc ccgcagactc tgg 23

<210> SEQ ID NO 1782
<211> LENGTH: 23
<212> TYPE: DNA
<213> ORGANISM: Homo sapiens

<400> SEQUENCE: 1782 ccagagtctg cgggcggagc cgg 23

<210> SEQ ID NO 1783
<211> LENGTH: 23
<212> TYPE: DNA
<213> ORGANISM: Homo sapiens

<400> SEQUENCE: 1783 gtctcgggct gcagtgctcc tgg 23

<210> SEQ ID NO 1784
<211> LENGTH: 23
<212> TYPE: DNA
<213> ORGANISM: Homo sapiens

<400> SEQUENCE: 1784 acctgagtgg cggagaagct ggg 23

<210> SEQ ID NO 1785
<211> LENGTH: 23
<212> TYPE: DNA
<213> ORGANISM: Homo sapiens

<400> SEQUENCE: 1785 gctggacttc ctgggttgaa tgg 23

<210> SEQ ID NO 1786
<211> LENGTH: 23
<212> TYPE: DNA
<213> ORGANISM: Homo sapiens

<400> SEQUENCE: 1786 tggaccaatc agcaggacac ggg 23

<210> SEQ ID NO 1787
<211> LENGTH: 23
<212> TYPE: DNA
<213> ORGANISM: Homo sapiens

<400> SEQUENCE: 1787 ctggacttcc tgggttgaat ggg 23

<210> SEQ ID NO 1788
<211> LENGTH: 23
<212> TYPE: DNA
<213> ORGANISM: Homo sapiens

<400> SEQUENCE: 1788 ttccgcggag ctcagccagc agg 23

<210> SEQ ID NO 1789
<211> LENGTH: 23
<212> TYPE: DNA
<213> ORGANISM: Homo sapiens

<400> SEQUENCE: 1789 cgtggaagca gactctggtg ggg 23

<210> SEQ ID NO 1790
<211> LENGTH: 23
<212> TYPE: DNA
<213> ORGANISM: Homo sapiens

<400> SEQUENCE: 1790 aacgtggaag cagactctgg tgg 23

<210> SEQ ID NO 1791
<211> LENGTH: 23
<212> TYPE: DNA
<213> ORGANISM: Homo sapiens

<400> SEQUENCE: 1791 cagagtctgc gggcggagcc ggg 23

<210> SEQ ID NO 1792
<211> LENGTH: 23
<212> TYPE: DNA
<213> ORGANISM: Homo sapiens

<400> SEQUENCE: 1792 tctcgggctg cagtgctcct ggg 23

<210> SEQ ID NO 1793
<211> LENGTH: 23
<212> TYPE: DNA
<213> ORGANISM: Homo sapiens

<400> SEQUENCE: 1793 tcggaggagc cagagtctgc ggg 23

<210> SEQ ID NO 1794
<211> LENGTH: 23
<212> TYPE: DNA
<213> ORGANISM: Homo sapiens

<400> SEQUENCE: 1794 tgaagccagc tggacttcct ggg 23

<210> SEQ ID NO 1795
<211> LENGTH: 23
<212> TYPE: DNA
<213> ORGANISM: Homo sapiens

<400> SEQUENCE: 1795 ctggaaagaa gctacagcac agg 23

<210> SEQ ID NO 1796
<211> LENGTH: 23
<212> TYPE: DNA
<213> ORGANISM: Homo sapiens

<400> SEQUENCE: 1796 atggaccaat cagcaggaca cgg 23

<210> SEQ ID NO 1797
<211> LENGTH: 23
<212> TYPE: DNA
<213> ORGANISM: Homo sapiens

<400> SEQUENCE: 1797 tcccagcttc tccgccactc agg 23

<210> SEQ ID NO 1798
<211> LENGTH: 23
<212> TYPE: DNA
<213> ORGANISM: Homo sapiens

<400> SEQUENCE: 1798 tttcccaagg agtagctgaa agg 23

<210> SEQ ID NO 1799
<211> LENGTH: 23
<212> TYPE: DNA
<213> ORGANISM: Homo sapiens

<400> SEQUENCE: 1799 gaaccctctg tcttctggct tgg 23

<210> SEQ ID NO 1800
<211> LENGTH: 23
<212> TYPE: DNA
<213> ORGANISM: Homo sapiens

<400> SEQUENCE: 1800 cttacaagag gattgtaaaa tgg 23

<210> SEQ ID NO 1801
<211> LENGTH: 23
<212> TYPE: DNA
<213> ORGANISM: Homo sapiens

<400> SEQUENCE: 1801 ggtatccgcc cctgagcccc agg 23

<210> SEQ ID NO 1802
<211> LENGTH: 23
<212> TYPE: DNA
<213> ORGANISM: Homo sapiens

<400> SEQUENCE: 1802 tagtagtagc agctacagaa agg 23

<210> SEQ ID NO 1803
<211> LENGTH: 23
<212> TYPE: DNA
<213> ORGANISM: Homo sapiens

<400> SEQUENCE: 1803 tttcagctac tccttgggaa agg 23

<210> SEQ ID NO 1804
<211> LENGTH: 23
<212> TYPE: DNA
<213> ORGANISM: Homo sapiens

<400> SEQUENCE: 1804 tagtccgcct ggggctggcc ggg 23

<210> SEQ ID NO 1805
<211> LENGTH: 23
<212> TYPE: DNA
<213> ORGANISM: Homo sapiens

<400> SEQUENCE: 1805 cgggctggtc ctcatctccc tgg 23

<210> SEQ ID NO 1806
<211> LENGTH: 23
<212> TYPE: DNA
<213> ORGANISM: Homo sapiens

<400> SEQUENCE: 1806 ctagtccgcc tggggctggc cgg 23

<210> SEQ ID NO 1807
<211> LENGTH: 23
<212> TYPE: DNA

<213> ORGANISM: Homo sapiens

<400> SEQUENCE: 1807 cttcctttca gctactcctt ggg 23

<210> SEQ ID NO 1808
<211> LENGTH: 23
<212> TYPE: DNA
<213> ORGANISM: Homo sapiens

<400> SEQUENCE: 1808 gtaagacaga aaagttctcc agg 23

<210> SEQ ID NO 1809
<211> LENGTH: 23
<212> TYPE: DNA
<213> ORGANISM: Homo sapiens

<400> SEQUENCE: 1809 ctcgggctgc agtgctcctg ggg 23

<210> SEQ ID NO 1810
<211> LENGTH: 23
<212> TYPE: DNA
<213> ORGANISM: Homo sapiens

<400> SEQUENCE: 1810 agctcagcca gcaggactgt ggg 23

<210> SEQ ID NO 1811
<211> LENGTH: 23
<212> TYPE: DNA
<213> ORGANISM: Homo sapiens

<400> SEQUENCE: 1811 gaacttttct gtcttacaag agg 23

<210> SEQ ID NO 1812
<211> LENGTH: 23
<212> TYPE: DNA
<213> ORGANISM: Homo sapiens

<400> SEQUENCE: 1812 gctactcctt gggaaaggcc tgg 23

<210> SEQ ID NO 1813
<211> LENGTH: 23
<212> TYPE: DNA
<213> ORGANISM: Homo sapiens

<400> SEQUENCE: 1813 ccagcgcgcc cagggagatg agg 23

<210> SEQ ID NO 1814
<211> LENGTH: 23
<212> TYPE: DNA
<213> ORGANISM: Homo sapiens

<400> SEQUENCE: 1814 ctacagcaca gggcacagcg ggg 23

<210> SEQ ID NO 1815
<211> LENGTH: 23

<212> TYPE: DNA
<213> ORGANISM: Homo sapiens

<400> SEQUENCE: 1815 gaggagccag agtctgcggg cgg 23

<210> SEQ ID NO 1816
<211> LENGTH: 23
<212> TYPE: DNA
<213> ORGANISM: Homo sapiens

<400> SEQUENCE: 1816 gtcggaggag ccagagtctg cgg 23

<210> SEQ ID NO 1817
<211> LENGTH: 23
<212> TYPE: DNA
<213> ORGANISM: Homo sapiens

<400> SEQUENCE: 1817 ctgtgctgta gcttctttcc agg 23

<210> SEQ ID NO 1818
<211> LENGTH: 23
<212> TYPE: DNA
<213> ORGANISM: Homo sapiens

<400> SEQUENCE: 1818 gacaataagg gaataaaagc tgg 23

<210> SEQ ID NO 1819
<211> LENGTH: 23
<212> TYPE: DNA
<213> ORGANISM: Homo sapiens

<400> SEQUENCE: 1819 tcctgggttg aatggggacc tgg 23

<210> SEQ ID NO 1820
<211> LENGTH: 23
<212> TYPE: DNA
<213> ORGANISM: Homo sapiens

<400> SEQUENCE: 1820 tggaaagaag ctacagcaca ggg 23

<210> SEQ ID NO 1821
<211> LENGTH: 23
<212> TYPE: DNA
<213> ORGANISM: Homo sapiens

<400> SEQUENCE: 1821 gctcagccag caggactgtg ggg 23

<210> SEQ ID NO 1822
<211> LENGTH: 23
<212> TYPE: DNA
<213> ORGANISM: Homo sapiens

<400> SEQUENCE: 1822 tgcagtgctc ctggggctca ggg 23

<210> SEQ ID NO 1823

<211> LENGTH: 23
<212> TYPE: DNA
<213> ORGANISM: Homo sapiens

<400> SEQUENCE: 1823 aggaaaggac agtccagccc agg 23

<210> SEQ ID NO 1824
<211> LENGTH: 23
<212> TYPE: DNA
<213> ORGANISM: Homo sapiens

<400> SEQUENCE: 1824 cccgcccgtg tcctgctgat tgg 23

<210> SEQ ID NO 1825
<211> LENGTH: 23
<212> TYPE: DNA
<213> ORGANISM: Homo sapiens

<400> SEQUENCE: 1825 ggcggagaag ctgggaccct ggg 23

<210> SEQ ID NO 1826
<211> LENGTH: 23
<212> TYPE: DNA
<213> ORGANISM: Homo sapiens

<400> SEQUENCE: 1826 ctgcagcccc acagtcctgc tgg 23

<210> SEQ ID NO 1827
<211> LENGTH: 23
<212> TYPE: DNA
<213> ORGANISM: Homo sapiens

<400> SEQUENCE: 1827 acttccaagc cagaagacag agg 23

<210> SEQ ID NO 1828
<211> LENGTH: 23
<212> TYPE: DNA
<213> ORGANISM: Homo sapiens

<400> SEQUENCE: 1828 gagctcagcc agcaggactg tgg 23

<210> SEQ ID NO 1829
<211> LENGTH: 23
<212> TYPE: DNA
<213> ORGANISM: Homo sapiens

<400> SEQUENCE: 1829 cagggagatg aggaccagcc cgg 23

<210> SEQ ID NO 1830
<211> LENGTH: 23
<212> TYPE: DNA
<213> ORGANISM: Homo sapiens

<400> SEQUENCE: 1830 agctacagca cagggcacag cgg 23

<210> SEQ ID NO 1831
<211> LENGTH: 23
<212> TYPE: DNA
<213> ORGANISM: Homo sapiens

<400> SEQUENCE: 1831 cttccaagcc agaagacaga ggg 23

<210> SEQ ID NO 1832
<211> LENGTH: 23
<212> TYPE: DNA
<213> ORGANISM: Homo sapiens

<400> SEQUENCE: 1832 tggcggagaa gctgggaccc tgg 23

<210> SEQ ID NO 1833
<211> LENGTH: 23
<212> TYPE: DNA
<213> ORGANISM: Homo sapiens

<400> SEQUENCE: 1833 ccgcctgggg ctggccgggc tgg 23

<210> SEQ ID NO 1834
<211> LENGTH: 23
<212> TYPE: DNA
<213> ORGANISM: Homo sapiens

<400> SEQUENCE: 1834 gcagtgctcc tggggctcag ggg 23

<210> SEQ ID NO 1835
<211> LENGTH: 23
<212> TYPE: DNA
<213> ORGANISM: Homo sapiens

<400> SEQUENCE: 1835 gctacagcac agggcacagc ggg 23

<210> SEQ ID NO 1836
<211> LENGTH: 23
<212> TYPE: DNA
<213> ORGANISM: Homo sapiens

<400> SEQUENCE: 1836 ctgcagtgct cctggggctc agg 23

<210> SEQ ID NO 1837
<211> LENGTH: 23
<212> TYPE: DNA
<213> ORGANISM: Homo sapiens

<400> SEQUENCE: 1837 gtcctgctgg ctgagctccg cgg 23

<210> SEQ ID NO 1838
<211> LENGTH: 23
<212> TYPE: DNA
<213> ORGANISM: Homo sapiens

<400> SEQUENCE: 1838 gggctggtcc tcatctccct ggg 23

<210> SEQ ID NO 1839
<211> LENGTH: 23
<212> TYPE: DNA
<213> ORGANISM: Homo sapiens

<400> SEQUENCE: 1839 ggaccagccc ggccagcccc agg 23

<210> SEQ ID NO 1840
<211> LENGTH: 23
<212> TYPE: DNA
<213> ORGANISM: Homo sapiens

<400> SEQUENCE: 1840 ttctttccag gcctttccca agg 23

<210> SEQ ID NO 1841
<211> LENGTH: 23
<212> TYPE: DNA
<213> ORGANISM: Homo sapiens

<400> SEQUENCE: 1841 ggactgtggg gctgcaggaa agg 23

<210> SEQ ID NO 1842
<211> LENGTH: 23
<212> TYPE: DNA
<213> ORGANISM: Homo sapiens

<400> SEQUENCE: 1842 cagcaggact gtggggctgc agg 23

<210> SEQ ID NO 1843
<211> LENGTH: 23
<212> TYPE: DNA
<213> ORGANISM: Homo sapiens

<400> SEQUENCE: 1843 ggaaaggaca gtccagccca ggg 23

<210> SEQ ID NO 1844
<211> LENGTH: 23
<212> TYPE: DNA
<213> ORGANISM: Homo sapiens

<400> SEQUENCE: 1844 tcttcctttc agctactcct tgg 23

<210> SEQ ID NO 1845
<211> LENGTH: 23
<212> TYPE: DNA
<213> ORGANISM: Homo sapiens

<400> SEQUENCE: 1845 gtgaagccag ctggacttcc tgg 23

<210> SEQ ID NO 1846
<211> LENGTH: 23
<212> TYPE: DNA
<213> ORGANISM: Homo sapiens

<400> SEQUENCE: 1846 gtgctcctgg ggctcagggg cgg 23

<210> SEQ ID NO 1847
<211> LENGTH: 23
<212> TYPE: DNA
<213> ORGANISM: Homo sapiens

<400> SEQUENCE: 1847 gagaagctgg gaccctgggc tgg 23

<210> SEQ ID NO 1848
<211> LENGTH: 23
<212> TYPE: DNA
<213> ORGANISM: Homo sapiens

<400> SEQUENCE: 1848 ccagcccggc cagccccagg cgg 23

<210> SEQ ID NO 1849
<211> LENGTH: 23
<212> TYPE: DNA
<213> ORGANISM: Homo sapiens

<400> SEQUENCE: 1849 caaagttgag ggggagtcga tgg 23

<210> SEQ ID NO 1850
<211> LENGTH: 23
<212> TYPE: DNA
<213> ORGANISM: Homo sapiens

<400> SEQUENCE: 1850 tcgatggagg cttcaactcc tgg 23

<210> SEQ ID NO 1851
<211> LENGTH: 23
<212> TYPE: DNA
<213> ORGANISM: Homo sapiens

<400> SEQUENCE: 1851 cgatggaggc ttcaactcct ggg 23

<210> SEQ ID NO 1852
<211> LENGTH: 23
<212> TYPE: DNA
<213> ORGANISM: Homo sapiens

<400> SEQUENCE: 1852 gactagactc ctggatctga ggg 23

<210> SEQ ID NO 1853
<211> LENGTH: 23
<212> TYPE: DNA
<213> ORGANISM: Homo sapiens

<400> SEQUENCE: 1853 ggctgcagga ctagacccct ggg 23

<210> SEQ ID NO 1854
<211> LENGTH: 23
<212> TYPE: DNA
<213> ORGANISM: Homo sapiens

<400> SEQUENCE: 1854 gagctggagg actagactcc tgg 23

<210> SEQ ID NO 1855
<211> LENGTH: 23
<212> TYPE: DNA
<213> ORGANISM: Homo sapiens

<400> SEQUENCE: 1855 agttgagggg gagtcgatgg agg 23

<210> SEQ ID NO 1856
<211> LENGTH: 23
<212> TYPE: DNA
<213> ORGANISM: Homo sapiens

<400> SEQUENCE: 1856 gctcccggac cccaaagtct ggg 23

<210> SEQ ID NO 1857
<211> LENGTH: 23
<212> TYPE: DNA
<213> ORGANISM: Homo sapiens

<400> SEQUENCE: 1857 agctcccgga ccccaaagtc tgg 23

<210> SEQ ID NO 1858
<211> LENGTH: 23
<212> TYPE: DNA
<213> ORGANISM: Homo sapiens

<400> SEQUENCE: 1858 ggtccctaag tccaccccag ggg 23

<210> SEQ ID NO 1859
<211> LENGTH: 23
<212> TYPE: DNA
<213> ORGANISM: Homo sapiens

<400> SEQUENCE: 1859 gggctgcagg actagacccc tgg 23

<210> SEQ ID NO 1860
<211> LENGTH: 23
<212> TYPE: DNA
<213> ORGANISM: Homo sapiens

<400> SEQUENCE: 1860 cagcccctgg ggtggactta ggg 23

<210> SEQ ID NO 1861
<211> LENGTH: 23
<212> TYPE: DNA
<213> ORGANISM: Homo sapiens

<400> SEQUENCE: 1861 actctacagt ctcaaagttg agg 23

<210> SEQ ID NO 1862
<211> LENGTH: 23
<212> TYPE: DNA
<213> ORGANISM: Homo sapiens

<400> SEQUENCE: 1862 aactttgaga ctgtagagtc agg 23

<210> SEQ ID NO 1863
<211> LENGTH: 23
<212> TYPE: DNA
<213> ORGANISM: Homo sapiens

<400> SEQUENCE: 1863 ggactagact cctggatctg agg 23

<210> SEQ ID NO 1864
<211> LENGTH: 23
<212> TYPE: DNA
<213> ORGANISM: Homo sapiens

<400> SEQUENCE: 1864 gtactggggc ccgggaatcc tgg 23

<210> SEQ ID NO 1865
<211> LENGTH: 23
<212> TYPE: DNA
<213> ORGANISM: Homo sapiens

<400> SEQUENCE: 1865 gactagaccc ctgggtctga agg 23

<210> SEQ ID NO 1866
<211> LENGTH: 23
<212> TYPE: DNA
<213> ORGANISM: Homo sapiens

<400> SEQUENCE: 1866 ccggctccgc ccgcagactc tgg 23

<210> SEQ ID NO 1867
<211> LENGTH: 23
<212> TYPE: DNA
<213> ORGANISM: Homo sapiens

<400> SEQUENCE: 1867 ccagagtctg cgggcggagc cgg 23

<210> SEQ ID NO 1868
<211> LENGTH: 23
<212> TYPE: DNA
<213> ORGANISM: Homo sapiens

<400> SEQUENCE: 1868 gagttcaggg cccagacttt ggg 23

<210> SEQ ID NO 1869
<211> LENGTH: 23
<212> TYPE: DNA
<213> ORGANISM: Homo sapiens

<400> SEQUENCE: 1869 ctacagtctc aaagttgagg ggg 23

<210> SEQ ID NO 1870
<211> LENGTH: 23
<212> TYPE: DNA
<213> ORGANISM: Homo sapiens

<400> SEQUENCE: 1870 tactggggcc cgggaatcct ggg 23

<210> SEQ ID NO 1871
<211> LENGTH: 23
<212> TYPE: DNA
<213> ORGANISM: Homo sapiens

<400> SEQUENCE: 1871 caggtcccta agtccacccc agg 23

<210> SEQ ID NO 1872
<211> LENGTH: 23
<212> TYPE: DNA
<213> ORGANISM: Homo sapiens

<400> SEQUENCE: 1872 cctggactgc tggatcagga agg 23

<210> SEQ ID NO 1873
<211> LENGTH: 23
<212> TYPE: DNA
<213> ORGANISM: Homo sapiens

<400> SEQUENCE: 1873 ggtctgaggg cggaggtcct ggg 23

<210> SEQ ID NO 1874
<211> LENGTH: 23
<212> TYPE: DNA
<213> ORGANISM: Homo sapiens

<400> SEQUENCE: 1874 cagagtctgc gggcggagcc ggg 23

<210> SEQ ID NO 1875
<211> LENGTH: 23
<212> TYPE: DNA
<213> ORGANISM: Homo sapiens

<400> SEQUENCE: 1875 aggtccctaa gtccacccca ggg 23

<210> SEQ ID NO 1876
<211> LENGTH: 23
<212> TYPE: DNA
<213> ORGANISM: Homo sapiens

<400> SEQUENCE: 1876 tctacagtct caaagttgag ggg 23

<210> SEQ ID NO 1877
<211> LENGTH: 23
<212> TYPE: DNA
<213> ORGANISM: Homo sapiens

<400> SEQUENCE: 1877 tcggaggagc cagagtctgc ggg 23

<210> SEQ ID NO 1878
<211> LENGTH: 23
<212> TYPE: DNA
<213> ORGANISM: Homo sapiens

<400> SEQUENCE: 1878 ctctacagtc tcaaagttga ggg 23

<210> SEQ ID NO 1879
<211> LENGTH: 23
<212> TYPE: DNA
<213> ORGANISM: Homo sapiens

<400> SEQUENCE: 1879 cccgggaatc ctgggtctga ggg 23

<210> SEQ ID NO 1880
<211> LENGTH: 23
<212> TYPE: DNA
<213> ORGANISM: Homo sapiens

<400> SEQUENCE: 1880 agttcagggc ccagactttg ggg 23

<210> SEQ ID NO 1881
<211> LENGTH: 23
<212> TYPE: DNA
<213> ORGANISM: Homo sapiens

<400> SEQUENCE: 1881 tagactcctg gatctgaggg agg 23

<210> SEQ ID NO 1882
<211> LENGTH: 23
<212> TYPE: DNA
<213> ORGANISM: Homo sapiens

<400> SEQUENCE: 1882 aagtctgggc cctgaactcc agg 23

<210> SEQ ID NO 1883
<211> LENGTH: 23
<212> TYPE: DNA
<213> ORGANISM: Homo sapiens

<400> SEQUENCE: 1883 ccttcctgat ccagcagtcc agg 23

<210> SEQ ID NO 1884
<211> LENGTH: 23
<212> TYPE: DNA
<213> ORGANISM: Homo sapiens

<400> SEQUENCE: 1884 tagacccctg ggtctgaagg agg 23

<210> SEQ ID NO 1885
<211> LENGTH: 23
<212> TYPE: DNA
<213> ORGANISM: Homo sapiens

<400> SEQUENCE: 1885 ctgcattcct ggggcggagg agg 23

<210> SEQ ID NO 1886
<211> LENGTH: 23
<212> TYPE: DNA

<213> ORGANISM: Homo sapiens

<400> SEQUENCE: 1886 ctcctccgcc ccaggaatgc agg 23

<210> SEQ ID NO 1887
<211> LENGTH: 23
<212> TYPE: DNA
<213> ORGANISM: Homo sapiens

<400> SEQUENCE: 1887 ggggcctgga ctgctggatc agg 23

<210> SEQ ID NO 1888
<211> LENGTH: 23
<212> TYPE: DNA
<213> ORGANISM: Homo sapiens

<400> SEQUENCE: 1888 cccaggaatc ctgggtctga ggg 23

<210> SEQ ID NO 1889
<211> LENGTH: 23
<212> TYPE: DNA
<213> ORGANISM: Homo sapiens

<400> SEQUENCE: 1889 ccagcccctg gggtggactt agg 23

<210> SEQ ID NO 1890
<211> LENGTH: 23
<212> TYPE: DNA
<213> ORGANISM: Homo sapiens

<400> SEQUENCE: 1890 ggcctgcatt cctggggcgg agg 23

<210> SEQ ID NO 1891
<211> LENGTH: 23
<212> TYPE: DNA
<213> ORGANISM: Homo sapiens

<400> SEQUENCE: 1891 gtctgagggc ggaggtcctg ggg 23

<210> SEQ ID NO 1892
<211> LENGTH: 23
<212> TYPE: DNA
<213> ORGANISM: Homo sapiens

<400> SEQUENCE: 1892 gggtctgagg gcggaggtcc tgg 23

<210> SEQ ID NO 1893
<211> LENGTH: 23
<212> TYPE: DNA
<213> ORGANISM: Homo sapiens

<400> SEQUENCE: 1893 cctaagtcca ccccaggggc tgg 23

<210> SEQ ID NO 1894
<211> LENGTH: 23

<212> TYPE: DNA
<213> ORGANISM: Homo sapiens

<400> SEQUENCE: 1894 aggaggcggg ccgggcctca ggg 23

<210> SEQ ID NO 1895
<211> LENGTH: 23
<212> TYPE: DNA
<213> ORGANISM: Homo sapiens

<400> SEQUENCE: 1895 gtgctggtca tcagctggga agg 23

<210> SEQ ID NO 1896
<211> LENGTH: 23
<212> TYPE: DNA
<213> ORGANISM: Homo sapiens

<400> SEQUENCE: 1896 ggctggaaac ctggagttca ggg 23

<210> SEQ ID NO 1897
<211> LENGTH: 23
<212> TYPE: DNA
<213> ORGANISM: Homo sapiens

<400> SEQUENCE: 1897 agggcccaga ctttggggtc cgg 23

<210> SEQ ID NO 1898
<211> LENGTH: 23
<212> TYPE: DNA
<213> ORGANISM: Homo sapiens

<400> SEQUENCE: 1898 agctgatggc ccctctctcc cgg 23

<210> SEQ ID NO 1899
<211> LENGTH: 23
<212> TYPE: DNA
<213> ORGANISM: Homo sapiens

<400> SEQUENCE: 1899 ggagttcagg gcccagactt tgg 23

<210> SEQ ID NO 1900
<211> LENGTH: 23
<212> TYPE: DNA
<213> ORGANISM: Homo sapiens

<400> SEQUENCE: 1900 agagaggggc catcagctcc cgg 23

<210> SEQ ID NO 1901
<211> LENGTH: 23
<212> TYPE: DNA
<213> ORGANISM: Homo sapiens

<400> SEQUENCE: 1901 ggctgggtcc caggaatcct ggg 23

<210> SEQ ID NO 1902

<211> LENGTH: 23
<212> TYPE: DNA
<213> ORGANISM: Homo sapiens

<400> SEQUENCE: 1902 gcgggcggag ccgggagaga ggg 23

<210> SEQ ID NO 1903
<211> LENGTH: 23
<212> TYPE: DNA
<213> ORGANISM: Homo sapiens

<400> SEQUENCE: 1903 gaggagccag agtctgcggg cgg 23

<210> SEQ ID NO 1904
<211> LENGTH: 23
<212> TYPE: DNA
<213> ORGANISM: Homo sapiens

<400> SEQUENCE: 1904 gtcggaggag ccagagtctg cgg 23

<210> SEQ ID NO 1905
<211> LENGTH: 23
<212> TYPE: DNA
<213> ORGANISM: Homo sapiens

<400> SEQUENCE: 1905 ggtctgaggg aggaggtact ggg 23

<210> SEQ ID NO 1906
<211> LENGTH: 23
<212> TYPE: DNA
<213> ORGANISM: Homo sapiens

<400> SEQUENCE: 1906 ggtcctgggg cctgcattcc tgg 23

<210> SEQ ID NO 1907
<211> LENGTH: 23
<212> TYPE: DNA
<213> ORGANISM: Homo sapiens

<400> SEQUENCE: 1907 ggtcatcagc tgggaaggtg agg 23

<210> SEQ ID NO 1908
<211> LENGTH: 23
<212> TYPE: DNA
<213> ORGANISM: Homo sapiens

<400> SEQUENCE: 1908 gcctggagtc ctgggtctga ggg 23

<210> SEQ ID NO 1909
<211> LENGTH: 23
<212> TYPE: DNA
<213> ORGANISM: Homo sapiens

<400> SEQUENCE: 1909 gggcccagac tttggggtcc ggg 23

<210> SEQ ID NO 1910
<211> LENGTH: 23
<212> TYPE: DNA
<213> ORGANISM: Homo sapiens

<400> SEQUENCE: 1910 gtcctggggc ctgcattcct ggg 23

<210> SEQ ID NO 1911
<211> LENGTH: 23
<212> TYPE: DNA
<213> ORGANISM: Homo sapiens

<400> SEQUENCE: 1911 ccctcagacc caggattccc ggg 23

<210> SEQ ID NO 1912
<211> LENGTH: 23
<212> TYPE: DNA
<213> ORGANISM: Homo sapiens

<400> SEQUENCE: 1912 tcccaggaat cctgggtctg agg 23

<210> SEQ ID NO 1913
<211> LENGTH: 23
<212> TYPE: DNA
<213> ORGANISM: Homo sapiens

<400> SEQUENCE: 1913 ggacctccgc cctcagaccc agg 23

<210> SEQ ID NO 1914
<211> LENGTH: 23
<212> TYPE: DNA
<213> ORGANISM: Homo sapiens

<400> SEQUENCE: 1914 cctctcctcc ttcagaccca ggg 23

<210> SEQ ID NO 1915
<211> LENGTH: 23
<212> TYPE: DNA
<213> ORGANISM: Homo sapiens

<400> SEQUENCE: 1915 aggaatcctg ggtctgaggg agg 23

<210> SEQ ID NO 1916
<211> LENGTH: 23
<212> TYPE: DNA
<213> ORGANISM: Homo sapiens

<400> SEQUENCE: 1916 aactccaggt ttccagcccc tgg 23

<210> SEQ ID NO 1917
<211> LENGTH: 23
<212> TYPE: DNA
<213> ORGANISM: Homo sapiens

<400> SEQUENCE: 1917 gtctgaggga ggaggtactg ggg 23

<210> SEQ ID NO 1918
<211> LENGTH: 23
<212> TYPE: DNA
<213> ORGANISM: Homo sapiens

<400> SEQUENCE: 1918 ggactgctgg atcaggaagg agg 23

<210> SEQ ID NO 1919
<211> LENGTH: 23
<212> TYPE: DNA
<213> ORGANISM: Homo sapiens

<400> SEQUENCE: 1919 gctcctgggt ctgagggcgg agg 23

<210> SEQ ID NO 1920
<211> LENGTH: 23
<212> TYPE: DNA
<213> ORGANISM: Homo sapiens

<400> SEQUENCE: 1920 ctttggggtc cgggagctga tgg 23

<210> SEQ ID NO 1921
<211> LENGTH: 23
<212> TYPE: DNA
<213> ORGANISM: Homo sapiens

<400> SEQUENCE: 1921 cttcctggac ccaggactcc agg 23

<210> SEQ ID NO 1922
<211> LENGTH: 23
<212> TYPE: DNA
<213> ORGANISM: Homo sapiens

<400> SEQUENCE: 1922 caccccaggg gctggaaacc tgg 23

<210> SEQ ID NO 1923
<211> LENGTH: 23
<212> TYPE: DNA
<213> ORGANISM: Homo sapiens

<400> SEQUENCE: 1923 gcccgggaat cctgggtctg agg 23

<210> SEQ ID NO 1924
<211> LENGTH: 23
<212> TYPE: DNA
<213> ORGANISM: Homo sapiens

<400> SEQUENCE: 1924 gactgctgga tcaggaagga ggg 23

<210> SEQ ID NO 1925
<211> LENGTH: 23
<212> TYPE: DNA
<213> ORGANISM: Homo sapiens

<400> SEQUENCE: 1925 actcctgggt ccaggaagaa ggg 23

<210> SEQ ID NO 1926
<211> LENGTH: 23
<212> TYPE: DNA
<213> ORGANISM: Homo sapiens

<400> SEQUENCE: 1926 tccctcagac ccaggattcc tgg 23

<210> SEQ ID NO 1927
<211> LENGTH: 23
<212> TYPE: DNA
<213> ORGANISM: Homo sapiens

<400> SEQUENCE: 1927 tccctcagac ccaggattcc cgg 23

<210> SEQ ID NO 1928
<211> LENGTH: 23
<212> TYPE: DNA
<213> ORGANISM: Homo sapiens

<400> SEQUENCE: 1928 gggtctgagg gaggaggtac tgg 23

<210> SEQ ID NO 1929
<211> LENGTH: 23
<212> TYPE: DNA
<213> ORGANISM: Homo sapiens

<400> SEQUENCE: 1929 gggctgggtc ccaggaatcc tgg 23

<210> SEQ ID NO 1930
<211> LENGTH: 23
<212> TYPE: DNA
<213> ORGANISM: Homo sapiens

<400> SEQUENCE: 1930 gcctctcctc cttcagaccc agg 23

<210> SEQ ID NO 1931
<211> LENGTH: 23
<212> TYPE: DNA
<213> ORGANISM: Homo sapiens

<400> SEQUENCE: 1931 gccccaggaa tgcaggcccc agg 23

<210> SEQ ID NO 1932
<211> LENGTH: 23
<212> TYPE: DNA
<213> ORGANISM: Homo sapiens

<400> SEQUENCE: 1932 attcctgggg cggaggaggc ggg 23

<210> SEQ ID NO 1933
<211> LENGTH: 23
<212> TYPE: DNA
<213> ORGANISM: Homo sapiens

<400> SEQUENCE: 1933 gggaatcctg ggtctgaggg agg 23

<210> SEQ ID NO 1934
<211> LENGTH: 23
<212> TYPE: DNA
<213> ORGANISM: Homo sapiens

<400> SEQUENCE: 1934 gcctgggctc ctgggtctga ggg 23

<210> SEQ ID NO 1935
<211> LENGTH: 23
<212> TYPE: DNA
<213> ORGANISM: Homo sapiens

<400> SEQUENCE: 1935 gaggaggcgg gccgggcctc agg 23

<210> SEQ ID NO 1936
<211> LENGTH: 23
<212> TYPE: DNA
<213> ORGANISM: Homo sapiens

<400> SEQUENCE: 1936 ctggagtcct gggtccagga agg 23

<210> SEQ ID NO 1937
<211> LENGTH: 23
<212> TYPE: DNA
<213> ORGANISM: Homo sapiens

<400> SEQUENCE: 1937 ctctcctcct tcagacccag ggg 23

<210> SEQ ID NO 1938
<211> LENGTH: 23
<212> TYPE: DNA
<213> ORGANISM: Homo sapiens

<400> SEQUENCE: 1938 ccctcagacc caggattcct ggg 23

<210> SEQ ID NO 1939
<211> LENGTH: 23
<212> TYPE: DNA
<213> ORGANISM: Homo sapiens

<400> SEQUENCE: 1939 caggtttcca gcccctgggg tgg 23

<210> SEQ ID NO 1940
<211> LENGTH: 23
<212> TYPE: DNA
<213> ORGANISM: Homo sapiens

<400> SEQUENCE: 1940 tggagtcctg ggtctgaggg agg 23

<210> SEQ ID NO 1941
<211> LENGTH: 23
<212> TYPE: DNA
<213> ORGANISM: Homo sapiens

<400> SEQUENCE: 1941 tgcgggcgga gccgggagag agg 23

<210> SEQ ID NO 1942
<211> LENGTH: 23
<212> TYPE: DNA
<213> ORGANISM: Homo sapiens

<400> SEQUENCE: 1942 gggctggaaa cctggagttc agg 23

<210> SEQ ID NO 1943
<211> LENGTH: 23
<212> TYPE: DNA
<213> ORGANISM: Homo sapiens

<400> SEQUENCE: 1943 ctccaggttt ccagcccctg ggg 23

<210> SEQ ID NO 1944
<211> LENGTH: 23
<212> TYPE: DNA
<213> ORGANISM: Homo sapiens

<400> SEQUENCE: 1944 cggcccgcct cctccgcccc agg 23

<210> SEQ ID NO 1945
<211> LENGTH: 23
<212> TYPE: DNA
<213> ORGANISM: Homo sapiens

<400> SEQUENCE: 1945 cgggcggagc cgggagagag ggg 23

<210> SEQ ID NO 1946
<211> LENGTH: 23
<212> TYPE: DNA
<213> ORGANISM: Homo sapiens

<400> SEQUENCE: 1946 aactcctggg tccaggaaga agg 23

<210> SEQ ID NO 1947
<211> LENGTH: 23
<212> TYPE: DNA
<213> ORGANISM: Homo sapiens

<400> SEQUENCE: 1947 tggggcggag gaggcgggcc ggg 23

<210> SEQ ID NO 1948
<211> LENGTH: 23
<212> TYPE: DNA
<213> ORGANISM: Homo sapiens

<400> SEQUENCE: 1948 tccctcagac ccaggactcc agg 23

<210> SEQ ID NO 1949
<211> LENGTH: 23
<212> TYPE: DNA
<213> ORGANISM: Homo sapiens

<400> SEQUENCE: 1949 agccccttct tcctggaccc agg 23

<210> SEQ ID NO 1950
<211> LENGTH: 23
<212> TYPE: DNA
<213> ORGANISM: Homo sapiens

<400> SEQUENCE: 1950 actcctggat ctgagggagg agg 23

<210> SEQ ID NO 1951
<211> LENGTH: 23
<212> TYPE: DNA
<213> ORGANISM: Homo sapiens

<400> SEQUENCE: 1951 gcccctcctc cctcagatcc agg 23

<210> SEQ ID NO 1952
<211> LENGTH: 23
<212> TYPE: DNA
<213> ORGANISM: Homo sapiens

<400> SEQUENCE: 1952 aggcttcaac tcctgggtcc agg 23

<210> SEQ ID NO 1953
<211> LENGTH: 23
<212> TYPE: DNA
<213> ORGANISM: Homo sapiens

<400> SEQUENCE: 1953 actgctggat caggaaggag ggg 23

<210> SEQ ID NO 1954
<211> LENGTH: 23
<212> TYPE: DNA
<213> ORGANISM: Homo sapiens

<400> SEQUENCE: 1954 tgggctcctg ggtctgaggg cgg 23

<210> SEQ ID NO 1955
<211> LENGTH: 23
<212> TYPE: DNA
<213> ORGANISM: Homo sapiens

<400> SEQUENCE: 1955 tcctggggcc tgcattcctg ggg 23

<210> SEQ ID NO 1956
<211> LENGTH: 23
<212> TYPE: DNA
<213> ORGANISM: Homo sapiens

<400> SEQUENCE: 1956 gtacctcctc cctcagaccc agg 23

<210> SEQ ID NO 1957
<211> LENGTH: 23
<212> TYPE: DNA
<213> ORGANISM: Homo sapiens

<400> SEQUENCE: 1957 tgggtccagg aagaaggggc tgg 23

<210> SEQ ID NO 1958
<211> LENGTH: 23
<212> TYPE: DNA
<213> ORGANISM: Homo sapiens

<400> SEQUENCE: 1958 ctggatcagg aaggaggggc tgg 23

<210> SEQ ID NO 1959
<211> LENGTH: 23
<212> TYPE: DNA
<213> ORGANISM: Homo sapiens

<400> SEQUENCE: 1959 ctcctgggtc caggaagaag ggg 23

<210> SEQ ID NO 1960
<211> LENGTH: 23
<212> TYPE: DNA
<213> ORGANISM: Homo sapiens

<400> SEQUENCE: 1960 ctcctggatc tgagggagga ggg 23

<210> SEQ ID NO 1961
<211> LENGTH: 23
<212> TYPE: DNA
<213> ORGANISM: Homo sapiens

<400> SEQUENCE: 1961 cattcctggg gcggaggagg cgg 23

<210> SEQ ID NO 1962
<211> LENGTH: 23
<212> TYPE: DNA
<213> ORGANISM: Homo sapiens

<400> SEQUENCE: 1962 gtcatcagct gggaaggtga ggg 23

<210> SEQ ID NO 1963
<211> LENGTH: 23
<212> TYPE: DNA
<213> ORGANISM: Homo sapiens

<400> SEQUENCE: 1963 ctggggcgga ggaggcgggc cgg 23

<210> SEQ ID NO 1964
<211> LENGTH: 23
<212> TYPE: DNA
<213> ORGANISM: Homo sapiens

<400> SEQUENCE: 1964 agggaggagg tactggggcc cgg 23

<210> SEQ ID NO 1965
<211> LENGTH: 23
<212> TYPE: DNA

<213> ORGANISM: Homo sapiens

<400> SEQUENCE: 1965 actccaggtt tccagcccct ggg 23

<210> SEQ ID NO 1966
<211> LENGTH: 23
<212> TYPE: DNA
<213> ORGANISM: Homo sapiens

<400> SEQUENCE: 1966 tggatcagga aggaggggct ggg 23

<210> SEQ ID NO 1967
<211> LENGTH: 23
<212> TYPE: DNA
<213> ORGANISM: Homo sapiens

<400> SEQUENCE: 1967 gggaggaggt actggggccc ggg 23

<210> SEQ ID NO 1968
<211> LENGTH: 23
<212> TYPE: DNA
<213> ORGANISM: Homo sapiens

<400> SEQUENCE: 1968 gccctcagac ccaggagccc agg 23

<210> SEQ ID NO 1969
<211> LENGTH: 23
<212> TYPE: DNA
<213> ORGANISM: Homo sapiens

<400> SEQUENCE: 1969 ccctgggtct gaaggaggag agg 23

<210> SEQ ID NO 1970
<211> LENGTH: 23
<212> TYPE: DNA
<213> ORGANISM: Homo sapiens

<400> SEQUENCE: 1970 agtcctgggt ccaggaagga ggg 23

<210> SEQ ID NO 1971
<211> LENGTH: 23
<212> TYPE: DNA
<213> ORGANISM: Homo sapiens

<400> SEQUENCE: 1971 atcctgggtc tgagggagga ggg 23

<210> SEQ ID NO 1972
<211> LENGTH: 23
<212> TYPE: DNA
<213> ORGANISM: Homo sapiens

<400> SEQUENCE: 1972 agcccctcct tcctggaccc agg 23

<210> SEQ ID NO 1973
<211> LENGTH: 23

<212> TYPE: DNA
<213> ORGANISM: Homo sapiens

<400> SEQUENCE: 1973 aatcctgggt ctgagggagg agg 23

<210> SEQ ID NO 1974
<211> LENGTH: 23
<212> TYPE: DNA
<213> ORGANISM: Homo sapiens

<400> SEQUENCE: 1974 aaggtgaggg ccctgaggcc cgg 23

<210> SEQ ID NO 1975
<211> LENGTH: 23
<212> TYPE: DNA
<213> ORGANISM: Homo sapiens

<400> SEQUENCE: 1975 gtcctgggtc caggaaggag ggg 23

<210> SEQ ID NO 1976
<211> LENGTH: 23
<212> TYPE: DNA
<213> ORGANISM: Homo sapiens

<400> SEQUENCE: 1976 ggtctgaagg aggagaggct ggg 23

<210> SEQ ID NO 1977
<211> LENGTH: 23
<212> TYPE: DNA
<213> ORGANISM: Homo sapiens

<400> SEQUENCE: 1977 gggtccagga agaaggggct ggg 23

<210> SEQ ID NO 1978
<211> LENGTH: 23
<212> TYPE: DNA
<213> ORGANISM: Homo sapiens

<400> SEQUENCE: 1978 aggccccagc cccttcttcc tgg 23

<210> SEQ ID NO 1979
<211> LENGTH: 23
<212> TYPE: DNA
<213> ORGANISM: Homo sapiens

<400> SEQUENCE: 1979 ggctgggggc ctggagtcct ggg 23

<210> SEQ ID NO 1980
<211> LENGTH: 23
<212> TYPE: DNA
<213> ORGANISM: Homo sapiens

<400> SEQUENCE: 1980 ggcctggagt cctgggtctg agg 23

<210> SEQ ID NO 1981

<211> LENGTH: 23
<212> TYPE: DNA
<213> ORGANISM: Homo sapiens

<400> SEQUENCE: 1981 agtcctgggt ctgagggagg agg 23

<210> SEQ ID NO 1982
<211> LENGTH: 23
<212> TYPE: DNA
<213> ORGANISM: Homo sapiens

<400> SEQUENCE: 1982 tgggtccagg aaggaggggc tgg 23

<210> SEQ ID NO 1983
<211> LENGTH: 23
<212> TYPE: DNA
<213> ORGANISM: Homo sapiens

<400> SEQUENCE: 1983 tggggcctgc attcctgggg cgg 23

<210> SEQ ID NO 1984
<211> LENGTH: 23
<212> TYPE: DNA
<213> ORGANISM: Homo sapiens

<400> SEQUENCE: 1984 ggtccaggaa gaaggggctg ggg 23

<210> SEQ ID NO 1985
<211> LENGTH: 23
<212> TYPE: DNA
<213> ORGANISM: Homo sapiens

<400> SEQUENCE: 1985 gggctggggg cctggagtcc tgg 23

<210> SEQ ID NO 1986
<211> LENGTH: 23
<212> TYPE: DNA
<213> ORGANISM: Homo sapiens

<400> SEQUENCE: 1986 ggcctgggct cctgggtctg agg 23

<210> SEQ ID NO 1987
<211> LENGTH: 23
<212> TYPE: DNA
<213> ORGANISM: Homo sapiens

<400> SEQUENCE: 1987 tctgaaggag gagaggctgg ggg 23

<210> SEQ ID NO 1988
<211> LENGTH: 23
<212> TYPE: DNA
<213> ORGANISM: Homo sapiens

<400> SEQUENCE: 1988 ggggctgggg cctggactgc tgg 23

<210> SEQ ID NO 1989
<211> LENGTH: 23
<212> TYPE: DNA
<213> ORGANISM: Homo sapiens

<400> SEQUENCE: 1989 gatctgaggg aggaggggct ggg 23

<210> SEQ ID NO 1990
<211> LENGTH: 23
<212> TYPE: DNA
<213> ORGANISM: Homo sapiens

<400> SEQUENCE: 1990 gtctgaagga ggagaggctg ggg 23

<210> SEQ ID NO 1991
<211> LENGTH: 23
<212> TYPE: DNA
<213> ORGANISM: Homo sapiens

<400> SEQUENCE: 1991 gggtctgaag gaggagaggc tgg 23

<210> SEQ ID NO 1992
<211> LENGTH: 23
<212> TYPE: DNA
<213> ORGANISM: Homo sapiens

<400> SEQUENCE: 1992 gggcctggag tcctgggtcc agg 23

<210> SEQ ID NO 1993
<211> LENGTH: 23
<212> TYPE: DNA
<213> ORGANISM: Homo sapiens

<400> SEQUENCE: 1993 ggctgggggc ctgggctcct ggg 23

<210> SEQ ID NO 1994
<211> LENGTH: 23
<212> TYPE: DNA
<213> ORGANISM: Homo sapiens

<400> SEQUENCE: 1994 gagtcctggg tccaggaagg agg 23

<210> SEQ ID NO 1995
<211> LENGTH: 23
<212> TYPE: DNA
<213> ORGANISM: Homo sapiens

<400> SEQUENCE: 1995 tcctggatct gagggaggag ggg 23

<210> SEQ ID NO 1996
<211> LENGTH: 23
<212> TYPE: DNA
<213> ORGANISM: Homo sapiens

<400> SEQUENCE: 1996 gggtccagga aggaggggct ggg 23

<210> SEQ ID NO 1997
<211> LENGTH: 23
<212> TYPE: DNA
<213> ORGANISM: Homo sapiens

<400> SEQUENCE: 1997 gggaggaggg gctgggtccc agg 23

<210> SEQ ID NO 1998
<211> LENGTH: 23
<212> TYPE: DNA
<213> ORGANISM: Homo sapiens

<400> SEQUENCE: 1998 tctgagggag gaggggctgc agg 23

<210> SEQ ID NO 1999
<211> LENGTH: 23
<212> TYPE: DNA
<213> ORGANISM: Homo sapiens

<400> SEQUENCE: 1999 ggaggagagg ctgggggcct ggg 23

<210> SEQ ID NO 2000
<211> LENGTH: 23
<212> TYPE: DNA
<213> ORGANISM: Homo sapiens

<400> SEQUENCE: 2000 gatcaggaag gaggggctgg ggg 23

<210> SEQ ID NO 2001
<211> LENGTH: 23
<212> TYPE: DNA
<213> ORGANISM: Homo sapiens

<400> SEQUENCE: 2001 ctgggaaggt gagggccctg agg 23

<210> SEQ ID NO 2002
<211> LENGTH: 23
<212> TYPE: DNA
<213> ORGANISM: Homo sapiens

<400> SEQUENCE: 2002 aggaggagag gctgggggcc tgg 23

<210> SEQ ID NO 2003
<211> LENGTH: 23
<212> TYPE: DNA
<213> ORGANISM: Homo sapiens

<400> SEQUENCE: 2003 ggtccaggaa ggaggggctg ggg 23

<210> SEQ ID NO 2004
<211> LENGTH: 23
<212> TYPE: DNA
<213> ORGANISM: Homo sapiens

<400> SEQUENCE: 2004 aggctggggg cctgggctcc tgg 23

<210> SEQ ID NO 2005
<211> LENGTH: 23
<212> TYPE: DNA
<213> ORGANISM: Homo sapiens

<400> SEQUENCE: 2005 gtccaggaag gaggggctgg ggg 23

<210> SEQ ID NO 2006
<211> LENGTH: 23
<212> TYPE: DNA
<213> ORGANISM: Homo sapiens

<400> SEQUENCE: 2006 ggcccccagc ccctccttcc tgg 23

<210> SEQ ID NO 2007
<211> LENGTH: 23
<212> TYPE: DNA
<213> ORGANISM: Homo sapiens

<400> SEQUENCE: 2007 gctcctcctc cctcagaccc agg 23

<210> SEQ ID NO 2008
<211> LENGTH: 23
<212> TYPE: DNA
<213> ORGANISM: Homo sapiens

<400> SEQUENCE: 2008 tctgagggag gaggagctgg agg 23

<210> SEQ ID NO 2009
<211> LENGTH: 23
<212> TYPE: DNA
<213> ORGANISM: Homo sapiens

<400> SEQUENCE: 2009 ggatcaggaa ggaggggctg ggg 23

<210> SEQ ID NO 2010
<211> LENGTH: 23
<212> TYPE: DNA
<213> ORGANISM: Homo sapiens

<400> SEQUENCE: 2010 ggaaggaggg gctgggggcc tgg 23

<210> SEQ ID NO 2011
<211> LENGTH: 23
<212> TYPE: DNA
<213> ORGANISM: Homo sapiens

<400> SEQUENCE: 2011 gcccctcctc cctcagaccc agg 23

<210> SEQ ID NO 2012
<211> LENGTH: 23
<212> TYPE: DNA
<213> ORGANISM: Homo sapiens

<400> SEQUENCE: 2012 tcctgggtct gagggaggag ggg 23

<210> SEQ ID NO 2013
<211> LENGTH: 23
<212> TYPE: DNA
<213> ORGANISM: Homo sapiens

<400> SEQUENCE: 2013 gggtctgagg gaggaggagc tgg 23

<210> SEQ ID NO 2014
<211> LENGTH: 23
<212> TYPE: DNA
<213> ORGANISM: Homo sapiens

<400> SEQUENCE: 2014 ggatctgagg gaggaggggc tgg 23

<210> SEQ ID NO 2015
<211> LENGTH: 23
<212> TYPE: DNA
<213> ORGANISM: Homo sapiens

<400> SEQUENCE: 2015 aggaagaagg ggctggggcc tgg 23

<210> SEQ ID NO 2016
<211> LENGTH: 20
<212> TYPE: DNA
<213> ORGANISM: Artificial Sequence
<220> FEATURE:
<223> OTHER INFORMATION: primer

<400> SEQUENCE: 2016 ctccatcgga gaaggacagc 20

<210> SEQ ID NO 2017
<211> LENGTH: 22
<212> TYPE: DNA
<213> ORGANISM: Artificial Sequence
<220> FEATURE:
<223> OTHER INFORMATION: primer

<400> SEQUENCE: 2017 aggtcctgaa agtccattgt cc 22

<210> SEQ ID NO 2018
<211> LENGTH: 120
<212> TYPE: DNA
<213> ORGANISM: Mus musculus

<400> SEQUENCE: 2018 aaaaaggcag ggtcaacctt ttcctcagct ccacggagag tgcccaccat ggtcctgtcg 60 ctgatactcc agctgtcgac tctctgtgag ctgtccctcc cctgtgtgtg gatccttggc 120

<210> SEQ ID NO 2019
<211> LENGTH: 120
<212> TYPE: DNA
<213> ORGANISM: Mus musculus

<400> SEQUENCE: 2019 gccaaggatc cacacacagg ggagggacag ctcacagaga gtcgacagct ggagtatcag 60 cgacaggacc atggtgggca ctctccgtgg agctgaggaa aaggttgacc ctgccttttt 120

<210> SEQ ID NO 2020
<211> LENGTH: 146
<212> TYPE: DNA
<213> ORGANISM: Mus musculus

<400> SEQUENCE: 2020 gccaaggatc cacacacagg ggagggacag ctcacagaga gtcgacagct ggagtatcag 60 cctcagaaga actcgtcaag aagtcacgac aggaccatgg tgggcactct ccgtggagct 120 gaggaaaagg ttgaccctgc cttttt 146

<210> SEQ ID NO 2021
<211> LENGTH: 120
<212> TYPE: DNA
<213> ORGANISM: Mus musculus

<400> SEQUENCE: 2021 acctttttcct cagctccacg gagagtgccc accatggtcc tgtcgctgat actccagctg 60 tcgactctct gtgagctgtc cctcccctgt gtgtggatcc ttggctgggc tgagggctat 120

<210> SEQ ID NO 2022
<211> LENGTH: 120
<212> TYPE: DNA
<213> ORGANISM: Mus musculus

<400> SEQUENCE: 2022 atagccctca gcccagccaa ggatccacac acaggggagg gacagctcac agagagtcga 60 cagctggagt atcagcgaca ggaccatggt gggcactctc cgtggagctg aggaaaaggt 120

<210> SEQ ID NO 2023
<211> LENGTH: 146
<212> TYPE: DNA
<213> ORGANISM: Mus musculus

<400> SEQUENCE: 2023 atagccctca gcccagccaa ggatccacac acaggggagg gacagctcac agagagtcga 60 cctcagaaga actcgtcaag aagtcacagc tggagtatca gcgacaggac catggtgggc 120 actctccgtg gagctgagga aaaggt 146

<210> SEQ ID NO 2024
<211> LENGTH: 58
<212> TYPE: DNA
<213> ORGANISM: Mus musculus

<400> SEQUENCE: 2024 atggtcctgt cgtgacttct tgagagttct actgaggctg atactccagc tgtcgact 58

<210> SEQ ID NO 2025
<211> LENGTH: 59
<212> TYPE: DNA
<213> ORGANISM: Mus musculus

<400> SEQUENCE: 2025 atggtcctgt cgctgatact ccagctgtga cttcttgacg agttcttctg aggtcgact 59

<210> SEQ ID NO 2026
<211> LENGTH: 12
<212> TYPE: PRT
<213> ORGANISM: Mus musculus -continued

```
<400> SEQUENCE: 2026

Met Val Leu Ser Leu Ile Leu Gln Leu Ser Thr Leu
1               5                   10


<210> SEQ ID NO 2027
<211> LENGTH: 4
<212> TYPE: PRT
<213> ORGANISM: Mus musculus

<400> SEQUENCE: 2027

Met Val Leu Ser
1


<210> SEQ ID NO 2028
<211> LENGTH: 9
<212> TYPE: PRT
<213> ORGANISM: Mus musculus

<400> SEQUENCE: 2028

Met Val Leu Ser Leu Ile Leu Gln Leu
1               5
```

The invention claimed is:

1. A method of suppressing expression of FGF23 induced by phosphorus overload, comprising:

administering a therapeutically-effective amount of (i) a soluble human Oscar-Fc fusion protein comprising the amino acid sequence of SEQ ID NO:2, or (ii) a soluble human Oscar-Fc fusion protein comprising the amino acid sequence of SEQ ID NO: 2 except that one to three amino acids are substituted, deleted, or inserted, to a human during phosphorus overload, wherein expression of FGF23 is suppressed.

* * * * *